US007885554B2

(12) United States Patent
Shirokoshi et al.

(10) Patent No.: US 7,885,554 B2
(45) Date of Patent: Feb. 8, 2011

(54) DEVELOPING DEVICE, IMAGE FORMING APPARATUS, IMAGE FORMING SYSTEM, CARTRIDGE, DEVELOPING UNIT AND PHOTOCONDUCTOR UNIT

(75) Inventors: Junji Shirokoshi, Nagano-ken (JP); Katsumi Okamoto, Azumino (JP); Yuichi Segawa, Shiojiri (JP); Satoru Miyamoto, Matsumoto (JP); Yoichi Yamada, Shiojiri (JP); Yasushige Hori, Matsumoto (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 987 days.

(21) Appl. No.: 11/574,647

(22) PCT Filed: Dec. 1, 2005

(86) PCT No.: PCT/JP2005/022093

§ 371 (c)(1),
(2), (4) Date: Mar. 2, 2007

(87) PCT Pub. No.: WO2006/062026

PCT Pub. Date: Jun. 15, 2006

(65) Prior Publication Data

US 2008/0267666 A1 Oct. 30, 2008

(30) Foreign Application Priority Data

| | | |
|---|---|---|
| Dec. 9, 2004 | (JP) | 2004-356874 |
| Jan. 20, 2005 | (JP) | 2005-012406 |
| Jan. 20, 2005 | (JP) | 2005-012420 |
| Jan. 24, 2005 | (JP) | 2005-015462 |
| Jan. 24, 2005 | (JP) | 2005-015463 |
| Jan. 28, 2005 | (JP) | 2005-021335 |
| Feb. 18, 2005 | (JP) | 2005-042898 |
| Feb. 23, 2005 | (JP) | 2005-047729 |
| Feb. 23, 2005 | (JP) | 2005-047730 |
| Mar. 16, 2005 | (JP) | 2005-074680 |
| Mar. 31, 2005 | (JP) | 2005-103418 |
| Nov. 29, 2005 | (JP) | 2005-344567 |
| Nov. 29, 2005 | (JP) | 2005-344568 |
| Nov. 30, 2005 | (JP) | 2005-344910 |

(51) Int. Cl.
*G03G 15/00* (2006.01)

(52) U.S. Cl. ..... 399/12; 399/83; 399/222; 399/226; 399/227

(58) Field of Classification Search ..... 399/83, 399/222, 226, 227
See application file for complete search history.

(56) References Cited

U.S. PATENT DOCUMENTS 6,032,002 A * 2/2000 Yokomori et al. ..... 399/12

(Continued)

FOREIGN PATENT DOCUMENTS

JP 10-221938 8/1998

(Continued)

*Primary Examiner*—David Gray
*Assistant Examiner*—Ryan D Walsh
(74) *Attorney, Agent, or Firm*—Hogan Lovells US LLP

(57) ABSTRACT

A developing device that can be mounted to and dismounted from a mounting and dismounting section provided in an image forming apparatus main unit, the developing device includes: a developing device main unit; a positioning member for positioning the developing device main unit with respect to the mounting and dismounting section by engaging the mounting and dismounting section when the developing device is mounted to the mounting and dismounting section, the positioning member being fixed on a one end side in a longitudinal direction of the developing device main unit; a coupling member that is to be coupled to the mounting and dismounting section when the developing device is mounted to the mounting and dismounting section, the coupling member being attached to the other end side in the longitudinal direction of the developing device main unit in such a manner that its relative position to the developing device main unit can be changed; and an element capable of communication in a noncontacting manner with the image forming apparatus main unit side when the developing device is mounted to the mounting and dismounting section, the element being provided at the one end side in the longitudinal direction of the developing device main unit.

91 Claims, 114 Drawing Sheets

U.S. PATENT DOCUMENTS

| | | | |
|---|---|---|---|
| 6,438,327 | B1 | 8/2002 | Kimizuka et al. |
| 6,859,626 | B2 | 2/2005 | Kimizuka et al. |
| 2003/0002880 | A1 | 1/2003 | Kimizuka et al. |

FOREIGN PATENT DOCUMENTS

| | | | |
|---|---|---|---|
| JP | 11-348375 | | 12/1999 |
| JP | 2001100617 | A | 4/2001 |
| JP | 2001-215861 | | 8/2001 |
| JP | 2002-062784 | | 2/2002 |
| JP | 2002049206 | A | 2/2002 |
| JP | 2002333756 | A | 11/2002 |
| JP | 2002351193 | A | 12/2002 |
| JP | 2003029494 | A | 1/2003 |
| JP | 2003-098789 | | 4/2003 |
| JP | 2003-195725 | | 7/2003 |
| JP | 2003-195730 | | 7/2003 |
| JP | 2003-241463 | | 8/2003 |
| JP | 2003255697 | A | 9/2003 |
| JP | 2003295570 | A | 10/2003 |
| JP | 2005-266298 | | 9/2005 |
| WO | WO 03/087952 | A1 | 10/2003 |
| WO | WO 03/087953 | A1 | 10/2003 |
| WO | WO 03/098355 | A1 | 11/2003 |
| WO | WO 03/098356 | A1 | 11/2003 |

* cited by examiner

| address | information content (8 bit) |
|---|---|
| 00H | ID information |
| 01H | manufacturing date |
| 02H | destination |
| 03H | manufacturing line |
| 04H | compatible models |
| 05H | remaining toner amount |
| ⋮ | ⋮ |

Fig.14

| address | information content (8 bit) |
|---|---|
| 00H | ID information |
| 01H | manufacturing date |
| 02H | destination |
| 03H | manufacturing line |
| 04H | compatible models |
| 05H | remaining toner amount |
| ⋮ | ⋮ |

| address | information content (8 bit) |
|---|---|
| 00H | ID information |
| 01H | manufacturing date |
| 02H | destination |
| 03H | manufacturing line |
| 04H | compatible models |
| 05H | remaining toner amount |
| ⋮ | ⋮ |

| address | information content (8 bit) |
|---|---|
| 00H | ID information |
| 01H | manufacturing date |
| 02H | destination |
| 03H | manufacturing line |
| 04H | compatible models |
| 05H | remaining toner amount |
| ⋮ | ⋮ |

DEVELOPING DEVICE, IMAGE FORMING APPARATUS, IMAGE FORMING SYSTEM, CARTRIDGE, DEVELOPING UNIT AND PHOTOCONDUCTOR UNIT

TECHNICAL FIELD

The present invention relates to developing devices, image forming apparatuses, image forming systems, cartridges, developing units and photoconductor units.

BACKGROUND ART

Image forming apparatuses such as laser beam printers are well known. Such image forming apparatuses include, for example, an image bearing member for bearing a latent image, and a developing device for developing the latent image borne on the image bearing member with a developer, wherein the developing device can be mounted to and dismounted from a mounting and dismounting section provided in the image forming apparatus main unit. When an image signal or the like is sent from an external device, such as a host computer, to this image forming apparatus, the developing device is positioned at the developing position opposite to the image bearing member, a developer image is formed by developing the latent image borne on the image bearing member with the developer inside the developing device, and an image is ultimately formed on the medium by transferring this developer image onto the medium.

Such a developing device has a positioning member for positioning a developing device main unit with respect to the mounting and dismounting section by engaging with the mounting and dismounting section when being mounted to the mounting and dismounting section. This positioning member is fixed to one end, with respect to the longitudinal direction, of the developing device main unit. Moreover, the developing device includes an element that can communicate in a noncontacting manner with the image forming apparatus main unit side when the developing device is mounted to the mounting and dismounting section.

Furthermore, there are developing devices that have a coupling member that is attached to the other end, in longitudinal direction, of the developing device main unit and that is coupled to the mounting and dismounting section when the developing device is mounted to the mounting and dismounting section. This coupling member is attached in such a manner that its relative position to the developing device main unit can be changed, for the purpose of setting the spacing between the image bearing member and the developing device when the developing device develops the latent image borne on the image bearing member to a desired spacing, even when the image bearing member is attached in a slanted manner with respect to the image forming apparatus main unit (see publication of WO 03/098355).

Now, in this developing device, the coupling member that is coupled to the mounting and dismounting section when the developing device is mounted to the mounting and dismounting section is attached to the developing device main unit in such a manner that its relative position to the developing device main unit is variable, so that depending on the position where the element is attached to the developing device main unit, there is the possibility that the distance between the element and the image forming apparatus main unit changes considerably as this relative position changes. In this case, there is the risk that the element cannot communicate properly with the image forming apparatus main unit side.

Also, image forming apparatuses that make recordings by electrophotography, in which an electrostatic latent image on the surface of a carrying member fabricated by a photoconductor is exposed and formed, are known, and in such image forming apparatuses, the toner image on the surface of the carrying member, obtained by developing this electrostatic latent image with toner, is transferred to a recording medium, such as recording paper, to accomplish image formation. This toner image is developed with toner by rotating a developing roller facing the surface of the carrying member and letting toner on the outer circumferential surface of that roller selectively transfer to the electrostatic latent image on the surface of the carrying member and adhere to it.

Among such image forming apparatuses employing recording by electrophotography, there are also apparatuses configured such that developing cartridges (developing containers), which include not only the developing roller facing the carrying member but also a container containing the toner, can be mounted removably, and a plurality of such developing cartridges can be accommodated in a developing rotary unit. In such an image forming apparatus, the developing cartridge at the developing position in which the developing roller faces the carrying member can be switched by rotating this developing rotary unit around a rotation shaft.

Thus, by devising such an image forming apparatus such that developing cartridges containing yellow (Y), magenta (M), cyan (C) and black (K) toner, respectively, serving as the developing cartridges adhering toner to the carrying member surface can be accommodated by (mounted to) the developing rotary unit, it is possible to form a color image in which toner of various colors is superimposed on each other by successively switching the developing cartridges. Needless to say, with this configuration, it is also possible to form a single-color image with toner of one color, for example a black-and-white monochrome image (referred to simply as monochrome image in the following) obtained with black (K) toner.

Here, in such an image forming apparatus, toner development is performed while both the carrying member and the developing roller rotate, so that it is difficult to transfer all of the toner on the circumferential surface of the developing roller to the carrying member or recover it inside the developing cartridge. Therefore, since the toner is a fine powder, it may scatter/drift from the developing position facing the carrying member to the surroundings and accumulate, and that it pollutes the recording paper or the like. For this reason, there are cases in which image forming apparatuses employing electrophotography are provided with an exhaust duct that provides suction in the vicinity of this developing position and exhausts.

Moreover, with an image forming apparatus provided with such a developing rotary unit, it is possible to freely choose, for example, the toner color of each of a plurality of the developing cartridges individually, and since also the remaining toner amount differs, it has been proposed to place a memory (storage element) storing and holding various kinds of information on each developing cartridge (see for example Patent Document 1). In this case, by accessing the memories in the developing cartridges, it is possible to confirm the type of the developing cartridge by reading out the information in the memory, and to associate various kinds of information with the developing cartridges themselves, by rewriting for example the remaining amount of toner contained in them (see WO 03/098356).

However, in such image forming apparatuses, devices generating heat, such as a device exposing/forming the electrostatic latent image on the carrying member surface or the fixing device that fixes the toner image by applying pressure and heat to the recording paper onto which the toner image has been transferred, are arranged inside the apparatus main unit. Therefore, when the memories placed on the developing cartridges are subjected to this thermal influence, then there is the risk that the storage elements placed on the developing cartridges of this image forming apparatus are not only adversely affected, but in the worst case errors may occur during the reading and writing (rewriting) of storage information in those memories.

Furthermore, if the stored information is read out and written by communication in a noncontacting manner with the memories of the developing cartridges from the apparatus main unit side, then there is similarly not only the risk that a communication controller is adversely affected by the heat inside the apparatus main unit, but also that, in the worst case, the communication performance drops.

Moreover, it is necessary to establish a connection, to the memories on the outer surface of the rotating developing cartridges accommodated in the developing rotary unit, that allows the exchange of various kinds of information (signals).

On the other hand, as shown in FIG. 30(*a*), in this image forming apparatus, a suction opening 2161*a* of an exhaust duct 2160 provides suction near a developing position where a developing roller 2014*a* of a developing cartridge 2014 faces a carrying member 2012, but as shown in FIG. 30(*b*), there may be a case where the rotation of a developing rotary unit 2015 for switching the developing cartridge 2014 begins before all of the drifting toner t is sucked away, and the drifting toner t moves along the outer surface of the developing cartridge 2014 before it is sucked away. This problem becomes more significant the more the processing speed of the image formation increases, since the time for which the developing cartridge 2014 stops after the developing is finished becomes shorter.

Typically, a memory 2141 placed on the outer surface of this developing cartridge 2014 is placed in the middle with respect to the main scanning direction (the axial direction of the developing roller 2014*a*), as described in the above-noted Document 1. Moreover, the suction opening 2161 of the exhaust duct 2160 is formed such that it covers the entire axial length of the developing roller 2014*a* facing the carrying member 2012, so as to suck in the drifting toner t. Therefore, the memory 2141 on the outer surface of the developing cartridge 2014 is moved within a region where it comes into contact with the drifting toner t (the region where it passes near the suction opening 2161).

However, if the communication section communicating with the apparatus main unit side in order to exchange storage information inside the memory 2141 on the side of the developing cartridge 2014 is polluted through contact with drifting toner t, there is the risk of communication faults, regardless of whether this communication section is connected in a contacting manner or in a noncontacting manner. When accessing the memory 2141 in such a state of connection fault, there is the risk that errors occur in the reading or writing (rewriting) of the information stored in the memory 2141. Moreover, when the surface of the memory 2141 is polluted, then there is the possibility that for example the outer surface of the memory 2141 is adversely affected by adhering substances.

Moreover, devices generating heat during operation (heat sources) are placed inside the apparatus main unit, for example an exposing unit that forms the electrostatic latent image by exposing/scanning the carrying member surface is disposed in a lower part of the apparatus main unit. In the course of the faster speeds attained in recent years, the amount of heat generated by the exposing unit, which is a heat-generating member, has increased, and in the course of miniaturization the various parts of the apparatus are laid out at ever closer positions.

Therefore, if the developing cartridge is laid out such that it rotates at a position close to the exposing unit, then it may stop its rotation at a position facing this exposing unit. In this situation, when for example the memory on the outer surface of the developing cartridge or the communication controller is subjected to the thermal influence of the exposing unit, whose temperature has increased, then it is at least adversely affected, and in the worst case, there is the risk that errors may occur in the reading and writing (rewriting) of information stored in this memory, and the communication performance drops.

Also, image forming apparatuses that make recordings by electrophotography, in which an electrostatic latent image on the surface of a carrying member fabricated by a photoconductor is exposed and formed, are known, and in such image forming apparatuses, the toner image on the surface of the carrying member, obtained by developing this electrostatic latent image with toner, is transferred to a recording medium, such as recording paper, to accomplish image formation. This toner image is developed with toner by rotating a developing roller facing the surface of the carrying member and letting toner on the outer circumferential surface of that roller selectively transfer to the electrostatic latent image on the surface of the carrying member and adhere to it.

In such image forming apparatuses employing electrophotography, there are also apparatuses configured such that developing cartridges (developing containers), which include not only the developing roller facing the carrying member but also a container containing the toner, can be mounted removably, and a plurality of such developing cartridges can be accommodated in a developing rotary unit. In such an image forming apparatus, the developing cartridge at the developing position in which the developing roller faces the carrying member can be switched by rotating this developing rotary unit around a rotation shaft.

Thus, by devising such an image forming apparatus such that developing cartridges containing yellow (Y), magenta (M), cyan (C) and black (K) toner, respectively, serving as the developing cartridges adhering toner to the carrying member surface can be accommodated by (mounted to) the developing rotary unit, it is possible to form a color image in which toner of various colors is superimposed on each other by successively switching the developing cartridges. Needless to say, with this configuration, it is also possible to form a single-color image with toner of one color, for example a black-and-white monochrome image (referred to simply as monochrome image in the following) obtained with black (K) toner.

Moreover, with image forming apparatuses including such a developing rotary unit, it is possible to freely select for example the toner color of each of a plurality of the cartridges individually, and since also the remaining toner amount differs, it has been proposed to place a memory (storage element) storing and holding various kinds of information on each developing cartridge, and use the memory to read or write information stored in the memory by communication in a noncontacting manner via antennas (see publication of WO 03/098356). In this case, by accessing the memories in the developing cartridges, it is possible to confirm the type of the developing cartridge by reading out the information in the memories, and to associate various kinds of information with the developing cartridges themselves, by rewriting for example the remaining amount of toner contained in them.

However, in such conventional image forming apparatuses using recording by electrophotography, the toner is transferred using a potential difference, when developing the electrostatic latent image formed on the surface of the carrying member by adhering toner to it. Therefore, in this image forming apparatus, it is necessary to charge one or both of the members passing on or receiving the toner to a high voltage, and there is the possibility that noise is emitted during the charging or from the charged member. Therefore, when this noise unnecessarily enters for example an antenna performing communication in a noncontacting manner to rewrite the information stored in the memory placed on the developing cartridge, then there is the risk that the information stored in the memory is deleted or otherwise becomes inaccurate.

Moreover, image forming apparatuses such as laser beam printers are well known. Such image forming apparatus include, for example, a photoconductor for carrying a latent image, and a developing device that develops the latent image borne on the photoconductor by the developer and that can be mounted or dismounted with respect to the image forming apparatus main unit. When image signals or the like are sent from an external device, such as a host computer, the developing device is positioned in the developing position at which it faces the photoconductor, the latent image borne on the photoconductor is turned into a developer image by developing it with the developer inside the developing device, this developer image is transferred onto a medium, and finally an image is formed on the medium.

Moreover, there are developing devices including an element that can perform wireless communication with an antenna with which the image forming apparatus main unit is provided, facing that antenna across a gap in a state in which the developing device is mounted to the image forming apparatus main unit (see publication of WO 03/087952).

Now, when the element and the antenna perform wireless communication, electromagnetic waves are propagated through the gap between the element and the antenna. Therefore, when too much noise intrudes into this gap from the outside, suitable wireless communication is obstructed. Consequently, there is a need for a way to reduce the amount of noise intruding into that gap.

Moreover, as a cartridge mounted to a laser beam printer or the like serving as an image forming apparatus, a developing device containing a developer is known, for example. This developing device is provided with a memory unit for storing a toner consumption amount or a remaining toner amount, for example. This memory unit includes an IC memory and an antenna for communicating contactlessly with the printer main unit in a position in which it faces that antenna, which is provided on the main unit side, when the developing device is mounted to the printer main unit (see WO 03/098356). Moreover, in order to ensure favorable communication conditions between the memory unit and a communication unit, the memory unit is provided at an outer circumference of the cartridge, so as to come close to the communication unit.

Now, the developing device is mounted in the printer by passing it from outside the printer through a frame of the printer or the like. Since the frame of the printer needs to ensure rigidity and prevent the intrusion of light to the region near the photoconductive drum, also the opening for mounting the developing containers is formed slightly larger than the outer shape of the process cartridges. Therefore, when a developing device is held by a user or the like and mounted to the printer, the developing device is in an instable state until a portion of the developing device is supported by the printer, and there is the risk that the IC memory of the memory unit provided on the outer circumference of the developing device is damaged by inadvertently bumping it into the frame of the printer or the like. Therefore, there was the problem that the user, for example, has to insert the developing device carefully into the printer.

Moreover, as a cartridge mounted to a laser beam printer or the like serving as an image forming apparatus, a process cartridge provided with a photoconductive drum or a developing roller is known, for example. This process cartridge is provided with a memory unit for storing the time that the photoconductive drum has been used, for example. This memory unit includes an IC memory and an antenna for communicating contactlessly in a position in which it faces a communication unit provided on the main unit side when the process cartridge is mounted to the printer main unit (see JP-A-H11-348375).

In such an image forming apparatus, there is the problem that favorable communication is not possible when the memory unit and the communication unit are not arranged at suitable positions, in order to perform communication in a noncontacting manner between the memory unit and the communication unit.

Moreover, for example, a developing device mounted to a laser beam printer or the like is known as a developing device containing a developer. This developing container is provided with a memory unit for storing a toner consumption amount or a remaining toner amount, for example. This memory unit includes an IC memory and an antenna for communicating contactlessly with the printer main unit by electromagnetic induction, in a position in which it faces an antenna provided on the main unit side when the developing container is mounted to the printer main unit (see publication of WO 03/087952). Moreover, in order to ensure favorable communication conditions between the memory unit and a communication unit, the memory unit is provided at an outer circumference of the developing device containing the developer, so that the memory unit comes close to the communication unit.

As the developer used in the laser beam printer, there are developers in which a magnetic material, that is, a material having conductivity, is included, as in developers in which for example a non-magnetic toner and a magnetic carrier are mixed together. When such a developer including a magnetic material is contained inside the developing container, then there is a case where it contacts the inner circumferential surface at a position where the memory unit is provided on the outer circumference side, so that the magnetic material is contained there and the magnetic material adheres to this inner circumferential surface.

However, since the memory unit and the communication unit communicate by electromagnetic induction, when a magnetic material is present at the inner circumferential surface of the developing container where the memory unit is attached, then there is the problem that when the magnetic flux generated on one side passes through the magnetic material, eddy currents flow in the magnetic material with the magnetic flux at the axial center, the propagated waves are attenuated considerably, and communication may not be possible.

Moreover, as a cartridge mounted to a laser beam printer or the like serving as an image forming apparatus, process cartridges provided with a photoconductive drum or a developing roller are known, for example. Such a process cartridge is provided with a memory unit for storing the time that the photoconductive drum has been used, for example. This memory unit includes an element and an antenna for communicating contactlessly in a position in which it faces the communication antenna, which is provided on the printer side, when the process cartridge is mounted inside the printer (see JP-A-H11-348375).

In such an image forming apparatus, the outer circumference is covered by a cover or the like, and the temperature inside the apparatus increases due to heat generated by electric components during the image forming operation. At this time, also the temperature of the antenna for communication, which is provided on the printer side, may increase. In the above-described case, in which the memory unit communicates contactlessly with the printer, there is the problem that, depending on the antenna characteristics, there is the risk that favorable communication between the memory unit and the printer may not be possible when the temperature of the antenna provided on the printer side increases.

Moreover, image forming apparatuses such as laser beam printers are already well known. Such image forming apparatus include, for example, a photoconductor for carrying a latent image, and a developing unit that develops the latent image borne on the photoconductor with a developer and that can be mounted or dismounted with respect to the image forming apparatus main unit. When image signals or the like are sent from an external device, such as a host computer, the developing unit is positioned in the developing position at which it faces the photoconductor, the latent image borne on the photoconductor is turned into a developer image by developing it with the developer inside the developing unit, this developer image is transferred onto a medium, and finally an image is formed on the medium.

Moreover, among such developing units, there are developing units that have a memory unit including a memory, and onto which a label on which information relating to the developing unit is written is stuck (see publication of WO 03/098356).

Moreover, in determining where to attach the memory unit to the developing unit, the prevention of damage to the memory unit needs to be taken into consideration. Since the developing unit is mounted and dismounted by a user or the like, it is necessary to devise measures effectively preventing damage to the memory unit by the user touching the memory unit or the memory unit touching other parts of the image forming apparatus during the mounting or dismounting.

As an approach to solve this problem, the approach of embedding the memory unit in the developing unit and covering it with a lid is known. However in this case, it is necessary to provide a separate lid, so that the number of parts increases.

DISCLOSURE OF INVENTION

Accordingly, in view of the aforementioned problems, it is an object of the present invention to realize a developing device which can perform suitable communication with the image forming apparatus main unit side.

A main first invention for solving the above-noted problem is a developing device that can be mounted to and dismounted from a mounting and dismounting section provided in an image forming apparatus main unit, the developing device including: a developing device main unit; a positioning member for positioning the developing device main unit with respect to the mounting and dismounting section by engaging the mounting and dismounting section when the developing device is mounted to the mounting and dismounting section, the positioning member being fixed on a one end side in a longitudinal direction of the developing device main unit; a coupling member that is to be coupled to the mounting and dismounting section when the developing device is mounted to the mounting and dismounting section, the coupling member being attached to the other end side in the longitudinal direction of the developing device main unit in such a manner that its relative position to the developing device main unit can be changed; and an element capable of communication in a noncontacting manner with the image forming apparatus main unit side when the developing device is mounted to the mounting and dismounting section, the element being provided at the one end side in the longitudinal direction of the developing device main unit.

It is another object of the present invention to provide an image forming apparatus with which the storage element of each developing cartridge can be accessed and utilized accurately and quickly, because it is as little as possible susceptible to thermal influences inside the apparatus main unit, and no errors occur in the processing of stored information and there is no drop in communication performance.

A main second invention for attaining the above-noted object is an image forming apparatus including: a bearing member for bearing an electrostatic latent image; a developing cartridge for developing the electrostatic latent image by selectively adhering a toner to the electrostatic latent image on a surface of the bearing member; a developing rotary unit provided in an apparatus main unit, that accommodates a plurality of the developing cartridges that can be inserted and removed around a rotation shaft, and lets one of the developing cartridges oppose the surface of the bearing member by rotating around the rotation shaft; and a storage element that stores and holds information relating to the developing cartridge, the storage element being provided at a position on an outer surface of the developing cartridge where its distance to an external cover of the apparatus main unit is shortest when the memory element communicates with the apparatus main unit after having been stopped in that stop position of the plurality of stop positions, at which the developing cartridge stops when being rotatively moved by the developing rotary unit, in which the outer surface of the developing cartridge is closest to the external cover.

It is another object of the present invention to provide an image forming apparatus with which the storage element of each developing cartridge can be accessed and utilized accurately, because there is as little pollution with toner of a communication section for accessing the storage element and the storage element itself as possible, and there are no errors in the processing of the stored information.

A main third invention for attaining this object is an image forming apparatus including:

a bearing member for bearing an electrostatic latent image;

a developing cartridge for developing the electrostatic latent image by selectively adhering toner to the electrostatic latent image on a surface of the bearing member;

a developing rotary unit provided in an apparatus main unit, that accommodates a plurality of the developing cartridges that can be inserted and removed around a rotation shaft, and lets one of the developing cartridges oppose the surface of the bearing member by rotating around the rotation shaft;

a duct having a suction opening for sucking a toner that drifts in a vicinity of a developing position at which the developing cartridge adheres a toner to the electrostatic latent image on the surface of the developing member, by providing suction near the developing position;

a storage element for storing and holding information relating to the developing cartridge; and communication sections for letting the apparatus main unit and the storage element communicate with each other, the communication sections being placed to the outside, in a direction along the rotation shaft, of a part of the duct where the suction opening is formed.

It is another object of the present invention to provide an image forming apparatus which is as little susceptible as possible to the thermal influence of heat-generating members when the rotation of the developing cartridge is stopped, so that there are no errors and no drop in communication performance during the processing of storage information in the storage element of each of the developing cartridges, and this storage information can be utilized with high reliability.

A main fourth invention for attaining this object is an image forming apparatus that forms an image by transferring a toner image on a bearing member surface onto a recording medium and fixing the toner image, the image forming apparatus including:

a bearing member that bears a toner image made by forming an electrostatic latent image based on image data on a surface and developing that electrostatic latent image;

an exposing unit that forms the electrostatic latent image based on the image data by selectively scanning and exposing the bearing member surface;

a developing cartridge that develops the electrostatic latent image by selectively adhering toner to the electrostatic latent image on the bearing member surface;

a developing rotary unit that accommodates a plurality of the developing cartridges that can be inserted and removed around a rotation shaft and lets one of the developing cartridges face the bearing member surface by rotating around the rotation shaft; and a controller that controls the driving of various sections of the apparatus, including the bearing member and the developing cartridge, based on received image data and various kinds of information;

wherein a storage element storing and holding information relating to the developing cartridge is placed on an outer surface of the developing cartridge, and a communication means is provided that performs communication by reading out at least information inside the storage element as information to be processed by the controller; and wherein the storage element is arranged outside a position facing a heat-generating member when the rotation of the developing cartridge is stopped.

It is another object of the present invention to provide an image forming apparatus in which the storage element placed on each of the developing cartridges is not influenced by the presence of a high-voltage member inside the apparatus main unit, so that the storage information inside the storage element can be utilize with high reliability.

A main fifth invention for attaining this object is an image forming apparatus that forms an image by transferring a toner image on a bearing member surface onto a recording medium and fixing the toner image, the image forming apparatus including: a bearing member that bears a toner image made by forming an electrostatic latent image based on image data on a surface and developing that electrostatic latent image; a developing cartridge that develops the electrostatic latent image by selectively adhering toner to the electrostatic latent image on the bearing member surface; a developing rotary unit that accommodates a plurality of the developing cartridges that can be inserted or removed around a rotation shaft and lets one of the developing cartridges face the bearing member surface by rotating around the rotation shaft; a controller that controls the driving of various sections of the apparatus, including the bearing member and the developing cartridge, based on received image data and various kinds of information;

the image forming apparatus further including:

a storage element that stores and holds information relating to the developing cartridge, placed on an outer surface of the developing cartridge, and a communication means that has a function of performing communication in a noncontacting manner, with antennas being placed at positions where the developing cartridge side can face the apparatus main unit side, and that performs communication in a noncontacting manner by reading out at least information inside the storage element as information processed by the controller;

wherein a blocking member is placed between a high-voltage member, which takes on a voltage equal or greater than that which is necessary for the adherence and transfer of a toner, and a rotation trajectory of the storage element on the outer surface of the developing cartridge, the blocking member limiting the influence that noise caused by the high-voltage member has on the storage element.

It is a further object of the present invention to realize a developing device, an image forming apparatus and an image forming system with which the amount of noise that intrudes the gap between the element and the antenna when the element and the antenna communicate wirelessly can be reduced.

A main sixth invention for attaining this object is a developing device that can be mounted to and dismounted from an image forming apparatus main unit, the developing device including:

an element that, when the developing device is mounted to the image forming apparatus main unit, faces, across a gap, an antenna provided to the image forming apparatus main unit, and is capable of wireless communication with the antenna; and a metal plate, at least a portion of which is positioned to the outer side of the gap and at a position corresponding to the gap in a direction from the element toward the antenna, when the developing device is mounted to the image forming apparatus main unit and the element performs wireless communication with the antenna.

It is a further object of the present invention to realize a cartridge that can be easily mounted to an image forming apparatus, as well as a developing device, an image forming apparatus and an image forming system.

A main seventh invention for attaining this object is (c) a cartridge including:

(a) a communication unit including:

a base;

an antenna supported by the base; and an element supported by the base, the element being for communication via the antenna; and (b) a housing by which the communication unit is supported with the element being positioned on an upstream side of the base, with respect to a mounting direction in which it is mounted to the image forming apparatus main unit.

It is a further object of the present invention to realize an image forming apparatus with which favorable communication can be achieved between the image forming apparatus main unit and the cartridge.

A main eighth invention for attaining this object is (d) an image forming apparatus including: (a) a mounting section that is to be mounted with a cartridge provided with an element unit having a first antenna and an element; (b) an antenna unit including a second antenna for communicating with the first antenna, the antenna unit being arranged at a position that is spaced by a predetermined distance L from the first antenna of the cartridge mounted into the mounting section; and (c) a communication region in which no conductive members are present besides the element unit, the antenna unit and a wire connected to the antenna unit, within a distance of L from the first antenna and within a distance of L from the second antenna.

It is a further object of the present invention to realize a developing device with which favorable communication is possible, even when a developer containing a magnetic material is contained in the developing device.

A main ninth invention for attaining this object is a developing device including:

a developing container containing a developer including a magnetic material;

a container-side antenna provided at the developing container, that is for communicating in a contactless manner, when mounted to an apparatus main unit, with a main unit-side antenna of the apparatus main unit; and an intrusion prevention section for preventing intrusion of the developer into a predetermined region between the container-side antenna and the developer.

It is a further object of the present invention to realize an image forming apparatus with which favorable communication between the image forming apparatus and the cartridge can be accomplished even when the temperature inside the apparatus rises.

A main tenth invention for attaining this object is (d) an image forming apparatus including:

(a) a mounting section that is to be mounted with a cartridge so that it can be mounted and dismounted;

(b) a duct serving as an air passageway within an apparatus including the mounting section; and (c) a second antenna provided to the duct, the second antenna being for communicating with an element provided with the cartridge, via a first antenna provided to the cartridge.

It is a further object of the present invention to effectively prevent the destruction of the memory unit without increasing the number of parts.

A main eleventh invention for attaining this object is a developing unit that can be mounted to and dismounted from an image forming apparatus main unit, the developing unit including:

a memory unit including a memory; and a label on which information relating to the developing unit is written, and that has been stuck to the developing unit so as to cover the memory unit.

Features and objects of the present invention other than the above will be made clear by reading the present specification with reference to the accompanying drawings.

BRIEF DESCRIPTION OF DRAWINGS

FIG. 14 is a diagram illustrating the information stored in a memory cell 54*h* of the element 54*a*.

FIG. 19(*a*) is a transparent plan view showing a memory tag (storage element) placed on its developing cartridge side and FIG. 19(*b*) is a relational block diagram illustrating its communication means.

FIG. 26(*a*) shows a transparent plan view showing a memory tag (storage element) placed on its developing cartridge side and FIG. 26(*b*) is a relational block diagram illustrating its communication means.

FIG. 30(*a*) is a diagrammatic transparent front view illustrating the suction with the exhaust duct, and FIG. 30(*b*) is a diagrammatic transparent front view showing the state during the rotation of its developing cartridge.

FIG. 33(*a*) shows a transparent plan view showing a memory tag (storage element) placed on its developing cartridge side and FIG. 33(*b*) is a relational block diagram illustrating its communication means.

FIG. 34(*a*) is a diagrammatic transparent view taken from its axial direction and FIG. 34(*b*) is a diagrammatic transparent view taken from its bottom side.

FIG. 35(*a*) is a diagrammatic transparent view taken from its axial direction and FIG. 35(*b*) is a diagrammatic transparent view taken from its bottom side.

FIG. 40(*a*) shows a transparent plan view showing a memory tag (storage element) placed on its developing cartridge side and FIG. 40(*b*) is a relational block diagram illustrating its communication means.

FIG. 120 is a cross-sectional view, taken from a direction perpendicular to the mounting direction, illustrating the communication distance and the communication region of the communication units and the antenna unit.

FIG. 121 is a cross-sectional view, taken from a direction parallel to the mounting direction, illustrating the communication distance and the communication region of the communication units and the antenna unit.

FIG. 122 is a diagram of the exhaust duct, taken from A in FIG. 103.

FIG. 123 is a diagram showing a second working example of this embodiment.

FIG. 124 is a diagram showing a third working example of this embodiment.

FIG. 125 is an explanatory diagram showing the external configuration of the image forming system.

FIG. 126 is a block diagram showing the configuration of the image forming system shown in FIG. 125.

FIG. 127 is a diagram illustrating how the developing unit 9054 (9051, 9052, 9053) and the photoconductor unit 9075 are mounted to and dismounted from the main printer unit 9010*a*.

FIG. 128 is a diagram showing the main structural components constituting the printer 9010.

FIG. 129 is a block diagram showing the control unit 9100 provided in the printer 9010.

FIG. 130 is a cross-sectional view showing the main structural components of the black developing unit 9051.

FIG. 131 is a perspective view of the black developing unit 9051, taken from the side of the developing roller 9510.

Figure 131:
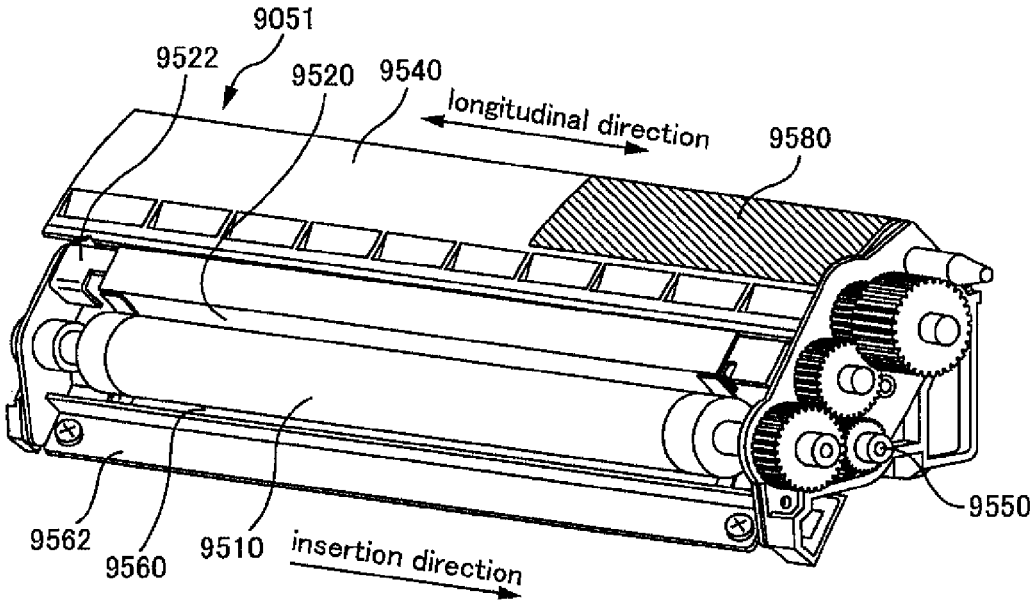
Figure 132:
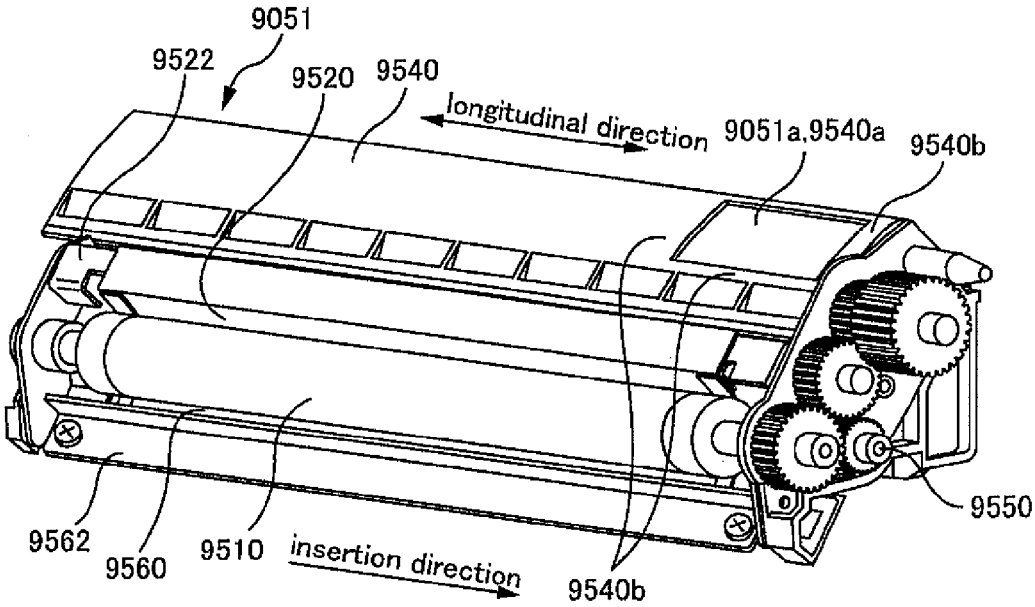

FIG. 132 is a perspective view showing an arrangement in which a label 9580 is removed from the black developing unit 9051 shown in FIG. 131.

Figure 133:
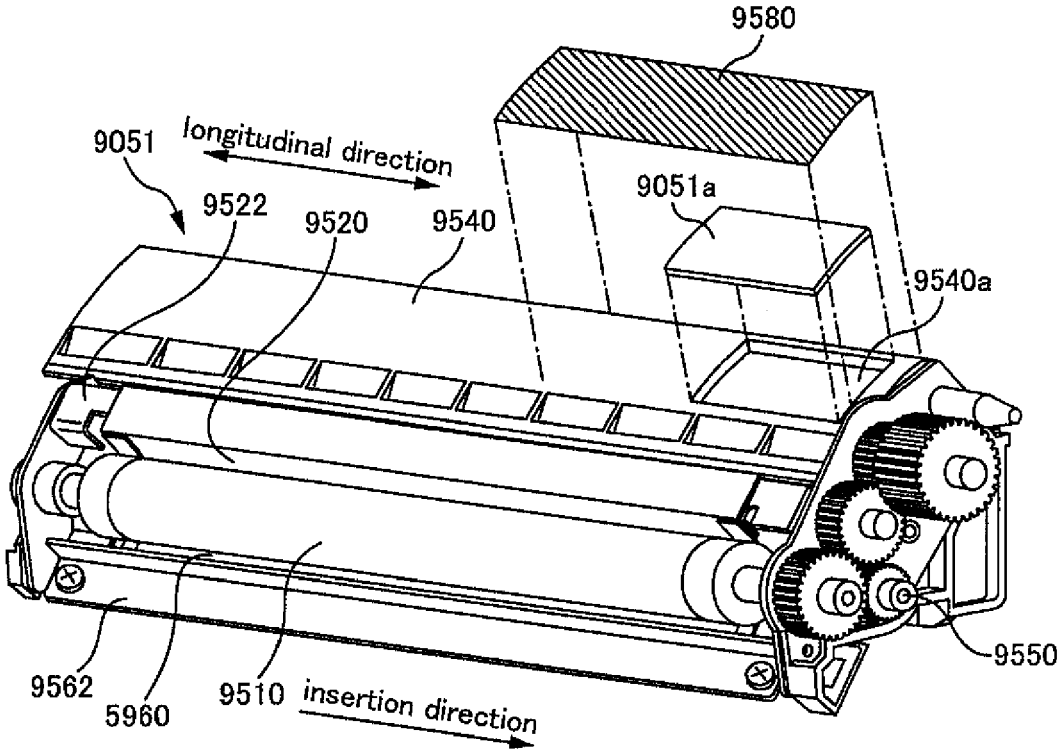

FIG. 133 is an exploded perspective view showing the positional relationship between the housing 9540, the memory unit 9051*a* and the label 9580 of the black developing unit 9051.

Figure 134:
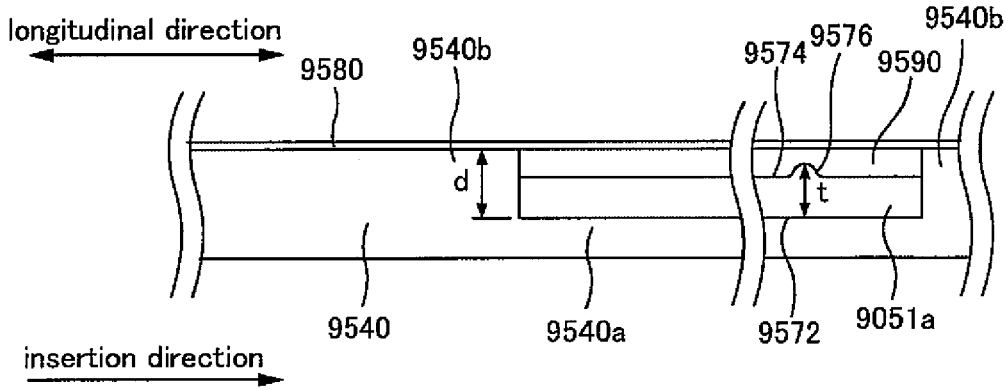

FIG. 134 is an cross-sectional diagrammatic view showing the positional relationship between the housing 9540, the memory unit 9051*a* and the label 9580 of the black developing unit 9051.

Figure 135:
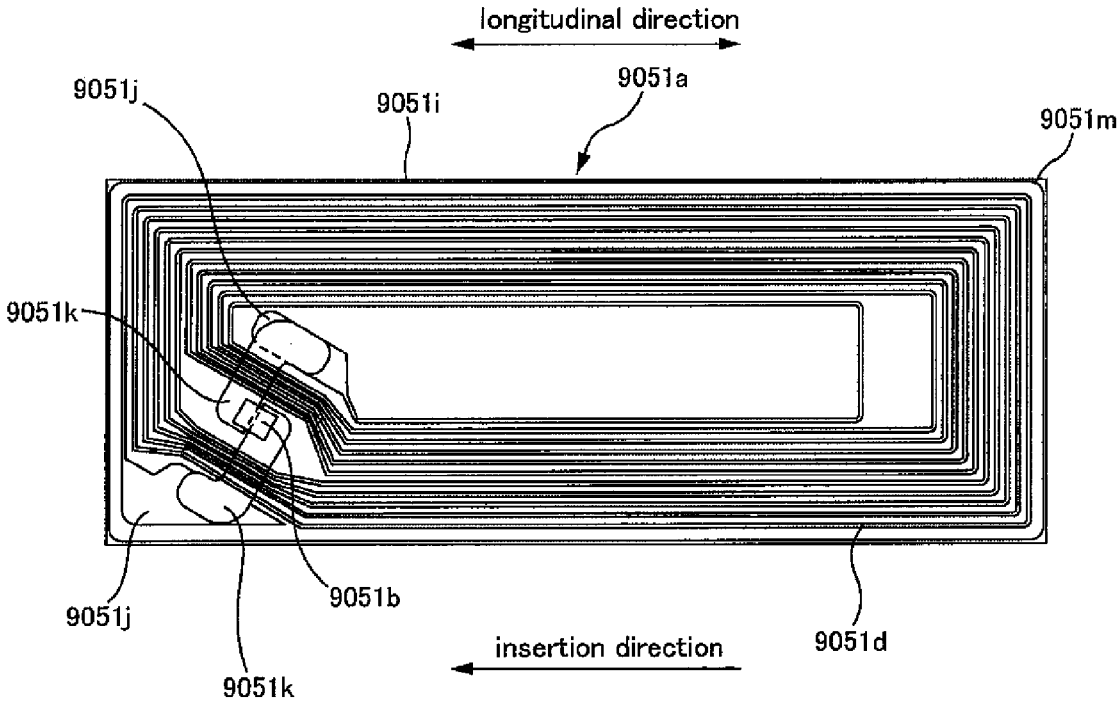

FIG. 135 is a plan view showing the configuration of the memory unit 9051*a*.

Figure 136:
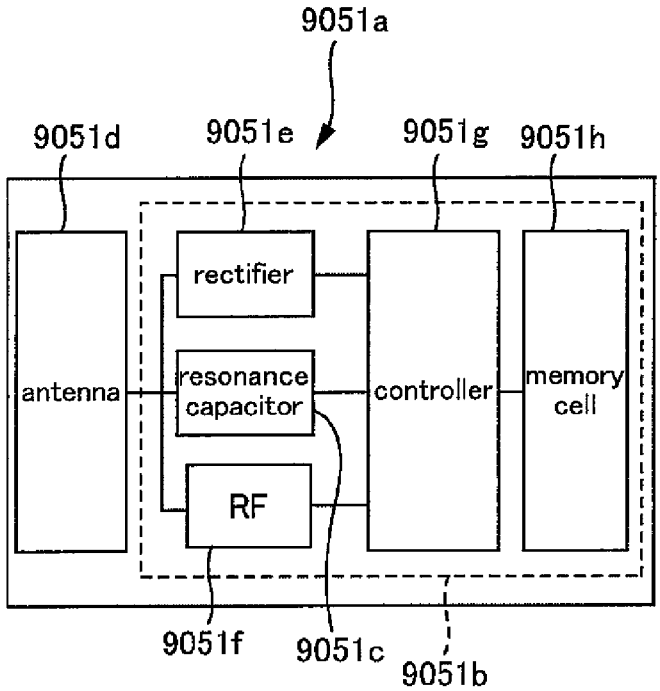

FIG. 136 is a block diagram illustrating the internal configuration of the memory unit 9051*a*.

Figure 137:
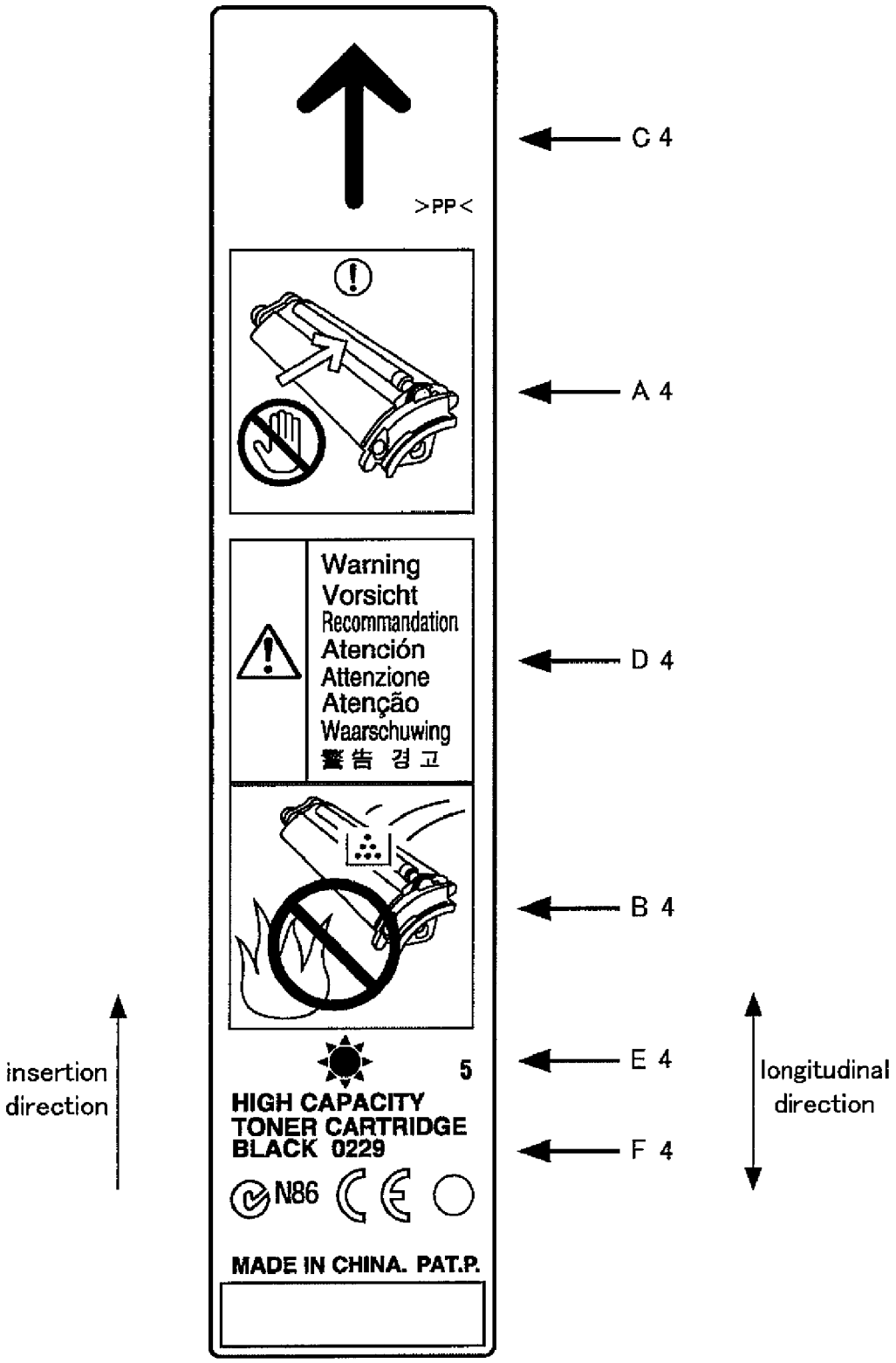

FIG. 137 is a diagram showing an example of the label 9580.

Figure 138A:
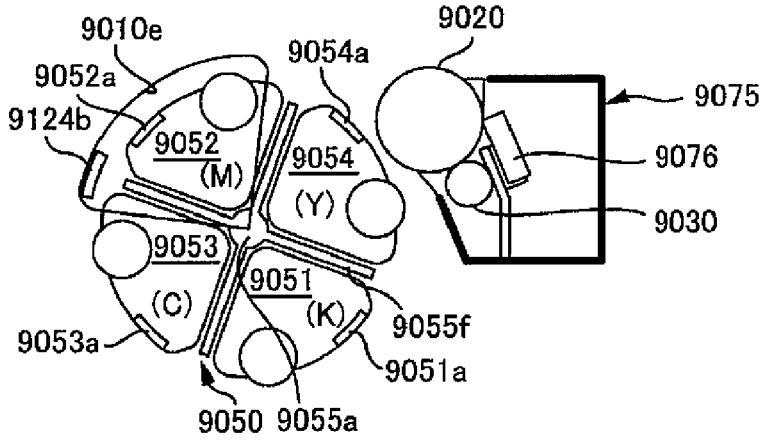
Figure 138B:
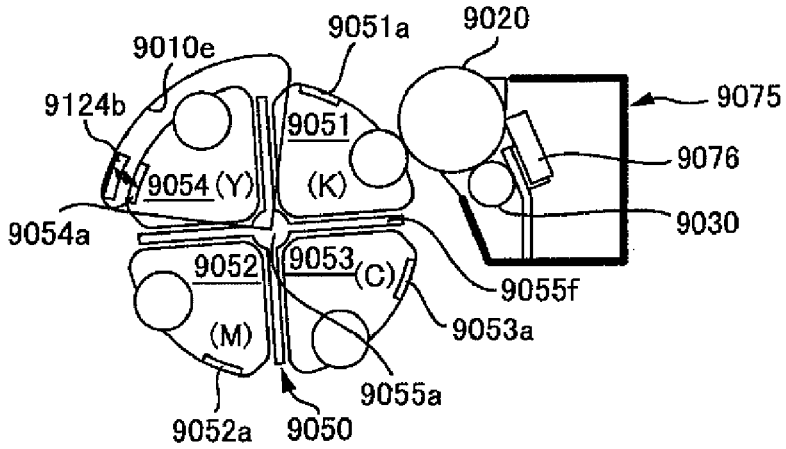
Figure 138C:
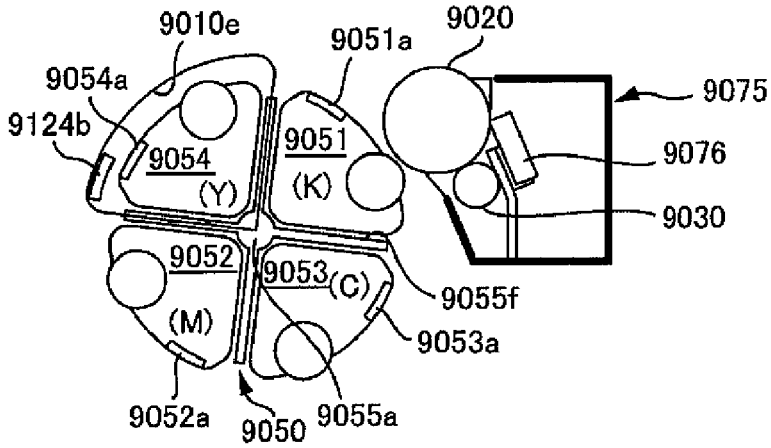

FIG. 138A is a diagram showing the HP position. FIG. 138B is a diagram showing the communication position of the yellow developing unit 9054. FIG. 138C is a diagram showing the mounting and dismounting position of the yellow developing unit 9054.

Figure 139:
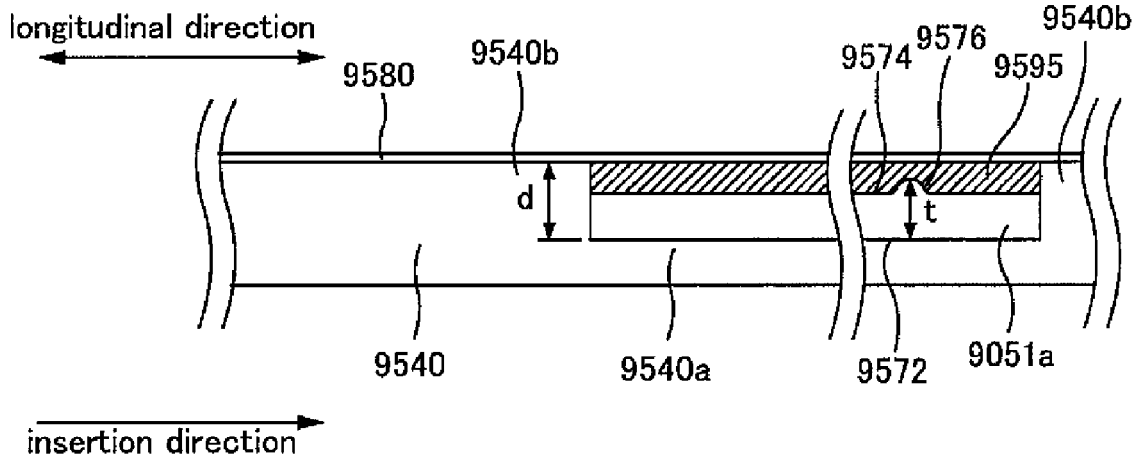

FIG. 139 is a cross-sectional diagrammatic view showing the cushion material 9595.

Figure 140:
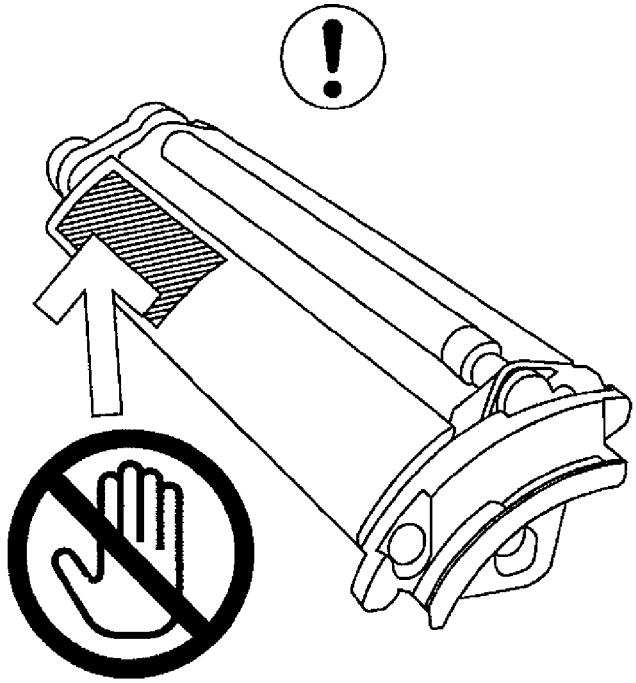

FIG. 140 is a diagram showing an example of information indicating the fact that persons handling the developing unit must not grasp the developing unit at the portion where the label is adhered.

Figure 141:
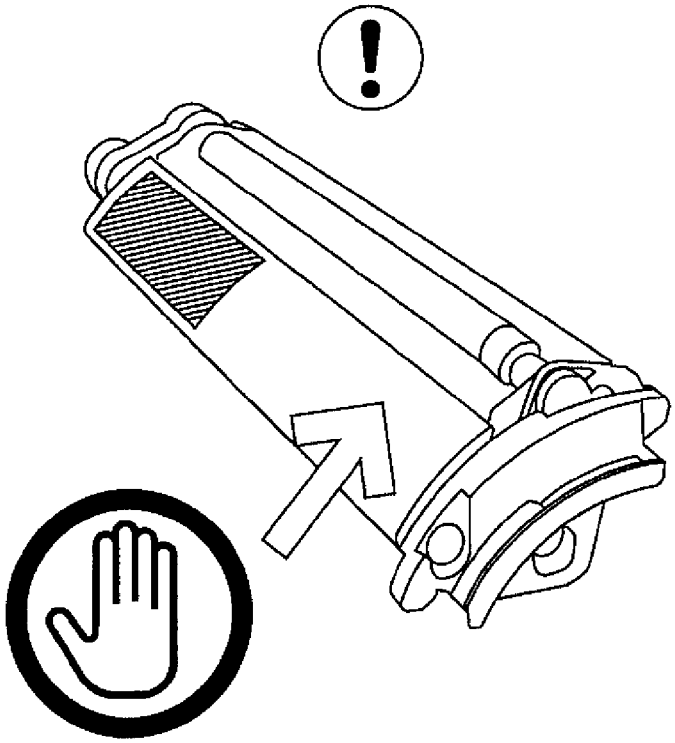

FIG. 141 is a diagram showing an example of such information urging persons handling the developing unit to grasp the developing unit at a portion other than the portion where the label is adhered.

Figure 142:
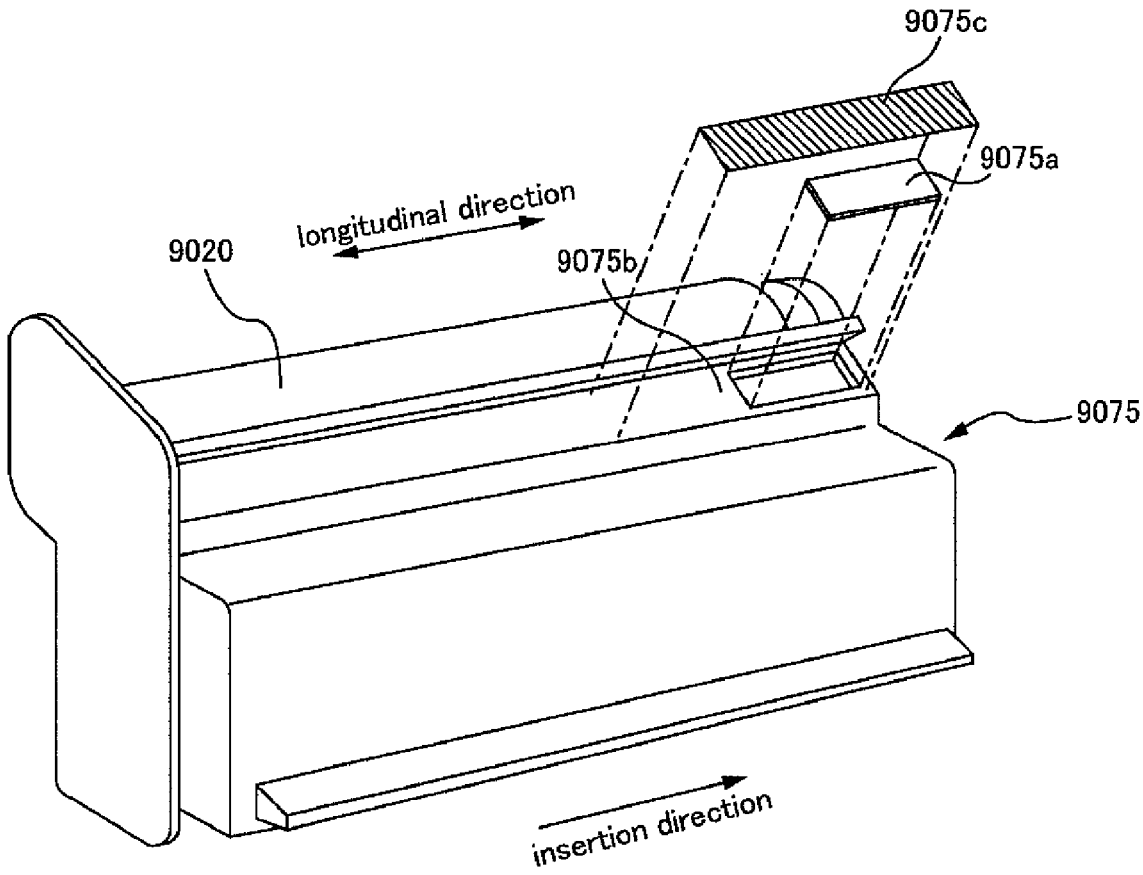

FIG. 142 is an exploded perspective view showing the positional relationship between the housing 9075*b*, the memory unit 9075*a* and the label 9075*c* of the photoconductor unit 9075.

Figure 143:
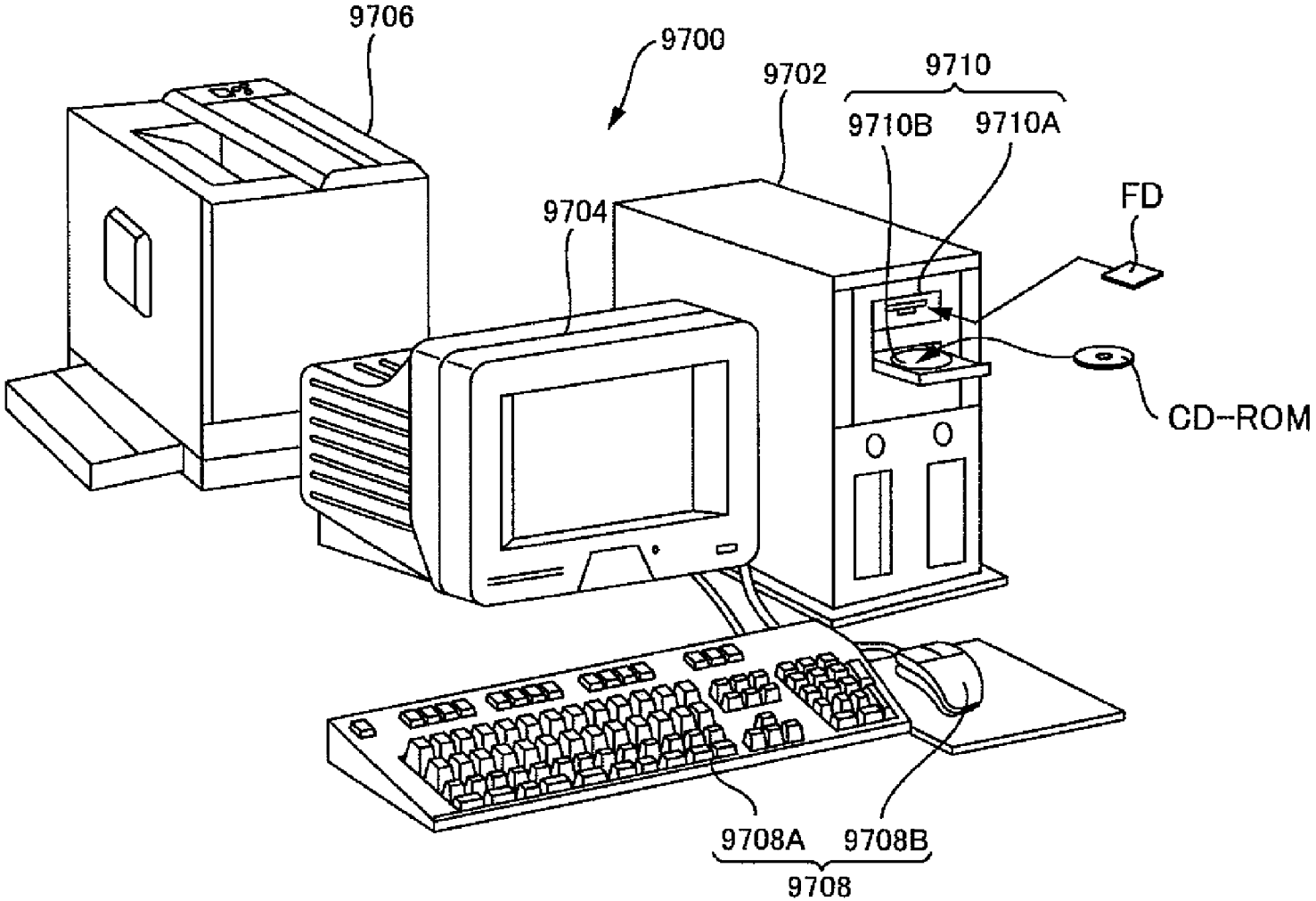

FIG. 143 is an explanatory diagram showing the external configuration of the image forming system.

Figure 144:
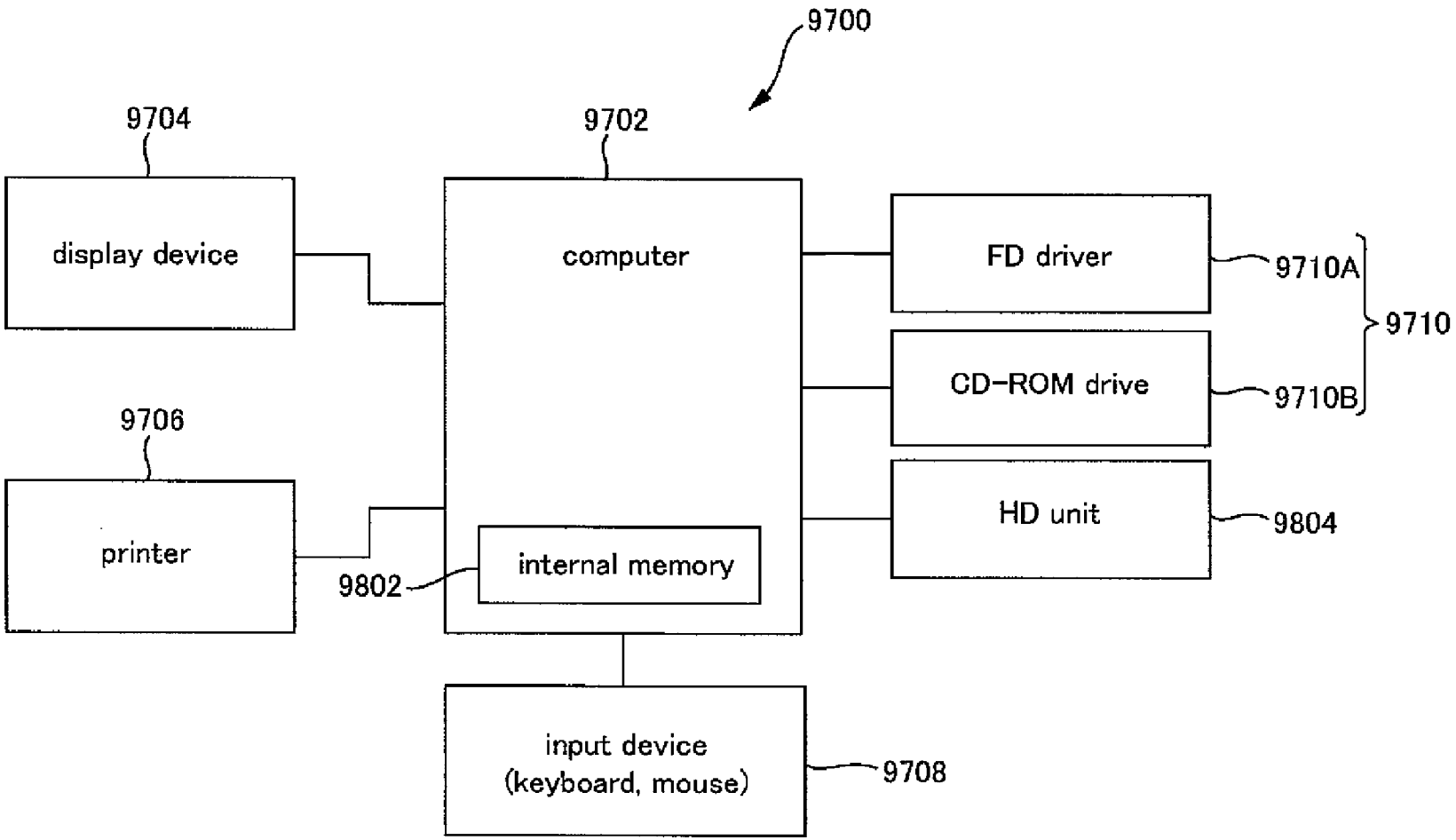

FIG. 144 is a block diagram showing the configuration of the image forming system shown in FIG. 143.

LIST OF REFERENCE NUMERALS

10 . . . printer, 10*a* . . . printer main unit, 10*b* . . . first opening cover, 10*c* . . . second opening cover, 10*d* . . . photoconductor unit mounting and dismounting opening, 10*e* . . . developing container mounting and dismounting opening, 20 . . . photoconductor, 30 . . . charging unit, 40 . . . exposing unit, 50 . . . developing container holding unit, 50*a*, 50*b*, 50*c*, 50*d* . . . mounting and dismounting section, 50*e* . . . rotation shaft, 51 . . . black developing container, 52 . . . magenta developing container, 53 . . . cyan developing container, 54 . . . yellow developing container, 51*a*, 52*a*, 53*a*, 54*a* . . . element, 54*b* . . . IC chip, 54*c* . . . resonance capacitor, 54*d* . . . antenna, 54*e* . . . rectifier, 54*f* . . . signal analysis section RF, 54*g* . . . controller, 54*h* . . . memory cell, 58 . . . positioning hole, 59 . . . coupling hole, 60 . . . primary image transfer unit, 70 . . . intermediate image transfer member, 75 . . . photoconductor unit, 76 . . . cleaning blade, 80 . . . secondary image transfer unit, 90 . . . fixing unit, 92 . . . paper supply tray, 94 . . . paper supply roller, 95 . . . display unit, 96 . . . registration roller, 100 . . . control unit, 101 . . . main controller, 102 . . . unit controller, 111 . . . CPU, 112 . . . interface, 113 . . . image memory, 114 . . . main controller-side memory, 114*a* . . . EEPROM, 114*b* . . . RAM, 116 . . . unit controller-side memory, 116*a* . . . EEPROM, 120 . . . CPU, 121 . . . serial interface, 122 . . . main unit-side memory, 123 . . . send-receive circuit, 124 . . . main unit-side antenna, 510 . . . developing roller, 510*a* . . . large-diameter section, 510*b* . . . axle section, 520 . . . sealing member, 522 . . . seal support metal plate, 524 . . . seal biasing member, 530 . . . toner containing section, 530*a* . . . first toner containing section, 530*b* . . . second toner containing section, 540 . . . housing, 542 . . . upper housing section, 543 . . . outer surface, 543*a* . . . arc-shaped surface, 544 . . . lower housing section, 546 . . . side wall on one end, 547 . . . side wall on other end, 550 . . . toner supply roller, 560 . . . regulating blade, 560*a* . . . rubber part, 560*b* . . . rubber supporting part, 562 . . . blade support metal plate, 570 . . . blade backing member, 572 . . . housing opening, 574 . . . roll, 576 . . . spring, 581*a*, 581*b* . . . attachment protrusion, 588 . . . positioning pin, 590 . . . coupling member, 593*a*, 593*b* . . . attachment hole, 595*a*, 595*b* . . . coupling pin, 700 . . . image forming system, 702 . . . computer, 704 . . . display device, 708 . . . input device, 708A . . . keyboard, 708B . . . mouse, 710 . . . reading device, 710A . . . flexible disk drive device, 710B . . . CD-ROM drive device, 802 . . . internal memory, 804 . . . hard disk drive unit,

1010 . . . image recording device, 1011 . . . laser beam scanning device, 1012 . . . photoconductive drum, 1014 . . . developing cartridge, 1014*a* . . . developing roller, 1015 . . . developing rotary unit, 1016 . . . intermediate transfer belt, 1017 . . . transfer roller, 1018 . . . pair of fixing rollers, 1020 . . . paper carry device, 1030 . . . control unit, 1031 . . . controller section, 1032 . . . engine controller, 1033 . . . CPU, 1035 . . . main unit memory, 1041, 1077 . . . memory tag, 1042 . . . non-contact IC chip, 1043 . . . developing-side antenna, 1044 . . . rectifier, 1045 . . . signal analysis RF, 1046 . . . memory cell, 1047 . . . controller, 1051 . . . main unit-side antenna, 1052 . . . send-receive circuit, 1060 . . . exhaust duct, 1061 . . . suction opening, 1062 . . . exhaust path, 1063 . . . exhaust opening, 1063*a* . . . suction fan, 1065 . . . duct plate, 1065*a* . . . wall surface, 1066 . . . drainage opening, 1071 . . . vent hole, 1072 . . . guide plate, 1075 . . . electrode terminal, 1076 . . . connector, 1100 . . . external over,

2010 . . . image recording device, 2011 . . . laser beam scanning device, 2012 . . . photoconductive drum, 2014 . . . developing cartridge, 2014*a* . . . developing roller, 2015 . . . developing rotary unit, 2016 . . . intermediate transfer belt, 2017 . . . transfer roller, 2018 . . . pair of fixing rollers, 2020 . . . paper carry device, 2030 . . . control unit, 2031 . . . controller section, 2032 . . . engine controller,

2033 . . . CPU, 2035 . . . main unit memory, 2041, 2073 . . . memory tag, 2042 . . . non-contact IC chip, 2043 . . . developing-side antenna, 2044 . . . rectifier, 2046 . . . memory cell, 2047 . . . controller, 2051 . . . main unit-side antenna, 2052 . . . send-receive circuit, 2060 . . . exhaust duct, 2061 . . . suction opening, 2062 . . . exhaust path, 2063 . . . exhaust opening, 2065 . . . duct plate, 2065*a* . . . wall surface, 2066 . . . drainage opening, 2071 . . . electrode terminal, 2072 . . . connector,

3010 . . . image recording device, 3011 . . . laser beam scanning device, 3011*a* . . . polygon mirror, 3011*b* . . . polygon motor, 3011*c* . . . driver section, 3012 . . . photoconductive drum, 3014 . . . developing cartridge, 3014*a* developing roller, 3015 . . . developing rotary unit, 3015*b* . . . rotation shaft, 3016 . . . intermediate transfer belt, 3017 . . . transfer roller, 3018 . . . pair of fixing rollers, 3020 . . . paper carry device, 3030 . . . control unit, 3031 . . . controller section, 3032 . . . engine controller, 3033 . . . CPU, 3035 . . . main unit memory, 3041, 3073 . . . memory tag, 3042 . . . non-contact IC chip, 3043 . . . developing-side antenna, 3044 . . . rectifier, 3045 . . . signal analysis RF, 3046 . . . memory cell, 3047 . . . controller, 3051 . . . main unit-side antenna, 3052 . . . send-receive circuit, 3071 . . . electrode terminal, 3072 . . . connector,

4010 . . . image recording device, 4011 . . . laser beam scanning device, 4012 . . . photoconductive drum, 4013 . . . charge device, 4014 . . . developing cartridge, 4014*a* . . . developing roller, 4015 . . . developing rotary unit, 4016 . . . intermediate transfer belt, 4017 . . . transfer roller, 4018 . . . pair of fixing rollers, 4020 . . . paper carry device, 4030 . . . control unit, 4031 . . . controller section, 4032 . . . engine controller, 4033 . . . CPU, 4035 . . . main unit memory, 4041 . . . memory tag, 4042 . . . non-contact IC chip, 4043 . . . developing-side antenna, 4044 . . . rectifier, 4045 . . . signal analysis RF, 4046 . . . memory cell, 4047 . . . controller, 4051 . . . main unit-side antenna, 4052 . . . send-receive circuit, 4071, 4072 . . . blocking member,

5010 . . . laser beam printer, 5012 . . . printer main unit, 5020 . . . photoconductor, 5030 . . . charging unit, 5037 . . . opening reserved for mounting and dismounting, 5040 . . . exposing unit, 5050 . . . YMCK developing unit, 5050*a* . . . central shaft, 5051 . . . black developing container, 5052 . . . magenta developing container, 5053 . . . cyan developing container, 5054 . . . yellow developing container, 5051*a*, 5052*a*, 5053*a*, 5054*a* . . . element, 5055 . . . support frame, 5055*a*, 5055*b*, 5055*c*, 5055*d* . . . holding section, 5056 . . . main unit-side gear wheel, 5057 . . . developing device driving motor, 5058 . . . positioning pin fitting hole, 5060 . . . primary image transfer unit, 5070 . . . intermediate image transfer member, 5075 . . . cleaning unit, 5076 . . . cleaning blade, 5080 . . . secondary image transfer unit, 5090 . . . fixing unit, 5092 . . . paper supply tray, 5094 . . . paper supply roller, 5095 . . . display unit, 5096 . . . registration roller, 5100 . . . control unit, 5101 . . . main controller, 5102 . . . unit controller, 5112 . . . interface, 5113 . . . image memory, 5121 . . . serial interface (I/F), 5122 . . . main unit-side memory, 5123 . . . send-receive circuit, 5124 . . . main unit-side antenna, 5126 . . . main unit-side metal plate, 5126*a* . . . lower section, 5150 . . . gap, 5510 . . . developing roller, 5510*a* . . . shaft, 5510*b* . . . large-diameter section, 5520 . . . upper sealing member, 5520*a* . . . end in shorter direction, 5520*b* . . . contact surface, 5520*c* . . . opposite surface, 5524 . . . upper seal biasing member, 5525 . . . integrating member, 5526 . . . holder, 5527 . . . upper seal support member, 5528 . . . regulating blade support part, 5529 . . . developing roller support section, 5529*a* . . . developing roller support section on one end, 5529*b* . . . developing roller support section on other end, 5530 . . . developing roller fitting hole, 5530*a* . . . developing roller fitting hole on one end, 5530*b* . . . developing roller fitting hole on other end, 5531 . . . intermediate gear wheel support section, 5538 . . . toner containing member, 5538*a* . . . first toner containing section, 5538*b* . . . second toner containing section, 5540 . . . housing, 5542 . . . upper housing section, 5543 . . . lower housing section, 5544 . . . sidewall, 5544*a* . . . pin, 5545 . . . partitioning wall, 5546 . . . supply roller fitting hole, 5546*a* . . . supply roller fitting hole on one end, 5546*b* . . . supply roller fitting hole on other end, 5550 . . . toner supply roller, 5560 . . . regulating blade, 5560*a* . . . rubber part, 5560*b* . . . rubber supporting part, 5560*c* . . . end in shorter direction, 5560*d* . . . end in longer direction, 5572 . . . opening, 5574 . . . end seal, 5576 . . . developing roller bearing, 5576*a* . . . developing roller bearing on one end, 5576*b* . . . developing roller bearing on other end, 5578 . . . supply roller bearing, 5578*a* . . . supply roller bearing on one end, 5578*b* . . . supply roller bearing on other end, 5580 . . . side plate, 5580*a* . . . upper section, 5582 . . . support section fitting hole, 5584 . . . developing roller fitting hole, 5586 . . . supply roller fitting hole, 5588 . . . pin fitting hole, 5590 . . . developing device-side gear wheel support section, 5592 . . . positioning pin, 5602 . . . housing seal, 5610 . . . supply roller driving gear wheel, 5612 . . . developing roller driving gear wheel, 5614 . . . intermediate gear wheel, 5616 . . . developing device-side gear wheel, 5700 . . . image forming system, 5702 . . . computer, 5704 . . . display device, 5706 . . . printer, 5708 . . . input device, 5708A . . . keyboard, 5708B . . . mouse, 5710 . . . reading device, 5710A . . . flexible disk drive device, 5710B . . . CD-ROM drive device, 5802 . . . internal memory, 5804 . . . hard disk drive unit,

6010 . . . printer, 6010*a* . . . printer main unit, 6010*b* . . . first opening cover, 6010*c* . . . second opening cover, 6010*d* . . . photoconductor unit mounting and dismounting opening, 6010*e* . . . developing container mounting and dismounting opening, 6010*f* . . . frame, 6010*g* . . . stay, 6020 . . . photoconductor, 6030 . . . charging unit, 6040 . . . exposing unit, 6050 . . . developing container holding unit, 6050*a*, 6050*b*, 6050*c*, 6050*d* . . . mounting and dismounting section, 6050*e* . . . rotation shaft, 6050*f* . . . wall section, 6051 . . . black developing container, 6052 . . . magenta developing container, 6053 . . . cyan developing container, 6054 . . . yellow developing container, 6051*a*, 6052*a*, 6053*a*, 6054*a* . . . communication unit, 6054*b* . . . non-contact IC chip, 6054*c* . . . resonance capacitor, 6054*d* . . . antenna, 6054*e* . . . rectifier, 6054*f* . . . signal analysis section RF, 6054*g* . . . controller, 6054*h* . . . memory cell, 6054*i* . . . thin plate-shaped substrate, 6054*j* . . . antenna terminal, 6054*k* . . . coupling section, 6054*m* . . . protective sheet, 6056 . . . guiding section, 6058 . . . positioning hole, 6059 . . . coupling hole, 6060 . . . primary image transfer unit, 6070 . . . intermediate image transfer member, 6075 . . . photoconductor unit, 6075*a* . . . communication unit, 6076 . . . cleaning blade, 6080 . . . secondary image transfer unit, 6090 . . . fixing unit, 6092 . . . paper supply tray, 6094 . . . paper supply roller, 6095 . . . display unit, 6096 . . . registration roller, 6098 . . . power source unit, 6098*a* . . . power source shielding member, 6100 . . . control unit, 6101 . . . main controller, 6102 . . . unit controller, 6111 . . . CPU, 6112 . . . interface, 6113 . . . image memory, 6114 . . . main controller-side memory, 6114*a* . . .

EEPROM, 6114*b* . . . RAM, 6116 . . . unit controller-side memory, 6116*a* . . . EEPROM, 6120 . . . CPU, 6121 . . . serial interface, 6122 . . . main unit-side memory, 6123 . . . communication control module, 6124 . . . antenna unit, 6124*a* . . . substrate, 6124*b* . . . antenna, 6124*c* . . . terminal, 6124*d* . . . protective sheet, 6124*e* . . . wire, 6125 . . . holder, 6125*a* . . . side wall, 6125*b* . . . tongue, 6510 . . . developing roller, 6510*a* . . . large-diameter section, 6510*b* . . . axle sections 6510*b*, 6520 . . . sealing member, 6522 . . . seal support metal plate, 6524 . . . seal biasing member, 6530 . . . toner containing section, 6530*a* . . . first toner containing section, 6530*b* . . . second toner containing section, 6540 . . . housing, 6542 . . . upper housing section, 6543 . . . outer surface, 6543*a* . . . arc-shaped surface, 6544 . . . lower housing section, 6545 . . . partitioning wall, 6546 . . . first side wall, 6547 . . . second side wall, 6549 . . . guided section, 6550 . . . toner supply roller, 6560 . . . regulating blade, 6560*a* . . . rubber part, 6560*b* . . . rubber supporting part, 6562 . . . blade support metal plate, 6570 . . . blade backing member, 6572 . . . housing opening, 6574 . . . roll, 6576 . . . spring, 6581*a*, 6581*b* . . . attachment protrusion, 6588 . . . positioning pin, 6590 . . . coupling member, 6593*a*, 6593*b* . . . attachment hole, 6595*a*, 6595*b* . . . coupling pin, 6598 . . . screw, 6700 image forming system, 6702 . . . computer, 6704 . . . display device, 6708 . . . input device, 6708A . . . keyboard, 6708B . . . mouse, 6710 . . . reading device, 6710A . . . flexible disk drive device, 6710B . . . CD-ROM drive device, 6802 . . . internal memory, 6804 . . . hard disk drive unit,

7010 . . . printer, 7010*a* . . . printer main unit, 7010*b* . . . first opening cover, 7010*c* . . . second opening cover, 7010*d* . . . photoconductor unit mounting and dismounting opening, 7010*e* . . . developing container mounting and dismounting opening, 7020 . . . photoconductor, 7030 . . . charging unit, 7040 . . . exposing unit, 7050 . . . developing container holding unit, 7050*a*, 7050*b*, 7050*c*, 7050*d* . . . mounting and dismounting section, 7050*e* . . . rotation shaft, 7051 . . . black developing container, 7052 . . . magenta developing container, 7053 . . . cyan developing container, 7054 . . . yellow developing container, 7051*a*, 7052*a*, 7053*a*, 7054*a* . . . communication unit, 7054*b* . . . non-contact IC chip, 7054*c* . . . resonance capacitor, 7054*d* . . . antenna, 7054*e* . . . rectifier, 7054*f* . . . signal analysis section RF, 7054*g* . . . controller, 7054*h* . . . memory cell, 7054*i* . . . thin plate-shaped substrate, 7054*j* . . . antenna terminal, 7054*k* . . . coupling section, 7054*m* . . . protective sheet, 7056 . . . guiding section, 7058 . . . positioning hole, 7059 . . . coupling hole, 7060 . . . image transfer unit, 7061 . . . image transfer drum, 7062 . . . image transfer corotron, 7063 . . . stripping tongue, 7070 . . . decharging unit, 7075 . . . photoconductor unit, 7076 . . . cleaning blade, 7080 . . . secondary image transfer unit, 7090 . . . fixing unit, 7092 . . . paper supply tray, 7095 . . . display unit, 7100 . . . control unit, 7101 . . . main controller, 7102 . . . unit controller, 7111 . . . CPU, 7112 . . . interface, 7113 . . . image memory, 7114 . . . main controller-side memory, 7114*a* . . . EEPROM, 7114*b* . . . RAM, 7116 . . . unit controller-side memory, 7116*a* . . . EEPROM, 7120 . . . CPU, 7121 . . . serial interface, 7122 . . . main unit-side memory, 7123 . . . communication control module, 7124 . . . antenna unit, 7124*a* . . . substrate, 7124*b* . . . antenna, 7124*c* . . . antenna terminal, 7124*d* . . . protective sheet, 7124*e* . . . wire, 7125 . . . holder, 7125*a* . . . side wall, 7125*b* . . . tongue, 7510 . . . developing roller, 7520 . . . first auger, 7521 . . . second auger, 7530 . . . first developer containing section, 7531 . . . second developer containing section, 7540 . . . housing, 7542 . . . upper housing section, 7543 . . . outer surface, 7543*a* . . . arc-shaped surface, 7544 . . . lower housing section, 7546 . . . intrusion prevention section, 7546*a* . . . partitioning member, 7547 . . . region holding member, 7549 . . . guided section, 7560 . . . regulating blade, 7572 . . . housing opening, 7576 . . . spring, 7700 . . . image forming system, 7702 . . . computer, 7704 . . . display device, 7708 . . . input device, 7708A . . . keyboard, 7708B . . . mouse, 7710 . . . reading device, 7710A . . . flexible disk drive device, 7710B . . . CD-ROM drive device, 7802 . . . internal memory, 7804 . . . hard disk drive unit,

8010 . . . printer, 8010*b* . . . first opening cover, 8010*c* . . . second opening cover, 8010*d* . . . photoconductor unit mounting and dismounting opening, 8010*e* . . . developing container mounting and dismounting opening, 8010*f* . . . frame, 8010*g* . . . stay, 8020 . . . photoconductor, 8030 . . . charging unit, 8040 . . . exposing unit, 8050 . . . developing container holding unit, 8050*a*, 8050*b*, 8050*c*, 8050*d* . . . mounting and dismounting section, 8050*e* . . . rotation shaft, 8050*f* . . . wall section, 8051 . . . black developing container, 8052 . . . magenta developing container, 8053 . . . cyan developing container, 8054 . . . yellow developing container, 8051*a*, 8052*a*, 8053*a*, 8054*a* . . . communication unit, 8054*b* . . . non-contact IC chip, 8054*c* . . . resonance capacitor, 8054*d* . . . antenna, 8054*e* . . . rectifier, 8054*f* . . . signal analysis section RF, 8054*g* . . . controller, 8054*h* . . . memory cell, 8054*i* . . . thin plate-shaped substrate, 8054*j* . . . antenna terminal, 8054*k* . . . coupling section, 8054*m* . . . protective sheet, 8056 . . . guiding section, 8058 . . . positioning hole, 8059 . . . coupling hole, 8060 . . . primary image transfer unit, 8062 . . . exhaust fan, 8062*a* . . . suction port, 8062*b* . . . exhaust port, 8064 . . . filter, 8066 . . . duct, 8066*a* . . . inner wall plate, 8066*b* . . . opening on the inner side, 8066*c* . . . exhaust-side opening, 8066*d* . . . antenna placement location, 8066*e* . . . tongue, 8066*f* . . . inner wall surface, 8066*g* . . . outer wall surface, 8070 . . . intermediate image transfer member, 8075 . . . photoconductor unit, 8075*a* . . . communication unit, 8076 . . . cleaning blade, 8080 . . . secondary image transfer unit, 8090 . . . fixing unit, 8092 . . . paper supply tray, 8094 . . . paper supply roller, 8095 . . . display unit, 8096 . . . registration roller, 8098 . . . power source unit, 8098*a* . . . power source shielding member, 8100 . . . control unit, 8101 . . . main controller, 8102 . . . unit controller, 8111 . . . CPU, 8112 . . . interface, 8113 . . . image memory, 8114 . . . main controller-side memory, 8114*a* . . . EEPROM, 8114*b* . . . RAM, 8116 . . . unit controller-side memory, 8116*a* . . . EEPROM, 8120 . . . CPU, 8121 . . . serial interface, 8122 . . . main unit-side memory, 8123 . . . communication control module, 8124 . . . antenna unit, 8124*a* . . . substrate, 8124*b* . . . antenna, 8124*c* . . . terminal, 8124*d* protective sheet, 8124*e* . . . wire, 8125 . . . holder, 8125*a* . . . side wall, 8125*b* . . . tongue, 8510 . . . developing roller, 8510*a* . . . large-diameter section, 8510*b* . . . axle section, 8520 . . . sealing member, 8522 . . . seal support metal plate, 8524 . . . seal biasing member, 8530 . . . toner containing section, 8530*a* . . . first toner containing section, 8530*b* . . . second toner containing section, 8540 . . . housing, 8542 . . . upper housing section, 8543 . . . outer surface, 8543*a* . . . arc-shaped surface, 8544 . . . lower housing section, 8545 . . . partitioning wall, 8546 . . . first side wall, 8547 . . . second side wall, 8549 . . . guided section, 8550 . . . toner supply roller, 8560 . . . regulating blade, 8560*a* . . . rubber part, 8560*b* . . . rubber supporting part, 8562 . . . blade support metal plate, 8570 . . . blade backing member, 8572 . . . housing opening, 8574 . . . roll, 8576 . . . spring, 8581*a*, 8581*b* . . . attachment protrusion, 8588 . . . positioning pin, 8590 . . . coupling member, 8593*a*, 8593*b* . . . attachment hole, 8595*a*, 8595*b* . . . coupling pin, 8598 . . . screw, 8700 . . . image forming system, 8702 . . . computer, 8704 . . . display device, 8708 . . . input device, 8708A . . . keyboard, 8708B . . . mouse, 8710 . . . reading device, 8710A . . . flexible disk drive device, 8710B . . . CD-ROM drive device, 8802 . . . internal memory, 8804 . . . hard disk drive unit,

9010 . . . printer, 9010*a* . . . printer main unit, 9010*b* . . . first opening cover, 9010*c* . . . second opening cover, 9010*d* . . . photoconductor unit mounting and dismounting opening, 9010*e* . . . developing unit mounting and dismounting opening, 9020 . . . photoconductor, 9030 . . . charging unit, 9040 . . . exposing unit, 9050 . . . YMCK developing device, 90951 . . . black developing unit, 9051*a* . . . memory unit, 9051*b* . . . non-contact IC chip, 9051*c* . . . resonance capacitor, 9051*d* . . . antenna, 9051*e* . . . rectifier, 9051*f* . . . signal analysis section RF, 9051*g* . . . controller, 9051*h* . . . memory cell, 9051*i* . . . thin plate-shaped substrate, 9051*j* . . . antenna terminal, 9051*k* . . . coupling section, 9051*m* . . . protective sheet, 9052 . . . magenta developing unit, 9052*a* . . . memory unit, 9053 . . . cyan developing unit, 9053*a* . . . memory unit, 9054 . . . yellow developing unit, 9054*a* . . . memory unit, 9055 . . . rotary, 9055*a* . . . central shaft, 9055*b*, 9055*c*, 9055*d*, 9055*e* . . . mounting and dismounting section, 9055*f* . . . support frame, 9060 . . . primary image transfer unit, 9070 . . . intermediate image transfer member, 9075 . . . photoconductor unit, 9075*a* . . . memory unit, 9075*b* . . . housing, 9075*c* . . . label, 9076 . . . cleaning blade, 9076*a* . . . waste toner containing section, 9080 . . . secondary image transfer unit, 9090 . . . fixing unit, 9092 . . . paper supply tray, 9094 . . . paper supply roller, 9095 . . . display unit, 9096 . . . registration roller, 9100 . . . control unit, 9101 . . . main controller, 9102 . . . unit controller, 9112 . . . interface, 9113 . . . image memory, 9120 . . . CPU, 9121 . . . serial interface, 9122 . . . main unit-side memory, 9123 . . . send-receive circuit, 9124*a* . . . main unit-side antenna for photoconductor unit, 9124*b* . . . main unit-side antenna for developing unit, 9510 . . . developing roller, 9520 . . . sealing member, 9522 . . . seal support metal plate, 9524 . . . seal biasing member, 99530 . . . toner containing member, 9530*a* . . . first toner containing section, 9530*b* . . . second toner containing section, 9540 . . . housing, 9540*a* . . . indentation, 9540*b* . . . portion outside the indentation, 9541 . . . opening, 9545 . . . regulating wall, 9550 . . . toner supply roller, 9560 . . . regulating blade, 9560*a* . . . rubber part, 99560*b* . . . rubber supporting part, 9562 . . . blade support metal plate, 9570 . . . blade backing member, 9572 . . . adhesive surface, 9574 . . . surface, 9576 . . . protrusion, 9580 . . . label, 9590 . . . air layer, 9595 . . . cushion material, 9700 . . . image forming system, 9702 . . . computer, 9704 . . . display device, 9706 . . . printer, 9708 . . . input device, 9708A . . . keyboard, 9708B . . . mouse, 9710 . . . reading device, 9710A . . . flexible disk drive device, 9710B . . . CD-ROM drive device, 9802 . . . internal memory, 9804 . . . hard disk drive unit, D . . . developer, T, t . . . toner, L . . . communication distance (radius), M . . . communication region, RS . . . read sensor for synchronization,

BEST MODE FOR CARRYING OUT THE INVENTION

At least the following matters will be made clear by the present specification and the accompanying drawings.

===First Invention===

A main first invention for solving the above-noted object is a developing device that can be mounted to and dismounted from a mounting and dismounting section provided in an image forming apparatus main unit, the developing device including: a developing device main unit; a positioning member for positioning the developing device main unit with respect to the mounting and dismounting section by engaging the mounting and dismounting section when the developing device is mounted to the mounting and dismounting section, the positioning member being fixed on a one end side in a longitudinal direction of the developing device main unit; a coupling member that is to be coupled to the mounting and dismounting section when the developing device is mounted to the mounting and dismounting section, the coupling member being attached to the other end side in the longitudinal direction of the developing device main unit in such a manner that its relative position to the developing device main unit can be changed; and an element capable of communication in a noncontacting manner with the image forming apparatus main unit side when the developing device is mounted to the mounting and dismounting section, the element being provided at the one end side in the longitudinal direction of the developing device main unit.

With such a developing device, the distance between the element and image forming apparatus main unit side tends not to change, so that it is possible to realize a developing device with which suitable communication with the image forming apparatus main unit side is possible.

In the foregoing developing device, the mounting and dismounting section may be movable; and the developing device may develop a latent image borne on an image bearing member with which the image forming apparatus main unit is provided, when having been moved to a first position through a movement of the mounting and dismounting section while being mounted to the mounting and dismounting section; and the element may communicate in a noncontacting manner with the image forming apparatus main unit side when the developing device has been moved to a second position that is different from the first position.

If the developing device moves with the movement of the mounting and dismounting section, then the relative position of the developing device main unit and the coupling member when the developing device is positioned in the second position changes more easily than in the case that the developing device does not move, so that there is a greater risk that the distance between the image forming apparatus main unit and the element changes. Therefore, if the developing device moves together with the movement of the mounting and dismounting section, the effect that is achieved by providing the element on the one end side, in the longitudinal direction, of the developing device main unit, that is, the effect that it becomes possible to realize a developing device with which suitable communication with the image forming apparatus is possible, can be displayed more effectively.

In the foregoing developing device, the mounting and dismounting section may include a spring that biases the developing device main unit along its longitudinal direction; and the relative position of the developing device main unit and the coupling member may change in accordance with the biasing amount provided by the spring.

If the mounting and dismounting section includes a spring that biases the developing device main unit along its longitudinal direction, then the developing device oscillates due to the extension and contraction of the spring when the developing device is positioned in the second position. And when the developing device oscillates, there is the risk that the distance between the image forming apparatus main unit and the element changes and that the element cannot communicate properly with the image forming apparatus main unit. Therefore, the effect of providing the element on the one end side in the longitudinal direction of the developing device main unit, that is, the effect that a developing device can be realized that can communicate properly with the image forming apparatus main unit can be more effectively displayed in the case that the mounting and dismounting section is provided with a spring.

In the foregoing developing device, the developing device main unit may include: a developer bearing member that bears a developer, and that is for developing the latent image borne on the image bearing member with the developer; and a distance holding member for holding a distance between the image bearing member and the developer bearing member by coming into contact with the image bearing member, the distance holding member being provided on both end portions in a longitudinal direction of the developer bearing member; and the distance holding member may hold the distance by coming into contact with the image bearing member when the developing device has moved to the first position.

In order to suitably develop the latent image carried on the bearing member, it is necessary to hold a suitable distance between the developer holding member and the image bearing member. Then, in order to hold this distance, a distance holding member coming into contact with the image bearing member may be provided at both ends in the longitudinal direction of the developer bearing member. In this case, when the relative position between the coupling member and the developing device main unit provided with the developer bearing member can change, then the distance holding member can come into contact with the image bearing member in order to ensure that the developer bearing member follows the image bearing member even when the image bearing member is attached slanted with respect to the image forming apparatus main unit, so that it is possible to hold a suitable distance between the developer bearing member and the image bearing member.

In the foregoing developing device, the positioning member may be a positioning shaft that is fixed to a side wall on the one end side in a longitudinal direction of the developing device main unit, such that the axial direction of the positioning member coincides with the longitudinal direction of the developing device main unit; and the positioning shaft may position the developing device main unit with respect to the mounting and dismounting section by fitting into a positioning hole provided in the mounting and dismounting section when the developing device has been mounted into the mounting and dismounting section.

If the positioning shaft fits into a positioning hole to position the developing device main unit with respect to the mounting and dismounting section, then the developing device main unit can be positioned with respect to the mounting and dismounting section with a simple configuration.

In the foregoing developing device, the mounting and dismounting section may be provided with a coupling hole; the coupling member may be provided with a coupling protrusion that can be fitted into the coupling hole, the coupling member may be attached to a side wall at the other end side in the longitudinal direction of the developing device main unit; and the coupling member may be coupled with the mounting and dismounting section by fitting the coupling protrusion in the coupling hole when the developing device has been mounted to the mounting and dismounting section.

If the coupling member is coupled to the mounting and dismounting section by fitting coupling protrusion into the coupling hole, then the coupling member can be coupled with the mounting and dismounting section with a simple configuration.

In the foregoing developing device, the developing device main unit may be provided with an attachment protrusion having a circular cross section; the coupling member may be provided with an attachment hole that has an elliptical cross section and into which the attachment protrusion can be fitted; and the attachment hole may allow movement, within the attachment hole, of the attachment protrusion fitted into the attachment hole.

If the attachment hole allows movement, within the attachment hole, of the attachment protrusion fitted into the attachment hole, then it becomes possible to move the developing device main unit easily with respect to the coupling member with a simple configuration.

In the foregoing developing device, the developing device main unit may be provided with a housing for containing a developer; and the element may be attached to an outer surface of the housing, the outer surface extending along a longitudinal direction of the housing.

In this case, it becomes possible to let the element communicate with the image forming apparatus main unit with a simple configuration.

In the foregoing developing device, the developing device main unit may include a developer bearing member that is supported by the housing at both end portions in its longitudinal direction, and that is for bearing a developer and developing a latent image borne on the image bearing member with the developer; the outer surface of the housing may include a circularly arc-shaped surface whose cross section through a perpendicular plane that is perpendicular to the longitudinal direction of the housing is circularly arc-shaped; and the element may be attached to a position of the circularly arc-shaped surface that is furthest removed from the developer bearing member.

If the element is attached to a position of the circularly arc-shaped surface that is furthest removed from the developer bearing member, then it can be prevented that developer carried by the developer bearing member is scattered and adheres to the element, so that it becomes possible to let the element communicate more properly with the image forming apparatus main unit side.

Furthermore, a developing device that can be mounted to and dismounted from a mounting and dismounting section provided in an image forming apparatus main unit, the developing device, including: a developing device main unit;

a positioning member for positioning the developing device main unit with respect to the mounting and dismounting section by engaging the mounting and dismounting section when the developing device is mounted to the mounting and dismounting section, the positioning member being fixed on a one end side in a longitudinal direction of the developing device main unit; a coupling member that is to be coupled to the mounting and dismounting section when the developing device is mounted to the mounting and dismounting section, the coupling member being attached to the other end side in the longitudinal direction of the developing device main unit in such a manner that its relative position to the developing device main unit can be changed; and an element capable of communication in a noncontacting manner with the image forming apparatus main unit side when the developing device is mounted to the mounting and dismounting section, the element being provided at the one end side in the longitudinal direction of the developing device main unit; wherein the mounting and dismounting section is movable; the developing device develops a latent image borne on an image bearing member with which the image forming apparatus main unit is provided, when having been moved to a first position through a movement of the mounting and dismounting section while being mounted to the mounting and dismounting section; the element communicates in a noncontacting manner with the image forming apparatus main unit side when the developing device has been moved to a second position that is different from the first position; the mounting and dismounting section includes a spring that biases the developing device main unit along its longitudinal direction; and the relative position of the developing device main unit and the coupling member changes in accordance with the biasing amount provided by the spring; the developing device main unit includes: a developer-bearing member that bears a developer and that is for developing the latent image borne on the image bearing member with the developer; and a distance holding member for holding a distance between the image bearing member and the developer bearing member by coming into contact with the image bearing member, the distance holding member being provided on both end portions in a longitudinal direction of the developer bearing member; the distance holding member holds the distance by coming into contact with the image bearing member when the developing device has moved to the first position; the positioning member is a positioning shaft that is fixed to a side wall on the one end side in a longitudinal direction of the developing device main unit, such that the axial direction of the positioning member coincides with the longitudinal direction of the developing device main unit; the positioning shaft positions the developing device main unit with respect to the mounting and dismounting section by fitting into a positioning hole provided in the mounting and dismounting section when the developing device has been mounted into the mounting and dismounting section; the mounting and dismounting section is provided with a coupling hole; the coupling member is provided with a coupling protrusion that can be fitted into the coupling hole, and the coupling member being attached to a side wall at the other end side in the longitudinal direction of the developing device main unit; the coupling member is coupled with the mounting and dismounting section by fitting the coupling protrusion in the coupling hole when the developing device has been mounted to the mounting and dismounting section; the developing device main unit is provided with an attachment protrusion having a circular cross section; the coupling member is provided with an attachment hole that has an elliptical cross section and into which the attachment protrusion can be fitted; the attachment hole allows movement, within the attachment hole, of the attachment protrusion fitted into the attachment hole; the developing device main unit is provided with a housing for containing a developer; the element is attached to an outer surface of the housing, the outer surface extending along a longitudinal direction of the housing; the developing device main unit includes a developer bearing member that is supported by the housing at both end portions in its longitudinal direction, and that is for bearing a developer and developing a latent image borne on the image bearing member with the developer; the outer surface of the housing includes a circularly arc-shaped surface whose cross section through a perpendicular plane that is perpendicular to the longitudinal direction of the housing is circularly arc-shaped; and the element is attached to a position of the circularly arc-shaped surface that is furthest removed from the developer bearing member.

With such a developing device, the effect that it becomes possible to realize a developing device that can communicate suitably with the image forming apparatus main unit side can be displayed most effectively.

Furthermore, an image forming apparatus including: an image bearing member for bearing a latent image; and a developing device that can be mounted to and dismounted from a mounting and dismounting section provided in an image forming apparatus main unit, the developing device including: a developing device main unit; a positioning member for positioning the developing device main unit with respect to the mounting and dismounting section by engaging the mounting and dismounting section when the developing device is mounted to the mounting and dismounting section, the positioning member being fixed on a one end side in a longitudinal direction of the developing device main unit; a coupling member that is to be coupled to the mounting and dismounting section when the developing device is mounted to the mounting and dismounting section, the coupling member being attached to the other end side in a longitudinal direction of the developing device main unit in such a manner that its relative position to the developing device main unit can be changed; and an element capable of communication in a noncontacting manner with the image forming apparatus main unit side when the developing device is mounted to the mounting and dismounting section, the element being provided at the one end side in the longitudinal direction of the developing device main unit, the developing device being for developing a latent image borne on the image bearing member when being mounted to the mounting and dismounting section.

Such an image forming apparatus is provided with a developing device that can communicate suitably with the image forming apparatus main unit side, so that it becomes possible to realize an image forming apparatus that is superior to the prior art.

Furthermore, an image forming system including: a computer; and an image forming apparatus that can be connected to the computer, the image forming apparatus including: an image bearing member for bearing a latent image; and a developing device that can be mounted to and dismounted from a mounting and dismounting section provided in an image forming apparatus main unit, the developing device including: a developing device main unit; a positioning member for positioning the developing device main unit with respect to the mounting and dismounting section by engaging the mounting and dismounting section when the developing device is mounted to the mounting and dismounting section, the positioning member being fixed on a one end side in a longitudinal direction of the developing device main unit; a coupling member that is to be coupled to the mounting and dismounting section when the developing device is mounted to the mounting and dismounting section, the coupling member being attached to the other end side in a longitudinal direction of the developing device main unit in such a manner that its relative position to the developing device main unit can be changed; and an element capable of communication in a noncontacting manner with the image forming apparatus main unit side when the developing device is mounted to the mounting and dismounting section, the element being provided at the one end side in the longitudinal direction of the developing device main unit, the developing device being for developing a latent image borne on the image bearing member when being mounted to the mounting and dismounting section.

Such an image forming system is provided with a developing device that can communicate suitably with the image forming apparatus main unit side, so that it becomes possible to realize an image forming system that is superior to the prior art.

===Second Invention===

A main second invention for solving the above-noted object is an image forming apparatus forming an image by transferring a toner image on a bearing member surface onto a recording medium and fixing that toner image, the image forming apparatus including: a bearing member carrying a toner image obtained by forming an electrostatic latent image on its surface and developing that electrostatic latent image; a developing cartridge for developing the electrostatic latent image by selectively adhering toner to the electrostatic latent image on the surface of the bearing member; a developing rotary unit that accommodates a plurality of the developing cartridges removably around a rotation shaft, and lets one of the developing cartridges oppose the surface of the bearing member by rotating around the rotation shaft; and a controller controlling the driving of various sections of the apparatus, including the bearing member and the developing cartridge, based on received image data and various kinds of information; wherein a storage element storing and holding information relating to the developing cartridge is placed on an outer surface of the developing cartridge, and a communication means is provided that performs communication by reading out at least information inside the storage element as information processed by the controller; the storage element is arranged at a position along the external cover when being stopped near the external cover of the apparatus main unit after being rotated by the developing rotary unit; and that stop position is set as the communication position with the communication means.

In this invention, during communication (in the communication position) in which the rotation is stopped and stored information is exchanged, the storage element on the outer surface of the developing cartridge is positioned at a position along the external cover of the apparatus main unit, or in other words, of the locations where it can be placed on the outer surface of the developing cartridge, at a position that becomes closest to the external cover of the apparatus main unit. Consequently, during communication, the storage element on the outer surface of the developing cartridge can perform the reading or writing of storage information in an environment that is close to the external temperature, via the external cover of the apparatus main unit, and the thermal influence from devices that are heat-generating members within the device main unit can be reduced.

A second second invention of a developing device solving the above-noted object is one, wherein, in addition to the features of the main second invention, the storage element in the communication position is positioned in a region in which it is furthest removed from a heat-generating member within the apparatus main unit.

With this invention, during communication, the storage element on the outer surface of the developing cartridge is closest to the external cover of the apparatus main unit, and at the same time its communication position is set such that it is positioned at a region that is furthest removed from heat-generating members within the apparatus main unit. Consequently, the storage element on the outer surface of the developing cartridge is in an environment that is close to the external temperature, via the external cover of the apparatus main unit, and the thermal influence from devices that are heat-generating members within the apparatus main unit can be reduced to a minimum.

A third second invention of a developing device solving the above-noted object is one, wherein, in addition to the features of the main second invention or the second second invention, the external cover is provided with a vent hole near the storage element positioned in the communication position.

With this invention, during communication, the storage element on the outer surface of the developing cartridge is closest to the external cover of the apparatus main unit, and is exposed to external air flowing in from the vent hole in the external cover. Consequently, the storage element on the outer surface of the developing cartridge is in an environment that is close to the external temperature outside the apparatus main unit, and the reading or writing of storage information can be carried out while effectively avoiding the occurrence of errors or a decrease in processing performance.

A fourth second invention of an image forming apparatus solving the above-noted object is one, which, in addition to the features of any of the main second invention to the third second invention, further includes a ventilation means that blows air onto a member surface near the storage element by forcibly generating an air-flow near the storage element in the communication position.

With this invention, during communication, the storage element on the outer surface of the developing cartridge is closest to the external cover of the apparatus main unit, and is exposed to a forcibly generated stream of air. Consequently, by forcibly blowing air that is close to the external temperature outside the apparatus main unit onto the storage element on the outer surface of the developing cartridge, heat is carried away, and it can be avoided that the temperature rises, and the reading or writing of stored information can be carried out while effectively avoiding the occurrence of errors or a decrease in processing performance.

A fifth second invention of an image forming apparatus solving the above-noted object is one, which, in addition to the features of the fourth second invention, further includes an exhaust duct that sucks in a portion inside the apparatus main unit and exhausting it out of the apparatus; wherein the exhaust duct is provided with a drainage opening near the storage element in the communication position and the ventilation means forcibly generates the air-flow near the storage element by sucking in surrounding air into the exhaust duct.

With this invention, during communication, the storage element on the outer surface of the developing cartridge is at a position closest to the external cover of the apparatus main unit, and is exposed to a stream of air that is generated by sucking in surrounding air from a suction opening in the exhaust duct. Consequently, it can be avoided, without providing a separate ventilation device, that the temperature of the storage element on the outer surface of the developing cartridge rises, and the reading or writing of stored information can be carried out while effectively avoiding the occurrence of errors or a decrease in processing performance.

A sixth second invention of an image forming apparatus solving the above-noted object is one, which, in addition to the features of any of the main second invention to the fifth second invention, antennas are provided at positions where the developing cartridge side can face the apparatus main unit side, providing the communication means with a function of performing communication in a noncontacting manner, and the antenna on the developing cartridge side is adjacent to the storage element.

With this invention, the storage element on the outer surface of the developing cartridge is adjacent to an antenna of the communication means, and furthermore, during communication, faces the antenna on the apparatus main unit side. Consequently, in addition to the storage element on the outer surface of the developing cartridge, also both antennas on the developing cartridge side and on the apparatus main unit side as well as the structural components on the apparatus main unit side controlling the communication via this antenna are in an environment that is close to the external temperature, so that communication in a noncontacting manner processing as well as the reading or writing of stored information can be carried out while effectively avoiding the occurrence of errors or a decrease in processing performance.

Furthermore, it may be an image forming apparatus including: a bearing member for bearing an electrostatic latent image; a developing cartridge for developing the electrostatic latent image by selectively adhering a toner to the electrostatic latent image on a surface of the bearing member; a developing rotary unit that is provided in an apparatus main unit, that accommodates a plurality of the developing cartridges that can be inserted and removed around a rotation shaft, and lets one of the developing cartridges oppose the surface of the bearing member by rotating around the rotation shaft; and a storage element that stores and holds information relating to the developing cartridge, the storage element being provided at a position on an outer surface of the developing cartridge where its distance to an external cover of the apparatus main unit is shortest when the memory element communicates with the apparatus main unit after having been stopped in that stop position of the plurality of stop positions, at which the developing cartridge stops when being rotatively moved by the developing rotary unit, in which the outer surface of the developing cartridge is closest to the external cover.

With such an image forming apparatus, the position at which the developing cartridge stops when the storage element and the apparatus main unit communicate, is the stop position, of the plurality of stop positions, at which the outer surface of the developing cartridge and the external cover are closest, and the position on the outer surface at which the storage element is provided is the stop position where distance between the storage element and the external cover becomes smallest, so that during communication, storage information can be read and written at a temperature on the outside of the external cover, that is, in an environment close to the external temperature. Therefore, the thermal influence from portions that are heat-generating members within the apparatus main unit is low, and favorable communication can be performed.

In the foregoing image forming apparatus, it is preferable that in the position in which the apparatus main unit communicates with the storage element, the storage element is positioned in a region in which it is furthest removed from a heat-generating member within the apparatus main unit.

With this image forming apparatus, during communication, the storage element on the outer surface of the developing cartridge is closest to the external cover of the apparatus main unit, and at the same time its communication position is set such that it is positioned at a region that is furthest removed from heat-generating members within the apparatus main unit. Therefore, at the position where the apparatus main unit and the storage element communicate, it is arranged at a position that is furthest removed from the heat-generating members and whose temperature within the apparatus is low, while being closest to the external cover next to the outside air of a temperature that is lower than the temperature within the apparatus, which has risen due to the heat-generating members, so that the temperature of the storage element can be kept from rising, and by suppressing the influence of a temperature rise on communication, favorable communication with the apparatus main unit can be ensured.

In the foregoing image forming apparatus, it is preferable that the external cover is provided with a vent hole near the position in which the apparatus main unit communicates with the storage element.

With this image forming apparatus, the storage element on the outer surface of the developing cartridge is closest to the external cover of the apparatus main unit in the position in which the apparatus main unit communicates with the storage element. Therefore, by forming a vent hole in the external cover, the storage element is exposed to outside air entering through the vent hole, cooling the storage element. Consequently, the storage element on the outer surface of the developing cartridge is in an environment that is close to the external temperature outside the apparatus main unit, and the reading or writing of stored information can be carried out while effectively avoiding the occurrence of errors or a decrease in processing performance.

In the foregoing image forming apparatus, it is preferable that there is provided in the position in which the apparatus main unit communicates with the storage element, a ventilation means that blows air onto a member surface near the storage element by forcibly generating an air-flow near the storage element.

With this image forming apparatus, air is blown onto a member surface near the storage element due to an air-flow generated forcibly by the ventilation means. That is to say, in the position in which the apparatus main unit communicates with the storage element, the storage element on the outer surface of the developer cartridge is forcibly exposed to air that is blown by the ventilation means. Consequently, by forcibly blowing air onto the storage element on the outer surface of the developing cartridge, heat is carried away, and it can be avoided that the temperature rises, and the reading or writing of storage information can be carried out while effectively avoiding the occurrence of errors or a decrease in processing performance.

In the foregoing image forming apparatus, it is preferable that there is provided an exhaust duct, which is provided with a drainage opening near the storage element at the position in which the apparatus main unit communicates with the storage element and that is for sucking air inside the apparatus main unit and exhausting it out of the apparatus; wherein the ventilation means forcibly generates the air-flow near the storage element by sucking air into the exhaust duct.

With such an image forming apparatus, the drainage opening of the exhaust duct is formed near the storage element at the position in which the apparatus main unit communicates with the storage element, so that an air-flow around the storage element is generated by sucking in air from the drainage opening of the exhaust duct. Consequently, due to the generated air-flow, it can be avoided, without providing a separate ventilation device, that the temperature of the storage element on the outer surface of the developing cartridge rises, and the reading or writing of stored information can be carried out while effectively avoiding the occurrence of errors or a decrease in processing performance.

In the foregoing image forming apparatus, it is preferable that antennas are provided at positions where the developing cartridge side faces the apparatus main unit side, allowing the storage element and the apparatus main unit to communicate in a noncontacting manner, and the antenna on the developing cartridge side is adjacent to the storage element.

With this image forming apparatus, the antennas of the apparatus main unit side and of the developing cartridge side oppose each other contactlessly and perform communication in a noncontacting manner. Therefore, it is possible to quickly access the storage element on the outer surface of the developing cartridge without performing a control operation, as for example in the case when a contact on the apparatus main unit side physically contacts a contact on the storage element side, such as moving one of the contacts in order to establish contact between the contacts. Moreover, the antenna is adjacent to the storage element, so that the antenna is arranged in substantially the same environment as the storage element, and the communication process in a noncontacting manner as well as the reading or writing of stored information can be carried out while effectively avoiding the occurrence of errors or a decrease in processing performance. For example, if the antenna is closest to the external cover, like the storage element, then the reading or writing of storage information can be carried out favorably in an environment that is close to the external temperature, and if the storage element is positioned in a region that is furthest removed from the heat-generating members, then also the antenna is furthest removed from the heat-generating members, so that favorable communication can be performed with little thermal influence.

===Third Invention===

A main third invention of an image forming apparatus solving the above-noted object is an image forming apparatus forming an image by transferring a toner image on a bearing member surface onto a recording medium and fixing the toner image, the image forming apparatus including: a bearing member carrying a toner image made by forming an electrostatic latent image based on image data on a surface and developing that electrostatic latent image; a developing cartridge developing the electrostatic latent image by selectively adhering toner to the electrostatic latent image on the bearing member surface; a developing rotary unit accommodating a plurality of the developing cartridges removably around a rotation shaft and letting one of the developing cartridges face the bearing member surface by rotating around the rotation shaft; and a controller controlling the driving of various sections of the apparatus, including the bearing member and the developing cartridge, based on received image data and various kinds of information; the image forming apparatus being further provided with a duct sucking in toner that drifts in a vicinity of a developing position at which the developing cartridge adheres toner to the electrostatic latent image on the surface of the developing member, by providing suction near the developing position; a storage element storing and holding information relating to the developing cartridge placed on an outer surface of the developing cartridge, and a communication means that performs communication by reading out at least information inside the storage element as information processed by the controller; wherein the storage element is arranged outside a region of the outer surface of the developing cartridge that passes near the suction opening of the duct.

With this invention, even when toner drifts near the suction opening of the duct, the storage element on the outer surface of the developing cartridge is not moved near it, and the drifting toner will not come into contact with the storage element and pollute it. Consequently, the storage element on the outer surface of the developing cartridge is not adversely influenced by substances adhering to it, and even when a connection section that is connected communicably with the apparatus main unit side is placed adjacent to this storage element, connection faults will not occur, and the information stored in the storage element can be reliably exchanged.

A second third invention of an image forming apparatus solving the above-noted object is one, wherein, in addition to the features of the main third invention, the communication means has a function of performing communication in a noncontacting manner, with antennas being placed at positions where the developing cartridge side can face the apparatus main unit side, and the antenna on the developing cartridge side is adjacent to the storage element.

With this invention, the antennas of the apparatus main unit side and the developing cartridge side face each other contactlessly and perform communication in a noncontacting manner, so that it is possible to quickly access the storage element on the outer surface of the developing cartridge without performing a control operation such as moving in order to establish contact, and even when the antenna is adjacent to the storage element, toner drifting near the suction opening of the duct will not accumulate on the surface of that antenna. Consequently, communication faults (connection faults) do not occur during the communication in a noncontacting manner, and the information stored in the storage element can be reliably exchanged.

A third second invention of an image forming apparatus solving the above-noted object is an image forming apparatus forming an image by transferring a toner image on a bearing member surface onto a recording medium and fixing the toner image, the image forming apparatus including: a bearing member carrying a toner image made by forming an electrostatic latent image based on image data on a surface and developing that electrostatic latent image; a developing cartridge developing the electrostatic latent image by selectively adhering toner to the electrostatic latent image on the bearing member surface; a developing rotary unit accommodating a plurality of the developing cartridges removably around a rotation shaft and letting one of the developing cartridges face the bearing member surface by rotating around the rotation shaft; and a controller controlling the driving of various sections of the apparatus, including the bearing member and the developing cartridge, based on received image data and various kinds of information; the image forming apparatus being further provided with a duct sucking in toner that drifts in a vicinity of a developing position at which the developing cartridge adheres toner to the electrostatic latent image on the surface of the developing member, by providing suction near the developing position; a storage element storing and holding information relating to the developing cartridge placed on an outer surface of the developing cartridge, and a communication means that performs communication by reading out at least information inside the storage element as information processed by the controller; wherein a position outside the region on the outer surface of the developing cartridge that passes a vicinity of the suction opening of the duct is set as a communication position for communication with the communication means, which is connected such that it can exchange storage information with the storage means.

With this invention, even when toner drifts near the suction opening of the duct, the connection section for providing a connection to the storage element on the outer surface of the developing cartridge is not moved near it, and the drifting toner will not come into contact with this connection element and pollute it. Consequently, the connection element on the outer surface of the developing cartridge can be connected such that it can communicate with the apparatus main unit side, without the occurrence of connection faults, and the information stored in the storage element can be reliably exchanged.

A fourth third invention of an image forming apparatus solving the above-noted object is one, wherein, in addition to the features of the third third invention, the communication means has a function of performing communication in a noncontacting manner, with antennas being placed at positions where the developing cartridge side faces the apparatus main unit side, and the antenna facing position is set to the communication position.

With this invention, the antennas (communication sections) on the apparatus main unit side and the developing cartridge side face each other contactlessly and perform communication in a noncontacting manner, so that it is possible to quickly access the storage element on the outer surface of the developing cartridge without performing a control operation such as moving in order to establish contact, and toner drifting neat the vicinity of the suction opening of the duct does not accumulate on the antenna surfaces. Consequently, communication faults (connection faults) do not occur during the communication in a noncontacting manner, and the information stored in the storage element can be reliably exchanged.

Furthermore, it is an image forming apparatus including: a bearing member for bearing an electrostatic latent image; a developing cartridge for developing the electrostatic latent image by selectively adhering a toner to the electrostatic latent image on a surface of the bearing member; a developing rotary unit provided in an apparatus main unit, that accommodates a plurality of the developing cartridges that can be inserted and removed around a rotation shaft, and lets one of the developing cartridges oppose the surface of the bearing member by rotating around the rotation shaft; a duct having a suction opening for sucking a toner that drifts in a vicinity of a developing position at which the developing cartridge adheres a toner to the electrostatic latent image on the surface of the developing member, by providing suction near the developing position; and a storage element capable of communication with the apparatus main unit, that stores and holds information relating to the developing cartridge, the storage element being provided on an outer surface of the developing cartridge to the outside of a region facing a part of the duct where the suction opening is formed, when the developing cartridge is rotated and passes the vicinity of the suction opening.

With such an image forming apparatus, when the developing cartridge is rotated and passes the vicinity of the suction opening, the storage element does not pass the vicinity of the suction opening. Therefore, even when the toner drives in the vicinity of the suction opening of the duct, it is possible to keep the drifting toner from adhering to the storage element. Consequently, the storage element on the outer surface of the developing cartridge is not adversely affected by substances adhering to it, so that it is possible to accomplish favorable communication between the storage element and the apparatus main unit, and to reliably exchange the information inside the storage element.

In the foregoing image forming apparatus, it is preferable that the storage element and the apparatus main unit include communication sections for communicating; wherein antennas are placed at positions where the developing cartridge side faces the apparatus main unit side, so that the communication sections have a function of performing communication in a noncontacting manner, and the antenna on the developing cartridge side is adjacent to the storage element.

With such an image forming apparatus, the antennas on the apparatus main unit side and on the developing cartridge side face each other without contacting each other and perform communication in a noncontacting manner. Therefore, it is possible to quickly access the storage element on the outer surface of the developing cartridge without performing a control operation, as for example in the case when a contact on the apparatus main unit side physically contacts a contact on the storage element side, such as moving one of the contacts in order to establish contact between the contacts. Moreover, the antenna is adjacent to the storage element, so that there is little possibility that the antenna passes near the suction opening of the duct when the developing cartridge is moved. Therefore, toner drifting in the vicinity of the suction opening of the duct does not tend to accumulate on the antenna surface. Consequently, communication faults (connection faults) do not occur during the communication in a noncontacting manner, and the information stored in the storage element can be reliably exchanged.

Furthermore, it may be an image forming apparatus including: a bearing member for bearing an electrostatic latent image; a developing cartridge for developing the electrostatic latent image by selectively adhering toner to the electrostatic latent image on a surface of the bearing member; a developing rotary unit provided in an apparatus main unit, that accommodates a plurality of the developing cartridges that can be inserted and removed around a rotation shaft, and lets one of the developing cartridges oppose the surface of the bearing member by rotating around the rotation shaft; a duct having a suction opening for sucking a toner that drifts in a vicinity of a developing position at which the developing cartridge adheres a toner to the electrostatic latent image on the surface of the developing member, by providing suction near the developing position; a storage element for storing and holding information relating to the developing cartridge; and communication sections for letting the apparatus main unit and the storage element communicate with each other, the communication sections being placed to the outside, in a direction along the rotation shaft, of a part of the duct where the suction opening is formed.

With such an image forming apparatus, the communication sections for establishing communication between the storage element and the apparatus main unit are arranged to the outside, in a direction parallel to the rotation shaft, of a position of the duct where the suction opening is formed. Therefore, even when the toner drifts near the suction opening of the duct, this drifting toner can be kept from adhering to the communication sections during the communication between the storage element and the apparatus main unit. Consequently, the communication section on the outer surface of the developing cartridge is not adversely affected by substances adhering to it, so that it is possible to accomplish favorable communication between the storage element and the apparatus main unit, and to reliably exchange the information inside the storage element.

In this image forming apparatus, it is preferable that the communication sections include a developing cartridge-side antenna and an apparatus main unit-side antenna for letting the storage element and the apparatus main unit communicate with each other, the developing cartridge-side antenna and the apparatus main unit-side antenna facing each other outside, in a direction along the rotation shaft, of a part of the duct where the suction opening is formed, so that the storage element and the apparatus main unit perform communication in a noncontacting manner.

With such an image forming apparatus, the antennas on the apparatus main unit side and on the developing cartridge side face each other without contacting each other and perform communication in a noncontacting manner. Therefore, it is possible to quickly access the storage element provided on the developing cartridge side without performing a control operation, as for example in the case when a contact on the apparatus main unit side physically contacts a contact on the storage element side, such as moving one of the contacts in order to establish contact between the contacts. Moreover, the storage element and the apparatus main unit communicate with each other with the developing cartridge-side antenna and the apparatus main unit-side antenna facing each other outside, in a direction parallel to the rotation shaft, of a position of the duct where the suction opening is formed, so that communication faults (connection faults) due to the influence of toner drifting around the duct do not occur during the communication in a noncontacting manner, and the information stored in the storage element can be reliably exchanged.

===Fourth Invention===

A main fourth invention of an image forming apparatus solving the above-noted object is an image forming apparatus that forms an image by transferring a toner image on a bearing member surface onto a recording medium and fixing the toner image, the image forming apparatus including: a bearing member that bears a toner image made by forming an electrostatic latent image based on image data on a surface and developing that electrostatic latent image; an exposing unit that forms the electrostatic latent image based on the image data by selectively scanning and exposing the bearing member surface; a developing cartridge that develops the electrostatic latent image by selectively adhering toner to the electrostatic latent image on the bearing member surface; a developing rotary unit that accommodates a plurality of the developing cartridges that can be inserted and removed around a rotation shaft and lets one of the developing cartridges face the bearing member surface by rotating around the rotation shaft; and a controller that controls the driving of various sections of the apparatus, including the bearing member and the developing cartridge, based on received image data and various kinds of information; wherein a storage element storing and holding information relating to the developing cartridge is placed on an outer surface of the developing cartridge, and a communication means is provided that performs communication by reading out at least information inside the storage element as information to be processed by the controller; and wherein the storage element is arranged outside a position facing a heat-generating member when the rotation of the developing cartridge is stopped.

With this invention, the storage element on the outer surface of the developing cartridge whose rotation has been stopped comes to rest outside a position facing heat-generating members serving as heat sources inside the apparatus main unit. Consequently, the temperature of storage element on the surface of the developing cartridge does not rise due to receiving the heat generated by the heat-generating members giving off heat inside the apparatus main unit while rotation is stopped, and it is possible to read and write the storage information inside the storage element at a temperature at which ordinary operation is possible, when the operation is resumed.

A second fourth invention of an image forming apparatus solving the above-noted object is one, wherein, in addition to the features of the main fourth invention, the heat-generating member is a scanner motor that rotates, at high speed, within the exposing unit in order to scan laser light that exposes the bearing member surface, or a driver section that controls the driving of the scanner motor.

With this invention, even when the scanner motor of the exposing motor or the driver section give off heat during driving, they do not face the storage element on the outer surface of the developing cartridge. Consequently, even when for example the scanner motor rotates at higher speeds and becomes hotter, as the image forming apparatus becomes faster, or the layout is such that the outer surface of the developing cartridge comes close to the exposing unit, as the apparatus becomes smaller, the storage element on the outer surface of the developing cartridge is not unnecessarily heated, so that it is possible to strive for higher speeds and smaller sizes without being restricted by the heating of the storage element.

A third fourth invention of an image forming apparatus solving the above-noted object is one, wherein, in addition to the features of the main fourth invention or the second fourth invention, the communication section has a function of performing communication in a noncontacting manner, with antennas being placed at positions where the developing cartridge side faces the apparatus main unit side, and the antenna on the developing cartridge side is adjacent to the storage element.

In this invention, not only the storage element on the outer surface of the developing cartridge, but also structural components performing communication control by facing contactlessly the antenna of the apparatus main unit side during communication come to rest outside a position opposing heat-generating members such as the exposing unit, which is a heat source inside the apparatus main unit, when rotation is stopped. Consequently, there is no drop in the processing capability of the communication in a noncontacting manner due to the amount of heat received from the heat-generating members giving off heat within the apparatus main unit while the rotation of the developing cartridge is stopped, and it is possible to exchange the storage information within the storage element at a temperature at which proper operation is possible, and to perform reading and writing.

A fourth fourth invention of an image forming apparatus solving the above-noted object is one, wherein, in addition to the features of any of the main fourth invention to the third fourth invention, the storage element is arranged at a position that is removed, in the rotation direction, from a position where the heat-generating member faces an outer surface of the developing cartridge whose rotation is stopped.

With this invention, when the rotation of the developing cartridge is stopped, the storage element on the outer surface of the developing device comes to rest at a position that is offset with respect to the rotation direction from a position facing the heat-generating member serving as a heat source inside the apparatus main unit. Consequently, even when the storage element is placed on the outer surface of the developing cartridge facing a heat-generating member inside the apparatus main unit during rotation, it is at least avoided that it stops in a condition where they face, its temperature does not rise due to receiving the amount of heat from the heat-generating member that is radiated inside the apparatus main unit when the rotation is stopped directly next to the heat source, and it is possible to read and write the storage information inside the storage element at a temperature at which ordinary operation is possible, when the operation is resumed.

A fifth fourth invention of an image forming apparatus solving the above-noted object is one, wherein, in addition to the features of the fourth fourth invention, the developing cartridge includes a developing roller that adheres contained toner onto the bearing member surface; and also the developing roller is arranged at a position that is removed, in the rotation direction, from a position where the heat-generating member faces an outer surface of the developing cartridge whose rotation is stopped.

With this invention, the developing roller of the developing cartridge, like the storage element on its outer surface, comes to rest at a position that is removed, in the rotation direction, from a position facing the heat-generating member, which is a heat source, inside the apparatus main unit, when the rotation of this developing cartridge is stopped. Consequently, as in the case of the storage element, it is avoided that it stops in a condition where it faces a heat-generating member inside the apparatus main unit, it is avoided that it is affected by the amount of heat from the heat-generating member that is radiated inside the apparatus main unit when the rotation is stopped in a state in which it is directly next to the developing roller itself or the toner on its circumferential surface, and it is possible to develop the electrostatic latent image on the bearing member surface with high quality, when the operation is resumed.

A sixth fourth invention of an image forming apparatus solving the above-noted object is one, wherein, in addition to the features of any of the main fourth invention to the fifth fourth invention, the storage element is arranged at a position that is removed, in an axial direction of the rotation shaft, from a position where the heat-generating member faces an outer surface of the developing cartridge whose rotation is stopped.

With this invention, the storage element on the outer surface of the developing cartridge comes to rest at a position that is removed, in the axial direction of the rotation shaft, from a position facing a heat-generating member that is a heat source inside the apparatus main unit. Consequently, the storage element on the outer surface of the developing cartridge does not oppose the heat-generating member inside the apparatus main unit, it is possible to avoid more reliably that its temperature rises due to receiving the amount of heat from the heat-generating member giving off heat inside the apparatus main unit, and it is possible to read and write the storage information within the storage element at a temperature at which proper operation is possible, after the operation is resumed.

===Fifth Invention===

A main fifth invention of an image forming apparatus solving the above-noted object is an image forming apparatus that forms an image by transferring a toner image on a bearing member surface onto a recording medium and fixing the toner image, the image forming apparatus including: a bearing member that bears a toner image made by forming an electrostatic latent image based on image data on a surface and developing that electrostatic latent image; a developing cartridge that develops the electrostatic latent image by selectively adhering toner to the electrostatic latent image on the bearing member surface; a developing rotary unit that accommodates a plurality of the developing cartridges that can be inserted or removed around a rotation shaft and lets one of the developing cartridges face the bearing member surface by rotating around the rotation shaft; a controller that controls the driving of various sections of the apparatus, including the bearing member and the developing cartridge, based on received image data and various kinds of information; the image forming apparatus further including: a storage element that stores and holds information relating to the developing cartridge, placed on an outer surface of the developing cartridge, and a communication means that has a function of performing communication in a noncontacting manner, with antennas being placed at positions where the developing cartridge side can face the apparatus main unit side, and that performs communication in a noncontacting manner by reading out at least information inside the storage element as information processed by the controller; wherein a blocking member is placed between a high-voltage member, which takes on a voltage equal or greater than that which is necessary for the adherence and transfer of a toner, and a rotation trajectory of the storage element on the outer surface of the developing cartridge, the blocking member limiting the influence that noise caused by the high-voltage member has on the storage element.

With this invention, even when noise emanates toward the storage element from the high-voltage member that is provided because electrophotography is employed, then the adverse influence that this noise may have is restricted, for example by being absorbed by the blocking member before it reaches the storage element. Consequently, it is avoided that the storage information inside the storage element is rewritten (corrupted) or deleted.

A second fifth invention of an image forming apparatus solving the above-noted object is one, wherein, in addition to the features of the main fifth invention, the storage element is placed on the outer surface of the developing cartridge, adjacent to the developing cartridge-side antenna.

With this invention, it is avoided that the noise from the high-voltage element is picked up by the antenna and adversely influences the storage information of the storage element. Consequently, even with a layout in which the antenna is close to the storage element and noise from the high-voltage element is easily picked up, it is avoided that the storage information inside the storage element is rewritten (corrupted) or deleted.

A third fifth invention of an image forming apparatus solving the above-noted object is one, wherein, in addition to the features of the main fifth invention or the second fifth fourth invention, the high-voltage member includes either one or both of a voltage applying member, which charges a contacting member with a high voltage, or that charged member.

With this invention, since the member for transferring the toner is charged, and since the voltage applying member applies a high charging voltage to the charged member, if noise is given off to the surroundings, then the adverse influence that this noise may have is restricted, for example by being absorbed by the blocking member before it reaches the storage element. Consequently, it is possible to lay out the voltage applying member and the charged member inside the apparatus without restrictions due to the placement of the storage element on the outer surface of the developing cartridge.

A fourth fifth invention of an image forming apparatus solving the above-noted object is one, wherein, in addition to the features of the third fifth invention, the charged member is a bearing member bearing a toner image obtained by developing the electrostatic latent image, and the voltage applying member is a member charging the bearing member surface to a potential at which the electrostatic latent image is formed and toner is adhered.

With this invention, the noise stemming from the bearing member bearing the toner image that is developed by forming an electrostatic latent image, or the member charging this bearing member, such that this electrostatic latent image can be formed or the toner image can be carried, is absorbed by the blocking member, so that the adverse influence it has on the storage element is restricted. Consequently, it is avoided that the storage information inside the storage element is rewritten (corrupted) or deleted, in the surroundings of the bearing member.

A fifth fifth invention of an image forming apparatus solving the above-noted object is one, which, in addition to the features of the third fifth invention or the fourth fifth invention, is provided with an intermediate image transfer member that, after a toner image on the bearing member surface has been transferred to it by primary image transfer, performs secondary image transfer of the toner image onto a recording medium; wherein the charged member is the intermediate image transfer member, and the voltage applying member is a member that charges the intermediate image transfer member to a potential at which the toner image is borne after receiving it from the bearing member.

With this invention, the noise from the intermediate image transfer member receiving the toner image carried by the bearing member and transferring it to the recording medium and from the member charging this intermediate image transfer member such that the carrying of this toner image is possible is absorbed by the blocking member, so that the adverse influence it has on the storage element is restricted. Consequently, it is avoided that the storage information inside the storage element is rewritten (corrupted) or deleted, in the surroundings of the intermediate image transfer member.

A sixth fifth invention of an image forming apparatus solving the above-noted object is one, wherein, in addition to the features of any of the main fifth invention to the fifth fifth invention, the blocking member is placed at a position where the high-voltage member faces the antenna or the storage element.

With this invention, the blocking member is placed at a location with an orientation at which the high-voltage member substantially faces the antenna or the storage element, and the noise from this high-voltage member is absorbed and its adverse influence is restricted. Consequently, at a timing in which the storage element is rotated to a location where it is easily affected by noise, it is prevented that this noise is picked up and it is effectively avoided that the storage information inside the storage element is rewritten (corrupted) or deleted.

===Sixth Invention===

A developing device that can be mounted to and dismounted from an image forming apparatus main unit, the developing device including: an element that, when the developing device is mounted to the image forming apparatus main unit, faces, across a gap, an antenna provided to the image forming apparatus main unit, and is capable of wireless communication with the antenna; and a metal plate, at least a portion of which is positioned to the outer side of the gap and at a position corresponding to the gap in a direction from the element toward the antenna, when the developing device is mounted to the image forming apparatus main unit and the element performs wireless communication with the antenna.

In this case, a developing device is realized, with which the amount of noise intruding into the gap between the element and the antenna is suitably reduced when wireless communication is performed between the element and the antenna.

The developing device may include: a developer bearing roller provided extending along a longitudinal direction of the developing device, that is for bearing a developer; a first driving wheel provided at one end portion of the developer bearing roller, that is for driving the developer bearing roller; and a second driving wheel that receives a driving force from the image forming apparatus main unit when the developing device is mounted to the image forming apparatus main unit, and that transmits the driving force to the first driving wheel; and the metal plate may be a positioning member for positioning the first driving wheel and the second driving wheel.

In this case, it is more efficient with regard to the fact that one member has a plurality of functions.

The element may be provided at an end portion, in the longitudinal direction of the developing device, at which the first driving wheel is positioned.

In this case, the element is positioned at a position that is closer to the metal plate, so that the metal plate can more suitably reduce the amount of noise that intrudes into the gap.

It is also possible to realize an image forming apparatus including: an image forming apparatus main unit including an antenna; and a developing device that can be mounted to and dismounted from the image forming apparatus main unit, the developing device including: an element that, when the developing device is mounted to the image forming apparatus main unit, faces the antenna across a gap, and is capable of wireless communication with the antenna; and a metal plate, at least a portion of which is positioned to the outer side of the gap and at a position corresponding to the gap in a direction from the element toward the antenna, when the developing device is mounted to the image forming apparatus main unit and the element performs wireless communication with the antenna.

In this case, an image forming apparatus is realized, with which the amount of noise intruding into the gap between the element and the antenna is suitably reduced when wireless communication is performed between the element and the antenna.

Furthermore, the image forming apparatus main unit may include a rotatable rotating member including a mounting and dismounting section to which the developing device can be mounted and dismounted; and the element may perform wireless communication with the antenna, when the developing device has been rotated through rotation of the rotating member with the developing device mounted in the mounting and dismounting section, so that the element provided on the developing device faces the antenna across the gap.

Furthermore, the developing device may include: a developer bearing roller for bearing a developer, that is provided extending along a longitudinal direction of the developing device; a first driving wheel for driving the developer bearing roller, that is provided at a one end portion of the developer bearing roller; and a second driving wheel that receives a driving force from the image forming apparatus main unit when the developing device is mounted to the image forming apparatus main unit, and that is for transmitting the driving force to the first driving wheel; wherein the metal plate is a positioning member for positioning the first driving wheel and the second driving wheel. In this case, it is more efficient with regard to the fact that one member has a plurality of functions.

Furthermore, the element may be provided at an end portion, in a longitudinal direction of the developing device, at which the first driving wheel is positioned.

In this case, the element is positioned at a position that is closer to the metal plate, so that the metal plate can more suitably reduce the amount of noise that intrudes into the gap.

Furthermore, the image forming apparatus main unit may include a motor; and the metal plate may be positioned between the motor and the gap when the element communicates wirelessly with the antenna.

In this case, the above-noted effect, that is, the effect that the amount of noise intruding into the gap is reduced, is displayed more effectively.

Furthermore, the image forming apparatus main unit may include a main unit-side metal plate at least a portion of which is positioned to an outer side of the gap and at a position corresponding to the gap in a direction from the element toward the antenna, when the element communicates wirelessly with the antenna.

In this case, it becomes possible to more suitably reduce the amount of noise intruding the gap between the element and the antenna when the element communicates wirelessly with the antenna.

Furthermore, it is possible to realize an image forming apparatus including: an image forming apparatus main unit including an antenna; and a developing device that can be mounted to and dismounted from the image forming apparatus main unit, the developing device including: an element that, when the developing device is mounted to the image forming apparatus main unit, faces the antenna across a gap, and is capable of wireless communication with the antenna; and a metal plate, at least a portion of which is positioned to the outer side of the gap and at a position corresponding to the gap in a direction from the element toward the antenna, when the developing device is mounted to the image forming apparatus main unit and the element performs wireless communication with the antenna; wherein the image forming apparatus main unit includes a rotatable rotating member including a mounting and dismounting section to which the developing device can be mounted and dismounted; the element performs wireless communication with the antenna, when the developing device has been rotated through rotation of the rotating member with the developing device mounted in the mounting and dismounting section, so that the element provided on the developing device faces the antenna across the gap; the developing device includes: a developer bearing roller for bearing a developer, that is provided extending along a longitudinal direction of the developing device; a first driving wheel for driving the developer bearing roller that is provided at one end of the developer bearing roller; and a second driving wheel that receives a driving force from the image forming apparatus main unit when the developing device is mounted to the image forming apparatus main unit, and that is for transmitting the driving force to the first driving wheel; wherein the metal plate is a positioning member for positioning the first driving wheel and the second driving wheel; the element is provided at an end portion, in a longitudinal direction of the developing device, at which the first driving wheel is positioned; the image forming apparatus main unit includes a motor; the metal plate is positioned between the motor and the gap when the element communicates wirelessly with the antenna; and the image forming apparatus main unit includes a main unit-side metal plate at least a portion of which is positioned to an outer side of the gap and at a position corresponding to the gap in a direction from the element toward the antenna, when the element communicates wirelessly with the antenna.

Thus, the object of the present invention is attained more effectively, since all of the above-noted effects are attained.

Furthermore, it is possible to realize an image forming system including: a computer; and an image forming apparatus that can be connected to the computer the image forming apparatus including: an image forming apparatus main unit including an antenna; and a developing device that can be mounted to and dismounted from the image forming apparatus main unit, the developing device including: an element that, when the developing device is mounted to the image forming apparatus main unit, faces the antenna across the gap, and is capable of wireless communication with the antenna; and a metal plate, at least a portion of which is positioned to the outer side of the gap and at a position corresponding to the gap in a direction from the element toward the antenna, when the developing device is mounted to the image forming apparatus main unit and the element performs wireless communication with the antenna.

In this case, an image forming system is realized, with which the amount of noise intruding into the gap between the element and the antenna is suitably reduced when wireless communication is performed between the element and the antenna.

===Seventh Invention===

A cartridge including: (a) a communication unit including: a base; an antenna supported by the base; and an element supported by the base, the element being for communication via the antenna; and (b) a housing by which the communication unit is supported with the element being positioned on an upstream side of the base, with respect to a mounting direction in which it is mounted to the image forming apparatus main unit.

The upstream side, with respect to the mounting direction when mounting the cartridge into an image forming apparatus main unit, is the side of the person doing the mounting, and becomes the side opposite of the image forming apparatus main unit. That is to say, when mounting the cartridge to the image forming apparatus main unit, at least the base of the communication unit is present further downstream (on the side of the image forming apparatus main unit) than the element, so that the element is not positioned at the frontmost end of the cartridge. Therefore, when the cartridge is being mounted to the image forming apparatus main unit, there is little risk that the person doing the mounting damages it by inadvertently bumping it against the frame. That is to say, the user or the like can mount the cartridge without paying excessively close attention. Consequently, a cartridge can be realized that is easy to mount.

In the foregoing cartridge, it is preferable that the communication unit communicates with the image forming apparatus main unit via an apparatus-side antenna provided to the image forming apparatus main unit.

The communication unit communicates via an apparatus-side antenna, with which the image forming apparatus is provided, so that the communication unit and the apparatus-side antenna are provided at positions that are close to each other. Therefore, there is little space around the communication unit when the cartridge is mounted to the image forming apparatus main unit. However, when the cartridge is inserted, the position where the element passes has already been passed by the front end side of the cartridge, and a portion of the cartridge is supported by the image forming apparatus main unit, so that there is little risk of inadvertently damaging the element during the insertion.

In the foregoing cartridge, it is preferable that the cartridge includes a positioning section for positioning with respect to the image forming apparatus main unit on a downstream side in the mounting direction; and that the communication unit is arranged on the downstream side in the mounting direction.

In order to ensure a favorable communication state with the communication unit, it is necessary to suitably position the communication unit and the apparatus-side antenna. In a cartridge having a positioning section on the downstream side, with respect to the mounting direction, the relative position to the apparatus-side antenna can be positioned with greater precision when the communication unit is provided on the downstream side with respect to the mounting direction. However, on the most downstream side of the cartridge, it comes close to the image forming apparatus main unit in an instable state during mounting, so that the cartridge may easily bump into the image forming apparatus main unit. Therefore, a cartridge can be realized with which favorable communication conditions can be ensured and that is easy to mount, by arranging the communication unit on the downstream side with respect to the mounting direction and arranging the element on the upstream side, with respect to the mounting direction, in the communication unit.

In the foregoing cartridge, it is preferable that the base is fixed to the housing, and the antenna and the element are supported by the base on the side of the base that is opposite to the housing and are covered by a film.

With such a cartridge, the base is fixed to the housing, so that the element is arranged on the surface of the cartridge. In this situation, if the element is arranged on the upstream side of the base, there is little risk that it is damaged during the mounting of the cartridge, so that it is not necessary to provide a cover with high rigidity or a thick cover or the like, and it is possible to protect it by covering it with a film. That is to say, only a film is present on the side of the element surface, so that there is no need to remove it by a certain distance from the apparatus-side antenna due to the cover or the like, and favorable communication conditions can be ensured.

In the foregoing cartridge, it is preferable that the image forming apparatus main unit includes: an opening through which the cartridge is inserted; and a guiding portion that guides the cartridge to a mounting position; wherein the element is passed through the opening and mounted after the guiding portion has been engaged when introducing the cartridge from the opening.

With such a cartridge, the cartridge is mounted to the image forming apparatus main unit through the opening, but as the element with which the cartridge is provided passes the opening, the cartridge is engaged by the guiding portion. That is to say, when the element passes the opening, the cartridge is guided by a guiding portion at a location that is further downstream, with respect to the mounting direction, than the element, so that a stable state is attained. Therefore, the element that is introduced through the opening is moved into the image forming apparatus main unit in a stable state, so that it is possible to prevent that the element is damaged during the mounting of the cartridge.

In the foregoing cartridge, the cartridge may be a developing device in which a developer is contained inside the housing.

With such a cartridge, there is little risk that the element is damaged during mounting, and it is possible to realize a developing device that is easy to mount.

In the foregoing cartridge, the cartridge may be an image bearing member unit provided with an image bearing member that bears a latent image.

With such a cartridge, there is little risk that the element is damaged during mounting, and it is possible to realize an image bearing member unit that is easy to mount.

Furthermore, it may be a developing device (c) including: (a) a communication unit including: a base; an antenna supported by the base; and an element supported by the base, the element being for communication via the antenna; (b) a housing by which the communication unit is supported with the element being positioned on an upstream side of the base, with respect to a mounting direction in which it is mounted to the image forming apparatus main unit; wherein (d) the communication unit communicates with the image forming apparatus main unit via an apparatus-side antenna provided to the image forming apparatus main unit; (e) which includes a positioning section for positioning with respect to the image forming apparatus main unit on a downstream side in the mounting direction, wherein the communication unit is arranged on the downstream side in the mounting direction; (f) wherein the base is fixed to the housing; and the antenna and the element are supported by the base on the side of the base that is opposite to the housing and are covered by a film; (g) wherein the image forming apparatus main unit includes: an opening through which the cartridge is inserted; and a guiding portion that guides the cartridge to a mounting position; wherein the element is passed through the opening and mounted after the guiding portion has been engaged when introducing the cartridge from the opening; (h) wherein a developer is contained inside the housing.

With such a developing device, all of the above-mentioned effects are displayed, so that the object of the present invention is attained most effectively.

Furthermore, it is also possible to realize an image forming apparatus including an image bearing member that bears a latent image and a developing device including the following (a) and (b): (a) a communication unit including: a base; an antenna supported by the base; and an element supported by the base, the element being for communication via the antenna; (b) a housing by which the communication unit, with the element being positioned on an upstream side of the base, is supported, with respect to a mounting direction in which it is mounted to the image forming apparatus main unit.

Furthermore, it is also possible to realize an image forming system including a computer and an image forming apparatus connected to the computer and including the following (A) and (B): (A) an image bearing member that bears a latent image, and (B) a developing device including the following (a) and (b): (a) a communication unit including: a base; an antenna supported by the base; and an element supported by the base, the element being for communication via the antenna; (b) a housing by which the communication unit, with the element being positioned on an upstream side of the base, is supported, with respect to a mounting direction in which it is mounted to the image forming apparatus main unit.

===Eighth Invention===

It may also be (d) an image forming apparatus including: (a) a mounting section that is to be mounted with a cartridge provided with an element unit having a first antenna and an element; (b) an antenna unit including a second antenna for communicating with the first antenna, the antenna unit being arranged at a position that is spaced by a predetermined distance L from the first antenna of the cartridge mounted into the mounting section; (c) a communication region in which no conductive members are present besides the element unit, the antenna unit and a wire connected to the antenna unit, within a distance of L from the first antenna and within a distance of L from the second antenna.

With such an image forming apparatus, no conductive members are present in the communication region apart from the element unit, the antenna unit and a wire connected to the antenna unit, so that no parts obstructing the communication between the element unit and the antenna unit are present in the communication region. Therefore, it is possible to realize an image forming apparatus, with which favorable communication between the element unit and the antenna unit is possible.

In the foregoing image forming apparatus, it is preferable that the image forming apparatus includes a holder made of resin, the holder including a flexible tongue; and that the antenna unit is fixed via the holder by engaging the base supporting the second antenna with the tongue.

With such an image forming apparatus, the antenna unit is engaged by a tongue of the holder, which is made of resin, so that the antenna unit can be fixed to the image forming apparatus via the holder without providing conductive members within the communication region. That is to say, no metal holder or screws are used, so that it is possible to accomplish favorable communication between the element unit and the antenna unit. Furthermore, the tongue with which the antenna unit is engaged is flexible, so that it is easy to install the antenna unit in the holder.

In the foregoing image forming apparatus, it is preferable that the image forming apparatus includes a metal shielding member outside of the communication region.

Such an image forming apparatus has a metal shielding member outside of the communication region so that it is possible to block electromagnetic waves or the like, which may intrude into the communication region, from the communication region. Therefore, it is possible to ensure more favorable conditions for the communication between the element unit and the antenna unit. Moreover, the electromagnetic waves caused by the communication between the element unit and the antenna unit can be blocked with the shielding member, so that it is possible to prevent that the electromagnetic waves caused by the communication between the element unit and the antenna unit influence the operation of the image forming apparatus.

In the foregoing image forming apparatus, it is preferable that the shielding member is an apparatus shielding member for blocking the image forming apparatus with respect to the outside.

With such an image forming apparatus, the shielding member provided outside of the communication region is an apparatus shielding member, so that it is possible to ensure favorable communication conditions between the element unit and the antenna unit by blocking the electromagnetic waves intruding from outside the apparatus, without using a separate shielding member. Furthermore, it is possible to prevent that the electromagnetic waves caused by the communication between the element unit and the antenna unit are emitted out of the apparatus.

In the foregoing image forming apparatus, it is preferable that the image forming apparatus includes a power source and a power source shielding member covering the power source; and that the shield is used as the power source shielding member.

With such an image forming apparatus, the shielding member that is provided outside of the communication region is a power source shielding member, so that it is possible to prevent that the communication between the element unit and the antenna unit is disturbed by electromagnetic waves emitted from the power source. Moreover, it is possible to prevent that the electromagnetic waves generated by the communication between the element unit and the antenna unit affect the power source.

In the foregoing image forming apparatus, it is preferable that the cartridge is a developing device containing a developer for developing the latent image.

With such an image forming apparatus, it is possible to realize an image forming apparatus, in which the antenna unit of the image forming apparatus main unit and the element unit of the developing device can communicate under favorable conditions.

In the foregoing image forming apparatus, the cartridge may be an image bearing member unit including an image bearing member for bearing the latent image.

With such an image forming apparatus, it is possible to realize an image forming apparatus, in which the antenna unit of the image forming apparatus main unit and the element unit of the developing device can communicate under favorable conditions.

Furthermore, it may be an image forming apparatus including: (a) a mounting section that is to be mounted with a cartridge provided with an element unit including a first antenna and an element; (b) an antenna unit having a second antenna for communicating with the first antenna, the antenna unit being arranged at a position that is spaced by a predetermined distance L from the first antenna of the cartridge mounted into the mounting section; (c) a communication region in which no conductive members are present besides the element unit, the antenna unit and a wire connected to the antenna unit, within a distance of L from the first antenna and within a distance of L from the second antenna; (d); (e) a holder made of resin, the holder including a flexible tongue, wherein the antenna unit is fixed via the holder by engaging the base supporting the second antenna with the tongue; and (f) a metal shielding member outside of the communication region; (g) the shielding member being an apparatus shielding member for blocking the image forming apparatus with respect to the outside; (h) the image forming apparatus including a power source and a power source shielding member covering the power source, the shield being used as the power source shielding member; and (i) the cartridge being a developing device containing a developer for developing a latent image.

With such an image forming apparatus, it is possible to realize an image forming apparatus that is superior to the prior art, since it includes a developing device that is capable of suitable communication with the image forming apparatus main unit.

Furthermore, it may be (C) an image forming system including: (A) a computer; and (B) an image forming apparatus including the following (a) to (i): (a) a mounting section that is to be mounted with a cartridge provided with an element unit including a first antenna and an element; (b) an antenna unit having a second antenna for communicating with the first antenna, the antenna unit being arranged at a position that is spaced by a predetermined distance L from the first antenna of the cartridge mounted into the mounting section; (c) a communication region in which no conductive members are present besides the element unit, the antenna unit and a wire connected to the antenna unit, within a distance of L from the first antenna and within a distance of L from the second antenna; (d); (e) a holder made of resin, the holder including a flexible tongue, wherein the antenna unit is fixed via the holder by engaging the base supporting the second antenna with the tongue; and (f) a metal shielding member outside of the communication region; (g) the shielding member being an apparatus shielding member for blocking the image forming apparatus with respect to the outside; (h) the image forming apparatus includes a power source and a power source shielding member covering the power source, the shield being used as the power source shielding member; and (i) the cartridge is a developing device containing a developer for developing a latent image.

With such an image forming system, it is possible to realize an image forming system that is superior to the prior art, because it includes a developing device that is capable of suitable communication with the image forming apparatus main unit.

===Ninth Invention===

It may also be a developing device including: a developing container containing a developer including a magnetic material; a container-side antenna that is provided at the developing container, and that is for communicating in a contactless manner, when mounted to an apparatus main unit, with a main unit-side antenna of the apparatus main unit; an intrusion prevention section for preventing intrusion of the developer into a predetermined region between the container-side antenna and the developer.

With such a developing device, an intrusion prevention section is provided for preventing intrusion of the developer into a predetermined region between the container-side antenna and the developer, which contains a magnetic material, so that it is possible to prevent magnetic material from entering into the predetermined region between the container-side antenna and the developer. That is to say, the developer is spaced apart by a predetermined region in which the magnetic material included at least in the developer is not present between the developer and the container-side antenna. Therefore, the magnetic flux generated by either the main unit-side antenna or the container-side antenna can pass through this predetermined region and reach a wider range. Therefore, the magnetic flux generated by either the main unit-side antenna or the container-side antenna can reliably reach the other antenna, so that favorable communication is possible.

In the foregoing developing device, it is preferable that the intrusion prevention section is a partitioning member for forming a gap by partitioning the predetermined region.

With such a developing device, the predetermined region is partitioned by the intrusion prevention section, so that it is possible to reliably ensure a region where no magnetic material is present, without the developer entering the predetermined region. Therefore, it is possible to ensure favorable communication between the main unit-side antenna and the container-side antenna.

In the foregoing developing device, the intrusion prevention member may be a region holding member that is provided such that it fills out the predetermined region.

With such a developing device, the predetermined region is filled out by the region holding member, so that no magnetic material enters the predetermined region. Thus, it is possible to ensure favorable communication between the main unit-side antenna and the container-side antenna.

In the foregoing developing device, it is preferable that the region holding member is a block made of urethane. With such a developing device, the region holding member is a block, so that it can be provided easily, for example by adhering it inside the developing container. Furthermore, since it is made of urethane, the region holding member is of light weight, and is particularly suited for a developing device that can be mounted and dismounted.

In the foregoing developing device, it is preferable that the container-side antenna and the main unit-side antenna communicate at positions spaced apart by a distance L; and the predetermined region includes a region of a distance L from the container-side antenna, and is wider than that region.

With such a developing device, the predetermined region includes a region of a distance L from the container-side antenna, and is wider than that region, so that the magnetic flux generated by the container-side antenna reaches at least a region of the distance L also on the opposite side of the developing container with respect to the container-side antenna. Therefore, it is possible to let the magnetic flux reach up to the main unit-side antenna that is provided at a spacing of the distance L from the container-side antenna, and to let the magnetic flux generated by the main unit-side antenna reach the container-side antenna. Therefore, it is possible to accomplish favorable communication between the main unit-side antenna and the container-side antenna.

Furthermore, it may be a developing device including: a developing container containing a developer including a magnetic material; a container-side antenna that is provided at the developing container, and that is for communicating contactlessly, when mounted to an apparatus main unit, with a main unit-side antenna of the apparatus main unit; an intrusion prevention section for preventing intrusion of the developer into a predetermined region between the container-side antenna and the developer; wherein the intrusion prevention section is a partitioning member for forming a gap by partitioning the predetermined region; the container-side antenna and the main unit-side antenna communicate at positions spaced apart by a distance L; and the predetermined region includes a region of a distance L from the container-side antenna, and is wider than that region.

With such a developing device, all of the above-mentioned effects can be displayed, so that the object of the present invention is attained most effectively.

Furthermore, (c) an image forming apparatus can be realized that includes: (a) an image bearing member that bears a latent image; and (b) a developing device including: a developing container containing a developer including a magnetic material; a container-side antenna that is provided at the developing container, and that is for communicating in a contactless manner, when mounted to an apparatus main unit, with a main unit-side antenna of the apparatus main unit; and an intrusion prevention section for preventing intrusion of the developer into a predetermined region between the container-side antenna and the developer.

Furthermore, (C) an image forming system can be realized that includes: (A) a computer; and (B) an image forming apparatus including the following (a) and (b): (a) an image bearing member that bears a latent image; and (b) a developing device including: a developing container containing a developer including a magnetic material; a container-side antenna that is provided at the developing container, and that is for communicating in a contactless manner, when mounted to an apparatus main unit, with a main unit-side antenna of the apparatus main unit; an intrusion prevention section for preventing intrusion of the developer into a predetermined region between the container-side antenna and the developer.

===Tenth Invention===

It may also be (d) an image forming apparatus including: (a) a mounting section that is to be mounted with a cartridge so that it can be mounted and dismounted; (b) a duct serving as an air passageway within an apparatus including the mounting section; and (c) a second antenna provided to the duct, the second antenna being for communicating with an element provided with the cartridge, via a first antenna provided to the cartridge.

With such an image forming apparatus, the duct provided inside the apparatus is an air passageway, so that the duct and the inside of the duct are cooled by an air-flow. Also the second antenna, which is provided in the duct, is cooled, and a temperature increase of the second antenna is suppressed. That is to say, by providing the second antenna in the duct, it is cooled and its temperature is kept from increasing, so that it is possible to ensure favorable communication between the image forming apparatus and the cartridge.

In the foregoing image forming apparatus, it is preferable that the second antenna is provided inside the duct. With such an image forming apparatus, the second antenna is provided inside the duct, so that the second antenna is directly cooled by the air-flow inside the duct, so that the second antenna can be cooled efficiently.

In the foregoing image forming apparatus, it is preferable that the second antenna is provided at an inner wall of the duct. With such an image forming apparatus, the second antenna is provided at an inner wall of the duct, so that it is not necessary to provide a separate member for fixing the second antenna. Therefore, it is possible to cool the second antenna efficiently by directly exposing it to the air-flow, while reducing the number of parts and the number of man-hours for assembly.

In the foregoing image forming apparatus, the second antenna also may be provided at an outer wall of the duct. With such an image forming apparatus, the duct is cooled by the air-flow inside the duct, so that the second antenna, which is provided on an outer wall of the duct, can be cooled via the duct. Moreover, since the second antenna is provided on the outer wall of the duct, there is no wall portion constituting the duct between the second antenna and the first antenna. Therefore, compared to the case that the second antenna is provided inside the duct, the second antenna and the first antenna can be arranged closer to each other, so that they are arranged at a distance at which favorable communication is possible, and the second antenna can be cooled via the duct, thus enabling favorable communication.

In the foregoing image forming apparatus, it is preferable that upstream, with respect to the direction of the air flow, from an antenna placement part where the second antenna is arranged, the duct has a part with a cross-sectional area that is larger than a cross-sectional area in a direction intersecting with the direction of the air flow at the antenna placement location.

With this image forming apparatus, upstream from the antenna placement location, there is a location with a cross-sectional area that is larger than a cross-sectional area in a direction intersecting with the direction of the air flow at the antenna placement location, so that the air-flow inside the duct becomes faster at the antenna placement location. Therefore, the second antenna, which is arranged at the antenna placement location, can be cooled even more efficiently, due to the faster air-flow.

In the foregoing image forming apparatus, it is preferable that the duct is made of resin. With such an image forming apparatus, since the duct is made of resin, that is, of a non-conductive member, the second antenna is not blocked and can communicate favorably with the first antenna even if the second antenna is provided in the duct.

In the foregoing image forming apparatus, it is preferable that the duct is an exhaust duct for exhausting air inside the apparatus to outside of the apparatus.

With such an image forming apparatus, by providing the second antenna in the exhaust duct, the second antenna can be cooled by utilizing the air flow for exhausting the air inside the apparatus out of the apparatus.

In the foregoing image forming apparatus, it is preferable that a filter is provided upstream of the second antenna, with respect to the direction of the air flow inside the duct.

With such an apparatus, it is possible to prevent dust, dirt and the like within the apparatus from adhering to the second antenna. In this situation, if conductive substances, such as iron dust or the like, are present in the dust or dirt inside the apparatus, then there is the risk that favorable communication between the first antenna and the second antenna is not possible. However, a filter is provided upstream of the second antenna, so that by preventing the iron dust or the like from adhering to the second antenna, it is possible to maintain favorable communication conditions.

In the foregoing image forming apparatus, it is preferable that a latent image borne on the image bearing member is developed using a developer; and the filter is provided in order to scavenge the developer.

With this image forming apparatus, it is possible to prevent the developer from scattering inside the apparatus, to cool the second antenna, and to ensure favorable communication between the image forming apparatus and the cartridge.

In the foregoing image forming apparatus, the developer may be a toner.

With this image forming apparatus, it is possible to prevent toner from scattering inside the apparatus, and to ensure favorable communication between the image forming apparatus and the cartridge, by cooling the second antenna.

In the foregoing image forming apparatus, it is preferable that the image forming apparatus includes an antenna driving circuit connected to the second antenna, that is for achieving communication between the first antenna and the second antenna; wherein the antenna driving circuit is provided at the duct.

With this image forming apparatus, it is possible to cool also the antenna driving circuit with the air-flow inside the duct.

Furthermore, it may be an image forming apparatus including: (a) a mounting section that is to be mounted with a cartridge removably; (b) a duct serving as an air passageway within an apparatus including the mounting section; and (c) a second antenna, with which the duct is provided, the second antenna being for communicating with an element with which the cartridge is provided, via a first antenna with which the cartridge is provided; wherein the second antenna is provided inside the duct; upstream, with respect to the direction of the air flow, from an antenna placement location where the second antenna is arranged, the duct has a location with a cross-sectional area that is larger than a cross-sectional area in a direction intersecting with the direction of the air flow at the antenna placement location; the duct is made of resin; the duct is an exhaust duct for exhausting air inside the apparatus out of the apparatus; a filter is provided upstream of the second antenna, with respect to the direction of the air flow inside the duct; a latent image borne on the image bearing member is developed using a developer; the upstream side opening is provided on the side of the image bearing member; the filter is provided in order to scavenge the developer; the developer is a toner; the image forming apparatus includes an antenna driving circuit that is connected to the second antenna and that is for achieving communication between the first antenna and the second antenna; and the antenna driving circuit is provided at the duct.

With such an image forming apparatus, all of the above-mentioned effects can be displayed, so that the object of the present invention is attained most effectively.

Furthermore, it is also possible to realize (C) an image forming system including: (A) a computer, and (B) an image forming apparatus including the following (a) to (c): (a) a mounting section that is to be mounted with a cartridge so that it can be mounted and dismounted; (b) a duct serving as an air passageway within an apparatus including the mounting section; (c) a second antenna provided to the duct, the second antenna being for communicating with an element provided to the cartridge, via a first antenna provided to the cartridge.

===Eleventh Invention===

A developing unit that can be mounted to and dismounted from an image forming apparatus main unit, the developing unit including: a memory unit including a memory; a label on which information relating to the developing unit is written, and that has been stuck to the developing unit so as to cover the memory unit.

With the foregoing developing unit, it is possible to effectively prevent the destruction of the memory unit without increasing the number of components.

Furthermore, the memory unit may be able to communicate wirelessly with the image forming apparatus main unit side, when the developing unit is mounted to the image forming apparatus main unit.

In this case, it is possible to effectively prevent the destruction of the memory unit, which can communicate wirelessly with the image forming apparatus main unit side, without increasing the number of parts.

Furthermore, the developing unit may be mounted to the image forming apparatus main unit by inserting it into the image forming apparatus main unit; and the memory unit may be provided on a downstream side, with respect to the insertion direction, of the developing unit.

In this case, when the developing unit is mounted or dismounted, the user or the like does not tend to touch the memory unit, and consequently, it is possible to effectively prevent the destruction of the memory unit.

Furthermore, the memory unit may be provided on a housing of the developing unit; and the label may be stuck to a surface of the housing so as to cover the memory unit.

Furthermore, the memory unit may be adhered to a surface of the housing.

In this case, it is not only possible to display the effect that the label effectively prevents the destruction of the memory unit without increasing the number of parts, but also the effect of effectively preventing that the memory unit is peeled off from the housing, due to the developer entering between the rear surface of the memory unit and the surface of the housing.

Furthermore, the housing may include an indentation; the memory unit may be adhered to a surface of the indentation; and the label may be stuck to a portion of the housing outside of the indentation.

In this case, since the memory unit is accommodated in the indentation, the user does not tend to touch the memory unit, so that the destruction of the memory unit can be prevented more effectively.

Furthermore, a maximum thickness of the memory unit may be smaller than a minimum depth of the indentation.

In this case, since the memory unit is entirely accommodated in the indentation, the user does not tend to touch the memory unit, so that the destruction of the memory unit can be prevented more effectively.

Furthermore, an air layer may be formed between a rear surface of the label and a surface of the memory unit on the side opposite to the adhesive surface.

In this case, the air layer functions as a cushion, so that the destruction of the memory unit can be suitable prevented, even in the case that the label is pressed down by the user or the like.

Furthermore, the developing unit may also include a cushion material between a rear surface of the label and a surface of the memory unit on the side opposite to the adhesive surface.

In this case, the cushion material functions as a cushion, so that the destruction of the memory unit can be suitable prevented, even in the case that the label is pressed down by the user or the like.

Furthermore, the information may be information representing warning messages relating to the handling of that developing unit. Furthermore, the information may be information cautioning persons handling that developing unit. Furthermore, the information may be information indicating a supplier of that developing unit. Furthermore, a developer may be contained in the developing unit; and the information may be information indicating the color of the developer. Furthermore, the developing unit may be mounted to the image forming apparatus main unit by insertion into the image forming apparatus main unit; and the information may be information indicating an inserting direction of the developing unit.

Furthermore, the information may be information indicating that persons handling the developing unit must not grasp the developing unit at a portion to which the label has been stuck.

In this case, the possibility is reduced that persons handling the developing unit, such as a user or the like, touch the memory unit, and it becomes possible to prevent the destruction of the memory unit more effectively.

Furthermore, information may be written that urges persons handling the developing unit to grasp the developing unit at a portion other than the portion to which the label has been stuck.

In this case, the possibility is reduced that persons handling the developing unit, such as a user or the like, touch the memory unit, and it becomes possible to prevent the destruction of the memory unit more effectively.

Furthermore, it is possible to realize a developing unit that can be mounted to and dismounted from an image forming apparatus main unit, the developing unit including: a memory unit including a memory; a label on which information relating to the developing unit is written, and that has been stuck to the developing unit so as to cover the memory unit; wherein the memory unit can communicate wirelessly with the image forming apparatus main unit side, when the developing unit is mounted to the image forming apparatus main unit; the developing unit is mounted to the image forming apparatus main unit by inserting it into the image forming apparatus main unit; the memory unit is provided on a downstream side, with respect to the insertion direction, of the developing unit; the memory unit is provided on a housing of the developing unit; the label is stuck to a surface of the housing, covering the memory unit; the memory unit is adhered to a surface of the housing; the housing includes an indentation; the memory unit is adhered to a surface of the indentation; the label is stuck to a portion of the housing outside of the indentation; a maximum thickness of the memory unit is smaller than a minimum depth of the indentation; an air layer is formed between a rear surface of the label and a surface of the memory unit on the side opposite to the adhesive surface; the information is information representing warning messages relating to the handling of that developing unit; the information is information cautioning persons handling that developing unit; the information is information indicating a supplier of that developing unit; a developer is contained in the developing unit; the information is information indicating the color of the developer; and the information is information indicating an inserting direction of the developing unit.

This way, almost all of the above-mentioned effects can be displayed, so that the object of the present invention is attained most effectively.

Furthermore, it is possible to realize an image forming apparatus including: an image forming apparatus main unit; and a developing unit that can be mounted to and dismounted from the image forming apparatus main unit, the developing unit including: a memory unit including a memory; and a label on which information relating to the developing unit is written, and that has been stuck to the developing unit so as to cover the memory unit.

With the foregoing image forming apparatus, it is possible to effectively prevent the destruction of memory unit, without increasing the number of parts.

Furthermore, it is also possible to realize an image forming system including: a computer; and an image forming apparatus that can be connected to the computer, the image forming apparatus including: an image forming apparatus main unit; and a developing unit that can be mounted to and dismounted from an image forming apparatus main unit, and that includes: a memory unit including a memory; and a label on which information relating to the developing unit is written, and that has been stuck to the developing unit so as to cover the memory unit.

With the foregoing image forming system, it is possible to effectively prevent the destruction of memory unit, without increasing the number of parts.

Furthermore, it is also possible to realize a photoconductor unit that can be mounted to and dismounted from an image forming apparatus main unit, the photoconductor unit including: a memory unit including a memory; and a label on which information relating to the developing unit is written, and that has been stuck to the developing unit so as to cover the memory unit.

With the foregoing photoconductor unit, it is possible to effectively prevent the destruction of memory unit, without increasing the number of parts.

Outline Of Image Forming Apparatus Of First Embodiment

Figure 1:
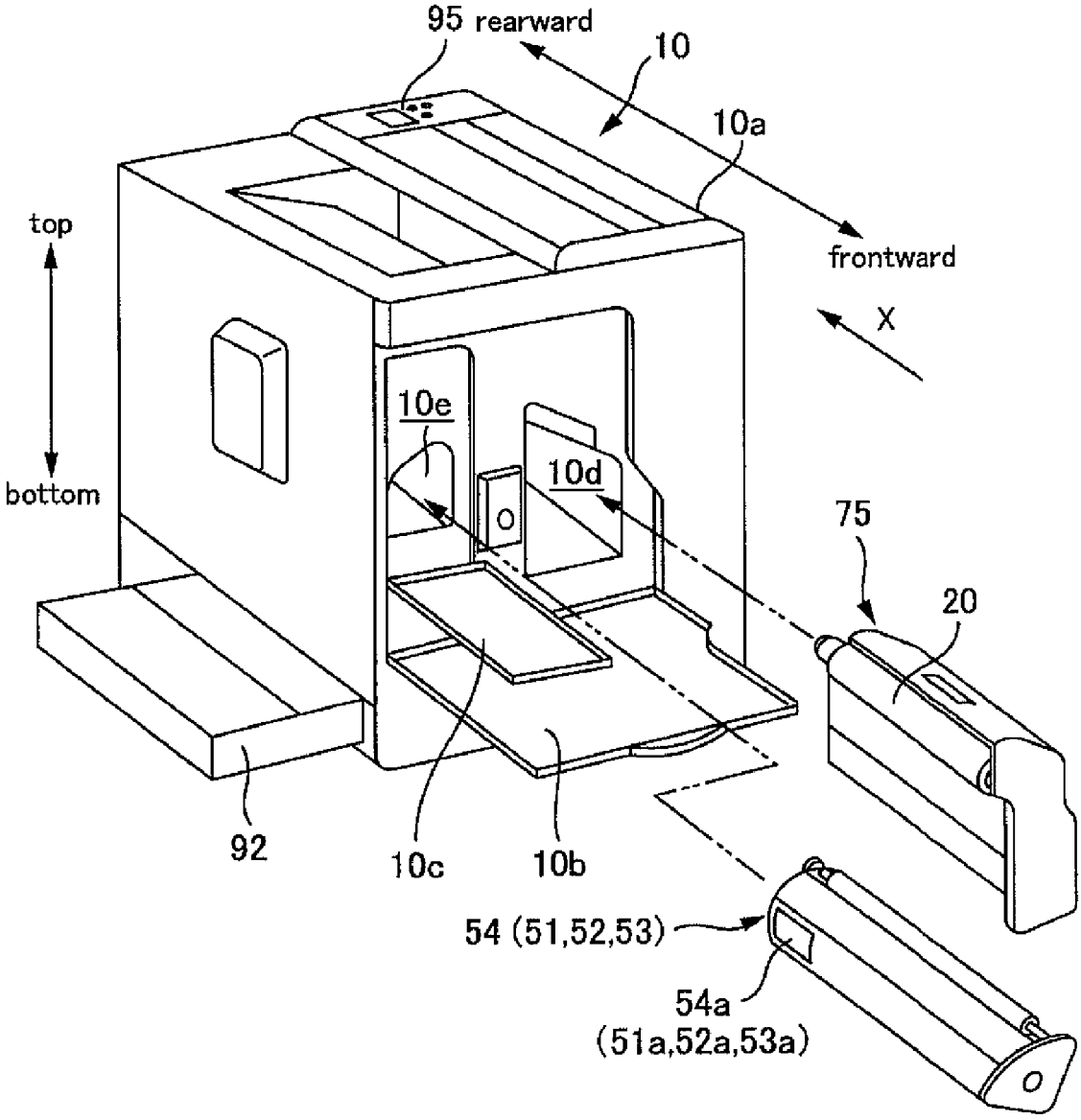
FIG. 1 is a diagram illustrating how developing containers 51, 52, 53 and 54 are mounted to and dismounted from a printer main unit 10*a*.
Figure 2:
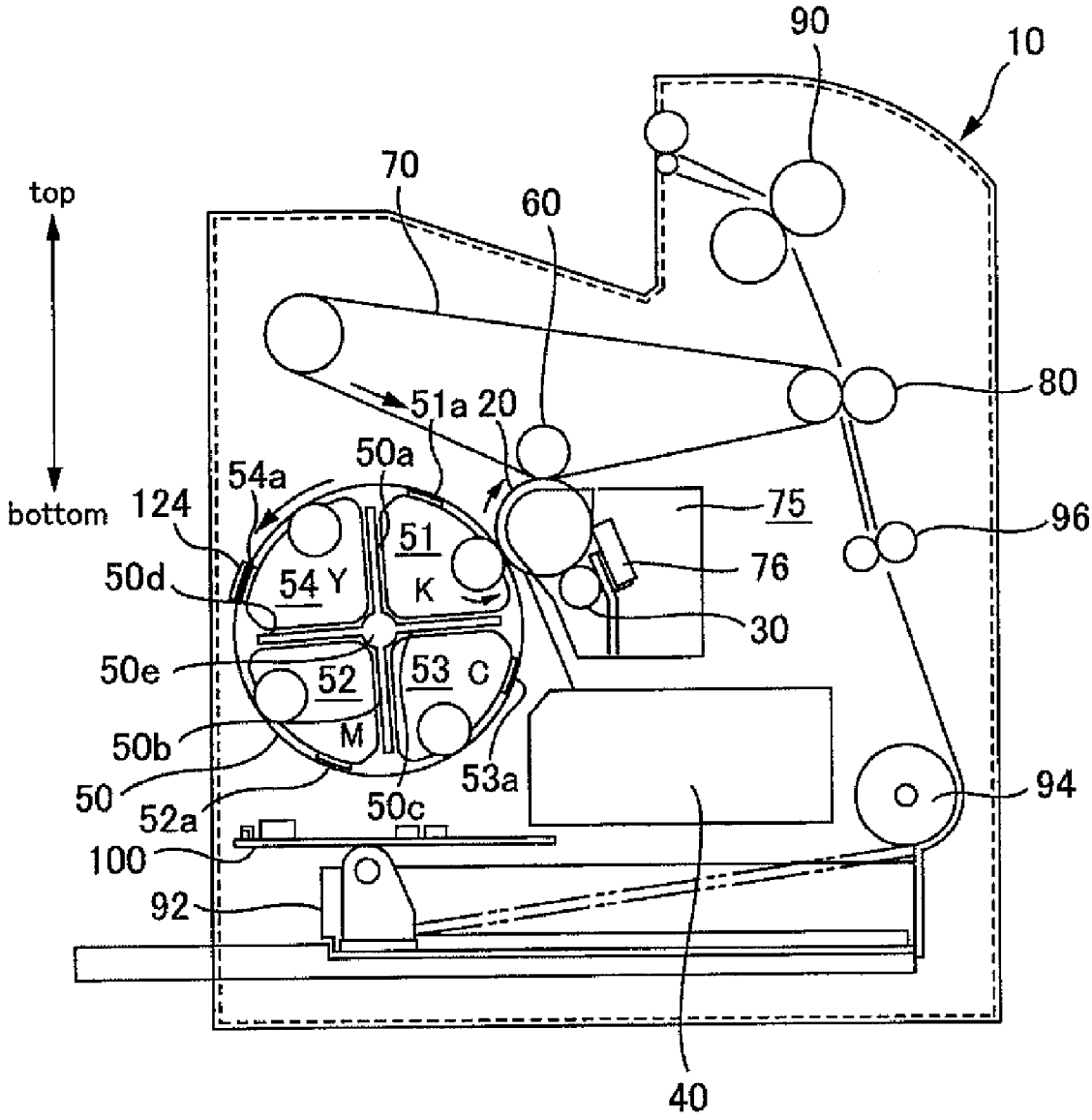
FIG. 2 is a diagram showing the main structural components constituting the printer 10.
Figure 3:
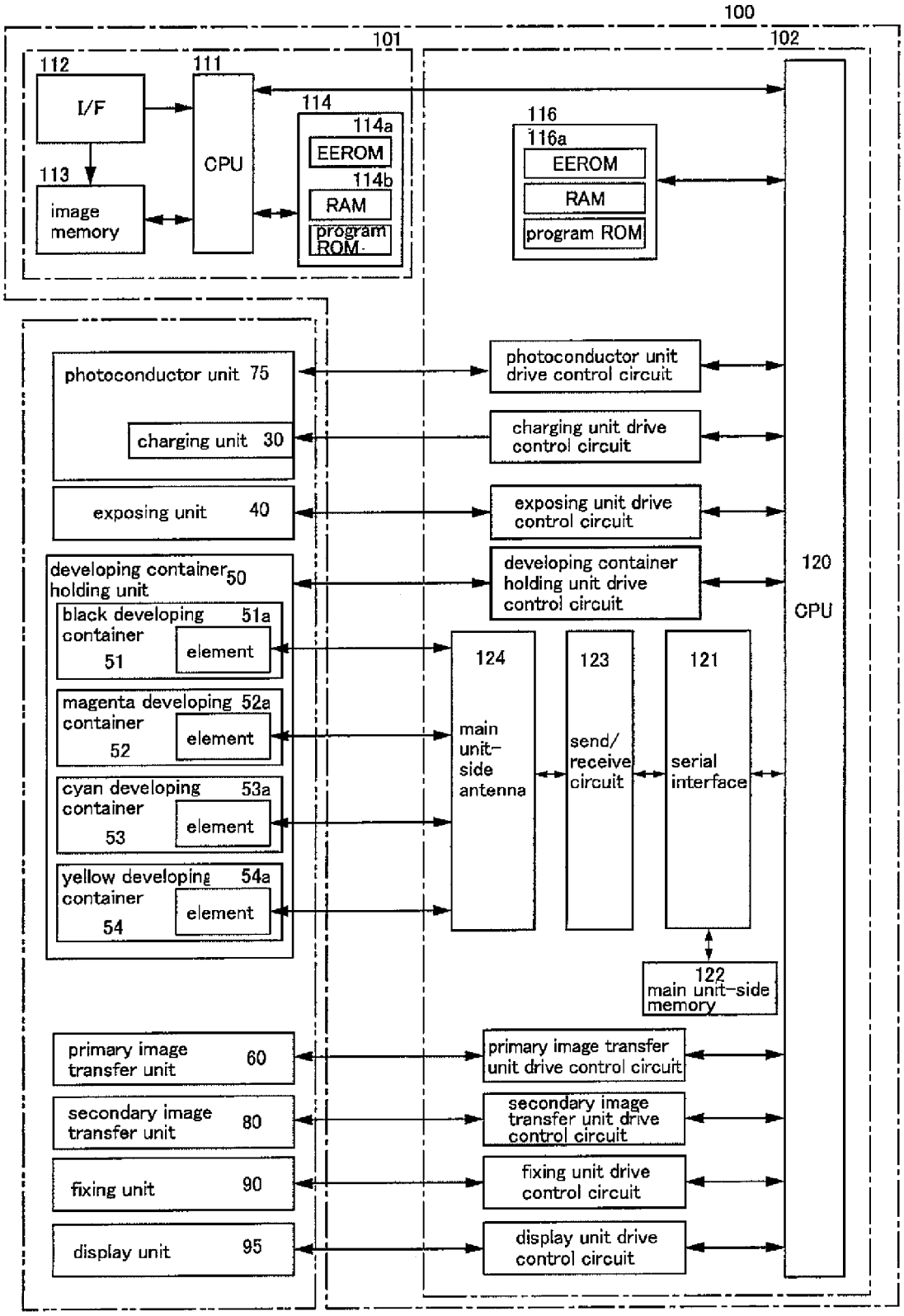
FIG. 3 is a block diagram showing the control unit 100 of the printer 10.
Figure 4:
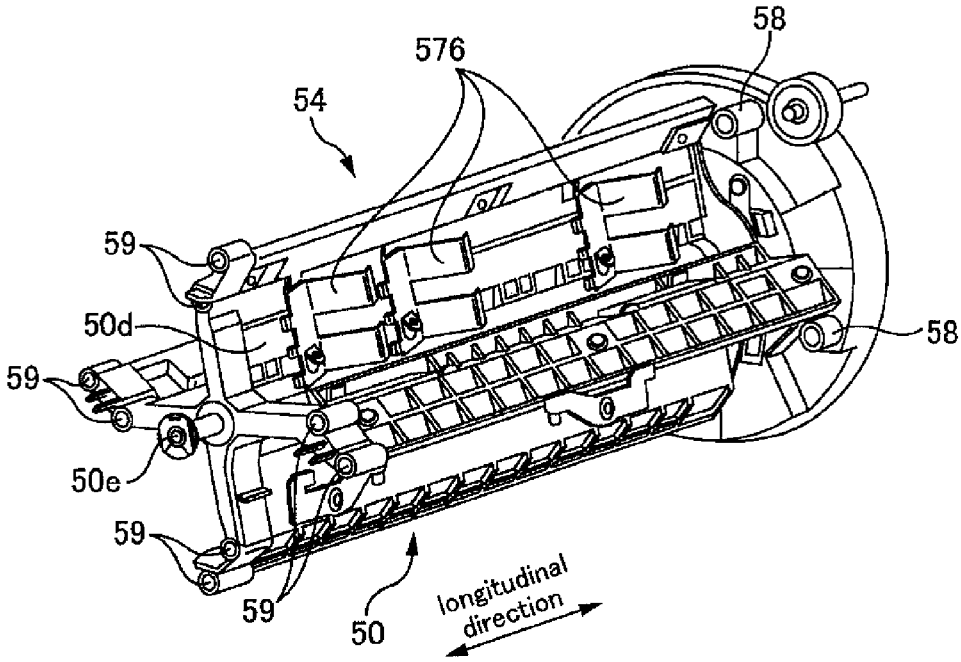
FIG. 4 is a perspective view of a developing container holding unit 50.
Figure 5:
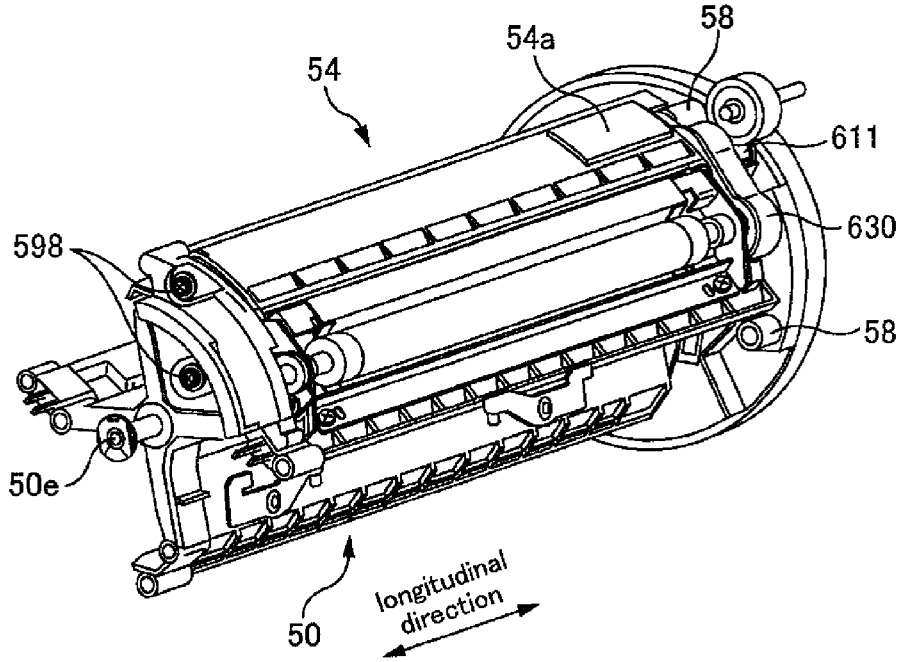
FIG. 5 is a diagram showing the developing container holding unit 50 in a state in which a yellow developing container 54 is mounted to a mounting and dismounting section 50*d*.

Referring to FIGS. 1 to 5, an overview of a laser beam printer (hereinafter, also referred to as "printer") 10 serving as an example of an image forming apparatus is described. FIG. 1 is a diagram illustrating how developing containers 51, 52, 53 and 54 are mounted to and dismounted from a printer main unit 10*a*. FIG. 2 is a diagram showing the main structural components constituting the printer 10. FIG. 3 is a block diagram showing the control unit 100 of the printer 10. FIG. 4 is a perspective view of a developing container holding unit 50. FIG. 5 is a diagram showing the developing container holding unit 50 in a state in which a yellow developing container 54 is mounted to a mounting and dismounting section 50*d*. It should be noted that FIG. 2 is a diagram of a cross section taken perpendicular to the X direction in FIG. 1. Also, the vertical direction is indicated by arrows in FIG. 1 and FIG. 2, and for example, a paper supply tray 92 is disposed at a lower part of the printer 10 and a fixing unit 90 is disposed at an upper part of the printer 10.

Mounting and Dismounting Configuration

Developing containers 51, 52, 53 and 54, which are examples of developing devices, and a photoconductor unit 75 can be mounted to and dismounted from a printer main unit 10*a*, which is an example of an image forming apparatus main unit. The printer 10 is configured by mounting the developing containers 51, 52, 53 and 54 and the photoconductor unit 75 to the printer main unit 10*a*.

The printer main unit 10*a* has a first opening cover 10*b* that can be opened and closed, a second opening cover 10*c* that can be opened and closed and that is provided further inward than the first opening cover 10*b*, a photoconductor unit mounting and dismounting opening 10*d* through which the photoconductor unit 75 can be mounted and dismounted, and a developing container mounting and dismounting opening 10*e* through which the developing containers 51, 52, 53 and 54 can be mounted and dismounted.

Here, by opening the first opening cover 10*b*, the user can mount and dismount the photoconductor unit 75 with respect to the printer main unit 10*a* through the photoconductor unit mounting and dismounting opening 10*d*. Furthermore, by opening the second opening cover 10*c*, the user can mount and dismount the developing containers 51, 52, 53 and 54 with respect to the printer main unit 10*a* through the developing container mounting and dismounting opening 10*e*.

Configuration of the Printer 10

The configuration of the printer 10 in a state in which the developing containers 51, 52, 53 and 54 and the photoconductor unit 75 are mounted to the printer main unit 10*a* is described.

As shown in FIG. 2, the printer 10 according to the present embodiment includes a charging unit 30, an exposing unit 40, a developing container holding unit 50, a primary image transfer unit 60, an intermediate image transfer member 70, and a cleaning blade 76. These units are arranged along the rotation direction of a photoconductor 20, which is an example of an image bearing member bearing a latent image. The printer 10 further includes a secondary image transfer unit 80, a fixing unit 90, a display unit 95 constituted by a liquid-crystal panel and serving as a means for giving notifications to the user, and a control unit 100 for controlling these units and managing the operations of the printer.

The photoconductor 20 has a hollow cylindrical conductive base and a photoconductive layer formed on the outer circumferential surface of the conductive base, and is rotatable around its center axis. In the present embodiment, the photoconductor 20 rotates clockwise, as indicated by the arrow in FIG. 2.

The charging unit 30 is a device for charging the photoconductor 20. The exposing unit 40 is a device for forming a latent image on the charged photoconductor 20 by irradiating a laser beam thereon. The exposing unit 40 includes, for example, a semiconductor laser, a polygon mirror, and an F-θ lens, and irradiates a modulated laser beam onto the charged photoconductor 20 in accordance with image signals that have been input from a host computer, not shown in the drawings, such as a personal computer or a word processor.

The developing container holding unit 50 is a device for developing the latent image formed on the photoconductor 20 using toner T, which is an example of a developer contained in developing containers 51, 52, 53 and 54, that is, black (K) toner contained in a black developing container 51, magenta (M) toner contained in a magenta developing container 52, cyan (C) toner contained in a cyan developing container 53, and yellow (Y) toner contained in a yellow developing container 54.

The developing container holding unit 50 includes four mounting and dismounting sections 50*a*, 50*b*, 50*c* and 50*d*, with respect to which the developing containers 51, 52, 53 and 54 can be mounted and dismounted, arranged in intervals of 90° in the circumferential direction. That is to say, the developing container holding unit 50 is provided with the mounting and dismounting section 50*a* with respect to which the black developing container 51 can be mounted and dismounted, the mounting and dismounting section 50*b* with respect to which the magenta developing container 52 can be mounted and dismounted, the mounting and dismounting section 50*c* with respect to which the cyan developing container 53 can be mounted and dismounted, and the mounting and dismounting section 50*d* with respect to which the yellow developing container 54 can be mounted and dismounted. The developing container holding unit 50 is provided with a rotation shaft 50*e*, and the mounting and dismounting sections 50*a*, 50*b*, 50*c* and 50*d* can be shifted through the rotation of this rotation shaft 50*e*.

In this embodiment, the position of the four developing containers 51, 52, 53 and 54 can be moved by shifting the mounting and dismounting sections 50*a*, 50*b*, 50*c* and 50*d*. That is to say, the four developing containers 51, 52, 53 and 54 can be rotated around the rotation shaft 50*e* while maintaining their relative positions. Then, when the developing containers 51, 52, 53 and 54 are mounted to the mounting and dismounting sections 50*a*, 50*b*, 50*c* and 50*d* and are moved to the developing position through the movement of the mounting and dismounting sections 50*a*, 50*b*, 50*c* and 50*d*, the latent image carried by the photoconductor 20 is developed with the toner contained in the respective developing containers 51, 52, 53 and 54. It should be noted that details of the developing containers are discussed later.

Moreover, as shown in FIG. 4, the mounting and dismounting sections 50*a*, 50*b*, 50*c* and 50*d* are each provided with coupling holes 59 into which coupling protrusions provided on a coupling member 590 (explained later) of the respective developing containers can be fitted. For example, as shown in FIG. 5, coupling pins 595*a* (explained later), which are an example of a coupling protrusion provided on the coupling member 590 of the yellow developing container 54 are fitted into the coupling holes 59 provided in the mounting and dismounting section 50*d*. Moreover, as shown in FIG. 5, the mounting and dismounting sections 50*a*, 50*b*, 50*c* and 50*d* are each provided with springs 576, which bias the developing container in the longitudinal direction. For example, the springs 576 provided on the mounting and dismounting section 50*d* bias the yellow developing container 54 in its longitudinal direction. Moreover, as shown in FIG. 4, the mounting and dismounting sections 50*a*, 50*b*, 50*c* and 50*d* are each provided with a positioning hole 58 into which a positioning pin 588 (explained later) provided to the respective developing containers can be fitted. For example, a positioning pin 588 provided on the yellow developing container 54 can be fitted into the positioning hole 58 provided on the mounting and dismounting section 50*d*.

The primary image transfer unit 60 is a device for transferring a single color toner image formed on the photoconductor 20 to the intermediate image transfer member 70. When the four toner colors are successively transferred over one another, a full color toner image is formed on the intermediate image transfer member 70. This intermediate image transfer member 70 is an endless belt that is rotatively driven at substantially the same circumferential velocity as the photoconductor 20.

The secondary image transfer unit 80 is a device for transferring a single color toner image or a full color toner image formed on the intermediate image transfer member 70 to a recording medium such as paper, film, or cloth. The fixing unit 90 is a device for fusing the single color toner image or the full color toner image that has been transferred to the recording medium on the recording medium, such as paper, making it a permanent image.

The cleaning blade 76 is made of rubber and is in contact with the surface of the photoconductor 20. The cleaning blade 76 scrapes off and removes toner remaining on the photoconductor 20, after the toner image has been transferred to the intermediate image transfer body 70 by the primary image transfer unit 60.

The photoconductor unit 75 is provided between the primary image transfer unit 60 and the exposing unit 40, and includes the photoconductor 20, the charging unit 30, the cleaning blade 76, and a waste toner container not shown in the drawings containing toner that has been scraped away by the cleaning blade 76.

The control unit 100 is made of a main controller 101 and a unit controller 102, as shown in FIG. 3. An image signal is input into the main controller 101, and in accordance with a command based on this image signal, the unit controller 102 controls the various units, for example, to form the image.

Operation of the Printer 10

The operation of the printer 10 configured as above is described below, referring to other structural components thereof as well.

First, when an image signal from a host computer not shown in the drawings is input into the main controller 101 of the printer 10 via an interface (I/F) 112, the photoconductor 20, developing rollers 510 provided in the developing containers 51, 52, 53 and 54, and the intermediate image transfer member 70 are rotated under the control of the unit controller 102 based on a command from the main controller 101. While rotating, the photoconductor 20 is successively charged by the charging unit 30 at a charging position.

The region of the photoconductor 20 that has been charged is brought to an exposure position through rotation of the photoconductor 20, and a latent image corresponding to image information of a first color, for example yellow Y, is formed at that region by the exposing unit 40. Moreover, the developing container holding unit 50 positions the yellow developing container 54 containing the yellow (Y) toner at the developing position opposite the photoconductor 20.

The latent image formed on the photoconductor 20 is brought to a developing position through the rotation of the photoconductor 20, and is developed with yellow toner by the yellow developing container 54. Thus, a yellow toner image is formed on the photoconductor 20.

The yellow toner image that is formed on the photoconductor 20 is brought to the primary image transfer position through rotation of the photoconductor 20 and is transferred to the intermediate image transfer member 70 by the primary image transfer unit 60. At this time, a primary image transfer voltage of a polarity that is opposite the toner charge polarity is applied to the primary image transfer unit 60. It should be noted that throughout this operation, the secondary image transfer unit 80 is removed from the intermediate image transfer member 70.

The above process is repeated for a second color, a third color, and a fourth color, thereby transferring toner images of four colors corresponding to various image signals layered over one another onto the intermediate image transfer member 70. Thus, a full color toner image is formed on the intermediate image transfer member 70.

The full color toner image that is formed on the intermediate image transfer member 70 is brought to the secondary image transfer position through the rotation of the intermediate image transfer member 70 and is transferred to a recording medium by the secondary image transfer unit 80. It should be noted that the recording medium is carried from the paper supply tray 92 to the secondary image transfer unit 80 via a paper supply roller 94 and registration rollers 96. Also, when performing the image transfer operation, the secondary image transfer unit 80 is pressed against the intermediate image transfer member 70 while applying a secondary image transfer voltage to it.

The fixing unit 90 heats and applies pressure to the full color toner image that has been transferred to the recording medium, thus fusing it to the recording medium. On the other hand, after the photoconductor 20 has passed the primary image transfer position, the toner adhering to its surface is scraped off by the cleaning blade 76 and it is provided with a charge for forming the next latent image. The toner that is scraped off is collected in the waste toner container.

Overview of the Control Unit

The configuration of the control unit 100 is described next, with reference to FIG. 3. The control unit 100 includes the main controller 101 and the unit controller 102.

The main controller 101 includes a CPU 111, an interface 112 for connection to a computer not shown in the drawings, an image memory 113 for storing image signals input from the computer, and a main controller-side memory 114 made of an EEPROM 114*a* that can be rewritten electrically, a RAM 114*b*, and a program ROM or the like in which a program for the various kinds of control is stored.

The CPU 111 of the main controller 101 controls the reading in and the reading out of image data that has been input via the interface into the image memory 113, and performs the control of the overall apparatus in synchronization with the CPU 120 of the unit controller 102 based on the control signals input from the computer.

The unit controller 102 includes the CPU 120, a unit controller-side memory 116 including an EEPROM 116*a* that can be rewritten electrically, a RAM, and a program ROM or the like in which a program for the various kinds of control is stored, as well as drive control circuits or the like for performing drive control of the various units of the entire device (the charging unit 30, the exposing unit 40, the developing container holding unit 50, the primary image transfer unit 60, the photoconductor unit 75, the secondary image transfer unit 80, the fixing unit 90 and the display unit 95).

The CPU 120 of the unit controller 102 is electrically connected to the various drive control circuits and controls the various drive control circuits in accordance with control signals from the CPU 111 of the main controller 101. That is to say, while the state of the units is detected by receiving signals from sensors or the like provided in each of the units, the units are controlled in accordance with signals input from the main controller 101.

Also, the CPU 120 provided in the unit controller 102 is connected to a non-volatile storage element (hereinafter, also referred to as "main unit-side memory") 122 such as a serial EEPROM via the serial interface (I/F) 121. This main unit-side memory 122 stores data that is necessary for the control of the apparatus.

Furthermore, the CPU 120 is capable of wirelessly communicating with elements 51*a*, 52*a*, 53*a*, and 54*a*, which are respectively provided in the developing containers 51, 52, 53, and 54, via the serial interface 121, a send-receive circuit 123, and a main unit-side antenna 124. During the wireless communication, the main unit-side antenna 124 writes information to the elements 51*a*, 52*a*, 53*a*, and 54*a* provided in the developing containers 51, 52, 53, and 54, respectively. The main unit-side antenna 124 is also capable of reading information from the elements 51*a*, 52*a*, 53*a*, and 54*a* provided in the developing containers 51, 52, 53, and 54, respectively.

Overview of the Developing containers

Figure 6:
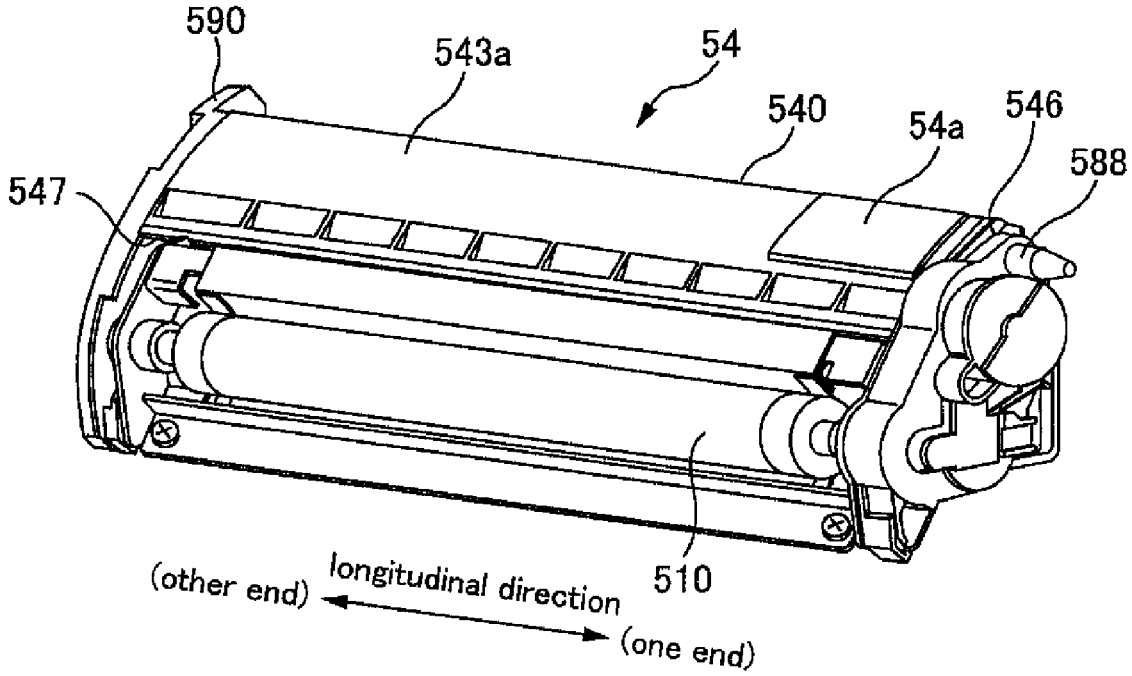
FIG. 6 is a perspective view of the yellow developing container 54.
Figure 7:
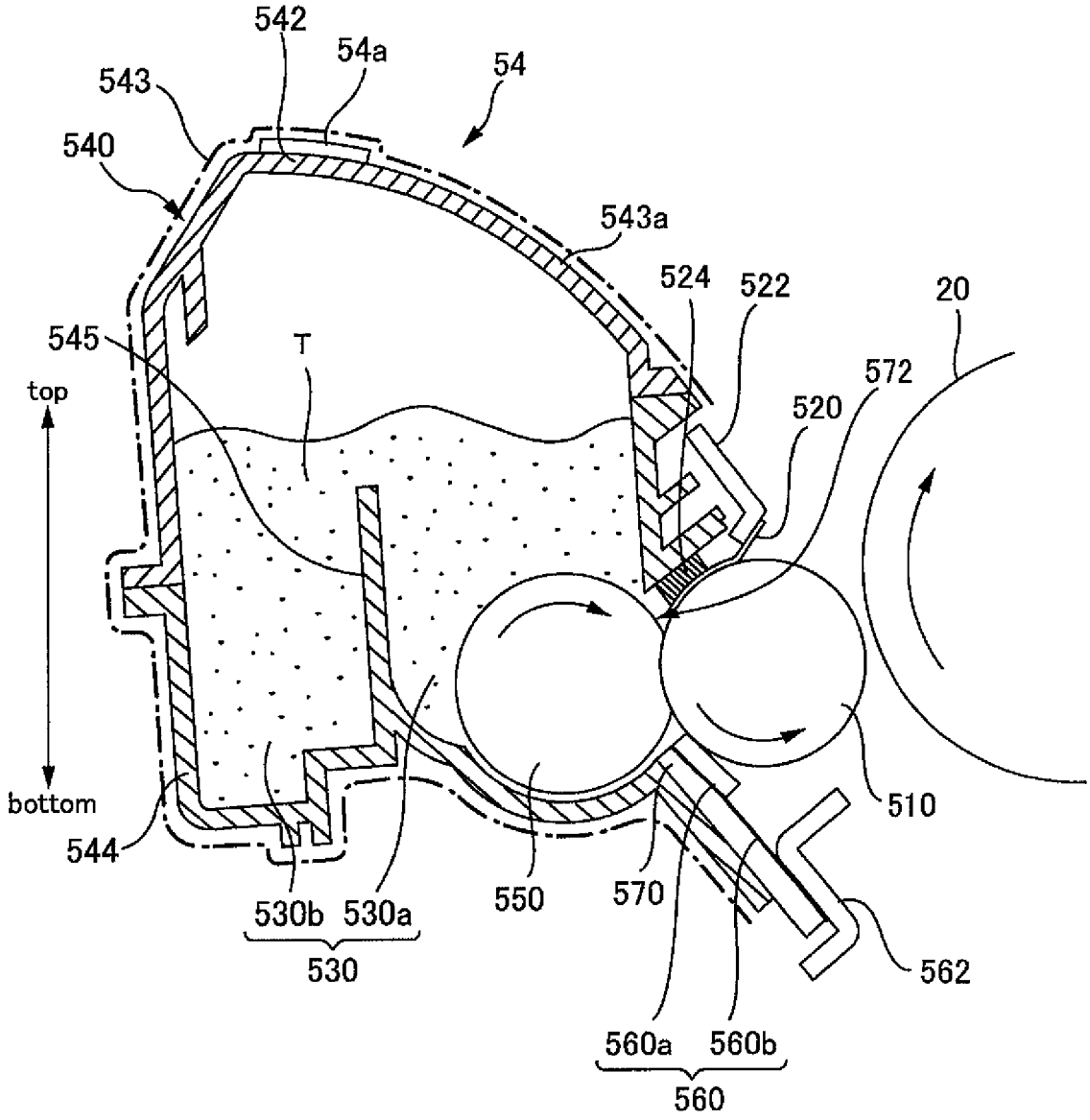
FIG. 7 is a cross-sectional view showing the main structural components of the yellow developing container 54.
Figure 8:
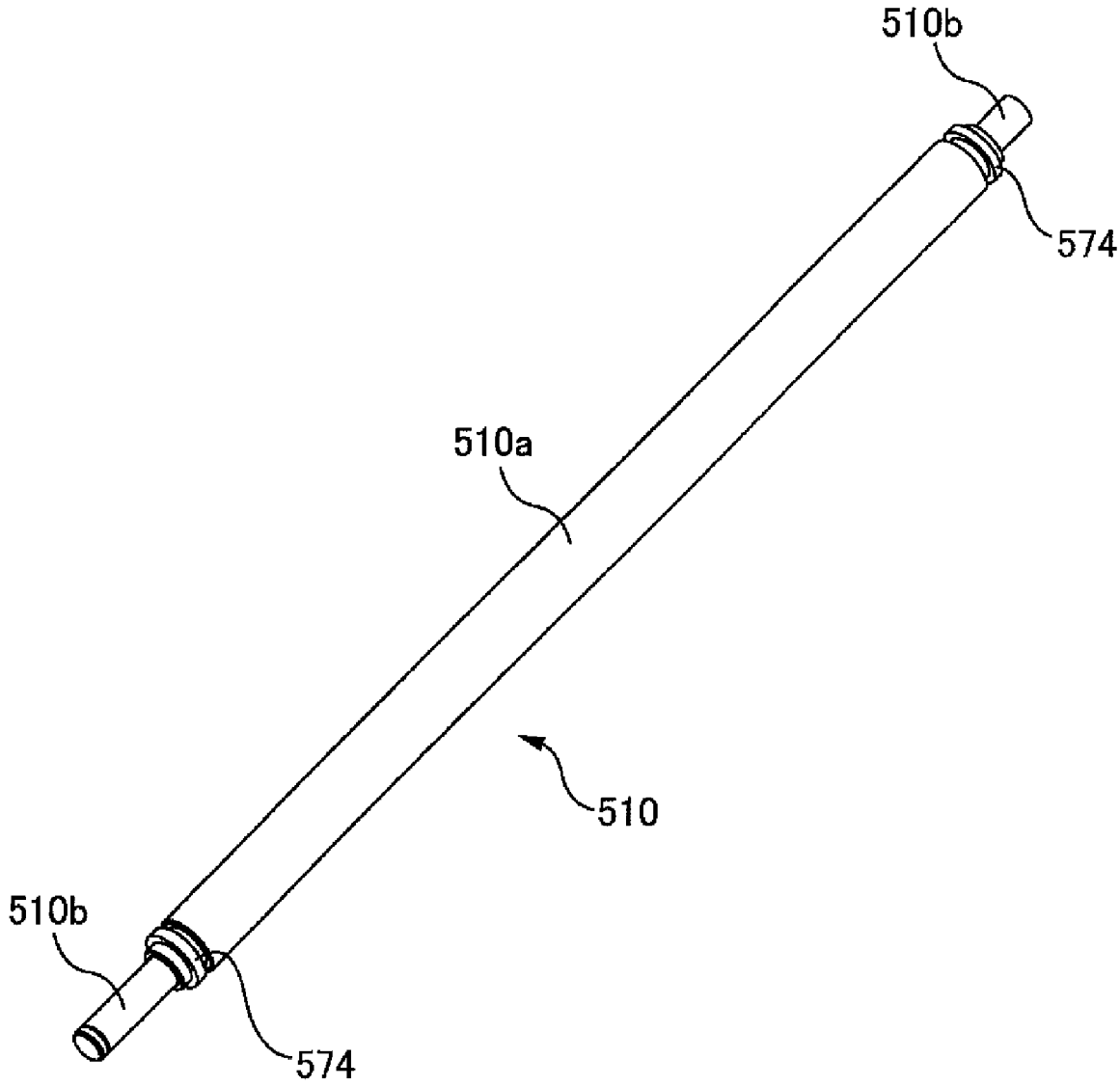
FIG. 8 is a perspective view of a developing roller 510 provided with rolls 574.
Figure 9:
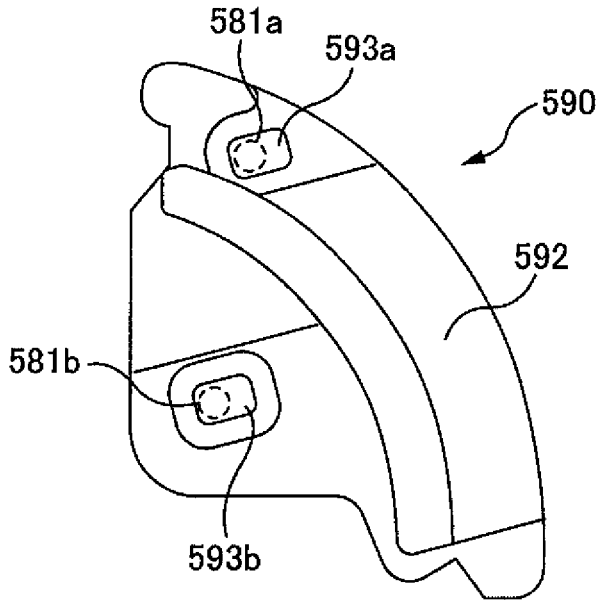
FIG. 9 is a front view of the coupling member 590.
Figure 10:
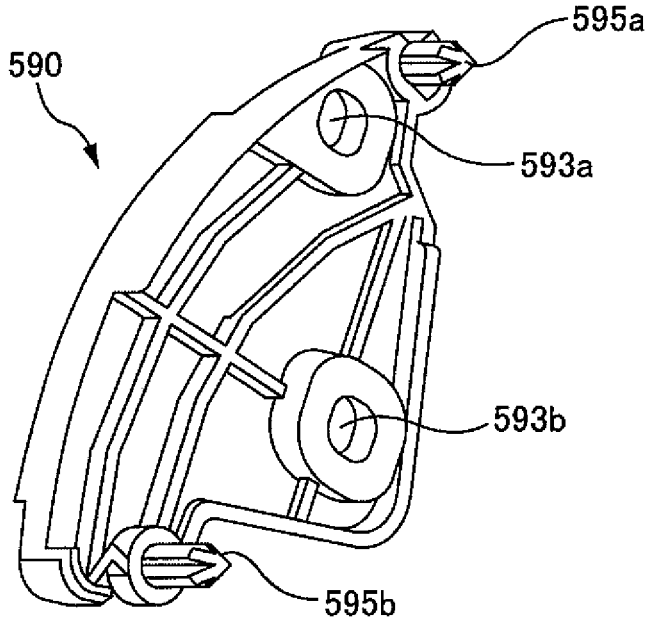
FIG. 10 is a perspective view showing the rear side of the coupling member 590.

The configuration and operation of the developing containers 51, 52, 53, and 54 is explained next, using FIG. 6 to FIG. 10. FIG. 6 is a perspective view of the yellow developing container 54. FIG. 7 is a cross-sectional view showing the main structural components of the yellow developing container 54. FIG. 8 is a perspective view of a developing roller 510 provided with rolls 574. FIG. 9 is a front view of the coupling member 590. FIG. 10 is a perspective view showing the rear side of the coupling member 590. It should be noted that the cross-sectional view in FIG. 7 shows a cross section of the yellow developing container 54 taken along a plane that is perpendicular to the longitudinal direction shown in FIG. 6. Moreover, in FIG. 7, like in FIG. 1, the vertical direction is indicated by arrows, and for example, the center axis of the developing roller 510 is lower than the center axis of the photoconductor 20. Also, in FIG. 7, the yellow developing container 54 is shown positioned at a developing position that is in opposition to the photoconductor 20.

The black developing container 51 containing black (K) toner, the magenta developing container 52 containing magenta (M) toner, the cyan developing container 53 containing cyan (C) toner and the yellow developing container 54 containing yellow (Y) toner can be mounted to the developing container holding unit 50, but since the configuration and the operation of each of the developing containers is the same, explanations are given only for the yellow developing container 54 in the following.

Internal Configuration of the Yellow Developing Container 54

First, the configuration of the yellow developing container 54 is described. The yellow developing container 54 includes the developing roller 510, which is an example of a developer bearing member, a toner containing section 530, a housing 540 containing toner T, a toner supply roller 550, a regulating blade 560, a sealing member 520, a positioning shaft (also referred to as "positioning pin" in this embodiment) 588 serving as an example of a positioning member and a coupling member 590.

The developing roller 510 bears toner T and carries it to the developing position opposite the photoconductor 20, and develops the latent image carried by the photoconductor 20 with the toner T carried to the developing position. This developing roller 510, which is made of metal, is fabricated from an aluminum alloy, such as 5056 aluminum alloy or 6063 aluminum alloy, or an iron alloy such as STKM, and may be nickel-plated or chromium-plated if necessary. As shown in FIG. 8, the developing roller 510 includes a large-diameter section 510*a* and axle sections 510*b*.

Moreover, as shown in FIG. 6, the developing roller 510 is supported by the housing 540 at its two ends in longitudinal direction, that is, at the axle section 510*b*, and can be rotated around its center axis. As shown in FIG. 7, the developing roller 510 rotates in a direction (the counterclockwise direction in FIG. 7) that is opposite to the rotation direction of the photoconductor 20 (the clockwise direction in FIG. 7). Its center axis is lower than the center axis of the photoconductor 20.

Also, as shown in FIG. 7, in a state where the yellow developing container 54 is in opposition to the photoconductor 20, there is a gap between the developing roller 510 and the photoconductor 20. That is to say, the yellow developing container 54 develops the latent image formed on the photoconductor 20 in a noncontacting manner. It should be noted that during the development of the latent image formed on the photoconductor 20, an alternating electric field is formed between the developing roller 510 and the photoconductor 20.

Furthermore, as shown in FIG. 8, rolls 574, which are an example of distance holding members, are formed on both ends in longitudinal direction of the developing roller 510. When the developing containers 51, 52, 53 and 54 are positioned in the developing position, these rolls 574 have the function of coming into contact with the photoconductor 20 and thereby holding a distance between the photoconductor 20 and the developing roller 510. The rolls 574 are supported by the axle sections 510*b*. The outer diameter of the rolls 574 is larger than the outer diameter of the large-diameter section 510*a*. Therefore, the rolls 574 are able to hold a distance between the photoconductor 20 and the developing roller 510.

The sealing member 520 prevents the toner T in the yellow developing container 54 from leaking to the outside, and also collects toner T on the developing roller 510, after it has passed the developing position, into the developing container without scraping it off. This sealing member 520 is a seal made of polyethylene film or the like. The sealing member 520 is supported by a seal support metal plate 522, and is attached to the housing 540 via the seal support metal plate 522. Furthermore, a seal biasing member 524 made of Moltopren or the like is provided on the side of the sealing member 520 that is opposite to its developing roller 510 side, and due to the elasticity of the seal biasing member 524, the sealing member 520 is pressed against the developing roller 510. It should be noted that the contact position where the sealing member 520 contacts the developing roller 510 is above the center axis of the developing roller 510.

The housing 540 is fabricated by welding together a plurality of integrally molded housing sections, namely an upper housing section 542 and a lower housing section 544. A partitioning wall 545 for partitioning the toner T that protrudes (vertically in FIG. 7) from the inner wall to the inside partitions the inside of the housing 540 into two toner containing sections 530, namely a first toner containing section 530*a* and a second toner containing section 530*b*. It should be noted that the housing 540 has a housing opening 572 at its bottom, and is arranged such that a portion of the developing roller 510 is exposed in this housing opening 572. Moreover, an element 54*a* is attached to the housing 540. The configuration of this element 54*a* and the position at which it is attached to the housing 540 are explained later.

Attachment protrusions 581*a* and 581*b* (see FIG. 9) are provided on a side wall 547 of the housing 540 at the other end side in the longitudinal direction. The attachment protrusion 581*a* can be fitted into an attachment hole 593*a* of the later-explained coupling member 590, and the attachment protrusion 581*b* can be fitted into an attachment hole 593*b* of the coupling member 590. The attachment protrusions 581*a* and 581*b* have a circular cross section.

Moreover, the toner containing section 530 may be provided with a stirring member for stirring the toner T, but in the present embodiment, the developing containers (the black developing container 51, the magenta developing container 52, the cyan developing container 53 and the yellow developing container 54) rotate with the rotation of the developing container holding unit 50, and this stirs the toner T inside the developing containers, so that the toner containing section 530 is not provided with a stirring member.

The toner supply roller 550 is provided in the above-mentioned first toner containing section 530*a* and not only supplies toner T that is contained in this first toner containing section 530*a* to the developing roller 510, but also scrapes off, from the developing roller 510, toner T that has remained on the developing roller 510 after developing. The toner supply roller 550 is made of polyurethane foam, for example, and abuts against the developing roller 510 in a state of elastic deformation. The toner supply roller 550 is disposed at the bottom of the toner containing section 530, and the toner T contained in the containing section 530 is supplied to the developing roller 510 by this toner supply roller 550 at the bottom of the toner containing section 530. The toner supply roller 550 rotates in a direction (the clockwise direction in FIG. 6) that is opposite the rotation direction of the developing roller 510 (the counterclockwise direction in FIG. 6). Its center axis is lower than the rotation center axis of the developing roller 510.

The regulating blade 560 applies a charge to the toner T borne on the developing roller 510 and regulates the layer thickness of the toner T borne on the developing roller 510. The regulating blade 560 includes a rubber part 560*a* and rubber supporting part 560*b*. The rubber part 560*a* is made of silicone rubber or urethane rubber, for example, and the rubber supporting part 560*b* is a thin plate of phosphor bronze or stainless steel, for example, and has elasticity. The rubber part 560*a* is supported by the rubber supporting part 560*b*, and the rubber supporting part 560*b* is attached to the housing 540 via a blade support metal plate 562, with one end of the rubber supporting part 560*b* being supported by the blade support metal plate 562. Also, a blade backing member 570 made of Moltopren or the like is provided on the side of the regulating blade 560 that is opposite the side of the developing roller 510.

Here, the rubber part 560*a* is pressed against the developing roller 510 by the elastic force due to the bending of the rubber supporting part 560*b*. The blade backing member 570 prevents the toner T from entering in between the rubber supporting part 560*b* and the housing 540, and stabilizes the elasticity due to the bending of the rubber supporting part 560*b* while pressing the rubber part 560*a* against the developing roller 510 by urging the rubber part 560*a* toward the developing roller 510 from directly behind the rubber part 560*a*. Consequently, the blade backing member 570 makes the contact of the rubber part 560*a* with the developing roller 510 more uniform.

The end of the regulating blade 560 on the side opposite the side supported by the blade support metal plate 562, that is, its front end, is not in contact with the developing roller 510, and a portion thereof removed from this front end by a predetermined distance is in contact with the developing roller 510 over a certain width. That is to say, the regulating blade 560 does not come into contact with the developing roller 510 at its edge but rather at a mid section thereof. Also, the regulating blade 560 is disposed such that its front end is facing upstream with respect to the direction in which the developing roller 510 rotates, and is in so-called counter contact. It should be noted that the contact position where the regulating blade 560 contacts the developing roller 510 is below the center axis of the developing roller 510 and is below the center axis of the toner supply roller 550.

Configuration of the Positioning Member

The following is a description of the configuration of the positioning pin 588. As shown in FIG. 6, the positioning pin 588 is provided on one end in longitudinal direction of the yellow developing container main unit, which is an example of a developing device main unit. It should be noted that "yellow developing container main unit" refers to those parts of the yellow developing container 54 excluding the positioning pin 588, the coupling member 590 and the element 54*a*.

This positioning pin 588 has the function of positioning the yellow developing container main unit with respect to the mounting and dismounting section 50*d* by engaging the mounting and dismounting section 50*d*, or more specifically by fitting into the positioning hole 58 provided on the mounting and dismounting section 50*d*, as shown in FIG. 5, when the yellow developing container 54 is mounted to the mounting and dismounting section 50*d*.

Moreover, the positioning pin 588, which is made of metal, is arranged such that its axial direction extends in the longitudinal direction of the developing container main unit. One end of the positioning pin 588 is fixed to a side wall 546 on one side in longitudinal direction of the housing 540. The other end of the positioning pin 588 is tapered, so that it can be easily fitted into the positioning hole 58 of the mounting and dismounting section.

Configuration of the Coupling Member

The configuration of the coupling member 590 is described next. As shown in FIG. 6, the coupling member 590 is attached to the other end side in the longitudinal direction of the yellow developing container main unit.

As shown in FIG. 10, the coupling member 590 is provided with coupling pins 595*a* and 595*b*, which are an example of coupling protrusions that can be fitted into the coupling holes 59 of the mounting and dismounting section 50*d*. When the yellow developing container 54 is mounted to the mounting and dismounting section 50*d*, the coupling pins 595*a* and 595*b* are fitted into the coupling holes 59 provided in the mounting and dismounting section 50*d*. Thus, when the yellow developing container 54 is mounted to the mounting and dismounting section 50*d*, the coupling member 590 is coupled to the mounting and dismounting section 50*d*. It should be noted that when the coupling member 590 is coupled to the mounting and dismounting section 50*d*, the movement of the coupling member 590 with respect to the mounting and dismounting section 50*d* is restricted.

Furthermore, as shown in FIG. 9, the coupling member 590 includes an attachment hole 593*a* into which the attachment protrusion 581*a* provided on the side wall 547 on the other end in longitudinal direction of the housing 540 can be fitted, and an attachment hole 593*b* into which the attachment protrusion 581*b* can be fitted. When the attachment protrusion 581*a* is fitted into the attachment hole 593*a* and the attachment protrusion 581*b* is fitted into the attachment hole 593*b*, the coupling member 590 is attached to the side wall on the other end side in the longitudinal direction of the housing 540, by stopping screws 598 via the coupling member 590 with respect to screw holes provided in the attachment protrusion 581*a* and the attachment protrusion 581*b*, as shown in FIG. 5.

Moreover, as shown in FIG. 9, the attachment hole 593*a* and the attachment hole 593*b* have an elliptical cross section. The attachment hole 593*a* and the attachment hole 593*b* are provided such that the directions of the major axes of the elliptical cross sections are the same direction. Moreover, as noted above, the cross section of the attachment protrusion 581*a* is circular. Consequently, the attachment hole 593*a* allows movement of the attachment protrusion 581*a*, which is fitted into the attachment hole 593*a*, within the attachment hole 593*a*. Similarly, the attachment hole 593*b* allows movement of the attachment protrusion 581*b*, which is fitted into the attachment hole 593*b*, within the attachment hole 593*b*.

That is to say, the attachment hole 593*a* allows movement of the attachment protrusion 581*a* within the attachment hole 593*a* in the direction of the major axis of its elliptical cross section, and the attachment hole 593*b* allows movement of the attachment protrusion 581*b* within the attachment hole 593*b* in the direction of the major axis of its elliptical cross section. It should be noted that the movement of the attachment protrusion 581*a* within the attachment hole 593*a* and the movement of the attachment protrusion 581*b* within the attachment hole 593*b* occur at the same timing. Thus, the coupling member 590 is attached in such a manner that its relative position to the developing container main unit can be changed.

Operation of the Yellow Developing Container 54

Next, the operation of the yellow developing container 54 is described. In the yellow developing container 54 configured in this manner, the toner T that is contained in the toner containing section 530 is supplied to the developing roller 510 by rotating the toner supply roller 550.

As the developing roller 510 rotates, the toner T that is supplied to the developing roller 510 is brought to the contact position of the regulating blade 560, and when it passes that contact position, the layer thickness of the toner T is regulated, and a charge is applied to it. The toner T on the developing roller 510, whose layer thickness has been regulated and which has been charged, is brought to the developing position in opposition to the photoconductor 20 by further rotation of the developing roller 510, and is supplied for the development of the latent image formed on the photoconductor 20 in an alternating electric field at the developing position.

The toner T on the developing roller 510 that has passed the developing position due to further rotation of the developing roller 510 passes the upper sealing member 520 and is collected in the developing device without being scraped off by the upper sealing member 520. Moreover, the toner T that still remains on the developing roller 510 is stripped off by the toner supply roller 550.

Figure 11A:
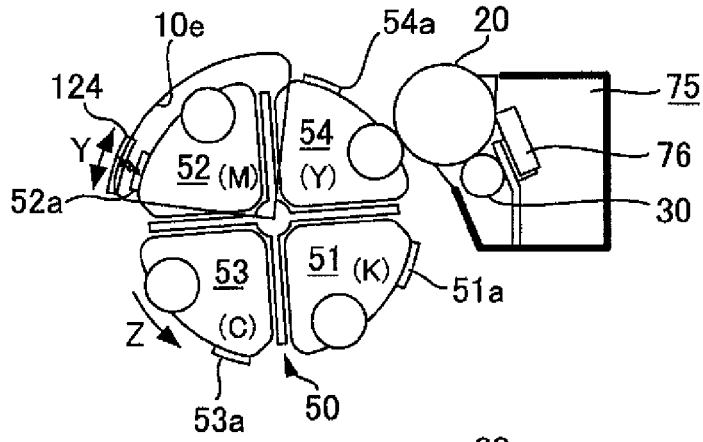
FIG. 11A is a diagram showing the developing container holding unit 50 in a state where the yellow developing container 54 is positioned at the developing position.
Figure 11B:
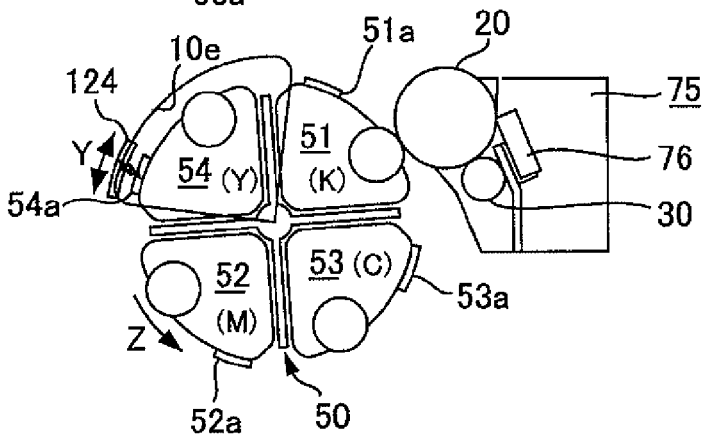
FIG. 11B is a diagram showing the developing container holding unit 50 in a state where the yellow developing container 54 is positioned at the communication position.
Figure 11C:
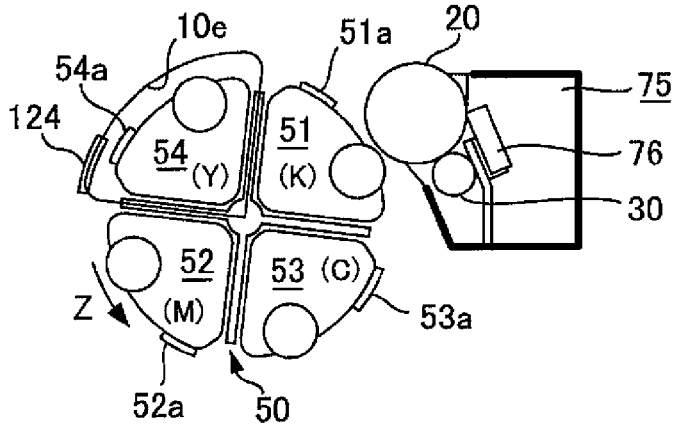
FIG. 11C is a diagram showing the developing container holding unit 50 in a state where the yellow developing container 54 is positioned at the mounting and dismounting position.
Figure 11D:
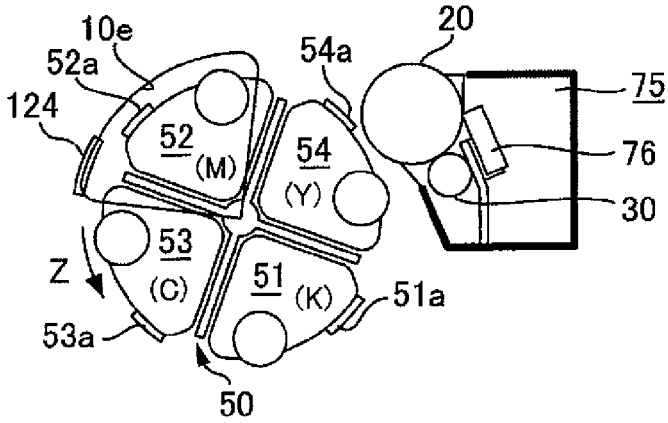
FIG. 11D is a diagram showing a state where the developing container holding unit 50 is positioned in its home position.

The Developing Position, Communication Position and Mounting and Dismounting Position of the Developing Containers As mentioned above, the developing containers 51, 52, 53 and 54 are moved together with the movement of the mounting and dismounting sections 50*a*, 50*b*, 50*c* and 50*d*. At that time, the mounting and dismounting sections are moved such that the developing containers are positioned in predetermined positions. Such predetermined positions are the developing position, serving as a first position, the communication position, serving as a second position, and the mounting and dismounting position. Since the developing position, the communication position and the mounting and dismounting position of each of the developing containers are the same, the developing position, the communication position and the mounting and dismounting position of the yellow developing container 54 are explained in the following with reference to FIGS. 11A to 11D. FIG. 11A is a diagram showing the developing container holding unit 50 in a state where the yellow developing container 54 is positioned at the developing position. FIG. 11B is a diagram showing the developing container holding unit 50 in a state where the yellow developing container 54 is positioned at the communication position. FIG. 11C is a diagram showing the developing container holding unit 50 in a state where the yellow developing container 54 is positioned at the mounting and dismounting position. FIG. 11D is a diagram showing a state where the developing container holding unit 50 is positioned in its home position.

In the state shown in FIG. 11A, the yellow developing container 54 is positioned at the developing position in which the developing roller 510 is in opposition to the photoconductor 20. In this state, the developing roller 510 is able to develop the latent image borne on the photoconductor 20. In the state in which the yellow developing container 54 is positioned in the developing position, as noted above, the springs 576 provided in the mounting and dismounting section 50*d* bias the yellow developing container main unit in its longitudinal direction. Due to this spring force of the springs 576, the rolls 574 come into contact with the photoconductor 20. It should be noted that when the photoconductor 20 is installed in a slanted manner with respect to the printer main unit 10*a*, then the yellow developing container main unit moves with respect to the coupling member 590 when the yellow developing container 54 is positioned in the developing position, that is, the attachment protrusion 581*a* of the yellow developing container main unit moves in the major axis direction within the attachment hole 593*a* of the coupling member and the attachment protrusion 581*b* of the yellow developing container main unit moves in the major axis direction within the attachment hole 593*b* of the coupling member 590, so that the rolls 574 with which the yellow developing container main unit is provided abut suitably against the photoconductor 20. During this, the relative position of the developing container main unit and the coupling member 590 is changed in accordance with the spring force of the springs 576. It should be noted that in a state in which the yellow developing container 54 is positioned in the developing position, the magenta developing container 52 is positioned in the communication position.

Furthermore, when the developing container holding unit 50 is rotated for a predetermined angle in Z-direction in FIG. 11A from the state shown in FIG. 11A around its rotation shaft 50*e*, then the state shown in FIG. 11B is achieved. In the state shown in FIG. 11B, the yellow developing container 54 is positioned in the communication position. In this state, the element 54*a* provided on the yellow developing container 54 opposes the main unit-side antenna 124 in a noncontacting manner. This element 54*a* is capable of communication with the main unit-side antenna 124. Furthermore, when the yellow developing container 54 is positioned in the communication position, the rolls 574 of the yellow developing container 54 do not come into contact with members on the side of the printer main unit 10*a*. It should be noted that when the yellow developing container 54 is positioned in the communication position, the black developing container 51 is positioned in the developing position. Therefore, the communication between the main unit-side antenna 124 and the element can take place while the black developing container 51 develops the latent image borne on the photoconductor 20.

Furthermore, when the developing container holding unit 50 is rotated around its rotation shaft 50*e* for a predetermined angle in Z-direction in FIG. 11B from the state shown in FIG. 11B, then the state shown in FIG. 11C is achieved. In the state shown in FIG. 11C, the yellow developing container 54 is positioned in the mounting and dismounting position. In this state, the yellow developing container 54 can be mounted and dismounted via the developing container mounting and dismounting opening 10*e*, that is, the yellow developing container 54 can be mounted to the mounting and dismounting section 50*d* or it can be dismounted from the mounting and dismounting section 50*d*.

It should be noted that after the power source of the printer main unit 10*a* has been turned on and an initialization operation has been performed, and before the printer 10 forms an image, the developing container holding unit 50 is positioned in the home position shown in FIG. 11D.

Configuration of the Element

Figure 12:
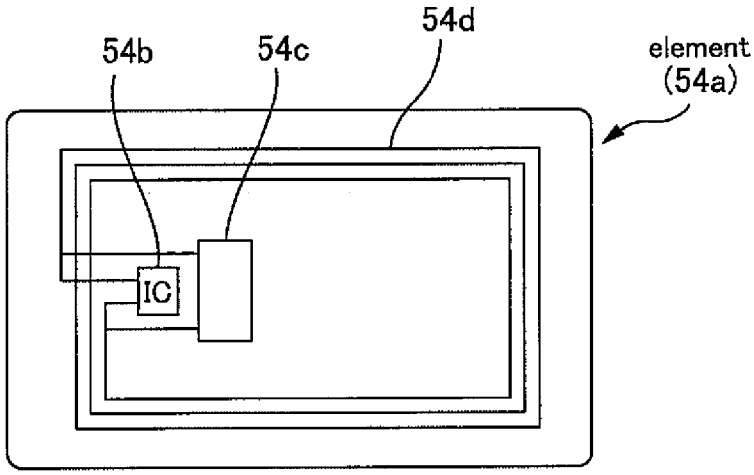
FIG. 12 is a plan transparent view showing the configuration of the element.
Figure 13:
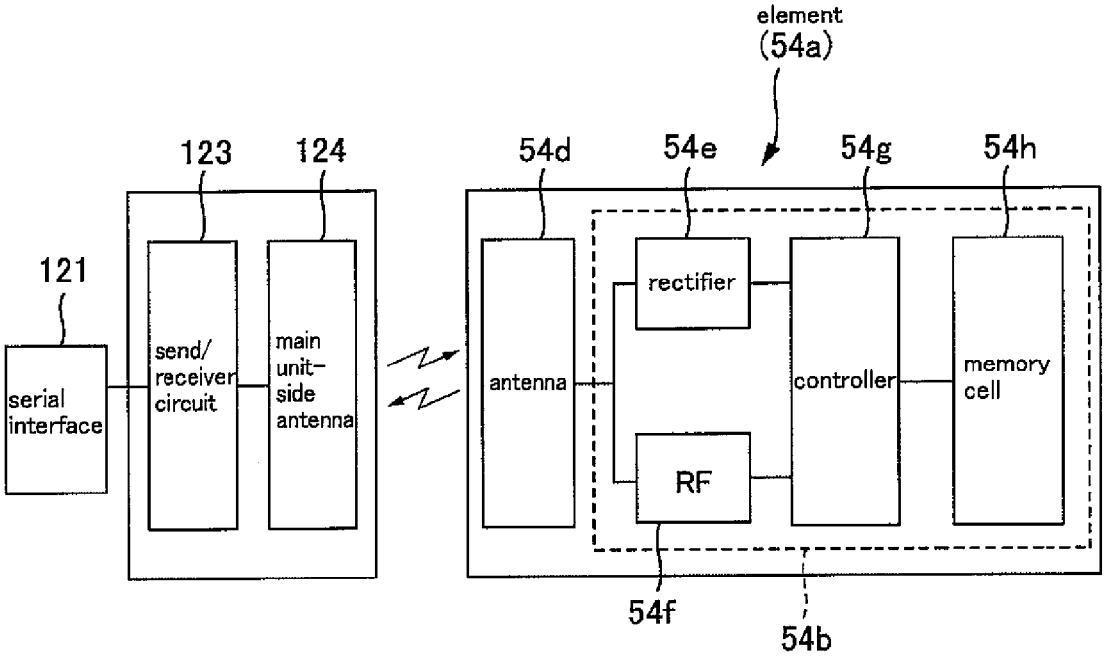
FIG. 13 is a block diagram illustrating the internal configuration of the element and the send/receive section.

The configuration of the element provided in the developing container as well as the configuration for sending and receiving data is described next with reference to FIG. 12, FIG. 13 and FIG. 14. FIG. 12 is a plan transparent view showing the configuration of the element. FIG. 13 is a block diagram illustrating the internal configuration of the element and the send/receive section. FIG. 14 is a diagram illustrating the information stored in a memory cell 54*h* of the element 54*a*.

The developing containers 51, 52, 53 and 54 are each provided with an element, but the configuration of the elements provided in the developing containers and the positions at which the elements are attached to the developing container main units are the same, so that in the following, the element 54*a* attached to the yellow developing container 54 is explained as an example.

When the yellow developing container 54 is mounted to the mounting and dismounting section 50*d*, the element 54*a* can communicate with the printer main unit 10*a* in a noncontacting manner. As mentioned above, the yellow developing container 54 is moved together with the movement of the mounting and dismounting section 50*d*. When the yellow developing container 54 has been moved to the communication position, which is different from the developing position, the element 54*a* communicates in a noncontacting manner with the main unit-side antenna 124 with which the printer main unit 10*a* is provided. The element 54*a* is provided further inward than the main unit-side antenna 124 with respect to the radial direction of the rotation of the developing container holding unit 50. It should be noted that the main unit-side antenna 124 is provided such that its longitudinal direction (Y direction in FIG. 11B) extends in the rotation direction of the developing container holding unit 50 (Z direction in FIG. 11B).

As shown in FIG. 6, the element 54*a* is provided between the positioning pin 588 and the coupling member 590 in the longitudinal direction of the yellow developing container main unit on the side of the positioning pin 588, that is, on one side in longitudinal direction of the yellow developing container unit. More specifically, the element 54*a* is provided near the side wall 546 at one end in the longitudinal direction of the yellow developing container main unit.

Moreover, the element 54*a* is attached to an outer surface 543 of the housing 540, which is provided extending in the longitudinal direction of the housing 540. Here, the outer surface 543 refers to the part of the housing 540 corresponding to the dash-dotted line in FIG. 7. It should be noted that this outer surface 543 includes a circularly arc-shaped surface 543*a*, whose cross section through a perpendicular plane that is perpendicular to the longitudinal direction of the housing 540 is circularly arc-shaped. This circularly arc-shaped surface 543*a* is arranged such that its circular arc extends along the rotation direction of the developing container holding unit 50 when the yellow developing container 54 is mounted to the mounting and dismounting section 50*d*. As shown in FIG. 7, the element 54*a* is attached at a position of the circularly arc-shaped surface 543*a* that is furthest removed from the developing roller 510.

If the element 54*a* and the main unit-side antenna 124 are in a predetermined positional relationship, for example, if they are within a distance of 10 mm of one another, information can be exchanged in a noncontacting manner between the two. The element 54*a* is overall very compact and thin, and one of its sides is adhesive and can be adhered to an object as a seal. It is also called a memory tag, for example, and is commercially available in various forms.

As shown in FIG. 12, the element 54*a* has a non-contact IC chip 54*b*, a resonance capacitor 54*c* that is formed by etching a metal film, and a flat coil serving as an antenna 54*d*. These are mounted onto a plastic film and covered by a transparent cover sheet.

As shown in FIG. 13, the printer main unit 10*a* includes a coil that serves as the main unit-side antenna 124, the send-receive circuit 123, and the serial interface 121, which is connected to the controller (CPU) 120 of the printer main unit 10*a*.

As shown in FIG. 13, the non-contact IC chip 54*b* includes a rectifier 54*e*, a signal analysis section RF (Radio Frequency) 54*f*, a controller 54*g*, and the memory cell 54*h*. The memory cell 54*h* is a non-volatile memory that can be electrically read and written, such as a NAND flash ROM, and is capable of storing information that has been written on it and reading stored information from the outside.

The antenna 54*d* of the element 54*a* and the main unit-side antenna 124 communicate wirelessly with one another, so that information stored in the memory cell 54*h* can be read and information can be written to the memory cell 54*h*. Also, the high-frequency signals that are generated by the send-receive circuit 123 of the printer main unit 10*a* are induced as a high-frequency magnetic field via the main unit-side antenna 124. This high-frequency magnetic field is absorbed via the antenna 54*d* of the element 54*a* and is rectified by the rectifier 54*e*, thus serving as a DC power source for driving the circuits in the IC chip 54*b*.

The memory cell 54*h* of the element 54*a* stores various types of information, as shown in FIG. 14. The address 00H stores unique ID information for each element, such as the serial number of the element, the address 01H stores the date when the yellow developing container 54 was manufactured, the address 02H stores information for specifying the destination of the yellow developing container 54, the address 03H stores information for specifying the manufacturing line on which the yellow developing container 54 was manufactured, the address 04H stores information for specifying models with which the yellow developing container 54 is compatible, the address 05H stores remaining toner amount information as information indicating the amount of toner that is contained in the yellow developing container 54, and the address 06H and subsequent regions also store information as appropriate.

The ID information that is stored in the memory cell 54*h* of the element 54*a* can be written at the time that the storage element is manufactured in the factory. The printer main unit 10*a* can read this ID information to identify the individual elements 54*a*, 51*a*, 52*a* and 53*a*.

It should be noted that it is also possible to let the main unit-side antenna 124 communicate wirelessly with the element 54*a* not only when the developing container holding unit 50 is standing still but also when the developing container holding unit 50 is moving. That is, it is possible to make the main unit-side antenna 124 capable of communicating wirelessly with the element 54*a* even when the element 54*a* is moving.

Advantages of the Developing Container of the Present Embodiment

The developing devices according to the present embodiment, that is, the developing containers 51, 52, 53 and 54 that can be mounted and dismounted with respect to the mounting and dismounting sections 50*a*, 50*b*, 50*c* and 50*d* with which the printer main unit 10*a* (image forming apparatus main unit) is provided and that that include a developing container main unit (developing device main unit), the positioning pin 588 (positioning member) that is fixed on one end in the longitudinal direction of the developing container main units and is for positioning the developing container main units with respect to the mounting and dismounting sections by engaging the mounting and dismounting sections when the developing containers 51, 52, 53 and 54 are mounted to the mounting and dismounting sections 50*a*, 50*b*, 50*c* and 50*d*, a coupling member 590 that is attached to the other end in longitudinal direction of the developing container main units in such a manner that their relative position to the developing container main units is variable and that are coupled with the mounting and dismounting sections when the developing containers 51, 52, 53 and 54 are mounted to the mounting and dismounting sections 50*a*, 50*b*, 50*c* and 50*d*, and elements 51*a*, 52*a*, 53*a* and 54*a* that are provided on one end in longitudinal direction of the developing container main units and that can communicate with the printer main unit 10*a* in a noncontacting manner when the developing containers 51, 52, 53 and 54 are mounted to the mounting and dismounting sections 50*a*, 50*b*, 50*c* and 50*d*. Thus, developing containers 51, 52, 53 and 54 can be realized that can communicate suitably with the printer main unit 10*a*. This is described in greater detail in the following.

When the developing containers 51, 52, 53 and 54 are mounted to the mounting and dismounting sections 50*a*, 50*b*, 50*c* and 50*d*, the coupling member 590 coupled to the mounting and dismounting sections is attached to the developing container main units in such a manner that its relative position to the developing container main units can be changed, so that depending on the position where the elements are attached to the developing container main units, the distance between the elements and the printer main unit 10*a* may change considerably with this change in relative position. In this case, there is the risk that the elements cannot communicate properly with the printer main unit 10*a*.

This is explained more specifically with a comparative example. Here, in the developing container of the comparative example, the element is provided at the other end side in the longitudinal direction of the developing container main unit, that is, on the side where the coupling member 590 is attached. The coupling member 590 is attached in such a manner that its relative position to the developing container main unit can be changed, in order to make it possible to achieve the desired distance between the photoconductor 20 and the developing container as the latent image borne on the photoconductor 20 is developed by the developing container, even when the photoconductor 20 is installed in a slanted manner with respect to the printer main unit 10*a*. Therefore, if the element is provided on the other side in longitudinal direction of the developing container main unit, that is, on the side where the coupling member 590 is attached, then there is the possibility that the distance between the printer main unit 10*a* and the element changes considerably as the relative position between the developing container main unit and the coupling member 590 changes. Then, if the distance between the printer main unit 10*a* and the element changes considerably, there is the risk that the element cannot communicate properly with the printer main unit 10*a*.

In the present embodiment on the other hand, the elements 51*a*, 52*a*, 53*a* and 54*a* are provided on the one end in the longitudinal direction of the developing container main units, as shown in FIG. 6. In this case, the elements are positioned on the side of the positioning pin 588. As noted above, the positioning pin 588 positions the developing container main unit with respect to the mounting and dismounting section, so that on this side in the longitudinal direction, changes in the distance between the developing container main units and the printer main unit 10*a* are less likely to occur. Moreover, even when there is a change in the relative position between the developing container main units and the coupling member 590 provided on the other side in the longitudinal direction, its influence on the one side in the longitudinal direction is small. Therefore, if the elements are provided on the one side in longitudinal direction of the developing container main units, that is, on the side of the positioning pin 58B, then the distance between the elements attached to the developing container main units and the printer main unit 10*a* tends not to change. Consequently, the elements 51*a*, 52*a*, 53*a* and 54*a* can communicate properly with the printer main unit 10*a*.

Thus, if the developing containers 51, 52, 53 and 54 have elements 51*a*, 52*a*, 53*a* and 54*a* that are arranged on the one end in the longitudinal direction of the developing container main units, then the distance between the printer main unit 10*a* and the elements is less likely to change, so that it is possible to realize developing containers that can communicate properly with the printer main unit 10*a*.

Other Embodiments

An image forming apparatus or the like according to the present invention was explained by way of the foregoing embodiment, but the foregoing embodiment of the invention is merely for the purpose of elucidating the present invention and is not to be interpreted as limiting the present invention.

The invention can of course be altered and improved without departing from the gist thereof and equivalents are intended to be embraced therein.

In the foregoing embodiment, an intermediate image transfer type full-color laser beam printer was described as an example of the image forming apparatus, but the present invention can also be applied to various other types of image forming apparatuses, such as full-color laser beam printers that are not of the intermediate image transfer type, monochrome laser beam printers, copying machines, and facsimiles.

Also, in the foregoing embodiment, the photoconductor, which is an image bearing member, was explained as having a photoconductive layer on the outer circumferential surface of a hollow cylindrical conductive member, but there is no limitation to this. For example, it may also be a so-called photoconductive belt, in which a photoconductive layer is provided on the surface of a belt-shaped photoconductive member.

Furthermore, in the foregoing embodiment, as shown in FIG. 2 for example, the mounting and dismounting sections 50*a*, 50*b*, 50*c* and 50*d* are movable, and when the developing containers 51, 52, 53 and 54 are mounted to the mounting and dismounting sections and are moved to the developing position (first position) through the movement of the mounting and dismounting sections, then the latent image borne on the photoconductor 20 (image bearing member) provided in the printer main unit 10*a* is developed. Moreover, the elements 51*a*, 52*a*, 53*a* and 54*a* communicate in a noncontacting manner with the printer main unit 10*a* when the developing containers 51, 52, 53 and 54 have been moved to the communication position (second position), which is different from the developing position. However, there is no limitation to this. For example, it is also possible to let the developing containers not move at all.

However, if the developing containers 51, 52, 53 and 54 move together with the movement of the mounting and dismounting sections 50*a*, 50*b*, 50*c* and 50*d*, then the relative position between the developing container main units and the coupling member 590 changes more easily when the developing containers are positioned in the communication position than in the case that the developing containers do not move, so that there is a greater risk that the distance between the printer main unit 10*a* and the elements 51*a*, 52*a*, 53*a* and 54*a* changes. Therefore, the effect of providing the elements on the one end in the longitudinal direction of the developing container main units, that is, the effect that developing containers can be realized that can communicate properly with the printer main unit 10*a* is more advantageous in the case that the developing containers move together with the movement of the mounting and dismounting sections. For this reason, the above-described embodiment is more preferable.

Furthermore, as shown in FIG. 4, in the present embodiment, the mounting and dismounting sections 50*a*, 50*b*, 50*c* and 50*d* are each provided with springs 576, which bias the developing container main units in their longitudinal direction. Also, the relative position between the developing container main units and the coupling member 590 is changed in accordance with the biasing amount of the springs 576. However, there is no limitation to this. For example, it is also possible that the mounting and dismounting sections are not provided with springs biasing the developing container main units in their longitudinal direction.

However, if the mounting and dismounting sections 50*a*, 50*b*, 50*c* and 50*d* are provided with springs 576 that bias the developing container main units in their longitudinal direction, then the developing containers oscillate due to the expansion and contraction of the springs 576 when the developing containers 51, 52, 53 and 54 are positioned in the communication position. Then, when the developing containers oscillate, there is the risk that the distance between the printer main unit 10*a* and the elements changes and that the elements cannot communicate properly with the printer main unit 10*a*. Therefore, the effect of providing the elements on the one end in the longitudinal direction of the developing container main units, that is, the effect that developing containers can be realized that can communicate properly with the printer main unit 10*a* can be more effectively displayed in the case that the mounting and dismounting sections are provided with springs 576. For this reason, the above-described embodiment is more preferable.

Furthermore, in the above-described embodiment, as shown in FIG. 8, the developing container main units include a developing roller 510 (developer bearing member) for bearing toner (developer) T developing the latent image borne on the photoconductor 20 with toner T, and rolls 574 (distance holding members) that are provided at both ends in the longitudinal direction of the developing rollers 510 and that are for holding a distance between the photoconductor 20 and the developing roller 510 by coming into contact with the photoconductor 20. Moreover, when the developing containers 51, 52, 53 and 54 are moved to the developing position, the rolls 574 hold this distance by coming into contact with the photoconductor 20. However, there is no limitation to this.

In order to properly develop the latent image carried on the photodetector 20, it is necessary to hold a proper distance between the developing roller 510 and the photodetector 20. To hold this distance, rolls 574 coming into contact with the photodetector 20 on both sides in longitudinal direction of the developing roller 510 may be provided. In this case, if the relative position between the developing container main unit provided with the developing roller 510 and the coupling member 590 can change, the rolls 574 can be abutted against the photoconductor 20 such that the developing roller 510 follows the photoconductor 20 even if the photoconductor 20 is attached at an inclination with respect to the printer main unit 10*a*, so that it becomes possible to hold a proper distance between the developing roller 510 and the photoconductor 20. For this reason, the above-described embodiment is more preferable.

Furthermore, in the above-described embodiment, as shown in FIG. 6, the positioning member is a positioning pin 588 (positioning shaft) that is fixed to the side wall 546 on one end in the longitudinal direction of the developing container main unit, such that its axial direction extends along the longitudinal direction of the developing container main unit. Moreover, as shown in FIG. 5, when the developing containers 51, 52, 53 and 54 are mounted to the mounting and dismounting sections 50*a*, 50*b*, 50*c* and 50*d*, the positioning pins 588 are fitted to the positioning holes 58 provided on the mounting and dismounting sections to position the developing container main units with respect to the mounting and dismounting sections. However, there is no limitation to this. For example, it is also possible that the positioning member positions the developing container main units with respect to the mounting and dismounting sections with a configuration different from positioning pins 588 fitted into positioning holes 58.

However, if the positioning pins 588 position the developing container main units with respect to the mounting and dismounting sections 50*a*, 50*b*, 50*c* and 50*d* by fitting into positioning holes 58, then the developing container main units can be positioned with respect to the mounting and dismounting sections with a simple configuration. For this reason, the above-described embodiment is more preferable.

Furthermore, as shown in FIG. 4, in the present embodiment, the mounting and dismounting sections 50*a*, 50*b*, 50*c* and 50*d* are each provided with coupling holes 59. Moreover, as shown in FIG. 10, the coupling member 590 is provided with coupling pins 595*a* and 595*b* (coupling protrusions) that can be fitted into the coupling holes 59, and the coupling member 590 can be attached to the side wall 547 on the other end in longitudinal direction of the developing container main unit. Moreover, as shown in FIG. 5, when the developing containers 51, 52, 53 and 54 are mounted to the mounting and dismounting sections 50*a*, 50*b*, 50*c* and 50*d*, the coupling member 590 is coupled to the mounting and dismounting section by fitting the coupling pins 595*a* and 595*b* into the coupling holes 59. However, there is no limitation to this. For example, it is also possible to couple the coupling member 590 with the mounting and dismounting section with another configuration than coupling the coupling pins 595*a* into the coupling holes 59.

However, if the coupling member 590 is coupled with the mounting and dismounting sections 50*a*, 50*b*, 50*c* and 50*d* by fitting the coupling pins 595*a* and 595*b* into the coupling holes 59, then it is possible to couple the coupling member 590 with the mounting and dismounting sections with a simple configuration. For this reason, the above-described embodiment is more preferable.

Furthermore, as shown in FIG. 9, in the present embodiment, the developing container main units are provided with attachment protrusions 581*a* and 581*b* having a circular cross section. Moreover, the coupling member 590 is provided with attachment holes (593*a* into which the attachment protrusion 581*a* can be fitted and 593*b* into which the attachment protrusion 581*b* can be fitted) which have an elliptical cross section and into which attachment protrusions can be fitted. Moreover, the attachment holes 593*a* and 593*b* allow some movement of the attachment protrusions fitted into those attachment holes within the attachment holes. However, there is no limitation to this. For example, it is also possible that the cross-sectional shape of the attachment holes 593*a* and 593*b* is a shape other than an elliptical shape.

Furthermore, as shown in FIG. 7, in the above-described embodiment, the developing container main units are provided with a housing 540 for containing the toner T. Moreover, as shown in FIG. 6, the elements 51*a*, 52*a*, 53*a* and 54*a* are each attached to the outer surface 543 of the housing 540, which is provided extending along the longitudinal direction of the housing 540. However, there is no limitation to this. For example, it is also possible to attach the elements to the side wall 546 on the one end in longitudinal direction of the developing container main unit, to which the positioning pin 588 is fixed.

Furthermore, in the above-described embodiment, as shown in FIG. 6, the developing container main unit is supported by the housing 540 at both ends in the longitudinal direction, and is provided with the developing roller 510 for bearing the toner T and developing the latent image borne on the photoconductor 20 with the toner T. Moreover, as shown in FIG. 7, the outer surface 543 of the housing 540 is provided with a circularly arc-shaped surface 543*a*, whose cross section through a perpendicular plane that is perpendicular to the longitudinal direction of the housing 540 is circularly arc-shaped. As shown in FIG. 7, the elements 51*a*, 52*a*, 53*a* and 54*a* are attached at positions of the circularly arc-shaped surface 543*a* that are furthest removed from the developing rollers 510. However, there is no limitation to this. For example, it is also possible that the elements are attached at positions of the circularly arc-shaped surface 543*a* that are close to the developing rollers 510.

However, if the elements 51*a*, 52*a*, 53*a* and 54*a* are attached at the positions of the circularly arc-shaped surface 543*a* that are furthest removed from the developing rollers 510, then it can be prevented that the toner T borne on the developing roller 510 is scattered and adheres to the elements, so that the elements can communicate more properly with the printer main unit 10*a*. For this reason, the above-described embodiment is more preferable.

Configuration of Image Forming System Etc.

Next, an embodiment of an image forming system serving as an example of an embodiment of the present invention is described with reference to the drawings.

Figure 15:
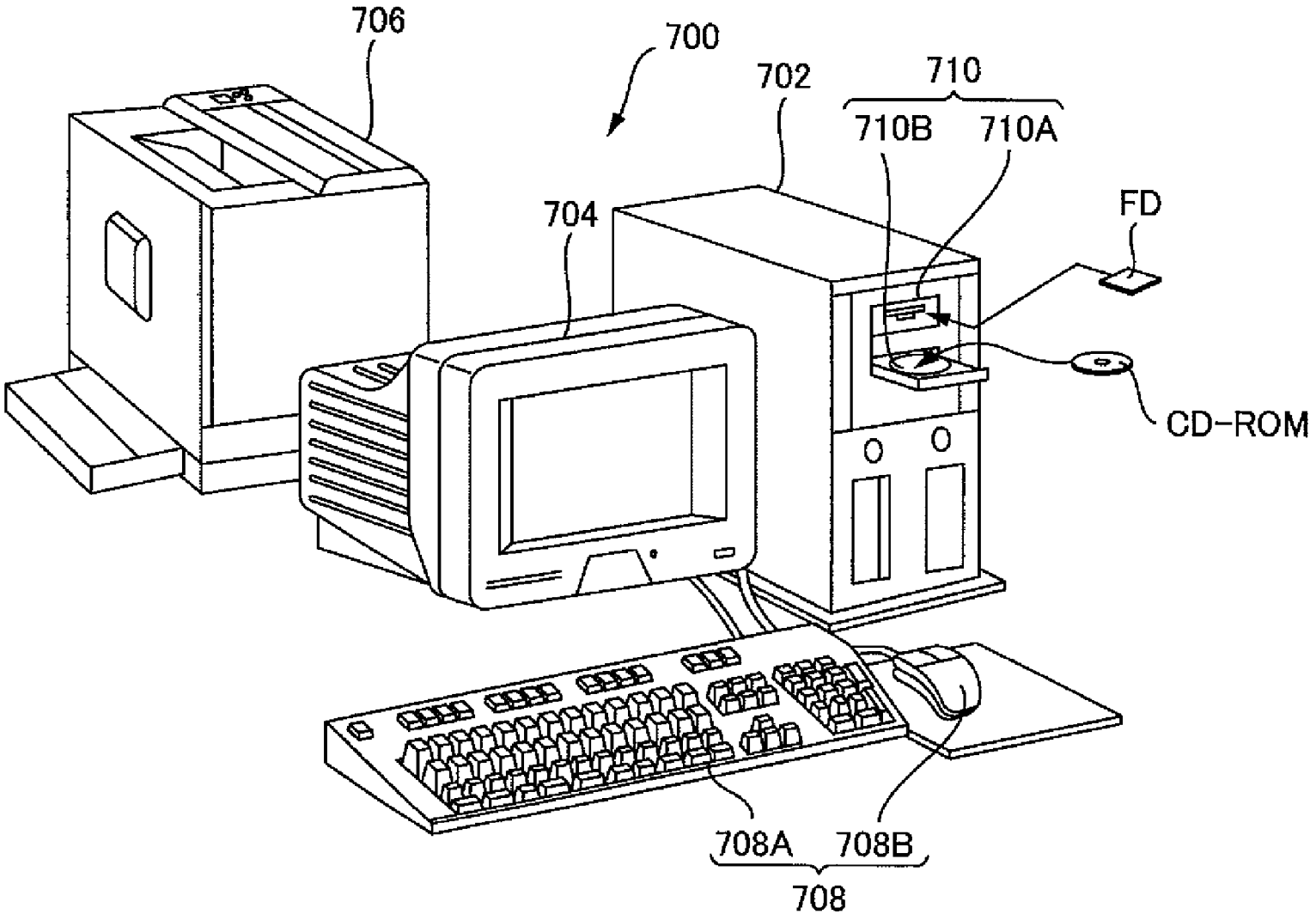
FIG. 15 is an explanatory diagram showing the external configuration of an image forming system.

FIG. 15 is an explanatory diagram showing the external configuration of an image forming system. An image forming system 700 is provided with a computer 702, a display device 704, a printer 10, input devices 708 and reading device 710.

In this embodiment, the computer 702 is contained within a mini-tower type housing, but there is no limitation to this. A CRT (cathode ray tube), a plasma display, or a liquid crystal display device, for example, is generally used as the display device 704, but there is no limitation to this. The printer 10 is the printer described above. In this embodiment, the input devices 708 are a keyboard 708A and a mouse 708B, but there is no limitation to these. In this embodiment, a flexible disk drive device 710A and a CD-ROM drive device 710B are used as the reading devices 710, but there is no limitation to these, and the reading devices 710 may also include an MO (magneto-optical) disk drive device or a DVD (digital versatile disk), for example.

Figure 16:
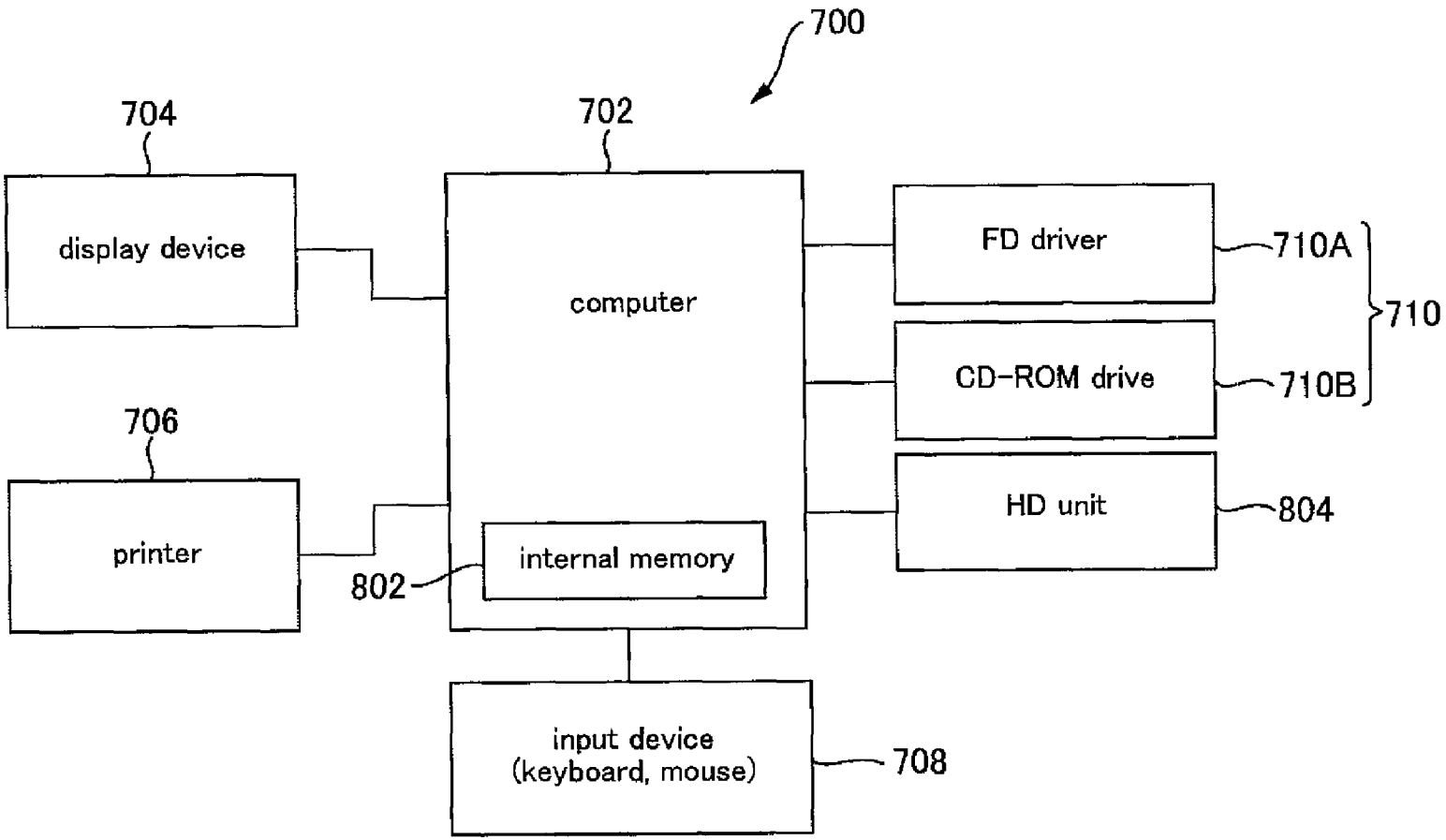
FIG. 16 is a block diagram showing the configuration of the image forming system shown in FIG. 15.

FIG. 16 is a block diagram showing the configuration of the image forming system shown in FIG. 15. An internal memory 802 such as a RAM is provided within the casing containing the computer 702, and furthermore an external memory such as a hard disk drive unit 804 is provided.

In the above explanations, an example was given in which the image forming system is constituted by connecting the printer 10 to the computer 702, the display device 704, the input devices 708, and the reading devices 710, but there is no limitation to this. For example, the image forming system may also be made of the computer 702 and the printer 10, and the image forming system does not have to be provided with any one of the display device 704, the input devices 708, and the reading devices 710.

It is also possible that the printer 10 has some of the functions or mechanisms of the computer 702, the display device 704, the input devices 708, and the reading devices 710. As an example, the printer 10 may be configured so as to have an image processing section for carrying out image processing, a display section for carrying out various types of displays, and a recording media mounting and dismounting section into and from which recording media storing image data captured by a digital camera or the like are inserted and taken out.

As an overall system, the image forming system that is thus achieved is superior to conventional systems.

Overview of Image Forming Apparatus of Second Embodiment

The following is an explanation of a second embodiment of the present invention, with reference to the drawings. FIGS. 17 to 21 are diagram showing an embodiment of an image forming apparatus according to the present invention.

Figure 17:
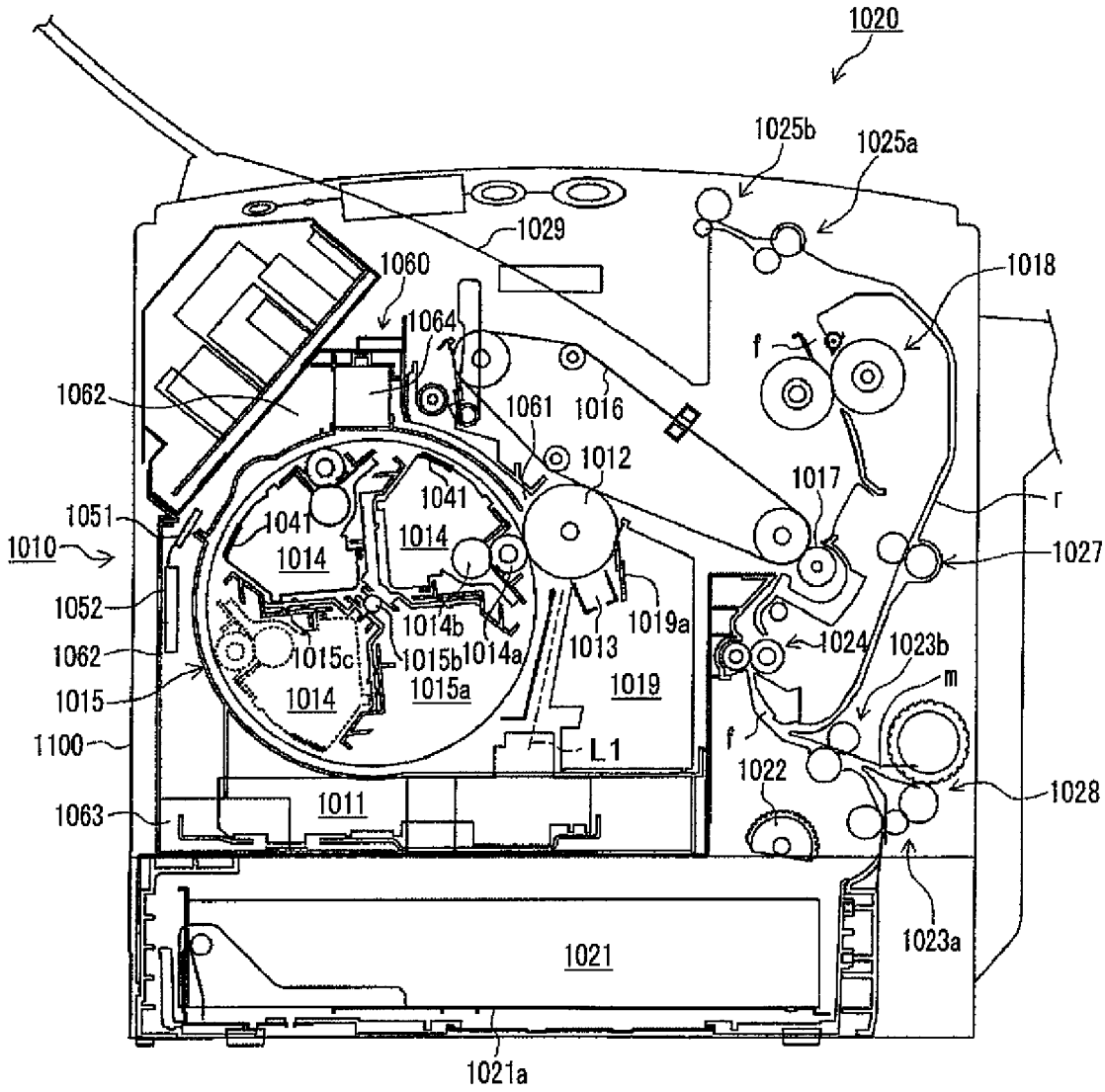
FIG. 17 is a diagram showing an embodiment of an image forming apparatus according to a second invention, and is a transparent front view showing its overall schematic configuration.
Figure 18:
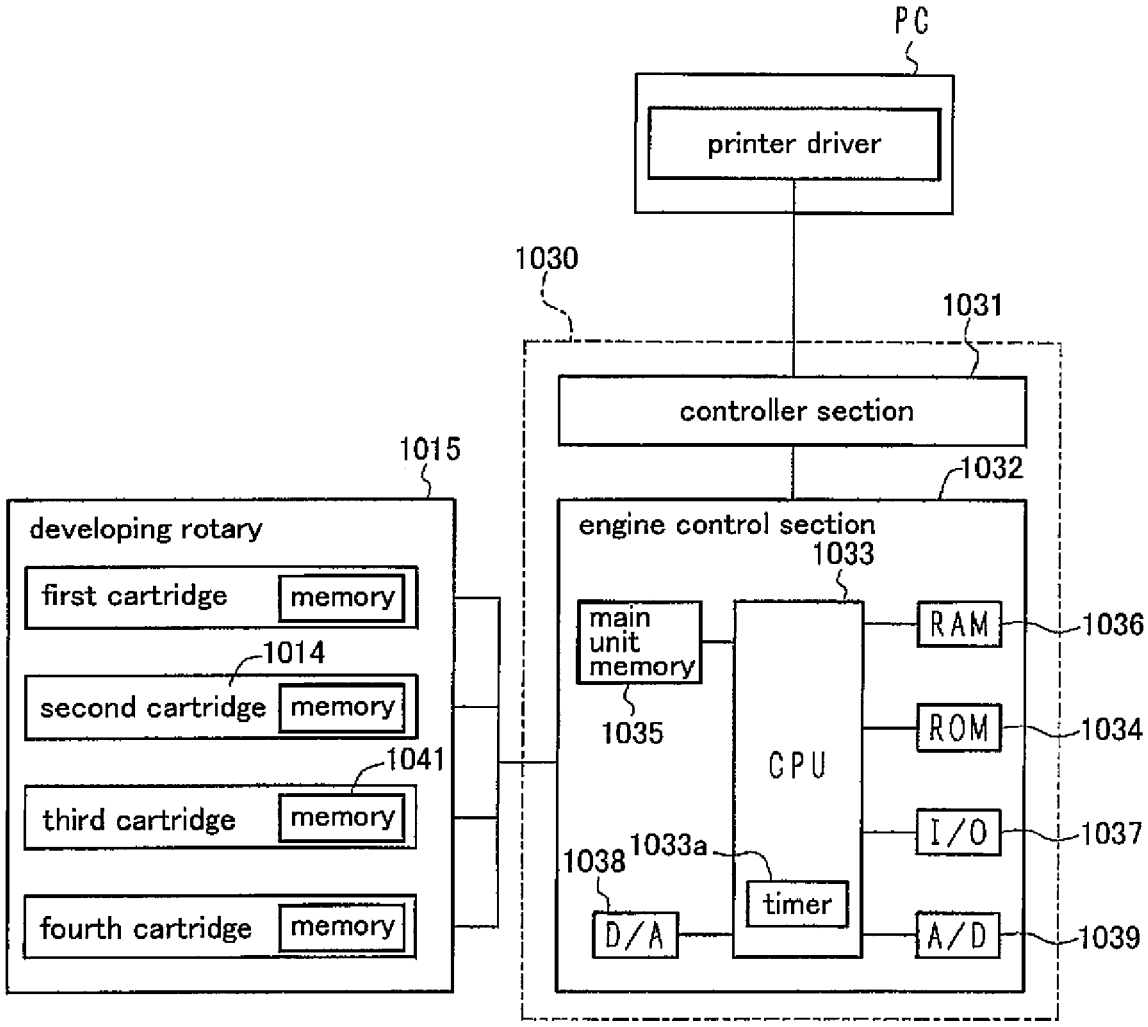
FIG. 18 is a relational block diagram illustrating its controller.

In FIG. 17 and FIG. 18, the image forming apparatus is a printer that is used by connecting it to an external device such as a personal computer PC that creates and outputs images of text or the like. This image forming apparatus includes an image recording device 1010 that records and forms images on one side or both sides of recording paper (recording medium) through electrophotography by reading in image data of text or the like to be image-formed, a paper carrying device 1020 that carries a plurality of stacked recording papers to the image recording device 1010 and carries the recording paper on which an image has been recorded and formed out of the apparatus, stacking the recording paper, and a control unit 1030 that is connected to a personal computer PC and makes print-outs by forming images on the recording paper through comprehensive control of the overall apparatus including the image recording device 1010 and the paper carrying device 1020 in accordance with the image data that has been received.

Simply speaking, the image recording device 1010 includes, as shown in FIG. 17, a laser beam scanning device 1011 scanning a laser beam L1 based on image data, a photoconductive drum (bearing member) 1012 on the surface of which an electrostatic latent image is exposed and formed based on image data that is irradiated and scanned with the laser beam L1 from the laser beam scanning device 1011, a charge device 1013 charging the outer circumferential surface of the photoconductive drum 1012 such that an electrostatic latent image can be formed by irradiating the laser beam L1, a developing cartridge 1014 (shown only at one place) for each of the colors, which contains yellow (Y), cyan (C), magenta (M) or black (K) toner and performs toner development of the electrostatic latent image on the photoconductive drum 1012, a developing rotary unit 1015 holding the developing cartridges 1014 in preset spaces 1015*a* for each color and rotating them around a rotation shaft 1015*b*, an intermediate image transfer belt (intermediate image transfer medium) 1016, which can receive the toner image developed on the photoconductive drum 1012 so that a toner image (monochrome image or color image) is formed on it that can be transferred and recorded on recording paper, an image transfer roller 1017 transferring the toner image carried on the intermediate image transfer belt 1016 by applying a contact pressure (nip) such that the recording paper carried up to it is sandwiched between the image transfer roller 1017 and the intermediate image transfer belt 1016, and carrying the recording paper downstream while clamping the recording paper, a pair of fixing rollers 1018 fixing the toner image by applying heat and pressure to the recording paper onto which the toner image has been transferred and which has been carried up to them, and clamping and carrying the recording paper further downstream, and a waste toner tank 1019 collecting and storing toner that has remained on the photoconductive drum 1012 with a blade 1019*a*.

Thus, in the image recording device 1010, the developing cartridge 1014 inside the developing rotary unit 1015 that has been switched in accordance with the image data develops with toner the electrostatic latent image based on the image data formed on the surface of the photoconductive drum 1012 with the laser beam scanning device 1011. After that, the toner image on the photoconductive drum 12 is transferred and recorded via the intermediate image transfer belt 1016 onto recording paper that has been carried with the paper carry device 1020, and then fixed by applying heat and pressure with the pair of fixing rollers 1018, thus accomplishing image formation. It should be noted that the intermediate image transfer belt 1016, the image transfer roller 1017 and the pair of fixing rollers 1018 of this image recording device also have the function of carrying the recording paper, so that they also constitute a part of the paper carry device 1020 explained below. Also the unit of the intermediate image transfer belt 1016 is provided with a waste toner tank in which the toner remaining on the belt 1016 is collected with a blade and stored.

Simply speaking, the paper carry device 1020 includes, as shown in FIG. 17, a paper cassette 1021, which is attachably and detachably set in a lower section of the apparatus main unit and in which a plurality of sheets of recording paper are stacked, a pick-up roller 1022, which picks up the uppermost recording paper by rotating while being pressed against the stack of recording paper that has been elevated with an elevating plate 1021*a* at the bottom surface of the paper cassette 1021, thereby feeding the recording paper to a carry path f, a pair of relay carry rollers 1023*a* and 1023*b*, which receive the recording paper that is fed to them by the pick-up roller 1022 and clamp and carry the recording paper to the carry path f further downstream, a pair of registration rollers 1024, which receive the recording paper in the carry path f that is carried by the pair of relay carry rollers 1023*a* and 1023*b* and clamp and carry the recording paper to an image recording formation position given by the intermediate image transfer belt 1016 and the image transfer roller 1017 of the image recording device 1010, and a pair of paper discharge rollers 1025*a* and 1025*b*, which receive the recording paper on one side of which a fixed image has been formed by carrying the recording paper along the carry path f from the pair of registration rollers 1024, between the intermediate image transfer belt 1016 and the image transfer roller 1017 and between the pair of fixing rollers 1018, and which carries out and discharges and stacks the recording paper on a paper discharge table 1029 on top of the apparatus main unit.

Thus, after the recording paper that has been picked up from the paper cassette 1021 with the pick-up roller 1022 has been passed on via the pair of relay carry rollers 1023*a* and 1023*b* to the pair of registration rollers 1024, the paper carry device 1020 supplies the recording paper to the image recording formation position at which the recording paper is pressed against by the intermediate image transfer belt 1016 and the image transfer roller 1017, such that the pair of registration rollers 1024 is synchronized with the operation of the image recording device 1010. The recording paper, on which the toner image on the intermediate image transfer belt 1016 has been transferred and recorded, and the image based on the image data has been fixed (recording formation) with the pair of fixing rollers 1018, is received by the pair of paper discharge rollers 1025*a* and 1025*b* and is carried out and discharged and stacked on the paper discharge table 1029.

It should be noted that this paper carry device 1020 includes a reverse carry path r and a pair of intermediate carry rollers 1027 disposed on this path r for turning over recording paper on one side of which an image has been formed and feeding it to the carry path f on the upstream side of the pair of registration rollers 1024. The recording paper, which has been fed into the reverse carry path r by inverting the rotation of the pair of paper discharge rollers 1025*a* and 1025*b* is received by the pair of intermediate carry rollers 1027 and passed on to the pair of registration rollers 1024, so that image formation on both sides of the recording paper is possible. Moreover, the paper carry device 1020 includes a manual feed path m and a pair of manual feed rollers 1028 disposed on this path m for manually feeding recording paper into the carry path f on the upstream side of the pair of registration rollers 1024. Image formation on one side or both sides of the recording paper is possible by receiving the recording paper inserted into this manual feed path m with the pair of manual feed rollers 1028 and passing it to the pair of registration rollers 1024.

As shown in FIG. 18, the control unit 1030 includes a controller section 1031 and an engine controller 1032 implemented on a circuit board mounted inside the apparatus main unit. These perform various kinds of data process control and drive control of the various components of the apparatus in accordance with a program that is provided in advance.

Simply speaking, the controller section 1031 exchanges various kinds of information, such as print commands, with a printer driver of a personal computer PC, with a CPU not shown in the drawings executing procedures of various processes in accordance with a processing program stored in a memory, receives image data, such as text, to be formed as an image (printed) on the recording paper, and temporarily stores the image data in a memory not shown in the drawings. Since the image data (image information signal) received from the personal computer PC is so-called RGB data of red (R), green (G) and blue (B), the controller section 1031 reads the data from the memory and passes it to the engine controller 1032 while converting this data into so-called YMCK image data of yellow (Y), magenta (M), cyan (C) and black (K) that can be printed.

With the CPU 1033 following the control program stored in the ROM 1034, the engine controller 1032 receives the image data page by page, for example, from the controller section 1031 and temporarily stores it in a main unit memory 1035, and an image based on this image data is formed on the recording paper by exchanging various kinds of information with the image recording device 1010 and the paper carry device 1020 while using a RAM 1036 as a working area. Moreover, when the CPU 1033 performs the image formation control at this time, it lets each component of the apparatus operate optimally by measuring the various processing times with an internal timer function (time measurement means) 1033*a*.

Thus, when the control unit 1030 receives image data from the personal computer PC or the like, the controller section 1031 outputs image data, which it has converted from RGB data to YMCK data, to the engine controller 1032, while temporarily storing the image data. In accordance with a control program in the ROM 1034, the CPU 1033 of the engine controller 1032 comprehensively controls the driving of the various sections of the apparatus while using the RAM 1036 as a working area, based on the image data from the controller section 1031 stored in units of pages in the main unit memory 1035. Due to this drive control, the paper carry device 1020 retrieves the recording paper from the paper cassette 1021 and carries it to the paper discharge table 1029, whereas the image recording device 1010 develops with toner the electrostatic latent image formed on the photoconductive drum 1012 with the developing cartridge 1014, based on the image data, so that the toner image is transferred and fixed on one or both sides of the recording paper that has been carried there, thereby accomplishing image formation.

It should be noted that in FIG. 18, an I/O interface 1037 is connected between the image recording device 1010, the paper carry device 1020 and the controller section 1031 on the one hand and the engine controller 1032 on the other hand, such that various kinds of information can be exchanged. A D/A converter 1038 and an A/D converter 1039 convert digital signals (D) into analog signals (A) and convert analog signals into digital signals, such that the various kinds of information that the engine controller 1032 exchanges with the image recording device 10, the paper carry device 1020 and the controller section 1031 can be processed by these.

The developing cartridges 1014 of the image recording device 1010 are provided with a similar external shape, such that they can be accommodated in a plurality of storage positions that are partitioned by partitioning frames 1015*c* that rotate around the rotation shaft 1015*b* of the developing rotary unit 1015. Based on the print commands including the image data from the personal computer PC received by the CPU (controller) 1033 of the engine controller 1032 via the controller section 1031, the developing rotary unit 1015 is rotated around the rotation shaft 1015*b* to switch the developing cartridge 1014 facing the photoconductive drum 1012, and the toner image to be formed is developed by transferring and fixing toner on one side or both sides of the recording paper.

For example, by storing in the developing rotary unit 1015 developing cartridges 1014 containing toner of the colors yellow (Y), cyan (C), magenta (M) and black (K) and switching the color of the toner for developing the electrostatic latent image on the photosensitive drum 1012, the image recording device 1010 can superimpose or select toner of various colors and print and form color images or monochrome images, based on the received image data.

Moreover, the image recording device 1010 can also perform image formation when toner of the same color is contained in all developing cartridges 1014 and those developing cartridges 1014 are mounted in the developing rotary unit 1015. For example, by mounting four developing cartridges 1014 containing toner of the same color black (K), it is possible to use the apparatus as a special purpose apparatus that successively switches the developing cartridges 1014 developing the electrostatic latent image on the photoconductive drum 1012 and continuously prints monochrome images.

A so-called memory tag 1041 that is overall very compact and thin is adhered to a predetermined outer surface of each of the developing cartridges 1014 by making one side of it adhesive. When the memory tag 1041 is moved to a rotation position (communication position) facing a main unit-side antenna 1051 on the main unit side of the apparatus shown in FIG. 17, then it is arranged at a position along an external cover 1100 of the apparatus main unit, or in other words, it is placed (adhered) on the outer surface of the developing cartridge 1014 such that it becomes closest to this external cover 1100. This memory tag 1041 is designed to store and hold necessary information and to pass the necessary information to the CPU 1033 of the engine controller 1032 by communicating in a noncontacting manner with a send-receive circuit 1052 on the apparatus main unit side via the main unit-side antenna 1051 to exchange various kinds of information. Here, the main unit-side antenna 1051 on the apparatus main unit side, which is fabricated in substantially the same manner as the later-described developing-side antenna 1043, is placed within a distance of 10 mm of the memory tag 1041 at the communication position, for example, so as to be able to communicate in a noncontacting manner with the memory tag 1041. The main unit-side antenna 1051 is connected to a circuit board constituting the send-receive circuit 1052 and performing communication in a noncontacting manner with the memory tag 1041. This send-receive circuit 1052 is connected via the I/O interface 1037 to the CPU 1033 of the engine controller 1032 on the apparatus main unit side.

Figure 19:
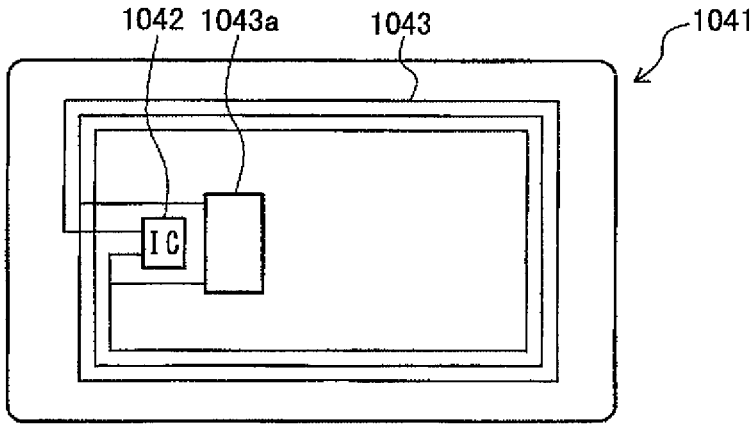
FIG. 19 is a diagram showing the configuration of its essential parts.
Figure 19:
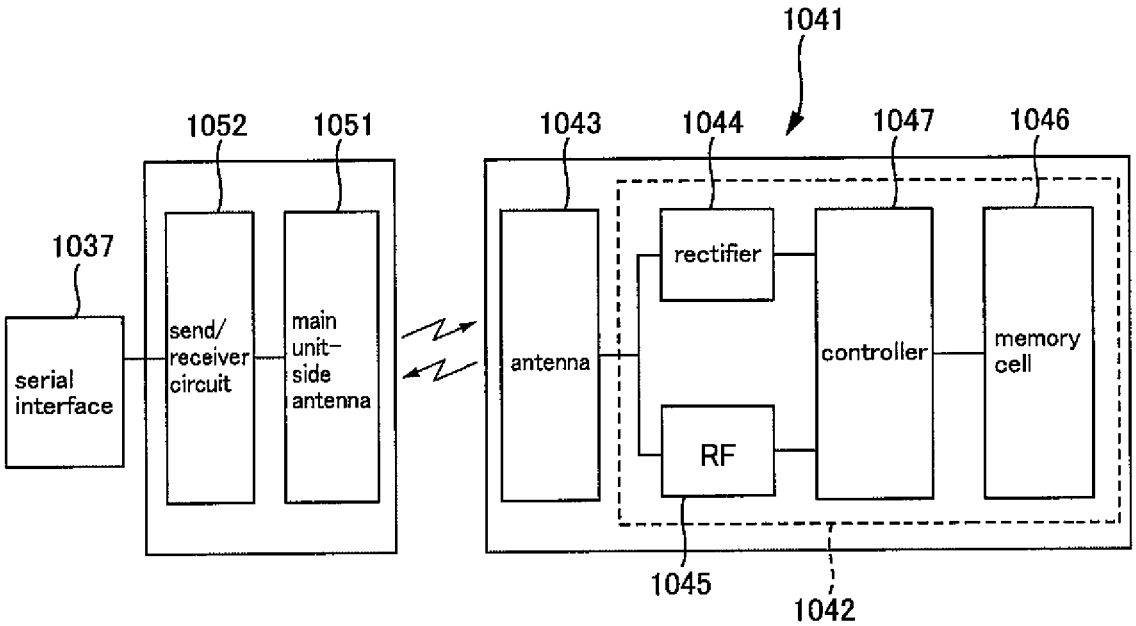

More specifically, as shown in FIG. 19(*a*), in the memory tag 1041 on the side of the developing cartridge 1014, a non-contact IC chip 1042 and the developing-side antenna 1043 are mounted on a plastic film and covered by a transparent cover sheet. The non-contact IC chip 1042 stores and holds various kinds of information based on commands from the send-receive circuit 1052 via the main unit-side antenna 1051 and reads necessary information from these various kinds of information, passing on the relevant information to the send-receive circuit 1052. The developing-side antenna 1043 is made of a planar coil that is connected in parallel to the non-contact IC chip 1042 and a resonance capacitor 1043*a* that is formed by etching a metal film. Thus, a high-frequency magnetic field induced via the main unit-side antenna 1051 by high-frequency signals generated with the send-receive circuit 1052 on the apparatus main unit side can be received (absorbed) by the developing-side antenna 1043 of the memory tag 1041 and input into the non-contact IC chip 1042.

As shown in FIG. 19(*b*), the non-contact IC chip 1042 of the memory tag 1041 includes a rectifier 1044 serving as a DC power source that rectifies the high-frequency magnetic field (high-frequency signals) from the send-receive circuit 1052 on the apparatus main unit side received via the developing-side antenna 1043 and drives the various circuits within the chip, a signal analysis section RF (Radio Frequency) 1045, which analyzes the high-frequency signals of the received high-frequency magnetic field and generates a high-frequency magnetic field that can be absorbed by the main unit-side antenna 1051 by generating a high-frequency signal based on the various kinds of signals to be passed on to the send-receive circuit 1052 on the apparatus main unit side and inputting this high-frequency signal to the developing-side antenna 1043, a non-volatile memory cell 1046, such as a NAND flash-ROM or the like, that can store and hold information written into it and from which this stored information can be read out from the outside, and a controller 1047, which rewrites the information stored in the memory cell 1046 by exchanging various kinds of signals with the send-receive circuit 1052 on the side of the apparatus main unit via the signal analysis section RF 1045 and passes the stored information that has been read out to the send-receive circuit 1052, while being driven by the DC power source of the interposed rectifier 1044. That is to say, the memory cell 1046 constitutes a storage element and the non-contact IC chip 1042 in which this memory cell 1046 is incorporated constitutes a communication means on the side of the developing cartridge 1014 adjacent to the developing-side antenna 1043, whereas the main unit-side antenna 1051 and the send-receive circuit 1052 constitute a communication means on the apparatus main unit side.

Here, stored and held inside the memory cell 1046 of the non-contact IC chip 1042 are unique ID information, such as a serial number for each memory tag 1041, manufacturing information, such as the date when the developing cartridge 1014 was manufactured or the manufacturing number, destination information specifying the destination of the developing cartridge 1014, model information specifying models to which the developing cartridge 1014 can be mounted, toner information, such as information on the color and the remaining amount of toner contained in the developing cartridge 1014, and various kinds of necessary information, such as the number of recycles or the number of times the developing cartridge 1014 has been mounted and dismounted. Thus, the engine controller 1032 of the control unit 1030 can perform an optimal image formation control, by suitably ascertaining various kinds of information that the CPU 1033 has stored and held in the main unit memory 1035, such as the presence and the position of the developing cartridge 1014 in the storage position of the developing rotary unit 1015, or information about the color of the toner of the developing cartridge 1014. Moreover, if an error occurs, the various kinds of information can be useful in finding the cause of the error by displaying and outputting the information to an operation port.

The information stored in the memory cell 1046 of the non-contact IC chip 1042 is rewritten and read out by performing communication in a noncontacting manner between the CPU 1033 of the engine controller 1032 and the memory tag 1041 via the send-receive circuit 1052 in accordance with a control program in the ROM 1034. For example, when the power is turned on or when the developing cartridge 1014 is exchanged, the CPU 1033 lets the developing rotary unit 1015 rotate at least one turn such that the memory tag 1041 (developing-side antenna 1043) of each developing cartridge 1014 faces the main unit-side antenna 1051 for the time necessary for communication in a noncontacting manner, to perform a rewrite and read-out process.

Figure 20:
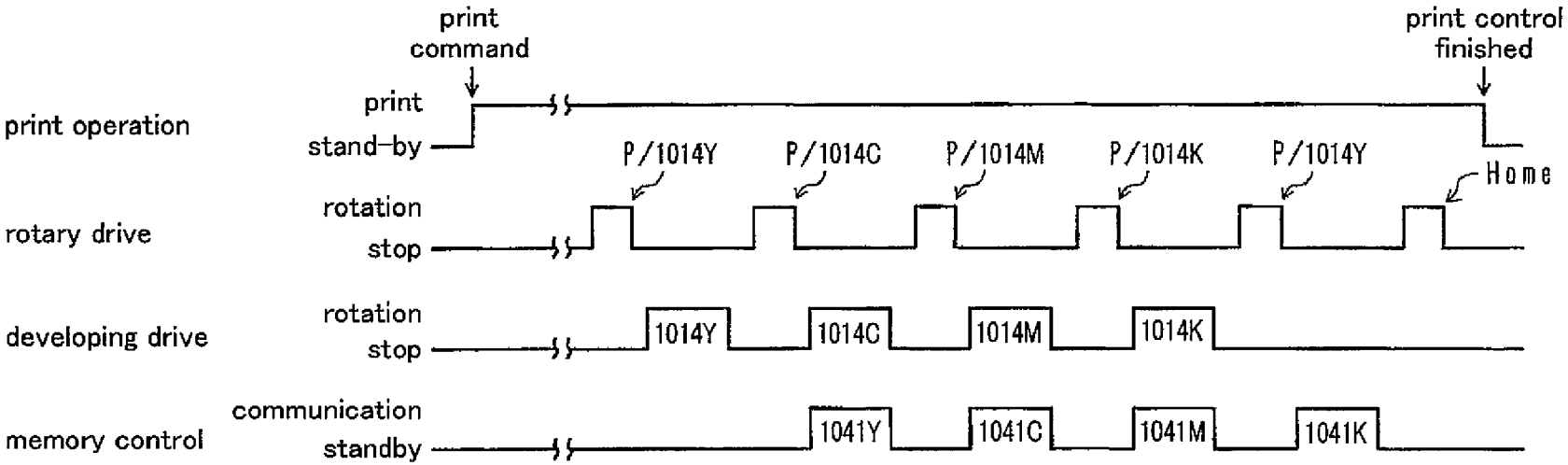
FIG. 20 is a timing chart illustrating the timing of the image forming operation and the communication operation.

During regular operation, as shown in FIG. 20 for example, when the CPU 1033 receives a print command of image data, by beginning with the rotation of the developing rotary unit 1015 from the home position, which is the stand-by position, first the developing cartridge 1014Y containing the yellow (Y) toner is positioned in the image recording formation position P facing the photoconductive drum 1012, and the electrostatic latent image formed on the surface of the photoconductive drum 1012 is developed with toner by this developing cartridge 1014Y. After that, the CPU 1033 successively positions (switches) the developing cartridge 1014C containing cyan (C) toner, the developing cartridge 1014M containing magenta (M) toner and the developing cartridge 1014K containing black (K) toner in a similar manner at the image recording formation position P, and forms color toner images based on the image data by letting them carry out toner development so as to transfer and fix the toner image on the recording paper, thus print-processing the image data.

Since, parallel to this print control, the memory tag 1041Y of the yellow (Y) developing cartridge 1014Y that has carried out the immediately preceding development operation is positioned in the communication position facing the main unit-side antenna 1051 while the cyan (C) developing cartridge 1014C performs the development operation, the CPU 1033 rewrites and reads out the information stored in the memory cell 1046 of this memory tag 1041Y by performing contactless information with this memory tag 1041Y via the send-receive circuit 1052 on the apparatus main unit side. After this, since the memory tag 1041C of the cyan (C) developing cartridge 1014C and the memory tag 1041M of the magenta (M) developing cartridge 1014M are successively positioned in the communication position facing the main unit-side antenna 1051 during the development operation of the magenta (M) developing cartridge 1014M and the black (K) developing cartridge 1014K, the CPU 1033 rewrites and reads out the information stored in the memory cells 1046 of these memory tags 1041C and 1041M by performing contactless information with these memory tags 1041C and 1041N via the send-receive circuit 1052 on the apparatus main unit side. Then, after the development operation with the black (K) developing cartridge 1014K has finished, the CPU 1033 positions the yellow (Y) developing cartridge 1014Y again in the image recording formation position P without performing an image formation process, so that the memory tag 1041K of the black (K) developing cartridge 1014K is positioned in the communication position facing the main unit-side antenna 1051 and communication in a noncontacting manner is carried out with this memory tag 1041K via the send-receive circuit 1052 on the apparatus main unit side. Thus, the CPU 1033 finishes the rewriting and reading of the information stored in the memory cells 1046 of all memory tags 1041Y to 1041K, after which it rotates the developing rotary unit 1015 to its home position to put it into the stand-by state.

In this situation, the memory tag 1041 of the developing cartridge 1014 in the communication position facing the main unit-side antenna 1051 is positioned on the upper side, closest to the external cover 1100, sandwiching the developing rotary unit 1015 (the developing cartridge 1014) between it and the image recording formation position P facing the photoconductor drum 1012. Therefore, the memory tag 1041 in the communication position is removed from the vicinity of the photoconductive drum 1012, which is a source of noise while the charge voltage is applied, and since the developing rotary unit 1015 and the developing cartridge 1014 are disposed between the memory tag 1041 and the photoconductive drum 1012, the information stored in the memory cell 1046 can be rewritten and read out without errors, unaffected by the noise. Moreover, the memory tag 1041 in the communication position is furthest removed from the pair of fixing rollers 1018 and the laser beam scanning device 1011, which are heat-generating members, and is positioned, via the external cover 1100, in an environment that is closest to the external temperature, so that with the elements in the non-contact IC chip 1042 being as little influenced by heat as possible, it is possible to carry out communication in a noncontacting manner with the send-receive circuit 1052 on the apparatus main unit side efficiently (without a drop in processing speed or the like) and the information stored in the memory cell 1046 can be rewritten and read out without errors.

Moreover, through synchronized rotation of the developing roller 1014*a* facing the surface of the photoconductive drum 1012 via a gap, the developing cartridge 1014 performs toner development by transferring toner and letting it adhere to the electrostatic latent image formed on that surface. The photoconductive drum 1012 rotates clockwise in FIG. 17, whereas the developing roller 1014*a* rotates counterclockwise in FIG. 17, so that a small fraction of the toner that is about to be transferred from the developing roller 1014*a* to the photoconductive drum 1012 is scattered and drifts to the downstream side of these rotation directions. Accordingly, an exhaust duct 1060 whose suction opening is above the vicinity of the position where the developing roller 1014*a* opposes the photoconductive drum 1012 (developing position) is arranged on the downstream side of the rotation directions of the developing roller 1014*a* and the photoconductive drum 1012. It should be noted that toner is supplied to the developing roller 1014*a* of the developing cartridge 1014 by pressing a supply roller 1014*b* rotating within the toner containing space of the developing cartridge 1014 against the developing roller 1014*a*.

As shown in FIG. 17, the exhaust duct 1060 includes a suction opening 1061, an exhaust path 1062, and an exhaust opening 1063. The suction opening 1061 is arranged above the vicinity of the developing position where the developing roller 1014*a* of the developing cartridge 1014 faces the photoconductive drum 1012 (the vicinity of the developing position on the inward side, with respect to the apparatus main unit, of the developing rotary unit 1015). The exhaust path 1062 describes an exhaust flow channel from the suction opening 1061, going around and covering the upper side of the developing rotary unit 1015 toward the external cover 1100 on the side of the side wall, and then descending along the external cover 1100. A suction fan 1063*a* sucking air inside the exhaust path 1062 is arranged in the exhaust opening 1063, which is disposed near the bottom of the developing rotary unit 1015 adjacent to the external cover 1100 on the side of the side wall. A filter 1064, which adsorbs and removes toner that has become intermingled in the suction air, is arranged in the exhaust path 1062 of the exhaust duct 1060, positioned above the developing rotary unit 1015. Thus, a design is achieved with which no toner is included in the exhaust air discharged from the exhaust opening 1063, polluting the surroundings.

Figure 21:
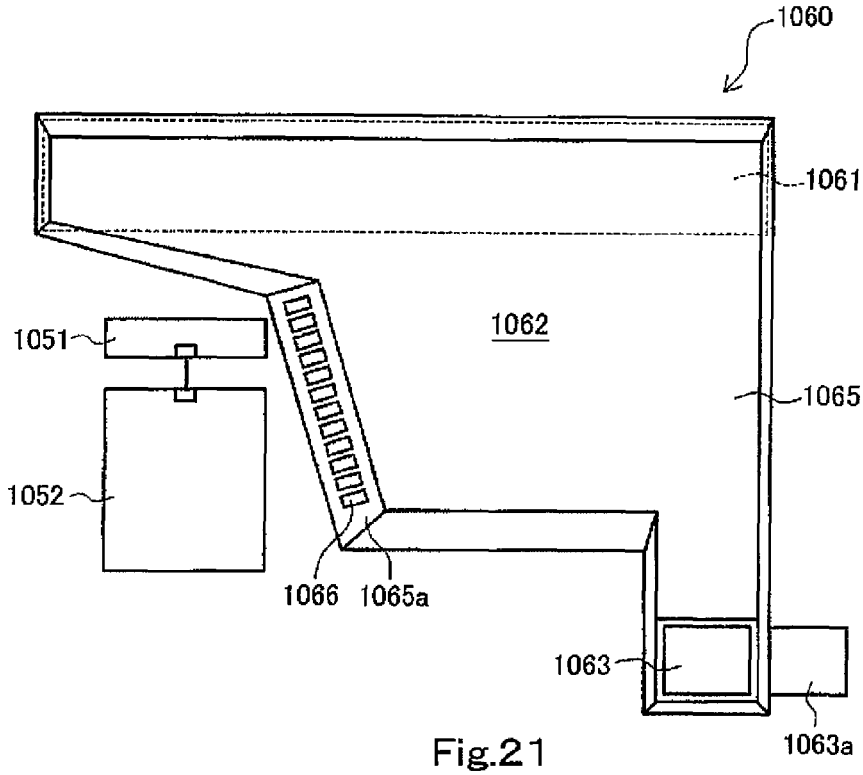
FIG. 21 is a diagrammatic plan view showing the state in which its essential parts are unfolded.

Moreover, as shown in FIG. 21, the suction opening 1061, which is so large that it covers the entire main scanning direction (axial length) of the exhaust duct 1060, sucks in the air above the vicinity of the developing position where the developing roller 1014*a* of the developing cartridge 1014 faces the photoconductive drum 1012. The air is ejected and exhausted from the exhaust opening 1063, which has a small opening, in which the suction fan 1063*a* is arranged. The exhaust path 1062 between the suction opening 1061 and the exhaust opening 1063 is defined by a duct plate 1065 that is shaped such that it is constricted from the suction opening 1061 having an opening width of approximately the entire width of the photoconductive drum 1012 toward the exhaust opening 1063 having an opening width of approximately its end portion.

A wall surface 1065*a* of the duct plate 1065 is arranged next to the main unit-side antenna 1051 and the send-receive circuit 1052 at a position of the exhaust duct 1060 that is closest to the external cover 1100, like the main unit-side antenna 1051 and the send-receive circuit 1052 on the apparatus main unit side. A plurality of drainage openings 1066 through which air within the apparatus main unit around the wall surface 1065*a* can flow into the exhaust path 1062, are provided in the wall surface 1065*a*. That is to say, when the suction fan 1063*a* is driven and the air inside the exhaust path 1062 is sucked and exhausted, then the exhaust duct 1060 also drains the air in the vicinity of the communication position of the memory tag 1041 of the developing cartridge 1014 and the main unit-side antenna 1051 (this includes also the vicinity of the send-receive circuit 1052) through the drainage openings 1066, thereby resulting in a ventilation means that forcibly blows air onto the memory tag 1041 and the like.

Thus, a layout is achieved in which the memory tag 1041 of the developing cartridge 1014 and the send-receive circuit 1052 are positioned at a communication position (region) that is closest to the external cover 1100, so that they are positioned in an environment that is closest to the external temperature and it can be avoided that their internal elements are affected by heat, leading to a drop in the processing speed or the like. In addition to this, as the exhaust duct 1060 (suction fan 1063*a*) provides suction in the vicinity of the region above the developing position where the developing roller 1014*a* of the developing cartridge 1014 faces the photoconductive drum 1012, the surrounding air flows from the drainage openings 1066 into the exhaust path 1062 of the exhaust duct 1060 during operation of the apparatus main unit, so that air whose temperature is close to that of the outside is always blown against the memory tag 1041 of the developing cartridge 1014 and the send-receive circuit 1052 (i.e. they are exposed to such air), thereby cooling them. Consequently, the memory tag 1041 of the developing cartridge 1014 and the send-receive circuit 1052 on the apparatus main unit side can carry out various processes, such as a communication operation or the reading and rewriting of stored information, without the occurrence of errors, simultaneously and with high efficiency, in an environment in which operation is possible without heating up of their internal elements.

Thus, in this embodiment, the memory tag 1041 on the outer surface of the developing cartridge 1014 in the communication position and the send-receive circuit 1052 on the apparatus main unit side are furthest removed from the pair of fixing rollers 1018 and the laser beam scanning device 1011, in an environment in which they are closest to the external cover 1100 of the apparatus main unit, and the suction (flow)

of air in the exhaust duct 1060 is utilized to blow air onto their surroundings, so that it can be avoided that the temperature rises unnecessarily, and communication in a noncontacting manner and reading/rewriting of stored information can be accomplished with high efficiency and without errors, without being subjected to the thermal influence due to the generation of heat externally (inside the apparatus main unit) or internally (within their internal elements). Consequently, the processes of rewriting or reading the various kinds of information in the memory tags 1041 of each of the developing cartridges 1014 can be carried out accurately and speedily without impeding the image formation process, and the information that is necessary for the drive control of the various components of the apparatus can be made accessible in a smooth manner.

Figure 22:
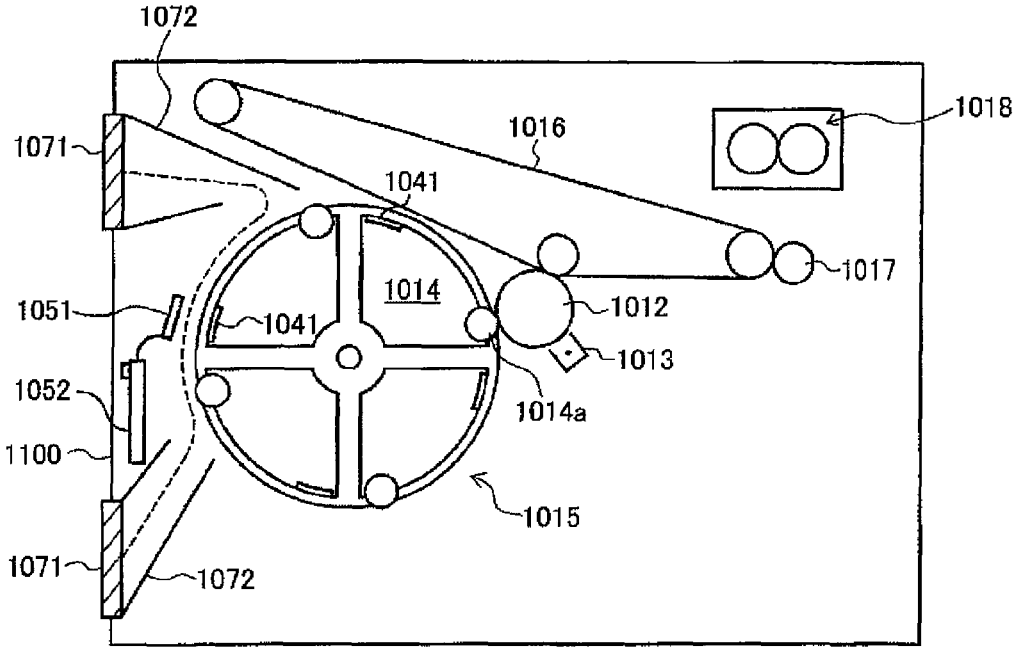
FIG. 22 is a transparent front view showing the diagrammatic configuration of a first alternative embodiment of the second invention.

As a first alternative form of this embodiment, it is also possible to arrange vent holes 1071 at the top and the bottom of the external cover 1100, such that air from outside the apparatus can flow into and pass through the apparatus main unit between the memory tag 1041 of the developing cartridge 1014 at the communication position adjacent to (closest to) the external cover 1100 and the main unit-side antenna 1051 and the send-receive circuit 1052 on the apparatus main unit side, even if no exhaust duct 1060 is provided as in the present embodiment, and it is also possible to provide guide plates 1072 so that the in-flowing external air flows between the memory tag 1041 of the developing cartridge 1014 and the main unit-side antenna 1051 on the apparatus main unit side, as shown FIG. 22. In this case, air is not forcibly blown as in the present embodiment, but it is possible to let external air flow in without being impeded by the external cover 1100, so that as a result, the memory tag 1041 and the like can be cooled. Needless to say, it is also possible to apply the vent holes 1071 and the guide plates 1072 to the present embodiment to achieve more effective cooling.

Figure 23:
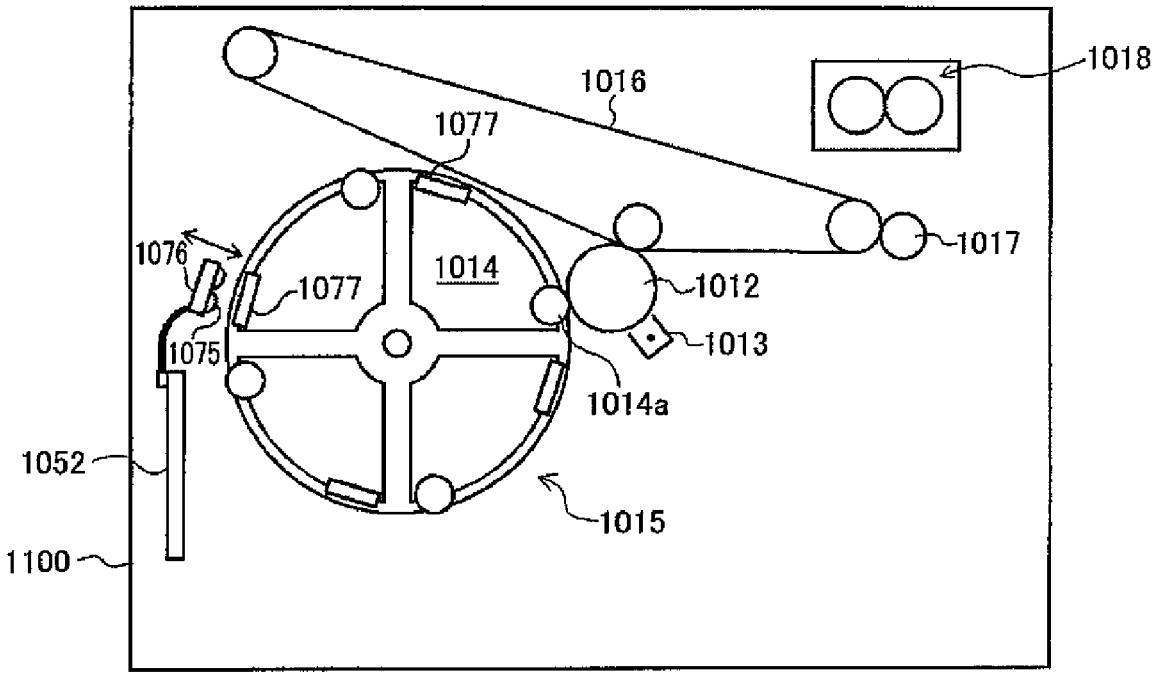
FIG. 23 is a transparent front view showing the diagrammatic configuration of a second alternative embodiment of the second invention.

As a second alternative form of this embodiment, the present invention can also be applied to cases in which, instead of an antenna for communication in a noncontacting manner as in the present embodiment, a connector 1076 provided with electrode terminals 1075 is connected with the send-receive circuit 1052 on the apparatus main unit side, and a memory tag 1077 with exposed electrode terminals not shown in the drawings is placed on the side of the developing cartridge 1014, as shown in FIG. 23, so that during communication, the connector 1076 approaches the memory tag 1077 and the electrode terminals 1075 are pressed against each other, thereby establishing a connection allowing communication by contact. In this case, as in the above embodiment, the memory tag 1077 on the outer surface of the developing cartridge 1014 in the communication position and the send-receive circuit 1052 on the apparatus main unit side can be cooled more effectively by utilizing the suction (flow) of air from the exhaust duct 1060 to blow air onto their surroundings, in an environment, in which they are closest to the external cover 1100 of the apparatus main unit and removed from heat-generating members, such as the pair of fixing rollers 1018.

With this embodiment, during communication, the storage element on the outer surface of the developing cartridge is positioned at a position where it is closest to the external cover of the apparatus main unit, so that the thermal influence of devices that are heat-generating members within the apparatus main unit is small and it is possible to perform the communication processes of reading and writing stored information. Consequently, it is possible to avoid errors occurring during the reading and writing of information stored in the storage element, or that the performance of the communication processing of this stored information drops. As a result, by accessing the storage element of each developing cartridge accurately and speedily, it is possible to smoothly utilize the information stored in the storage elements for the drive control of the image processing or the like.

The preceding was an explanation of an embodiment of the present invention, but the present invention is not limited to this embodiment, and needless to say, the present invention can be embodied through various different forms within the technical scope of the invention. For example, in the present embodiment, an image forming apparatus is explained, in which the developing cartridges are stored in a developing rotary unit, but there is not limitation to this, and for example, it is also possible to apply the present invention to an image forming apparatus with a configuration, in which the developing cartridges are lined up side by side, or one in which the developing cartridges are disposed around the photoconductive drum. Furthermore, in the present embodiment, an example of developing cartridges is explained, in which the developing roller is integrally attached to a container containing the toner, but there is no limitation to this, and it is also possible to devise a developing cartridge in which a developing device, such as the developing roller, and a toner-containing container (toner cartridge) are fabricated as separate members and mounted separately in the apparatus main unit.

Overview of Image Forming Apparatus of Third Embodiment

The following is an explanation of a third embodiment of the present invention, with reference to the drawings. FIGS. 24 to 28 are diagrams showing an embodiment of an image forming apparatus according to a third embodiment of the present invention.

Figure 24:
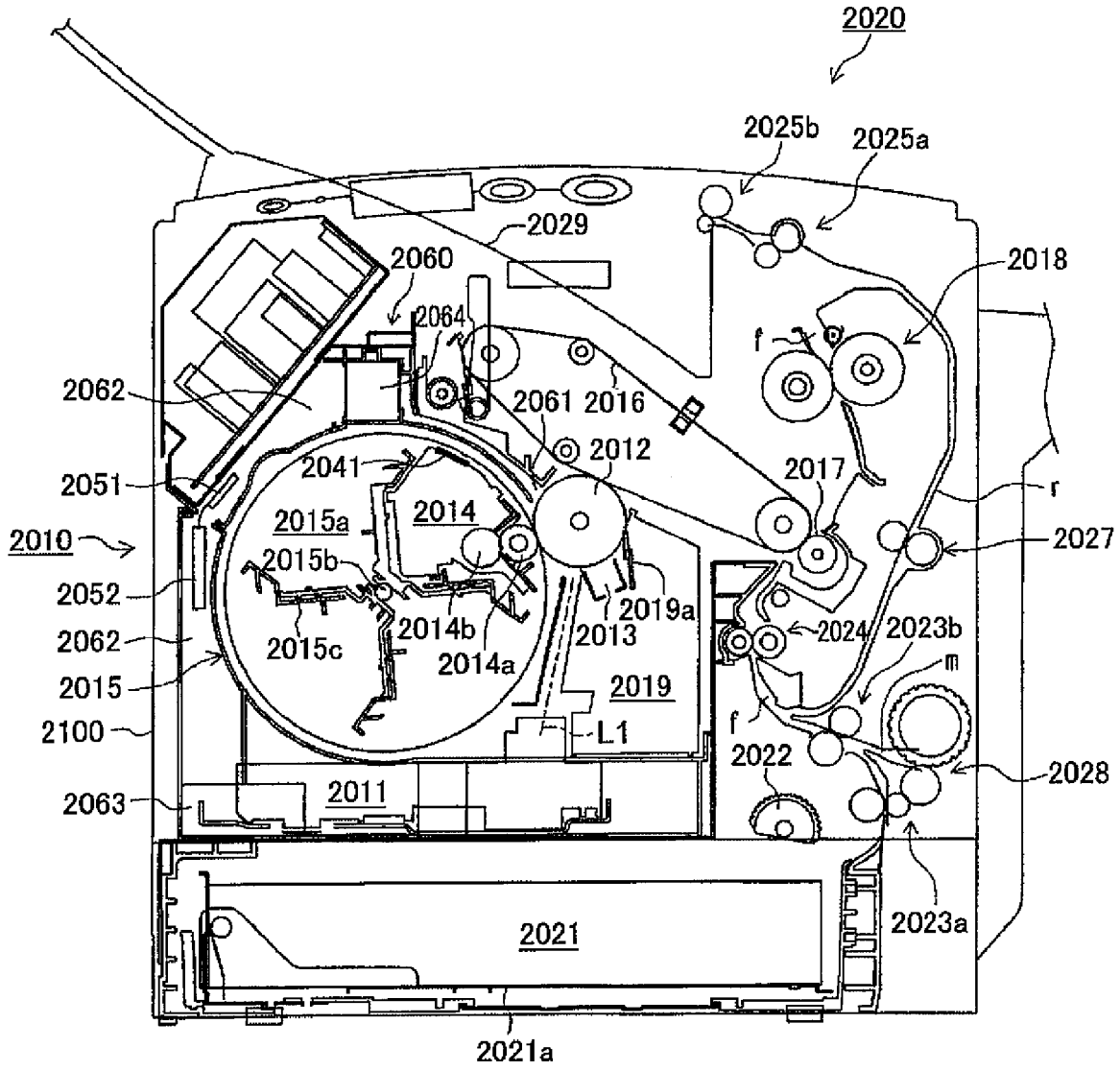
FIG. 24 is a diagram showing an embodiment of an image forming apparatus according to a third invention, and is a transparent front view showing its overall schematic configuration.
Figure 25:
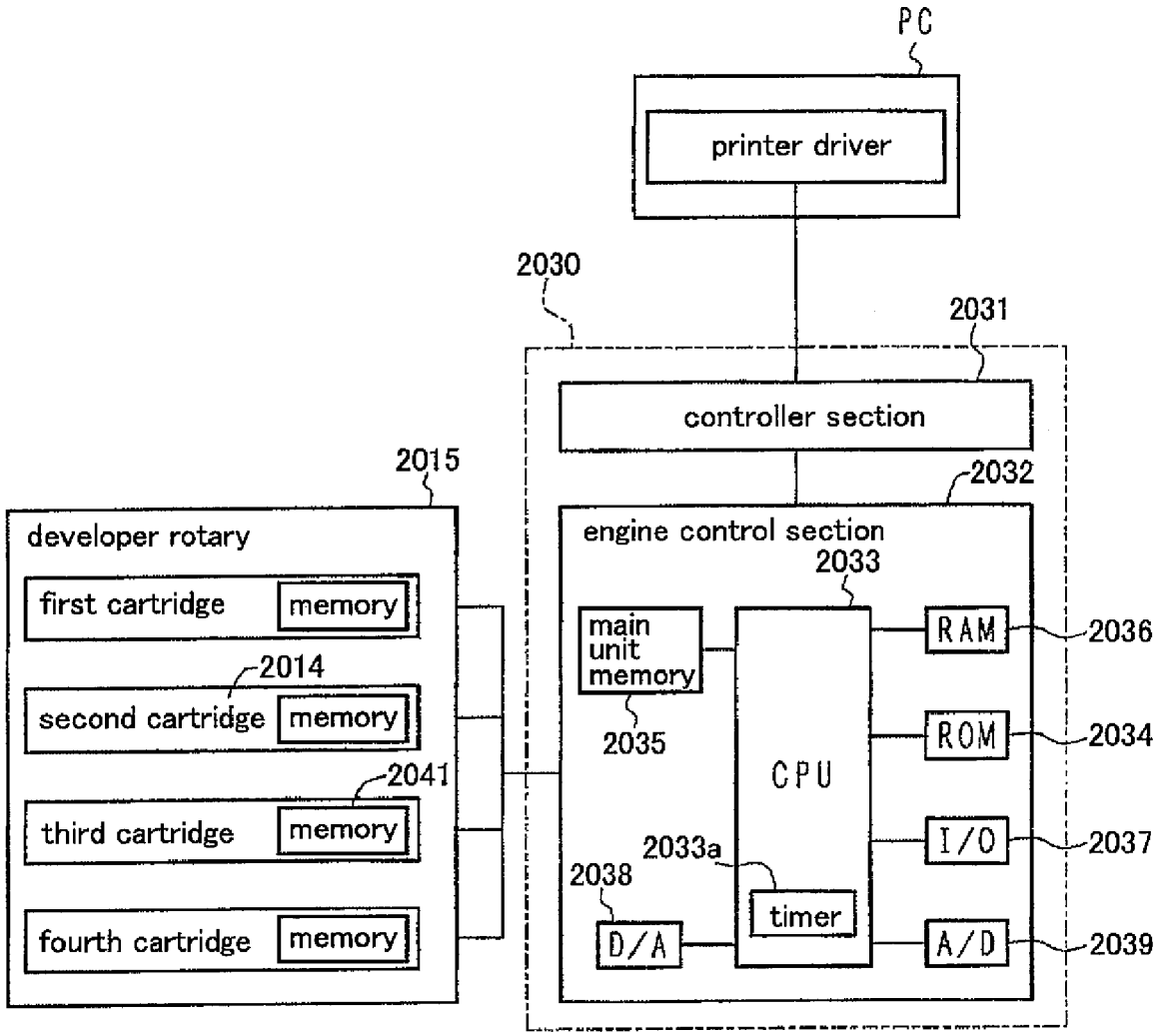
FIG. 25 is a relational block diagram illustrating its controller.

In FIG. 24 and FIG. 25, the image forming apparatus is a printer that is used by connecting it to an external device such as a personal computer PC that creates and outputs images of text or the like. This image forming apparatus includes an image recording device 2010 that records and forms images on one side or both sides of recording paper (recording medium) through electrophotography by reading in image data of text or the like to be image-formed, a paper carry device 2020 that carries a plurality of stacked recording papers to the image recording device 2010 and carries the recording paper on which an image has been recorded and formed out of the apparatus, stacking the recording paper, and a control unit 2030 that is connected to a personal computer PC and makes print-outs by forming images on the recording paper through comprehensive control of the overall apparatus including the image recording device 2010 and the paper carry device 2020 in accordance with the image data that has been received.

Simply speaking, the image recording device 2010 includes, as shown in FIG. 24, a laser beam scanning device 2011 scanning a laser beam L1 based on image data, a photoconductive drum (bearing member) 2012 on the surface of which an electrostatic latent image is exposed and formed based on image data that is irradiated and scanned with the laser beam L1 from the laser beam scanning device 2011, a charge device 2013 charging the outer circumferential surface of the photoconductive drum 2012 such that an electrostatic latent image can be formed by irradiating the laser beam L1, a developing cartridge 2014 (shown only at one place) for each of the colors, which contains yellow (Y), cyan (C), magenta (M) or black (K) toner and performs toner development of the electrostatic latent image on the photoconductive drum 2012, a developing rotary unit 2015 holding the developing cartridges 2014 in preset spaces 2015*a* for each color and rotating them around a rotation shaft 2015*b*, an intermediate image transfer belt (intermediate image transfer medium) 2016, which can receive the toner image developed on the photoconductive drum 2012 so that a toner image (monochrome image or color image) is formed on it that can be transferred and recorded on recording paper, an image transfer roller 2017 transferring the toner image carried on the intermediate image transfer belt 2016 by applying a contact pressure (nip) such that the recording paper carried up to it is sandwiched between the image transfer roller 2017 and the intermediate image transfer belt 2016, and carrying the recording paper downstream while clamping the recording paper, a pair of fixing rollers 2018 fixing the toner image by applying heat and contact pressure to the recording paper onto which the toner image has been transferred and which has been carried up to them, and clamping and carrying the recording paper further downstream, and a waste toner tank 2019 collecting and accumulating toner that has remained on the photoconductive drum 2012 with a blade 2019*a*.

Thus, in the image recording device 2010, the developing cartridge 2014 inside the developing rotary unit 2015 that has been switched in accordance with the image data develops with toner the electrostatic latent image based on the image data formed on the surface of the photoconductive drum 2012 with the laser beam scanning device 2011. And after that, the toner image on the photoconductive drum 2012 is transferred and recorded via the intermediate image transfer belt 2016 onto recording paper that has been carried with the paper carry device 2020, and then fixed by applying heat and pressure with the pair of fixing rollers 2018, thus accomplishing image formation. It should be noted that the intermediate image transfer belt 2016, the image transfer roller 2017 and the pair of fixing rollers 2018 of this image recording device also have the function of carrying the recording paper, so that they also constitute a part of the paper carry device 2020 explained below. Also the unit of the intermediate image transfer belt 2016 is provided with a waste toner tank in which the toner remaining on the belt 2016 is collected with a blade and stored.

Simply speaking, the paper carry device 2020 includes, as shown in FIG. 24, a paper cassette 2021, which is removably set in a lower section of the apparatus main unit and in which a plurality of sheets of recording paper are stacked, a pick-up roller 2022, which picks up the uppermost recording paper by rotating while being pressed against the stack of recording paper that has been elevated with an elevating plate 2021*a* at the bottom surface of the paper cassette 2021, thereby feeding the recording paper to a carry path f, a pair of relay carry rollers 2023*a* and 2023*b*, which receive the recording paper that is fed to them by the pick-up roller 2022 and clamp and carry the recording paper to the carry path f further downstream, a pair of registration rollers 2024, which receive the recording paper in the carry path f that is carried by the pair of relay carry rollers 2023*a* and 2023*b* and clamp and carry the recording paper to an image recording formation position given by the intermediate image transfer belt 2016 and the image transfer roller 2017 of the image recording device 2010, and a pair of paper discharge rollers 2025*a* and 2025*b*, which receive the recording paper on one side of which a fixed image has been formed by carrying the recording paper along the carry path f from the pair of registration rollers 2024, between the intermediate image transfer belt 2016 and the image transfer roller 2017 and between the pair of fixing rollers 2018, and which carries and discharges and stacks the recording paper on a paper discharge table 2029 on top of the apparatus main unit.

Thus, after the recording paper that has been picked up from the paper cassette 2021 with the pick-up roller 2022 has been passed on via the pair of relay carry rollers 2023*a* and 2023*b* to the pair of registration rollers 2024, the paper carry device 2020 supplies the recording paper to the image recording formation position at which the recording paper is pressed against by the intermediate image transfer belt 2016 and the image transfer roller 2017 such that the pair of registration rollers 2024 is synchronized with the operation of the image recording device 2010. The recording paper, on which the toner image on the intermediate image transfer belt 2016 has been transferred and recorded, and the image based on the image data has been fixed (recording formation) with the pair of fixing rollers 2018, is received by the pair of paper discharge rollers 2025*a* and 2025*b* and is carried and ejected and stacked on the paper discharge table 2029.

It should be noted that this paper carry device 2020 includes a reverse carry path r and a pair of intermediate carry rollers 2027 disposed on this path r for turning over recording paper on one side of which an image has been formed and feeding it to the carry path f on the upstream side of the pair of registration rollers 2024. The recording paper, which has been fed into the reverse carry path r by inverting the rotation of the pair of paper discharge rollers 2025*a* and 2025*b* is received by the pair of intermediate carry rollers 2027 and passed on to the pair of registration rollers 2024, so that image formation on both sides of the recording paper is possible. Moreover, the paper carry device 2020 includes a manual feed path m and a pair of manual feed rollers 2028 disposed on this path m for manually feeding recording paper into the carry path f on the upstream side of the pair of registration rollers 2024. Image formation on one side or both sides of the recording paper is possible by receiving the recording paper inserted into this manual feed path m with the pair of manual feed rollers 2028 and passing it to the pair of registration rollers 2024.

As shown in FIG. 25, the control unit 2030 includes a controller section 2031 and an engine controller 2032 implemented on a circuit board mounted inside the apparatus main unit. These perform various kinds of data process control and drive control of the various components of the apparatus in accordance with a program that is provided in advance.

Simply speaking, the controller section 2031 exchanges various kinds of information, such as print commands, with a printer driver of a personal computer PC, with a CPU not shown in the drawings successively executing various processes in accordance with a processing program stored in a memory, receives image data, such as text, to be formed as an image (printed) on the recording paper, and temporarily stores the image data in a memory not shown in the drawings. Since the image data (image information signal) received from the personal computer PC is so-called RGB data of red (R), green (G) and blue (B), the controller section 2031 reads the data from the memory and passes it to the engine controller 2032 while converting this data into so-called YMCK image data of yellow (Y), magenta (M), cyan (C) and black (K) that can be printed.

With the CPU 2033 following the control program stored in the ROM 2034, the engine controller 2032 receives the image data page by page, for example, from the controller section 2031 and temporarily stores it in a main unit-side memory 2035, and an image based on this image data is formed on the recording paper by exchanging various kinds of information with the image recording device 2010 and the paper carry device 2020 while using a RAM 2036 as a working area. Moreover, when the CPU 2033 performs the image formation control at this time, it lets each component of the apparatus operate optimally by measuring the various processing times with an internal timer function (time measurement means) 2033*a*.

Thus, when the control unit 2030 receives image data from the personal computer PC or the like, the controller section 2031 outputs image data, which it has converted from RGB data to YMCK data, to the engine controller 2032, while temporarily storing the image data. The CPU 2033 of the engine controller 2032 comprehensively controls the image recording device 2010 and the paper carry device 2020 based on the image data from the controller section 2031 stored in units of pages in the main unit memory 2035. In accordance with this control, the electrostatic latent image formed on the photoconductive drum 2012 based on the image data is developed with toner by the developing cartridge 2014, and this toner image is transferred to and fixed on one or both sides of recording paper that has been carried from the paper cassette 2021 to form an image, and the recording paper is carried to and stacked on the paper discharge table 2029.

It should be noted that in FIG. 25, an I/O interface 2037 is connected between the image recording device 2010, the paper carry device 2020 and the controller section 2031 on the one hand and the engine controller 2032 on the other hand, such that various kinds of information can be exchanged. A D/A converter 2038 and an A/D converter 2039 convert digital signals (D) into analog signals (A) and convert analog signals into digital signals, such that the various kinds of information that the engine controller 2032 exchanges with the image recording device 2010, the paper carry device 2020 and the controller section 2031 can be processed by these.

The developing cartridges 2014 of the image recording device 2010 are provided with a similar external shape, such that they can be accommodated in a plurality of storage positions that are partitioned by partitioning frames 2015*c* that rotate around the rotation shaft 2015*b* of the developing rotary unit 2015. Based on the print commands included in the image data from the personal computer PC, the CPU (controller) 2033 of the engine controller 2032 lets the developing rotary unit 2015 rotate around the rotation shaft 2015*b* to switch the developing cartridge 2014 facing the photoconductive drum 2012 and develop the toner image formed by transferring/fixing toner on one side or both sides of the recording paper.

For example, by storing in the developing rotary unit 2015 developing cartridges 2014 containing toner of the colors yellow (Y), cyan (C), magenta (M) and black (K) and switching the color of the toner for developing the electrostatic latent image on the photosensitive drum 2012, the image recording device 2010 can superimpose or select toner of various colors and print color images or monochrome images, based on the received image data.

Moreover, the image recording device 2010 can also perform image formation when toner of the same color is contained in all developing cartridges 2014 and those developing cartridges 2014 are mounted in the developing rotary unit 2015. For example, by mounting four developing cartridges 2014 containing toner of the same color black (K), it is possible to use the apparatus as a special purpose apparatus that successively switches the developing cartridges 2014 developing the electrostatic latent image on the photoconductive drum 2012 and continuously prints and forms monochrome images.

A so-called memory tag 2041 that is overall very compact and thin is adhered to a predetermined outer surface of each of the developing cartridges 2014 by making one side of it adhesive. When the memory tag 2041 is moved to a rotation position (communication position) facing a main unit-side antenna 2051 on the main unit side of the apparatus shown in FIG. 24, then it is arranged at a position along an external cover 100 of the apparatus main unit, or in other words, it is placed (adhered) on the outer surface of the developing cartridge 2014 in an upright orientation and at a position where it is closest to this external cover 100 and facing it. This memory tag 2041 is designed to store and hold relevant information and to pass the relevant information to the CPU 2033 of the engine controller 2032 by communicating in a noncontacting manner with a send-receive circuit 2052 on the apparatus main unit side via the main unit-side antenna 2051 to exchange various kinds of information. Here, the main unit-side antenna 2051, which is placed in a downward-facing orientation (an orientation in which no dust and dirt accumulates on it) on the apparatus main unit side, is fabricated in substantially the same manner as a later-described developing-side antenna 2043. The main unit-side antenna 2051 is placed within a distance of, for example, 10 mm of the memory tag 2041, so as to be able to communicate in a noncontacting manner with the memory tag 2041. The main unit-side antenna 2051 is connected to a circuit board constituting the send-receive circuit 2052 and performing communication in a noncontacting manner with the memory tag 2041. This send-receive circuit 2052 is connected via the I/O interface 2037 to the CPU 2033 of the engine controller 2032 on the apparatus main unit side.

Figure 26:
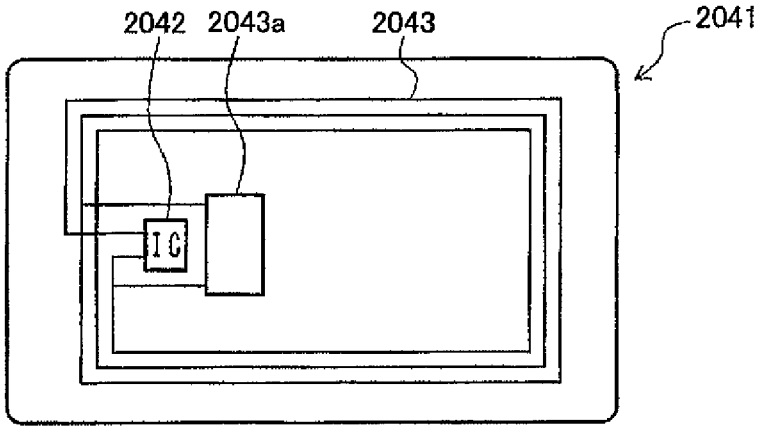
FIG. 26 is a diagram showing the configuration of its essential parts.
Figure 26:
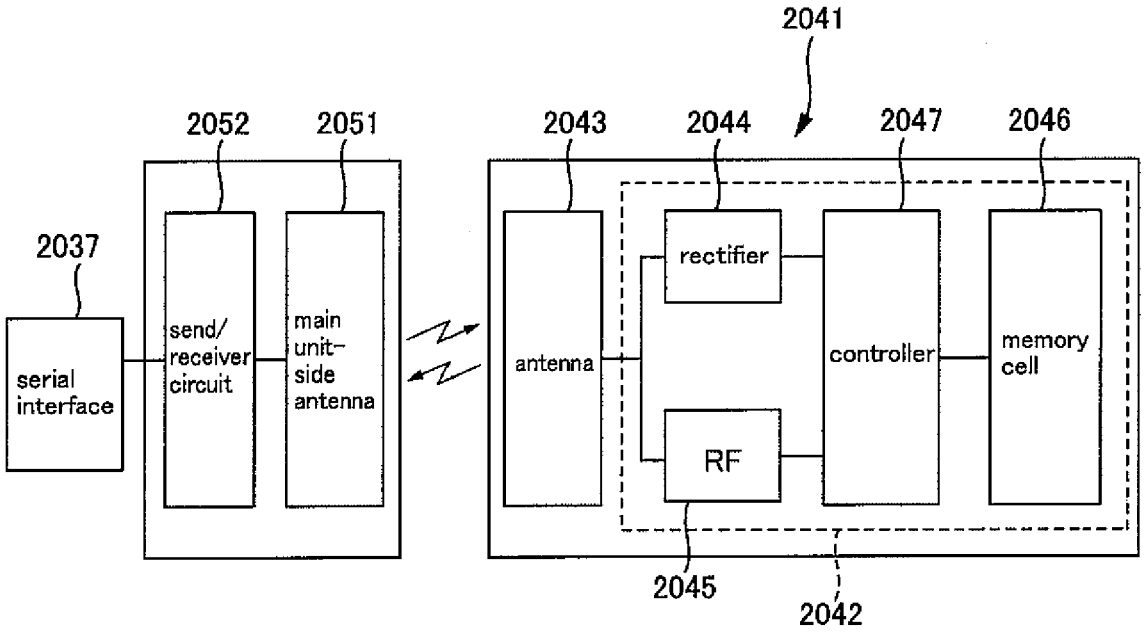

More specifically, as shown in FIG. 26(*a*), in the memory tag 2041 on the side of the developing cartridge 2014, a non-contact IC chip 2042 and the developing-side antenna 2043 are mounted on a plastic film and covered by a transparent cover sheet. The non-contact IC chip 2042 stores and holds various kinds of information based on commands from the send-receive circuit 2052 via the main unit-side antenna 2051 and reads relevant information from these various kinds of information, passing on the relevant information to the send-receive circuit 2052. The developing-side antenna 2043 is made by connecting in parallel the non-contact IC chip 2042 and a resonance capacitor 2043*a* that is formed by etching a metal film, and arranging a planar coil next to these, the planar coil going several times around the non-contact IC chip 2042 and the resonance capacitor 2043*a*. Thus, by receiving (absorbing) with the developing-side antenna 2043 a high-frequency magnetic field induced via the main unit-side antenna 2051 by high-frequency signals generated with the send-receive circuit 2052 on the apparatus main unit side, it is possible to access the memory tag 2041 quickly and perform an input into the non-contact IC chip 2042, without carrying out an operation of moving a connector and directly connecting it.

As shown in FIG. 26(*b*), the non-contact IC chip 2042 of the memory tag 2041 includes a rectifier 2044 serving as a DC power source that rectifies the high-frequency magnetic field (high-frequency signals) from the send-receive circuit 2052 on the apparatus main unit side received via the developing-side antenna 2043 and drives the various circuits within the chip, a signal analysis section RF (Radio Frequency) 2045, which analyzes the high-frequency signals of the received high-frequency magnetic field received via the developing-side antenna 2043 and generates a high-frequency magnetic field that can be absorbed by the main unit-side antenna 2051 by generating a high-frequency signal based on the various kinds of signals to be passed on to the send-receive circuit 2052 on the apparatus main unit side and inputting this high-frequency signal to the developing-side antenna 2043, a non-volatile memory cell 2046, such as a NAND flash-ROM or the like, that can store and hold information written into it and from which this stored information can be read out from the outside, and a controller 2047, which rewrites the information stored in the memory cell 2046 by exchanging various kinds of signals with the send-receive circuit 2052 on the side of the apparatus main unit via the signal analysis section RF 2045 and passes the stored information that has been read out to the send-receive circuit 2052, while being driven by the DC power source of the interposed rectifier 2044. That is to say, the memory cell 2046 constitutes a storage element, the developing-side antenna 2043 and the main unit-side antenna 2051 constitute a connection link that can be connected to enable communication in a noncontacting manner, the non-contact IC chip 2042 incorporating the memory cell 2046 and the developing-side antenna 2043 constitute a communication means (communication section) for communication in a noncontacting manner on the side of the developing cartridge 2014, whereas the main unit-side antenna 2051 and the send-receive circuit 2052 constitute a communication means (communication section) on the apparatus main unit side.

Here, stored and held inside the memory cell 2046 of the non-contact IC chip 2042 are unique ID information, such as a serial number for each memory tag 2041, manufacturing information, such as the date when the developing cartridge 2014 was manufactured or the manufacturing number, destination information specifying the destination of the developing cartridge 2014, model information specifying models to which the developing cartridge 2014 can be mounted, toner information, such as information on the color and the remaining amount of toner contained in the developing cartridge 2014, and various kinds of relevant information, such as the number of recycles or the number of times the developing cartridge 2014 has been mounted and dismounted. Thus, the engine controller 2032 of the control unit 2030 can perform an optimal image formation control, by suitably ascertaining various kinds of information that the CPU 2033 has stored and held in the main unit-side memory 2035, such as the presence and the position of the developing cartridge 2014 in the storage position of the developing rotary unit 2015, or information about the color of the toner of the developing cartridge 2014. Moreover, if an error occurs, the various kinds of information can be useful in finding the cause of the error by displaying/outputting the information to an operation port.

Moreover, through synchronized rotation of the developing roller 2014*a* facing the surface of the photoconductive drum 2012 via a gap, the developing cartridge 2014 performs toner development by transferring toner and letting it adhere to the electrostatic latent image formed on that surface. The photoconductive drum 2012 rotates clockwise in FIG. 24, whereas the developing roller 2014*a* rotates counterclockwise in FIG. 24, so that a small fraction of the toner that is about to be transferred from the developing roller 2014*a* to the photoconductive drum 2012 is scattered and drifts to the downstream side of these rotation directions. Accordingly, an exhaust duct 2060 whose suction opening is above the vicinity of the position where the developing roller 2014*a* opposes the photoconductive drum 2012 (developing position) is arranged on the downstream side of the rotation directions of the developing roller 2014*a* and the photoconductive drum 2012. It should be noted that toner is supplied to the developing roller 2014*a* of the developing cartridge 2014 by pressing a supply roller 2014*b* rotating within the toner containing space of the developing cartridge 2014 against the developing roller 2014*a*.

As shown in FIG. 24, the exhaust duct 2060 includes a suction opening 2061, an exhaust path 2062 and an exhaust opening 2063. The suction opening 2061 is arranged above the vicinity of the developing position where the developing roller 2014*a* of the developing cartridge 2014 faces the photoconductive drum 2012 (the vicinity of the developing position on the inward side, with respect to the apparatus main unit, of the developing rotary unit 2015). The exhaust path 2062 describes an exhaust flow channel from the suction opening 2061, going around and covering the upper side of the developing rotary unit 2015 toward the external cover 1100 on the side of the side wall, and then descending along the external cover 1100. A suction fan (not shown in the drawings) sucking air inside the exhaust path 2062 is arranged in the exhaust opening 2063, which is disposed near the bottom of the developing rotary unit 2015 adjacent to the external cover 1100 on the side of the side wall. A filter 2064, which adsorbs and removes toner that has become intermingled in the suction air, is arranged in the exhaust path 2062 of the exhaust duct 2060, positioned above the developing rotary unit 2015. Thus, a design is achieved with which no toner is included in the exhaust air discharged from the exhaust opening 2063, polluting the surroundings.

Figure 27:
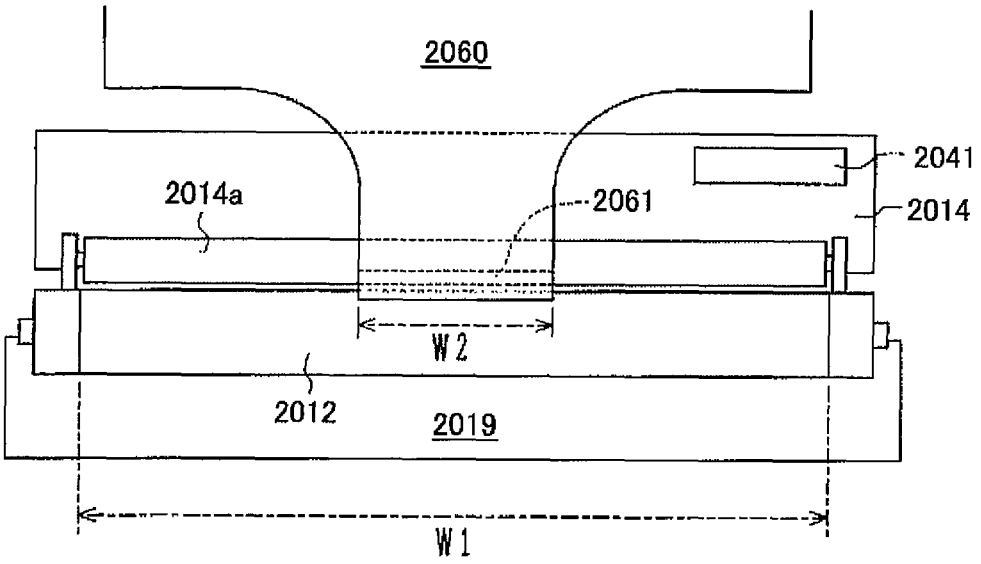
FIG. 27 is a top view illustrating the arrangement of its exhaust duct.

Moreover, as shown in FIG. 27, the suction opening 2061 of the exhaust duct 2060 is formed so that it is shorter than the width W1 of the developing position in the main scanning direction (axial direction) where the developing roller 2014*a* of the developing cartridge 2014 faces the photoconductive drum 2012, for example to a width W2 of about ¼ thereof, and is designed to provide suction above the vicinity of this developing position. In the exhaust duct 2060, a suction fan is driven such that its suction force reaches the entire length in the main scanning direction above the vicinity of the developing position from the suction opening 2061.

Figure 28:
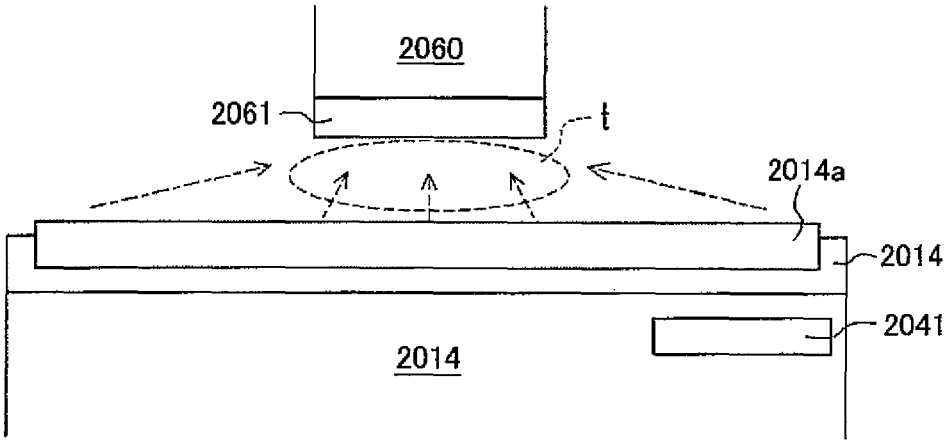
FIG. 28 is a side view illustrating the suction of its exhaust duct.

At this time, the suction opening 2061 of the exhaust duct 2060 approaches both the photoconductive drum 2012 and the developing roller 2014*a* (to an extent that it does not contact the developing roller 2014*a* during the rotation of the developing cartridge 2014) and provides suction above the developing position where they face each other, so that it is possible to effectively draw in air over the entire length above the vicinity of the developing position where the photoconductive drum 2012 faces the developing roller 2014*a*, without drawing in a large amount of air from locations outside the developing position (for example from the open space removed from the end in axial direction of the photoconductive drum 2012 or the developing roller 2014*a*), and toner t drifting above the vicinity of the developing position can be collected on the side of the suction opening 2061 and sucked in, as shown in FIG. 28.

Thus, the toner t drifting in the vicinity of the developing position where the photoconductive drum 2012 faces the developing roller 2014*a* of the developing cartridge 2014 is collected near the suction opening 2061 of the exhaust duct 2060, which is arranged at the center in the main scanning direction of these and is effectively sucked in, so that even if the developing cartridge 2014 is rotated before the toner is completely sucked away, hardly any toner will adhere to its outer surface, and even if some toner adheres thereto, toner can be kept from adhering to the entire outer surface of the developing cartridge 2014 by simply moving along a narrow region of the outer surface near the middle of the developing cartridge 2014.

On the other hand, when the developing rotary unit 2015 rotates, the memory tag 2041, which is placed on the outer surface of the developing cartridge 2014, is placed on the outer surface of the developing cartridge 2014 at a location that is further to the right in FIG. 27 than the range that faces the suction opening 2061 of the exhaust duct 2060 while moving relative to it (that is, the range passing near the suction opening 2061), so that also the main unit-side antenna 2051 on the apparatus main unit side is arranged at a communication position that is set at a position to the rearward side with respect to the paper plane of FIG. 24, so that it faces the memory tag 2041 (the developing-side antenna 2043).

Thus, the reading and rewriting of information stored in the memory cell 2046 can be accomplished with high reliability and accuracy, without the memory tag 2041 on the outer surface of the developing cartridge 2014 coming close to the suction opening 2061 of the exhaust duct 2060, without its surface (the developing-side antenna 2043) being polluted by toner t drawn in from this suction opening 2061, and without communication faults (connection faults) due to a decrease in the sensitivity of the signals exchanged with the main unit-side antenna 2051 while performing communication in a noncontacting manner. As a result, various kinds of processes, such as communication in a noncontacting manner, can be accomplished quickly between the memory tag 2041 and the send-receive circuit 2052, and it can be avoided that the toner t accumulating on the surface of the memory tag 2041 adheres and undergoes a reaction or the like.

Thus, in this embodiment, it can be avoided that toner t drifting near the suction opening 2061 of the exhaust duct 2060 contacts the surface of the memory tag 2041 (the developing-side antenna 2043 or the memory cell 2046) on the outer surface of the developing cartridge 2014, and unnecessarily adheres or accumulates thereon, and communication in a noncontacting manner and the reading and rewriting of stored information can be accomplished with high efficiency and without errors, without adversely affecting that surface or the internal elements and without connection faults (communication faults in the communication in a noncontacting manner) between the developing-side antenna 2043 and the main unit-side antenna 2051. Consequently, the processes of rewriting or reading the various kinds of information in the memory tags 2041 of each of the developing cartridges 2014 can be carried out accurately and speedily, and the information that is necessary for the drive control of the various components of the apparatus can be made accessible in a smooth manner.

Figure 29:
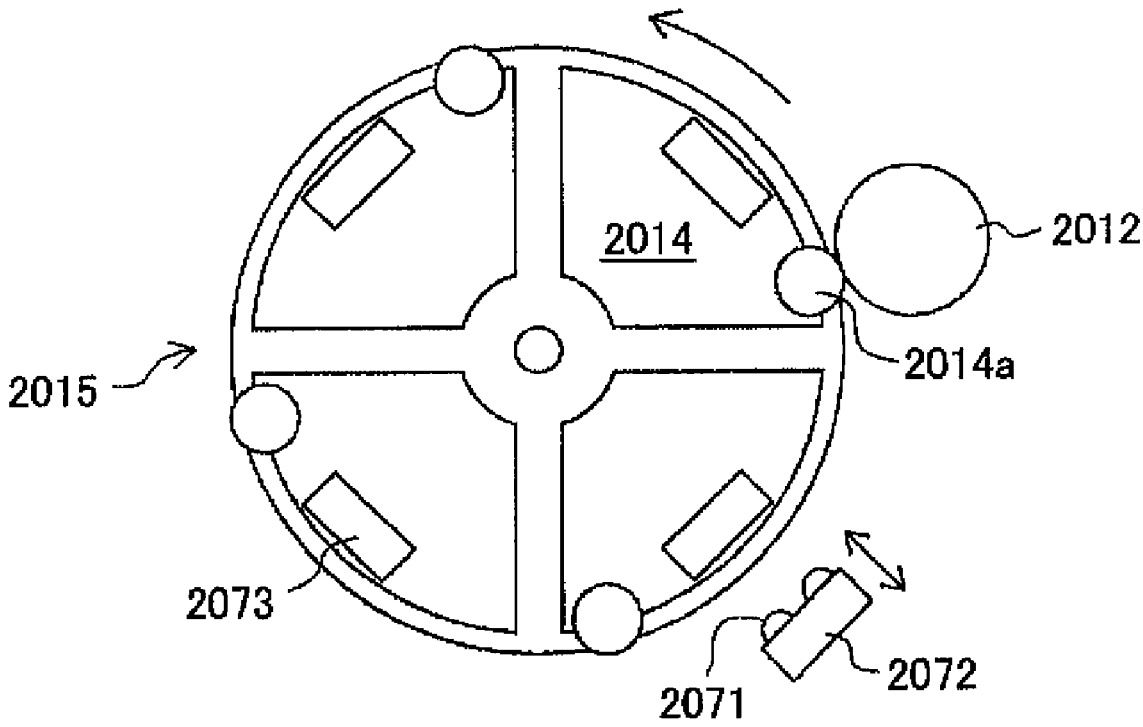
FIG. 29 is a diagram showing another embodiment, and is a diagrammatic transparent front view showing the configuration of its essential parts.
Figure 30:
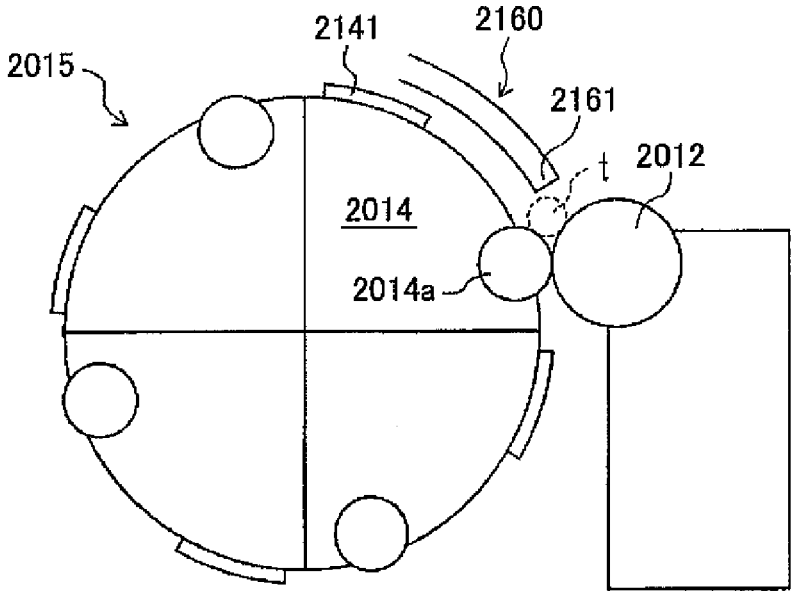
FIG. 30 is a diagram illustrating the problem.
Figure 30:
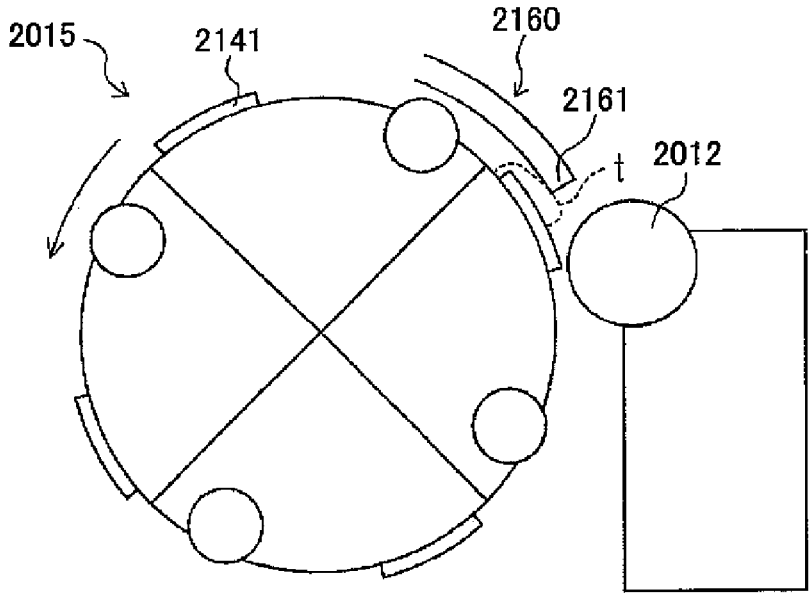

As an alternative form of this embodiment, the present invention can also be applied to cases in which, instead of an antenna for communication in a noncontacting manner as in the present embodiment, a connector 2072 provided with electrode terminals 2071 is connected with the send-receive circuit 2052 on the apparatus main unit side, and a memory tag 2073 with exposed electrode terminals not shown in the drawings is placed on the side of the developing cartridge 2014, as shown in FIG. 29, so that during communication, the connector 2072 approaches the memory tag 2073 and the electrode terminals 2071 are pressed against each other, thereby establishing a connection allowing communication by contact. In this case, as in the above embodiment, it can be avoided that dust or dirt unnecessarily adheres or accumulates on the surface of the memory tag 2073 (electrode terminal) on the outer surface of the developing cartridge 2014 in the communication position, and the connector 2072 can be brought with high reliability into conductive contact with the memory tag 2073 of each of the developing cartridges 2014, so that the processes of rewriting and reading the various kinds of information in the memory cell can be carried out accurately and speedily.

Moreover, in the above embodiment, an example was explained, in which the suction opening 2061 of the exhaust duct 2060 is formed narrowly, but there is no limitation to this. For example, also when the suction opening has a width of approximately the entire length in axial direction of the photoconductive drum 2012, it is possible to place the memory tag such that it is positioned further outside than the suction opening on the outer surface of the developing cartridge.

With the present embodiment, even when toner drifts in the vicinity of the suction opening of the duct, the storage element on the outer surface of the developing cartridge and the connection section on the apparatus main unit side are not moved through a region where this toner drifts, and it can be avoided that this drifting toner accumulates and pollutes them, thus becoming a cause for connection faults. Consequently, it is possible establish communication by which the information stored in the storage element can be exchanged accurately, without affecting the storage element and without the occurrence of connection faults between the developing cartridge side and the apparatus main unit side. As a result, it is possible to read out or rewrite the information stored in the storage element on the outer surface of the developing cartridge with high reliability, and to accurately access the storage element of each developing cartridge to smoothly utilize the information stored in the storage element for the drive control of the image processing or the like.

The preceding was an explanation of an embodiment of the present invention, but the present invention is not limited to this embodiment, and needless to say, the present invention can be embodied through various forms within the technical scope of the invention.

Overview of Image Forming Apparatus of Fourth Embodiment

The following is an explanation of a fourth embodiment of the present invention, with reference to the drawings. FIGS. 31 to 36 are diagrams showing an embodiment of an image forming apparatus according to the present invention.

Figure 31:
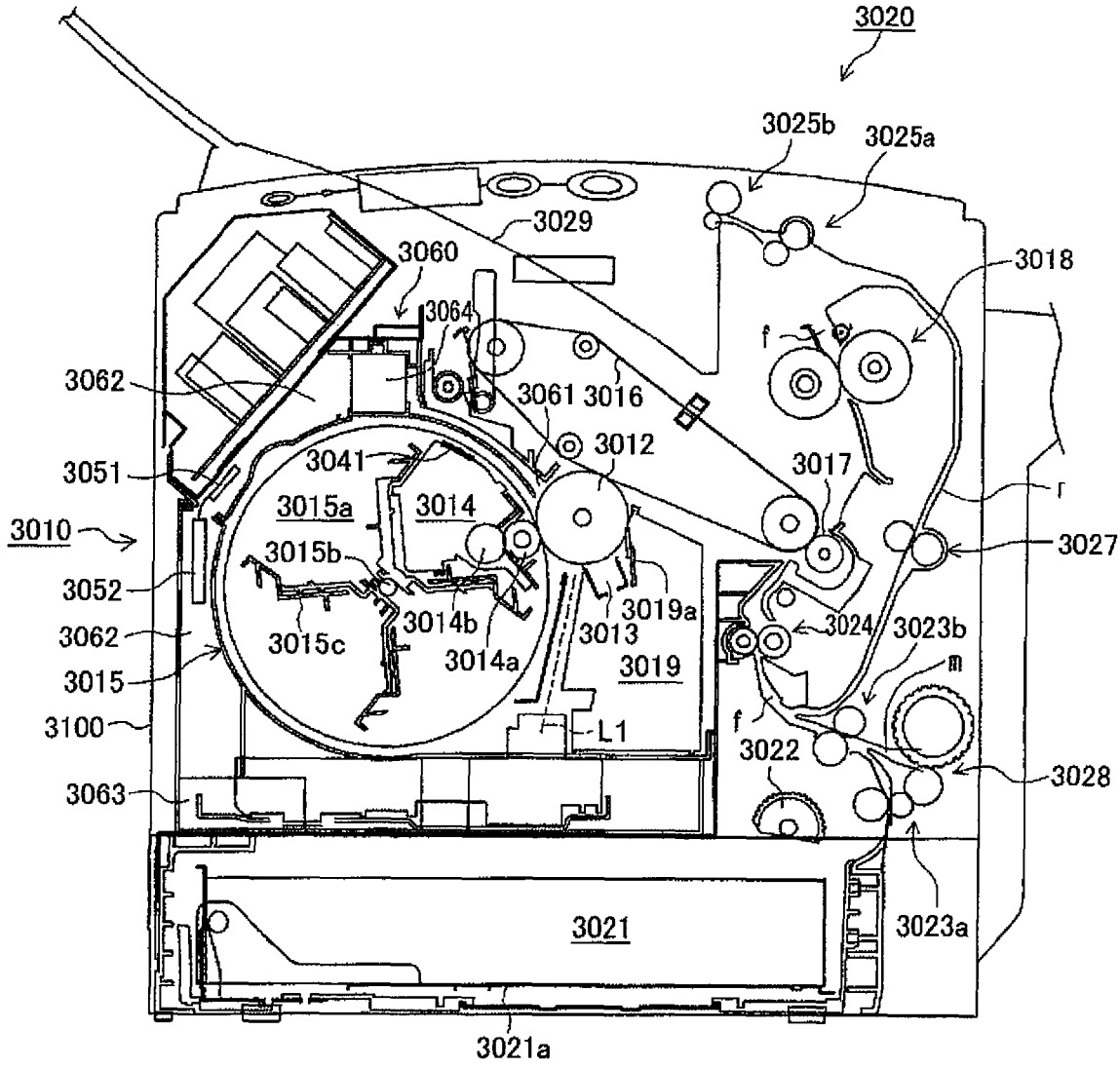
FIG. 31 is a diagram showing an embodiment of an image forming apparatus according to a fourth invention, and is a transparent front view showing its overall schematic configuration.
Figure 32:
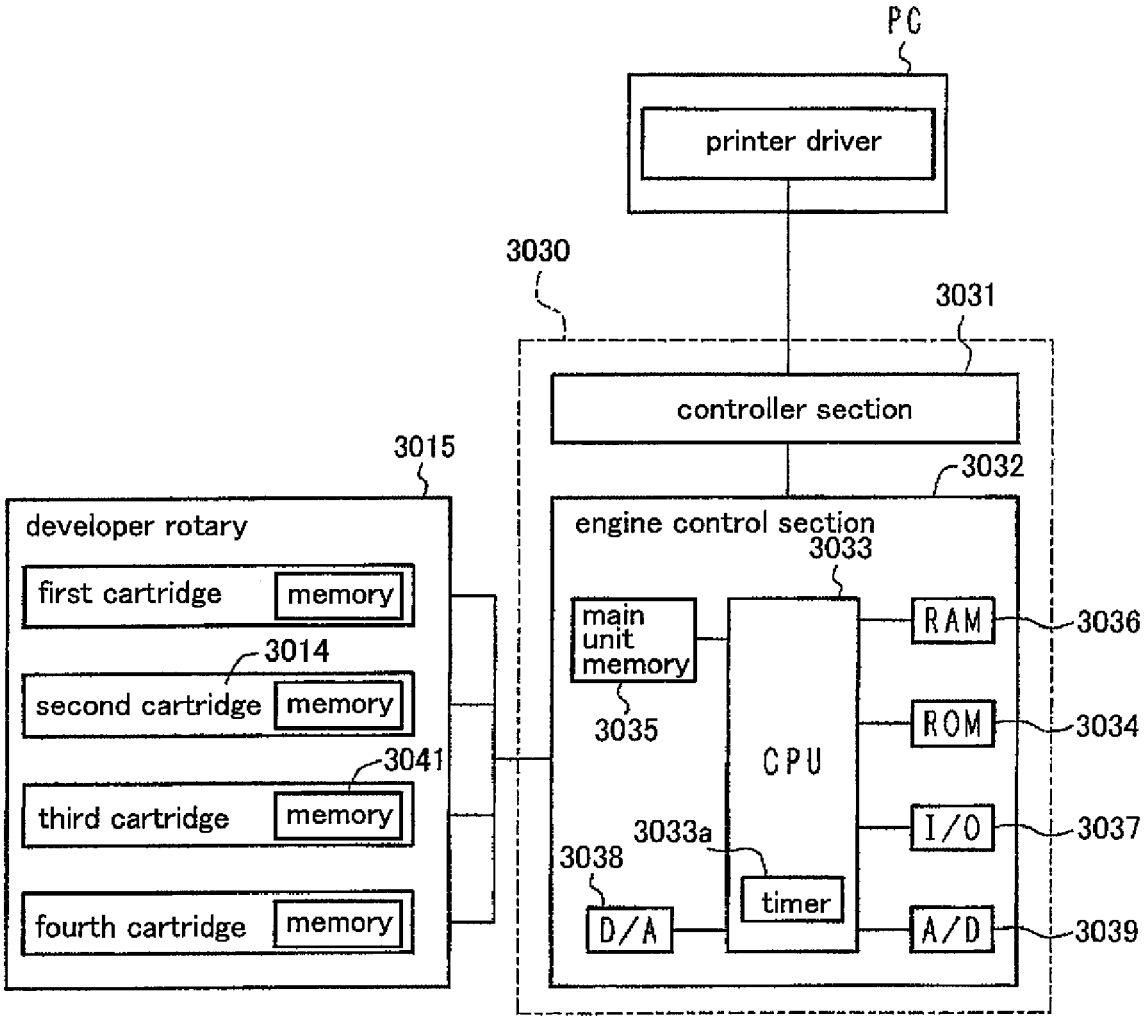
FIG. 32 is a relational block diagram illustrating its controller.

In FIG. 31 and FIG. 32, the image forming apparatus is a printer that is used by connecting it to an external device such as a personal computer PC that creates and outputs images of text or the like. This image forming apparatus includes an image recording device 3010 that records and forms images on one side or both sides of recording paper (recording medium) through electrophotography by reading in image data of text or the like to be image-formed, a paper carry device 3020 that carries a plurality of stacked recording papers to the image recording device 3010 and carries the recording paper on which an image has been recorded and formed out of the apparatus, stacking the recording paper, and a control unit 3030 that is connected to a personal computer PC and makes print-outs by forming images on the recording paper through comprehensive control of the overall apparatus including the image recording device 3010 and the paper carry device 3020 in accordance with the image data that has been received and the like.

Simply speaking, the image recording device 3010 includes, as shown in FIG. 31, a laser beam scanning device 3011 scanning a laser beam L1 based on image data, a photoconductive drum (bearing member) 3012 on the surface of which an electrostatic latent image is exposed and formed based on image data that is irradiated and scanned with the laser beam L1 from the laser beam scanning device 3011, a charge device 3013 charging the outer circumferential surface of the photoconductive drum 3012 such that an electrostatic latent image can be formed by irradiating the laser beam L1, a developing cartridge 3014 (shown only at one place) for each of the colors, which contains yellow (Y), cyan (C), magenta (M) or black (K) toner and selectively lets the contained toner adhere to perform toner development of the electrostatic latent image on the surface of the photoconductive drum 3012 by rotating, in synchronization, developing rollers

3014*a* facing the surface of the photoconductive drum 3012 across a gap, a developing rotary unit 3015 holding the developing cartridges 3014 in preset spaces 3015*a* for each color and rotating them around a rotation shaft 3015*b*, an intermediate image transfer belt (intermediate image transfer medium) 3016, which can receive the toner image developed on the photoconductive drum 3012 so that a toner image (monochrome image or color image) is formed on it that can be transferred and recorded on recording paper, an image transfer roller 3017 transferring the toner image carried on the intermediate image transfer belt 3016 by applying a contact pressure (nip) such that the recording paper carried up to it is sandwiched between the image transfer roller 3017 and the intermediate image transfer belt 3016, and carrying the recording paper downstream while clamping the recording paper, a pair of fixing rollers 3018 fixing the toner image by applying heat and contact pressure to the recording paper onto which the toner image has been transferred and which has been carried up to them, and clamping and carrying the recording paper further downstream, and a waste toner tank 3019 collecting and accumulating toner that has remained on the photoconductive drum 3012 with a blade 3019*a*. It should be noted that toner is supplied to the developing roller 3014*a* of the developing cartridge 3014 by pressing and rotating a supply roller 3014*b* rotating within the toner containing space of the developing cartridge 3014 against the developing roller 3014*a*. Also the unit of the intermediate image transfer belt 3016 is provided with a waste toner tank in which the toner remaining on the belt 3016 is collected with a blade and stored.

Thus, in the image recording device 3010, the developing cartridge 3014 inside the developing rotary unit 3015 that has been switched in accordance with the image data develops with toner the electrostatic latent image based on the image data formed on the surface of the photoconductive drum 3012 with the laser beam scanning device 3011. And after that, the toner image on the photoconductive drum 3012 is transferred and recorded via the intermediate image transfer belt 3016 onto recording paper that has been carried with the paper carry device 3020, and then fixed by applying heat and pressure with the pair of fixing rollers 3018, thus accomplishing image formation.

Here, with this developing cartridge 3014, when the developing roller 3014*a* that rotates while facing the photoconductive drum 3012 across the gap transfers and adheres contained toner to the surface of the photoconductive drum 3012, a small fraction of the toner is scattered and drifts to the downstream side in the rotation direction, so that an exhaust duct 3060 sucks in air with a suction fan not shown in the drawings from a suction opening 3061 above the vicinity of the position where the developing roller 3014*a* opposes the photoconductive drum 3012, and exhausts the air via an exhaust path 3062 from an exhaust opening 3063. The toner included in the air that is sucked in is adsorbed and removed by a filter 3064 arranged midway in the exhaust path 3062, thereby preventing the outside of the apparatus from being polluted.

Simply speaking, the paper carry device 3020 includes, as shown in FIG. 31, a paper cassette 3021, which is removably set in a lower section of the apparatus main unit and in which a plurality of sheets of recording paper are stacked, a pick-up roller 3022, which picks up the uppermost recording paper by rotating while being pressed against the stack of recording paper that has been elevated with an elevating plate 3021*a* at the bottom surface of the paper cassette 3021, thereby feeding the recording paper to a carry path f, a pair of relay carry rollers 3023*a* and 3023*b*, which receive the recording paper that is fed to them by the pick-up roller 3022 and clamp and carry the recording paper to the carry path f further downstream, a pair of registration rollers 3024, which receive the recording paper in the carry path f that is carried by the pair of relay carry rollers 3023*a* and 3023*b* and clamp and carry the recording paper to an image recording formation position given by the intermediate image transfer belt 3016 and the image transfer roller 3017 of the image recording device 3010, and a pair of paper discharge rollers 3025*a* and 3025*b*, which receive the recording paper on one side of which a fixed image has been formed by carrying the recording paper along the carry path f from the pair of registration rollers 3024, between the intermediate image transfer belt 3016 and the image transfer roller 3017 and between the pair of fixing rollers 3018, and which carries and discharges and stacks the recording paper on a paper discharge table 3029 on top of the apparatus main unit. It should be noted that the intermediate image transfer belt 3016, the image transfer roller 3017 and the pair of fixing rollers 3018 of this image recording device also have the function of carrying the recording paper, so that they also constitute a part of the paper carry device 3020.

Thus, after the recording paper that has been picked up from the paper cassette 3021 with the pick-up roller 3022 has been passed on via the pair of relay carry rollers 3023*a* and 3023*b* to the pair of registration rollers 3024, the paper carry device 3020 supplies the recording paper to the image recording formation position at which the recording paper is pressed against by the intermediate image transfer belt 3016 and the image transfer roller 3017 such that the pair of registration rollers 3024 is synchronized with the operation of the image recording device 3010. The recording paper, on which the toner image on the intermediate image transfer belt 3016 has been transferred and recorded, and the image based on the image data has been fixed (recording formation) with the pair of fixing rollers 3018, is received by the pair of paper discharge rollers 3025*a* and 3025*b*, and is carried and ejected and stacked on the paper discharge table 3029.

Here, this paper carry device 3020 includes a reverse carry path r and a pair of intermediate carry rollers 3027 disposed on this path r for turning over recording paper on one side of which an image has been formed and feeding it to the carry path f on the upstream side of the pair of registration rollers 3024. The recording paper, which has been fed into the reverse carry path r by inverting the rotation of the pair of paper discharge rollers 3025*a* and 3025*b*, is received by the pair of intermediate carry rollers 3027 and passed on to the pair of registration rollers 3024, so that image formation on both sides of the recording paper is possible. Moreover, the paper carry device 3020 includes a manual feed path m and a pair of manual feed rollers 3028 disposed on this path m for manually feeding recording paper into the carry path f on the upstream side of the pair of registration rollers 3024. Image formation on one side or both sides of the recording paper is possible by receiving the recording paper inserted into this manual feed path m with the pair of manual feed rollers 3028 and passing it to the pair of registration rollers 3024.

As shown in FIG. 32, the control unit 3030 includes a controller section 3031 and an engine controller 3032 implemented on a circuit board mounted inside the apparatus main unit. These perform various kinds of data process control and drive control of the various components of the apparatus in accordance with a program that is provided in advance.

Simply speaking, the controller section 3031 exchanges various kinds of information, such as print commands, with a printer driver of a personal computer PC, with a CPU not shown in the drawings successively executing various processes in accordance with a processing program stored in a memory, receives image data, such as text, to be formed as an image (printed) on the recording paper, and temporarily stores the image data in a memory not shown in the drawings. Since the image data (image information signal) received from the personal computer PC is so-called RGB data of red (R), green (G) and blue (B), the controller section 3031 reads the data from the memory and passes it to the engine controller 3032 while converting this data into so-called YMCK image data of yellow (Y), magenta (M), cyan (C) and black (K) that can be printed.

With the CPU 3033 following the control program stored in the ROM 3034, the engine controller 3032 receives the image data page by page, for example, from the controller section 3031 and temporarily stores it in a main unit memory 3035, and an image based on this image data is formed on the recording paper by exchanging various kinds of information with the image recording device 3010 and the paper carry device 3020 while using a RAM 3036 as a working area. Moreover, when the CPU 3033 performs the image formation control at this time, it lets each component of the apparatus operate optimally by measuring the various processing times with an internal timer function (time measurement means) 3033*a*.

Thus, when the control unit 3030 receives image data from the personal computer PC or the like, the controller section 3031 outputs image data, which it has converted from RGB data to YMCK data, to the engine controller 3032, while temporarily storing the image data. The CPU 3033 of the engine controller 3032 comprehensively controls the image recording device 3010 and the paper carry device 3020 based on the image data from the controller section 3031 stored in units of pages in the main unit memory 3035. In accordance with this control, the electrostatic latent image formed on the photoconductive drum 3012 based on the image data is developed with toner by the developing cartridge 3014, and this toner image is transferred to and fixed on one or both sides of recording paper that has been carried from the paper cassette 3021 to form an image, and the recording paper is carried to and stacked on the paper discharge table 3029.

It should be noted that in FIG. 32, an I/O interface 3037 is connected between the image recording device 3010, the paper carry device 3020 and the controller section 3031 on the one hand and the engine controller 3032 on the other hand, such that various kinds of information can be exchanged. A D/A converter 3038 and an A/D converter 3039 convert digital signals (D) into analog signals (A) and convert analog signals into digital signals, such that the various kinds of information that the engine controller 3032 exchanges with the image recording device 3010, the paper carry device 3020 and the controller section 3031 can be processed by these.

The developing cartridges 3014 of the image recording device 3010 are provided with a similar external shape, such that they can be accommodated in a plurality of preset spaces 3015*a* that are partitioned by partitioning frames 3015*c* that rotate around the rotation shaft 3015*b* of the developing rotary unit 3015. Based on the print commands included in the image data from the personal computer PC, the CPU (controller) 3033 of the engine controller 3032 lets the developing rotary unit 3015 rotate around the rotation shaft 3015*b* to switch the developing cartridge 3014 facing the photoconductive drum 3012 and develop the toner image to be formed by transferring and fixing toner on one side or both sides of the recording paper.

For example, by storing in the developing rotary unit 3015 developing cartridges 3014 containing toner of the colors yellow (Y), cyan (C), magenta (M) and black (K) and switching the color of the toner for developing the electrostatic latent image on the photosensitive drum 3012, the image recording device 3010 can superimpose or select toner of various colors and print color images or monochrome images, based on the received image data.

Moreover, the image recording device 3010 can also perform image formation when toner of the same color is contained in all developing cartridges 3014 and those developing cartridges 3015 are mounted in the developing rotary unit 3014. For example, by mounting four developing cartridges 3014 containing toner of the same color black (K), it is possible to use the apparatus as a special purpose apparatus that successively switches the developing cartridges 3014 developing the electrostatic latent image on the photoconductive drum 3012 and continuously prints monochrome images.

A so-called memory tag 3041 that is overall very compact and thin is adhered to a predetermined outer surface of each of the developing cartridges 3014 by making one side of it adhesive. When the memory tag 3041 is moved to a rotation position (communication position) facing a main unit-side antenna 3051 on the main unit side of the apparatus shown in FIG. 31, then it is arranged at a position along an external cover 3100 of the apparatus main unit, or in other words, it is placed (adhered) on the outer surface of the developing cartridge 3014 in an upright orientation and at a position where it is closest to this external cover 3100 facing it. This memory tag 3041 is designed to store and hold relevant information and to pass the relevant information to the CPU 3033 of the engine controller 3032 by communicating in a noncontacting manner with a send-receive circuit 3052 on the apparatus main unit side via the main unit-side antenna 3051 to exchange various kinds of information. Here, the main unit-side antenna 3051, which is placed in a downward-facing orientation on the apparatus main unit side, is fabricated in substantially the same manner as a later-described developing-side antenna 3043. The main unit-side antenna 3051 is placed within a distance of, for example, 10 mm of the memory tag 3041, so as to be able to communicate in a noncontacting manner with the memory tag 3041. The main unit-side antenna 3051 is connected to a circuit board constituting the send-receive circuit 3052 and performing communication in a noncontacting manner with the memory tag 3041. This send-receive circuit 3052 is connected via the I/O interface 3037 to the CPU 3033 of the engine controller 3032 on the apparatus main unit side.

Figure 33:
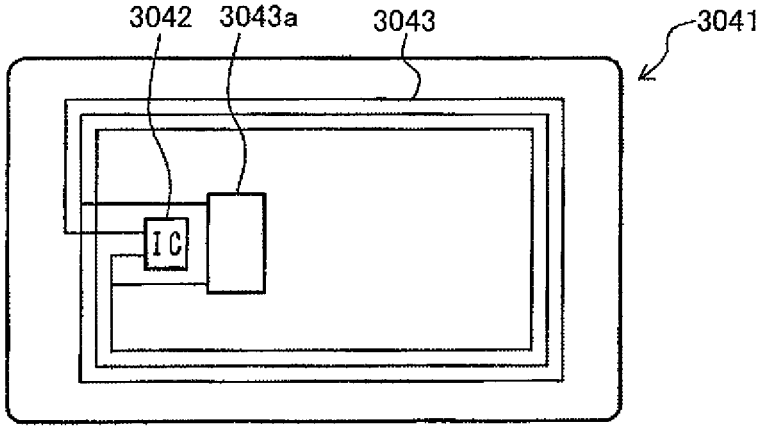
FIG. 33 is a diagram showing the configuration of its essential parts.
Figure 33:
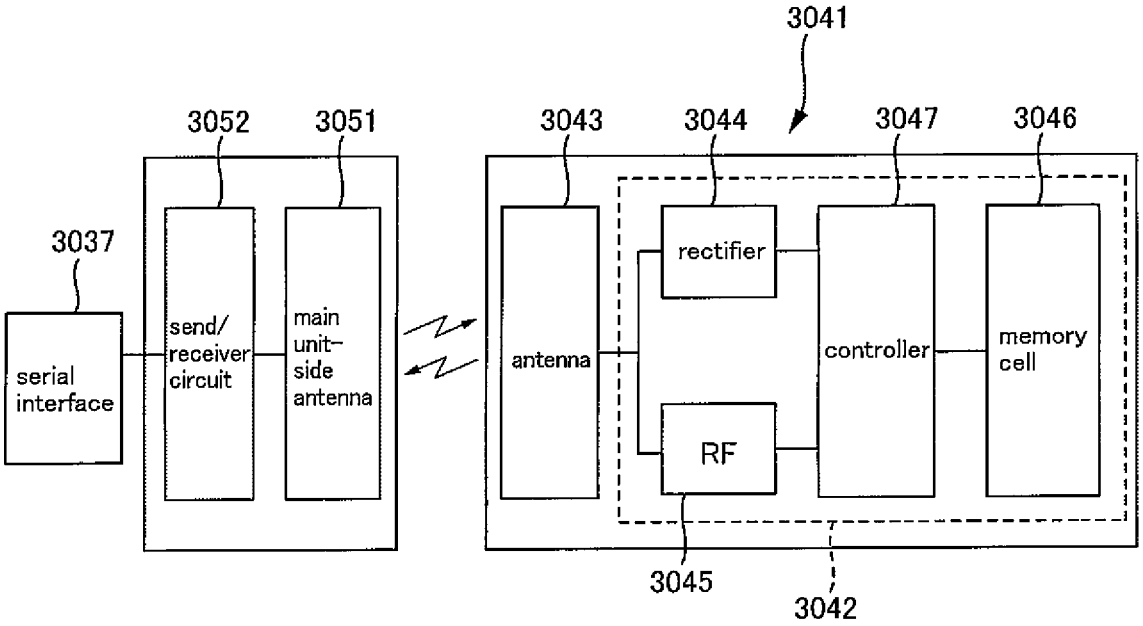

More specifically, as shown in FIG. 33(*a*), in the memory tag 3041 on the side of the developing cartridge 3014, a non-contact IC chip 3042 and the developing-side antenna 3043 are mounted on a plastic film and covered by a transparent cover sheet. The non-contact IC chip 3042 stores and holds various kinds of information based on commands from the send-receive circuit 3052 via the main unit-side antenna 3051 and reads relevant information from these various kinds of information, passing on the relevant information to the send-receive circuit 3052. The developing-side antenna 3043 is made by connecting in parallel the non-contact IC chip 3042 and a resonance capacitor 3043*a* that is formed by etching a metal film, and arranging a planar coil next to these, the planar coil going several times around the non-contact IC chip 3042 and the resonance capacitor 3043*a*. Thus, by receiving (absorbing) with the developing-side antenna 3043 a high-frequency magnetic field induced via the main unit-side antenna 3051 by high-frequency signals generated with the send-receive circuit 3052 on the apparatus main unit side, it is possible to access the memory tag 3041 quickly and perform an input into the non-contact IC chip 3042, without carrying out an operation of moving a connector and directly connecting it.

As shown in FIG. 33(*b*), the non-contact IC chip 3042 of the memory tag 3041 includes a rectifier 3044 serving as a DC power source that rectifies the high-frequency magnetic field (high-frequency signals) from the send-receive circuit 3052 on the apparatus main unit side received via the developing-side antenna 3043 and drives the various circuits within the chip, a signal analysis section RF (Radio Frequency) 3045, which analyzes the high-frequency signals of the received high-frequency magnetic field received via the developing-side antenna 3043 and generates a high-frequency magnetic field that can be absorbed by the main unit-side antenna 3051 by generating a high-frequency signal based on the various kinds of signals to be passed to the send-receive circuit 3052 on the apparatus main unit side and inputting this high-frequency signal to the developing-side antenna 3043, a non-volatile memory cell 3046, such as a NAND flash-ROM or the like, that can store and hold information written into it and from which this stored information can be read out from the outside, and a controller 3047, which rewrites the information stored in the memory cell 3046 by exchanging various kinds of signals with the send-receive circuit 3052 on the side of the apparatus main unit via the signal analysis section RF 3045 and passes the stored information that has been read out to the send-receive circuit 3052, while being driven by the DC power source of the interposed rectifier 3044. That is to say, the memory cell 3046 constitutes a storage element, the developing-side antenna 3043 and the main unit-side antenna 3051 constitute a connection link that can be connected to enable communication in a noncontacting manner, the non-contact IC chip 3042 incorporating the memory cell 3046 and the developing-side antenna 3043 constitute a communication means for communication in a noncontacting manner on the side of the developing cartridge 3014, whereas the main unit-side antenna 3051 and the send-receive circuit 3052 constitute a communication means on the apparatus main unit side.

Here, stored and held inside the memory cell 3046 of the non-contact IC chip 3042 are unique ID information, such as a serial number for each memory tag 3041, manufacturing information, such as the date when the developing cartridge 3014 was manufactured or the manufacturing number, destination information specifying the destination of the developing cartridge 3014, model information specifying models to which the developing cartridge 3014 can be mounted, toner information, such as information on the color and the remaining amount of toner contained in the developing cartridge 3014, and various kinds of relevant information, such as the number of recycles or the number of times the developing cartridge 3014 has been mounted and dismounted. Thus, the engine controller 3032 of the control unit 3030 can perform an optimal image formation control, by suitably ascertaining various kinds of information that the CPU 3033 has stored and held in the main unit-side memory 3035, such as the presence and the position of the developing cartridge 3014 in the storage position of the developing rotary unit 3015, or information about the color of the toner of the developing cartridge 3014. Moreover, if an error occurs, the various kinds of information can be useful in finding the cause of the error by displaying and outputting the information to an operation port.

With the CPU 3033 of the engine controller 3032 following a control program in the ROM 3034, the controller 3047 is caused to perform communication in a noncontacting manner with the apparatus main unit side (the send-receive circuit 3052 via the main unit-side antenna 3051) through the developing-side antenna 3043 of the memory tag 3041, and thus the information stored in the memory cell 3046 of the non-contact IC chip 3042 is rewritten or readout. For example, when turning on the power or while exchanging the developing cartridge 3014, the CPU 3033 performs a rewrite/read-out process, in which the developing rotary unit 3015 is rotated at least once, so that the memory tag 3041 (developing-side antenna 3043) of each of the developing cartridges 3014 comes to face the main unit-side antenna 3051 for the time necessary for communication in a noncontacting manner. During regular operation, when the CPU 3033 receives a print command of image data, by beginning with the rotation of the developing rotary unit 3015 from the home position, which is the stand-by position shown in FIG. 34, first the developing cartridge 3014K containing the black (K) toner is positioned in the image recording formation position P facing the photoconductive drum 3012 shown in FIG. 35, and the electrostatic latent image formed on the surface of the photoconductive drum 3012 is developed with toner by this developing cartridge 3014K. After that, the CPU 3033 successively positions (switches) the developing cartridge 3014M containing magenta (M) toner, the developing cartridge 3014C containing cyan (C) toner and the developing cartridge 3014Y containing yellow (Y) toner in a similar manner at the image recording formation position P, and forms color toner images based on the image data by letting them carry out toner development so as to transfer and fix the toner image on the recording paper, thus print-processing the image data.

Parallel to this print control or before or after the print control, when the magenta (M) developing cartridge 3014M is positioned in the image recording formation position P, the memory tag 3041 of the black (K) developing cartridge 3014K that has performed the directly preceding developing operation is positioned in the communication position facing the main unit-side antenna 3051, so that the CPU 3033 rewrites and reads out information stored in the memory cell 3046 of this memory tag 3041 by performing contactless information with this memory tag 3041 via the send-receive circuit 3052 on the apparatus main unit side. After this, and before the black (K) developing cartridge 3014K is rotated and moved hack to its home position, which is the lowest position, and put into the stand-by state, the respective memory tags 3041 of the magenta (M) developing cartridge 3014M, the cyan (C) developing cartridge 3014C and the yellow (Y) developing cartridge 3014Y are successively positioned in the communication position facing the main unit-side antenna 3051, so that the CPU 3033 rewrites or reads the information stored in the memory cells 3046 of these memory tags 3041. Thus, the CPU 3033 finishes the rewriting and reading of the information stored in the memory cells 3046 of all memory tags 3041, after which it rotates the developing rotary unit 3015 to its home position to put it into the stand-by state.

Figure 36:
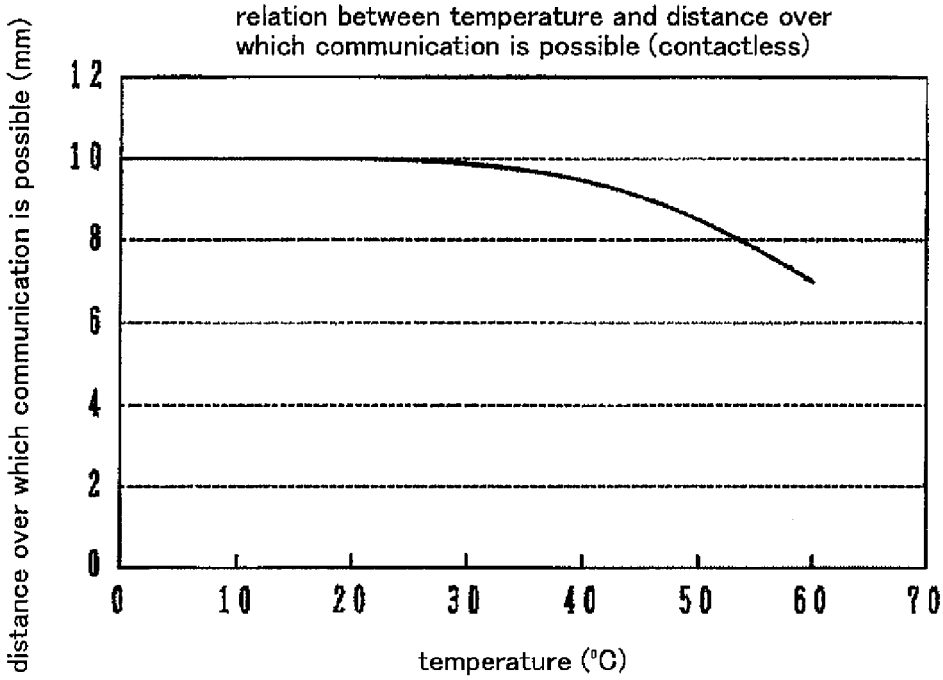
FIG. 36 is a graph illustrating the communication characteristics in terms of the separation distance between the antennas of its communication means.

Here, the non-contact IC chip 3042, which incorporates the rectifier 3044, the signal analysis section RF 304, the memory cell 3046, and the controller 3047, is connected in parallel to the resonance capacitor 3043*a*, and the memory tag 3041 performs communication in a noncontacting manner through the antennas 3043 and 3051 with the send-receive circuit 3052 on the apparatus main unit side, so that its internal elements, namely the resonance capacitor 3043*a* and the non-contact IC chip 3042 are easily affected by the environment in which the memory tag 3041 is placed. For example, when attempting to perform communication in a noncontacting manner while the memory tag 3041 is exposed to a high temperature and heated up, the distance over which communication in a noncontacting manner is possible becomes shorter the higher the temperature is above room temperature, as shown in FIG. 36. Moreover, the memory tag 3041 is stuck to the outer surface of the developing cartridge 3014 rotating away from the communication position where the memory tag 3041 faces the main unit-side antenna 3051. The developing roller 3014*a*, which faces the photoconductive drum 3012 across a tiny gap, protrudes from the outer surface of the developing cartridge 3014, so that there is a limit to how close the developing cartridge 3014 can be brought to the main unit-side antenna 3051.

Figure 34:
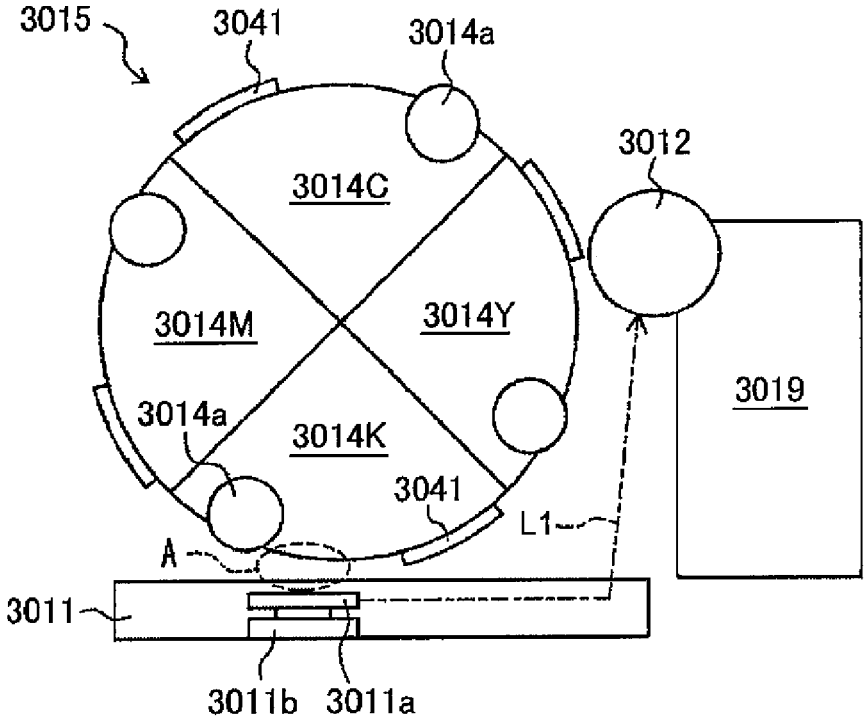
FIG. 34 is a diagram showing the rotation stop position during stand-by of its developing cartridge.
Figure 34:
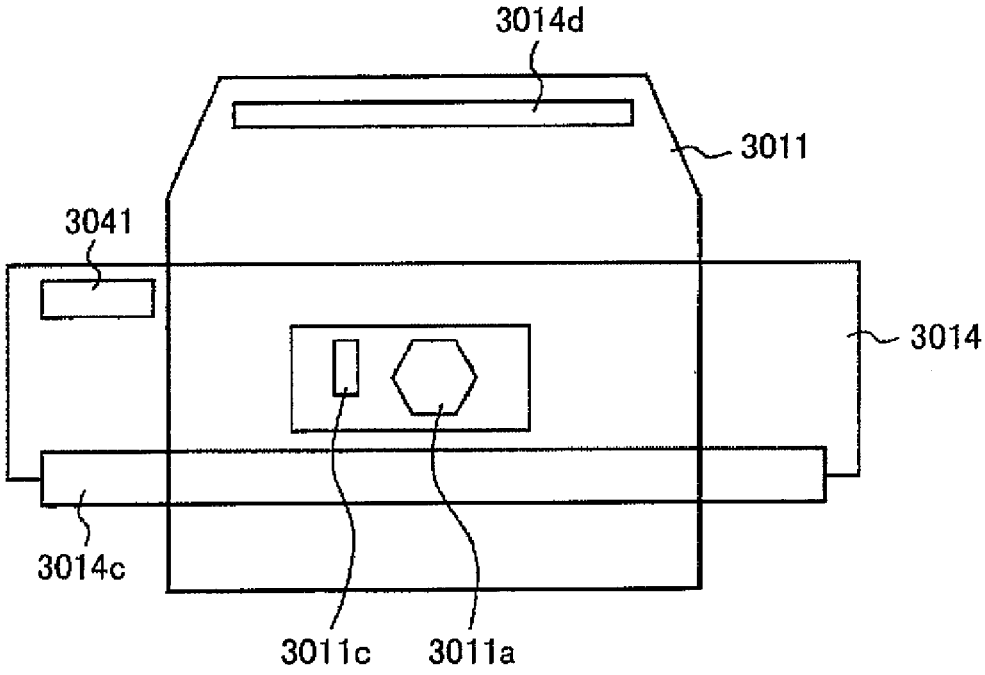
Figure 35:
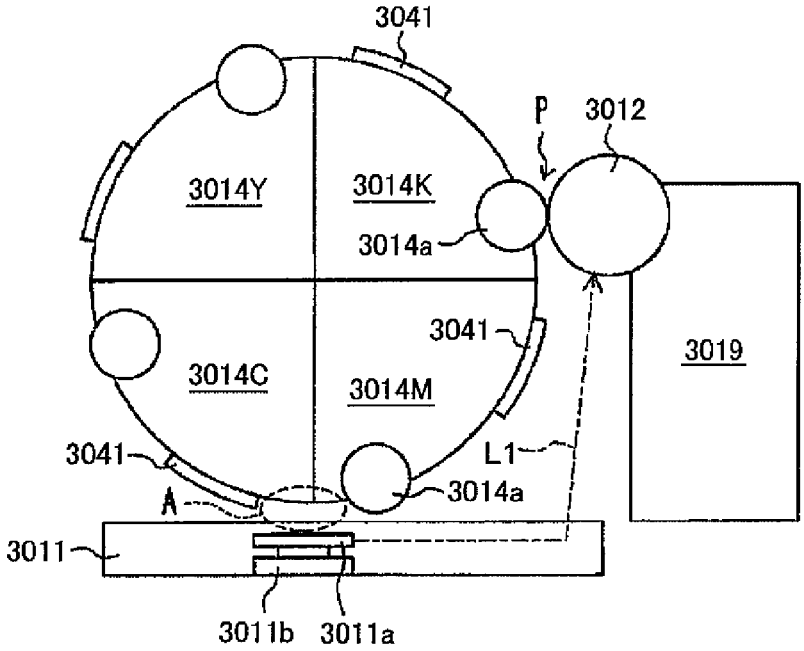
FIG. 35 is a diagram showing the rotation stop position during operation of its developing cartridge.
Figure 35:
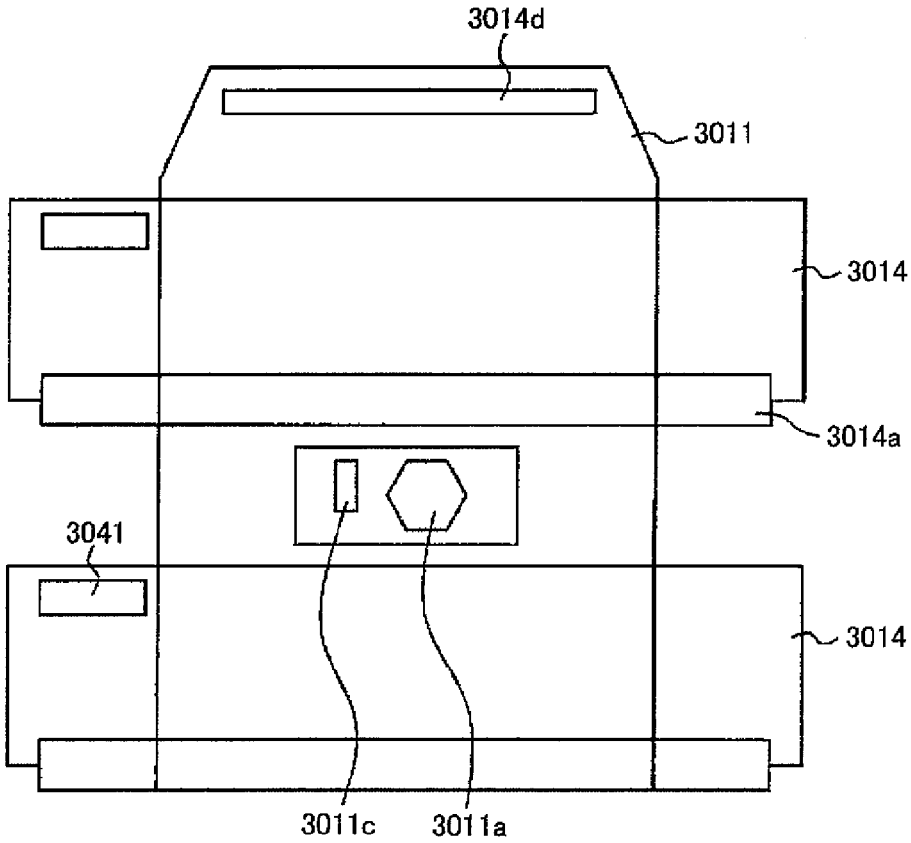

On the other hand, below the developing rotary unit 3015 that rotates and moves the developing cartridges 3014, the laser beam scanning device (exposing unit) 3011, which forms the electrostatic latent image through scanning/exposing the photoconductive drum 3012 by irradiating a laser beam L1 based on the image data, is disposed at a position that is close, in accordance with the miniaturization of the image forming apparatus, as is shown in FIG. 34 and FIG. 35. This laser beam scanning device 3011, which is placed with the purpose of quickly exposing and forming an electrostatic latent image on the photoconductive drum 3012, scans the laser beam L1 by swinging (reflecting) it along the axial direction (main scanning direction) of the photoconductive drum 3012 by rotating an internal polygon mirror 3011*a* at high speed. That is to say, the laser beam scanning device 3011 incorporates a polygon motor (scanner motor) 3011*b*, which rotates the polygon mirror 3011*a* at high speed, as well as a driver section 3011*c* controlling the generation/irradiation of the laser beam L1 and the driving of the polygon motor 3011*b*, so that it is a heat-generating member (heat source) that becomes hotter the longer it is continuously driven.

Therefore, if the memory tag 3041, which is placed on the outer surface of the developing cartridge 3014, is positioned for a long time in the vicinity A of a position facing the polygon motor 3011*b* or the driver section 3011*c* of the laser beam scanning device 3011 during continuous image formation or when being rotated and moved into the home position for stand-by after a continuous operation has been finished, then the memory tag 3041 is heated up. When this memory tag 3041 is rotated and moved to the communication position where it faces the main unit-side antenna 3051 to carry out communication in a noncontacting manner before its temperature has returned to approximately room temperature, there is the risk that a sufficient sensitivity cannot be attained, that the rewriting and reading of the information stored in the memory cell 3046 with the send-receive circuit 3052 on the apparatus main unit side cannot be accomplished efficiently (without a drop in the processing speed or the like), and that errors occur during the rewriting or reading of information stored in the memory cell 3046 due to connection faults (communication faults). Furthermore, also the developing roller 3014*a* of the developing cartridge 3014 is in a state where its outer circumferential surface on which the contained toner adheres is exposed to the outside, so that when this toner is unnecessarily heated, there is the risk that the developing quality of the electrostatic latent image on the photoconductive drum 3012 or the quality of the image transfer onto the intermediate image transfer belt 3016 or the like drops.

Accordingly, the memory tags 3041 are arranged on the outer surface of the developing cartridge 3014 at a position that is removed in the axial direction of the rotation shaft 3015*b* of the developing rotary unit 3015 from the vicinity A of the position where it faces the laser beam scanning device 3011, as shown in FIG. 34(*b*) and FIG. 35(*b*). In addition to this, the polygon motor 3011*b* and the driver section 3011*c* of the laser beam scanning device 3011 are laid out such that at a timing when the black (K) developing cartridge 3014K is positioned in the home position in which it is in stand-by at the lowest position, they are positioned between its developing roller 3014*a* and its memory tag 3041 in terms of the rotation direction of the developing rotary unit 3015, as shown in FIG. 34, and at a timing when one of the developing cartridges 3014 is positioned in the image recording formation position P facing the photoconductive drum 3012, they are positioned between the two developing cartridges 3014 positioned on the lower side of the developing rotary unit 3015, or in other words, between the developing roller 3014*a* and the memory tag 3041, as shown in FIG. 35. That is to say, the memory tags 3041 are removed in the axial direction and the rotation direction of the developing rotary unit 3015 from the position on the outer surface of the developing cartridge 3014 that faces the vicinity A of the position near the polygon motor 3011*b* and the driver section 3011*c* of the laser beam scanning device 3011, which are heat-generating members. Moreover, also the developing rollers 3014*a* are arranged at a position that is removed in the rotation direction from the position opposite the vicinity A of this position. It should be noted that 3014*d* in FIG. 34 and FIG. 35 denotes an aperture section through which the laser beam L1 is irradiated from the laser beam scanning device 3011.

Thus, it is possible to let the memory tag 3041 and the developing roller 3014*a* of the developing cartridges 3014 rotating and stopping during stand-by or during the developing operation rest at a position that is removed from the vicinity A of the position facing the polygon motor 3011*b* and the driver section 3011*c* of the laser beam scanning device 3011, so that it is possible to avoid that the memory tag 3041 receives the heat emitted from the laser beam scanning device 3011 and unnecessarily heats up when the vicinity A of this position heats up considerably above room temperature due to continuous driving of the laser beam scanning device 3011. Consequently, even when directly before the developing cartridge 3014 has come close to the laser beam scanning device 3011, it can be avoided that this becomes a cause for a drop in the image quality of the toner image made by adhering the toner on the outer circumferential surface of the developing roller 3014*a* to the electrostatic latent image on the photoconductive drum 3012 or the image quality of this toner image transferred onto the intermediate image transfer belt 3016 or the like. Furthermore, when reading or rewriting the stored information by accessing the memory tag 3041 of the developing cartridge 3014 through communication in a noncontacting manner, it is possible to rewrite or read the information stored in the memory cell 3046 efficiently, without errors and without a drop in sensitivity.

Thus, in this embodiment, by removing the memory tag 3041 of the developing cartridge 3014 in its rotation direction and its axial direction from the vicinity A of the position where it faces the polygon motor 3011*b* or the driver section 3011*c* of the laser beam scanning device 3011, it can perform communication in a noncontacting manner with the send-receive circuit 3052 via the main unit-side antenna 3051 without being thermally affected by the laser beam scanning device 3011 (without the occurrence of sensitivity faults), so that the reading out and rewriting of information stored in the memory cell 3046 can be accomplished efficiently and without errors. Consequently, the processes of rewriting or reading the various kinds of information in the memory tags 3041 of each of the developing cartridges 3014 can be carried out accurately and speedily, and the information that is necessary for the drive control of the various components of the apparatus can be made accessible in a smooth manner. Furthermore, by removing also the developing roller 3014*a* of the developing cartridge 3014 in its rotation direction from the vicinity A of this position at this time, the toner development of the electrostatic latent image on the photoconductive drum 3012 can be performed with high accuracy without being thermally affected by the laser beam scanning device 3011, and an image of high quality can be formed.

Figure 37:
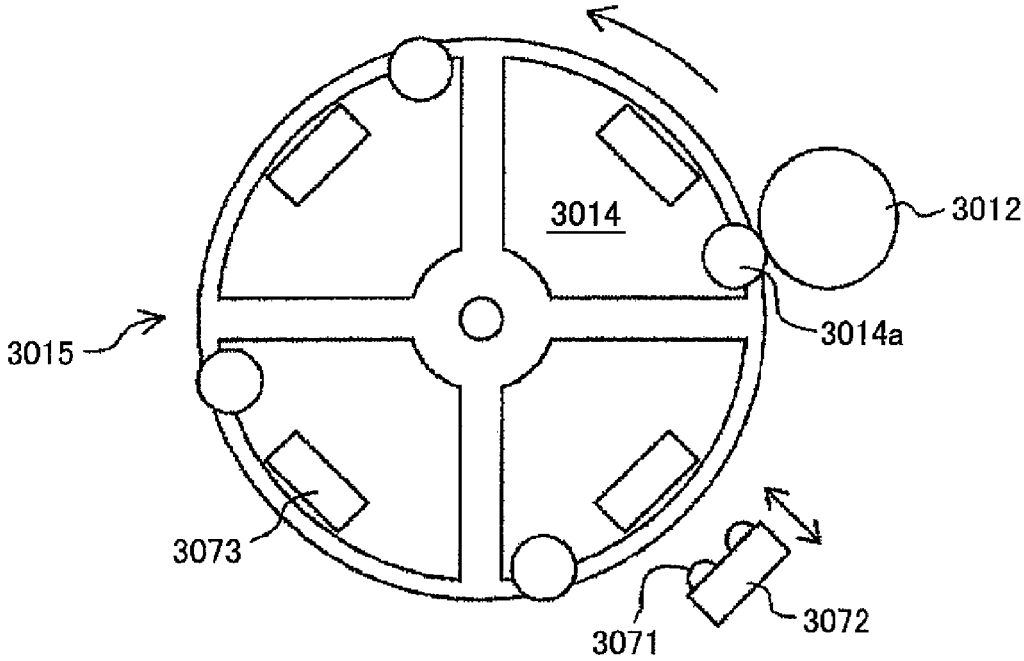
FIG. 37 is a diagram showing another embodiment of the fourth invention, and is a diagrammatic transparent front view showing the configuration of its essential parts.

As an alternative form of this embodiment, the present invention can also be applied to cases in which, instead of an antenna for communication in a noncontacting manner as in the present embodiment, a connector 3072 provided with electrode terminals 3071 is connected with the send-receive circuit 3052 on the apparatus main unit side, and a memory tag 3073 with exposed electrode terminals not shown in the drawings is placed on the side of the developing cartridge 3014, as shown in FIG. 37, so that during communication, the connector 3072 approaches the memory tag 3073 and the electrode terminals 3071 are pressed against each other, thereby establishing a connection allowing communication by contact. In this case, as in the above-described embodiment, the memory tag 3073 on the outer surface of the developing cartridge 3014 in the communication position establishes a conductive connection with the connector 3072 and can perform the processes of rewriting and reading various kinds of information in the memory cell with high reliability, without being thermally affected by the laser beam scanning device 3011.

Thus, with this fourth embodiment, the storage elements on the outer surfaces of the developing cartridges can be removed in either the rotation direction or the axial direction or both from the position where they face the heat-generating members that are heat sources inside the apparatus main unit during the time when the rotation of the developing cartridges is stopped, and they can perform the reading and writing of the information stored in the storage element and the communication processing without being thermally affected by these heat-generating members. Consequently, it is possible to avoid that errors occur during the reading and writing of information stored in the storage element, or that the performance of the communication processing of this stored information drops. As a result, by accessing the storage element of each developing cartridge with high reliability, it is possible to smoothly utilize the information stored in the storage elements for the drive control of the image processing or the like.

The preceding was an explanation of a fourth embodiment, but the present invention is not limited to this embodiment, and needless to say, the present invention can be embodied through various forms within the technical scope of the invention.

Overview of Image Forming Apparatus of Fifth Embodiment

The following is an explanation of a fifth embodiment of the present invention, with reference to the drawings. FIGS. 38 to 41 are diagrams showing an embodiment of an image forming apparatus according to the present invention.

Figure 38:
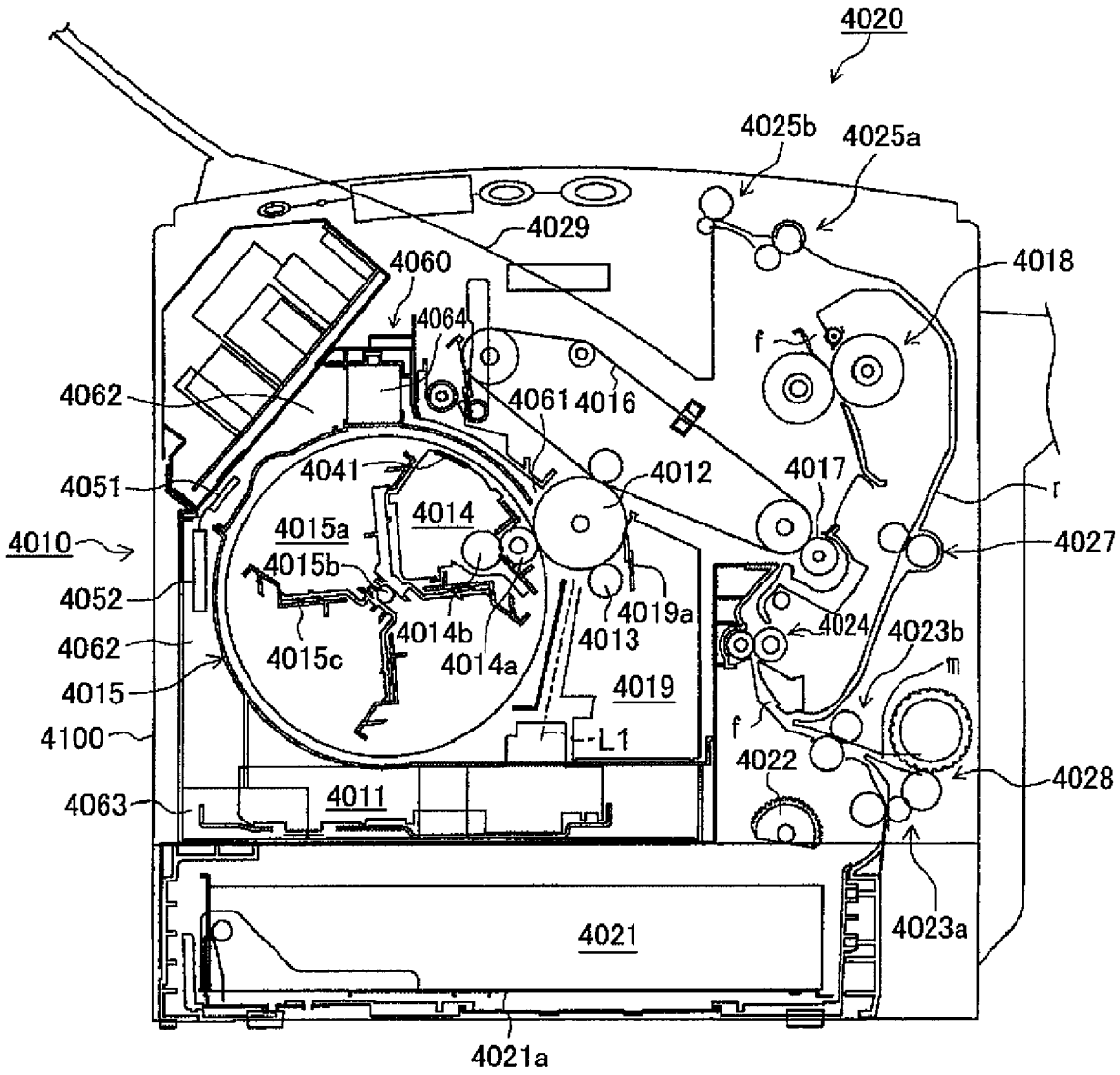
FIG. 38 is a diagram showing an embodiment of an image forming apparatus according to a fifth invention, and is a transparent front view showing its overall schematic configuration.
Figure 39:
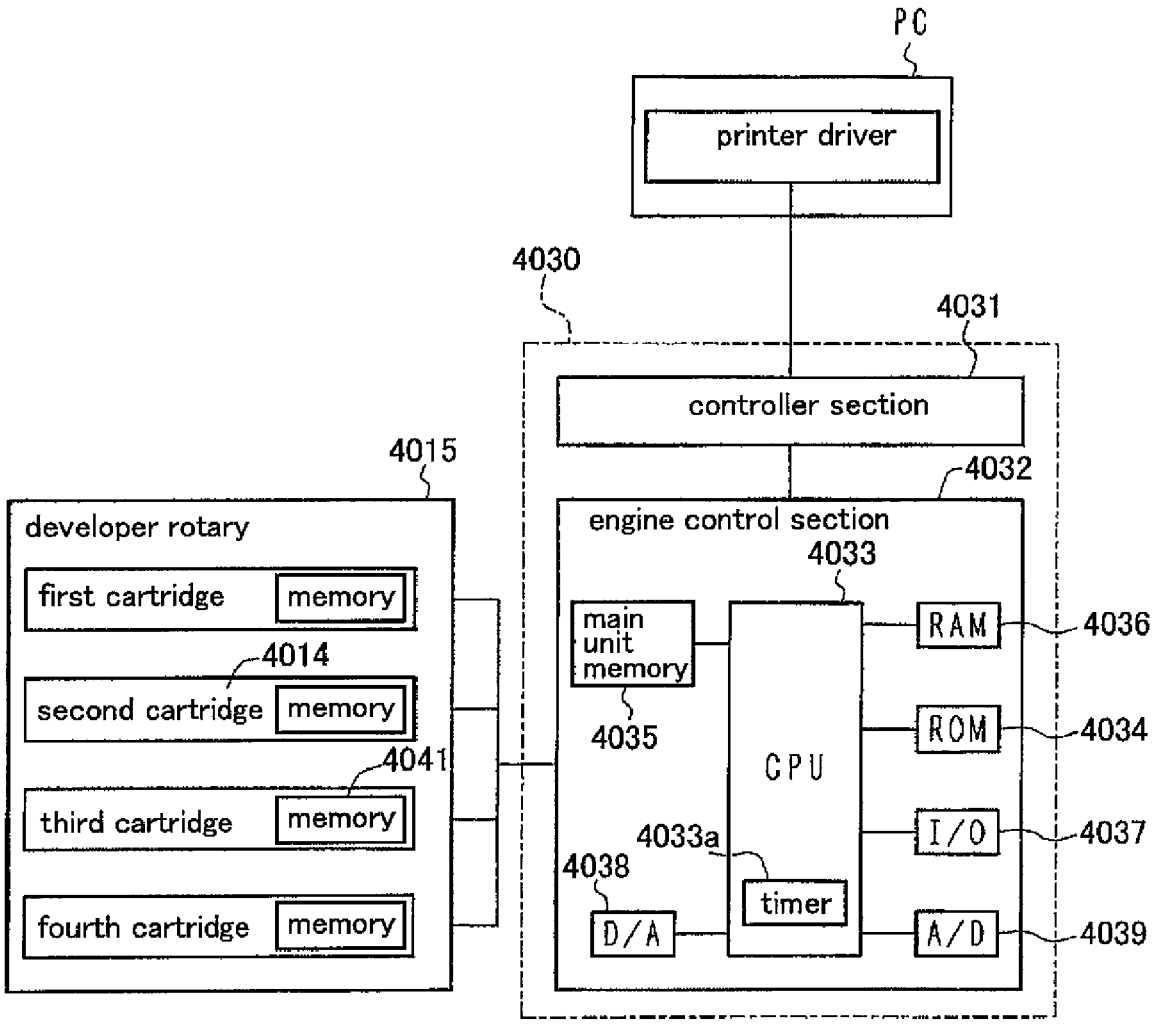
FIG. 39 is a relational block diagram illustrating its controller.

In FIG. 38 and FIG. 39, the image forming apparatus is a printer that is used by connecting it to an external device such as a personal computer PC that creates and outputs images of text or the like. This image forming apparatus includes an image recording device 4010 that records and forms images on one side or both sides of recording paper (recording medium) through electrophotography by reading in image data of text or the like to be image-formed, a paper carry device 4020 that carries a plurality of stacked recording papers to the image recording device 4010 and carries the recording paper on which an image has been recorded and formed out of the apparatus, stacking the recording paper, and a control unit 4030 that is connected to a personal computer PC and makes print-outs by forming images on the recording paper through comprehensive control of the overall apparatus including the image recording device 4010 and the paper carry device 4020 in accordance with the image data that has been received.

Simply speaking, the image recording device 4010 includes, as shown in FIG. 38, a laser beam scanning device 4011 scanning a laser beam L1 based on image data, a photoconductive drum (bearing member) 4012 on the surface of which an electrostatic latent image is exposed and formed based on image data that is irradiated and scanned with the laser beam L1 from the laser beam scanning device 4011, a charge device 4013 charging the outer circumferential surface of the photoconductive drum 4012 such that an electrostatic latent image can be formed by irradiating the laser beam L1, a developing cartridge 4014 (shown only at one place) for each of the colors, which contains yellow (Y), cyan (C), magenta (M) or black (K) toner and selectively lets the contained toner adhere to perform toner development of the electrostatic latent image on the surface of the photoconductive drum 4012 by rotating, in synchronization, developing rollers 4014*a* facing the surface of the photoconductive drum 4012 across a gap, a developing rotary unit 4015 holding the developing cartridges 4014 in preset spaces 4015*a* for each color and rotating them around a rotation shaft 4015*b*, an intermediate image transfer belt (intermediate image transfer member) 4016, which can receive the toner image developed on the photoconductive drum 4012 so that a toner image (monochrome image or color image) is formed on it that can be transferred and recorded on recording paper, an image transfer roller 4017 transferring the toner image carried on the intermediate image transfer belt 4016 by applying a contact pressure (nip) such that the recording paper carried up to it is sandwiched between the image transfer roller 4017 and the intermediate image transfer belt 4016, and carrying the recording paper downstream while clamping the recording paper, a pair of fixing rollers 4018 fixing the toner image by applying heat and contact pressure to the recording paper onto which the toner image has been transferred and which has been carried up to them, and clamping and carrying the recording paper further downstream, and a waste toner tank 4019 collecting and accumulating toner that has remained on the photoconductive drum 4012 with a blade 4019*a*. It should be noted that toner is supplied to the developing roller 4014*a* of the developing cartridge 4014 by pressing a supply roller 4014*b* rotating within the toner containing space of the developing cartridge 4014 against the developing roller 4014*a*. Also the unit of the intermediate image transfer belt 4016 is provided with a waste toner tank in which the toner remaining on the belt 4016 is collected with a blade and stored.

Thus, in the image recording device 4010, the developing cartridge 4014 inside the developing rotary unit 15 that has been switched in accordance with the image data develops with toner the electrostatic latent image based on the image data formed on the surface of the photoconductive drum 4012 with the laser beam scanning device 4011. And after that, the toner image on the photoconductive drum 4012 is subjected to a primary image transfer onto the intermediate image transfer belt 4016 and then subjected to a secondary image transfer onto recording paper that has been carried with the paper carry device 4020 and recorded, after which it is fixed by applying heat and pressure with the pair of fixing rollers 4018, thus accomplishing image formation.

Here, with this developing cartridge 4014, when the developing roller 4014*a* that rotates while facing the photoconductive drum 4012 across the gap transfers and adheres the contained toner to the surface of the photoconductive drum 4012, a small fraction of the toner is scattered and drifts to the downstream side in the rotation direction, so that an exhaust duct 4060 sucks in air with a suction fan not shown in the drawings from a suction opening 4061 above the vicinity of the position where the developing roller 4014*a* opposes the photoconductive drum 4012, and exhausts the air via an exhaust path 4062 from an exhaust opening 4063. The toner included in the air that is sucked in is adsorbed and removed by a filter 4064 arranged midway in the exhaust path 4062, thereby preventing that the outside of the apparatus is polluted.

Simply speaking, the paper carry device 4020 includes, as shown in FIG. 38, a paper cassette 4021, which is removably set in a lower section of the apparatus main unit and in which a plurality of sheets of recording paper are stacked, a pick-up roller 4022, which picks up the uppermost recording paper by rotating while being pressed against the stack of recording paper that has been elevated with an elevating plate 4021*a* at the bottom surface of the paper cassette 4021, thereby feeding the recording paper to a carry path f, a pair of relay carry rollers 4023*a* and 4023*b*, which receive the recording paper that is fed to them by the pick-up roller 4022 and clamp and carry the recording paper to the carry path f further downstream, a pair of registration rollers 4024, which receive the recording paper in the carry path f that is carried by the pair of relay carry rollers 4023*a* and 4023*b* and clamp and carry the recording paper to an image recording formation position given by the intermediate image transfer belt 4016 and the image transfer roller 4017 of the image recording device 4010, and a pair of paper discharge rollers 4025*a* and 4025*b*, which receive the recording paper on one side of which a fixed image has been formed by carrying the recording paper along the carry path f from the pair of registration rollers 4024, between the intermediate image transfer belt 4016 and the image transfer roller 4017 and between the pair of fixing rollers 4018, and which carries, discharges and stacks the recording paper on a paper discharge table 4029 at the top portion of the apparatus main unit. It should be noted that the intermediate image transfer belt 4016, the image transfer roller 4017 and the pair of fixing rollers 4018 of this image recording device also have the function of carrying the recording paper, so that they also constitute a part of the paper carry device 4020.

Thus, after the recording paper that has been picked up from the paper cassette 4021 with the pick-up roller 4022 has been passed on via the pair of relay carry rollers 4023*a* and 4023*b* to the pair of registration rollers 4024, the paper carry device 4020 supplies the recording paper to the image recording formation position at which the recording paper is pressed against by the intermediate image transfer belt 4016 and the image transfer roller 4017 such that the pair of registration rollers 4024 is synchronized with the operation of the image recording device 4010. The recording paper, on which the toner image on the intermediate image transfer belt 4016 has been transferred and recorded, and the image based on the image data has been fixed (recording formation) with the pair of fixing rollers 4018, is received by the pair of paper discharge rollers 4025*a* and 4025*b* and is carried and ejected and stacked on the paper discharge table 4029.

Here, this paper carry device 4020 includes a reverse carry path r and a pair of intermediate carry rollers 4027 disposed on this path r for turning over recording paper on one side of which an image has been formed and feeding it to the carry path f on the upstream side of the pair of registration rollers 4024. The recording paper, which has been fed into the reverse carry path r by inverting the rotation of the pair of paper discharge rollers 4025*a* and 4025*b* is received by the pair of intermediate carry rollers 4027 and passed on to the pair of registration rollers 4024, so that image formation on both sides of the recording paper is possible. Moreover, the paper carry device 4020 includes a manual feed path m and a pair of manual feed rollers 4028 disposed on this path m for manually feeding recording paper into the carry path f on the upstream side of the pair of registration rollers 4024. Image formation on one side or both sides of the recording paper is possible by receiving the recording paper inserted into this manual feed path m with the pair of manual feed rollers 4028 and passing it to the pair of registration rollers 4024.

As shown in FIG. 39, the control unit 4030 includes a controller section 4031 and an engine controller 4032 implemented on a circuit board mounted inside the apparatus main unit. These perform various kinds of data process control and drive control of the various components of the apparatus in accordance with a program that is provided in advance.

Simply speaking, the controller section 4031 exchanges various kinds of information, such as print commands, with a printer driver of a personal computer PC, with a CPU not shown in the drawings successively executing various processes in accordance with a processing program stored in a memory, receives image data, such as text, to be formed as an image (printed) on the recording paper, and temporarily stores the image data in a memory not shown in the drawings. Since the image data (image information signal) received from the personal computer PC is so-called RGB data of red (R), green (G) and blue (B), the controller section 4031 reads the data from the memory and passes it to the engine controller 4032 while converting this data into so-called YMCK image data of yellow (Y), magenta (M), cyan (C) and black (K) that can be printed.

With the CPU 4033 following the control program stored in the ROM 4034, the engine controller 4032 receives the image data page by page, for example, from the controller section 4031 and temporarily stores it in a main unit memory 4035, and an image based on this image data is formed on the recording paper by exchanging various kinds of information with the image recording device 4010 and the paper carry device 4020 while using a RAM 4036 as a working area. Moreover, in this situation, when the CPU 4033 performs the image formation control, it lets each section of the apparatus operate optimally by measuring the various processing times with an internal timer function (time measurement means) 4033*a*.

Thus, when the control unit 4030 receives image data from the personal computer PC or the like, the controller section 4031 outputs image data, which it has converted from RGB data to YMCK data, to the engine controller 4032, while temporarily storing the image data. The CPU 4033 of the engine controller 4032 comprehensively controls the image recording device 4010 and the paper carry device 4020 based on the image data from the controller section 4031 stored in units of pages in the main unit memory 4035. In accordance with this control, the electrostatic latent image formed on the photoconductive drum 4012 based on the image data is developed with toner by the developing cartridge 4014, and this toner image is transferred to and fixed on one or both sides of recording paper that has been carried from the paper cassette 21 to be form an image, and the recording paper is carried to and stacked on the paper discharge table 4029.

It should be noted that in FIG. 39, an I/O interface 4037 is connected between the image recording device 4010, the paper carry device 4020 and the controller section 4031 on the one hand and the engine controller 4032 on the other hand, such that various kinds of information can be exchanged. A D/A converter 4038 and an A/D converter 4039 convert digital signals (D) into analog signals (A) and convert analog signals into digital signals, such that the various kinds of information that the engine controller 4032 exchanges with the image recording device 4010, the paper carry device 4020 and the controller section 4031 can be processed by these.

The developing cartridges 4014 of the image recording device 4010 are provided with a similar external shape, such that they can be accommodated in a plurality of preset spaces 4015*a* that are partitioned by partitioning frames 4015*c* that rotate around the rotation shaft 4015*b* of the developing rotary unit 4015. Based on the print commands included in the image data from the personal computer PC, the CPU (controller) 4033 of the engine controller 4032 lets the developing rotary unit 4015 rotate around the rotation shaft 15*b* to switch the developing cartridge 4014 facing the photoconductive drum 4012 and develop the toner image formed by transferring and fixing toner on one side or both sides of the recording paper.

For example, by storing in the developing rotary unit 4015 developing cartridges 4014 containing toner of the colors yellow (Y), cyan (C), magenta (M) and black (K) and switching the color of the toner for developing the electrostatic latent image on the photosensitive drum 4012, the image recording device 4010 can superimpose or select toner of various colors and print color images or monochrome images, based on the received image data.

Moreover, the image recording device 4010 can also perform image formation when toner of the same color is contained in all developing cartridges 4014 and those developing cartridges 4014 are mounted in the developing rotary unit 4015. For example, by mounting four developing cartridges 4014 containing toner of the same color black (K), it is possible to use the apparatus as a special purpose apparatus that successively switches the developing cartridges 4014 developing the electrostatic latent image on the photoconductive drum 4012 and continuously prints monochrome images.

A so-called memory tag 4041 that is overall very compact and thin is adhered to a predetermined outer surface of each of the developing cartridges 4014 by making one side of it adhesive. When the memory tag 4041 is moved to a rotation position (communication position) facing a main unit-side antenna 4051 on the main unit side of the apparatus shown in FIG. 38, then it is arranged at a position along an external cover 4100 of the apparatus main unit, or in other words, it is placed (stuck) on the outer surface of the developing cartridge 4014 in an upright orientation and at a position where it is closest to this external cover 4100 facing it. This memory tag 4041 is designed to store and hold relevant information and to pass the relevant information to the CPU 4033 of the engine controller 4032 by communicating in a noncontacting manner with a send-receive circuit 4052 on the apparatus main unit side via the main unit-side antenna 4051 to exchange various kinds of information. Here, the main unit-side antenna 4051, which is placed in a downward-facing orientation on the apparatus main unit side, is fabricated in substantially the same manner as a later-described developing-side antenna 4043. The main unit-side antenna 4051 is placed within a distance of, for example, 10 mm of the memory tag 4041, so as to be able to communicate in a noncontacting manner with the memory tag 4041. The main unit-side antenna 4051 is connected to a circuit board constituting the send-receive circuit 4052 and performing communication in a noncontacting manner with the memory tag 4041. This send-receive circuit 4052 is connected via the I/O interface 4037 to the CPU 4033 of the engine controller 4032 on the apparatus main unit side.

Figure 40:
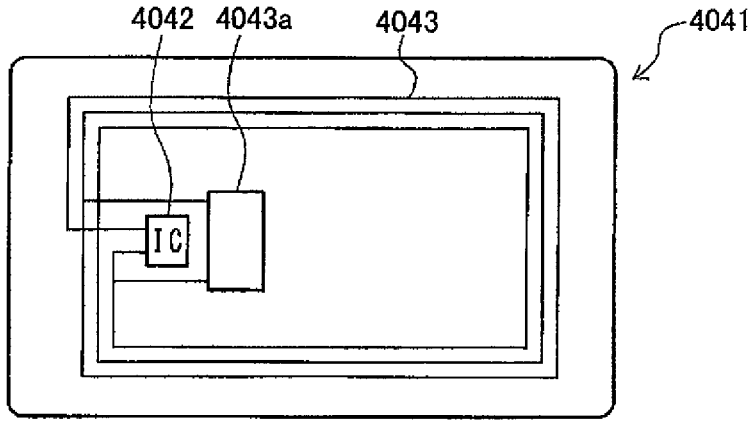
FIG. 40 is a diagram showing the configuration of its essential parts.
Figure 40:
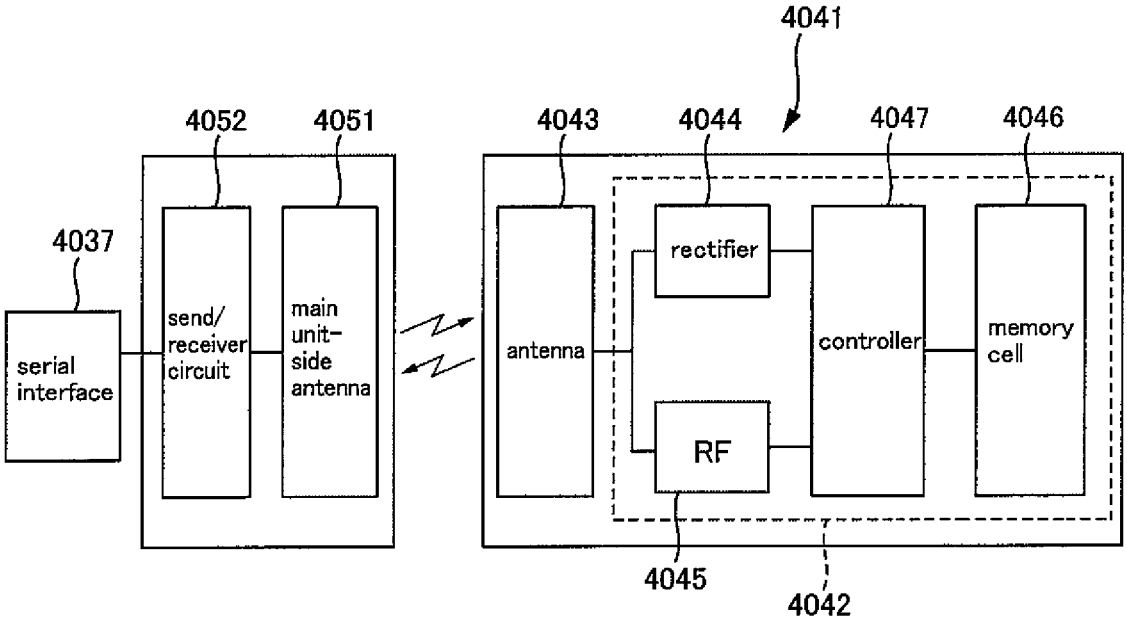

More specifically, as shown in FIG. 40(*a*), in the memory tag 4041 on the side of the developing cartridge 4014, a non-contact IC chip 4042 and the developing-side antenna 4043 are mounted on a plastic film and covered by a transparent cover sheet. The non-contact IC chip 4042 stores and holds various kinds of information based on commands from the send-receive circuit 4052 via the main unit-side antenna 4051 and reads relevant information from these various kinds of information, passing on the relevant information to the send-receive circuit 4052. The developing-side antenna 4043 is made by connecting in parallel the non-contact IC chip 4042 and a resonance capacitor 4043*a* that is formed by etching a metal film, and arranging a planar coil next to these, the planar coil going several times around the non-contact IC chip 4042 and the resonance capacitor 4043*a*. Thus, by receiving (absorbing) with the developing-side antenna 4043 a high-frequency magnetic field induced via the main unit-side antenna 4051 by high-frequency signals generated with the send-receive circuit 4052 on the apparatus main unit side, it is possible to access the memory tag 4041 quickly and perform an input into the non-contact IC chip 4042, without carrying out an operation of moving a connector and directly connecting it.

As shown in FIG. 40(*b*), the non-contact IC chip 4042 of the memory tag 4041 includes a rectifier 4044 serving as a DC power source that rectifies the high-frequency magnetic field (high-frequency signals) from the send-receive circuit 4052 on the apparatus main unit side received via the developing-side antenna 4043 and drives the various circuits within the chip, a signal analysis section REF (Radio Frequency) 4045, which analyzes the high-frequency signals of the received high-frequency magnetic field received via the developing-side antenna 4043 and generates a high-frequency magnetic field that can be absorbed by the main unit-side antenna 4051 by generating a high-frequency signal based on the various kinds of signals to be passed to the send-receive circuit 4052 on the apparatus main unit side and inputting this high-frequency signal to the developing-side antenna 4043, a non-volatile memory cell 4046, such as a NAND flash-ROM or the like, that can store and hold information written into it and from which this stored information can be read out from the outside, and a controller 4047, which rewrites the information stored in the memory cell 4046 by exchanging various kinds of signals with the send-receive circuit 4052 on the side of the apparatus main unit via the signal analysis section REF 4045 and passes the stored information that has been read out to the send-receive circuit 4052, while being driven by the DC power source of the interposed rectifier 4044. That is to say, the memory cell 4046 constitutes a storage element, the developing-side antenna 4043 and the main unit-side antenna 4051 constitute a connection link that can be connected to enable communication in a noncontacting manner, the non-contact IC chip 4042 incorporating the memory cell 4046 and the developing-side antenna 4043 constitutes a communication means for communication in a noncontacting manner on the side of the developing cartridge 4014, whereas the main unit-side antenna 4051 and the send-receive circuit 4052 constitute a communication means on the apparatus main unit side.

Here, stored and held inside the memory cell 4046 of the non-contact IC chip 4042 are unique ID information, such as a serial number for each memory tag 4041, manufacturing information, such as the date when the developing cartridge 4014 was manufactured or the manufacturing number, destination information specifying the destination of the developing cartridge 4014, model information specifying models to which the developing cartridge 4014 can be mounted, toner information, such as information on the color and the remaining amount of toner contained in the developing cartridge 4014, and various kinds of relevant information, such as the number of recycles or the number of times the developing cartridge 4014 has been mounted and dismounted. Thus, the engine controller 4032 of the control unit 4030 can perform an optimal image formation control, by suitably ascertaining various kinds of information that the CPU 4033 has stored and held in the main unit-side memory 35, such as the presence and the position of the developing cartridge 4014 in the storage position of the developing rotary unit 4015, or information about the color of the toner of the developing cartridge 4014. Moreover, if an error occurs, the various kinds of information can be useful in finding the cause of the error by displaying/outputting the information to an operation port.

With the CPU 4033 of the engine controller 4032 following a control program in the ROM 4034, the controller 4047 is caused to perform communication in a noncontacting manner with the apparatus main unit side (the send-receive circuit 4052 via the main unit-side antenna 4051) through the developing-side antenna 4043 of the memory tag 4041, and thus the information stored in the memory cell 4046 of the non-contact IC chip 4042 is rewritten or read out. For example, when turning on the power or while exchanging the developing cartridge 4014, the CPU 4033 performs a rewrite/read-out process, in which the developing rotary unit 4015 is rotated at least once, so that the memory tag 4041 (developing-side antenna 4043) of each of the developing cartridges 4014 comes to face the main unit-side antenna 4051 for the time necessary for communication in a noncontacting manner. Moreover, when the CPU 4033 receives a print command of image data during ordinary operation, the developing cartridge 4014K containing the black (K) toner is first positioned in the image recording formation position P where it faces the photoconductive drum 4012 shown in FIG. 41 by starting to rotate the developing rotary unit 4015 from the home position, in which the black (K) developing cartridge 4014K is at the lowest position, and toner development of the electrostatic latent image formed on the surface of the photoconductive drum 4012 is carried out with this developing cartridge 4014K. After that, the CPU 4033 successively positions (switches) the developing cartridge 4014M containing magenta (M) toner, the developing cartridge 4014C containing cyan (C) toner, and the developing cartridge 4014Y containing yellow (Y) toner in a similar manner at the image recording formation position P, and forms color toner images based on the image data by letting them carry out toner development so as to transfer and fix the toner image on the recording paper, thus print-processing the image data.

Figure 41:
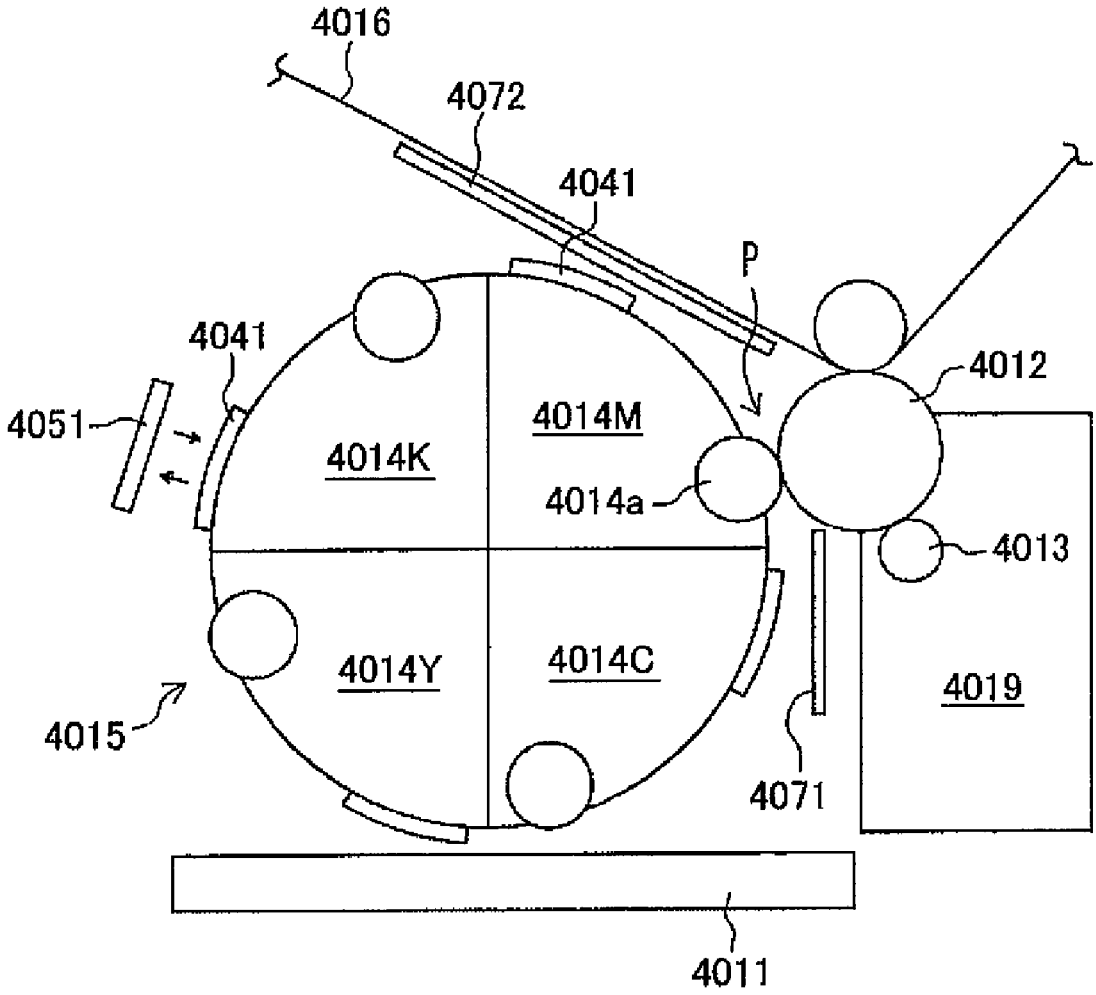
FIG. 41 is a diagrammatic transparent view showing the positional relationship between the memory tag (storage element) on the outer surface of its developing cartridge and other devices.

Parallel to this print control or before or after the print control, when the magenta (M) developing cartridge 4014M is positioned in the image recording formation position P, the memory tag 4041 of the black (K) developing cartridge 4014K that has performed the directly preceding developing operation is positioned in the communication position facing the main unit-side antenna 4051 as shown in FIG. 41, so that the CPU 4033 rewrites and reads out information stored in the memory cell 4046 of this memory tag 4041 by performing contactless information with this memory tag 4041 via the send-receive circuit 4052 on the apparatus main unit side. After this, and before the black (K) developing cartridge 4014K is rotated and moved back to its home position, which is the lowest position, and put into the stand-by state, the respective memory tags 4041 of the magenta (M) developing cartridge 4014M, the cyan (C) developing cartridge 4014C and the yellow (Y) developing cartridge 4014Y are successively positioned in the communication position facing the main unit-side antenna 4051, so that the CPU 4033 rewrites or reads the information stored in the memory cells 4046 of these memory tags 4041. Thus, the CPU 4033 finishes the rewriting and reading of the information stored in the memory cells 4046 of all memory tags 4041, after which it rotates the developing rotary unit 4015 to its home position to put it into the stand-by state.

Here, the memory tag 4041 performs the reading and rewriting of the information stored in the memory cell 4046 of the non-contact IC chip 4042 by performing communication in a noncontacting manner, in which it exchanges signals with the main unit-side antenna 4051 via the developing-side antenna 4043, so that the information stored in the memory cell 4046 may be unnecessarily rewritten or deleted and corrupted directly or indirectly by noise of or above a certain intensity. In this context, the risk that the noise easily intrudes into the memory cell 4046 from the developing-side antenna 4043 and thus indirectly makes the information stored in the memory cell 4046 inaccurate is greater than the risk that the noise directly intrudes into the memory cell 4046. In particular, the memory tag 4041, in which the developing-side antenna 4043 is formed in the same plane as the non-contact IC chip 4042 incorporating the memory cell 4046, is stuck to the outer surface of the developing cartridge 4014, so that depending on the rotation position of the developing cartridge 4014, it can assume an orientation in which it is approximately facing the source of the noise and the noise from there can easily intrude (may be easily picked up from the developing-side antenna 4043).

On the other hand, regarding the devices arranged around the developing rotary unit 4015, the roller-shaped charge device 4013 contacts the outer circumferential surface of the photoconductive drum 4012 and applies a high voltage to it, thereby charging the photoconductive drum 4012 to a potential at which an electrostatic latent image to which toner adheres by scanning a laser beam L1 with the laser beam scanning device 4011 is formed (to a high voltage at which no toner adheres before exposure), so that there is the possibility that the location where the charge device 4013 applies a high voltage to the photoconductive drum 4012 or the photoconductive drum 4012 itself emit noise to their surroundings. That is to say, the photoconductive drum 4012 itself constitutes a high-voltage member, of the charged members, taking on a voltage equal or greater than that which is necessary for the adherence of toner, and the charge device 4013 constitutes a high-voltage member, of the voltage-applying members, taking on a voltage equal or greater than that which is necessary for the adherence of toner. Moreover, by letting a roller member (not shown in the drawings) contact an electrode portion exposed at the edge of the belt and rotating the roller member while applying a high voltage, the intermediate image transfer belt 4016 is charged to a high voltage at which the primary image transfer of the toner image on the surface of the photoconductive drum 4012 is possible (at which the toner is attracted), so that there is the possibility that the location where the roller member applies a high voltage to the intermediate image transfer belt 4016 or the intermediate image transfer belt 4016 itself emit noise to their surroundings. That is to say, the intermediate image transfer belt 4016 itself constitutes a high-voltage member, of the charged members, taking on a voltage equal or greater than that which is necessary for the image transfer, and the roller member constitutes a high-voltage member, of the voltage-applying members, taking on a voltage equal or greater than that which is necessary for the image transfer. Here, the case is explained that a method is adopted in which the photoconductive drum 4012 is charged by contacting it with a roller-shaped member serving as the charge device 4013, but the present invention can also be applied when a method is adopted in which the photoconductive drum 4012 is charged by applying a high voltage to an electrode wire.

For this reason, the possibility is high that at a timing in which the memory tag 4041 placed on the outer surface of the developing cartridge 4014 is in a location facing the photoconductive drum 4012 and the intermediate image transfer belt 4016, or at a timing in which it is in an orientation facing the locations where the photoconductive drum 4012 and the intermediate image transfer belt 4016 are charged, the memory tag 4041 picks up noise emitted from these, and the risk that it is in a state facing a noise-emitting location continuously for a certain period of time and picks up the noise emitted from there is highest in particular during development when the photoconductive drum 4012 faces the developing roller 4014*a* of the developing cartridge 4014.

Accordingly, blocking members 4071 and 4072 that are made of a conductive material, such as sheet metal, and connected to ground are arranged around the developing rotary unit 4015 on both the upstream side and the downstream side in the rotation direction of the developing cartridge 4014 adjacent to the outer circumferential surface of the photoconductive drum 4012. That is to say, the blocking members 4071 and 4072 are arranged between the rotation trajectory of the memory tags 4041 on the outer surface of the developing cartridges 4014 and the location where the photoconductive drum 4012 faces the intermediate image transfer belt 4016 as well as the location where these are charged, and when the rotation of the developing cartridge 4014 is stopped and the development operation is carried out, the blocking members 4071 and 4072 face the memory tag 4041 opposing them in a substantially planar orientation, so that they are placed between the memory tag 4041 and the noise source. It should be noted that the developing rollers 4014*a* of the developing cartridges 4014 oppose the photoconductive drum 4012 across a tiny gap, so that the blocking members 4071 and 4072 are placed at positions that are so close to the photoconductive drum 4012 that this opposition is not hindered.

Thus, even when noise is emitted from the location where the photoconductive drum 4012 faces the intermediate image transfer belt 4016 or the location where these are charged, this noise is absorbed by the blocking members 4071 and 4072 and can be restricted so that it does not reach the memory tags 4041 (the developing-side antennas 4043 or the memory cells 4046), and it can be prevented that the information stored in the memory cells 4046 is adversely affected by being rewritten (destroyed) or deleted.

Thus, in the present embodiment, it can be prevented from the beginning that noise emitted from the location where the photoconductive drum 4012 faces the intermediate image transfer belt 4016 or the location where these are charged intrudes into the memory tags 4041 rotating and moving on the outer surface of the developing cartridges 4014, and it can be avoided that the information stored in the memory cells 4046 is rewritten or deleted so that it becomes unusable. Consequently, the reliability of the information stored in the memory tags 4041 (memory cells 4046) on the outer surface of the developing cartridges 4014 can be ensured even when the photoconductive drum 4012 is designed to have a smaller diameter and the charge device 4013 is placed at a position near the developing rotary unit 4015 (developing cartridges 4014), or similarly, when the intermediate image transfer belt 4016 is arranged near the developing rotary unit 4015. As a result, accurate information stored in the memory tags 4041 can be utilized smoothly for the drive control.

With the present embodiment, it can be prevented from the beginning that the noise from the high-voltage members intrudes into the storage elements or antennas rotating and moving on the outer surface of the developing cartridges, so that it can be avoided that the information stored in these storage elements is rewritten or deleted and becomes unusable. Consequently, it is possible to utilize the information stored in the storage elements with high reliability, and the information stored in the storage elements can be utilized smoothly for the drive control of the image processing or the like.

The preceding was an explanation of an embodiment of the present invention, but the present invention is not limited to this embodiment, and needless to say, the present invention can be embodied through various forms within the technical scope of the invention. For example, in the present embodiment, an example was explained in which a configuration is adopted in which a plurality of developing cartridges 4014 are accommodated in the developing cartridge unit 4015 and an intermediate image transfer belt 4016 is provided. However, there is no limitation to this, and the present invention can also be favorably applied to cases where a member is provided that charges the toner in order to transfer the toner.

Overview of Image Forming Apparatus of Sixth Embodiment

Figure 42:
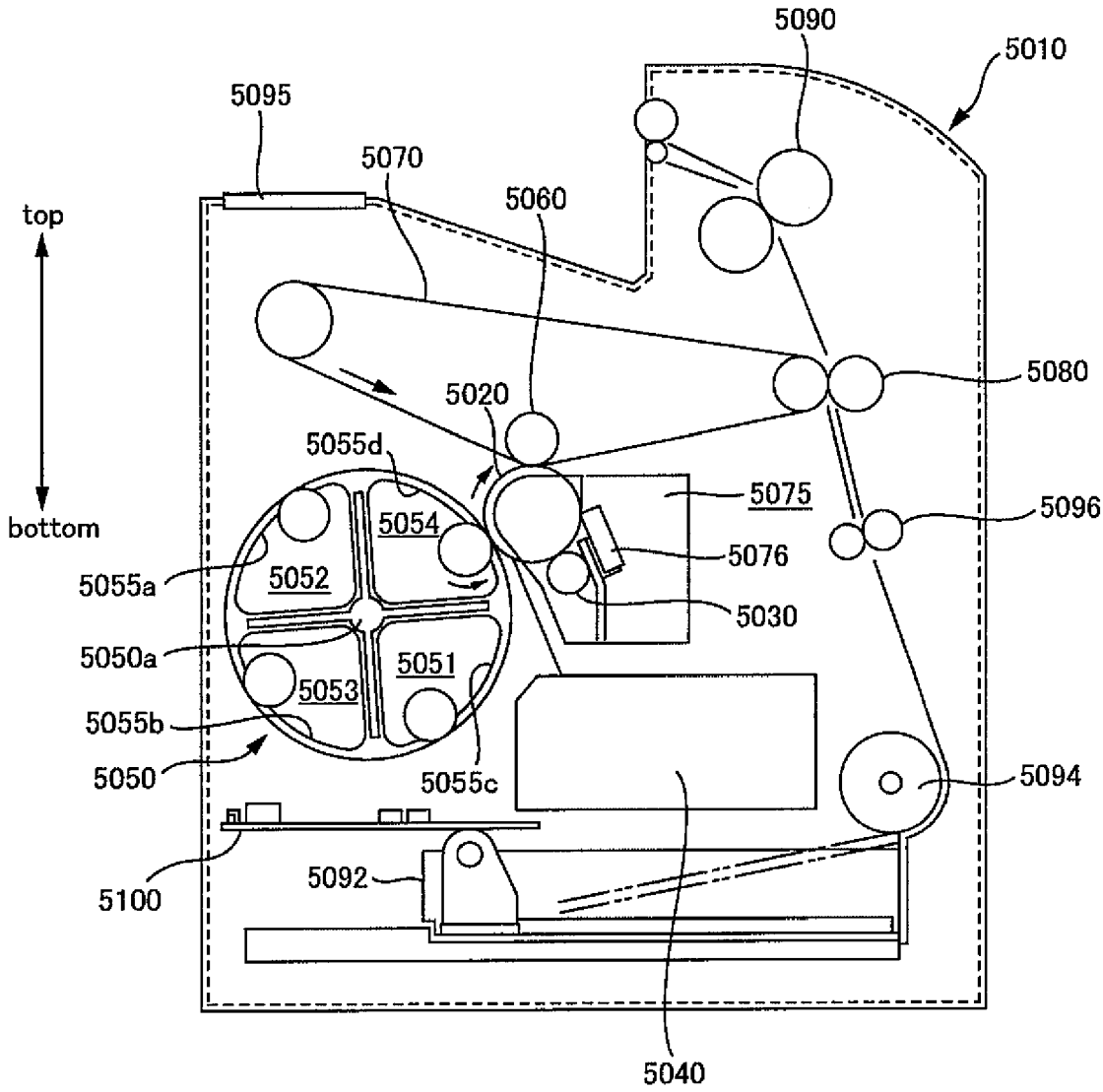
FIG. 42 is a diagram showing the main structural components constituting a printer 5010.

Next, using FIG. 42, an overview of a laser beam printer (hereinafter, also referred to as "printer") 5010 serving as an example of an image forming apparatus is described. FIG. 42 is a diagram showing the main structural components constituting the printer 5010. It should be noted that in FIG. 42, the vertical direction is indicated by the arrows, and, for example, a paper supply tray 5092 is arranged at a lower section of the printer 5010 and a fixing unit 5090 is disposed at an upper section of the printer 5010.

As shown in FIG. 42, the printer 5010 according to the present embodiment includes a charging unit 5030, an exposing unit 5040, a YMCK developing unit 5050 serving as an example of a rotating member, a primary image transfer unit 5060, an intermediate image transfer member 5070, and a cleaning unit 5075, which are arranged along the rotation direction of a photoconductor 5020. The printer 5010 further includes a secondary image transfer unit 5080, a fixing unit 5090, a displaying unit 5095 constituted by a liquid-crystal panel and serving as a means for giving notifications to the user, and a control unit 5100 for controlling these units and managing the operations of the printer.

The photoconductor 5020 has a hollow cylindrical conductive base and a photoconductive layer formed on the outer circumferential surface of the conductive base, and is rotatable around its center axis. In the present embodiment, the photoconductor 5020 rotates clockwise, as indicated by the arrow in FIG. 42.

The charging unit 5030 is a device for charging the photoconductor 5020. The exposing unit 5040 is a device for forming a latent image on the charged photoconductor 5020 by irradiating a laser beam thereon. The exposing unit 5040 includes, for example, a semiconductor laser, a polygon mirror, and an F-θ lens, and irradiates a modulated laser beam onto the charged photoconductor 5020 in accordance with image signals that have been input from a host computer, not shown in the drawings, such as a personal computer or a word processor.

The YMCK developing unit 5050 is a device for developing the latent image formed on the photoconductor 5020 using toner T, which is an example of a developer contained in developing containers, that is, black (K) toner contained in a black developing container 5051, magenta (M) toner contained in a magenta developing container 5052, cyan (C) toner contained in a cyan developing container 5053, and yellow (Y) toner contained in a yellow developing container 5054.

By rotating the YMCK developing unit 5050 with the four developing containers 5051, 5052, 5053, and 5054 mounted to it, it is possible to move the positions of these four developing containers 5051, 5052, 5053, and 5054. That is to say, the YMCK developing unit 5050 holds the four developing containers 5051, 5052, 5053 and 5054 with four holding sections 5055*a*, 5055*b*, 5055*c* and 5055*d*, which are examples of mounting and dismounting sections, and the four developing containers 5051, 5052, 5053, and 5054 can be rotated about a rotation shaft 5050*a* while maintaining their relative positions. Every time the image formation corresponding to one page is finished, one of the developing devices is caused to selectively oppose the photoconductor 5020, and the latent image formed on the photoconductor 5020 is successively developed using the toner T contained in the developing containers 5051, 5052, 5053, and 5054. It should be noted that each of these four developing containers 5051, 5052, 5053 and 5054 can be mounted and dismounted with respect to the printer main unit 5012, which is an example of an image forming apparatus main unit, or more specifically, with respect to the holding sections 5055*a*, 5055*b*, 5055*c* and 5055*d* of the YMCK developing unit 5050. When the developing containers 5051, 5052, 5053, and 5054 are mounted to the holding sections 5055*a*, 5055*b*, 5055*c*, and 5055*d*, later-explained positioning pins 5592, which are provided on the developing containers 5051, 5052, 5053 and 5054, are provided on the printer main unit 5012, and the developing containers 5051, 5052, 5053 and 5054 are positioned in the printer main unit 5012 by fitting these positioning pins 5592 into positioning pin fitting holes 5058 into which the positioning pins 5592 can be fitted (see FIG. 53). The details concerning YMCK developing unit 5050 and the developing units are explained later.

The primary image transfer unit 5060 is a device for transferring a single color toner image formed on the photoconductor 5020 to the intermediate image transfer member 5070. When the four toner colors are successively transferred over one another, a full color toner image is formed on the intermediate image transfer member 5070.

The intermediate image transfer member 5070 is a layered endless belt made by providing an aluminum vapor deposition layer on the surface of a PET film and forming a semiconductive coating on its surface. The intermediate image transfer member 5070 is driven to rotate at substantially the same circumferential speed as the photoconductor 5020.

The secondary image transfer unit 5080 is a device for transferring the single-color toner image or the full-color toner image formed on the intermediate image transfer member 5070 onto a medium such as paper, film, and cloth.

The fixing unit 5090 is a device for fusing the single-color toner image or the full-color toner image, which has been transferred to the medium, onto the medium to turn it into a permanent image.

The cleaning unit 5075 is a device that is provided between the primary image transfer 5060 and the charging unit 30, has a rubber cleaning blade 5076 coming into contact with the surface of the photoconductor 5020, and is for removing the toner T remaining on the photoconductor 5020 by scraping it off with the cleaning blade 5076 after the toner image has been transferred onto the intermediate image transfer member 5070 by the primary image transfer unit 5060.

Figure 43:
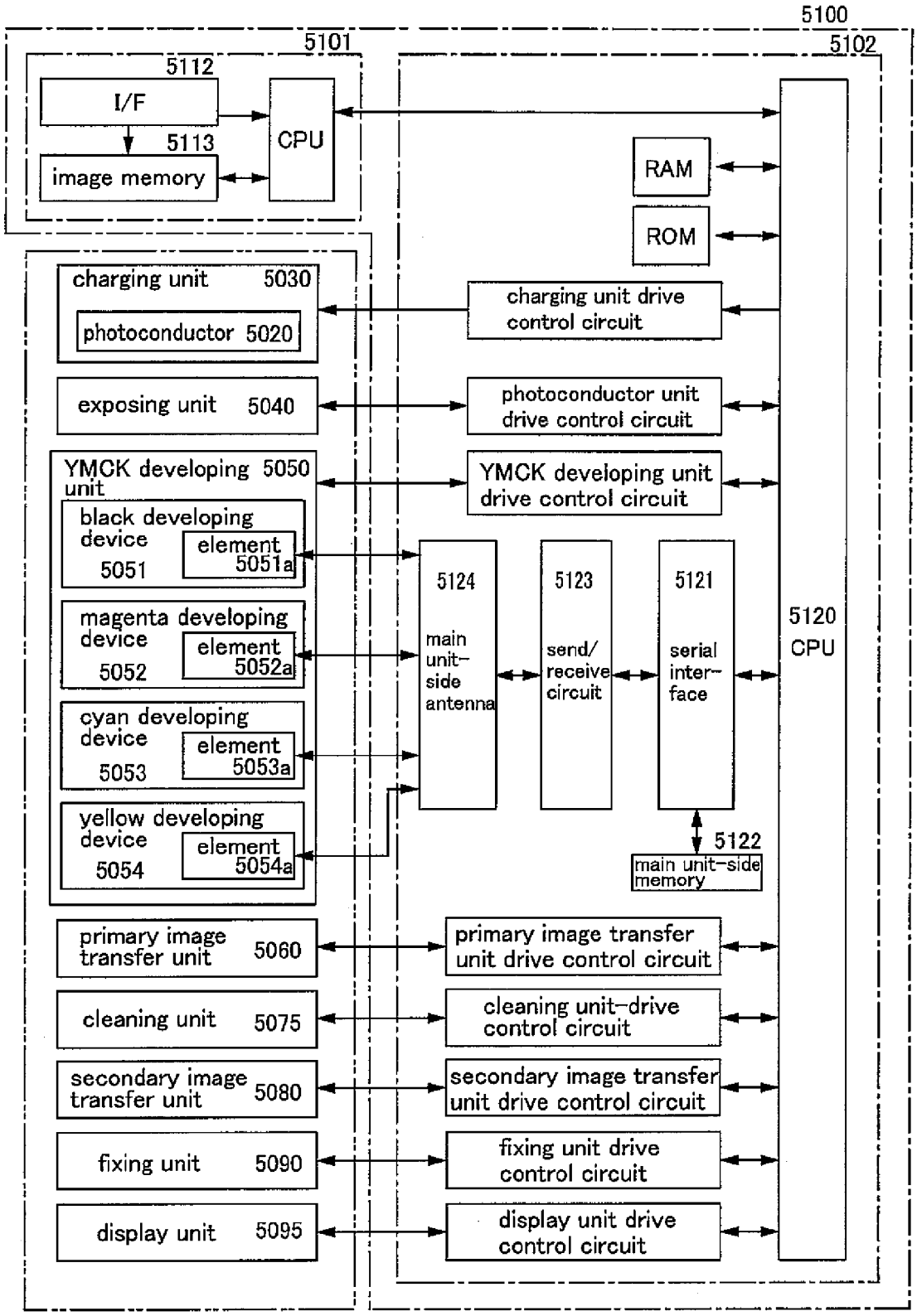
FIG. 43 is a block diagram showing the control unit of the printer 5010 in FIG. 42.

The control unit 5100 is made of a main controller 5101 and a unit controller 5102, as shown in FIG. 43. An image signal and a control signal are input into the main controller 5101, and in accordance with a command based on the image signal and the control signal, the unit controller 5102 controls the various units and the like to form the image.

Next, the operation during the image formation of the printer 5010 configured as above is described.

First, when an image signal and a control signal from a host computer not shown in the drawings are input into the main controller 5101 of the printer 5010 via an interface (I/F) 5112, the photoconductor 5020, the developing roller, which is an example of a developer bearing roller, and the intermediate image transfer member 5070 are rotated under the control of the unit controller 5102 based on a command from the main controller 5101. While rotating, the photoconductor 5020 is successively charged by the charging unit 5030 at a charging position.

The region of the photoconductor 5020 that has been charged is brought to an exposure position through rotation of the photoconductor 5020, and a latent image corresponding to image information of a first color, for example yellow Y, is formed at that region by the exposing unit 5040. The YMCK developing unit 5050 positions the yellow developing container 5054, which contains yellow (Y) toner, at the developing position opposing the photoconductor 5020.

The latent image formed on the photoconductor 5020 is brought to a developing position through the rotation of the photoconductor 5020, and is developed with yellow toner by the yellow developing container 5054. Thus, a yellow toner image is formed on the photoconductor 5020.

The yellow toner image that is formed on the photoconductor 5020 is brought to the primary image transfer position through rotation of the photoconductor 5020 and is transferred to the intermediate image transfer member 5070 by the primary image transfer unit 5060. At this time, a primary image transfer voltage, which has an opposite polarity to the polarity to which the toner T is charged, is applied to the primary image transfer unit 5060. It should be noted that during this process, the photoconductor 5020 and the intermediate image transfer member 5070 are in contact, whereas the secondary image transfer unit 5080 is kept separated from the intermediate image transfer member 5070.

By sequentially repeating the above-described processes with each of the developing containers for the second, the third, and the fourth color, toner images in four colors corresponding to the respective image signals are transferred to the intermediate image transfer member 5070 in a superimposed manner. Thus, a full color toner image is formed on the intermediate image transfer member 5070.

With the rotation of the intermediate image transfer member 5070, the full-color toner image formed on the intermediate image transfer member 5070 reaches a secondary image transfer position, and is transferred onto the medium by the secondary image transfer unit 5080. It should be noted that the medium is carried from the paper supply tray 5092 to the secondary image transfer 5080 via the paper supply roller 5094 and the registration rollers 5096. Also, when performing the image transfer operation, the secondary image transfer unit 5080 is pressed against the intermediate image transfer member 5070 while applying a secondary image transfer voltage to it.

The full-color toner image transferred onto the medium is heated and pressurized by the fixing unit 5090 and thus fused to the medium.

On the other hand, after the photoconductor 5020 has passed the primary image transfer position, the toner T adhering to the surface of the photoconductor 5020 is scraped off by the cleaning blade 5076 that is supported by the cleaning unit 5075, and the photoconductor 5020 is prepared for charging for the next latent image to be formed. The scraped-off toner T is collected into a remaining-toner collector of the cleaning unit 5075.

===Overview of the Control Unit===

The configuration of the control unit 5100 is described next, with reference to FIG. 43. The main controller 5101 of the control unit 5100 is electrically connected to the host computer via an interface 5112, and is provided with an image memory 5113 for storing image signals input into it from the host computer. The unit controller 5102 is electrically connected to each of the units (i.e., the charging unit 5030, the exposing unit 5040, the YMCK developing unit 5050, the primary image transfer unit 5060, the cleaning unit 5075, the secondary image transfer unit 5080, the fixing unit 5090 and the displaying unit 5095), and it detects the state of the units by receiving signals from sensors provided in those units, and controls each of the units based on the signals that are input from the main controller 5101.

Also, the CPU 5120 provided in the unit controller 5102 is electrically connected to a non-volatile storage element (hereinafter, also referred to as "main unit-side memory 5122") such as an EEPROM via the serial interface (I/F) 5121. Also, the CPU 5120 is capable of wirelessly communicating with elements 5051*a*, 5052*a*, 5053*a*, and 5054*a*, which are respectively provided in the developing containers 5051, 5052, 5053, and 5054, via the serial interface 5121, a send-receive circuit 5123, and a main unit-side antenna (antenna for element communication) 5124, which is an example of an antenna. During the wireless communication, the main unit-side antenna 5124 writes information into the elements 5051*a*, 5052*a*, 5053*a*, and 5054*a* provided on the developing containers 5051, 5052, 5053, and 5054, respectively. The main unit-side antenna 5124 can also read information from the elements 5051*a*, 5052*a*, 5053*a* and 5054*a*.

Thus, the main unit-side memory 5122 and the elements 5051*a*, 5052*a*, 5053*a* and 5054*a* can communicate with each other. That is to say, the transfer of information stored in the main unit-side memory 5122 to the elements 5051*a*, 5052*a*, 5053*a* and 5054*a*, as well as the transfer of information stored in the 5051*a*, 5052*a*, 5053*a* and 5054*a* to the main unit-side memory 5122 can be accomplished.

===Configuration Example of the Developing Device===

Figure 44:
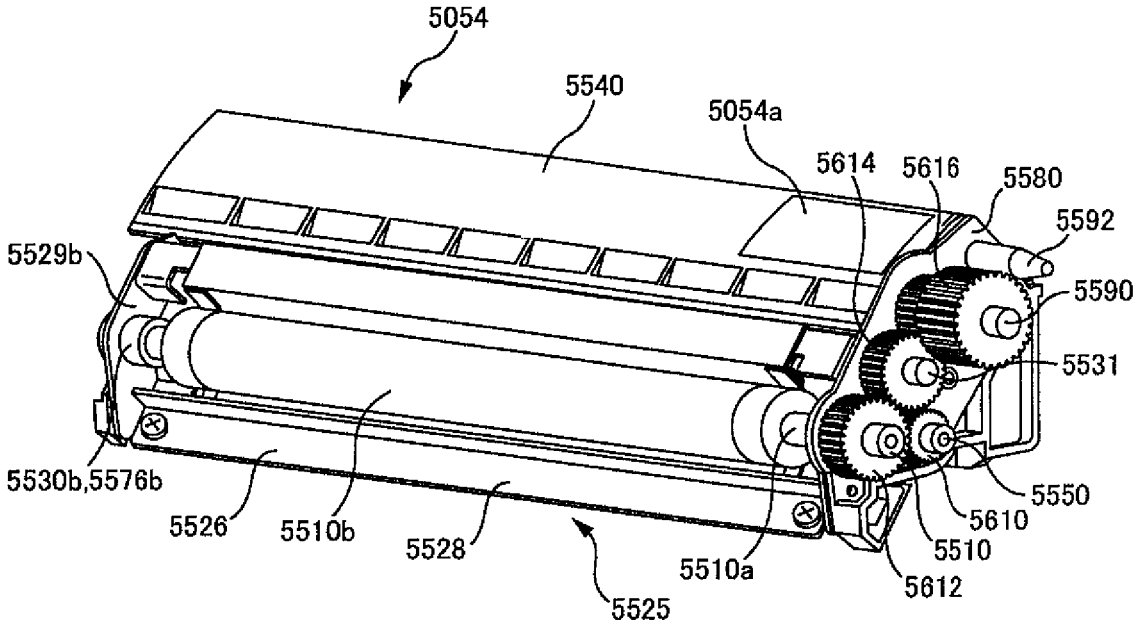
FIG. 44 is a perspective view of a developing device.
Figure 45:
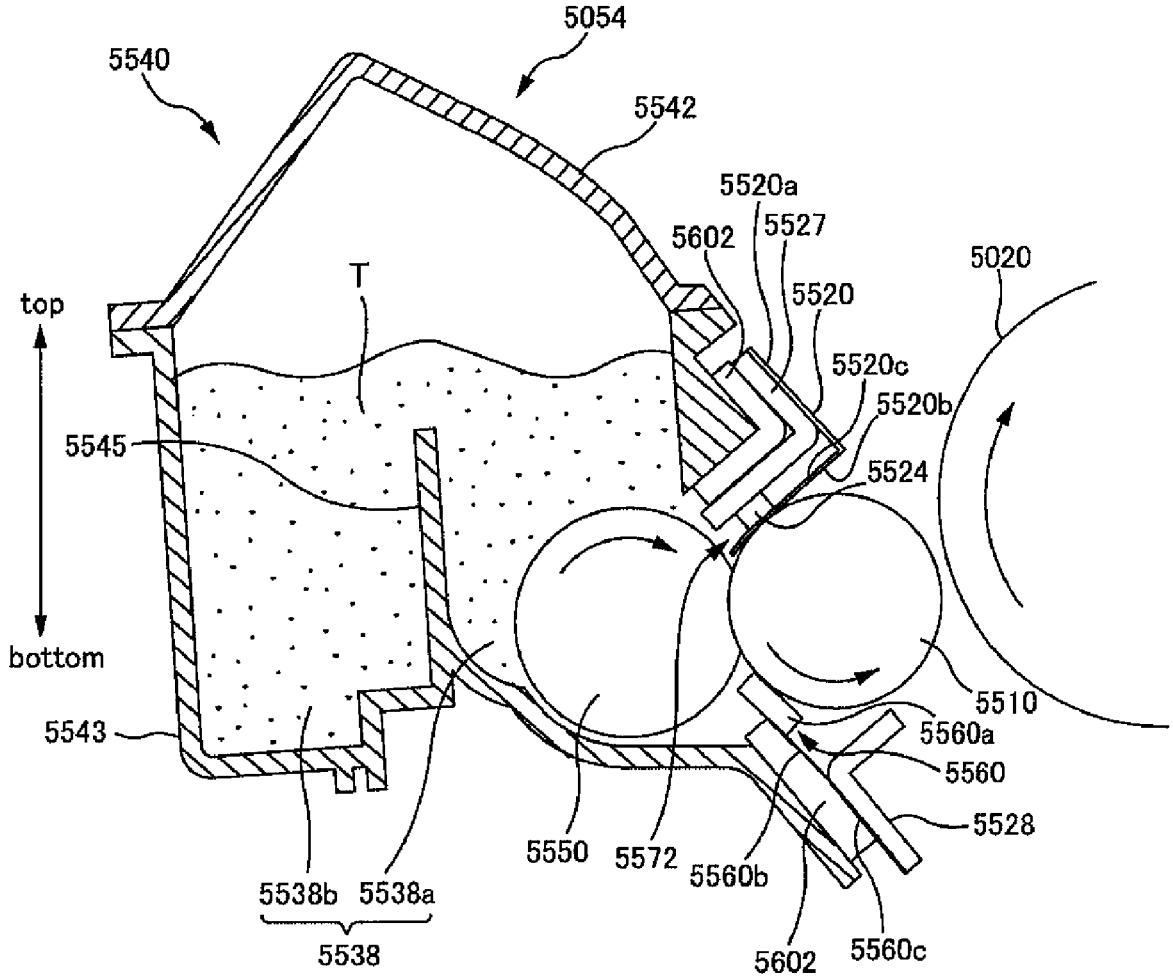
FIG. 45 is a cross-sectional view showing main structural components of this developing device.
Figure 46:
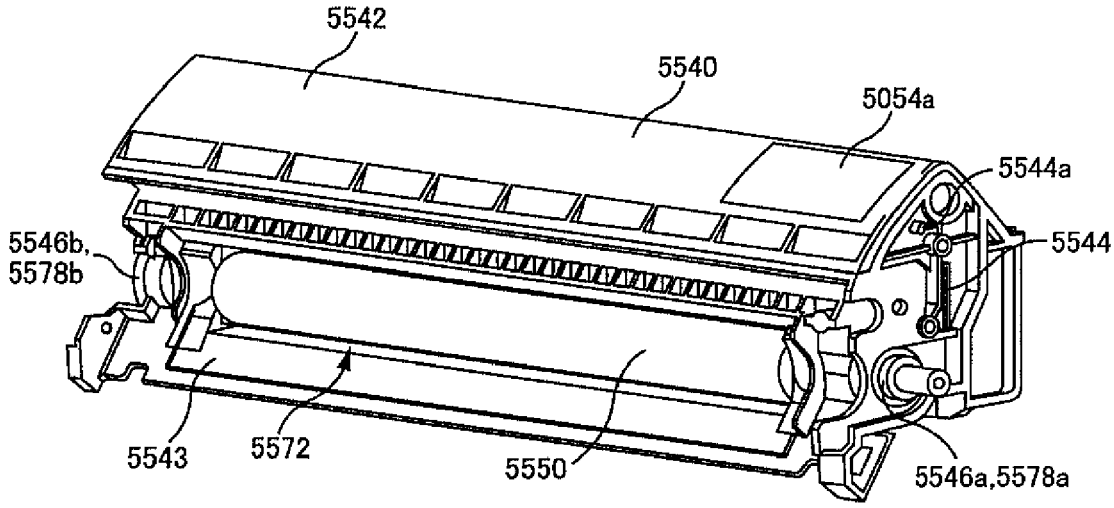
FIG. 46 is a perspective view showing an arrangement in which a toner supply roller 5550 is installed in a housing 5540.
Figure 47:
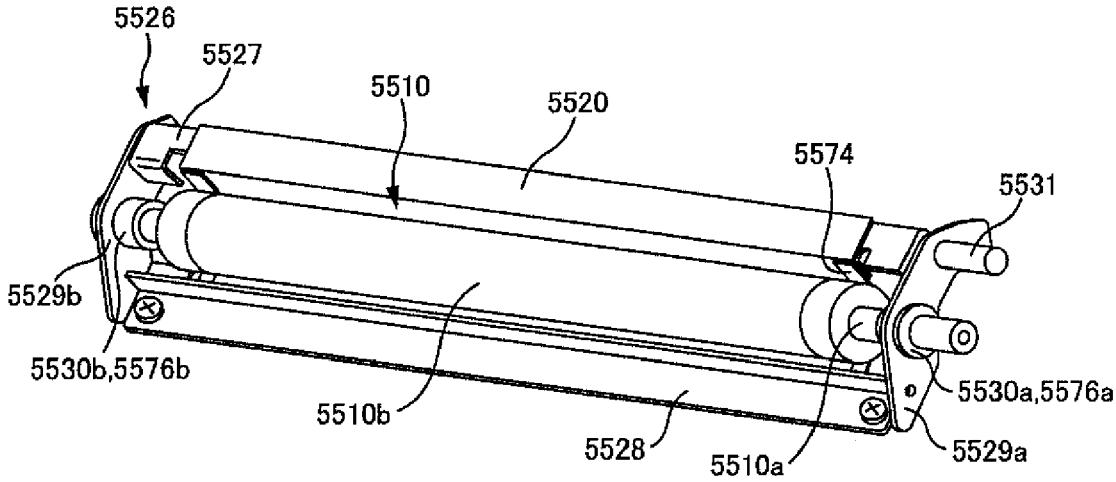
FIG. 47 is a perspective view showing an arrangement in which a developing roller 5510 is installed in a holder 5526, which is shown in FIG. 48.
Figure 48:
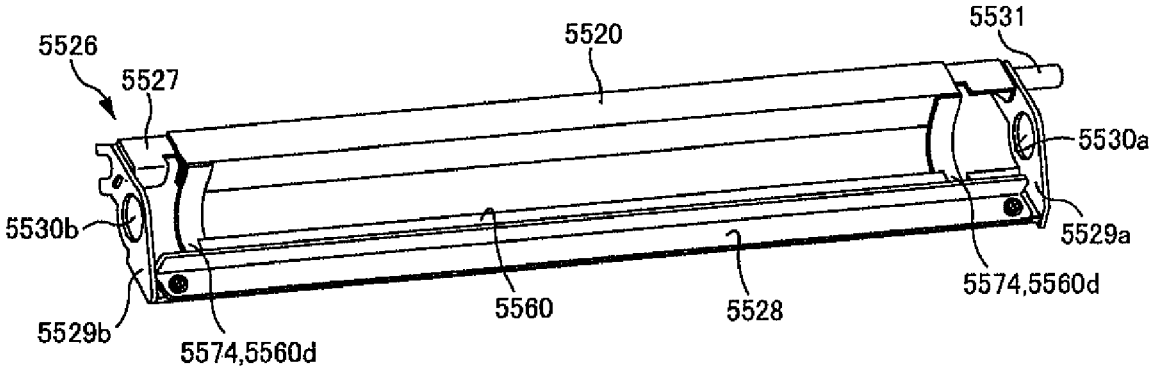
FIG. 48 is a perspective view showing an arrangement in which an upper sealing member 5520 and a regulating blade 5560 are integrated in the holder 5526.
Figure 49:
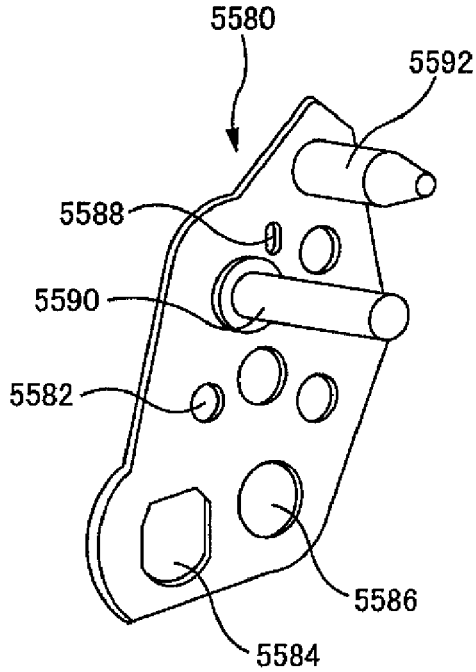
FIG. 49 is a perspective view of a side plate 5580.
Figure 50:
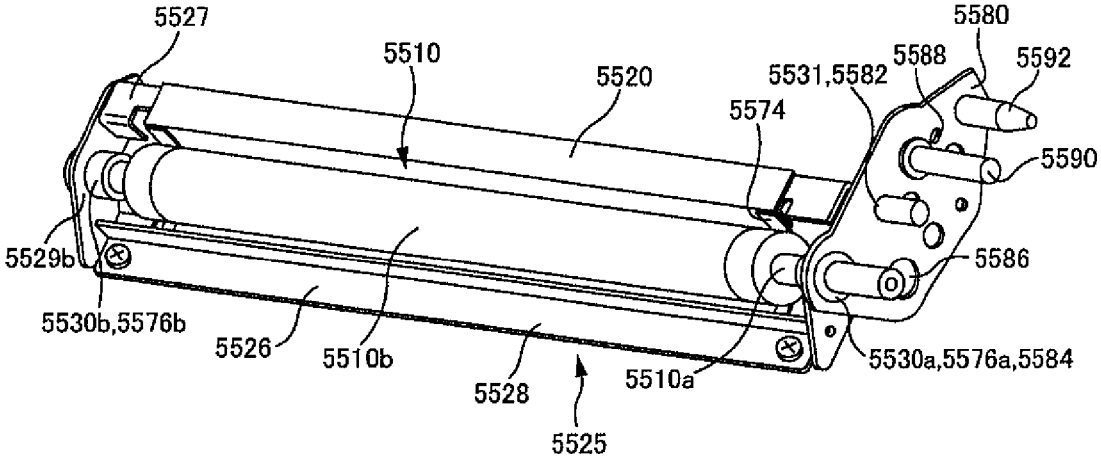
FIG. 50 is a perspective view showing an arrangement in which the upper sealing member 5520, the regulating blade 5560 and the developing roller 5510 are integrated in an integrating member 5525.
Figure 51:
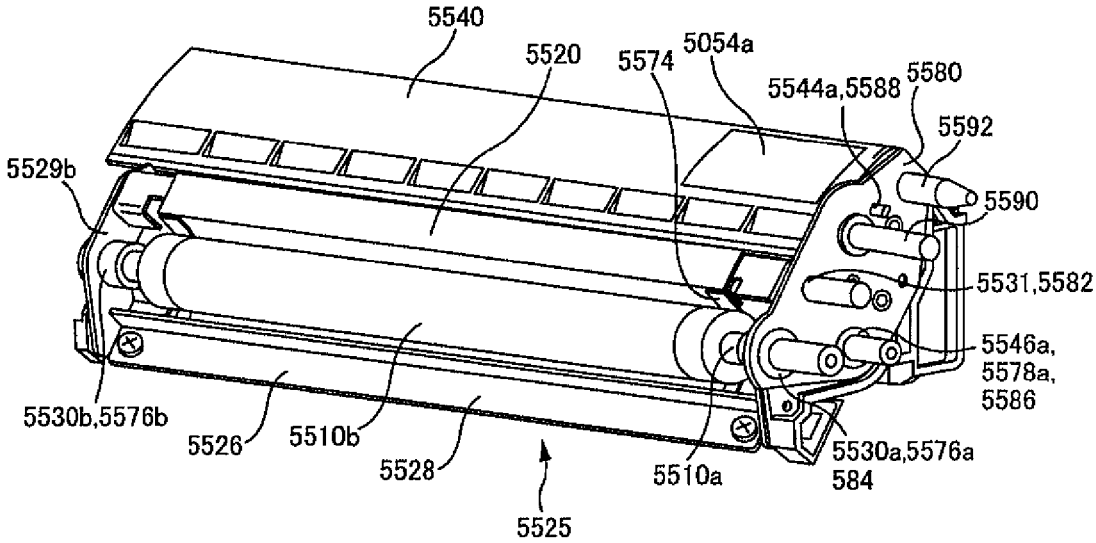
FIG. 51 is a perspective view showing an arrangement in which the integrating member 5525 shown in FIG. 50 is installed in the housing 5540 shown in FIG. 46.
Figure 52:
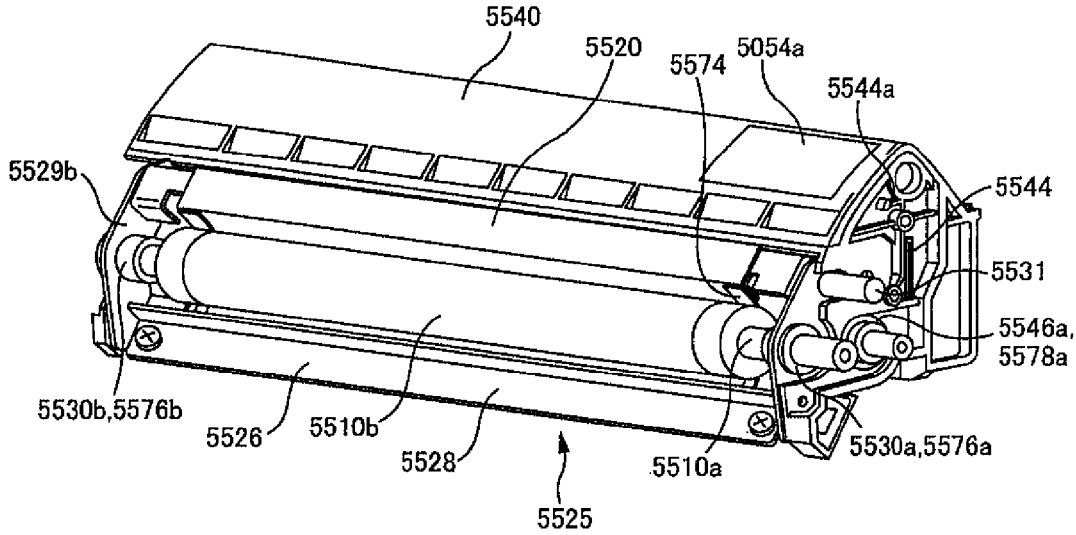
FIG. 52 is a perspective reference view showing the arrangement in FIG. 51 when the side plate 5580 is removed from the integrating member 5525.
Figure 53:
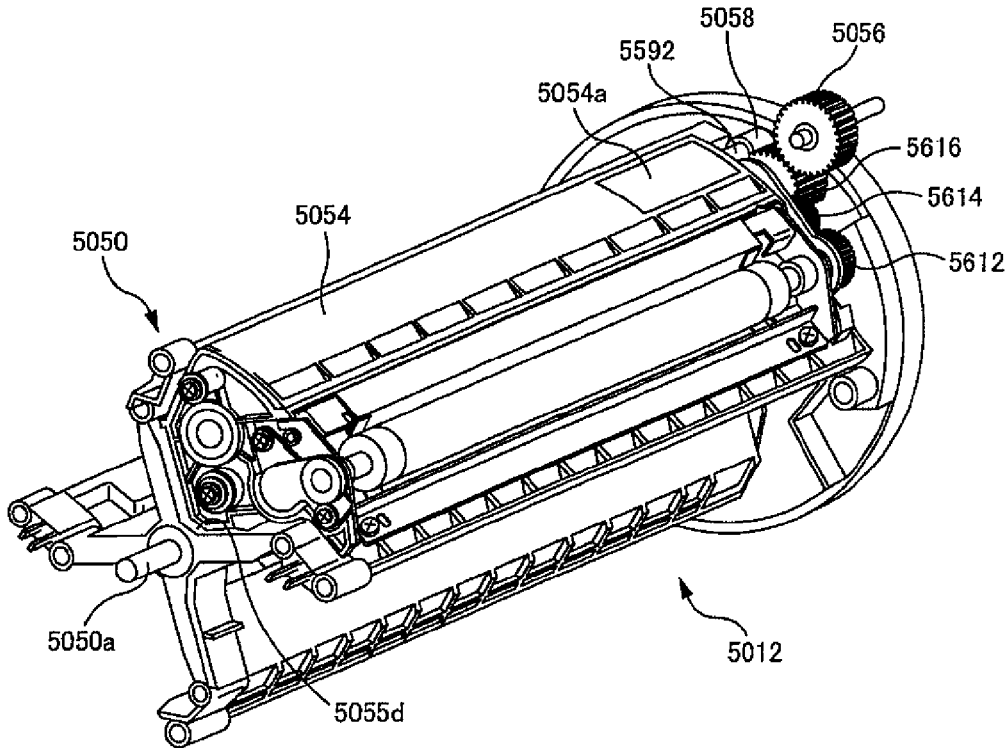
FIG. 53 is a perspective view showing an arrangement in which the yellow developing container 5054 is mounted to the holding section 5055*d* of the YMCK developing unit 5050.
Figure 54:
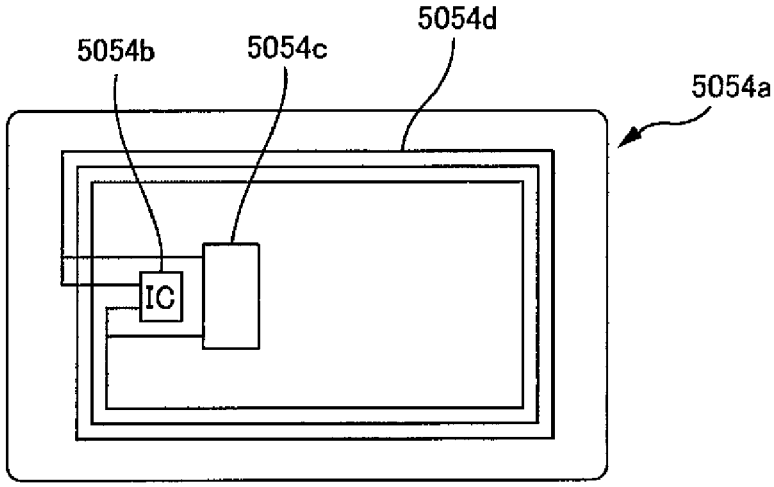
FIG. 54 is a plan transparent view showing the configuration of the element 5054*a*.
Figure 55:
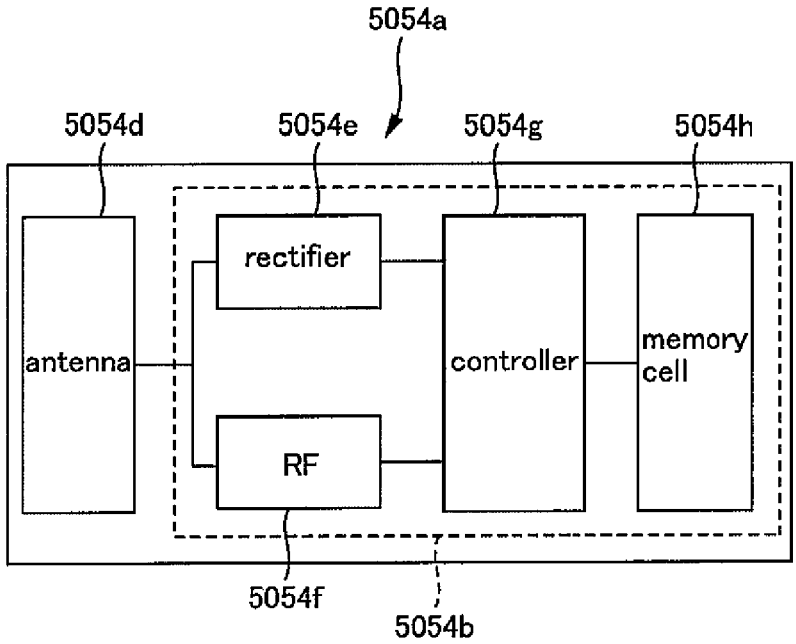
FIG. 55 is a block diagram illustrating the internal configuration of the element 5054*a*.

A configuration example of the developing devices is explained next, using FIG. 44 to FIG. 55. FIG. 44 is a perspective view of a developing device. FIG. 45 is a cross-sectional view showing the main structural components of this developing unit. FIG. 46 is a perspective view showing an arrangement in which a toner supply roller 5550 is installed a housing 5540. FIG. 47 is a perspective view showing an arrangement in which a developing roller 5510 is installed in a holder 5526, which is shown in FIG. 48. FIG. 48 is a perspective view showing an arrangement in which an upper sealing member 5520 and a regulating blade 5560 are integrated in the holder 5526. FIG. 49 is a perspective view of a side plate 5580. FIG. 50 is a perspective view showing an arrangement in which the upper sealing member 5520, the regulating blade 5560 and the developing roller 510 are integrated in an integrating member 5525. FIG. 51 is a perspective view showing an arrangement in which the integrating member 5525 shown in FIG. 50 is installed in the housing 5540 shown in FIG. 46. FIG. 52 is a perspective reference view showing the arrangement in FIG. 51 when the side plate 5580 is removed from the integrating member 5525. FIG. 53 is a perspective view showing an arrangement in which the yellow developing container 5054 is mounted to the holding section 5055*d* of the YMCK developing unit 5050. FIG. 54 is a plan transparent view showing the configuration of the element 5054*a*. FIG. 55 is a block diagram illustrating the internal configuration of the element 5054*a*.

It should be noted that the cross-sectional view shown in FIG. 45 shows a cross section of the developing device taken along a plane perpendicular to the longitudinal direction shown in FIG. 44. Moreover, in FIG. 45, like in FIG. 42, the vertical direction is indicated by arrows, and for example, the center axis of the developing roller 5510 is lower than the center axis of the photoconductor 5020. Also, in FIG. 45, the yellow developing container 5054 is shown in a state positioned at a developing position that is in opposition to the photoconductor 5020.

The black developing container 5051 containing black (K) toner, the magenta developing container 5052 containing magenta (M) toner, the cyan developing container 5053 containing cyan (C) toner, and the yellow developing container 5054 containing yellow (Y) toner are mounted to the YMCK developing unit 5050. However, since the configuration of the developing containers is the same, only the yellow developing container 5054 will be explained below.

The yellow developing container 5054 includes the housing 5540, the toner supply roller 5550, the developing roller 5510, the upper sealing member 5520, the regulating blade 5560, the integrating member 5525, and the element 5054*a*, for example.

The housing 5540 is manufactured by welding together a plurality of integrally-molded housing sections made of resin, that is, an upper housing section 5542 and a lower housing section 5543. A toner containing member 5538 for containing toner T is formed inside the housing 5540. The toner containing member 5538 is divided by a partitioning wall 5545 for partitioning the toner T, which protrudes inwards (in the vertical direction of FIG. 45) from the inner wall, into two toner containing sections, namely, a first toner containing section 5538*a* and a second toner containing section 5538*b*.

The first toner containing section 5538*a* and the second toner containing section 5538*b* are in communication at the top, and in the state shown in FIG. 45, the movement of toner T is restricted by the partitioning wall 5545. However, when the YMCK developing unit 5050 rotates, the toner contained in the first toner containing section 5538*a* and the second toner containing section 5538*b* is temporarily collected on the side where the top sides are in communication in the developing position, and when it returns to the state shown in FIG. 45, the toner is mixed and returned to the first toner containing section 5538*a* and the second toner containing section 5538*b*. That is to say, by rotating the YMCK developing unit 5050, the toner T in the developing containers is suitably stirred. Therefore, in the present embodiment, the toner containing member 5538 is not provided with a stirring member, but it is also possible to provide a stirring member for stirring the toner T contained in the toner containing member 5538. Moreover, as shown in FIG. 45, the housing 5540 (that is, the first toner containing section 5538*a*) has an opening 5572 at its lower side, and the developing roller 5510, which is explained below, is arranged such that it protrudes into this opening 5572. Moreover, a side wall 5544 positioned at one end in the longitudinal direction of the housing 5540 (the yellow developing container 5054) is provided with a pin 5544*a*, which can be fitted into a pin fitting hole 5588 (see FIG. 46) provided on the later-described integrating member 5525 (side plate 5580).

As shown in FIG. 45 and FIG. 46, the toner supply roller 5550 is provided in the above-mentioned first toner accommodation section 5538*a* and not only supplies toner T that is contained in this first toner containing section 5538*a* to the later-described developing roller 5510, but also scrapes off, from the developing roller 5510, toner T that has remained on the developing roller 5510 after developing. The toner supply roller 5550 is made of polyurethane foam, for example, and is in contact with the developing roller 5510 in a state of elastic deformation. The toner supply roller 5550 is disposed at a lower part of the first toner containing section 5538*a*, and the toner T contained in the first toner containing section 5538*a* is supplied to the developing roller 5510 by the toner supply roller 5550 at the lower part of the first toner containing section 5538*a*. As shown in FIG. 46, a shaft of the toner supply roller 5550 is supported rotatably by the housing 5540 with two supply roller bearings 5578, namely a supply roller bearing 5578*a* positioned at one end in the longitudinal direction of the toner supply roller 5550 (yellow developing container 5054) and a supply roller bearing 5578*h* positioned at the other end in the longitudinal direction. More specifically, the housing 5540 is provided with, as supply roller fitting holes 5546 into which the supply roller bearings 5578 can be fitted, a supply roller fitting hole 5546*a* on one end into which the supply roller bearing 5578*a* on the one end can be fitted and a supply roller fitting hole 5546*b* on the other end into which the supply roller bearing 5578*b* on the other end can be fitted. The toner supply roller 5550 is supported rotatably by the housing 5540 with the supply roller bearing 5578*a* on the one end, which is fitted into the supply roller fitting hole 5546*a* on the one end and the supply roller bearing 5578*b* on the other end, which is fitted into the supply roller fitting hole 5546*b* on the other end. As shown in FIG. 45, the toner supply roller 5550 rotates in a direction (the clockwise direction in FIG. 45) that is opposite to the rotation direction of the developing roller 5510 (the counterclockwise direction in FIG. 45). Its center axis is lower than the rotation center axis of the developing roller 5510. It should be noted that a supply roller driving gear wheel 5610 for driving the toner supply roller 5550 is provided at the end (one end in axial direction) of the toner supply roller 5550 (see FIG. 44).

The developing roller 5510 bears toner T and carries it to the developing position opposite the photoconductor 5020. This developing roller 5510 is fabricated from an aluminum alloy, such as 5056 aluminum alloy or 6063 aluminum alloy, or an iron alloy such as STKM, and may be nickel-plated or chromium-plated if necessary.

The developing roller 5510 extends along the longitudinal direction of the yellow developing container 5054 and includes a shaft 5510*a* and a large-diameter section 5510*b*. The shaft 5510*a* is supported by a later-described holder 5526 through two developing roller bearings 5576, namely a developing roller bearing 5576*a* on one end that is positioned on one end in the longitudinal direction of the developing roller 5510 (the yellow developing container 5054) and a developing roller bearing 5576*b* on the other end that is positioned on the other end in the longitudinal direction, thereby rotatably supporting the developing roller 5510. As shown in FIG. 45, the developing roller 5510 rotates in a direction (the counterclockwise direction in FIG. 45) that is opposite to the rotation direction of the photoconductor 5020 (the clockwise direction in FIG. 45). Its center axis is lower than the center axis of the photoconductor 5020. It should be noted that a developing roller driving gear wheel 56512, which is an example of a first driving wheel, for driving the developing roller 5510 is provided at one end of the developing roller 5510 (see FIG. 44).

Moreover, in the state in which the yellow developing container 5054 opposes the photoconductor 5020, there is a gap between the developing roller 5510 and the photoconductor 5020. That is to say, the yellow developing container 5054 develops the latent image formed on the photoconductor 5020 in a noncontacting manner. It should be noted that during the development of the latent image formed on the photoconductor 5020, an alternating electric field is formed between the developing roller 5510 and the photoconductor 5020.

The upper sealing member 5520, which abuts against the developing roller 5510 along its axial direction, allows the movement of toner T that has remained on the developing roller 5510 after passing the developing position and restricts the movement of toner T inside the housing 5540 out of the housing 5540. This upper sealing member 5520 is a seal made of polyethylene film or the like. The upper sealing member 5520 is supported by an upper seal support section 5527 of the holder 5526, which is described later, and is disposed such that its longitudinal direction extends in the axial direction of the developing roller 5510 (see FIG. 48). The contact position where the upper sealing member 5520 contacts the developing roller 5510 is above the center axis of the developing roller 5510.

Moreover, as shown in FIG. 45, an upper seal biasing member 5524 made of an elastic member such as Moltopren is provided in a compressed state between the upper seal support section 5527 and the surface of the upper sealing member 5520 that is on the opposite side of the contact surface 5520*b* contacting the developing roller 5510 (this surface is also referred to as opposite surface 5520*c*). This upper seal biasing member 5524 presses the upper sealing member 5520 against the developing roller 5510 by biasing the upper sealing member 5520 towards the developing roller 5510 with its biasing force.

The regulating blade 5560 abuts against the developing roller 5510 along its axial direction, and regulates the thickness of the toner T borne by the developing roller 5510. Moreover, it applies a charge to the toner T borne by the developing roller 5510. The regulating blade 5560 includes a rubber part 5560*a* and a rubber supporting part 5560*b*. The rubber part 5560*a* is made of silicone rubber or urethane rubber, for example, and the rubber supporting part 5560*b* is a thin plate of phosphor bronze or stainless steel, for example, having elasticity.

The rubber part 5560*a* is supported by the rubber supporting part 5560*b*, and the rubber supporting part 5560*b* presses the rubber part 5560*a* against the developing roller 5510 with its biasing force. With one end of the rubber supporting part 5560*b* being supported by a regulating blade support part 5528 of the holder 5526, which is described later, the rubber supporting part 5560*b* is attached to the regulating blade support part 5528.

The end of the regulating blade 5560 on the side opposite the side supported by the regulating blade supporting part 5528, that is, its front end, is not in contact with the developing roller 5510, and a portion thereof that is removed from this front end by a predetermined distance is in contact with the developing roller 5510 over a certain width. That is to say, the regulating blade 5560 does not come into contact with the developing roller 5510 at its edge but rather at a mid section thereof. Also, the regulating blade 5560 is disposed such that its front end is facing upstream with respect to the direction in which the developing roller 5510 rotates, and is in so-called counter contact. It should be noted that the contact position where the regulating blade 5560 contacts the developing roller 5510 is below the center axis of the developing roller 5510 and is below the center axis of the toner supply roller 5550.

Moreover, end seals 5574 (see FIG. 48) are provided on the outer side in longitudinal direction of the rubber part 5560*a* of the regulating blade 5560. These end seals 5574, which are made of non-woven fabric, abut along the circumferential direction of the developing roller 5510 against the ends in axial direction of the developing roller 5510 and have the function of preventing the leaking of toner T from between its circumferential surface and the housing 5540.

The integrating member 5525 is a member for integrating the various members, such as the developing roller 5510 or the driving gear wheels. It is mainly made of two members, namely the holder 5526 and the side plate 5580, which is positioned at one end in longitudinal direction of the holder 5526 (the yellow developing container 5054) and is an example of a metal plate (see FIG. 50).

The holder 5526 is a member made of metal. As shown in FIG. 48, it includes the upper seal support section 5527 extending along its longitudinal direction (that is, in the axial direction of the developing roller 5510), the regulating blade supporting part 5528 also extending in its longitudinal direction (that is, in the axial direction of the developing roller 5510), and developing roller supporting sections 5529, which are provided on the outer side, with respect to the longitudinal direction (the axial direction), of the upper seal support section 5527 and the regulating blade supporting part 5528 and intersects with the longitudinal direction (the axial direction).

The developing roller support sections 5529 include a developing roller support section 5529*a* positioned on one end in the longitudinal direction of the holder 5526 (the yellow developing container 5054) and a developing roller support section 5529*b* positioned on the other end in the longitudinal direction of the holder 5526 (the yellow developing container 5054). Furthermore, the developing roller support section 5529*a* on the one end and the developing roller support section 5529*b* on the other end include, as developing roller fitting holes 5530 into which the developing roller bearings 5576 can be fitted, a developing roller fitting hole 5530*a* on one end, into which the developing roller bearing 5576*a* on the one end can be fitted, and a developing roller fitting hole 5530*b* on the other end, into which the developing roller bearing 5576*b* on the other end can be fitted. Thus, the developing roller 5510 can be rotatably supported by the holder 5526 with the developing roller bearing 5576*a* on the one end, which is fitted into the developing roller fitting hole 5530*a* on the one end, and the developing roller bearing 5576*b* on the other end, which is fitted into the developing roller fitting hole 5530*h* on the other end (see FIG. 47). It should be noted that the developing roller support section 5529*a* on the one end is provided with an intermediate gear wheel support section 5531 for rotatably supporting a later-described intermediate gear wheel 5614.

Moreover, the upper sealing member 5520 is supported at an end 5520*a* in shorter direction (see FIG. 45) by the upper seal support section 5527, and the regulating blade 5560 is supported at an end 5560*c* in shorter direction (see FIG. 45) by the regulating blade support part 5528. Furthermore, as shown in FIG. 48, the regulating blade 5560 is supported at its ends 5560*d* in longer direction by the end seals 5574.

The side plate 5580 is a member made of metal and, as shown in FIG. 49, includes a support section fitting hole 5582 into which the intermediate gearwheel support section 5531 can be fitted, a developing roller fitting hole 5584 into which the developing roller bearing 5576*a* on the one end can be fitted, a supply roller fitting hole 5586 into which the supply roller bearing 5578*a* on the one end can be fitted, a pin fitting hole 5588 into which the pin 5544*a* can be fitted, a developing device-side gear wheel support section 5590 for rotatably supporting a later-described developing device-side gear wheel 5616, which is an example of a second driving wheel, and a positioning pin 5592 for positioning the yellow developing container 5054 in the printer main unit 5012.

As shown in FIG. 50, the integrating member 5525 is constituted by fitting the intermediate gear wheel support section 5531 and the one-end developing roller bearing 5576*a* of the holder 5526 in which the developing roller 5510 is installed respectively into the support section fitting hole 5582 and the developing roller hole 5584 of the side plate 5580.

As shown in FIG. 51 and FIG. 52, the thusly constituted integrating member 5525 is installed in the housing 5540, which is provided with the toner supply roller 5550, as shown in FIG. 46, via a housing seal 5602 (see FIG. 45) for preventing the leakage of toner T from between the integrating member 5525 and the housing 5540. During this, the supply roller bearing 5578*a* on the one end and the pin 5544*a* provided on the housing 5540 including the toner supply roller 5550 are respectively fitted into the supply roller fitting hole 5586 and the pin fitting hole 5588 of the integrating member 5525 at the one end in longitudinal direction of the yellow developing container 5054. Consequently, the toner supply roller 5550 is rotatively supported by the supply roller hole 5586 of the integrating member 5525 and the supply roller hole 5546 of the housing 5540 mentioned above.

In the foregoing, it was explained that the developing roller driving gear wheel 5612 and the supply roller driving gear wheel 5610 are respectively provided at the end (the end in axial direction) of the developing roller 55510 and the toner supply roller 5550, but as show in FIG. 44, the yellow developing container 5054 also includes a developing device-side gear wheel 5616 and an intermediate gear wheel 5614 besides these gear wheels.

The developing device-side gear wheel 5616 is a gear wheel for receiving driving force from the printer main unit 5012, or more specifically from a later-described main unit-side gear wheel 5056, and transmitting this driving force to the developing roller driving gear wheel 5612 and the supply roller driving gear wheel 5610 in a state in which the yellow developing container 5054 is mounted to the printer main unit 5012. This developing device-side gear wheel 5616 is supported rotatively by the above-mentioned developing device-side gear wheel support section 5590.

The intermediate gear wheel 5614 is a gear wheel serving as a medium when the developing device-side gearwheel 5616 transmits driving force to the developing roller driving gear wheel 5612 and the supply roller driving gear wheel 5610. That is to say, when the yellow developing container 5054 is mounted to the printer main unit 5012, the developing device-side gear wheel 5616 receives driving force from the printer main unit 5012 and transmits the driving force via the intermediate gear wheel 5614 to the developing roller driving gear wheel 5612 and the supply roller driving gear wheel 5610. This intermediate gear wheel 5614 is supported rotatively by the above-mentioned intermediate gear wheel support section 5531.

As shown in FIG. 44, the developing device-side gear wheel 5616 meshes with the intermediate gear wheel 5614, the intermediate gear wheel 5614 meshes with the developing roller driving gear wheel 5612, and the developing roller driving gear wheel 5612 meshes with the supply roller driving gear wheel 5610. Moreover, as shown in FIG. 53, the developing device-side gear wheel 5616 meshes with the main unit-side gear wheel 5056 with which the printer main unit 5012 is provided.

This main unit-side gear wheel 5056 applies the driving force received from a developing device driving motor 5057 (see FIG. 58), which is as an example of a motor, to the developing device-side gear wheel 5616. Then, the developing device-side gear wheel 6516 transmits the driving force received from the main unit-side gear wheel 5056 via the intermediate gear wheel 5614 to the developing roller driving gear wheel 5612. Due to the meshing of the developing roller driving gear wheel 5612 with the supply roller driving gear wheel 5610, the driving force transmitted to the developing roller driving gear wheel 5612 is also transmitted to the supply roller driving gear wheel 5610.

As noted above, the element 5054*a* is a member that can communicate wirelessly with the main unit-side antenna 5124. This element 5054*a* has an adhesive surface on its rear side and is adhered to an indented section provided in the housing 5540. As shown in FIG. 44 for example, the position where the element 5054*a* is adhered is at an end in the longitudinal direction of the yellow developing container 5054, namely at the end on the side where the aforementioned developing roller driving gear wheel 5612 is positioned.

As shown in FIG. 54, the element 5054*a* has a non-contact IC chip 5054*b*, a resonance capacitor 5054*c* that is formed by etching a metal film, and a flat coil serving as an antenna 5054*d*. These are mounted onto a plastic film and covered by a transparent coversheet. As shown in FIG. 55, the non-contact IC chip 5054*b* includes a rectifier 5054*e*, a signal analysis section RF (Radio Frequency) 5054*f*, a controller 5054*g*, and the memory cell 5054*h*. The memory cell 5054*h* is a nonvolatile memory that can be electrically read and written, such as an NAND flash ROM, and is capable of storing information that has been written in it and reading that stored information from the outside.

The antenna 5054*d* of the element 5054*a* and the main unit-side antenna 5124 communicate wirelessly with one another, so that information stored in the memory cell 5054*h* can be read and information can be written to the memory cell 5054*h*. Also, the high-frequency signals that are generated by the send-receive circuit 5123 of the printer main unit 5012 are induced as a high-frequency magnetic field via the main unit-side antenna 5124. This high-frequency magnetic field is absorbed via the antenna 5054*d* of the element 5054*a* and is rectified by the rectifier 5054*e*, thus serving as a DC power source for driving the circuits in the non-contact IC chip 5054*b*.

The following is an explanation of the operation of the thusly configured yellow developing container 5054 during developing. The toner supply roller 5550 supplies, through its rotation, toner T contained in the toner containing member 5538 to the developing roller 5510. In this situation, the toner supply roller 5550 is driven by the driving force transmitted to it by the supply roller driving gear wheel 5610, and rotates. As the developing roller 5510 rotates, the toner T that is supplied to the developing roller 5510 is brought to the contact position of the regulating blade 5560, and when it passes the contact position, the layer thickness of the toner T is regulated, and a charge is applied to it. The toner T on the developing roller 5510, whose layer thickness has been regulated and which has been charged, is brought to the developing position in opposition to the photoconductor 5020 by further rotation of the developing roller 5510, and is supplied for the development of the latent image formed on the photoconductor 5020 in an alternating electric field at the developing position. The toner T on the developing roller 5510 that has passed the developing position due to further rotation of the developing roller 5510 passes the upper sealing member 5520 and is collected in the developing device without being scraped off by the upper sealing member 5520. It should be noted that the developing roller 5510 is driven by the driving force transmitted to it by the developing roller driving gear wheel 5612, and rotates. Moreover, the toner T that still remains on the developing roller 5510 is stripped off by the toner supply roller 5550.

<<<About the Positioning of the Gear Wheels>>>

In order to suitably drive the developing roller 5510, the above-mentioned developing device-side gear wheel 5616 and the developing roller driving gear wheel 5612 need to be positioned with high precision. In developing devices in which the developing device-side gear wheel 5616 and the developing roller driving gear wheel 5612 are not positioned with high precision, an improper developing operation will be performed, since the developing roller 5510 is not driven properly. Similarly, if the developing device is provided with a toner supply roller 5550, then it is necessary to position the supply roller driving gear wheel 5610 with high precision, in order to suitably drive the toner supply roller 5550. Furthermore, if the developing device is provided with an intermediate gear wheel 5614, then also this intermediate gear wheel 5614 needs to be positioned with high precision.

The following is an explanation of how these gear wheels are positioned in the yellow developing container 5054 according to this embodiment. As noted above, the intermediate gear wheel support section 5531 and the bearing 5576*a* for the developing roller at the one end of the holder 5526 in which for example the developing roller 5510 is installed are fitted respectively into the support section fitting hole 5582 and the developing roller fitting hole 55B4 of the side plate 5580. Thus, the relative position of the side plate 5580 and the holder 5526 in which the developing roller 5510 is installed is positioned.

Also, the bearing 5578*a* for the supply roller at the one end is fitted into the supply roller fitting hole 5586 of the side plate 5580. And moreover, the side plate 5580 is provided with the developing device-side gear wheel support section 5590 for rotatively supporting the developing device-side gear wheel 5616, and the holder 5526 is provided with the intermediate gear wheel support section 5531 for rotatively supporting the intermediate gear wheel 5614. Thus, the relative positions of the developing device-side gear wheel support section 5590, the intermediate gear wheel support section 5531, the bearing 5576*a* for the developing roller on the one side and the bearing 5578*a* for the supply roller on the one side are positioned.

Furthermore, the developing device-side gearwheel 5616 is supported by the developing device-side gear wheel support section 5590, and the intermediate gear wheel 5614 is supported by the intermediate gear wheel support section 5531. The developing roller driving gear wheel 5612 and the support roller driving gear wheel 5610 are respectively provided at ends (ends in axial direction) of the developing roller 55510 and the toner supply roller 5550. Thus, the relative positions of the developing device-side gear wheel 5616, the intermediate gear wheel 5614, the developing roller driving gear wheel 5612 and the supply roller driving gear wheel 5610 are positioned.

Thus, by cooperating with the holder 5526, the side plate 5580 has the function of serving as a positioning member for positioning the above-noted gear wheels (the developing device-side gear wheel 5616, the developing roller driving gear wheel 5612, the intermediate gear wheel 5614, and the supply roller driving gear wheel 5610).

===Overview of the YMCK Developing Unit===

Figure 56A:
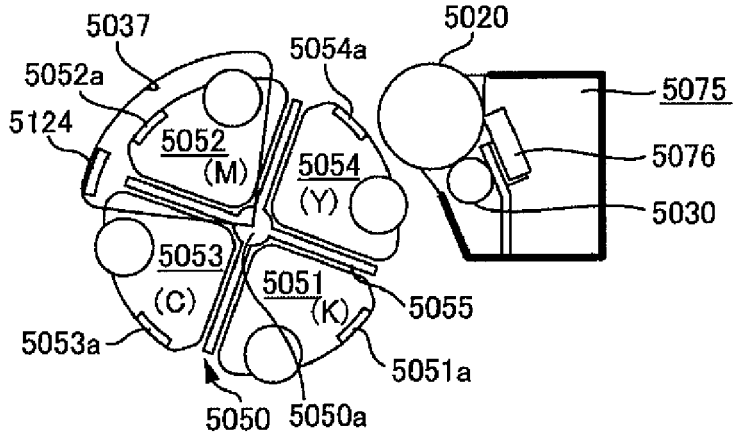
FIG. 56A is a diagram showing the HP position.
Figure 56B:
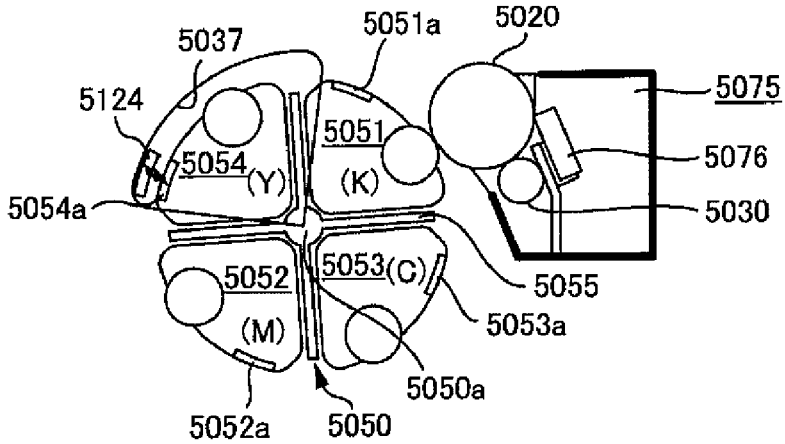
FIG. 56B is a diagram showing the communication position of the yellow developing container 5054.
Figure 56C:
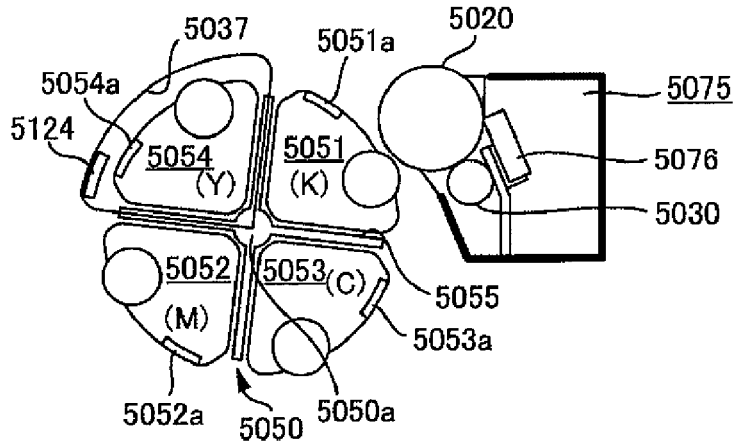
FIG. 56C is a diagram showing the mounting and dismounting position of the yellow developing container 5054.

Next, an overview of the YMCK developing unit 5050 is given using FIG. 56A, FIG. 56B and FIG. 56C. The YMCK developing unit 5050 includes a central shaft 5050*a* positioned in its center. A support frame 5055 for holding the developing devices is fixed to this central shaft 5050*a*. The central shaft 5050*a* spans the distance between two frame side plates (not shown in the drawings) of the housing of the printer 5010, which support its two end portions. It should be noted that the axial direction of the central shaft 5050*a* intersects with the vertical direction.

This support frame 5055 includes four holding sections 5055*a*, 5055*b*, 5055*c*, and 5055*d*, in which the four developing devices 5051, 5052, 5053, and 5054 are removably held, arranged at spacings of 90° in circumferential direction.

A pulse motor not shown in the drawings is connected via a clutch to the central shaft 5050*a*, and by driving this pulse motor, the support frame 5055 is rotated and the four developing devices 5051, 5052, 5053 and 5054 can be positioned at predetermined positions.

FIG. 56A, FIG. 56B, and FIG. 56C illustrate the three stop positions of the rotating YMCK developing units 5050. FIG. 56A shows the home position (referred to as "HP position" below), which is the stand-by position when waiting for the execution of image formation, and is also the stop position serving as a reference position for the rotational direction of the YMCK developing unit 5050. FIG. 56B shows the communication position of the yellow developing device 5054 mounted to the YMCK developing unit 5050. FIG. 56C shows the mounting and dismounting position of the yellow developing device 5054.

Here, in FIG. 56B and FIG. 56C, the communication position and the mounting and dismounting position of the yellow developing device 5054 are shown, but the communication position and the mounting and dismounting position of any developing device can be achieved by rotating the YMCK developing unit 5050 successively by amounts of 90°.

First, the HP position shown in FIG. 56A is explained. A HP detection section (not shown in the drawings) for detecting the HP position is provided at one end of the central shaft 5050*a* of the YMCK developing unit 5050. This HP detection section includes a circular disk for generating a signal that is attached to one end of the central shaft 5050*a*, and an HP sensor made of a photo-interrupter including a light-emitting section and a light-receiving section. The outer edge of the circular disk is arranged such that it is positioned between the light-emitting section and the light-receiving section of the HP sensor. When slit sections formed in the circular disk are moved to a detection position of the HP sensor, the signal that is output by the HP sensor changes from "L" to "H". Then, the HP position of the YMCK developing unit 5050 is detected from this change in signal level and the pulse number of the pulse motor, and taking this HP position as a reference, it is possible to position the developing devices at the communication position or the like.

FIG. 56B shows the communication position of the yellow developing device 5054, after letting the pulse motor rotate by a predetermined number of pulses from the HP position. In the communication position of the yellow developing roller 5054 shown in FIG. 56B, the element 5054*a* of the yellow developing device 5054 communicates wirelessly with the main unit-side antenna 5124 with which the printer main unit 5012 is provided. It should be noted that the communication position for the yellow developing device 5054 is the developing position of the black developing device 5051, in which the developing roller 510 of the black developing device 5051 and the photoconductor 5020 face each other. That is to say, the communication position of the YMCK developing unit 5050 for the yellow developing device 5054 is the developing position of the YMCK developing unit 5050 for the black developing device 5051. Moreover, when the pulse motor rotates the YMCK developing unit 5050 for 90° in the counterclockwise direction, the communication position of the black developing device 5051 and the developing position of the cyan developing device 5053 are attained. When the YMCK developing unit 5050 is rotated by amounts of 90° each, the communication position and the developing position of each of the developing units are successively attained.

It should be noted that the positional relation between the element 5054*a* and the main unit-side antenna 5124 in the communication position is explained in detail later.

Moreover, one of the two frame side plates that support the YMCK developing unit 5050 and are part of the housing of the printer 5010 is provided with an opening 5037 reserved for mounting and dismounting through which one developing device can be passed. This opening 5037 reserved for mounting and dismounting is formed at such a position that, when the YMCK developing unit 5050 is rotated and stopped at one of the mounting and dismounting positions that are set for each of the developing devices, only the corresponding developing device (here, the yellow developing device 5054) can be removed by pulling it out in a direction parallel to the central shaft 5050*a*, as shown in FIG. 56C. Moreover, the opening 5037 reserved for mounting and dismounting is formed slightly larger than the outer shape of the developing device, and in the mounting and dismounting position, not only can the developing device be retrieved, but a new developing device can be inserted in the direction parallel to the central shaft 5050*a* through this opening 5037 reserved for mounting and dismounting, and the developing device can be mounted to the support frame 5055. While the YMCK developing unit 5050 is not positioned in a mounting and dismounting position, the mounting and dismounting of developing devices is prevented by the frame side plates.

It should be noted that the YMCK developing unit 5050 is provided with a locking mechanism not shown in the drawings, in order to position and fix the YMCK developing unit 5050 reliably at the above-noted positions.

===About the Positional Relation Between Element, Main Unit-Side Antenna and Members in their Vicinity===

Figure 57:
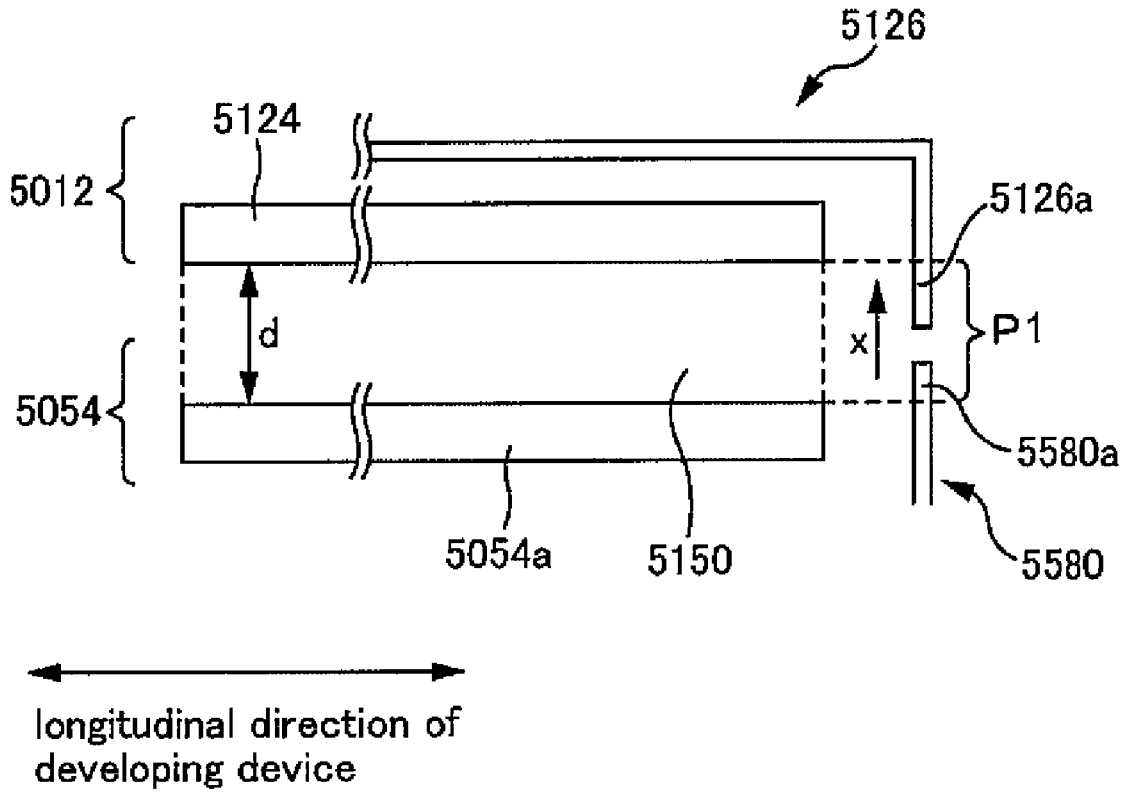
FIG. 57 is a diagrammatic view showing the positional relation between the element 5054*a* and the main unit-side antenna 5124 when the element 5054*a* communicates wirelessly with the main unit-side antenna 5124.
Figure 58:
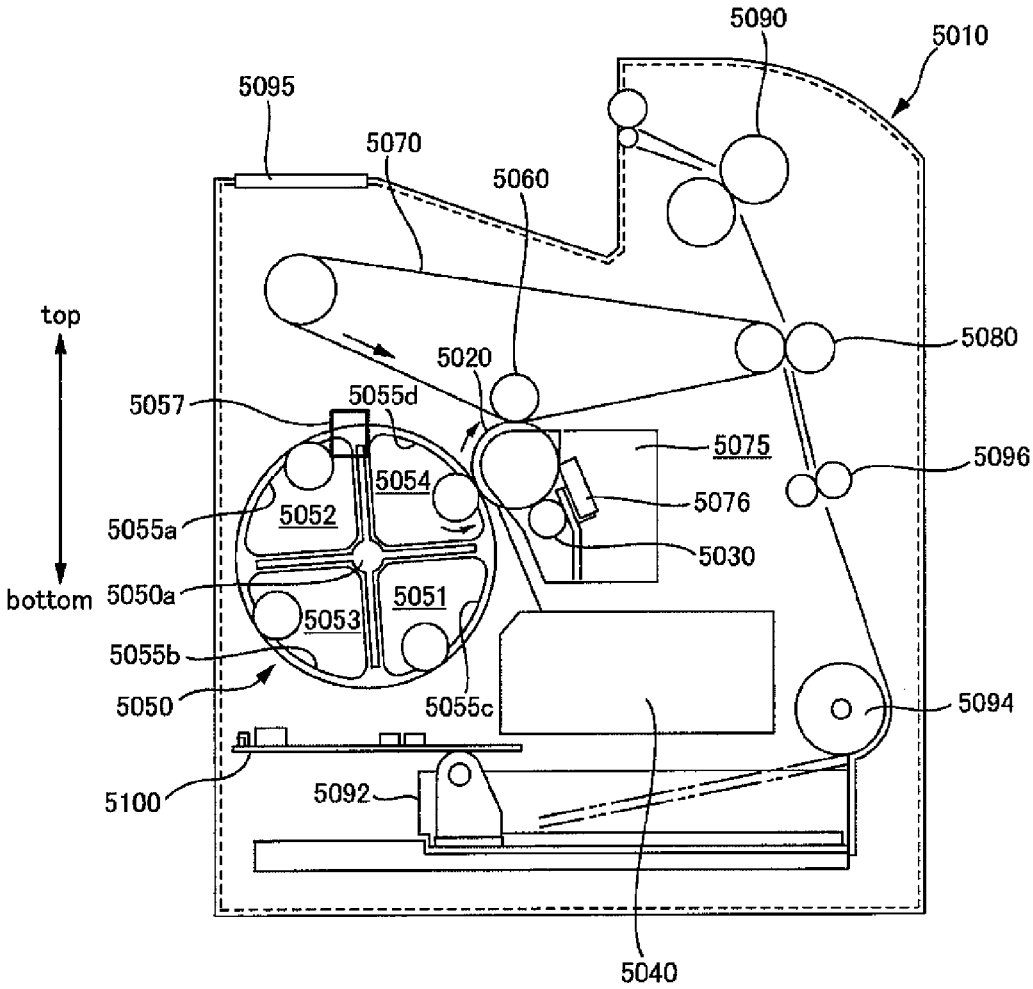
FIG. 58 is a diagrammatic view showing the position of the developing device driving motor 5057.

As noted above, in the communication positions of the developing devices, which are stop positions of the YMCK developing unit 5050, the elements of the developing devices communicate wirelessly with the main unit-side antenna 5124 with which the printer main unit 5012 is provided. Referring to FIG. 57 and FIG. 58, the following is an explanation of the positional relation between the element and the main unit-side antenna 5124, when one of the elements performs wireless communication with the main unit-side antenna 5124. FIG. 57 is a diagrammatic view showing the positional relation between the element 5054*a* and the main unit-side antenna 5124 when the element 5054*a* communicates wirelessly with the main unit-side antenna 5124. FIG. 58 is a diagrammatic view showing the position of the developing device driving motor 5057.

It should be noted that as the communication positions of the developing device, there are the communication position of the black developing device 5051, the communication position of the magenta developing device 5052, the communication position of the cyan developing device 5053, and the communication position of the yellow developing device 5054, but the positional relation between the element and the main unit-side antenna 5124 is the same for all these communication positions, so that in the following, the positional relationship between the element 5054*a* of the yellow developing device 5054 and the main unit-side antenna 5124 is explained. Moreover, in the following, not only the positional relationship between the element 5054*a* and the main unit-side antenna 5124, but also the positional relationship between these and members in their vicinity is considered.

As shown in FIG. 57, in the communication position of the yellow developing device 5054, the element 5054*a* is in a state facing the main unit-side antenna 5124 across a gap 5150, such that the element 5054*a* of the yellow developing device 5054 can perform suitable wireless communication with the main unit-side antenna 5124 with which the printer main unit 5012 is provided. That is to say, when the yellow developing device 5054 is mounted to the holding section 5055*d*, it rotates together with the rotation of the YMCK developing unit 5050, so that when the element 5054*a* of the yellow developing device 5054 faces the main unit-side antenna 5124 across the gap 5150, the element 5054*a* performs wireless communication with the main unit-side antenna 5124. It should be noted that the distance d between the element 5054*a* and the main unit-side antenna 5124 when the element 5054*a* faces the main unit-side antenna 5124 (in other words, the width d of the gap 5150) is about 8 mm.

Moreover, as noted above, the yellow developing device 5054 is provided with a side plate 5580 made of metal. And as shown in FIG. 51 and FIG. 57, when the element 5054*a* performs wireless communication with the main unit-side antenna 5124, a portion of this side plate 5580 (in this embodiment, the upper portion 5580*a*) is positioned at a position corresponding to this gap 5150 (this corresponding position is denoted as P1 in FIG. 57), to the outer side of the gap 5150 and extending along the direction from the element 5054*a* toward the main unit-side antenna 5124 (this direction is denoted as X in FIG. 57).

Moreover, as shown in FIG. 57, the printer main unit 5012 is provided with a plate made of metal (this plate is referred to as the main unit-side metal plate 5126), surrounding the main unit-side antenna 5124. When the element 5054*a* performs wireless communication with the main unit-side antenna 5124, also a portion of this main unit-side metal plate 5126 (in the present embodiment, the bottom portion 5126*a*) is positioned at the position P1 corresponding to the gap 5150 to the outer side of the gap 5150 and extending along the direction X from the element 5054*a* toward the main unit-side antenna 5124.

The upper portion 5580*a* of the side plate 5580 and the lower portion 5126*a* of the main unit-side metal plate 5126 respectively fulfill the role of decreasing the amount of noise that intrudes into the gap 5150 between the element 5054*a* and the main unit-side antenna 5124.

That is to say, as explained in the section stating the problem to be solved by the invention, when the element 5054*a* performs wireless communication with the main unit-side antenna 5124, electromagnetic waves are propagated into the gap 5150 between the element 5054*a* and the main unit-side antenna 5124. Therefore, when too much noise intrudes into this gap 5150 from the outside, suitable wireless communication is obstructed. In the present embodiment, when the element 5054*a* communicates wirelessly with the main unit-side antenna 5124, (the upper portion 5580*a* of) the side plate 5580 and (the lower portion 5126*a*) of the main unit-side metal plate 5126, which are both made of metal, are positioned at the position P1 corresponding to the gap 5150 to the outer side of the gap 5150 and extending along the direction X from the element 5054*a* toward the main unit-side antenna 5124 so that they suitably block the intrusion of noise from the outside into the gap 5150. Consequently, the amount of noise intruding into the gap 5150 is suitably decreased, and suitable wireless communication can be performed.

Moreover, in the present embodiment, when the element 5054*a* communicates wirelessly with the main unit-side antenna 5124, the side plate 5580 is positioned between the developing device driving motor 5057 and the gap 5150. That is to say, the developing device driving motor 5057 is provided at the position marked by the black frame in FIG. 58, on the opposite side of the element 5054*a* when seen from the side plate 5580 (the yellow developing device 5054 is provided on the printer main unit 5012 such that the element 5054*a* and the side plate 5580, which are positioned at one end in longitudinal direction, are arranged behind the paper plane of FIG. 58, and the developing device driving motor 5057 is arranged even further behind the paper plane than the yellow developing device 5054). Therefore, the yellow developing device 5054 rotates together with the rotation of the YMCK developing unit 5050 when it is mounted to the holding section 5055*d*, and when the element 5054*a* faces the main unit-side antenna 5124 across the gap 5150, the side plate 5580 is positioned between the developing device driving motor 5057 and the gap 5150.

And, since the developing device driving motor 5057 is a source of noise, in the present embodiment, the above-noted effect of the side plate 5580, that is, the effect that the amount of noise intruding the gap 5150 is appropriately reduced, can be displayed even more effectively.

Other Embodiments

A developing device or the like according to the present invention was explained by way of the foregoing embodiment, but the foregoing embodiment of the invention is merely for the purpose of elucidating the present invention and is not to be interpreted as limiting the present invention. The invention can of course be altered and improved without departing from the gist thereof and equivalents are intended to be embraced therein.

In the foregoing embodiment, an intermediate image transfer type full-color laser beam printer was described as an example of the image forming apparatus, but the present invention can also be applied to various other types of image forming apparatuses, such as full-color laser beam printers that are not of the intermediate image transfer type, monochrome laser beam printers, copying machines, and facsimiles.

Moreover, also the photoconductor is not limited to a so-called photoconductive roller, which is configured by providing a photoconductive layer on the outer circumferential surface of a hollow cylindrical conductive base, and can also be a so-called photoconductive belt, which is configured by providing a photoconductive layer on the surface of a belt-shaped conductive base.

Moreover, in the present embodiment, when the developing devices are mounted to the holding sections 5055*a*, 5055*b*, 5055*c* and 5055*d*, they rotate together with the rotation of the YMCK developing unit 5050, so that the elements communicate wirelessly with the main unit-side antenna 5124 when the elements with which the developing devices are provided face the main unit-side antenna 5124 across the gap 5150. However, there is no limitation to this. For example, it is also possible that when the developing devices are mounted to the holding sections 5055*a*, 5055*b*, 5055*c*, and 5055*d*, without rotating the developing devices, the elements with which the developing devices are provided constantly face the main unit-side antenna 5124 across the gap 5150.

Moreover, in the foregoing embodiment, the metal plate (side plate 5580) of the developing device is a positioning member for positioning the developing roller driving gear wheel 5612 and the developing device-side gear wheel 5616, but there is no limitation to this. That is to say, the metal plate of the developing device has the two functions of decreasing the amount of noise that intrudes into the gap 5150 to the main unit-side antenna 5124 and the function of serving as the positioning member, but there is no limitation to this, and it is also possible that it does not have the function of serving as the positioning member. However, with respect to one member having a plurality of functions, the foregoing embodiment is more effective.

Moreover, in the foregoing embodiment, the element is provided at the end in longitudinal direction of the developing device on the side where the developing roller driving gear wheel 5612 is positioned, but there is no limitation to this. For example, it is also possible that the element is provided in the middle in longitudinal direction of the developing device.

If the element is provided at the end in longitudinal direction of the developing device on the side where the developing roller driving gear wheel 5612 is positioned, then the element is positioned at a position that is closer to the side plate 5580, so that the side plate 5580 can more suitably decrease the amount of noise intruding into the gap 5150. For this reason, the foregoing embodiment is more preferable.

Moreover, in the foregoing embodiment, when the element communicates wirelessly with the main unit-side antenna 5124, the side plate 5580 is positioned between the motor and the gap 5150, but there is no limitation to this, and it is also possible that the side plate 5580 is not positioned between the motor and the gap 5150. Moreover, in the foregoing embodiment, the developing device driving motor 5057 is given as an example of that motor, but there is no limitation to this, and any motor may used. For example, the side plate 5580 may be positioned between the YMCK developing unit driving unit motor and the gap 5150, or the side plate 5580 may be positioned between the medium carry motor and the gap 5150. Moreover, in the foregoing embodiment, the printer main unit 5012 includes a main unit-side metal plate 5126 at least a portion of which is positioned at a position corresponding to the gap 5150 to the outer side of the gap 5150 and extending along the direction from the element toward the main unit-side antenna 5124 when the element communicates wirelessly with the main unit-side antenna 5124, but there is no limitation to this, and it is also possible that the printer main unit 5012 does not include this main unit-side metal plate 5126.

However, with regard to the fact that the amount of noise that intrudes into the gap between the element and the main unit-side antenna 5124 is decreased more suitably when the element communicates wirelessly with the main unit-side antenna 5124, the foregoing embodiment is preferable.

Figure 59:
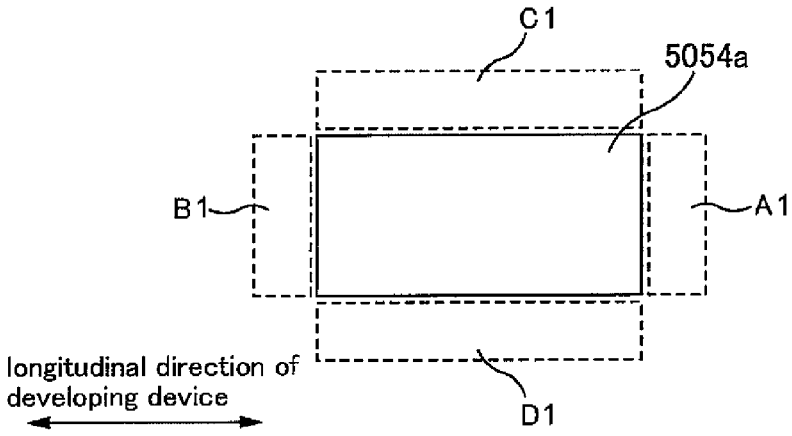
FIG. 59 is a diagram illustrating the variation of the placement positions of the metal plates.

Moreover, in the foregoing embodiment, the metal plate of the developing device is provided further to the outside than the element in the longitudinal direction of the developing device, but there is no limitation to this. That is to say, it is not necessarily required that the metal plate of the developing device is provided at the region A1 in FIG. 59, and it may also be provided at the region S1, the region C1 or the region D1. It can also be provided at a plurality of the regions A1 to D1. It should be noted that FIG. 59 is a diagrammatic view showing the element of FIG. 44 from above, and is a diagram illustrating variations of the positions where the metal plate can be placed.

Moreover, in the foregoing embodiment, when the element 5054*a* communicates wirelessly with the main unit-side antenna 5124, a portion of the side plate 5580 is positioned at a position P1 corresponding to the gap 5150 to the outer side of the gap 5150 and extending along the direction X from the element 5054*a* toward the main unit-side antenna 5124, but there is no limitation to this and it is also possible that, for example, all portions of the side plate 5580 are positioned at the position P1 corresponding to the gap 5150 to the outer side of the gap 5150 and extending along the direction X.

Similarly, in the foregoing embodiment, when the element 5054*a* communicates wirelessly with the main unit-side antenna 5124, a portion of the main unit-side metal plate 5126 is positioned at a position P1 corresponding to the gap 5150 to the outer side of the gap 5150 and extending along the direction X from the element 5054*a* toward the main unit-side antenna 5124, but there is no limitation to this and it is also possible that, for example, all portions of the main unit-side metal plate 5126 are positioned at the position P1 corresponding to the gap 5150 to the outer side of the gap 5150 and extending along the direction X.

===Configuration of the Image Forming System Etc.===

Next, an embodiment of an image forming system serving as an example of an embodiment of the present invention is described with reference to the drawings.

Figure 60:
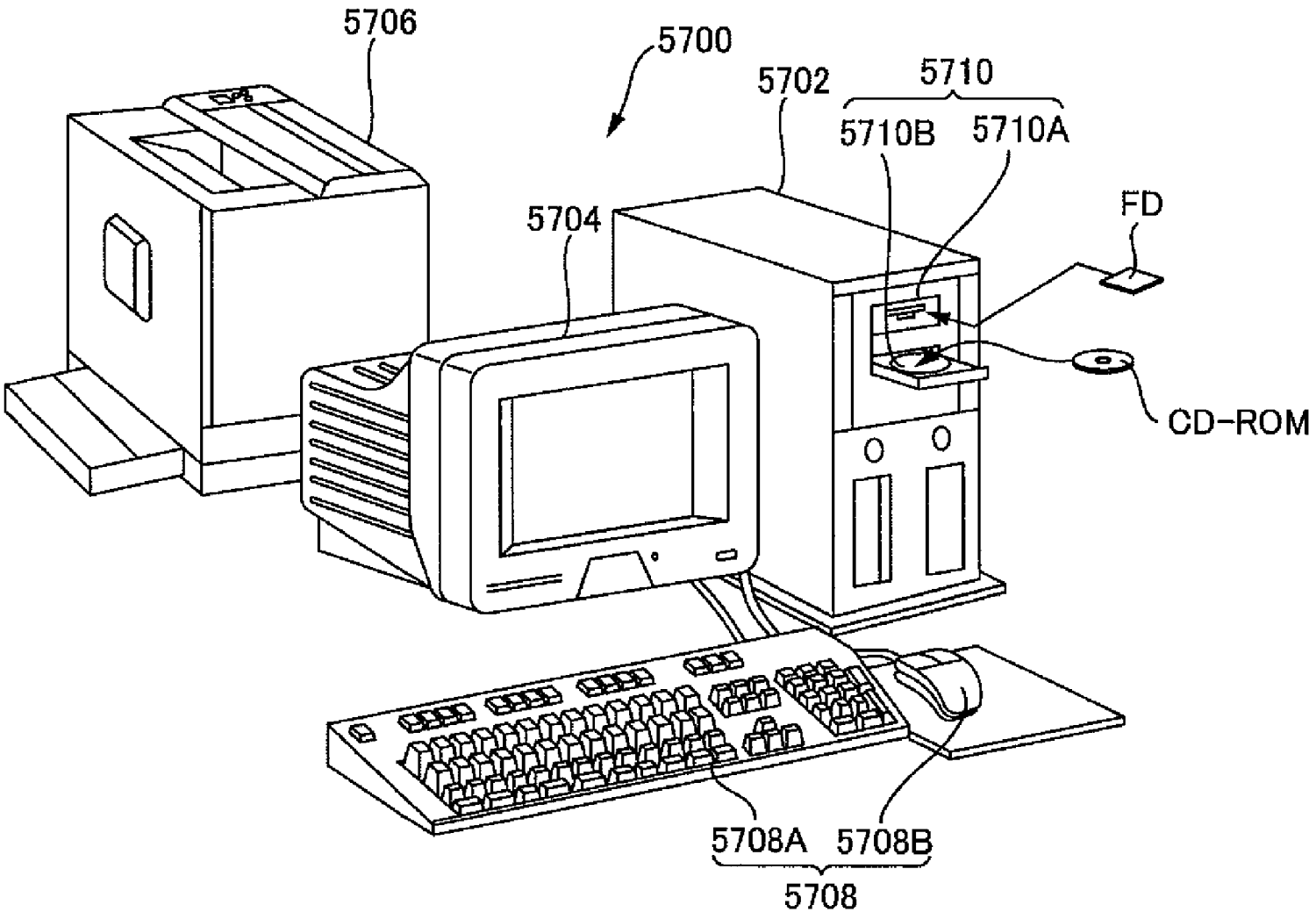
FIG. 60 is an explanatory diagram showing the external configuration of the image forming system.

FIG. 60 is an explanatory diagram showing the external configuration of an image forming system. An image forming system 5700 is provided with a computer 5702, a display device 5704, a printer 5706, input devices 5708, and reading devices 5710. In this embodiment, the computer 5702 is contained within a mini-tower type housing, but there is no limitation to this. A CRT (cathode ray tube), plasma display, or liquid crystal display device, for example, is generally used as the display device 5704, but there is no limitation to this. As the printer 5706, the printer described above is used. In this embodiment, the input devices 5708 are a keyboard 5708A and a mouse 5708B, but there is no limitation to these. In this embodiment, a flexible disk drive device 5710A and a CD-ROM drive device 5710B are used as the reading devices 5710, but the reading devices 5710 are not limited to these, and may also include an MO (magnetooptical) disk drive device or a DVD (digital versatile disk), for example.

Figure 61:
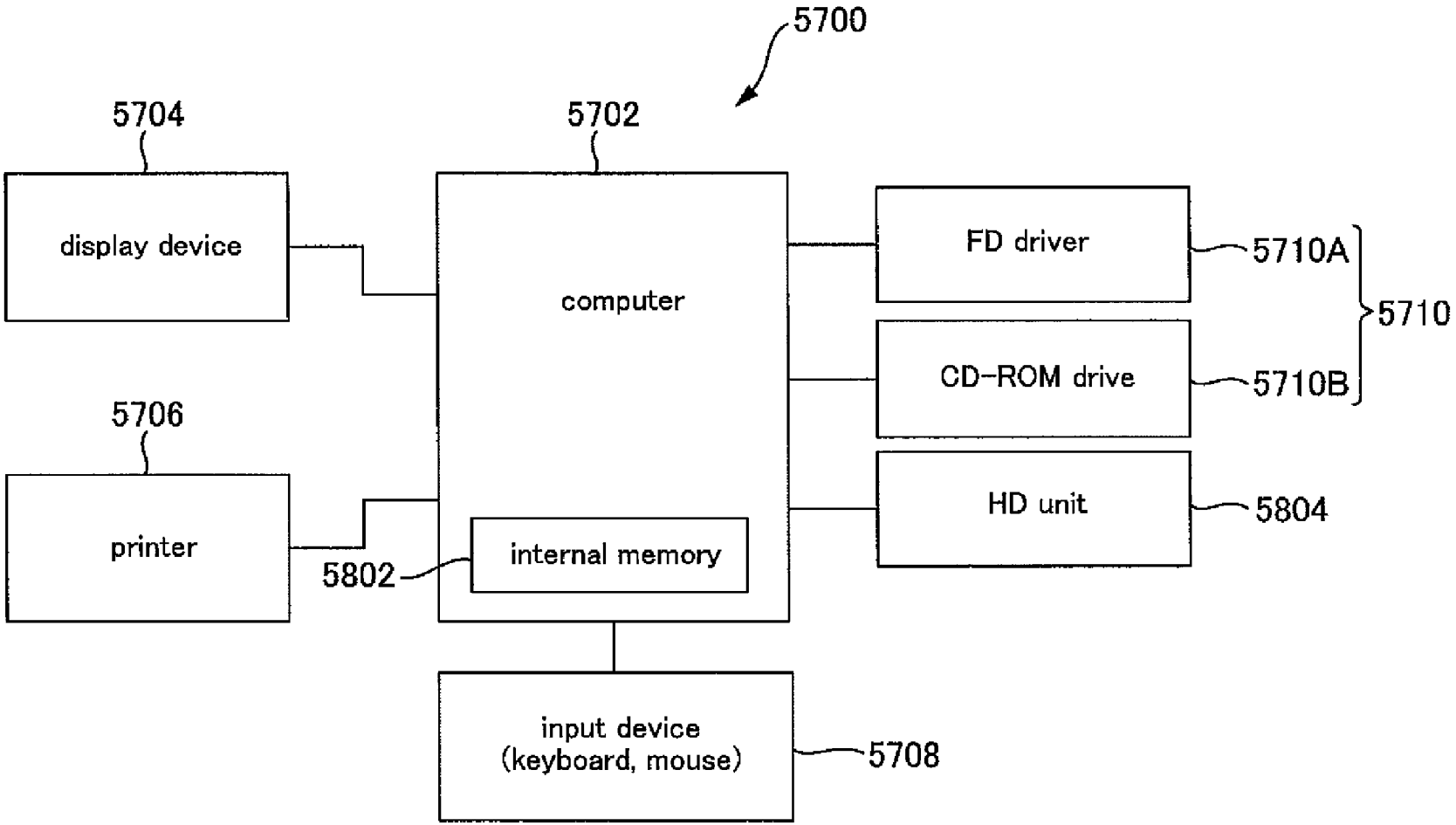
FIG. 61 is a block diagram showing the configuration of the image forming system shown in FIG. 60.

FIG. 61 is a block diagram showing the configuration of the image forming system shown in FIG. 60. An internal memory 5802 such as a RAM is provided within the housing containing the computer 5702, and furthermore an external memory such as a hard disk drive unit 5804 is provided.

In the above explanations, an example was given in which the image forming system is constituted by connecting the printer 5706 to the computer 5702, the display device 5704, the input devices 5708, and the reading devices 5710, but there is no limitation to this. For example, the image forming system may also be made of the computer 5702 and the printer 5706, and the image forming system does not have to be provided with any one of the display device 5704, the input devices 5708, and the reading devices 5710.

It is also possible that the printer 5706 has some of the functions or mechanisms of the computer 5702, the display device 5704, the input devices 5708, and the reading devices 5710. For example, the printer 5706 may be configured so as to have an image processing section for carrying out image processing, a display section for carrying out various types of displays, and a recording media mounting and dismounting section into and from which recording media storing image data captured by a digital camera or the like are inserted and taken out.

As an overall system, the image forming system that is thus achieved is superior to conventional systems.

Overview of Image Forming Apparatus of Seventh Embodiment

Figure 62:
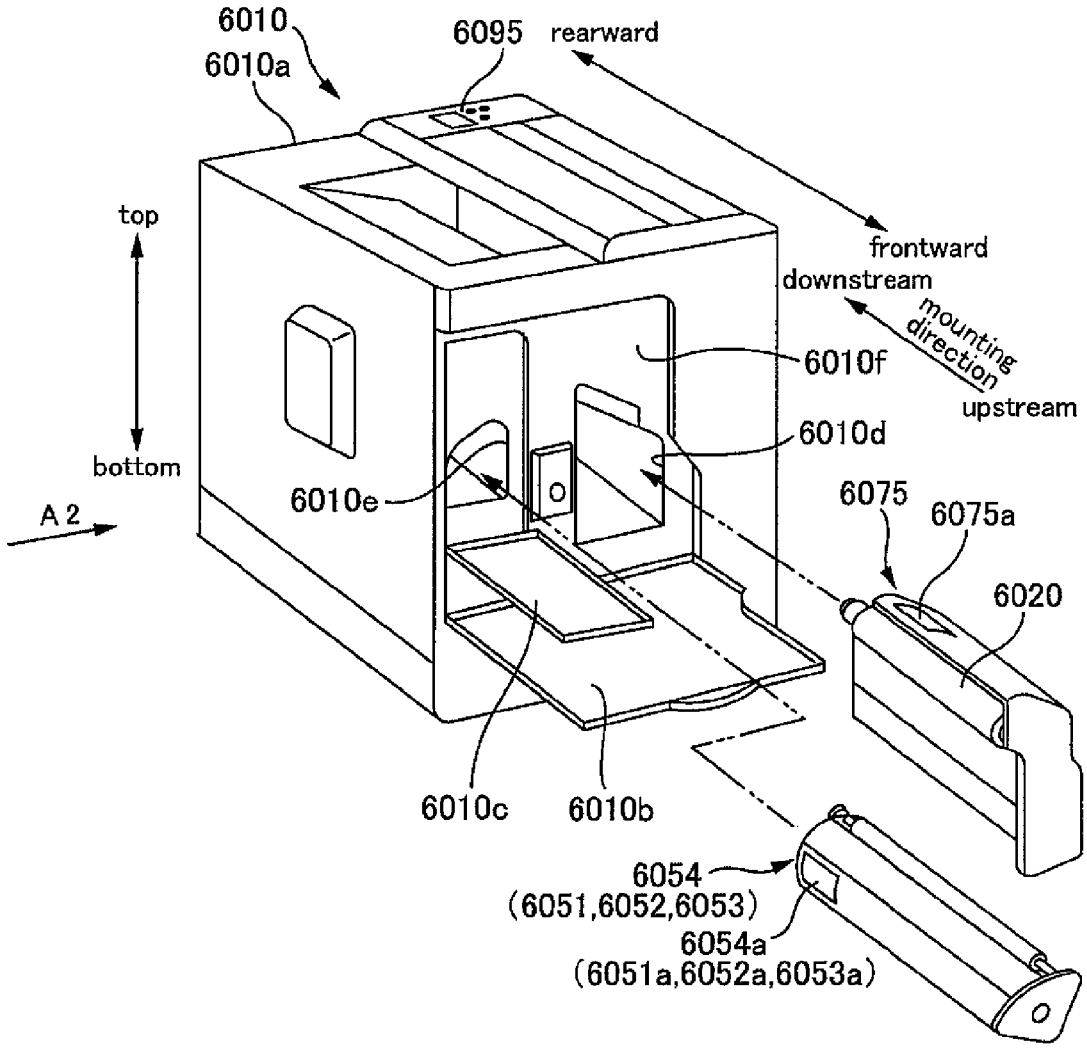
FIG. 62 is a diagram illustrating the configuration of a printer main unit with respect to which developing containers and the like can be mounted and dismounted.
Figure 63:
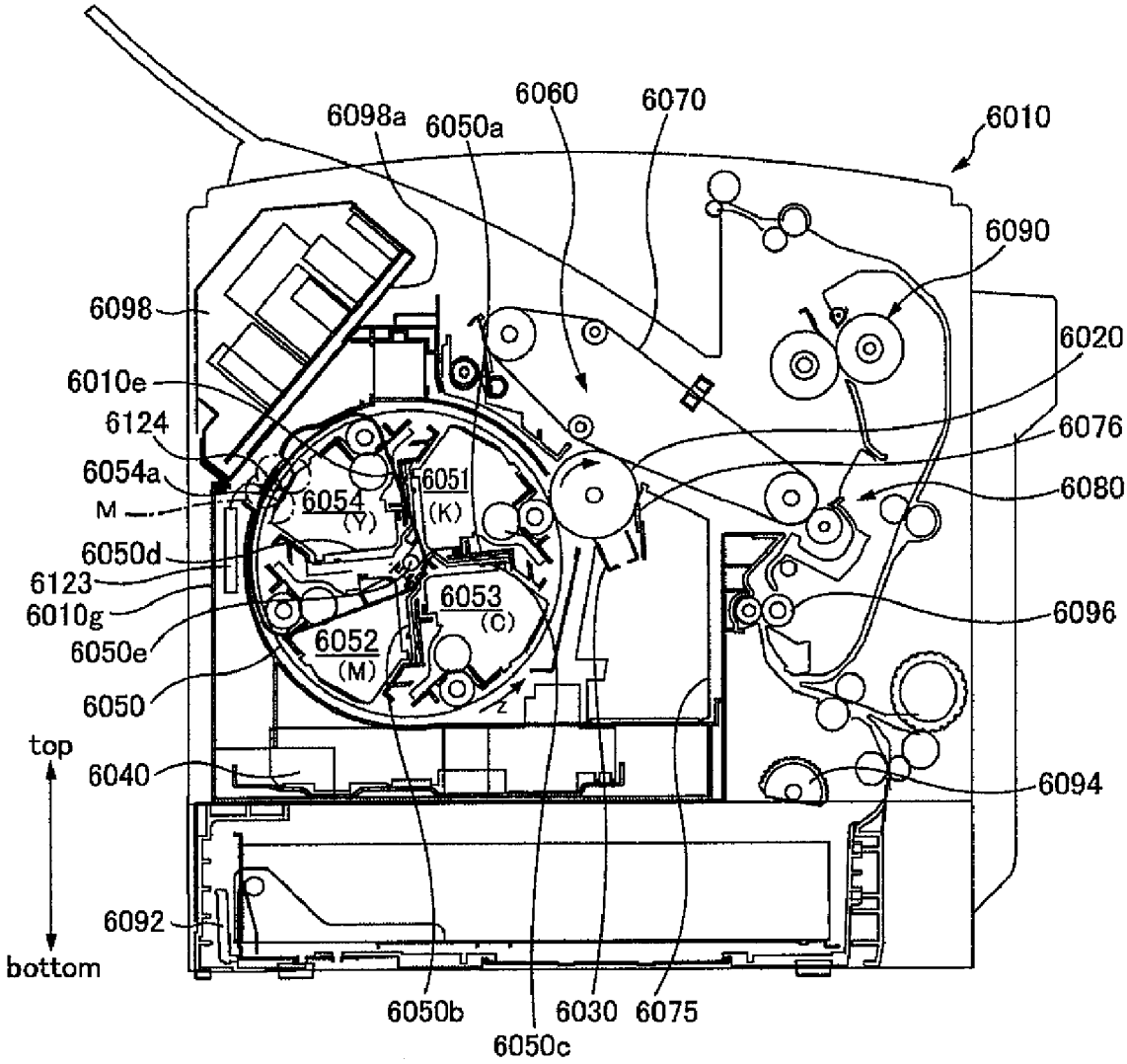
FIG. 63 is a diagram showing the main structural components constituting a printer.
Figure 64:
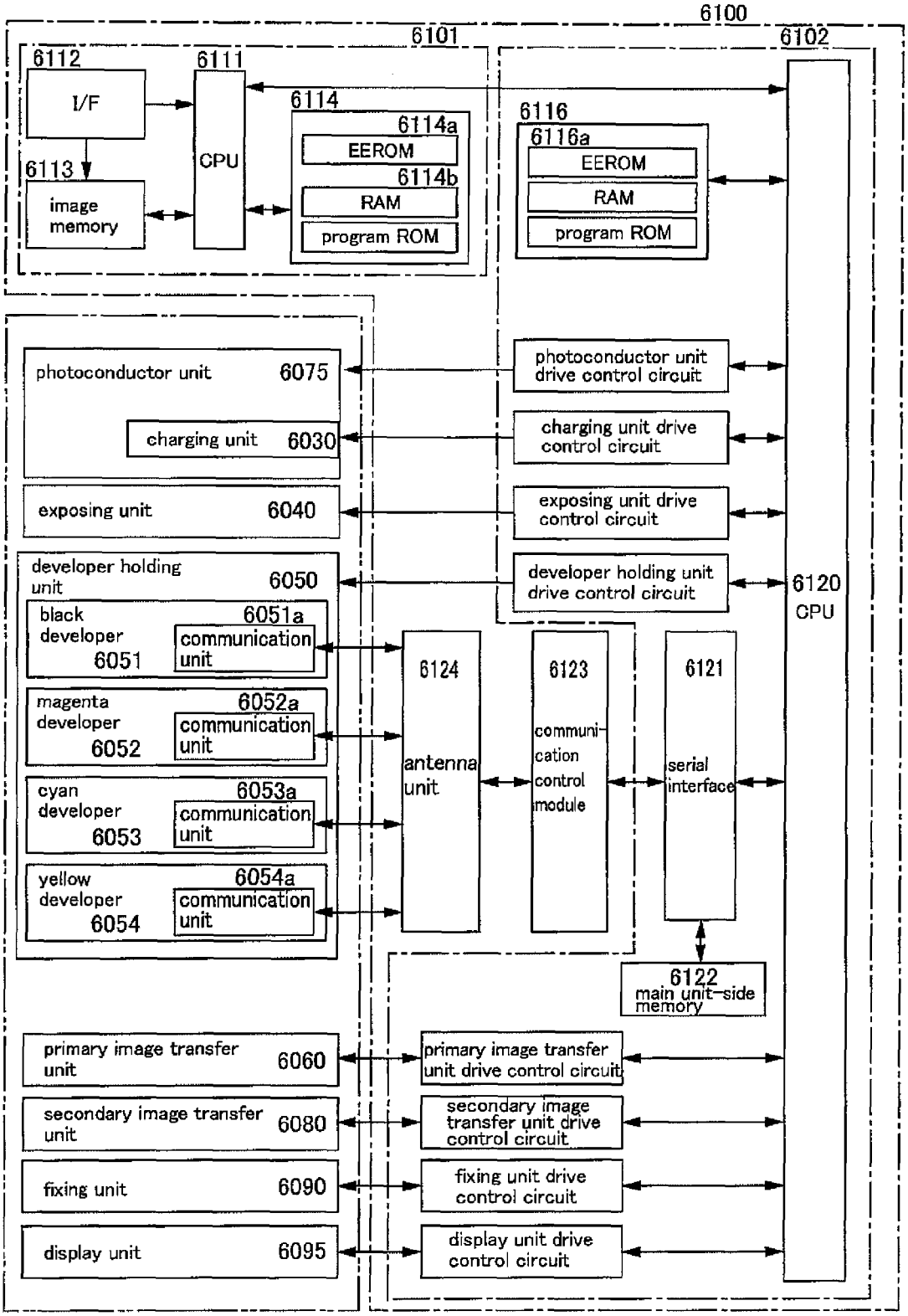
FIG. 64 is a block diagram showing the control unit of the printer.
Figure 65:
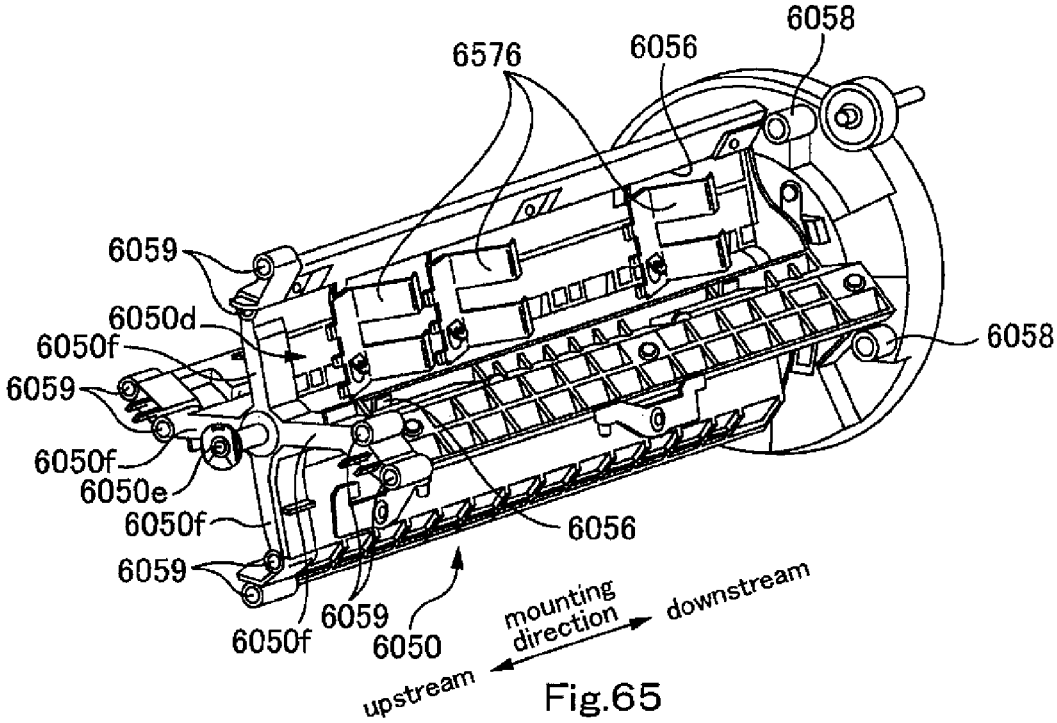
FIG. 65 is a perspective view of a developing container holding unit.
Figure 66:
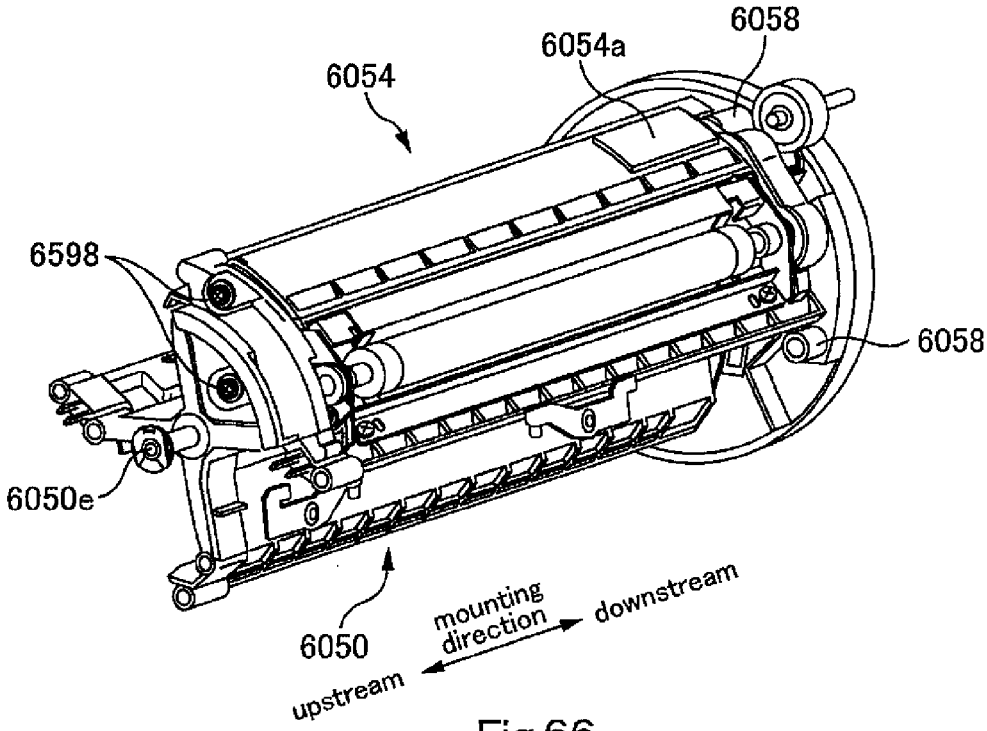
FIG. 66 is a diagram showing the developing container holding unit in a state in which a yellow developing container is mounted to a mounting and dismounting section.
Figure 67:
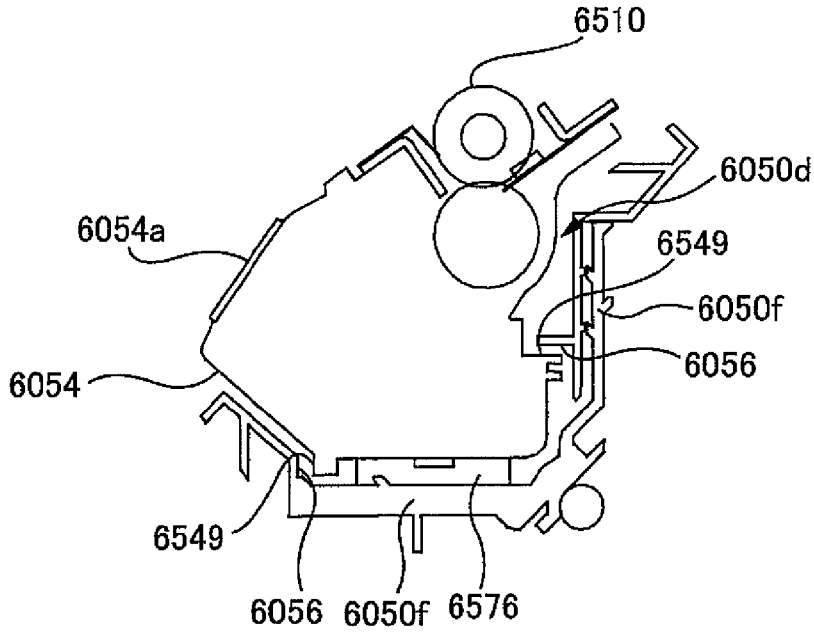
FIG. 67 is a diagram showing the positions of the mounted developing container and the developing container holding unit.

Referring to FIGS. 62 to 67, an overview of a laser beam printer (hereinafter, also referred to as "printer") 6010 serving as an example of an image forming apparatus is described. FIG. 62 is a diagram illustrating the configuration of a printer main unit 6010*a* to which developing containers 6051, 6052, 6053 and 6054 can be mounted and dismounted. FIG. 63 is a diagram showing the main structural components constituting the printer 6010. FIG. 64 is a block diagram showing the control unit 6100 of the printer 6010. FIG. 65 is a perspective view of a developing container holding unit 6050. FIG. 66 is a diagram showing the developing container holding unit 6050 in a state in which a yellow developing container 6054 is mounted to a mounting and dismounting section 6050*d*. FIG. 67 is a diagram showing the positions of the mounted developing container and the developing container holding unit. It should be noted that FIG. 63 is a diagram of a cross section taken perpendicular to the mounting direction of the developing container, for example, in FIG. 62. Also, the vertical direction is indicated by arrows in FIG. 62 and FIG. 63, and for example, a paper supply tray 6092 is disposed at a lower part of the printer 6010 and a fixing unit 6090 is disposed at an upper part of the printer 6010.

<Mounting and Dismounting Configuration>

Developing containers 6051, 6052, 6053, and 6054, which are configured as cartridges and are examples of developing devices, and a photoconductor unit 6075, which is an example of an image bearing member unit, can be mounted and dismounted with respect to the printer main unit 6010*a*, which is an example of an image forming apparatus main unit. The printer 6010 is configured by mounting the developing containers 6051, 6052, 6053, and 6054, and the photoconductor unit 75 to the printer main unit 6010*a*.

The printer main unit 6010*a* has a first opening cover 6010*b* that can be opened and closed, a second opening cover 6010*c* that can be opened and closed and that is provided further inward than the first opening cover 6010*b*, a photoconductor unit mounting and dismounting opening 10*d* through which the photoconductor unit 6075 can be mounted and dismounted, and a developing container mounting and dismounting opening 6010*e* serving as an opening through which the developing containers 6051, 6052, 6053, and 6054 can be mounted and dismounted.

Here, by opening the first opening cover 6010*b*, the user can mount and dismount the photoconductor unit 6075, which is devised as a cartridge, with respect to the printer main unit 6010*a* through the photoconductor unit mounting and dismounting opening 6010*d*. Further, by opening the second opening cover 6010*c*, the user can mount/dismount the developing containers 6051, 6052, 6053, and 6054, which are devised as cartridges, with respect to the printer main unit 6010*a* through the developing container mounting and dismounting opening 6010*e*.

<Configuration of the Printer 6010>

The configuration of the printer 6010 in a state in which the developing containers 6051, 6052, 6053 and 6054 and the photoconductor unit 75 are mounted to the printer main unit 6010*a* is described next.

As shown in FIG. 63, the printer 6010 according to the present embodiment includes a charging unit 6030, an exposing unit 6040, a developing container holding unit 6050, a first image transfer unit 6060, an intermediate image transfer member 6070, and a cleaning blade 6076. These units are arranged along the rotation direction of a photoconductor 6020, which is an example of an image bearing member bearing a latent image. The printer 6010 further includes a second image transfer unit 6080, a fixing unit 6090, a display unit 6095 constituted by a liquid-crystal panel and serving as a means for giving notifications to the user, a control unit 6100 for controlling these units and managing the operations of the printer, and a power source unit 6098 covered by a power source shielding member 6098*a*.

The photoconductor 6020, the charging unit 6030, the exposing unit 6040, the developing container holding unit 6050, the primary image transfer unit 6060, the intermediate image transfer member 6070, the cleaning blade 6076, the secondary image transfer unit 6080, the fixing unit 6090, the control unit 6100, and the power source unit 6098 are disposed at a certain spacing from the upstream side to the downstream side with respect to the mounting direction in a metal frame 6010*f* serving as a casing of the printer 6010. Moreover, between these elements and the frame 6010*f*, a metal stay 6010*g* is disposed on both ends in the direction intersecting with the mounting direction. Furthermore, the printer main unit 6010*a* is provided with mounting shielding members for shielding electromagnetic waves intruding from the outside, and the printer 6010 is covered substantially entirely by these shielding members. That is to say, the frame 6010*f*, which serves as the casing, and also the stay 6010*g* are mounting shielding members having the function of shielding members.

The photoconductor 6020 has a hollow cylindrical conductive base and a photoconductive layer formed on the outer circumferential surface of the conductive base, and is rotatable around its center axis. In the present embodiment, the photoconductor 6020 rotates clockwise, as indicated by the arrow in FIG. 63. The charging unit 6030 is a device for charging the photoconductor 6020. In the printer 6010 of the present embodiment, the photoconductor 6020, the cleaning blade 6076, and the charging unit 6030 are configured as one photoconductor unit 6075 provided with a waster toner container.

The exposing unit 6040 is a device for forming a latent image on the photoconductor 6020, which has been charged by irradiating a laser beam on the photoconductor 6020. The exposing unit 6040 includes, for example, a semiconductor laser, a polygon mirror, and an F-θ lens, and irradiates a modulated laser beam onto the charged photoconductor 6020 in accordance with image signals that have been input from a host computer not shown in the drawings, such as a personal computer or a word processor.

The developing container holding unit 6050 is a device for developing the latent image formed on the photoconductor 6020 using toner T, which is an example of a developer contained in the developing containers 6051, 6052, 6053, and 6054, that is, black (K) toner contained in a black developing container 6051, magenta (M) toner contained in a magenta developing container 6052, cyan (C) toner contained in a cyan developing container 6053, and yellow (Y) toner contained in a yellow developing container 6054.

This developing container holding unit 50 includes a rotation shaft 6050*e* and four mounting and dismounting sections 6050*a*, 6050*b*, 6050*c* and 6050*d* with respect to which the developing containers 6051, 6052, 6053 and 6054 can be mounted and dismounted and which are disposed at intervals of 90° in circumferential direction around the rotation shaft. The mounting and dismounting sections 6050*a*, 6050*b*, 6050*c*, and 6050*d* are moved by rotating the developing container holding unit 6050 around the rotation shaft 6050*e*. Each of the mounting and dismounting sections 6050*a*, 6050*b*, 6050*c*, and 6050*d* is provided with the same space, partitioned by two neighboring wall sections 6050*f* of the four wall sections 6050*f* formed at intervals of 90° in four radial directions from the rotation shaft 6050*e* provided in the middle of the developing container holding unit 6050. That is to say, the mounting and dismounting section 6050*a* with respect to which the black developing container 6051 can be mounted and dismounted, the mounting and dismounting section 6050*b* with respect to which the magenta developing container 6052 can be mounted and dismounted, the mounting and dismounting section 6050*c* with respect to which the cyan developing container 6053 can be mounted and dismounted, and the mounting and dismounting section 6050*d* with respect to which the yellow developing container 6054 can be mounted and dismounted are disposed at intervals of 90° in circumferential direction around the rotation shaft 6050*e* in the developing container holding unit 6050.

It is possible to move the positions of the four developing containers 6051, 6052, 6053, and 6054 that are held by moving the mounting and dismounting sections 6050*a*, 6050*b*, 6050*c*, and 6050*d* through the rotation of the developing container holding unit 6050 around the rotation shaft 6050*e*. That is to say, the four developing containers 6051, 6052, 6053, and 6054 can be rotated around the rotation shaft 6050*e* while maintaining their relative positions. Then, when the developing containers 6051, 6052, 6053, and 6054 are mounted to the mounting and dismounting sections 6050*a*, 6050*b*, 6050*c*, and 6050*d* and are moved to the developing position through the movement of the mounting and dismounting sections 6050*a*, 6050*b*, 6050*c*, and 6050*d*, the latent image carried by the photoconductor 6020 is developed with the toner contained in the respective developing containers 6051, 6052, 6053, and 6054. It should be noted that details of the developing containers are discussed later.

As shown in FIG. 65, the mounting and dismounting sections 6050*a*, 6050*b*, 6050*c*, and 6050*d* are each provided with coupling holes 6059 into which coupling protrusions provided on a coupling member 6590 (see FIG. 68) of the developing containers can be fitted, guiding sections 6056 for guiding the developing container into the mounting position by engaging with a guided section 6549 provided on the developing container that is inserted from the developing container mounting and dismounting opening 6010*e*, and springs 6576 for urging the developing containers toward the outer circumferential direction of the developing container holding unit 6050. For example, coupling pins 6595*a* and 6595*b* (see FIG. 72), which are examples of coupling protrusions provided on the coupling member 6590 of the yellow developing container 6054, as shown in FIG. 66, are fitted into the coupling holes 6059 with which the mounting and dismounting section 6050*d* is provided.

And as shown in FIG. 67, the guiding sections 6056 are provided on each of two wall sections 6050*f* constituting the mounting and dismounting section. The guiding sections 6056 have perpendicular surfaces formed on the respective wall sections 6050*f* and are arranged extending along the longitudinal direction of the yellow developing container 6054, protruding on the side of the same space partitioned by two adjacent wall sections 6050*f*. That is to say, the guiding sections 6056, which are provided on adjacent wall sections 6050*f* facing toward the same space, are formed such that their surfaces both face toward the rotation shaft 6050*e* and their surfaces define an angle of substantially 90°. The yellow developing container 6054 is mounted by arranging the guided sections 6549 of the yellow developing container 6054 such that they are on the side of the rotation shaft 6050*e* with respect to the two perpendicular surfaces of the guiding sections 6056, and inserting the guided sections 6549 along the guiding sections 6056.

Moreover, as shown in FIG. 66 and FIG. 67, the mounting and dismounting sections 6050*a*, 6050*b*, 6050*c*, and 6050*d* are provided with springs 6576. For example, the springs 6576 provided on the mounting and dismounting section 6050*d* urge the yellow developing container 6054 toward the outer circumferential direction of the developing container holding unit 6050. Thus, when the yellow developing container 6054 is inserted from the developing container mounting and dismounting opening 6010*e* with the guided sections 6549 being arranged on the side of the rotation shaft 6050*e* with respect to the perpendicular surfaces of the guiding sections 6056, the yellow developing container 6054 is urged by the springs 6576 toward the outer circumferential direction. Moreover, as shown in FIG. 65, the mounting and dismounting sections 6050*a*, 6050*b*, 6050*c*, and 6050*d* are each provided with a positioning hole 6058 into which a positioning pin 6588 (see FIG. 68) of the respective developing container can be fitted. That is to say, by fitting the positioning pin 6588 provided on the yellow developing container 6054 into the positioning hole 6058 provided in the mounting and dismounting section 6050*d*, the yellow developing container 6054 is mounted by positioning it in a predetermined position.

The primary image transfer unit 6060 is a device for transferring a single color toner image formed on the photoconductor 6020 to the intermediate image transfer member 6070. When the four toner colors are successively transferred over one another, a full color toner image is formed on the intermediate image transfer member 6070. This intermediate image transfer member 6070 is an endless belt that is rotatively driven at substantially the same circumferential velocity as the photoconductor 6020.

The secondary image transfer unit 6080 is a device for transferring a single color toner image or a full color toner image formed on the intermediate image transfer member 6070 to a recording medium such as paper, film, or cloth. The fixing unit 6090 is a device for fusing the single color toner image or the full color toner image that has been transferred to the recording medium on the recording medium, such as paper, making it a permanent image.

The cleaning blade 6076 is made of rubber and is in contact with the surface of the photoconductor 6020. The cleaning blade 6076 scrapes off and removes toner remaining on the photoconductor 6020, after the toner image has been transferred to the intermediate image transfer body 6070 by the primary image transfer unit 6060.

The photoconductor unit 6075 is provided between the primary image transfer unit 6060 and the exposing unit 6040, and includes the photoconductor 6020, the charging unit 6030, the cleaning blade 6076, and a waste toner container not shown in the drawings containing toner that has been scraped away by the cleaning blade 6076.

The control unit 6100 is made of a main controller 6101 and a unit controller 6102, as shown in FIG. 64. An image signal is input into the main controller 6101, and in accordance with a command based on this image signal, the unit controller 6102 controls the various units, for example, to form the image.

<Operation of the Printer 6010>

The operation of the printer 6010 configured as above is described below, referring to other structural components thereof as well.

First, when an image signal from a host computer not shown in the drawings is input into the main controller 6101 of the printer 6010 via an interface (I/F) 6112, the photoconductor 6020, developing rollers 6510 provided in the developing containers 6051, 6052, 6053, and 6054, and the intermediate image transfer member 6070 are rotated under the control of the unit controller 6102 based on a command from the main controller 6101. While rotating, the photoconductor 6020 is successively charged by the charging unit 6030 at a charging position.

The region of the photoconductor 6020 that has been charged is brought to an exposure position through rotation of the photoconductor 6020, and a latent image corresponding to image information of a first color, for example yellow Y, is formed at that region by the exposing unit 6040. Moreover, the developing container holding unit 6050 positions the yellow developing container 6054 containing the yellow (Y) toner at the developing position opposite the photoconductor 6020.

The latent image formed on the photoconductor 6020 is brought to a developing position through the rotation of the photoconductor 6020, and is developed with yellow toner by the yellow developing container 6054. Thus, a yellow toner image is formed on the photoconductor 6020.

The yellow toner image that is formed on the photoconductor 6020 is brought to the primary image transfer position through rotation of the photoconductor 6020 and is transferred to the intermediate image transfer member 6070 by the primary image transfer unit 6060. At this time, a primary image transfer voltage of a polarity that is opposite the toner charge polarity is applied to the primary image transfer unit 6060. It should be noted that throughout this operation, the secondary image transfer unit 6080 is removed from the intermediate image transfer member 6070.

The above process is repeated for a second color, a third color, and a fourth color, thereby transferring toner images of four colors corresponding to various image signals layered over one another onto the intermediate image transfer unit 6070. Thus, a full color toner image is formed on the intermediate image transfer member 6070.

The full color toner image that is formed on the intermediate image transfer member 6070 is brought to the secondary image transfer position through the rotation of the intermediate image transfer member 6070 and is transferred to a recording medium by the secondary image transfer unit 6080. It should be noted that the recording medium is carried from the paper supply tray 6092 to the secondary image transfer unit 6080 via a paper supply roller 6094 and registration rollers 6096. Also, when performing the image transfer operation, the secondary image transfer unit 6080 is pressed against the intermediate image transfer member 6070 while applying a secondary image transfer voltage to it.

The fixing unit 6090 heats and applies pressure to the full color toner image that has been transferred to the recording medium, thus fusing it to the recording medium. On the other hand, after the photoconductor 6020 has passed the primary image transfer position, the toner adhering to its surface is scraped off by the cleaning blade 6076 and it is provided with a charge for forming the next latent image. The toner that is scraped off is collected in the waste toner container.

===Overview of the Control Unit===

The configuration of the control unit 6100 is described next, with reference to FIG. 64. The control unit 6100 includes the main controller 6101 and the unit controller 6102.

The main controller 6101 includes a CPU 6111, an interface 6112 for connection to a computer not shown in the drawings, an image memory 6113 for storing image signals input from the computer, a main controller-side memory 6114 made of an EEPROM 6114*a* that can be rewritten electrically, a RAM 6114*b*, and a program ROM or the like in which a program for the various kinds of control is stored.

The CPU 6111 of the main controller 6101 controls the reading in and the reading out of image data that has been input via the interface into the image memory 6113, and performs the control of the overall apparatus in synchronization with the CPU 6120 of the unit controller 6102 based on the control signals input from the computer.

The unit controller 6102 includes the CPU 6120, a unit controller-side memory 6116 including an EEPROM 6116*a* that can be rewritten electrically, a RAM and a program ROM or the like in which a program for the various kinds of control is stored, as well as drive control circuits or the like for performing drive control of the various units of the entire device (the charging unit 6030, the exposing unit 6040, the developing container holding unit 6050, the primary image transfer unit 6060, the photoconductor unit 6075, the secondary image transfer unit 6080, the fixing unit 6090, and the display unit 6095).

The CPU 6120 of the unit controller 6102 is electrically connected to the various drive control circuits and controls the various drive control circuits in accordance with control signals from the CPU 6111 of the main controller 6101. That is to say, while the state of the units is detected by receiving signals from sensors or the like provided in each of the units, the units are controlled in accordance with signals input from the main controller 6101.

Also, the CPU 6120 provided in the unit controller 6102 is connected to a non-volatile storage element (hereinafter, also referred to as "main unit-side memory") 6122 such as a serial EEPROM via the serial interface (I/F) 6121. This main unit-side memory 6122 stores data that is necessary for the control of the apparatus.

Furthermore, the CPU 6120 is capable of wirelessly communicating with communication units 6051*a*, 6052*a*, 6053*a*, and 6054*a*, which serve as element units and are respectively provided in the developing containers 6051, 6052, 6053, and 6054, via the serial interface 6121, a communication control module 6123, and an antenna unit 6124 serving as an apparatus-side antenna. Through the communication of the antenna unit 124 and the communication units 6051*a*, 6052*a*, 6053*a*, and 6054*a*, the control unit 6100 can write information into the communication units 6051*a*, 6052*a*, 6053*a*, and 6054*a* provided in the developing containers 6051, 6052, 6053, and 6054 as well as read in information from the communication units 6051*a*, 6052*a*, 6053*a*, and 6054*a* provided in the developing containers 6051, 6052, 6053, and 6054. The communication units 6051*a*, 6052*a*, 6053*a*, and 6054*a* are explained further below.

===Overview of the Developing Containers===

Figure 68:
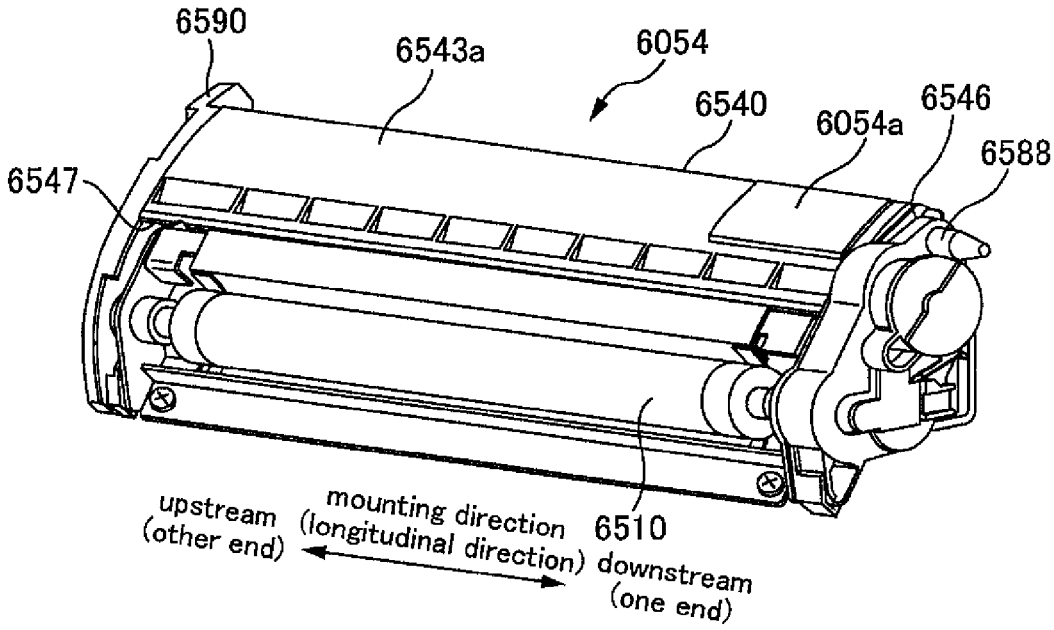
FIG. 68 is a perspective view of the yellow developing container.
Figure 69:
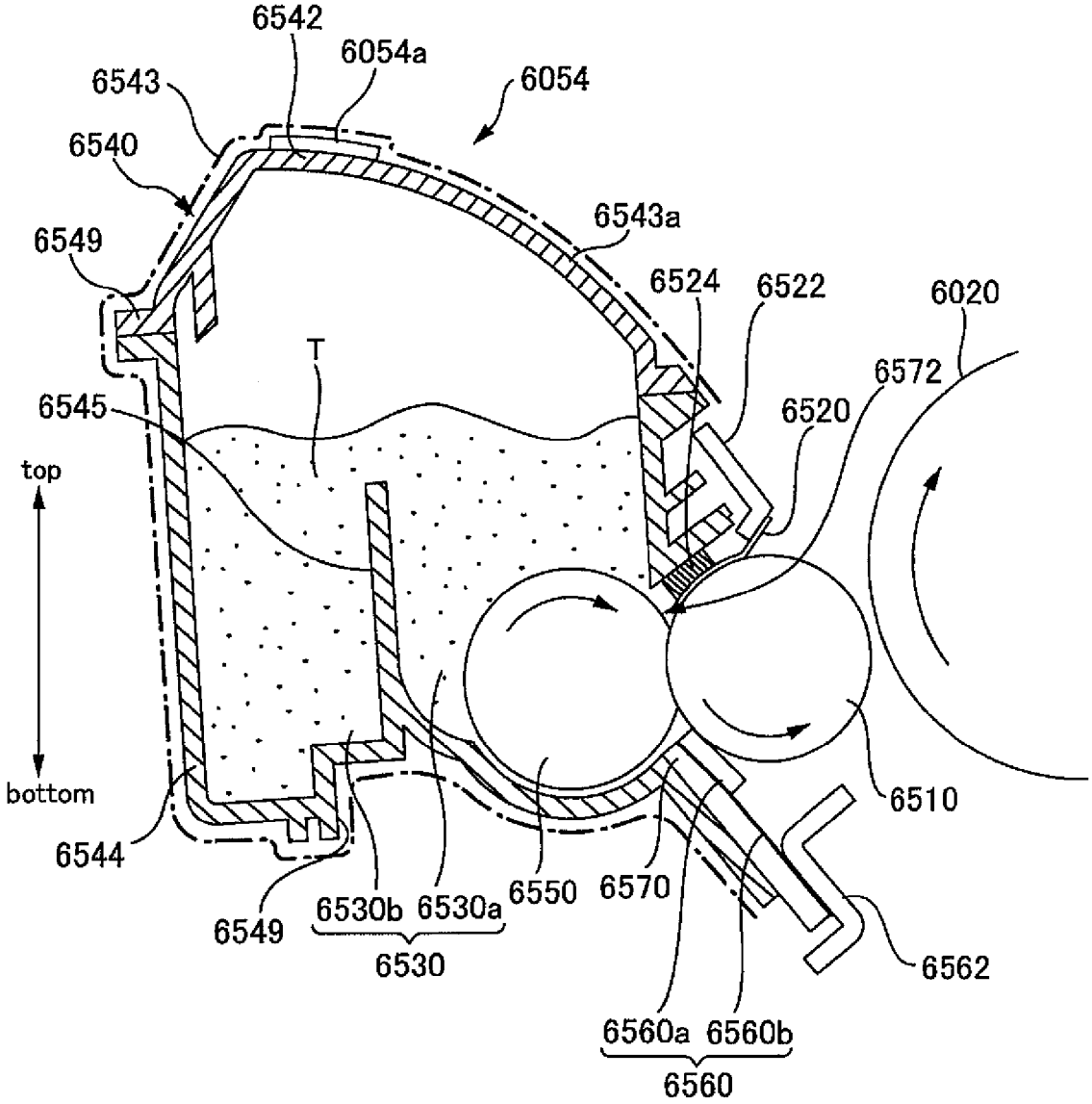
FIG. 69 is a cross-sectional view showing main structural components of the yellow developing container.
Figure 70:
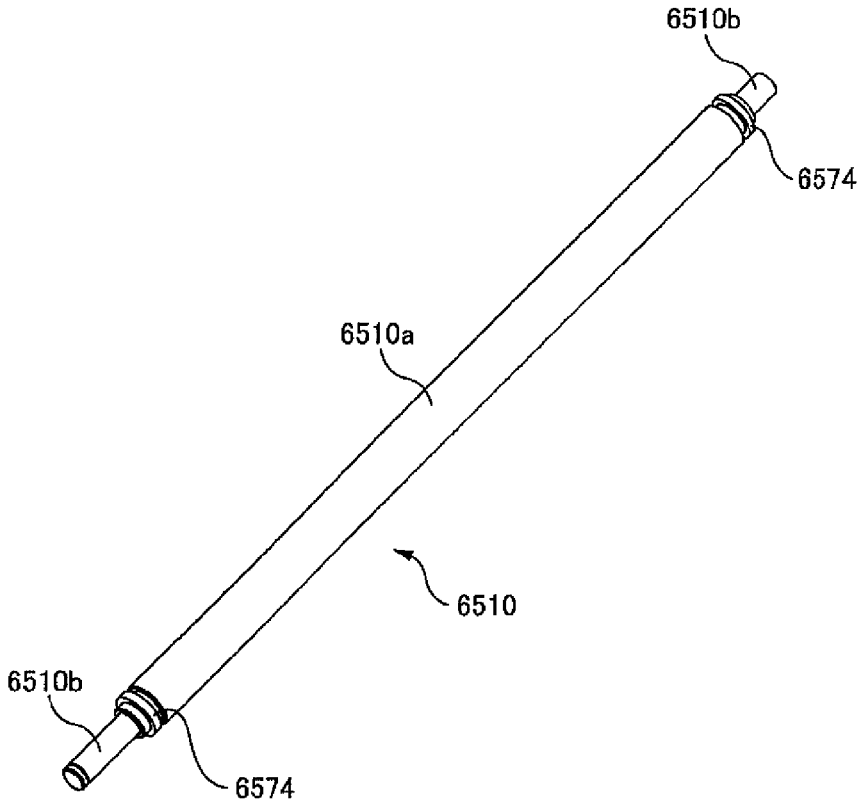
FIG. 70 is a perspective view of a developing roller provided with rolls.
Figure 71:
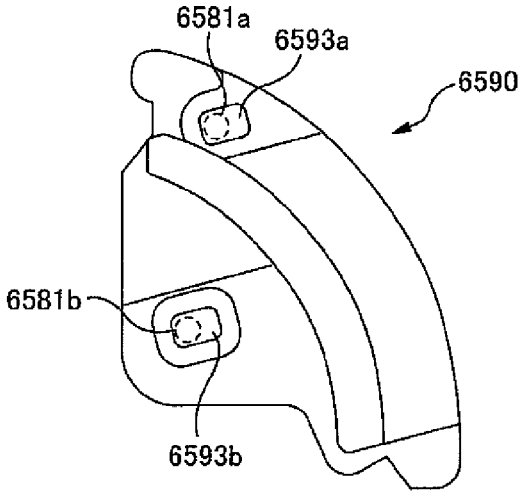
FIG. 71 is a front view of a coupling member.
Figure 72:
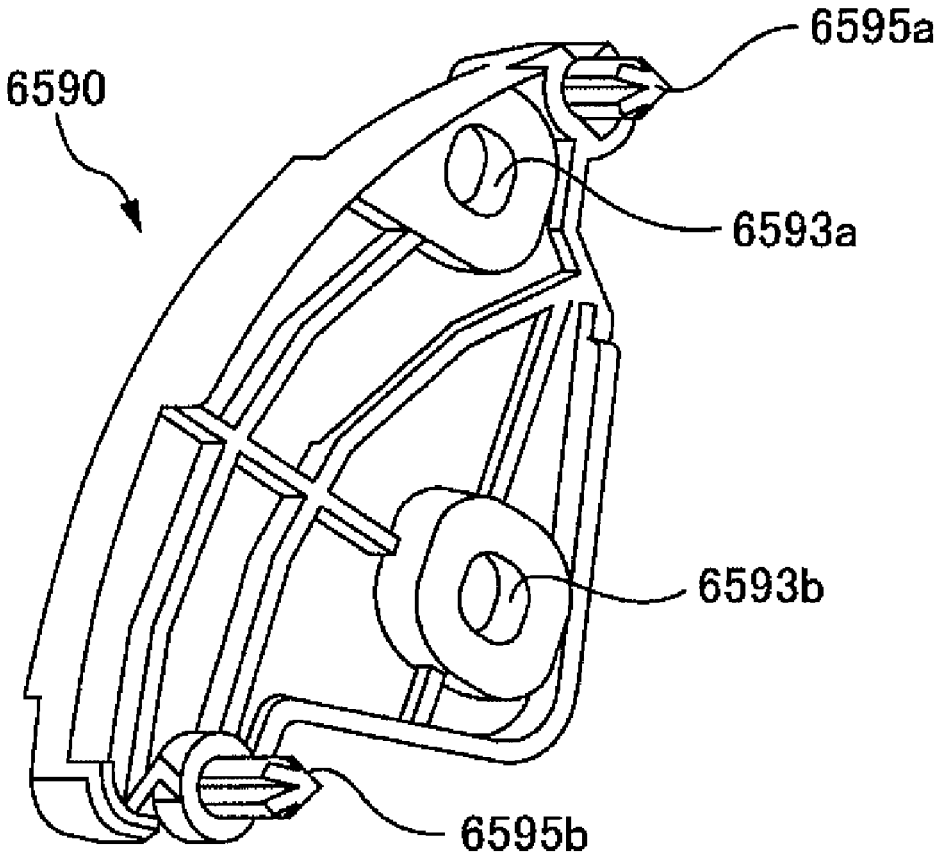
FIG. 72 is a perspective view showing the rear side of the coupling member.

The configuration and operation of the developing containers 6051, 6052, 6053, and 6054 is explained next, using FIG. 68 to FIG. 72. FIG. 68 is a perspective view of the yellow developing container 6054. FIG. 69 is a cross-sectional view showing the main structural components of the yellow developing container 6054. FIG. 70 is a perspective view of a developing roller 6510 provided with rolls 6574. FIG. 71 is a front view of the coupling member 6590. FIG. 72 is a perspective view showing the rear side of the coupling member 6590. It should be noted that the cross-sectional view in FIG. 69 shows a cross section of the yellow developing container

6054 taken along a plane that is perpendicular to the longitudinal direction shown in FIG. 68. Moreover, in FIG. 69, like in FIG. 62, the vertical direction is indicated by arrows, and for example, the center axis of the developing roller 6510 is lower than the center axis of the photoconductor 6020. Also, in FIG. 69, the yellow developing container 6054 is shown positioned at a developing position that is in opposition to the photoconductor 6020.

The black developing container 6051 containing black (K) toner, the magenta developing container 6052 containing magenta (M) toner, the cyan developing container 6053 containing cyan (C) toner, and the yellow developing container 6054 containing yellow (Y) toner can be mounted to the developing container holding unit 6050, but since the configuration and the operation of each of the developing containers is the same, explanations are given only for the yellow developing container 6054 in the following.

<Internal Configuration of the Yellow Developing Container 6054>

First, the configuration of the yellow developing container 6054 is described. The yellow developing container 6054 includes the developing roller 6510, which is an example of a developer-carrying member, a toner containing section 6530, a housing 6540 containing toner T, a toner supply roller 6550, a regulating blade 6560, a sealing member 6520, a positioning shaft (also referred to as "positioning pin" in this embodiment) 6588, which is an example of a positioning member (positioning section), and a coupling member 6590.

The developing roller 6510 bears toner T and carries it to the developing position opposite the photoconductor 6020, and develops the latent image carried by the photoconductor 6020 with the toner T carried to the developing position. This developing roller 6510, which is made of metal, is fabricated from an aluminum alloy, such as 5056 aluminum alloy or 6063 aluminum alloy, or an iron alloy such as STKM, and may be nickel-plated or chromium-plated if necessary. As shown in FIG. 70, the developing roller 6510 includes a large-diameter section 6510*a* and axle sections 6510*b*.

Moreover, as shown in FIG. 68, the developing roller 6510 is supported by the housing 6540 at its two ends in longitudinal direction, that is, at the axle sections 6510*b*, and can be rotated around its center axis. As shown in FIG. 69, the developing roller 6510 rotates in a direction (the counterclockwise direction in FIG. 69) that is opposite to the rotation direction of the photoconductor 6020 (the clockwise direction in FIG. 69). Its center axis is lower than the center axis of the photoconductor 6020.

Also, as shown in FIG. 69, in a state where the yellow developing container 6054 is in opposition to the photoconductor 6020, there is a gap between the developing roller 6510 and the photoconductor 6020. That is to say, the yellow developing container 6054 develops the latent image formed on the photoconductor 6020 in a noncontacting manner. It should be noted that during the development of the latent image formed on the photoconductor 6020, an alternating electric field is formed between the developing roller 6510 and the photoconductor 6020.

Furthermore, as shown in FIG. 70, rolls 6574, which are an example of distance holding members, are formed on both ends in longitudinal direction of the developing roller 6510. When the developing containers 6051, 6052, 6053 and 6054 are positioned in the developing position, these rolls 6574 have the function of coming into contact with the photoconductor 6020 and thereby holding a constant distance between the photoconductor 6020 and the developing roller 6510. The rolls 6574 are slid rotatably onto the axle sections 6510*b*. The outer diameter of the rolls 6574 is larger than the outer diameter of the large-diameter section 6510*a*. Therefore, it is possible to hold a constant distance between the developing roller 6510 and the photoconductor 6020 by rotating the rolls 6574 while they contact the photoconductor 6020.

The sealing member 6520 prevents the toner T in the yellow developing container 6054 from leaking to the outside, and also collects toner T on the developing roller 6510, after it has passed the developing position, into the developing device without scraping it off. This sealing member 6520 is a seal made of polyethylene film or the like. The sealing member 6520 is supported by a seal support metal plate 6522, and is attached to the housing 6540 via the seal support metal plate 6522. Furthermore, a seal biasing member 6520 made of Moltopren or the like is provided on the side of the sealing member 6524 that is opposite to its developing roller 6510 side, and due to the elasticity of the seal biasing member 6524, the sealing member 6520 is pressed against the developing roller 6510. It should be noted that the contact position where the sealing member 6520 contacts the developing roller 6510 is above the center axis of the developing roller 6510.

The housing 6540 is fabricated by welding together a plurality of integrally molded housing sections, namely an upper housing section 6542 and a lower housing section 6544. A partitioning wall 6545 for partitioning the inside of the housing, which protrudes from the inner wall to the inside (vertically in FIG. 69), partitions the inside of the housing 6540 into two toner containing sections 6530, namely a first toner containing section 6530*a* and a second toner containing section 6530*b*. It should be noted that the housing 6540 has a housing opening 6572 at its bottom, and the developing roller 6510 is arranged such that a portion of it is exposed in this housing opening 6572. Moreover, a communication unit 6054*a* is attached to the housing 6540. The configuration of this communication unit 6054*a* and the position at which it is attached to the housing 6540 are explained later.

A second side wall 6547, which is arranged on the frontward side of the printer main unit 6010*a* in the longitudinal direction of the housing 6540, is provided with attachment protrusions 6581*a* and 6581*b* (see FIG. 71). The attachment protrusion 6581*a* can be fitted into an attachment hole 6593*a* of the later-explained coupling member 6590, and the attachment protrusion 6581*b* can be fitted into an attachment hole 6593*b* of the coupling member 6590. The attachment protrusions 6581*a* and 6581*b* have a circular cross section.

Moreover, the toner containing section 6530 may be provided with a stirring member for stirring the toner T, but in the present embodiment, the developing containers (the black developing container 6051, the magenta developing container 6052, the cyan developing container 6053 and the yellow developing container 6054) rotate with the rotation of the developing container holding unit 6050, and this stirs the toner T inside the developing containers, so that the toner containing section 6530 is not provided with a stirring member.

The toner supply roller 6550 is provided in the above-mentioned first toner containing section 6530*a* and not only supplies toner T that is contained in this first toner containing section 6530*a* to the developing roller 6510, but also scrapes off, from the developing roller 6510, toner T that has remained on the developing roller 6510 after developing. The toner supply roller 6550 is made of polyurethane foam, for example, and is in contact with the developing roller 6510 in a state of elastic deformation. The toner supply roller 6550 is disposed at the bottom of the toner containing section 6530, and the toner T contained in the toner containing section 6530 is supplied to the developing roller 6510 by this toner supply roller 6550 at the bottom of the toner containing section 6530. The toner supply roller 6550 rotates in a direction (the clockwise direction in FIG. 69) that is opposite the rotation direction of the developing roller 6510 (the counterclockwise direction in FIG. 69). Its center axis is lower than the rotation center axis of the developing roller 6510.

The regulating blade 6560 applies a charge to the toner T borne on the developing roller 6510 and regulates the layer thickness of the toner T borne on the developing roller 6510. The regulating blade 6560 includes a rubber part 6560*a* and a rubber supporting part 6560*b*. The rubber part 6560*a* is made of silicone rubber or urethane rubber, for example, and the rubber supporting part 6560*b* is a thin plate of phosphor bronze or stainless steel, for example, and has elasticity. The rubber part 6560*a* is supported by the rubber supporting part 6560*b*, and the rubber supporting part 6560*b* is attached to the housing 6540 via a blade support metal plate 6562, with one end of the rubber supporting part 6560*b* being supported by the blade support metal plate 6562. Also, a blade backing member 6570 made of Moltopren or the like is provided on the side of the regulating blade 6560 that is opposite the side of the developing roller 6510.

Here, the rubber part 6560*a* is pressed against the developing roller 6510 by the elastic force due to the bending of the rubber supporting part 6560*b*. The blade backing member 6570 prevents the toner T from entering in between the rubber supporting part 6560*b* and the housing 6540, and stabilizes the elasticity due to the bending of the rubber supporting part 6560*b* while pressing the rubber part 6560*a* against the developing roller 6510 by urging the rubber part 6560*a* toward the developing roller 6510 from directly behind the rubber part 6560*a*. Consequently, the blade backing member 6570 makes the contact of the rubber part 6560*a* with the developing roller 6510 more uniform.

The end of the regulating blade 6560 on the side opposite the side supported by the blade support metal plate 6562, that is, its front end, is not in contact with the developing roller 6510, and a portion thereof removed from this front end by a predetermined distance is in contact with the developing roller 6510 over a certain width. That is to say, the regulating blade 6560 does not contact against the developing roller 6510 at its edge but rather at a mid section thereof. Also, the regulating blade 6560 is disposed such that its front end is facing upstream with respect to the direction in which the developing roller 6510 rotates, and is in so-called counter contact. It should be noted that the contact position where the regulating blade 6560 contacts the developing roller 6510 is below the center axis of the developing roller 6510 and is below the center axis of the toner supply roller 6550.

<Configuration of the Positioning Member (Section)>

The following is a description of the configuration of the positioning pin 6588. As shown in FIG. 68, the positioning pin 6588 is provided on one end in longitudinal direction of the yellow developing container main unit, which is an example of a developing device main unit, that is, on the downstream side with respect to the direction in which the developing container is mounted.

This positioning pin 6588 has the function of positioning the yellow developing container main unit with respect to the mounting and dismounting section 6050*d* by engaging the mounting and dismounting section 6050*d*, or more specifically by fitting into the positioning hole 6058 provided on the mounting and dismounting section 6050*d*, as shown in FIG. 66, when the yellow developing container 6054 is mounted to the mounting and dismounting section 6050*d*.

Moreover, the positioning pin 6588, which is made of metal, is arranged such that its axial direction extends in the longitudinal direction of the developing container main unit. One end of the positioning pin 6588 is fixed to a first side wall 6546 of the housing 6540, on the downstream side with respect to the mounting direction. The front end of the positioning pin 6588 is tapered, so that it can be easily fitted into the positioning hole 6058 of the mounting and dismounting section 6050*d*.

<Configuration of the Coupling Member>

The configuration of the coupling member 6590 is described next. As shown in FIG. 68, the coupling member 6590 is attached to the upstream side, with respect to the mounting direction, of the yellow developing container main unit.

As shown in FIG. 72, the coupling member 6590 is provided with coupling pins 6595*a* and 6595*b*, which are an example of coupling protrusions that can be fitted into the coupling holes 6059 of the mounting and dismounting section 6050*d*. When the yellow developing container 6054 is mounted to the mounting and dismounting section 6050*d*, the coupling pins 6595*a* and 6595*b* are fitted into the coupling holes 6059 provided in the mounting and dismounting section 6050*d*. Thus, when the yellow developing container 6054 is mounted to the mounting and dismounting section 6050*d*, the coupling member 6590 is coupled to the mounting and dismounting section 6050*d*. It should be noted that when the coupling member 6590 is coupled to the mounting and dismounting section 6050*d*, the movement of the coupling member 6590 with respect to the mounting and dismounting section 6050*d* is restricted.

Furthermore, as shown in FIG. 71, the coupling member 6590 includes an attachment hole 6593*a* into which the attachment protrusion 6581*a* provided on the second side wall 6547 on the other end in longitudinal direction of the housing 6540, that is, the upstream side with respect to the mounting direction of the developing container, can be fitted, and an attachment hole 6593*b* into which the attachment protrusion 6581*b* can be fitted. When the attachment protrusion 6581*a* is fitted into the attachment hole 6593*a* and the attachment protrusion 6581*b* is fitted into the attachment hole 6593*b*, the coupling member 6590 is attached to the side wall on the upstream side in the mounting direction of the housing 6540, that is, of the developing container, by screwing on screws 6598 via the coupling member 6590 with respect to screw holes provided in the attachment protrusion 6581*a* and the attachment protrusion 6581*b*, as shown in FIG. 66.

Moreover, as shown in FIG. 71, the attachment hole 6593*a* and the attachment hole 6593*b* have a substantially elliptical cross section. The attachment hole 6593*a* and the attachment hole 6593*b* are provided such that the directions of the major axes of the substantially elliptical cross sections are the same direction. Moreover, as noted above, the cross section of the attachment protrusion 6581*a* is circular. Consequently, the attachment hole 6593*a* allows movement of the attachment protrusion 6581*a*, which is fitted into the attachment hole 6593*a*, within the attachment hole 6593*a*. Similarly, the attachment hole 6593*b* allows movement of the attachment protrusion 6581*b*, which is fitted into the attachment hole 6593*b*, within the attachment hole 6593*b*.

That is to say, the attachment hole 6593*a* allows movement of the attachment protrusion 6581*a* within the attachment hole 6593*a* in the direction of the major axis of its substantially elliptical cross section, and the attachment hole 6593*b* allows movement of the attachment protrusion 6581*b* within the attachment hole 6593*b* in the direction of the major axis of its elliptical cross section. It should be noted that the movement of the attachment protrusion 6581*a* within the attachment hole 6593*a* and the movement of the attachment protrusion 6581*b* within the attachment hole 6593*b* occur at the same timing. Thus, the coupling member 6590 is attached in such a manner that its relative position to the developing container main unit can be changed.

<Operation of the Yellow Developing Container 6054>

Next, the operation of the yellow developing container 6054 is described. In the yellow developing container 6054 configured in this manner, the toner T that is contained in the toner containing section 6530 is supplied to the developing roller 6510 by rotating the toner supply roller 6550.

As the developing roller 6510 rotates, the toner T that is supplied to the developing roller 6510 is brought to the contact position of the regulating blade 6560, and when it passes that contact position, the layer thickness of the toner T is regulated, and a charge is applied to it. The toner T on the developing roller 6510, whose layer thickness has been regulated and which has been charged, is brought to the developing position in opposition to the photoconductor 6020 by further rotation of the developing roller 6510, and is supplied for the development of the latent image formed on the photoconductor 6020 in an alternating electric field at the developing position.

The toner T on the developing roller 6510 that has passed the developing position due to further rotation of the developing roller 6510 passes the upper sealing member 6520 and is collected in the developing device without being scraped off by the upper sealing member 6520. Moreover, the toner T that still remains on the developing roller 6510 is stripped off by the toner supply roller 6550.

===The Developing Position, Communication Position and Mounting and Dismounting Position of the Developing Containers===

Figure 73A:
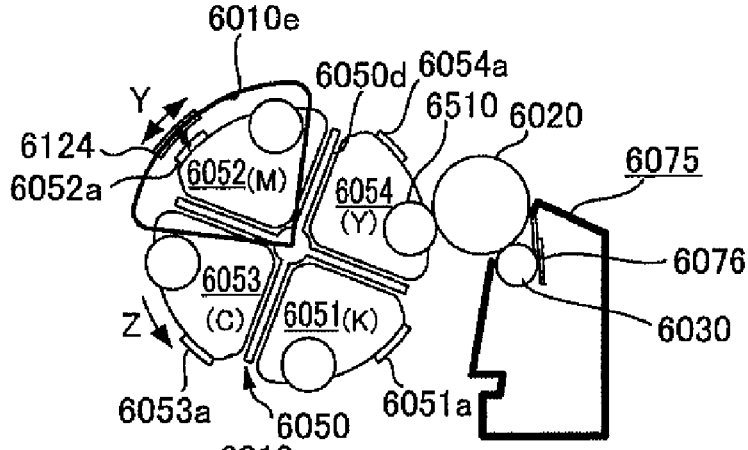
FIG. 73A is a diagram showing the developing container holding unit 6050 in a state where the yellow developing container 6054 is positioned at the developing position.
Figure 73B:
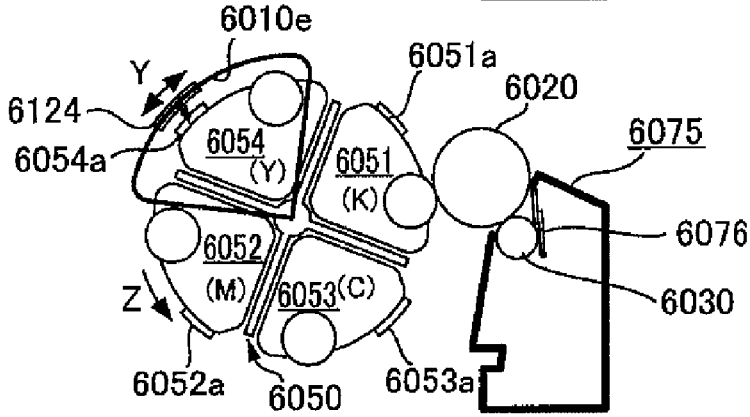
FIG. 73B is a diagram showing the developing container holding unit 6050 in a state where the yellow developing container 6054 is positioned at the communication position.
Figure 73C:
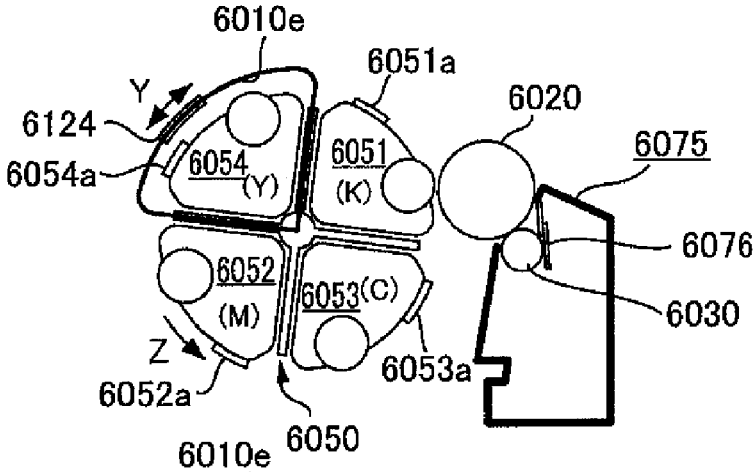
FIG. 73C is a diagram showing the developing container holding unit 6050 in a state where the yellow developing container 6054 is positioned at the mounting and dismounting position.
Figure 73D:
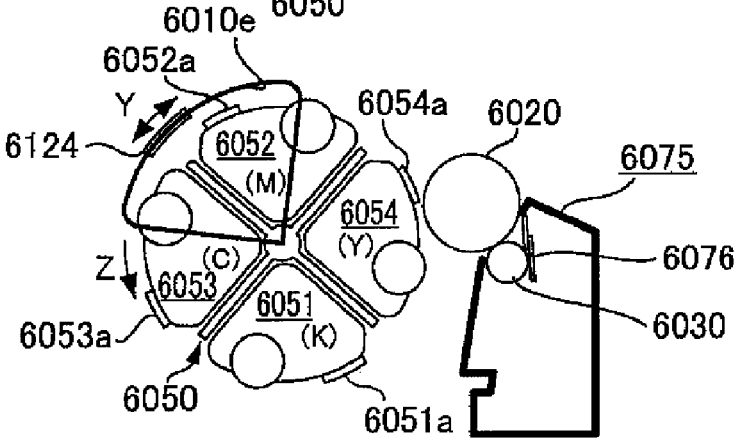
FIG. 73D is a diagram showing a state where the developing container holding unit 6050 is positioned in its home position.

As mentioned above, the developing containers 6051, 6052, 6053, and 6054 are moved together with the movement of the mounting and dismounting sections 6050*a*, 6050*b*, 6050*c*, and 6050*d*. At that time, the mounting and dismounting sections are moved such that the developing containers are positioned in predetermined positions. Such predetermined positions are the developing position, serving as a first position, the communication position, serving as a second position, and the mounting and dismounting position. Since the developing position, the communication position and the mounting and dismounting position of each of the developing containers are the same, the developing position, the communication position and the mounting and dismounting position of the yellow developing container 6054 are explained in the following with reference to FIGS. 73A to 73D. FIG. 73A is a diagram showing the developing container holding unit 6050 in a state where the yellow developing container 6054 is positioned at the developing position. FIG. 73B is a diagram showing the developing container holding unit 6050 in a state where the yellow developing container 6054 is positioned at the communication position. FIG. 73C is a diagram showing the developing container holding unit 6050 in a state where the yellow developing container 6054 is positioned at the mounting and dismounting position. FIG. 73D is a diagram showing a state where the developing container holding unit 6050 is positioned in its home position.

In the state shown in FIG. 73A, the yellow developing container 6054 is positioned at the developing position in which the developing roller 6510 is in opposition to the photoconductor 6020. In this state, the developing roller 6510 is able to develop the latent image borne on the photoconductor 6020. In the state in which the yellow developing container 6054 is positioned in the developing position, as noted above, the springs 6576 provided in the mounting and dismounting section 6050*d* bias the yellow developing container main unit towards the outer circumferential side. Due to this biasing force of the springs 6576, the rolls 6574 contact against the photoconductor 6020. It should be noted that when the photoconductor 6020 is installed in a slanted manner with respect to the printer main unit 6010*a*, then the yellow developing container main unit moves with respect to the coupling member 6590 when the yellow developing container 6054 is positioned in the developing position, that is, the attachment protrusion 6581*a* of the yellow developing container main unit moves in the major axis direction within the attachment hole 6593*a* of the coupling member and the attachment protrusion 6581*b* of the yellow developing container main unit moves in the major axis direction within the attachment hole 6593*b* of the coupling member 6590, so that the rolls 6574 with which the yellow developing container main unit is provided contact suitably against the photoconductor 6020. During this, the relative position of the developing container main unit and the coupling member 6590 is changed in accordance with the biasing force of the springs 6576. It should be noted that in a state in which the yellow developing container 6054 is positioned in the developing position, the magenta developing container 6052 is positioned in the communication position.

Furthermore, when the developing container holding unit 6050 is rotated for a predetermined angle in Z-direction in FIG. 73A from the state shown in FIG. 73A around its rotation shaft 6050*e*, then the state shown in FIG. 73B is achieved. In the state shown in FIG. 73B, the yellow developing container 6054 is positioned in the communication position. In this state, the communication unit 6054*a* provided on the yellow developing container 6054 opposes the antenna unit 6124 in a noncontacting manner. This communication unit 6054*a* can then communicate with the antenna unit 6124. Furthermore, when the yellow developing container 6054 is positioned in the communication position, the rolls 6574 of the yellow developing container 6054 do not contact against members on the side of the printer main unit 6010*a*. It should be noted that when the yellow developing container 6054 is positioned in the communication position, the black developing container 6051 is positioned in the developing position. Therefore, the communication between the antenna unit 6124 and the communication unit can take place while the black developing container 6051 develops the latent image borne on the photoconductor 6020.

Furthermore, when the developing container holding unit 6050 is rotated around its rotation shaft 6050*e* for a predetermined angle in Z-direction in FIG. 73B from the state shown in FIG. 73B, then the state shown in FIG. 73C is achieved. In the state shown in FIG. 73C, the yellow developing container 6054 is positioned in the mounting and dismounting position. In this state, the yellow developing container 6054 can be mounted and dismounted via the developing container mounting and dismounting opening 6010*e*, that is, the yellow developing container 6054 can be mounted to the mounting and dismounting section 6050*d* or it can be dismounted from the mounting and dismounting section 6050*d*.

It should be noted that after the power source of the printer main unit 6010*a* has been turned on and an initialization operation has been performed, and before the printer 6010 forms an image, the developing container holding unit 6050 is positioned in the home position shown in FIG. 73D.

===Configuration of the Communication Unit===

Figure 74:
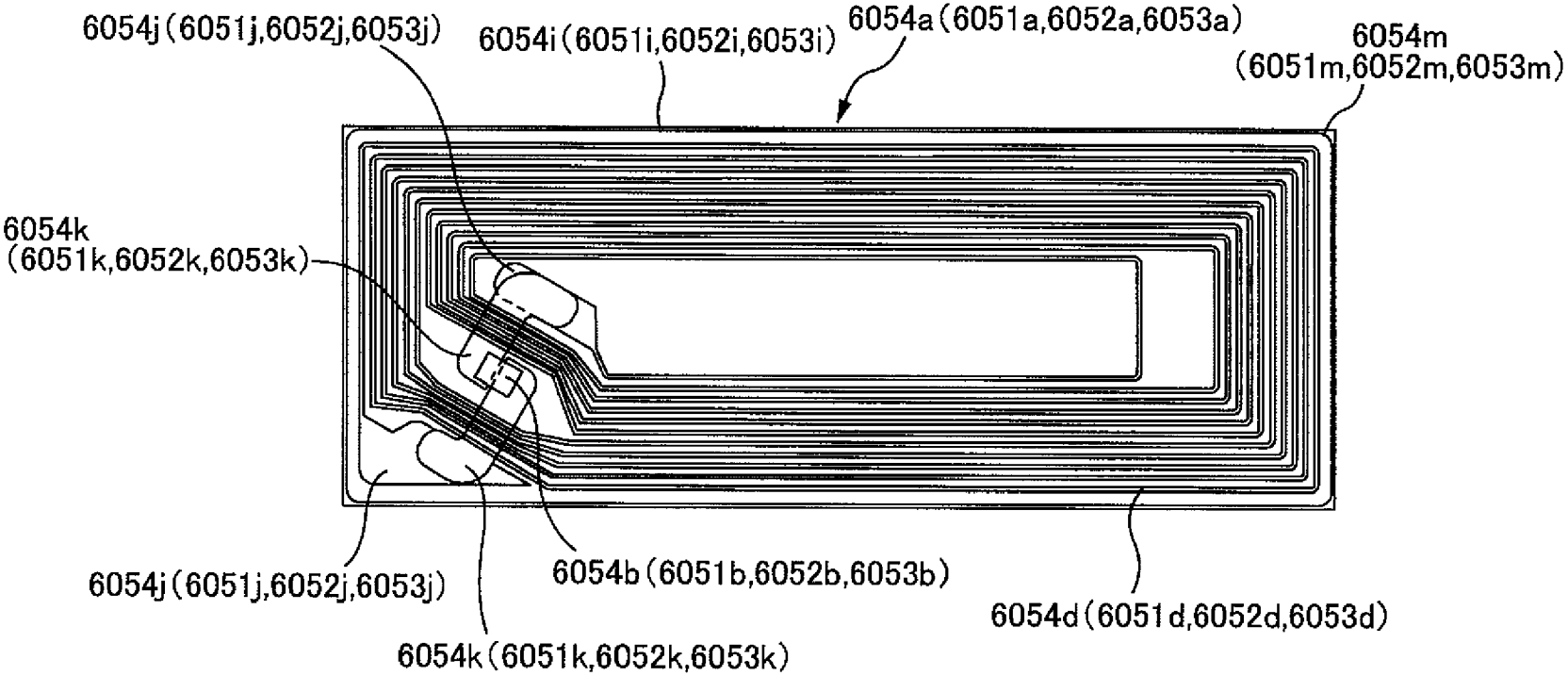
FIG. 74 is a plan view showing the configuration of the communication unit.
Figures 75, 76:
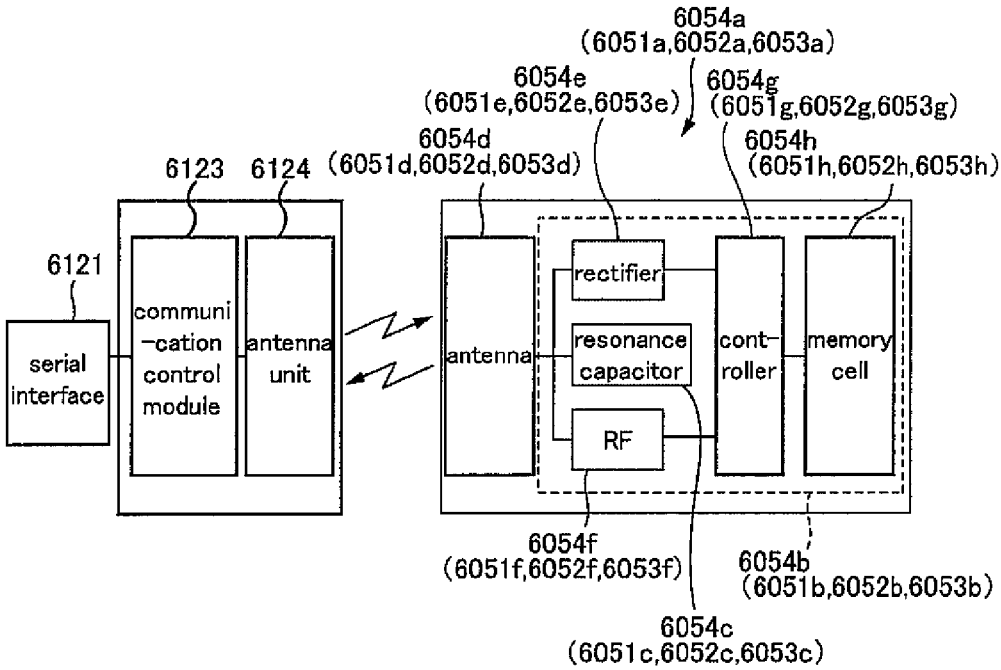
FIG. 75 is a block diagram illustrating the internal configuration of the communication unit and the send/receive section.
FIG. 76 is a diagram illustrating the information stored in a memory cell of the communication unit.

The configuration of the communication unit with which in the developing container is provided as well as the configuration for sending and receiving data is described next with reference to FIG. 74, FIG. 75, and FIG. 76. FIG. 74 is a plan view showing the configuration of the communication unit. FIG. 75 is a block diagram illustrating the internal configuration of the communication unit and the send/receive section. FIG. 76 is a diagram illustrating the information stored in a memory cell 6054*h* of the communication unit 6054*a*.

Communication units are attached respectively to the developing containers 6051, 6052, 6053, and 6054, but since the configuration of the communication units attached to the developing containers and the positions at which the communication units are attached to the developing container main units are the same for all developing containers, the following is an explanation taking the communication unit 6054*a* attached to the yellow developing container 6054 as an example.

When the yellow developing container 6054 is mounted to the mounting and dismounting section 6050*d*, the communication unit 6054*a* can communicate with the antenna unit 6124 on the side of the printer main unit 6010*a* in a noncontacting manner. As mentioned above, the yellow developing container 6054 is moved by the movement of the mounting and dismounting section 6050*d*. When the yellow developing container 6054 has been moved to the communication position, which is different from the developing position, the communication unit 6054*a* communicates in a noncontacting manner with the antenna unit 6124 with which the printer main unit 6010*a* is provided. The communication unit 6054*a* is provided inward of the antenna unit 6124 in radial direction with respect to the center of the rotation shaft 6050*e* of the developing container holding unit 6050.

The communication unit 6054*a* includes a thin plate-shaped substrate 6054*i* serving as a substrate made of a thin plate-shaped piece of plastic that is flexible in its longitudinal direction, an antenna 6054*d* serving as a first antenna made by arranging copper foil in a rectangular planar coil shape, antenna terminals 6054*j* provided on both ends of the antenna, a non-contact IC chip 6054*b* including a memory and serving as an element for communicating with an external antenna, two coupling sections 6054*k* made of aluminum that connect the chip terminals of the non-contact IC chip 6054*b* with the antenna terminals 6054*j*, and a film-shaped protective sheet 6054*m* covering these elements, sandwiching them together with the thin plate-shaped substrate 6054*i*.

As shown in FIG. 74, one antenna terminal 6054*j* of the antenna 6054*d* is arranged at one end in the longitudinal direction of the rectangular thin plate-shaped substrate 6054*i*, the antenna 6054*d* is wrapped about ten times in a coil shape along the outer shape of the thin plate-shaped substrate 6054*i*, and the other antenna terminal 6054*j* is provided to the inner side of the antenna 6054*d*. The outer antenna terminal 6054*j* and the inner antenna terminal 6054*j* are both provided on the same side in the longitudinal direction of the thin plate-shaped substrate 6054*i*. On the thin plate-shaped substrate 6054*i*, the ten copper foil structures of the antenna 6054*d* are lined up next to each other along the vertical and horizontal edges of the rectangular shape, and are divided into five each at one corner on that side of the thin plate-shaped substrate 6054*i* where the antenna terminals 6054*j* are provided, the non-contact IC chip 6054*b* being arranged between these. Furthermore, two coupling sections 6054*k* connecting chip terminals (not shown in the drawings) provided on the non-contact IC chip 6054*b* with the antenna terminals 6054*j* are provided, respectively straddling five copper foil structures. That is to say, on the thin plate-shaped substrate 6054*i*, the non-contact IC chip 6054*b*, two antenna terminals 6054*j*, and two coupling sections 6054*k* are provided on one end in longitudinal direction, and the copper foil structures serving as the antenna 6054*d* are guided around the remaining region, except for the center.

As shown in FIG. 68, the communication unit 6054*a* is provided between the positioning pin 6588 and the coupling member 6590 in the longitudinal direction of the yellow developing container main unit on the side of the positioning pin 6588, that is, on the downstream side with respect to the direction in which the yellow developing container 6054 is mounted. In this situation, the communication unit 6054*a* is arranged such that the end where the non-contact IC chip 6054*b* is provided is arranged on the upstream side of the communication unit 6054*a* with respect to the mounting direction.

Moreover, the communication unit 6054*a* is attached to an outer surface 6543 of the housing 6540, that outer surface 6543 extending in the longitudinal direction of the housing 6540. Here, the outer surface 6543 refers to the part of the housing 6540 corresponding to the dash-dotted line in FIG. 69. It should be noted that this outer surface 6543 includes a circularly arc-shaped surface 6543*a*, whose cross section through a perpendicular plane that is perpendicular to the longitudinal direction of the housing 6540 is circularly arc-shaped. This circularly arc-shaped surface 6543*a* is arranged such that its circular arc extends along the rotation direction of the developing container holding unit 6050 when the yellow developing container 6054 is mounted to the mounting and dismounting section 6050*d*. As shown in FIG. 69, the communication unit 6054*a* is attached at a position of the circularly arc-shaped surface 6543*a* that is furthest removed from the developing roller 6510.

Figure 77:
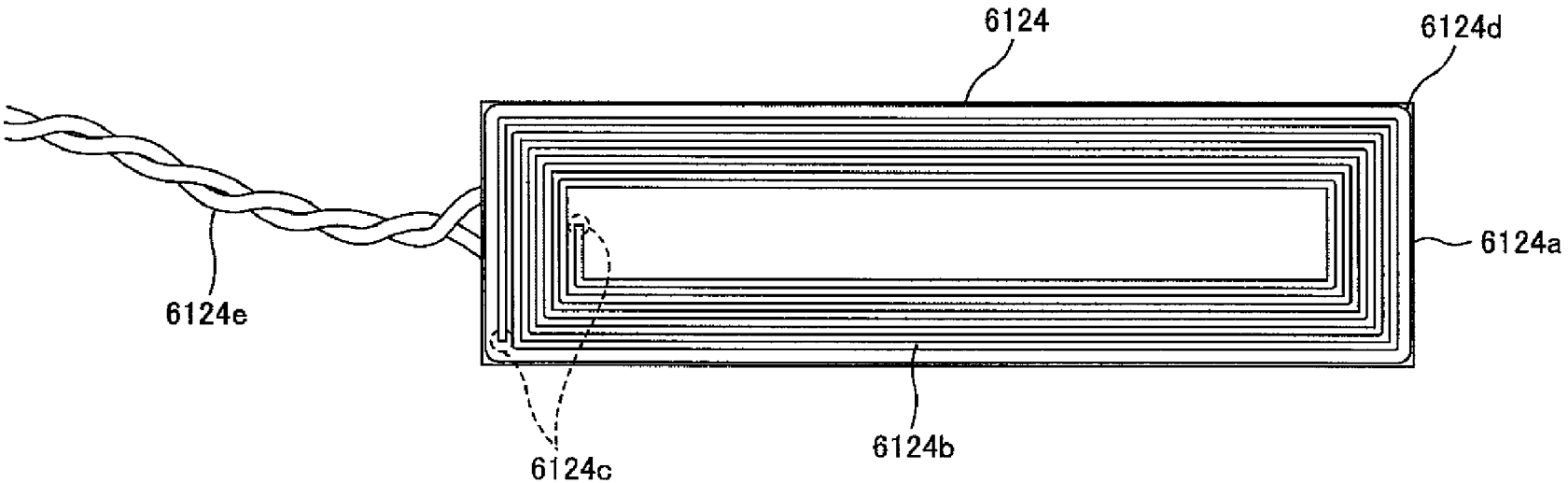
FIG. 77 is a diagram illustrating the antenna unit.
Figure 78:
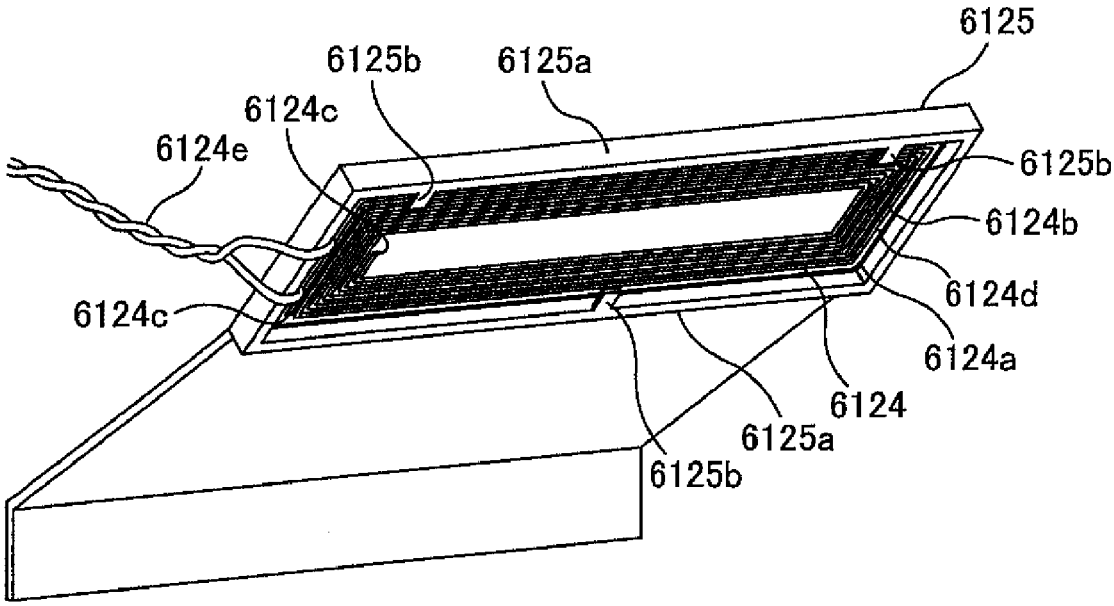
FIG. 78 is a diagram illustrating how the antenna unit is installed in a holder.

FIG. 77 is a diagram illustrating the antenna unit 6124. FIG. 78 is a diagram illustrating how the antenna unit is installed in a holder. The antenna unit 6124 provided on the side of the printer main unit 6010*a* includes a substrate 6124*a* that is formed on a plate material made of resin, an antenna 6124*b* serving as a second antenna that is made of copper foil wrapped in a planar coil shape along the outer shape of the substrate 6124*a*, substantially as in the communication unit 6054*a*, antenna terminals 6124*c* provided at the ends of the antenna 6124*b*, and a film-shaped protective sheet 6124*d* made of resin. Furthermore, the two antenna terminals 6124*c* are each connected to a wire 6124*e* and connected to the control unit 6100 via the communication control module 6123. Here, the antenna unit 6124 of the present embodiment is configured having a protective sheet 6124*d*, but it is not necessarily required to provide the protective sheet 6124*d*.

When the mounted yellow developing container 6054 has been arranged in the communication position, the antenna 6054*d* of the communication unit 6054*a* and the antenna 6124*b* of the antenna unit 6124 are arranged at positions facing each other. Moreover, the antenna unit 6124 is fixed via a holder 6125 made of resin to the printer main unit 6010*a*.

The holder 6125 is box-shaped, covering the surroundings of the antenna unit 6124 as well as the sides of the substrate 6124*a* and open on one side, and is arranged such that the antenna 6124*b* faces the outside from the open side. At the edges of the open sides of the holder 6125, flexible tongues 6125*b* protruding toward the inside are provided on opposing side walls 6125*a*. The antenna unit 6124 is accommodated inside the box-shaped holder 6125 and is held there by the tongues 6125*b*. That is to say, the antenna unit 6124 is held only by the holder 6125 made of resin, so that metal components such as screws are not required to fasten the antenna unit 6124.

If the communication unit 6054*a* and the antenna unit 6124 are in a predetermined positional relationship, for example, if they are within a distance of 10 mm of one another, then information can be exchanged in a noncontacting manner between the two. The communication unit 6054*a* is overall very compact and thin, and one of its sides is adhesive and can be adhered to an object as a seal. It is also called a memory tag, for example, and is commercially available in various forms.

As shown in FIG. 75, the non-contact IC chip 6054*b* includes a resonance capacitor 6054*c*, a rectifier 6054*e*, a signal analysis section RF (Radio Frequency) 6054*f*, a controller 6054*g*, and the memory cell 6054*h*. The memory cell 6054*h* is a non-volatile memory that can be electrically read and written, such as a NAND flash-ROM, and is capable of storing information that has been written on it and reading stored information from the outside. The antenna 6054*d* of the communication unit 6054*a* and the antenna unit 6124 communicate wirelessly with one another, so that information stored in the memory cell 6054*h* can be read and information can be written to the memory cell 6054*h*. Also, the high-frequency signals that are generated by the communication control module 6123 of the printer main unit 6010*a* are induced as a high-frequency magnetic field via the antenna unit 6124. This high-frequency magnetic field is absorbed via the antenna 6054*d* of the communication unit 6054*a* and is rectified by the rectifier 6054*e*, thus serving as a DC power source for driving the circuits in the non-contact IC chip 6054*b*.

The memory cell 6054*h* of the communication unit 6054*a* stores various types of information, as shown in FIG. 76. The address 00H stores unique ID information for each communication unit, such as the serial number of the communication unit, the address 01H stores the date when the yellow developing container 6054 was manufactured, the address 02H stores information for specifying the destination of the yellow developing container 6054, the address 03H stores information for specifying the manufacturing line on which the yellow developing container 6054 was manufactured, the address 04H stores information for specifying models with which the yellow developing container 6054 is compatible, the address 05H stores remaining toner amount information as information indicating the amount of toner that is contained in the yellow developing container 6054, and the address 06H and subsequent regions also store information as appropriate.

The ID information that is stored in the memory cell 6054*h* of the communication unit 6054*a* can be written at the time that the storage communication unit is manufactured in the factory. By reading this ID information with the printer main unit 6010*a*, it is possible to identify the individual communication units 6054*a*, 6051*a*, 6052*a*, and 6053*a*.

It should be noted that it is also possible to let the antenna unit 6124 communicate wirelessly with the communication unit 6054*a* not only when the developing container holding unit 6050 is standing still but also when the developing container holding unit 6050 is moving. That is, the antenna unit 6124 may be able to communicate wirelessly with the communication unit 6054*a* even when the communication unit 6054*a* is moving.

===Operation of Mounting the Developing Containers===

Figure 79:
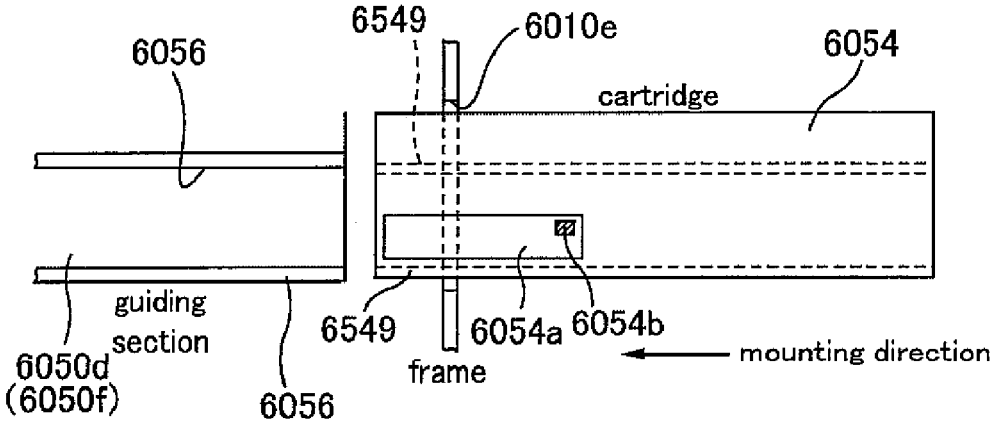
FIG. 79 is a diagrammatic view, taken from A in FIG. 62, showing the positional relationship between the developing container and the printer main unit when mounting the developing container to the printer main unit.

FIG. 79 is a diagrammatic view, taken from A2 in FIG. 62, showing the positional relationship between a developing container and the printer main unit when mounting the developing container to the printer main unit 6010*a*. Also here, the explanations concern the mounting of the yellow developing container 6054, but the mounting operation of the other developing containers is the same.

When the yellow developing container 6054 is mounted to the printer main unit 6010*a*, the user operates the printer main unit 6010*a*, whose power has been turned on, and enters a command for mounting the yellow developing container 6054. Through this operation, the developing container holding unit 6050 is rotated such that the mounting and dismounting section 6050*d*, to which the yellow developing container 6054 is supposed to be mounted, becomes positioned in the mounting and dismounting position. After the developing container holding unit 6050 has stopped, the user opens the first opening cover 6010*b* and the second opening cover 6010*c* of the printer main unit 6010*a*.

Next, the yellow developing container 6054 is passed through the developing container mounting and dismounting opening 6010*e* of the printer main unit 6010*a* from the side of the positioning pin 6588, with the side of the coupling member 6590 facing frontward.

Then, it is slowly inserted up to a position where the guided sections 6549 at the front end side of the yellow developing container 6054 engage the guiding sections 6056 on the side of the printer main unit 6010*a*. Even though at this time a portion of the communication unit 6054*a* has passed through the developing container mounting and dismounting opening 6010*e*, the non-contact IC chip 6054*b* has not yet reached the developing container mounting and dismounting opening 6010*e*.

After this, the yellow developing container 6054 is moved downstream in the carry direction, while the guided sections 6549 are slid into the guiding sections 6056, and the positioning pin 6588 is fitted into the positioning hole 6058, whereas the coupling pins 6595*a* and 6595*b* are fitted into the coupling holes 6059. Finally, after shutting the second opening cover 6010*c* and then shutting the first opening cover 6010*b*, the developing container holding unit 6050 is rotated and stopped at its home position.

That is to say, in the developing containers 6051, 6052, 6053 and 6054 of the this embodiment, the non-contact IC chips 6051*b*, 6052*b*, 6053*b*, and 6054*b* are arranged at one end of rectangular thin plate-shaped bases 6051*i*, 6052*i*, 6053*i*, 6054*i* of the communication units 6051*a*, 6052*a*, 6053*a*, and 6054*a*, and the end on the side were the non-contact IC chips 6051*b*, 6052*b*, 6053*b*, and 6054*b* are arranged is positioned on the upstream side with respect to the mounting direction of the developing containers 6051, 6052, 6053, and 6054. Therefore, a distance of the extent that the antennas 6051*d*, 6052*d*, 6053*d* and 6054*d* of the communication units 6051*a*, 6052*a*, 6053*a*, and 6054*a* are disposed on the downstream side with respect to the mounting direction is ensured between the non-contact IC chips 6051*b*, 6052*b*, 6053*b*, and 6054*b* and the front end of the developing container. That is to say, when the developing containers 6051, 6052, 6053, and 6054 are mounted to the printer main unit 6010*a*, the thin plate-shaped bases 6051*i*, 6052*i*, 6053*i* and 6054*i* of the communication units 6051*a*, 6052*a*, 6053*a*, and 6054*a* are positioned further downstream than at least the non-contact IC chips 6051*b*, 6052*b*, 6053*b*, and 6054*b*, and the non-contact IC chips 6051*b*, 6052*b*, 6053*b*, and 6054*b* are not positioned at the front-most end of the developing containers 6051, 6052, 6053, and 6054. Therefore, there is little risk that the user inadvertently damages the non-contact IC chips 6051*b*, 6052*b*, 6053*b*, or 6054*b* by bumping them against the developing container mounting and dismounting opening 6010*e*, when mounting the developing containers 6051, 6052, 6053, and 6054 to the printer main unit 6010*a*. Thus, the user can mount the developing containers 6051, 6052, 6053, and 6054 without paying excessively close attention. Thus, it is possible to realize developing containers 6051, 6052, 6053, and 6054 that are easy to mount.

More particularly, since the communication units 6051*a*, 6052*a*, 6053*a*, and 6054*a* communicate via the antenna unit 6124, which is provided on the printer main unit 6010*a*, the communication units 6051*a*, 6052*a*, 6053*a*, and 6054*a* and the antenna unit 6124 are arranged at positions where they come close to each other, so that there is little space around the communication units 6051*a*, 6052*a*, 6053*a*, and 6054*a* when the developing containers 6051, 6052, 6053, and 6054 are mounted to the printer main unit 6010*a*. However, when the developing containers 6051, 6052, 6053 and 6054 have been inserted, the positions where the non-contact IC chips 6051*b*, 6052*b*, 6053*b*, and 6054*b* are passed through have already been passed by the front end side of the developing containers 6051, 6052, 6053, and 6054, and the guided sections 6549 are guided by the guiding sections 6056, so that the risk is small that the non-contact IC chips 6051*b*, 6052*b*, 6053*b*, and 6054*b* are damaged while inserting the developing containers 6051, 6052, 6053, and 6054.

Furthermore, since the risk that the non-contact IC chips 6051*b*, 6052*b*, 6053*b*, and 6054*b* are damaged while mounting the developing containers 6051, 6052, 6053, and 6054, it is possible to use a film-shaped protective sheet 6054*m*, instead of providing a thick protection cover on the surface of the communication units 6051*a*, 6052*a*, 6053*a*, and 6054*a*. For this reason, the communication distance to the antenna unit 6124 facing the communication units during communication can be made shorter, so that it is possible to ensure favorable communication conditions.

Moreover, as shown in FIG. 68, in the developing containers 6051, 6052, 6053, and 6054 of the above-described embodiment, the communication units 6051*a*, 6052*a*, 6053*a*, and 6054*a* are provided at the end in the longitudinal direction of the main units of the developing containers 6051, 6052, 6053, and 6054, that is, on the downstream side, with respect to the mounting direction, of the developing containers 6051, 6052, 6053, and 6054. And when the developing containers 6051, 6052, 6053, and 6054 are mounted to the printer main unit 6010*a*, also the positioning pins 6588, which determine the relative position of the printer main unit 6010*a* and the developing containers 6051, 6052, 6053, and 6054, are arranged on the downstream side, with respect to the mounting direction, of the developing containers 6051, 6052, 6053, and 6054. That is to say, the communication units 6051*a*, 6052*a*, 6053*a*, and 6054*a* are positioned on the side of the positioning pins 6588. As mentioned above, the positioning pins 6588 position the main units of the developing containers 6051, 6052, 6053, and 6054 with respect to the mounting and dismounting sections 6050*a*, 6050*b*, 6050*c*, and 6050*d*, so that on the downstream side, with respect to the mounting direction, of the developing containers 6051, 6052, 6053, and 6054, there is hardly any change in the distance between the main units of the developing containers 6051, 6052, 6053, and 6054 and the printer main unit 6010*a*. Moreover, even when there is a change in the relative position between the main units of the developing containers 6051, 6052, 6053, and 6054 and the coupling member 6590 provided on the upstream side with respect to the mounting direction, this has little influence at the downstream side in the mounting direction. For this reason, if the communication units 6051*a*, 6052*a*, 6053*a*, and 6054*a* are arranged on the downstream side, with respect to the mounting direction, of the main units of the developing containers 6051, 6052, 6053 and 6054, that is, on the side of the positioning pins 588, as in this embodiment, then is hardly any change in the distance between the printer main unit 6010*a* and the communication units 6051*a*, 6052*a*, 6053*a*, and 6054*a* attached to the main units of the developing containers 6051, 6052, 6053, and 6054. Consequently, the communication units 6051*a*, 6052*a*, 6053*a*, and 6054*a* can communicate properly with the printer main unit 6010*a*.

In this embodiment, the developing containers 6051, 6052, 6053, and 6054 were explained to be cartridges, and as long as they are cartridges that can be mounted and dismounted to and from the printer main unit 6010*a*, that are mounted by inserting them from one side of the printer main unit 6010*a*, and that have communication units 6051*a*, 6052*a*, 6053*a*, and 6054*a*, it is possible to realize easy-to-mount cartridges by disposing the communication units 6051*a*, 6052*a*, 6053*a*, and 6054*a* on the downstream side with respect to the mounting direction, and arranging the non-contact IC chips 6051*b*, 6052*b*, 6053*b*, and 6054*b* within the communication units 6051*a*, 6052*a*, 6053*a*, and 6054*a* on the upstream side, with respect to the mounting direction, in the thin plate-shaped bases 6051*i*, 6052*i*, 6053*i*, and 6054*i*. For example, similar effects can also be attained when applying the communication unit 6075*a* to the photoconductor unit 6075 including the photoconductor 6020, as shown in FIG. 62.

Second Working Example

===Communication Distance and Communication Region of Communication Unit and Antenna Unit===

Figure 80:
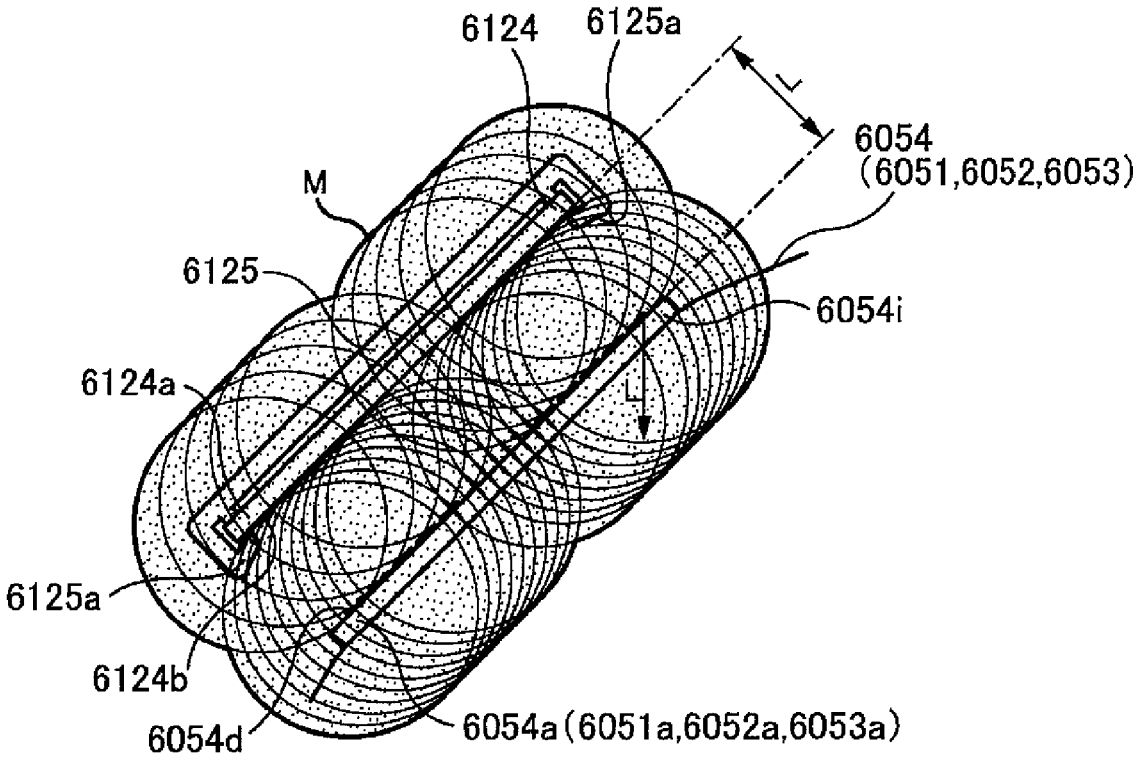
FIG. 80 is a cross-sectional view, taken from a direction perpendicular to the mounting direction, illustrating the communication distance and the communication region of the communication units and the antenna unit.
Figure 81:
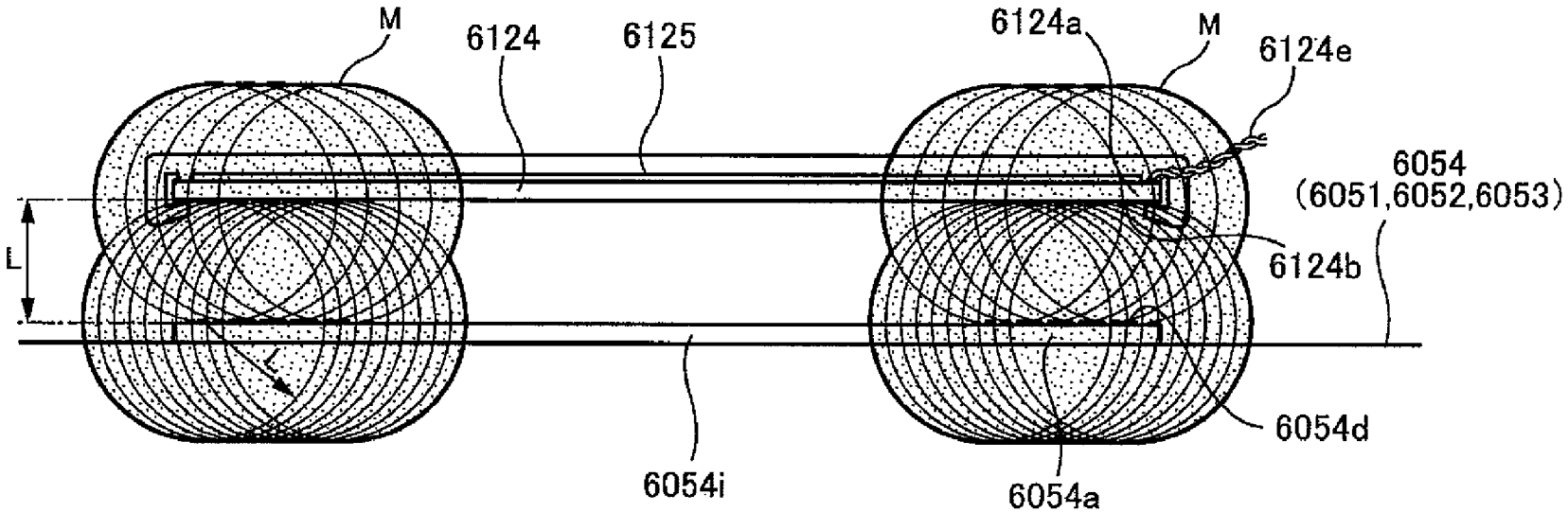
FIG. 81 is a cross-sectional view, taken from a direction parallel to the mounting direction, illustrating the communication distance and the communication region of the communication units and the antenna unit.

FIG. 80 is a cross-sectional view, taken from a direction perpendicular to the mounting direction, illustrating the communication distance and the communication region of the communication units and the antenna unit. FIG. 81 is a cross-sectional view, taken from a direction parallel to the mounting direction, illustrating the communication distance and the communication region of the communication units and the antenna unit.

As shown in these drawings, the communication units 6051*a*, 6052*a*, 6053*a*, and 6054*a* and the antenna unit 6124 are spaced apart by a communication distance L. The communication units 6051*a*, 6052*a*, 6053*a*, and 6054*a* are provided, respectively, on the developing containers 6051, 6052, 6053, and 6054. They are held by the developing container holding unit 6050 and are moved by rotating the developing container holding unit 6050 around its rotation shaft 6050*e*. For this reason, the antenna unit 6124, which is provided on the side of the printer main unit 6010*a*, is arranged at a position where it does not come into contact with the portion protruding furthest outward when the developing container holding unit 6050 holding the developing containers 6051, 6052, 6053, and 6054 rotates. On the other hand, rolls 6574 are provided on the axle sections 6510*b* of the developing roller 6510 provided to the developing device, such that the developing roller 6510 and the photoconductor 6020 face each other at a predetermined distance. That is to say, the rolls 6574 are the only components that come in contact with the printer main unit 6010*a*. For this reason, the communication units 6051*a*, 6052*a*, 6053*a* and 6054*a* are disposed inward from the outer circumference of the rolls 6574, that is, closer to the center of the rotation shaft 6050*e*, and the antenna unit 6124 is disposed outward from the outer circumference of the rolls 6574, that is, on the side that is further away from the center of the rotation shaft 6050*e*.

The communication units 6051*a*, 6052*a*, 6053*a*, and 6054*a* and the antenna unit 6124 are arranged such that they face each other at the above-mentioned communication position, preferably spaced apart at a communication distance L of, for example, 10 mm, at which communication is possible. Moreover, the communication units 6051*a*, 6052*a*, 6053*a*, and 6054*a* do not include a power source, so that electric power is supplied to them through carrier waves from the antenna unit 6124. That is to say, electric power supply as well as signals transmission to the communication units 6051*a*, 6052*a*, 6053*a*, and 6054*a* through electromagnetic induction occurring between the planar coil-shaped antennas 6054*d* and 6124*b* with which the communication units 6051*a*, 6052*a*, 6053*a*, and 6054*a* and the antenna unit 6124 are respectively provided. For this reason, when the communication units 6051*a*, 6052*a*, 6053*a*, and 6054*a* and the antenna unit 6124 communicate, a magnetic flux occurs around the copper foils of the antennas 6051*d*, 6052*d*, 6053*d*, 6054*d*, and 6124*b*. This magnetic flux occurring at the antenna 6124*b* of the antenna unit 6124 then has to reach the antennas 6051*d*, 6052*d*, 6053*d*, and 6054*d* of the communication units 6051*a*, 6052*a*, 6053*a*, and 6054*a*, which are removed by at least the communication distance L. That is to say, for the communication units 6051*a*, 6052*a*, 6053*a*, and 6054*a* and the antenna unit 6124 to communicate, it is necessary that magnetic flux can be generated in a region of the distance L around the copper foils of the antennas 6051*d*, 6052*d*, 6053*d*, 6054*d*, and 6124*b* (referred to as "communication region M" below). It is preferable that the radius L, which defines the communication distance L and the communication region M, is set to such a distance that favorable communication conditions can be ensured, while considering the precision of the components of the communication units 6051*a*, 6052*a*, 6053*a*, and 6054*a* and the antenna unit 6124 or attachment errors when attaching components to the printer main unit 6010*a*.

In the case of the present embodiment, around the communication units 6051*a*, 6052*a*, 6053*a*, and 6054*a* and the antenna unit 6124, a region of the distance L from the center of the copper foil constituting the antennas of the communication units and the antenna of the antenna unit becomes the communication region M, as shown in FIG. 80 and FIG. 81.

Now, if there are conductive members within this communication region M, then the magnetic flux occurring in the antenna 6124*b* passes through the conductive members, so that eddy currents flow through these conductive members with the magnetic flux at the axial center and the carrier wave is attenuated significantly. For this reason, the communication region M of the present embodiment is set to such a region that no other conductive members besides the communication units 6051*a*, 6052*a*, 6053*a*, 6054*a*, the antenna unit 6124 and the wires 6124*e* are present within this communication region M. That is to say, conductive members such as the frame 6010*f* and the stay 6010*g* of the printer main unit 6010*a*, the power source shielding member 6098*a*, the cooling duct, and the metal components of the developing containers are all arranged outside the communication region M.

With the printer 6010 of the present embodiment, there are no conductive components other than the communication units 6051*a*, 6052*a*, 6053*a*, 6054*a*, the antenna unit 6124, and the wires 6124*e* connected to the antenna unit 6124 present within the communication region M, so that there are no conductive components hampering the communication present in the communication region M of the communication units 6051*a*, 6052*a*, 6053*a*, and 6054*a* and the antenna unit 6124. For this reason, a printer 6010 can be realized, with which favorable communication between the communication units 6051*a*, 6052*a*, 6053*a*, 6054*a* and the antenna unit 6124 is possible. Moreover, in the method for fixing the antenna unit 6124, the antenna unit 6124 is accommodated in a holder 6125 made of resin and is held by engaging flexible tongues 6125*b* provided on the holder 6125, and the holder 6125 is fixed on the main unit side, so that it is possible to fix the antenna unit 6124 within the printer 6010 without disposing conductive components within the communication region M. That is to say, no metal holder and screws are used when fixing the antenna unit 6124, so that there are no conductive components present within the communication region M. For this reason, favorable communication between the communication units 6051*a*, 6052*a*, 6053*a*, 6054*a* and the antenna unit 6124 is possible. Moreover, the tongues 6125*b* engaging the antenna unit 6124 have flexibility, which also makes it easy to attach the antenna unit 6124 to the holder 6125.

Moreover, in the printer of the present embodiment the metal shielding members, for example the frame 6010*f* or the stay 6010*g*, are outside of the communication region M, so that it is possible to let the communication units 6051*a*, 6052*a*, 6053*a*, and 6054*a* and the antenna unit 6124 communicate with favorable conditions. Furthermore, in the communication position, the power source unit 6098 is positioned at a spacing that is larger than the communication distance L on the opposite side of the developing containers 6051, 6052, 6053, and 6054 with respect to the antenna unit 6124, so that also the power source shielding member 6098*a* functions as a shielding member when the communication units 6051*a*, 6052*a*, 6053*a*, and 6054*a* communicate with the antenna unit 6124 and it is possible to prevent the communication between the communication units 6051*a*, 6052*a*, 6053*a*, and 6054*a* and the antenna unit 6124 from being impeded by electromagnetic waves that are emitted from the power source unit 6098.

In this embodiment, the developing containers 6051, 6052, 6053, and 6054 were explained to be cartridges, and as long as they are cartridges that can be mounted and dismounted to and from the printer main unit 6010*a*, and that have communication units 6051*a*, 6052*a*, 6053*a*, and 6054*a*, it is possible to realize a printer that allows communication under favorable conditions, through a configuration in which no conductive components other than the communication units 6051*a*, 6052*a*, 6053*a*, and 6054*a*, the antenna unit 6124, and the wires 6124*e* connected to the antenna unit 6124 are present within the communication region M. For example, similar effects can also be attained when providing the communication unit 6075*a* on the photoconductor unit 6075 including the photoconductor 6020, as shown in FIG. 62.

Other Embodiments

An image forming apparatus or the like according to the present invention was explained by way of the foregoing embodiment, but the foregoing embodiment of the invention is merely for the purpose of elucidating the present invention and is not to be interpreted as limiting the present invention. The invention can of course be altered and improved without departing from the gist thereof and equivalents are intended to be embraced therein.

In the foregoing embodiment, an intermediate image transfer type full-color laser beam printer was described as an example of the image forming apparatus, but the present invention can also be applied to various other types of image forming apparatuses, such as full-color laser beam printers that are not of the intermediate image transfer type, monochrome laser beam printers, copying machines, and facsimiles.

Also, in the foregoing embodiment, the photoconductor, which is an image bearing member, was explained as having a photoconductive layer on the outer circumferential surface of a hollow cylindrical conductive member, but there is no limitation to this. For example, it may also be a so-called photoconductive belt, in which a photoconductive layer is provided on the surface of a belt-shaped photoconductive member.

Furthermore, in the foregoing embodiment, as shown in FIG. 63 for example, the mounting and dismounting sections 6050*a*, 6050*b*, 6050*c*, and 6050*d* are movable, and when the developing containers 6051, 6052, 6053, and 6054 are mounted to the mounting and dismounting sections and are moved to the developing position through the movement of the mounting and dismounting sections, then the latent image borne on the photoconductor 6020 (image bearing member) provided in the printer main unit 6010*a* is developed. Moreover, the communication units 6051*a*, 6052*a*, 6053*a*, and 6054*a* communicate in a noncontacting manner with the printer main unit 6010*a* when the developing containers 6051, 6052, 6053, and 6054 have been moved to the communication position, which is different from the developing position. However, there is no limitation to this. For example, it is also possible to let the developing containers not move at all.

However, if the developing containers 6051, 6052, 6053, and 6054 move together with the movement of the mounting and dismounting sections 6050*a*, 6050*b*, 6050*c*, and 6050*d*, then the relative position between the developing container main units and the coupling member 6590 changes more easily when the developing containers are positioned in the communication position than in the case that the developing containers do not move, so that there is a greater risk that the distance between the printer main unit 6010*a* and the communication units 6051*a*, 6052*a*, 6053*a*, and 6054*a* changes. Therefore, the effect of providing the communication units on the one end in the longitudinal direction of the developing container main units, that is, the effect that developing containers that can communicate properly with the printer main unit 6010*a* can be realized is more advantageous in the case that the developing containers move together with the movement of the mounting and dismounting sections. For this reason, the above-described embodiment is more preferable.

Furthermore, as shown in FIG. 65, in the foregoing embodiment, the mounting and dismounting sections 6050*a*, 6050*b*, 6050*c*, and 6050*d* are each provided with springs 6576, which bias the developing container main units in their longitudinal direction. Also, the relative position between the developing container main units and the coupling member 6590 is changed in accordance with the biasing amount of the springs 6576. However, there is no limitation to this. For example, it is also possible that the mounting and dismounting sections are not provided with springs biasing the developing container main units in their longitudinal direction.

However, if the mounting and dismounting sections 6050*a*, 6050*b*, 6050*c*, and 6050*d* are provided with springs 6576 that bias the developing container main units in their longitudinal direction, then the developing containers 6051, 6052, 6053, and 6054 oscillate due to the expansion and contraction of the springs 6576 when the developing containers are positioned in the communication position. Then, when the developing containers oscillate, there is the risk that the distance between the printer main unit 6010*a* and the communication units changes and that the communication units cannot communicate properly with the printer main unit 6010*a*. Therefore, the effect of providing the communication units on the one end in the longitudinal direction of the developing container main units, that is, the effect that developing containers can be realized that can communicate properly with the printer main unit 6010*a* can be more effectively displayed in the case that the mounting and dismounting sections are provided with springs 6576. For this reason, the foregoing embodiment is more preferable.

Furthermore, in the foregoing embodiment, as shown in FIG. 70, the developing container main units include a developing roller 6510 (developer bearing member) for bearing toner T (developer) and developing the latent image borne on the photoconductor 6020 with toner T, and rolls 6574 (distance holding members) that are provided at both ends in the longitudinal direction of the developing rollers 6510 and that are for holding a distance between the photoconductor 6020 and the developing roller 6510 by coming into contact with the photoconductor 6020. Moreover, when the developing containers 6051, 6052, 6053, and 6054 are moved to the developing position, the rolls 6574 hold this distance by coming into contact with the photoconductor 6020. However, there is no limitation to this.

In order to properly develop the latent image carried on the photoconductor 6020, it is necessary to hold a proper distance between the developing roller 6510 and the photoconductor 6020. To hold this distance, rolls 6574 coming into contact with the photoconductor 6020 on both sides in longitudinal direction of the developing roller 6510 may be provided. In this case, if the relative position between the developing container main unit provided with the developing roller 6510 and the coupling member 6590 can change, the rolls 6574 can be contacted against the photoconductor 6020 such that the developing roller 6510 follows the photoconductor 6020 even if the photoconductor 6020 is attached at an inclination with respect to the printer main unit 6010*a*, so that it becomes possible to hold a proper distance between the developing roller 6510 and the photoconductor 6020. For this reason, the above-described embodiment is more preferable.

Furthermore, in the above-described embodiment, as shown in FIG. 68, the positioning member is a positioning pin 6588 (positioning shaft) that is fixed to the first side wall 6546 on one end in the longitudinal direction of the developing container main unit, such that its axial direction extends in the longitudinal direction of the developing container main unit. Moreover, as shown in FIG. 66, when the developing containers 6051, 6052, 6053, and 6054 are mounted to the mounting and dismounting sections 6050*a*, 6050*b*, 6050*c*, and 6050*d*, the positioning pins 6588 are fitted to the positioning holes 6058 provided on the mounting and dismounting sections to position the developing container main units with respect to the mounting and dismounting sections. However, there is no limitation to this. For example, it is also possible that the positioning member positions the developing container main units with respect to the mounting and dismounting sections with a configuration different from positioning pins 6588 fitted into positioning holes 6058.

However, if the positioning pins 6588 position the developing container main units with respect to the mounting and dismounting sections 6050*a*, 6050*b*, 6050*c*, and 6050*d* by fitting into positioning holes 6058, then the developing container main units can be positioned with respect to the mounting and dismounting sections with a simple configuration. For this reason, the above-described embodiment is more preferable.

Furthermore, as shown in FIG. 65, in the present embodiment, the mounting and dismounting sections 6050*a*, 6050*b*,

6050*c*, and 6050*d* are each provided with coupling holes 6059. Moreover, as shown in FIG. 72, the coupling member 6590 is provided with coupling pins 6595*a* and 6595*b* (coupling protrusions) that can be fitted into the coupling holes 6059, and the coupling member 6590 is attached to the second side wall 6547 on the other end in longitudinal direction of the developing container main unit. Moreover, as shown in FIG. 66, when the developing containers 6051, 6052, 6053, and 6054 are mounted to the mounting and dismounting sections 6050*a*, 6050*b*, 6050*c*, and 6050*d*, the coupling member 6590 is coupled to the mounting and dismounting section by fitting the coupling pins 6595*a* and 6595*b* into the coupling holes 6059. However, there is no limitation to this. For example, it is also possible to couple the coupling member 6590 with the mounting and dismounting section with another configuration than coupling the coupling pin 6595*a* into the coupling hole 6059.

However, if the coupling member 6590 is coupled with the mounting and dismounting sections 6050*a*, 6050*b*, 6050*c*, and 6050*d* by fitting the coupling pins 6595*a* and 6595*b* into the coupling holes 6059, then it is possible to couple the coupling member 6590 with the mounting and dismounting sections with a simple configuration. For this reason, the above-described embodiment is more preferable.

Furthermore, as shown in FIG. 71, in the foregoing embodiment, the developing container main units are provided with attachment protrusions 6581*a* and 6581*b* having a circular cross section. Moreover, the coupling member 6590 is provided with attachment holes (6593*a* into which the attachment protrusion 6581*a* can be fitted and 6593*b* into which the attachment protrusion 6581*b* can be fitted) which have an elliptical cross section and into which attachment protrusions can be fitted. Moreover, the attachment holes 6593*a* and 6593*b* allow some movement of the attachment protrusions fitted into those attachment holes within the attachment holes. However, there is no limitation to this. For example, it is also possible that the cross-sectional shape of the attachment holes 6593*a* and 6593*b* is a shape other than a substantially elliptical shape.

Furthermore, in the foregoing embodiment, as shown in FIG. 68, the developing container main unit is supported by the housing 6540 at both ends in the longitudinal direction, and is provided with the developing roller 6510 for bearing the toner T and developing the latent image borne on the photoconductor 6020 with the toner T. Moreover, as shown in FIG. 69, the outer surface 6543 of the housing 6540 is provided with a circularly arc-shaped surface 6543*a*, whose cross section through a perpendicular plane that is perpendicular to the longitudinal direction of the housing 6540 is circularly arc-shaped. And as shown in FIG. 69, the communication units 6051*a*, 6052*a*, 6053*a*, and 6054*a* are attached at positions of the circularly arc-shaped surface 6543*a* that are furthest removed from the developing rollers 6510. However, there is no limitation to this. For example, it is also possible that the communication units are attached at positions of the circularly arc-shaped surface 6543*a* that are close to the developing rollers 6510.

However, if the communication units 6051*a*, 6052*a*, 6053*a*, and 6054*a* are attached at the positions of the circularly arc-shaped surface 6543*a* that are furthest removed from the developing rollers 6510, then it can be prevented that the toner T borne on the developing roller 6510 is scattered and adheres to the communication units, so that the communication units can communicate more properly with the printer main unit 6010*a*. For this reason, the above-described embodiment is more preferable.

===Configuration of Image Forming System Etc.===

Next, an embodiment of an image forming system serving as an example of an embodiment of the present invention is described with reference to the drawings.

Figure 82:
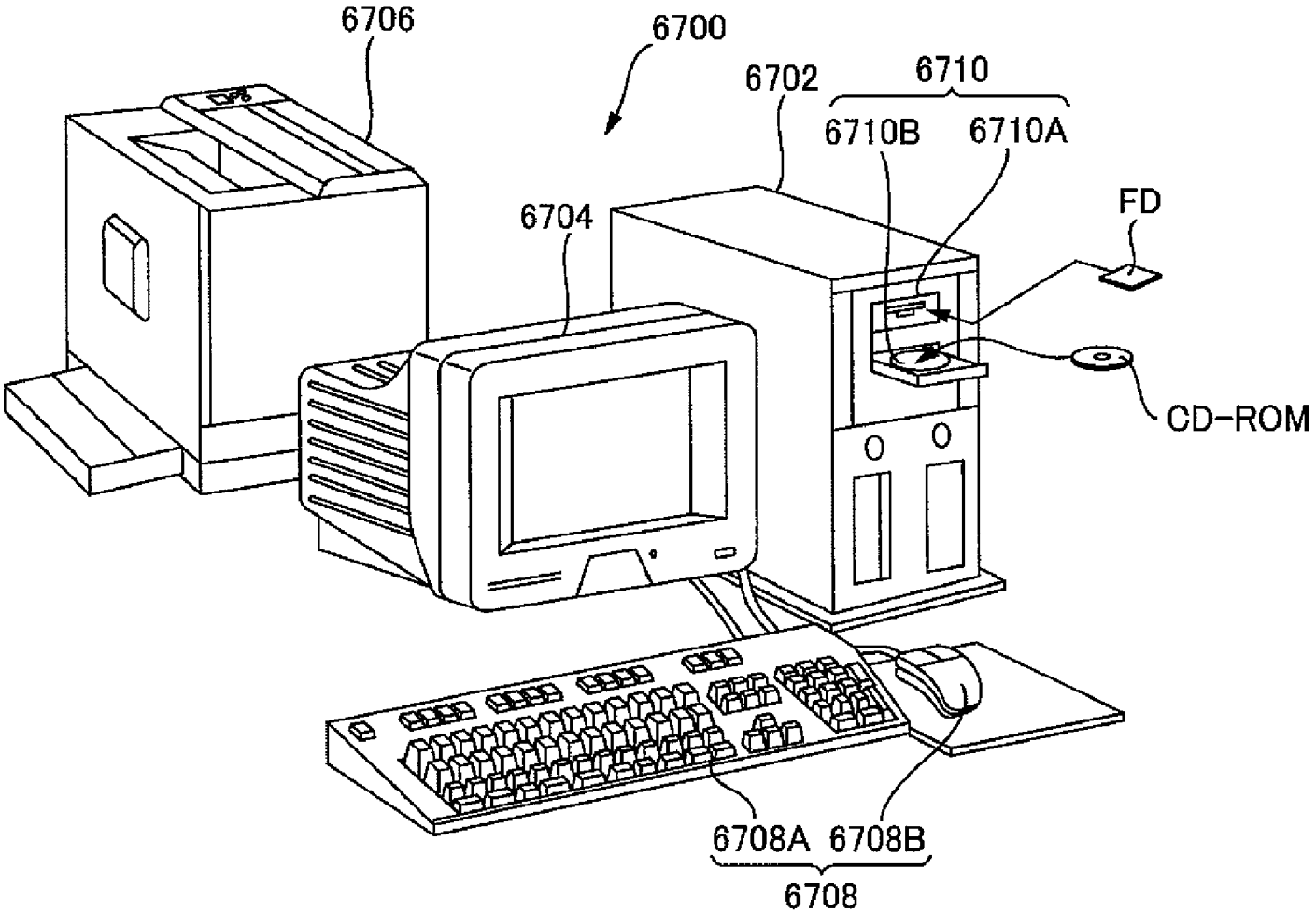
FIG. 82 is an explanatory diagram showing the external configuration of the image forming system.

FIG. 82 is an explanatory diagram showing the external configuration of an image forming system. An image forming system 6700 is provided with a computer 6702, a display device 6704, a printer 6010, input devices 6708, and reading devices 6710.

In this embodiment, the computer 6702 is contained within a mini-tower type housing, but there is no limitation to this. A CRT (cathode ray tube), plasma display, or liquid crystal display device, for example, is generally used as the display device 6704, but there is no limitation to this. As the printer 6010, the printer described above is used. In this embodiment, the input devices 6708 are a keyboard 6708A and a mouse 6708B, but there is no limitation to these. In this embodiment, a flexible disk drive device 6710A and a CD-ROM drive device 6710B are used as the reading devices 6710, but there is no limitation to these, and they may also include an MO (magneto-optical) disk drive device or a DVD (digital versatile disk), for example.

Figure 83:
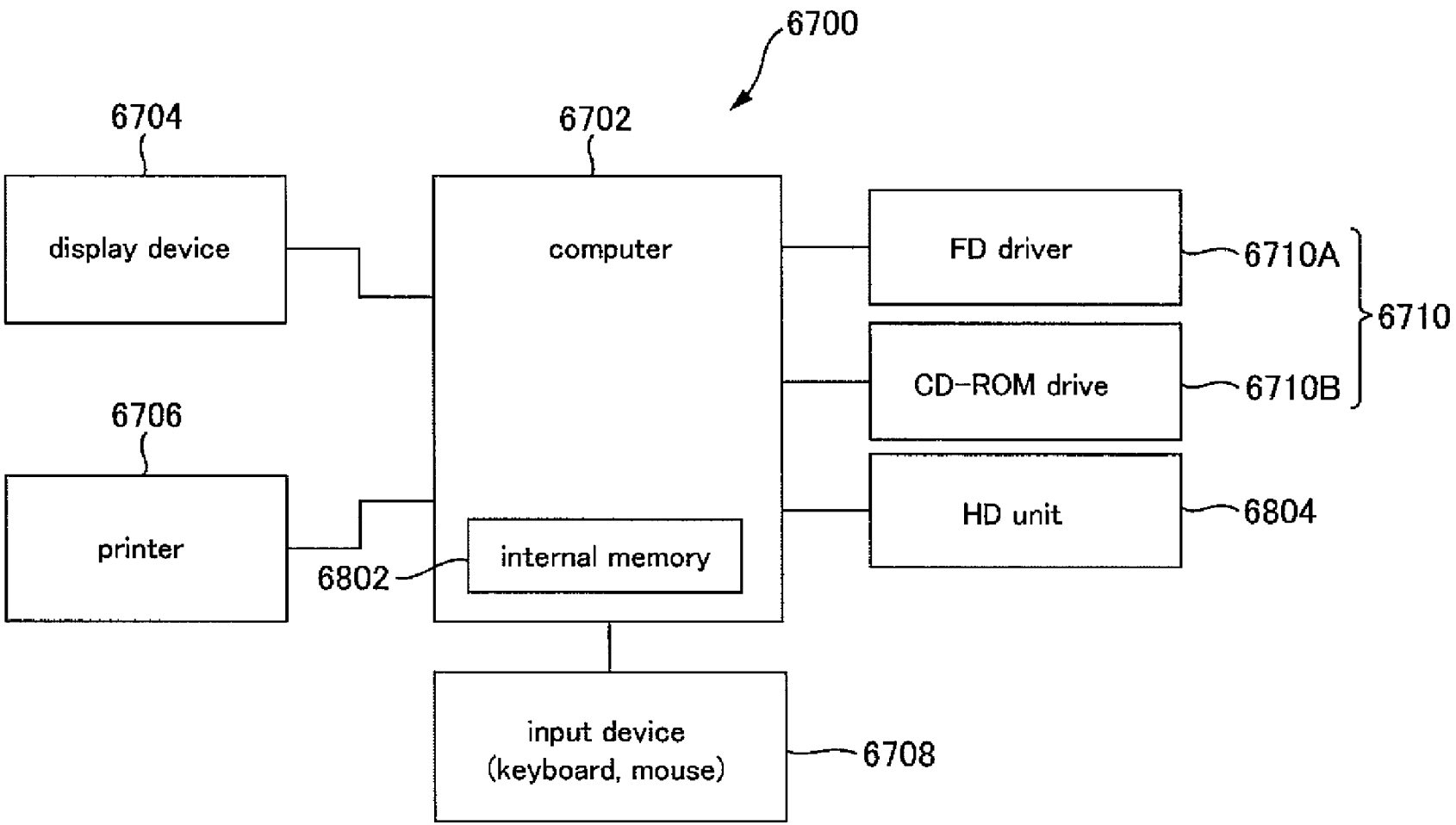
FIG. 83 is a block diagram showing the configuration of the image forming system shown in FIG. 82.

FIG. 83 is a block diagram showing the configuration of the image forming system shown in FIG. 82. An internal memory 6802 such as a RAM is provided within the casing containing the computer 6702, and furthermore an external memory such as a hard disk drive unit 6804 is provided.

In the above explanations, an example was given in which the image forming system is constituted by connecting the printer 6010 to the computer 6702, the display device 6704, the input device 6708, and the reading device 6710, but there is no limitation to this. For example, the image forming system may also be made of the computer 6702 and the printer 6010, and the image forming system does not have to be provided with any one of the display device 6704, the input device 6708, and the reading device 6710.

It is also possible that the printer 6010 has some of the functions or mechanisms of each of the computer 6702, the display device 6704, the input device 6708, and the reading device 6710. For example, the printer 6010 may be configured so as to have an image processing section for carrying out image processing, a display section for carrying out various types of displays, and a recording media mounting and dismounting section into and from which recording media storing image data captured by a digital camera or the like are inserted and taken out.

As an overall system, the image forming system that is thus achieved is superior to conventional systems.

Overview of Image Forming Apparatus of Eighth Embodiment

Figure 84:
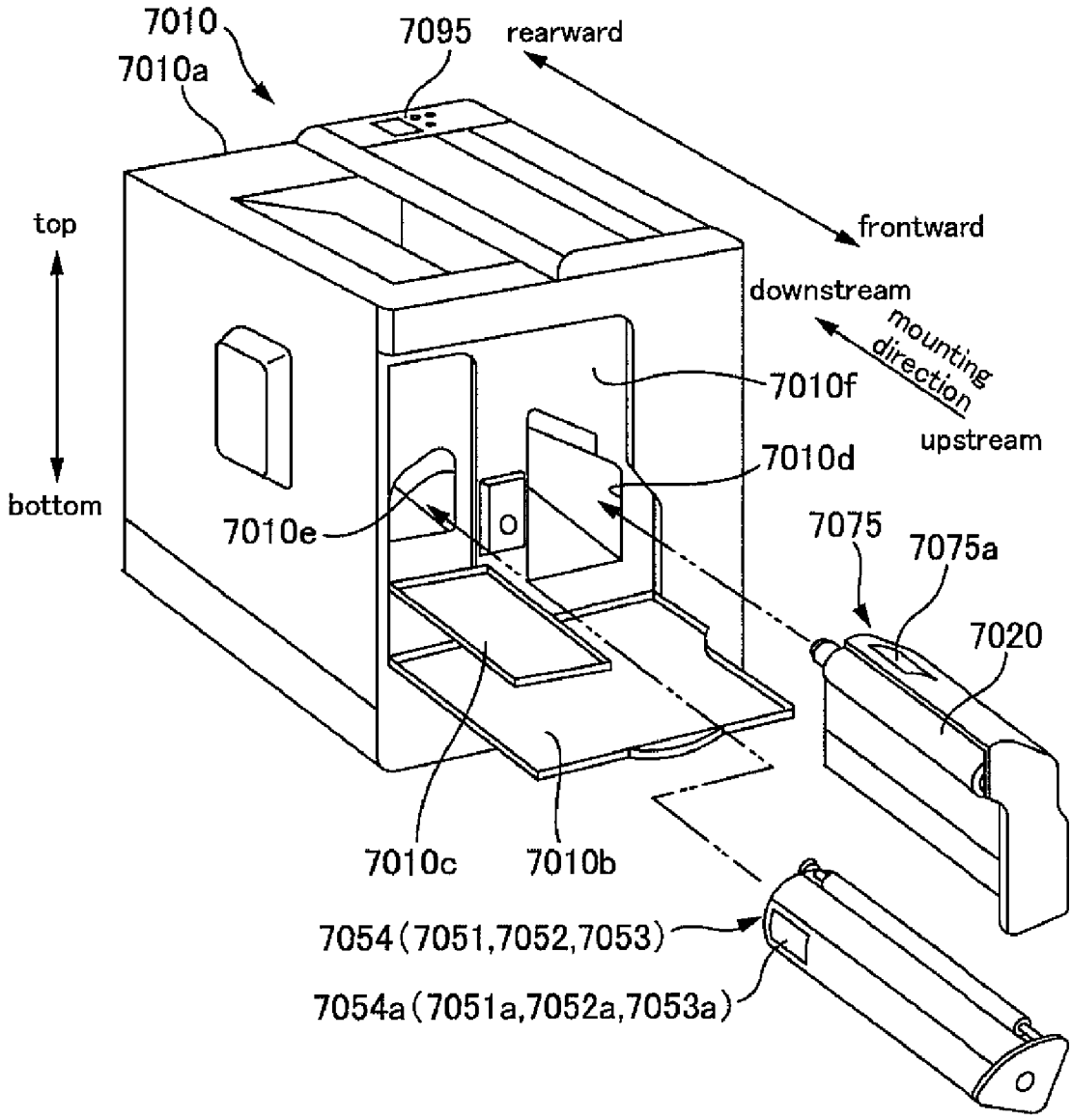
FIG. 84 is a diagram illustrating how developing containers 7051, 7052, 7053 and 7054 are mounted to and dismounted from a printer main unit 7010*a*.
Figure 85:
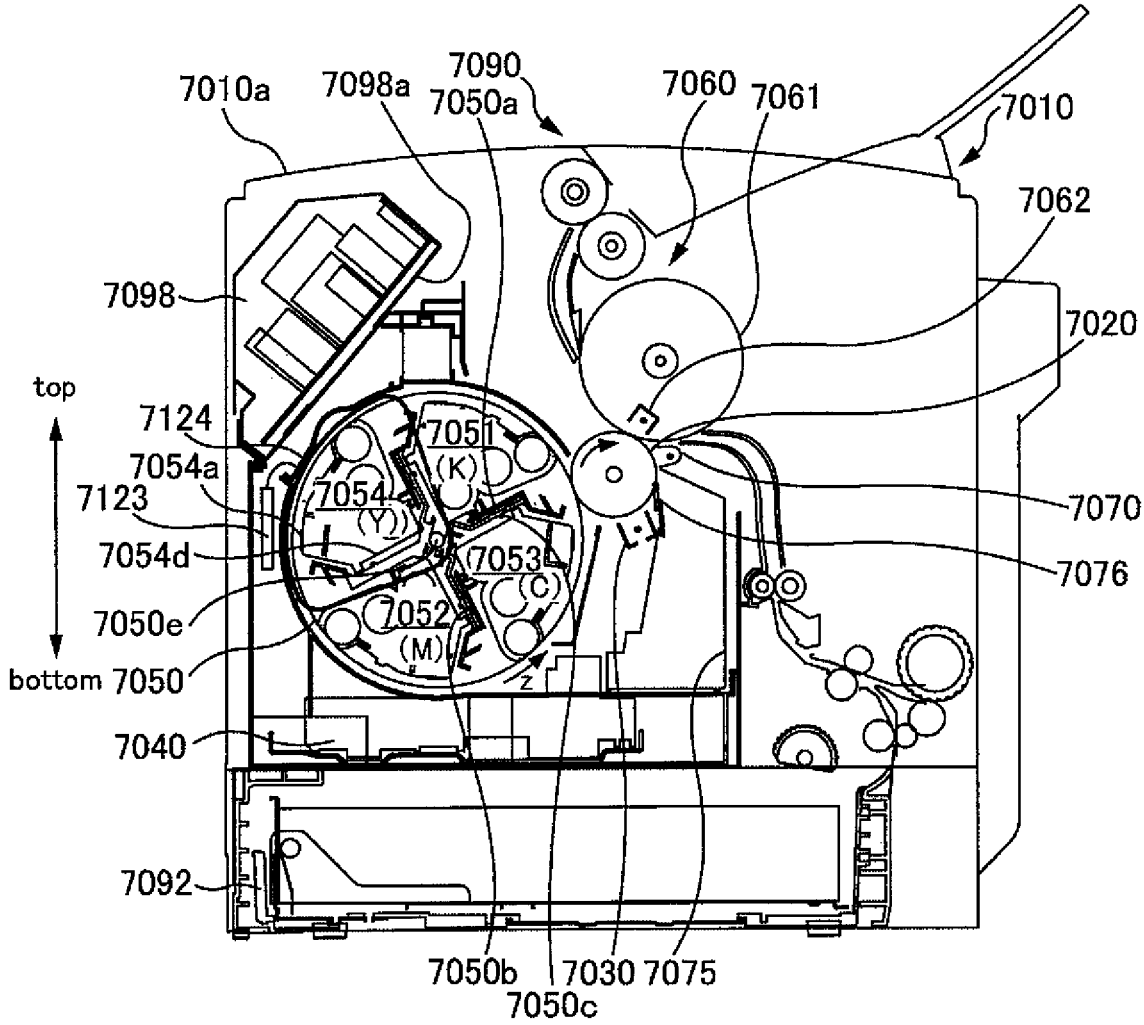
FIG. 85 is a diagram showing the main structural components constituting the printer 7010.
Figure 86:
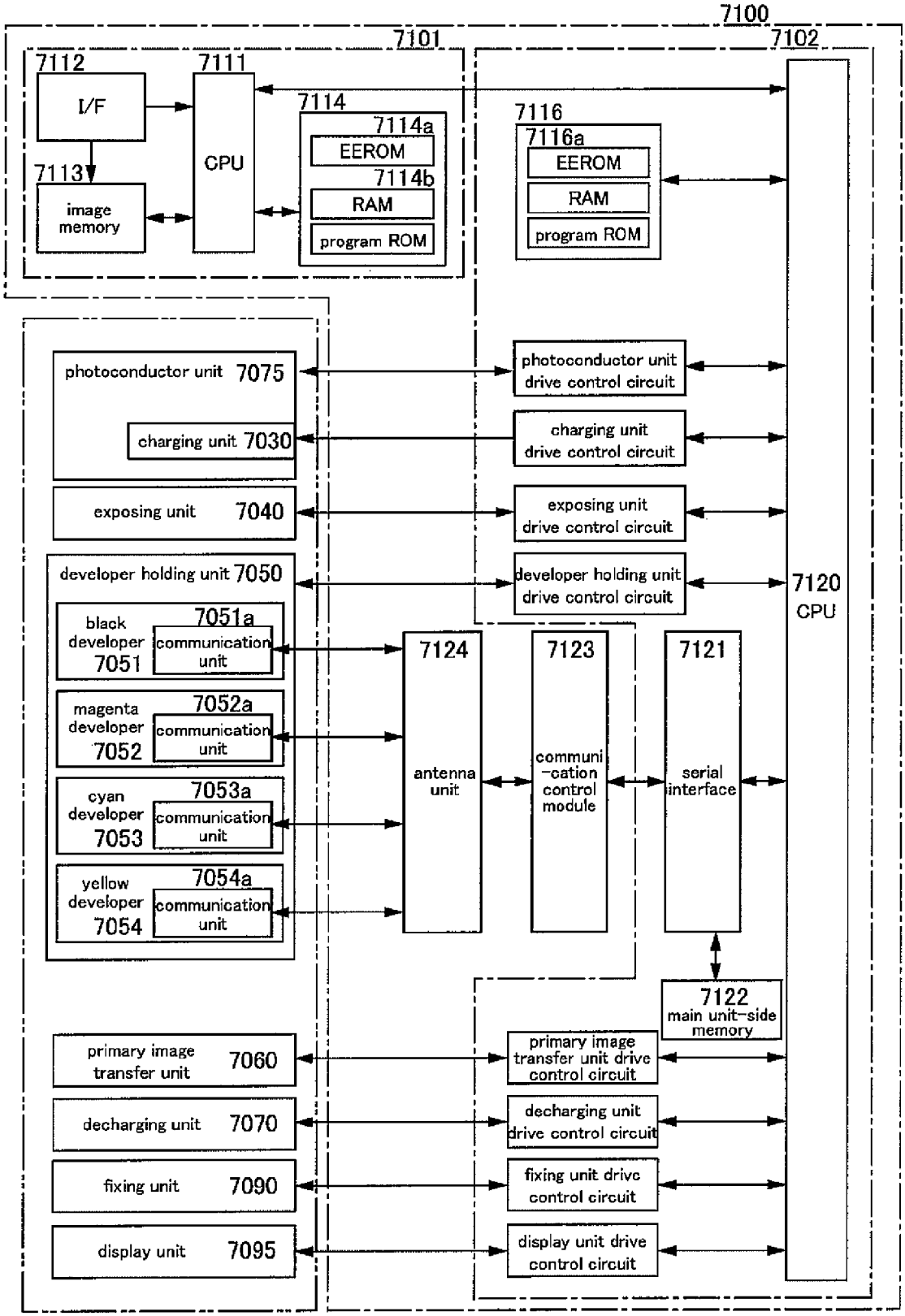
FIG. 86 is a block diagram showing the control unit 7100 of the printer 7010.
Figure 87:
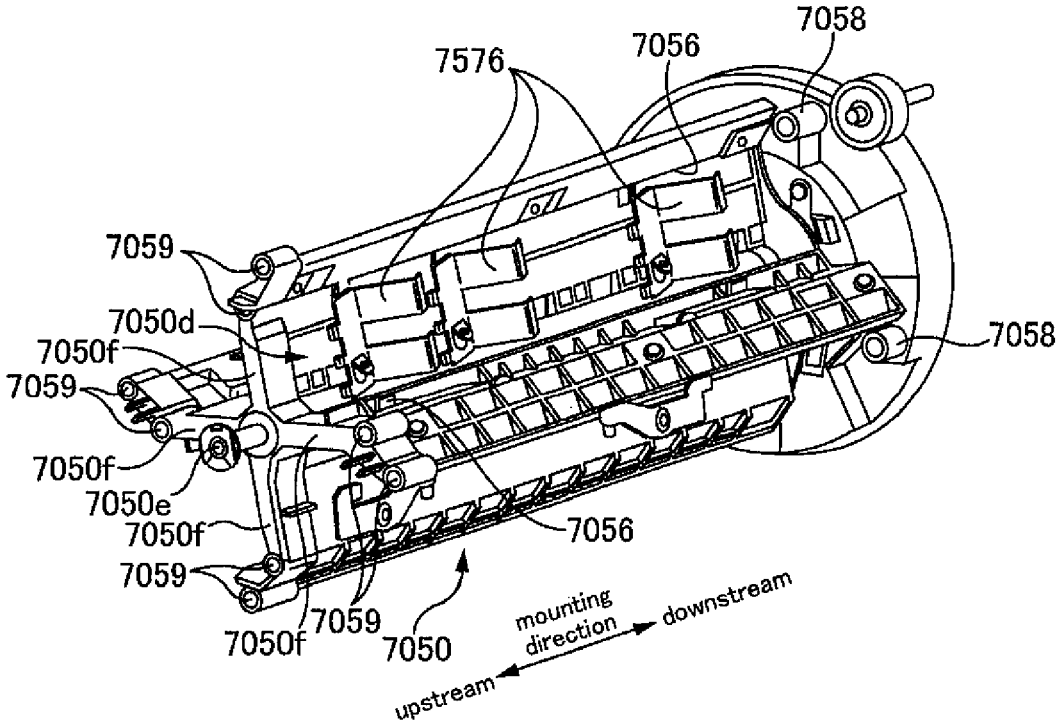
FIG. 87 is a perspective view of a developing container holding unit 7050.
Figure 88:
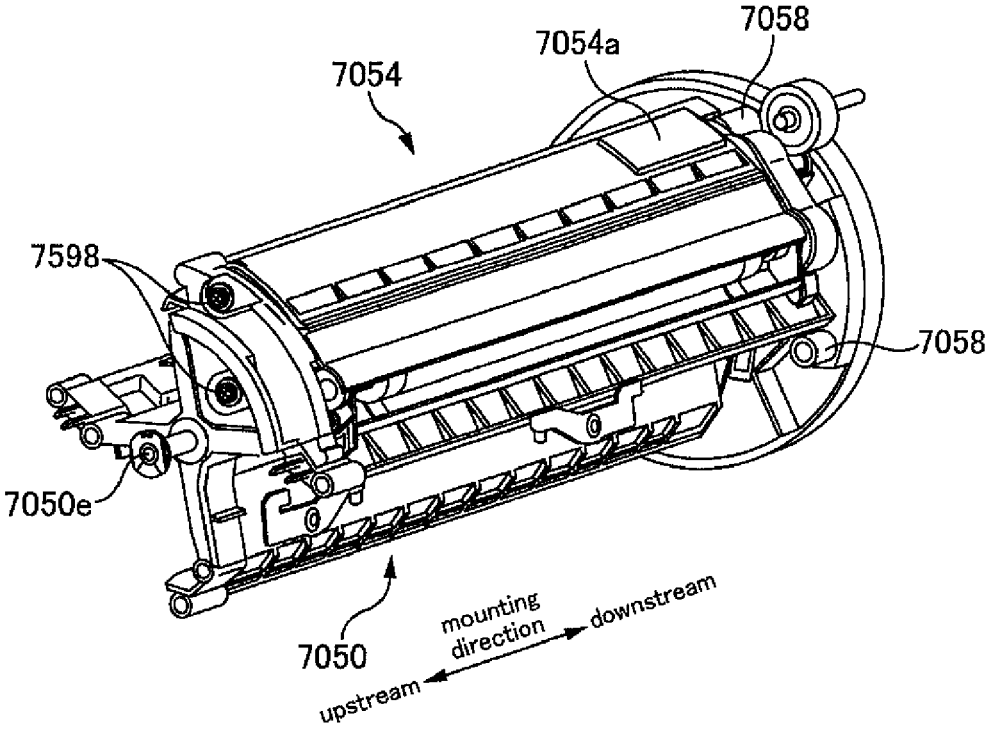
FIG. 88 is a diagram showing the developing container holding unit 7050 in a state in which a yellow developing container 7054 is mounted to a mounting and dismounting section 7050*d*.
Figure 89:
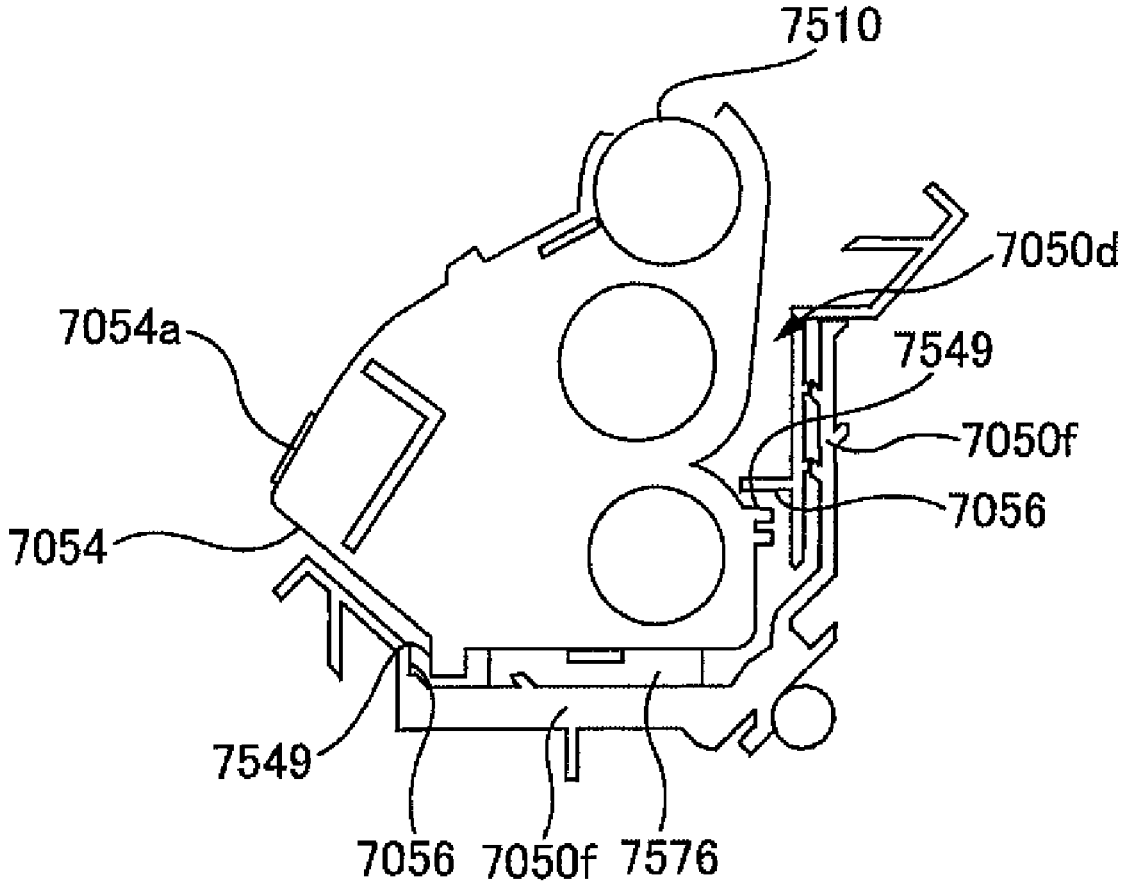
FIG. 89 is a diagram showing the positions of the mounted developing container and the developing container holding unit.

Referring to FIGS. 84 to 89, an overview of a laser beam printer (hereinafter, also referred to as "printer") 7010 serving as an example of an image forming apparatus is described. FIG. 84 is a diagram illustrating the configuration of a printer main unit 7010*a* with respect to which developing containers 7051, 7052, 7053, and 7054 can be mounted and dismounted. FIG. 85 is a diagram showing the main structural components constituting the printer 7010. FIG. 86 is a block diagram showing the control unit 7100 of the printer 7010. FIG. 87 is a perspective view of a developing container holding unit 7050. FIG. 88 is a diagram showing the developing container holding unit 7050 in a state in which a yellow developing container 7054 is mounted to a mounting and dismounting section 7050*d*. FIG. 89 is a diagram showing the positions of the mounted developing container and the developing container holding unit. It should be noted that FIG. 85 is a diagram of a cross section taken perpendicular to the mounting direction of the developing container, for example, in FIG. 84. Also, the vertical direction is indicated by arrows in FIG. 84 and FIG. 85, and for example, a paper supply tray 7092 is disposed at a lower part of the printer 7010 and a fixing unit 7090 is disposed at an upper part of the printer 7010.

<Mounting and Dismounting Configuration>

Developing containers 7051, 7052, 7053, and 7054, which are examples of developing devices, and a photoconductor unit 7075 can be mounted to and dismounted from a printer main unit 7010*a*, which is an example of an image forming apparatus main unit. The printer 7010 is configured by mounting the developing containers 7051, 7052, 7053, and 7054 and the photoconductor unit 7075 to the printer main unit 7010*a*.

The printer main unit 7010*a* has a first opening cover 7010*b* that can be opened and closed, a second opening cover 7010*c* that can be opened and closed and that is provided further inward than the first opening cover 7010*b*, a photoconductor unit mounting and dismounting opening 7010*d* through which the photoconductor unit 7075 can be mounted and dismounted, and a developing container mounting and dismounting opening 7010*e* serving as an opening through which the developing containers 7051, 7052, 7053, and 7054 can be mounted and dismounted.

Here, by opening the first opening cover 7010*b*, the user can mount and dismount the photoconductor unit 7075, which is devised as a cartridge, with respect to the printer main unit 7010*a* through the photoconductor unit mounting and dismounting opening 7010*d*. Further, by opening the second opening cover 7010*c*, the user can mount and dismount the developing containers 7051, 7052, 7053, and 7054, which are devised as cartridges, with respect to the printer main unit 7010*a* through the developing container mounting and dismounting opening 7010*e*.

<Configuration of the Printer 7010>

The configuration of the printer 7010 in a state in which the developing containers 7051, 7052, 7053, and 7054 and the photoconductor unit 75 are mounted to the printer main unit 7010*a* is described.

As shown in FIG. 85, the printer 7010 according to this embodiment includes a charging unit 7030, an exposing unit 7040, a developing container holding unit 7050, an image transfer unit 7060, a decharging unit 7070, and a cleaning blade 7076. These units are arranged along the rotation direction of a photoconductor 7020, which is an example of an image bearing member bearing a latent image. The printer 7010 further includes a fixing unit 7090, a display unit 7095 constituted by a liquid-crystal panel and serving as a means for giving notifications to the user, a control unit 7100 (see FIG. 86) for controlling these units and managing the operations of the printer, and a power source unit 7098 covered by a power source shielding member 7098*a*.

The photoconductor 7020 has a hollow cylindrical conductive base and a photoconductive layer formed on the outer circumferential surface of the conductive base, and is rotatable around its center axis. In the present embodiment, the photoconductor 7020 rotates clockwise, as indicated by the arrow in FIG. 86. The charging unit 7030 is a device for charging the photoconductor 7020. In the present embodiment, the photoconductor 7020, the cleaning blade 7076, and the charging unit 7030 are configured as one photoconductor unit 7075 provided with a waster toner container.

The exposing unit 7040 is a device for forming a latent image on the photoconductor 7020, which has been charged by irradiating a laser beam on the photoconductor 7020. The exposing unit 7040 includes, for example, a semiconductor laser, a polygon mirror, and an F-θ lens, and irradiates a modulated laser beam onto the charged photoconductor 7020 in accordance with image signals that have been input from a host computer, not shown in the drawings, such as a personal computer or a word processor.

The developing container holding unit 7050 is a device for developing the latent image formed on the photoconductor 7020 using toner T, which is an example of a developer contained in developing containers 7051, 7052, 7053, and 7054, that is, black (K) toner contained in a black developing container 7051, magenta (M) toner contained in a magenta developing container 7052, cyan (C) toner contained in a cyan developing container 7053, and yellow (Y) toner contained in a yellow developing container 7054.

This developing container holding unit 7050 includes a rotation shaft 7050*e* and four mounting and dismounting sections 7050*a*, 7050*b*, 7050*c*, and 7050*d* with respect to which the developing containers 7051, 7052, 7053, and 7054 can be mounted and dismounted and which are disposed at intervals of 90° in circumferential direction around the rotation shaft. The mounting and dismounting sections 7050*a*, 7050*b*, 7050*c*, and 7050*d* are moved by rotating the developing container holding unit 7050 around the rotation shaft 7050*e*.

Each of the mounting and dismounting sections 7050*a*, 7050*b*, 7050*c*, and 7050*d* is provided with the same space, partitioned by two neighboring wall sections 7050*f* of the four wall sections 7050*f* formed at intervals of 90° in four radial directions from the rotation shaft 7050*e* provided in the middle of the developing container holding unit 7050. That is to say, the mounting and dismounting section 7050*a* with respect to which the black developing container 7051 can be mounted and dismounted, the mounting and dismounting section 7050*b* with respect to which the magenta developing container 7052 can be mounted and dismounted, the mounting and dismounting section 7050*c* with respect to which the cyan developing container 7053 can be mounted and dismounted, and the mounting and dismounting section 7050*d* with respect to which the yellow developing container 7054 can be mounted and dismounted are disposed at intervals of 90° in circumferential direction around the rotation shaft 7050*e* in the developing container holding unit 7050.

In this embodiment, the positions of the four developing containers 7051, 7052, 7053, and 7054 can be moved by shifting the mounting and dismounting sections 7050*a*, 7050*b*, 7050*c*, and 7050*d*. That is to say, the four developing containers 7051, 7052, 7053, and 7054 can be rotated around the rotation shaft 7050*e* while maintaining their relative positions. Then, when the developing containers 7051, 7052, 7053, and 7054 are mounted to the mounting and dismounting sections 7050*a*, 7050*b*, 7050*c*, and 7050*d* and are moved to the developing position through the movement of the mounting and dismounting sections 7050*a*, 7050*b*, 7050*c*, and 7050*d*, the latent image borne by the photoconductor 7020 is developed with the toner contained in the respective developing containers 7051, 7052, 7053, and 7054 together with a carrier. It should be noted that details of the developing containers are discussed later.

As shown in FIG. 87, the mounting and dismounting sections 7050*a*, 7050*b*, 7050*c*, and 7050*d* are each provided with coupling holes 7059 into which coupling protrusions (not shown in the drawings) provided on the upstream side of the developing containers can be fitted, guiding sections 7056 for guiding the developing containers by engaging with a guided section 7549 provided on the developing containers that are inserted from the developing container mounting and dismounting opening 7010*e*, and springs 7576 for biasing the developing containers toward the outer circumferential direction of the developing container holding unit 7050.

And as shown in FIG. 89, the guiding sections 7056 are provided on each of the two wall sections 7050*f* constituting the mounting and dismounting section. The guiding sections 7056 have perpendicular surfaces formed on the two wall sections 7050*f* and are arranged extending along the longitudinal direction of the yellow developing container 7054, protruding on the side of the same space partitioned by the two adjacent wall sections 7050*f*. That is to say, the guiding sections 7056, which are provided on adjacent wall sections 7050*f* facing toward the same space, are formed such that their surfaces both face toward the rotation shaft 7050*e* and their surfaces define an angle of substantially 90°. The yellow developing container 7054 is mounted by arranging the guided sections 7549 of the yellow developing container 7054 such that they are on the side of the rotation shaft 7050*e* with respect to the two perpendicular surfaces of the guiding sections 7056, and inserting the guided sections 7549 along the guiding sections 7056.

The springs 7576 provided on the mounting and dismounting section 7050*d* bias the yellow developing container 7054 toward the outer circumferential direction of the developing container holding unit 7050. Thus, when the yellow developing container 7054 is inserted from the developing container mounting and dismounting opening 7010*e* with the guided sections 7549 being arranged on the side of the rotation shaft 7050*e* with respect to the perpendicular surfaces of the guiding sections 7056, the yellow developing container 7054 is biased by the springs 7576 toward the outer circumferential direction.

Then, positioning pins (not shown in the drawings) respectively provided on the downstream side of the developing containers fit into corresponding positioning holes 7058 shown in FIG. 87, and the yellow developing container 7054 is positioned in its predetermined position and mounted by fitting a coupling protrusion provided on the upstream side of the yellow developing container 7054 into a coupling hole 7059 provided on the mounting and dismounting section 7050*d*, as shown in FIG. 88.

The image transfer unit 7060 includes an image transfer drum 7061 made of a dielectric film that is provided in opposition to the photoconductor 7020 and is for electrostatically adsorbing paper serving as the medium to be carried, and a transfer corotron 7062 that is disposed inside the image transfer drum 7061 and is for applying to the paper a charge of a polarity that is opposite to that of the toner from the rear side of the adsorbed paper. That is to say, the carried paper is electrostatically adsorbed to the image transfer drum 7061, and at the position opposite to the developing roller 7510, the monochrome toner image formed on the photoconductor 7020 is transferred to the paper. Then, when the four toner images have been successively transferred, a full-color toner image is formed on the paper. This image transfer drum 61 is rotatively driven at substantially the same speed as the photoconductor 7020.

The fixing unit 7090 is a device for fusing the single-color toner image or the full-color toner image, which has been formed on the paper, and to turn it into a permanent image.

The decharging unit 7070 is a device for removing the electrical potential of the photoconductor 7020 after the image transfer. The cleaning blade 7076 is made of rubber and is in contact with the surface of the photoconductor 7020. The cleaning blade 7076 scrapes off and removes toner remaining on the photoconductor 7020, after the toner image has been transferred onto the paper by the image transfer unit 7060.

The photoconductor unit 7075 is provided between the image transfer unit 7060 and the exposing unit 7040, and includes the photoconductor 7020, the decharging unit 7070, the cleaning blade 7076, and a waste toner container not shown in the drawings containing toner that has been scraped away by the cleaning blade 7076.

The control unit 7100 is made of a main controller 7101 and a unit controller 7102, as shown in FIG. 86. An image signal is input into the main controller 7101, and in accordance with a command based on this image signal, the unit controller 7102 controls the various units, for example, to form the image.

<Operation of the Printer 7010>

The operation of the printer 7010 configured as above is described below, referring to other structural components thereof as well.

First, when an image signal from a host computer not shown in the drawings is input into the main controller 7101 of the printer 7010 via an interface (I/F) 7112, the photoconductor 7020, the developing rollers 7510 provided in the developing containers 7051, 7052, 7053, and 7054, and the image transfer drum are rotated under the control of the unit controller 7102 based on a command from the main controller 7101. While rotating, the photoconductor 7020 is successively charged by the charging unit 7030 at a charging position.

The region of the photoconductor 7020 that has been charged is brought to an exposure position through rotation of the photoconductor 7020, and a latent image corresponding to image information of a first color, for example yellow Y, is formed at that region by the exposing unit 7040. Moreover, the developing container holding unit 7050 positions the yellow developing container 7054 containing the yellow (Y) toner at the developing position opposite the photoconductor 7020.

The latent image formed on the photoconductor 7020 is brought to a developing position through the rotation of the photoconductor 7020, and is developed with yellow toner by the yellow developing container 7054. Thus, a yellow toner image is formed on the photoconductor 7020. The yellow toner image that is formed on the photoconductor 7020 is brought to the image transfer position through rotation of the photoconductor 7020 and is transferred to paper by the image transfer unit 7060.

The above process is repeated for a second color, a third color, and a fourth color, thereby transferring toner images of four colors corresponding to various image signals layered over one another onto the paper. Thus, a full color toner image is formed on the paper.

The full-color toner image formed on the paper is moved by rotating the image transfer drum 7061. Then, the paper is stripped off the image transfer drum 7061 by a wedge-shaped stripping tongue 7063 whose front end contacts against the image transfer drum 7061, and carried towards the fixing unit 7090.

The full-color toner image on the paper that has reached the fixing unit 7090 is turned into a permanent image by fusing it through the application of heat and pressure with the fixing unit 7090. On the other hand, after the photoconductor 7020 has passed the image transfer unit 7060 and after the charge has been removed by the decharging unit 7070, the toner adhering to its surface is scraped off by the cleaning blade 7076 and it is provided with a charge for forming the next latent image. The toner that is scraped off is collected in the waste toner container.

===Overview of the Control Unit===

The configuration of the control unit 7100 is described next, with reference to FIG. 86. The control unit 7100 includes the main controller 7101 and the unit controller 7102.

The main controller 7101 includes a CPU 7111, an interface 7112 for connection to a computer not shown in the drawings, an image memory 7113 for storing image signals input from the computer, and a main controller-side memory 7114 made of an EEPROM 7114*a* that can be rewritten electrically, a RAM 7114*b*, and a program ROM or the like in which a program for the various kinds of control is stored.

The CPU 7111 of the main controller 7101 controls the reading in and the reading out of image data that has been input via the interface into the image memory 7113, and performs the control of the overall apparatus in synchronization with the CPU 7120 of the unit controller 7102 based on the control signals input from the computer.

The unit controller 7102 includes the CPU 7120, a unit controller-side memory 7116 including an EEPROM 7116*a* that can be rewritten electrically, a RAM, and a program ROM or the like in which a program for the various kinds of control is stored, as well as drive control circuits or the like for performing drive control of the various units of the entire device (the charging unit 7030, the exposing unit 7040, the developing container holding unit 7050, the image transfer unit 7060, the photoconductor unit 7075, the decharging unit 7070, the fixing unit 7090, and the display unit 7095).

The CPU 7120 of the unit controller 7102 is electrically connected to the various drive control circuits and controls the various drive control circuits in accordance with control signals from the CPU 7111 of the main controller 7101. That is to say, while the state of the units is detected by receiving signals from sensors or the like provided in each of the units, the units are controlled in accordance with signals input from the main controller 7101.

Also, the CPU 7120 provided in the unit controller 7102 is connected to a non-volatile storage element (hereinafter, also referred to as "main unit-side memory") 7122 such as a serial EEPROM via the serial interface (I/F) 7121. This main unit-side memory 7122 stores data that is necessary for the control of the apparatus.

Furthermore, the CPU 7120 is capable of wirelessly communicating with communication units 7051*a*, 7052*a*, 7053*a*, and 7054*a*, which are respectively provided on the developing containers 7051, 7052, 7053, and 7054, via the serial interface 7121, a communication control module 7123 and an antenna unit 7124 serving as a main unit-side antenna. Through the communication of the antenna unit 7124 and the communication units 7051*a*, 7052*a*, 7053*a*, and 7054*a*, the control unit 7100 can write information into the communication units 7051*a*, 7052*a*, 7053*a*, and 7054*a* provided in the developing containers 7051, 7052, 7053, and 7054 as well as read in information from the communication units 7051*a*, 7052*a*, 7053*a*, and 7054*a* provided in the developing containers 7051, 7052, 7053, and 7054. The communication units 7051*a*, 7052*a*, 7053*a*, and 7054*a* are explained further below.

===Overview of the Developing Containers===

A developer D, which is used in the printer 7010 of this embodiment, is a two-component developer in which a non-magnetic toner is mixed with a magnetic carrier. The developing containers 7051, 7052, 7053, and 7054 mix and stir this developer in their interior and the latent image written onto the photoconductor 7020 is developed by the so-called magnetic brush developing method.

Figure 90:
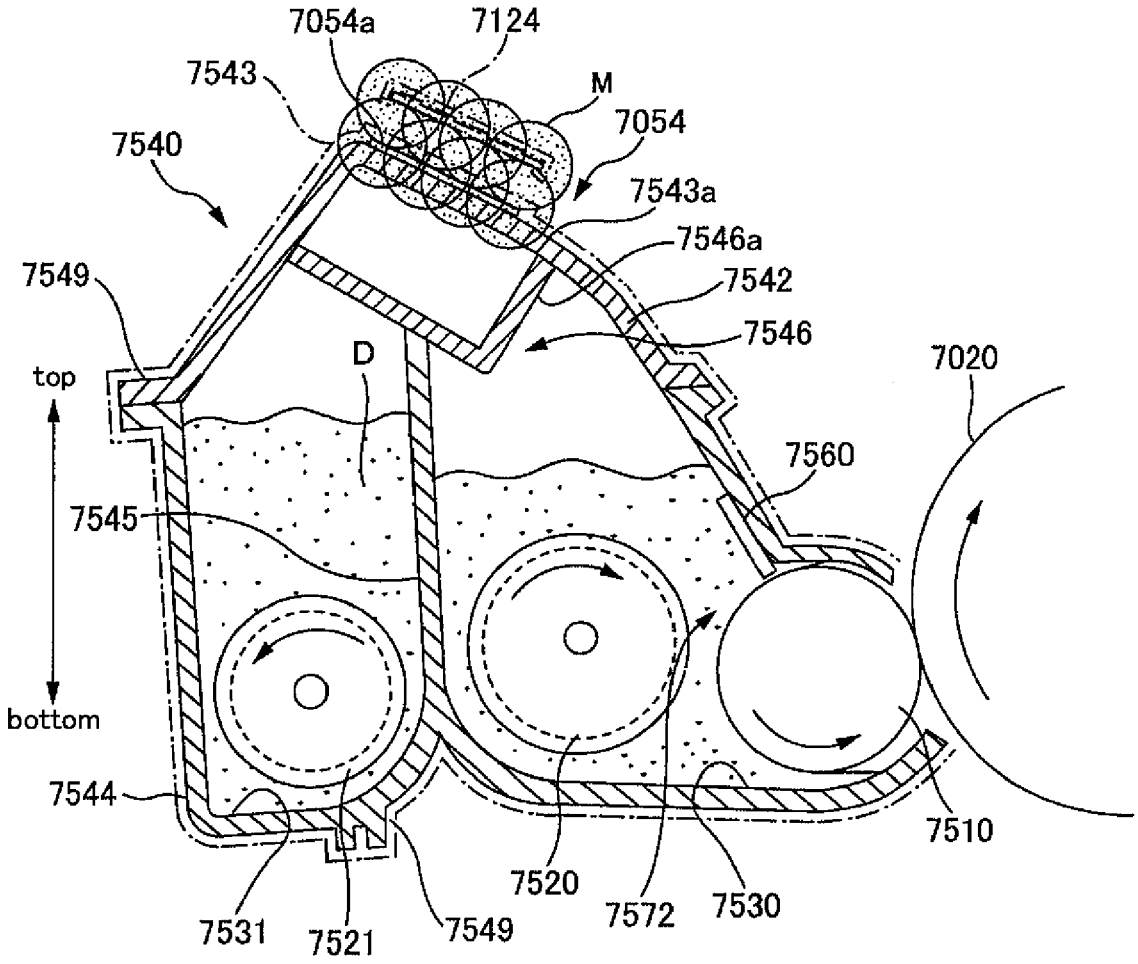
FIG. 90 is a cross-sectional view showing the main structural components of the yellow developing container 7054.

The configuration and operation of the developing containers 7051, 7052, 7053 and 7054 is explained with reference to FIG. 90. FIG. 90 is a cross-sectional view showing the main structural components of the yellow developing container 7054. In FIG. 90, as in FIG. 84, the vertical direction is indicated by arrows. Also, in FIG. 90, the yellow developing container 7054 is shown positioned at a developing position that is in opposition to the photoconductor 7020.

The black developing container 7051 containing black (K) toner, the magenta developing container 7052 containing magenta (M) toner, the cyan developing container 7053 containing cyan (C) toner, and the yellow developing container 7054 containing yellow (Y) toner can be mounted to the developing container holding unit 7050, but since the configuration and the operation of each of the developing containers is the same, explanations are given only for the yellow developing container 7054 in the following.

<Internal Configuration of the Yellow Developing Container 7054>

First, the configuration of the yellow developing container 7054 is described. The yellow developing container 7054 includes a developing roller 7510, which is an example of a developer carrying member, a regulating blade 7560, a housing 7540 serving as a developer containing section forming a first developer containing section 7530 and a second developer containing section 7531, and augers 7520 and 7521 for carrying the developer while stirring it within the first developer containing section 7530 and the second developer containing section 7531.

The developing roller 77510 bears toner T and carries it to the developing position opposite the photoconductor 7020, and develops the latent image borne by the photoconductor 7020 with the toner T carried to the developing position. This developing roller 77510 includes a magnet roller with a plurality of magnetic poles, and a hollow cylindrical sleeve that rotates while covering the circumference of the magnet roller. By adsorbing polarized carriers in lines to the circumferential surface of the sleeve due to the magnetic force of the magnet roller, the developer D is held in the form of spikes, thus forming a so-called magnetic brush. Then, the developer D of this magnetic brush is carried with the rotation of the sleeve to the outside through a housing opening 7572 provided in the housing 7540, and the grains of developer D standing on the magnetic brush are rubbed onto the photoconductor 7020.

Inside the housing 7540, the regulating blade 7560 is disposed at a predetermined spacing to the developing roller 7510. The length of the spikes of the magnetic brush formed on the circumferential surface of the developing roller 7510 is adjusted to a predetermined length by the regulating blade 7560.

The housing 7540 is fabricated by welding together a plurality of integrally molded housing sections, namely an upper housing section 7542 and a lower housing section 7544. A communication unit 7054*a* is attached to an outer circumferential portion of the housing 7540. The housing 7540 has a housing opening 7572 at its bottom, and is arranged such that a portion of the developing roller 7510 is exposed in this housing opening 7572, as mentioned above.

The inside of the housing 7540 includes an intrusion prevention section 7546 for preventing the developer from intruding to a predetermined region by partitioning the interior side of the position where the communication unit 7054*a* is arranged from other regions. This intrusion prevention section 7546 is formed by a partitioning member 7546*a* that provides a partition so that the developer cannot intrude to the side of the inner surface where the communication unit 7054*a* is provided. A gap is formed by the interior that is enclosed by the partitioning member 7546*a* and the housing 7540.

Parallel to the axial direction of the developing roller 7510, the housing 7540 is provided with a partitioning wall 7545 that protrudes inward from an inner wall (in vertical direction in FIG. 90). Except for the region that is partitioned by the partitioning member 7546*a*, the space inside the housing 7540 is divided into two developer containing sections, namely the first developer containing section 7530 and the second developer containing section 7531. The partitioning wall 7545 is provided with respective connection openings (not shown in the drawings) on the upstream side and the downstream side in the mounting direction, and the first developer containing section 7530 and the second developer containing section 7531 are connected by these connection openings.

Moreover, the first auger 7520, which is formed with a screw shape adjacent to the developing roller 7510, is arranged in the first developer containing section 7530, which includes the developing roller 7510. By rotating in the direction of the arrow in FIG. 7, this first auger 7520 carries the developer D within the first developer containing section 7530 towards the upstream side (the side to the front in a direction perpendicular to the paper plane) with respect to the mounting direction of the developing container 7054. On the other hand, a second auger 7521, that is substantially the same as the first auger 7520, is arranged in the second developer containing section 7531, which is adjacent to the first developer containing section 7530 with the partitioning wall 7545 arranged between them. By rotating in the direction of the arrow in FIG. 90, this second auger 7521 carries the developer D inside the second developer containing section 7531 towards the downstream side (the side behind in a direction perpendicular to the paper plane) with respect to the mounting direction of the developing container 7054.

The first developer containing section 7530 and the second developer containing section 7531 are connected through the connection openings, so that the developer D that has been carried to the upstream side within the first developer containing section 7530 due to the rotation of the first auger 7520 is moved through the connection opening on the upstream side to the second developer containing section 7531. On the other hand, the developer D that has been carried to the downstream side within the second developer containing section 7531 due to the rotation of the second auger 7521 is moved through the connection opening on the downstream side to the first developer containing section 7530. That is to say, when the pair of first and second augers 7520 and 7521 is rotated by the developing containers 7051, 7052, 7053, and 7054, the developer D is circulated in a constant direction around the partitioning wall 7545, and this circulation not only stirs the developer D, but also enhances the frictional electrification of the toner.

===The Developing Position, Communication Position and Mounting and Dismounting Position of the Developing Containers===

Figure 91A:
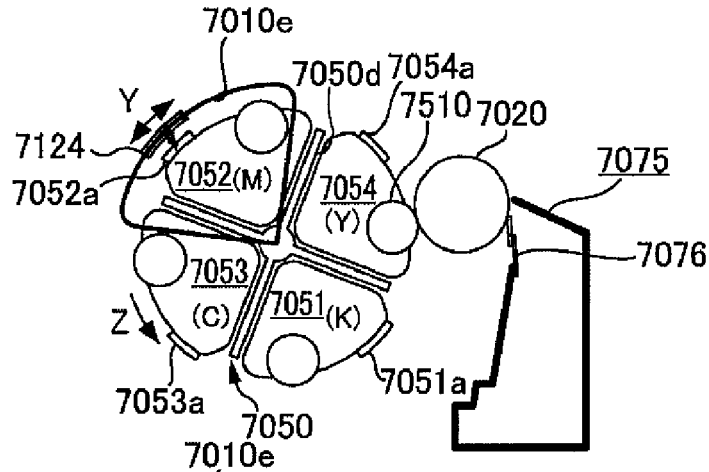
FIG. 91A is a diagram showing the developing container holding unit 7050 in a state where the yellow developing container 7054 is positioned at the developing position.
Figure 91B:
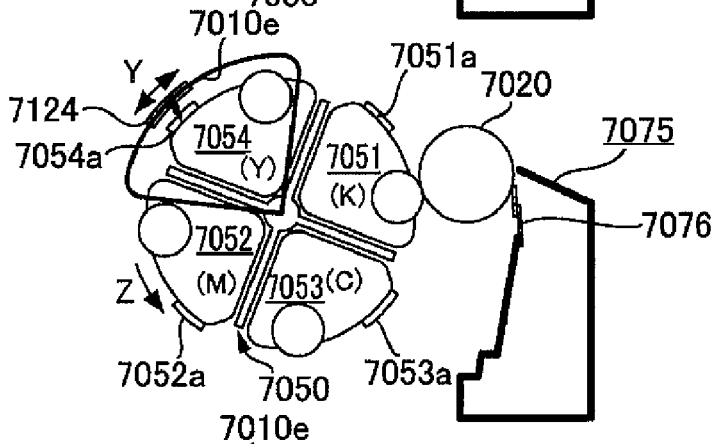
FIG. 91B is a diagram showing the developing container holding unit 7050 in a state where the yellow developing container 7054 is positioned at the communication position.
Figure 91C:
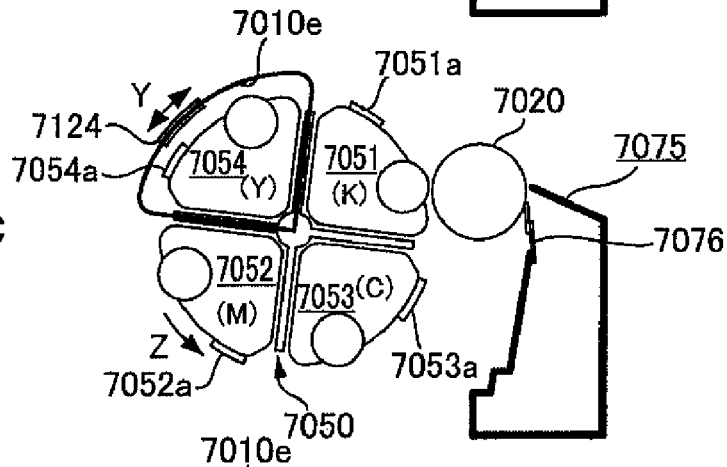
FIG. 91C is a diagram showing the developing container holding unit 7050 in a state where the yellow developing container 7054 is positioned at the mounting and dismounting position.
Figure 91D:
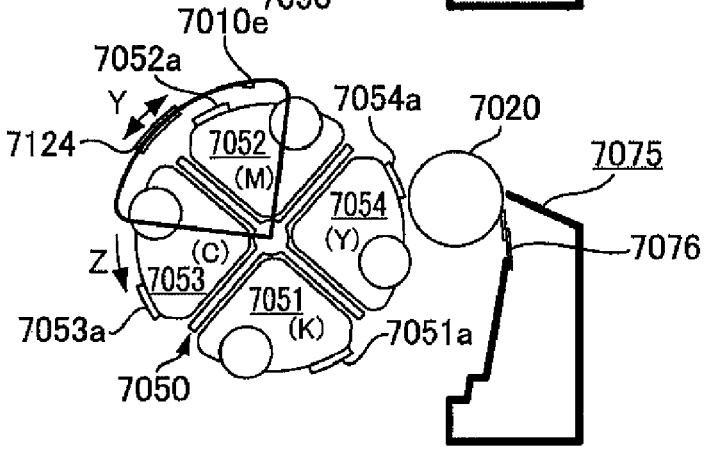
FIG. 91D is a diagram showing a state where the developing container holding unit 7050 is positioned in its home position.

As mentioned above, the developing containers 7051, 7052, 7053, and 7054 are moved together with the movement of the mounting and dismounting sections 7050*a*, 7050*b*, 7050*c*, and 7050*d*. At that time, the mounting and dismounting sections are moved such that the developing containers are positioned in predetermined positions. Such predetermined positions are the developing position, serving as a first position, the communication position, serving as a second position, and the mounting and dismounting position. Since the developing position, the communication position, and the mounting and dismounting position of each of the developing containers are the same, the developing position, the communication position, and the mounting and dismounting position of the yellow developing container 7054 are explained in the following with reference to FIGS. 91A to 91D. FIG. 91A is a diagram showing the developing container holding unit 7050 in a state where the yellow developing container 7054 is positioned at the developing position. FIG. 91B is a diagram showing the developing container holding unit 7050 in a state where the yellow developing container 7054 is positioned at the communication position. FIG. 91C is a diagram showing the developing container holding unit 7050 in a state where the yellow developing container 7054 is positioned at the mounting and dismounting position. FIG. 91D is a diagram showing a state where the developing container holding unit 7050 is positioned in its home position.

In the state shown in FIG. 91A, the yellow developing container 7054 is positioned at the developing position in which the developing roller 7510 is in opposition to the photoconductor 7020. In this state, the developing roller 7510 forming the magnetic brush rubs against the photoconductor 7020 with the spikes of the magnetic brush, so that the latent image borne on the photoconductor 7020 can be developed. In the state in which the yellow developing container 7054 is positioned in the developing position, as noted above, the springs 7576 provided in the mounting and dismounting section 7050*d* bias the yellow developing container main unit towards the outer circumferential side. It should be noted that in a state in which the yellow developing container 7054 is positioned in the developing position, the magenta developing container 7052 is positioned in the communication position.

Furthermore, when the developing container holding unit 7050 is rotated for a predetermined angle in Z-direction in FIG. 91A from the state shown in FIG. 91A around its rotation shaft 7050*e*, then the state shown in FIG. 91B is achieved. In the state shown in FIG. 91B, the yellow developing container 7054 is positioned in the communication position. In this state, the communication unit 7054*a* provided on the yellow developing container 7054 opposes the antenna unit 7124 in a noncontacting manner. This communication unit 7054*a* can then communicate with the antenna unit 7124. It should be noted that when the yellow developing container 7054 is positioned in the communication position, the black developing container 7051 is positioned in the developing position. Therefore, the communication between the antenna unit 7124 and the communication unit can take place while the black developing container 7051 develops the latent image borne on the photoconductor 7020.

Furthermore, when the developing container holding unit 7050 is rotated around its rotation shaft 7050*e* for a predetermined angle in Z-direction in FIG. 91B from the state shown in FIG. 91B, then the state shown in FIG. 91C is achieved. In the state shown in FIG. 91C, the yellow developing container 7054 is positioned in the mounting and dismounting position. In this state, the yellow developing container 7054 can be mounted and dismounted via the developing container mounting and dismounting opening 7010*e*, that is, the yellow developing container 7054 can be mounted to the mounting and dismounting section 7050*d* or it can be dismounted from the mounting and dismounting section 7050*d*.

It should be noted that after the power source of the printer main unit 7010*a* has been turned on and an initialization operation has been performed, and before the printer 7010 forms an image, the developing container holding unit 7050 is positioned in the home position shown in FIG. 91D.

===Configuration of the Communication Units===

Figure 92:
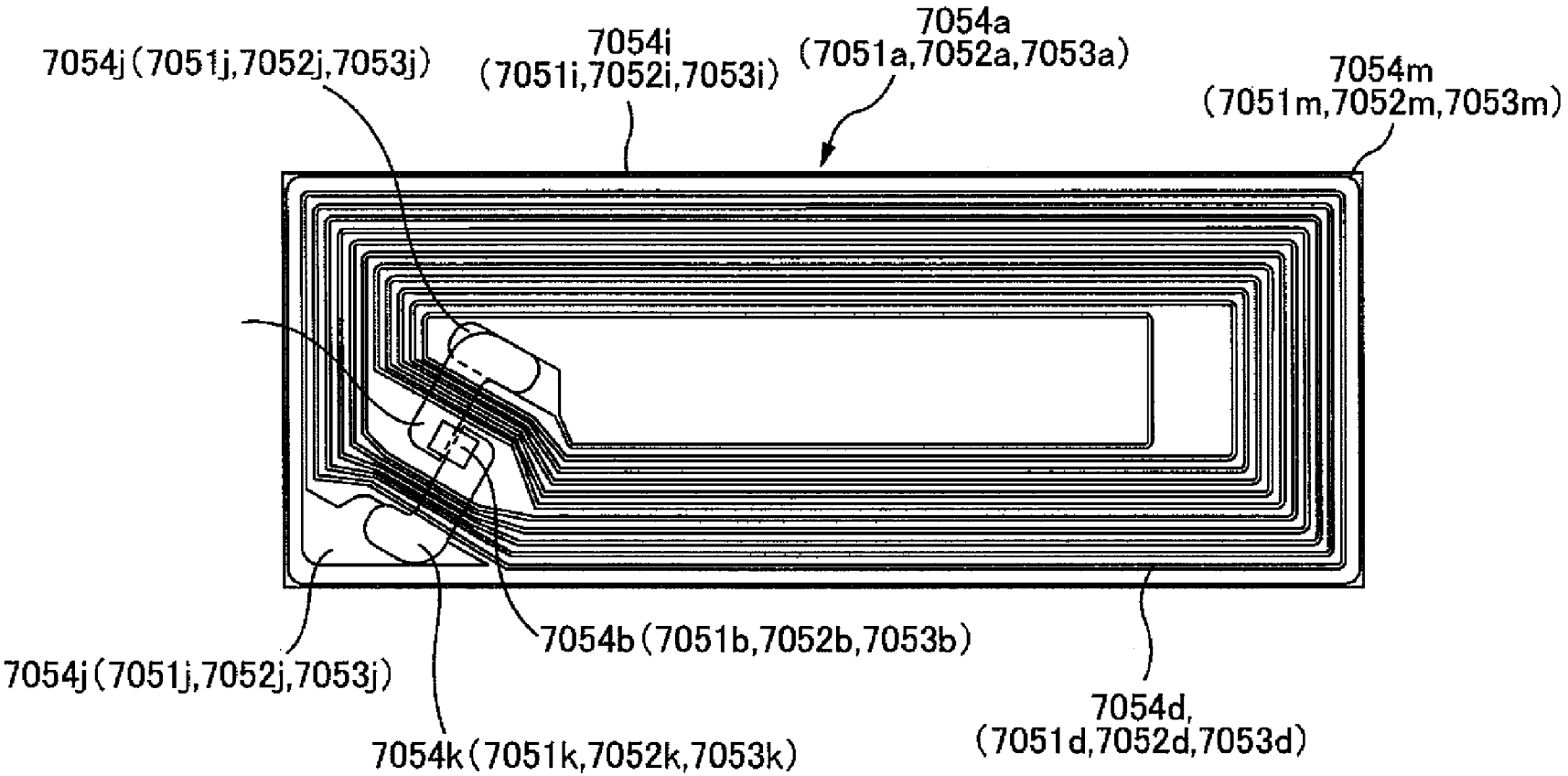
FIG. 92 is a plan view showing the configuration of the communication unit.
Figures 93, 94:
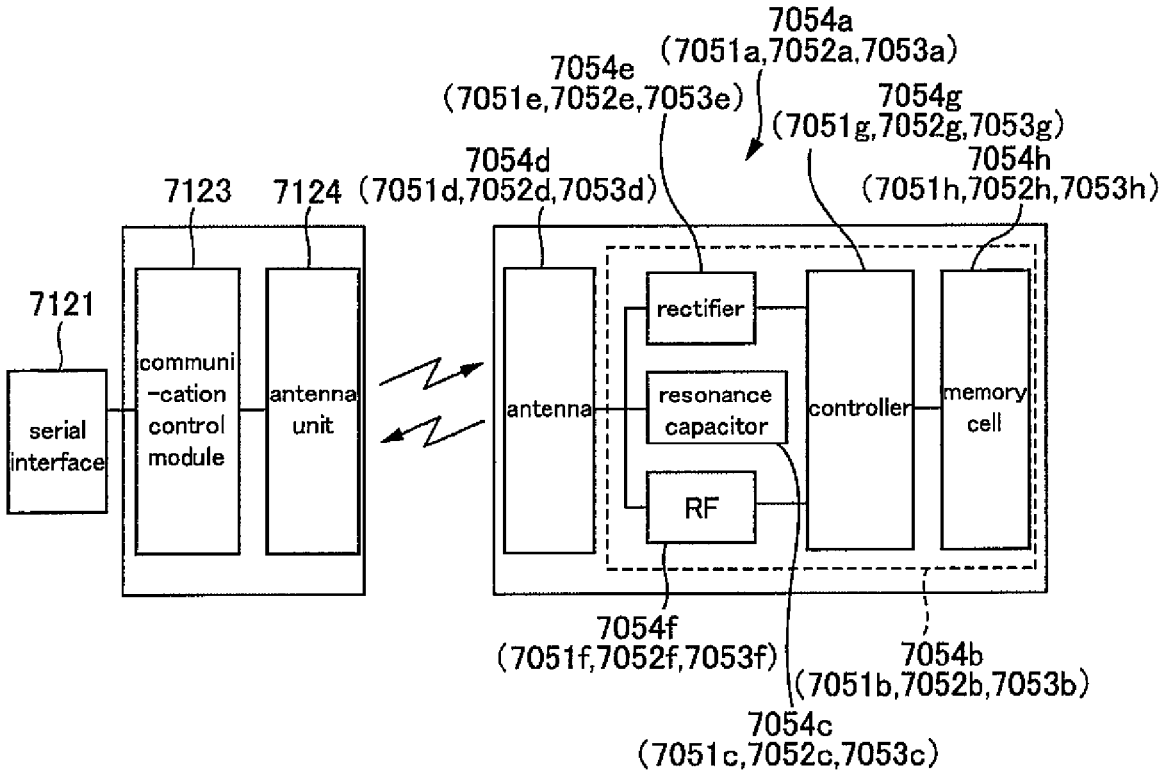
FIG. 93 is a block diagram illustrating the internal configuration of the communication unit and the send/receive section.
FIG. 94 is a diagram illustrating the information stored in a memory cell 7054*h* of the communication unit 7054*a*.

The configuration of the communication units provided in the developing containers as well as the configuration for sending and receiving data is described next with reference to FIG. 92, FIG. 93, and FIG. 94. FIG. 92 is a plan view showing the configuration of a communication unit. FIG. 93 is a block diagram illustrating the internal configuration of the communication unit and the send/receive section. FIG. 94 is a diagram illustrating the information stored in a memory cell 7054*h* of the communication unit 7054*a*.

Communication units are attached respectively to the developing containers 7051, 7052, 7053, and 7054, but since the configuration of the communication units attached to the developing containers and the positions at which the communication units are attached to the developing containers are the same for all developing containers, the following is an explanation taking the communication unit 7054*a* attached to the yellow developing container 7054 as an example.

When the yellow developing container 7054 is mounted to the mounting and dismounting section 7050*d*, the communication unit 7054*a* can communicate with the antenna unit 7124 on the side of the printer main unit 7010*a* in a noncontacting manner. As mentioned above, the yellow developing container 7054 is moved by the movement of the mounting and dismounting section 7050*d*. When the yellow developing container 7054 has been moved to the communication position, which is different from the developing position, the communication unit 7054*a* communicates in a noncontacting manner with the antenna unit 7124 with which the printer main unit 7010*a* is provided. The communication unit 7054*a* is provided inward of the antenna unit 7124 in radial direction with respect to the center of the rotation shaft 7050*e* of the developing container holding unit 7050.

The communication unit 7054*a* includes a thin plate-shaped substrate 7054*i* serving as a substrate made of a thin plate-shaped piece of plastic that is flexible in its longitudinal direction, an antenna 7054*d* serving as a container-side antenna made by arranging copper foil in a rectangular planar coil shape, antenna terminals 7054*j* provided on both ends of the antenna, a non-contact IC chip 7054*b* including a memory and serving as an element for communicating with an external antenna, two coupling sections 7054*k* made of aluminum that connect the chip terminals of the non-contact IC chip 7054*b* with the antenna terminals 7054*j*, and a film-shaped protective sheet 7054*m* covering these elements, and sandwiching them together with the thin plate-shaped substrate 7054*i*.

As shown in FIG. 92, one antenna terminal 7054*j* of the antenna 7054*d* is arranged at one end in the longitudinal direction of the rectangular thin plate-shaped substrate 7054*i*, the antenna 7054*d* is wrapped about ten times in a coil shape along the outer shape of the thin plate-shaped substrate 7054*i*, and the other antenna terminal 7054*j* is provided to the inner side of the antenna 7054*d*. The outer antenna terminal 7054*j* and the inner antenna terminal 7054*j* are both provided on the same side in the longitudinal direction of the thin plate-shaped substrate 7054*i*. On the thin plate-shaped substrate 7054*i*, the ten copper foil structures of the antenna 7054*d* are lined up next to each other along the vertical and horizontal edges of the rectangular shape, and are divided into five each on that side of the thin plate-shaped substrate 7054*i* where the antenna terminals 7054*j* are provided, the non-contact IC chip 7054*b* being arranged between these. Furthermore, two coupling sections 7054*k* connecting chip terminals (not shown in the drawings) provided on the non-contact IC chip 7054*b* with the antenna terminals 7054*j* are provided, respectively straddling five copper foil structures. That is to say, on the thin plate-shaped substrate 7054*i*, the non-contact IC chip 7054*b*, two antenna terminals 7054*j*, and two coupling sections 7054*k* are provided on one end in longitudinal direction, and the copper foil structures serving as the antenna 7054*d* are guided around the remaining region, except for the center.

The communication unit 7054*a* is positioned downstream with respect to the mounting direction of the yellow developing container 7054, in the longitudinal direction of the yellow developing container main unit. In this situation, the communication unit 7054*a* is arranged such that the end where the non-contact IC chip 7054*b* is provided is arranged on the upstream side of the communication unit 7054*a* with respect to the mounting direction.

Moreover, the communication unit 7054*a* is attached to an outer surface 7543 of the housing 70540, which is provided extending in the longitudinal direction of the housing 70540. Here, the outer surface 7543 refers to the part of the housing 7540 corresponding to the dash-dotted line in FIG. 90. It should be noted that this outer surface 7543 includes a circularly arc-shaped surface 7543*a*, whose cross section through a perpendicular plane that is perpendicular to the longitudinal direction of the housing 7540 is circularly arc-shaped. This circularly arc-shaped surface 7543*a* is arranged such that its circular arc extends along the rotation direction of the developing container holding unit 7050 when the yellow developing container 7054 is mounted to the mounting and dismounting section 7050*d*. As shown in FIG. 90, the communication unit 7054*a* is attached at a position of the circularly arc-shaped surface 7543*a* that is furthest removed from the developing roller 7510.

Figure 95:
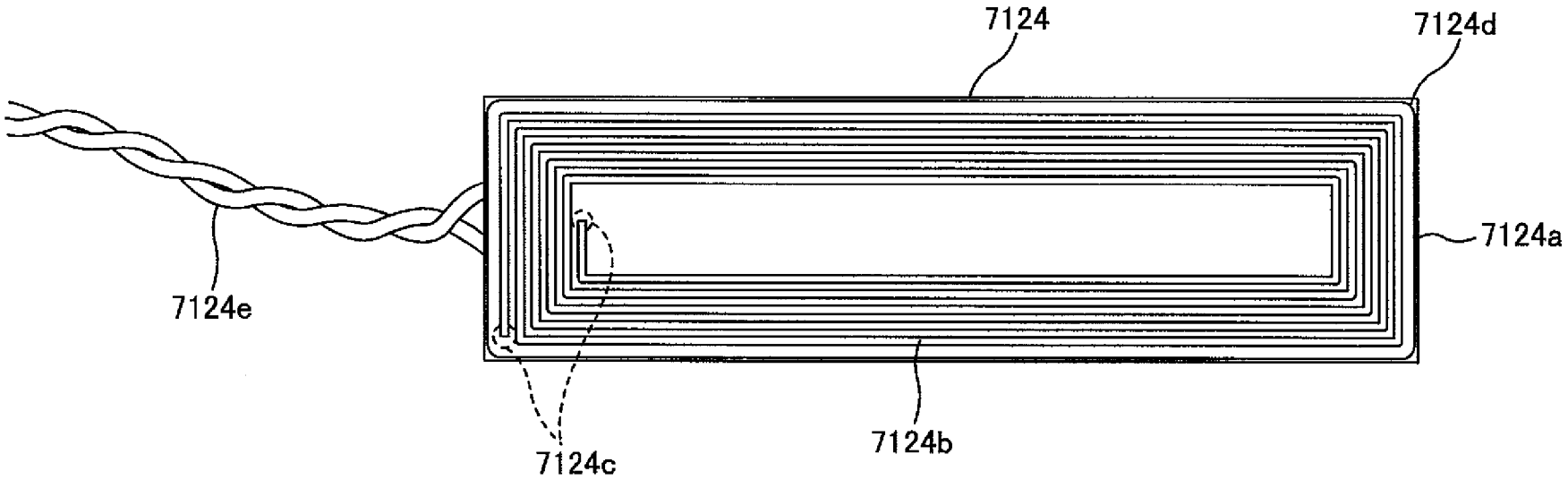
FIG. 95 is a diagram illustrating the antenna unit 7124.
Figure 96:
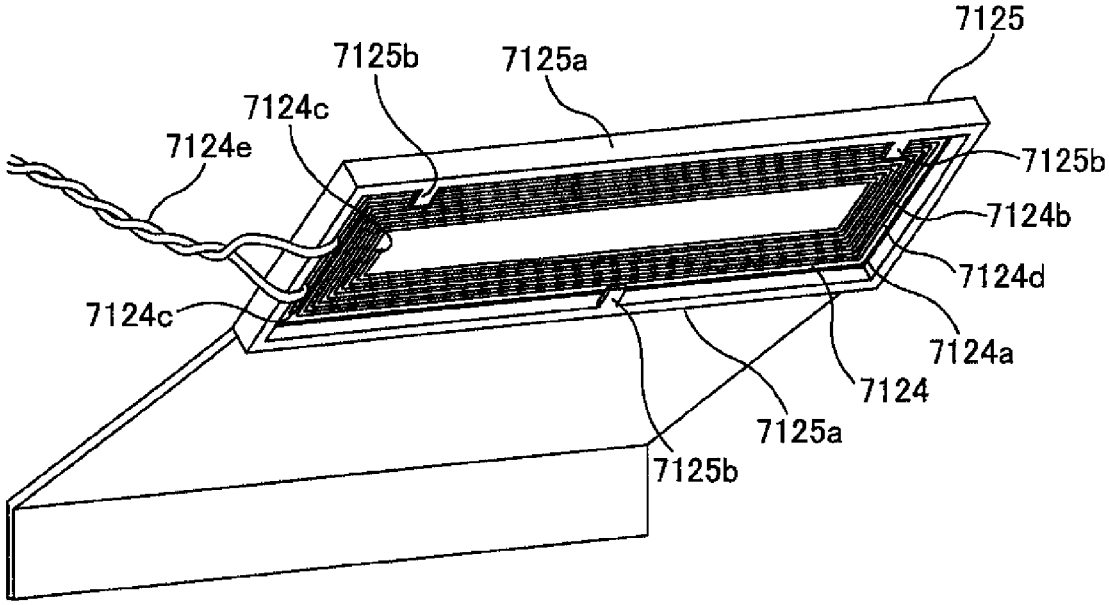
FIG. 96 is a diagram illustrating how the antenna unit is installed in a holder.

FIG. 95 is a diagram illustrating the antenna unit 7124. FIG. 96 is a diagram illustrating how the antenna unit is attached to a holder. The antenna unit 7124 provided on the side of the printer main unit 7010*a* includes a substrate 7124*a* that is formed on a plate material made of resin, an antenna 7124*b* serving as a main unit-side antenna that is made of copper foil wrapped in a planar coil shape along the outer shape of the substrate 7124*a*, substantially as in the communication unit 7054*a*, antenna terminals 7124*c* provided at the ends of the antenna 7124*b*, and a film-shaped protective sheet 7124*d*. Furthermore, the two antenna terminals 7124*c* are each connected to a wire 7124*e* and connected to the control unit 7100 via the communication control module 7123. Here, the antenna unit 7124 of the present embodiment is configured having a protective sheet 7124*d*, but it is not necessarily required to provide the protective sheet 7124*d*.

When the mounted yellow developing container 7054 has been arranged in the communication position, the antenna 7054*d* of the communication unit 7054*a* and the antenna 7124*b* of the antenna unit 7124 are arranged at positions facing each other. Moreover, the antenna unit 7124 is fixed via a holder 7125 made of resin to the printer main unit 7010*a*.

The holder 7125 is box-shaped, covering the surroundings of the antenna unit 7124 as well as the sides of the substrate 7124*a* and open on one side, and is arranged such that the antenna 7124*b* faces the outside from the open side. At the edges of the open side of the holder 7125, flexible tongues 7125*b* protruding toward the inside are provided on opposing side walls 7125*a*. The antenna unit 7124 is accommodated inside the box-shaped holder 7125 and is held there by the tongues 7125*b*. That is to say, the antenna unit 7124 is held only by the holder 7125 made of resin, so that metal components such as screws are not required to fasten the antenna unit 7124.

If the communication unit 7054*a* and the antenna unit 7124 are in a predetermined positional relationship, for example, if they are within a distance of 10 mm of one another, then information can be exchanged in a noncontacting manner between the two. The communication unit 7054*a* is overall very compact and thin, and one of its sides is adhesive and can be adhered to an object as a seal. It is also called a memory tag, for example, and is commercially available in various forms.

As shown in FIG. 93, the non-contact IC chip 7054*b* includes a resonance capacitor 7054*c*, a rectifier 7054*e*, a signal analysis section RF (Radio Frequency) 7054*f*, a controller 7054*g*, and the memory cell 7054*h*. The memory cell 7054*h* is a non-volatile memory that can be electrically read and written, such as an NAND flash ROM, and is capable of storing information that has been written on it and reading stored information from the outside.

The antenna 7054*d* of the communication unit 7054*a* and the antenna unit 7124 communicate wirelessly with one another, so that information stored in the memory cell 7054*h* can be read and information can be written to the memory cell 7054*h*. Also, the high-frequency signals that are generated by the communication control module 7123 of the printer main unit 7010*a* are induced as a high-frequency magnetic field via the antenna unit 7124. This high-frequency magnetic field is absorbed via the antenna 7054*d* of the communication unit 7054*a* and is rectified by the rectifier 7054*e*, thus serving as a DC power source for driving the circuits in the non-contact IC chip 7054*b*.

The memory cell 7054*h* of the communication unit 7054*a* stores various types of information, as shown in FIG. 94. The address 00H stores unique ID information for each communication unit, such as the serial number of the communication unit, the address 01H stores the date when the yellow developing container 7054 was manufactured, the address 02H stores information for specifying the destination of the yellow developing container 7054, the address 03H stores information for specifying the manufacturing line on which the yellow developing container 7054 was manufactured, the address 04H stores information for specifying models with which the yellow developing container 7054 is compatible, the address 05H stores remaining toner amount information as information indicating the amount of toner that is contained in the yellow developing container 7054, and the address 06H and subsequent regions also store information as appropriate.

The ID information that is stored in the memory cell 7054*h* of the communication unit 7054*a* can be written at the time that the storage communication unit is manufactured in the factory. By reading this ID information with the printer main unit 7010*a*, it is possible to identify the individual communication units 7054*a*, 7051*a*, 7052*a*, and 7053*a*.

It should be noted that it is also possible to let the antenna unit 7124 communicate wirelessly with the communication unit 7054*a* not only when the developing container holding unit 7050 is standing still but also when the developing container holding unit 7050 is moving. That is, the antenna unit 7124 may be able to communicate wirelessly with the communication unit 7054*a* even when the communication unit 7054*a* is moving.

===Communication Distance and Communication Region of Communication Units and Antenna Unit===

Figure 97:
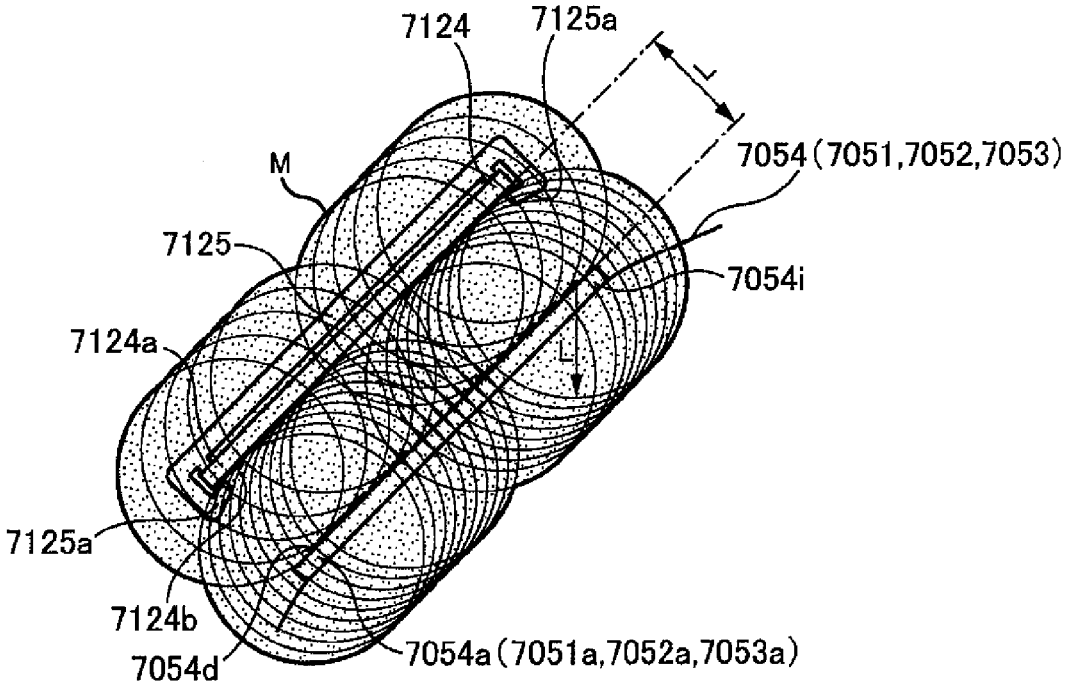
FIG. 97 is a cross-sectional view, taken from a direction perpendicular to the mounting direction, illustrating the communication distance and the communication region of the communication units and the antenna unit.
Figure 98:
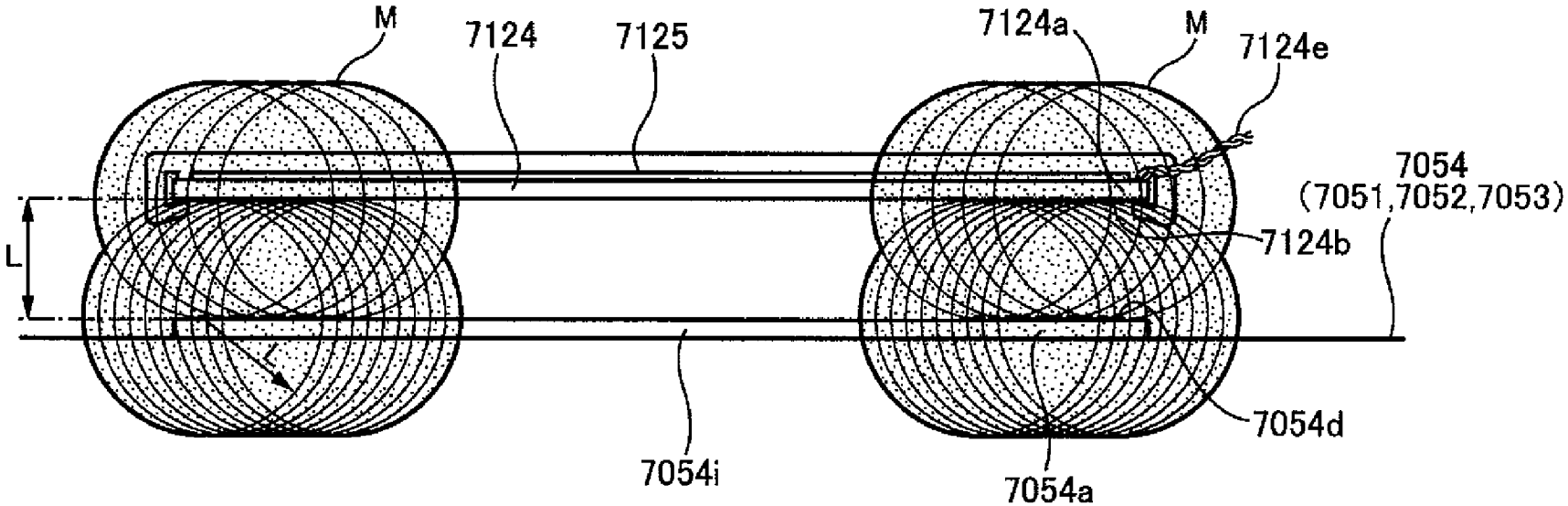
FIG. 98 is a cross-sectional view, taken from a direction parallel to the mounting direction, illustrating the communication distance and the communication region of the communication units and the antenna unit.

FIG. 97 is a cross-sectional view, taken from a direction perpendicular to the mounting direction, illustrating the communication distance and the communication region of the communication units and the antenna unit. FIG. 98 is a cross-sectional view, taken from a direction parallel to the mounting direction, illustrating the communication distance and the communication region of the communication units and the antenna unit.

As shown in these drawings, the communication units 7051*a*, 7052*a*, 7053*a*, and 7054*a* and the antenna unit 7124 are spaced apart by a communication distance L. The communication units 7051*a*, 7052*a*, 7053*a*, and 7054*a* are provided, respectively, on the developing containers 7051, 7052, 7053, and 7054. They are held by the developing container holding unit 7050 and are moved by rotating the developing container holding unit 7050 around its rotation shaft 7050*e*. For this reason, the antenna unit 7124, which is provided on the side of the printer main unit 7010*a*, is arranged at a position where it does not come into contact with the portion protruding furthest outward when the developing container holding unit 7050 holding the developing containers 7051, 7052, 7053, and 7054 rotates.

The communication units 7051*a*, 7052*a*, 7053*a*, and 7054*a* and the antenna unit 7124 are arranged such that they face each other at the above-mentioned communication position, preferably spaced apart at a communication distance L of, for example, 10 mm, at which communication is possible. Moreover, the communication units 7051*a*, 7052*a*, 7053*a*, and 7054*a* do not include a power source, so that electric power is supplied to them through carrier waves from the antenna unit 7124. That is to say, electric power is supplied and signals are transmitted to the communication units 7051*a*, 7052*a*, 7053*a*, and 7054*a* through electromagnetic induction occurring between the planar coil-shaped antennas 7054*d* and 7124*b* with which the communication units 7051*a*, 7052*a*, 7053*a*, and 7054*a* and the antenna unit 7124 are respectively provided. For this reason, when the communication units 7051*a*, 7052*a*, 7053*a*, and 7054*a* and the antenna unit 7124 communicate, a magnetic flux occurs around the copper foils of the antennas 7051*d*, 7052*d*, 7053*d*, 7054*d* and 7124*b*. This magnetic flux occurring at the antenna 7124*b* of the antenna unit 7124 then has to reach the antennas 7051*d*, 7052*d*, 7053*d*, and 7054*d* of the communication units 7051*a*, 7052*a*, 7053*a*, and 7054*a*, which are removed by at least the communication distance L. That is to say, for the communication units 7051*a*, 7052*a*, 7053*a*, and 7054*a* and the antenna unit 7124 to communicate, it is necessary that magnetic flux can be generated in a region of the distance L around the copper foils of the antennas 7051*d*, 7052*d*, 7053*d*, 7054*d*, and 7124*b* (referred to as "communication region M" below). Considering the precision of the components of the communication units 7051*a*, 7052*a*, 7053*a*, and 7054*a* and the antenna unit 7124 or attachment errors when attaching components to the printer main unit 7010*a*, it is preferable that the radius L, which defines the communication distance L and the communication region M, is set to such a distance that favorable communication conditions can be ensured.

In the case of the present embodiment, around the communication units 7051*a*, 7052*a*, 7053*a* and 7054*a* and the antenna unit 7124, a region of the distance L from the center of the copper foil constituting the antennas of the communication units and the antenna of the antenna unit becomes the communication region M, as shown in FIG. 97 and FIG. 98.

Now, if there are conductive members within this communication region M, then the magnetic flux occurring in the antenna 7124*b* passes through the conductive members, so that eddy currents flow through these conductive members with the magnetic flux at the axial center and the carrier wave is attenuated significantly. For this reason, the configuration is such that no conductive members are present within the communication region M.

Now, in the printer 7010 of the present embodiment, a two-component developer made by mixing a non-magnetic toner serving as the developer D and a magnetic carrier is used. That is to say, the magnetic carrier included in the developer is a conductive member, so that carrier waves are also attenuated when developer is present within the communication region M.

More particularly, the developing containers of this embodiment are held by the developing container holding unit 7050, and the positions of the various developing containers are shifted by rotating the developing container holding unit 7050. That is to say, when the developing container holding unit 7050 is rotated once, each developing container is rotated once, too, and is returned to its original state after having been turned upside down. Therefore, it occurs that the developer migrates to the communication unit 7054*a*. Since the housing 7540 of the developing containers is made of resin, the developer tends to adhere to the inner circumferential surface of the developing containers due to static electricity when the developing containers are rotated. Then, when the developer including the conductive carrier adheres to the inner circumferential surface at the position where the communication unit 7054*a* is provided, there is the risk that favorable communication is not possible due to the adhering developer, even when the communication unit is positioned on top in the communication position and the developer is positioned below.

The developing container of the present embodiment includes the intrusion prevention section 7546 on the inner side of the position where the communication unit 7054*a* is provided, in order to partition it from the other regions. This intrusion prevention section 7546 is configured such that no developer intrudes into the region surrounded by the outer circumferential wall of the housing 7540 and the partitioning member 7546*a*. That is to say, in order to allow favorable communication, the partitioning member 7546*a* is provided so that it prevents the intrusion of the developer to the side of the communication unit 7054*a*, so that the outer edge of the partitioning member 7546*a* on the side of the developer is made larger than the communication region M. That is to say, the region that is partitioned by the partitioning member 7546*a* includes a region of a distance L from the antenna 7054*d* of the communication unit 7054*a*, and is a region that is broader than this region. Therefore, the magnetic flux generated by the antenna 7054*d* is also generated at least in a region of the distance L on the side of the antenna 7054*d* that is opposite with respect to the developing container. Thus, it is possible to let the magnetic flux reach the antenna 7124*b* on the main unit side that is arranged at a spacing of up to the distance L to the antenna 7054*d*, and to let the magnetic flux generated by the antenna 7124*b* on the main unit side reach the antenna 7054*d*. Therefore, it is possible to achieve favorable communication between the antenna 7124*b* on the main unit side and the antenna 7054*d*.

With the printer 7010 of the present embodiment, the intrusion prevention section 7546 is provided such that no developer intrudes into the communication region M inside the developing container, so that no conductive carrier obstructing communication is present inside the developing container in the communication region M of the communication units 7051*a*, 7052*a*, 7053*a*, and 7054*a* and the antenna unit 7124. For this reason, a printer 7010 can be realized, with which favorable communication between the communication units 7051*a*, 7052*a*, 7053*a*, 7054*a* and the antenna unit 7124 is possible.

In the foregoing embodiment, an example was described, in which the intrusion prevention section is formed by providing a partitioning member 7546 within the housing 7540 of the developing container, but also a configuration is possible in which a concave section for ensuring a region that includes the communication region M and is broader than this communication region M is arranged in the outer circumferential portion of the housing 7540, the intrusion prevention section is formed by providing a lid-shaped partitioning member covering this concave section from the outside, and the communication unit is provided on the outer surface of this lid-shaped partitioning member.

In the foregoing embodiment, an example was described, in which the partitioning member 7546*a* is provided inside the developing container, a gap is formed between the outer circumferential portion of the housing 7540 and the partitioning member 7546*a*, and a region that includes the communication region M and is broader than the communication region is partitioned into developer containing sections 7530 and 7531, but it is not necessarily required to form a gap.

Figure 99:
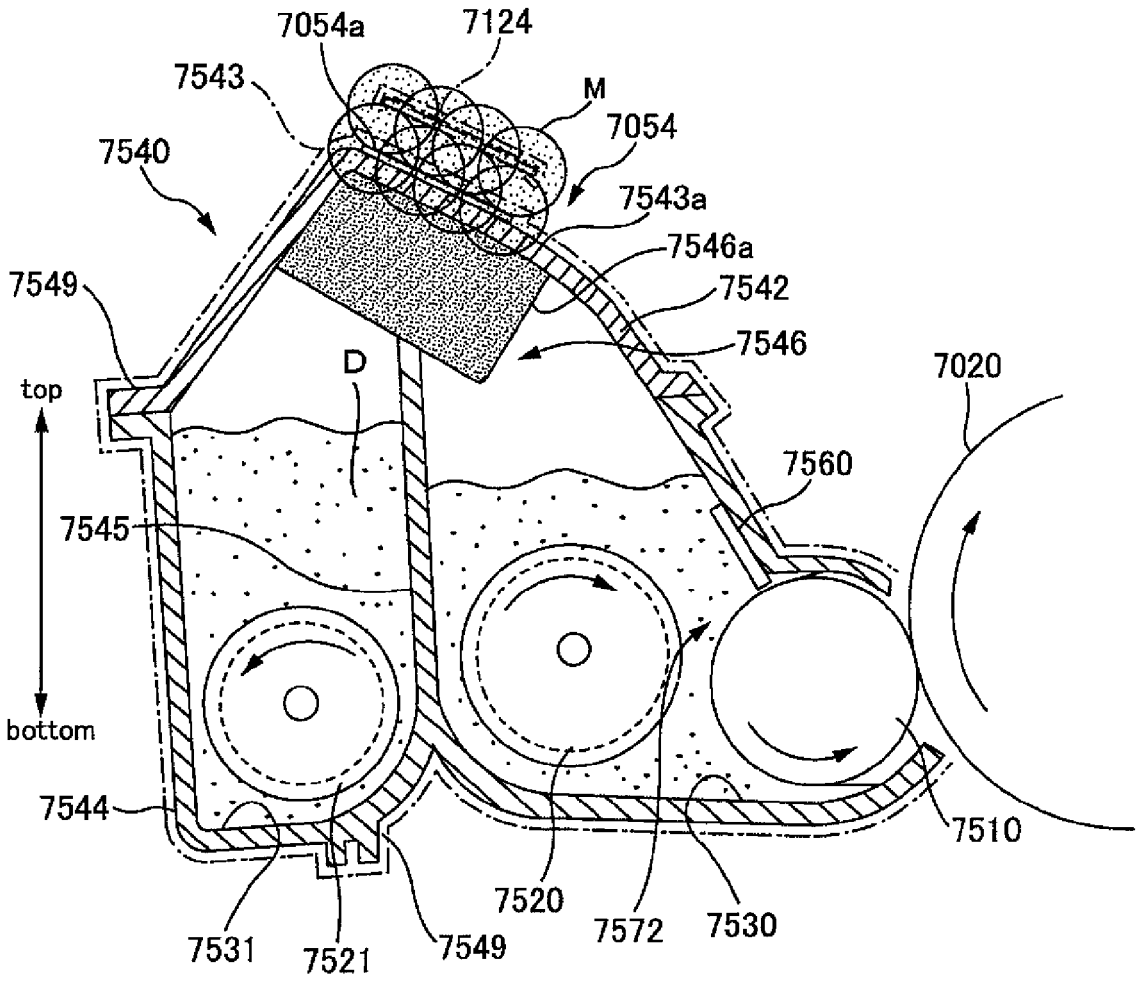
FIG. 99 is a diagram showing another working example of an intrusion prevention section.

FIG. 99 is a diagram showing another working example of an intrusion prevention section. As shown in this diagram, also a configuration of the intrusion prevention section 7546 is possible in which a block made of a resin or urethane or the like, serving as a region holding member 7547 that blocks a region including at least the communication region M, is glued to the inner circumference side of the communication unit, so that the developer will not enter a region broader than the communication region M.

Other Embodiments

An image forming apparatus or the like according to this invention was explained by way of the foregoing embodiment, but the foregoing embodiment of the invention is merely for the purpose of elucidating this invention and is not to be interpreted as limiting this invention. This invention can of course be altered and improved without departing from the gist thereof and equivalents are intended to be embraced therein.

The foregoing embodiment was described for an example of a full-color laser beam printer serving as an image forming apparatus, but the present invention can be applied to image forming apparatuses using the developer including various kinds of magnetic materials, such as monochrome laser beam printers, copiers, facsimile apparatuses, and so on.

Also, in the foregoing embodiment, the photoconductor, which is an image bearing member, was explained as having a photoconductive layer on the outer circumferential surface of a hollow cylindrical conductive member, but there is no limitation to this. For example, it may also be a so-called photoconductive belt, in which a photoconductive layer is provided on the surface of a belt-shaped photoconductive member.

Furthermore, in the foregoing embodiment, as shown in FIG. 85 for example, the mounting and dismounting sections 7050*a*, 7050*b*, 7050*c*, and 7050*d* are movable, and when the developing containers 7051, 7052, 7053, and 7054 are mounted to the mounting and dismounting sections and are moved to the developing position (first position) through the movement of the mounting and dismounting sections, then the latent image borne on the photoconductor 7020 (image bearing member) provided in the printer main unit 7010*a* is developed. Moreover, the communication units 7051*a*, 7052*a*, 7053*a*, and 7054*a* communicate in a noncontacting manner with the printer main unit 7010*a* when the developing containers 7051, 7052, 7053, and 7054 have been moved to the communication position (second position), which is different from the developing position. However, there is no limitation to this. For example, it is also possible to let the developing containers not move at all.

And as shown in FIG. 90, the communication units 7051*a*, 7052*a*, 7053*a*, and 7054*a* are attached at positions of the circularly arc-shaped surface 7543*a* that are furthest removed from the developing rollers 7510. However, there is no limitation to this. For example, it is also possible that the communication units are attached at positions of the circularly arc-shaped surface 7543*a* that are close to the developing rollers 7510.

However, if the communication units 7051*a*, 7052*a*, 7053*a*, and 7054*a* are attached at the positions of the circularly arc-shaped surface 7543*a* that are furthest removed from the developing rollers 7510, then it can be prevented that the toner T borne on the developing rollers 7510 is scattered and adheres to the communication units, so that the communication units can communicate more properly with the printer main unit 7010*a*. For this reason, the above-described embodiment is more preferable.

===Configuration of Image Forming System Etc.===

Next, an embodiment of an image forming system serving as an example of an embodiment of the present invention is described with reference to the drawings.

Figure 100:
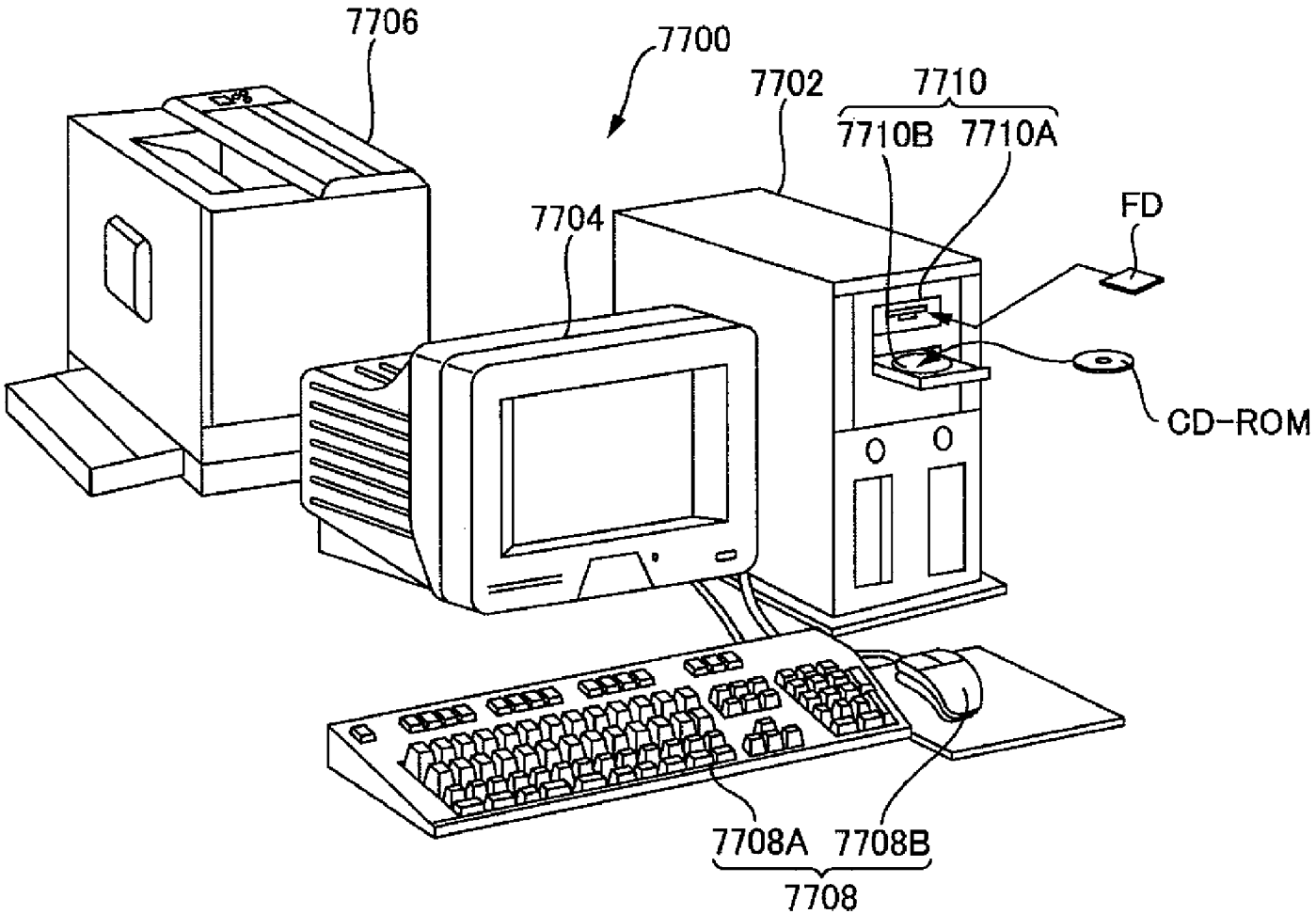
FIG. 100 is an explanatory diagram showing the external configuration of the image forming system.

FIG. 100 is an explanatory diagram showing the external configuration of an image forming system. An image forming system 7700 is provided with a computer 7702, a display device 7704, a printer 7010, input devices 7708, and reading devices 7710.

In this embodiment, the computer 7702 is contained within a mini-tower type housing, but there is no limitation to this. A CRT (cathode ray tube), plasma display, or liquid crystal display device, for example, is generally used as the display device 7704, but there is no limitation to this. As the printer 7010, the printer described above is used. In this embodiment, the input devices 7708 are a keyboard 7708A and a mouse 7708B, but there is no limitation to these. In this embodiment, a flexible disk drive device 7710A and a CD-ROM drive device 7710B are used as the reading devices 7710, but the reading devices 7710 are not limited to these, and may also include an MO (magneto-optical) disk drive device or a DVD (digital versatile disk), for example.

Figure 101:
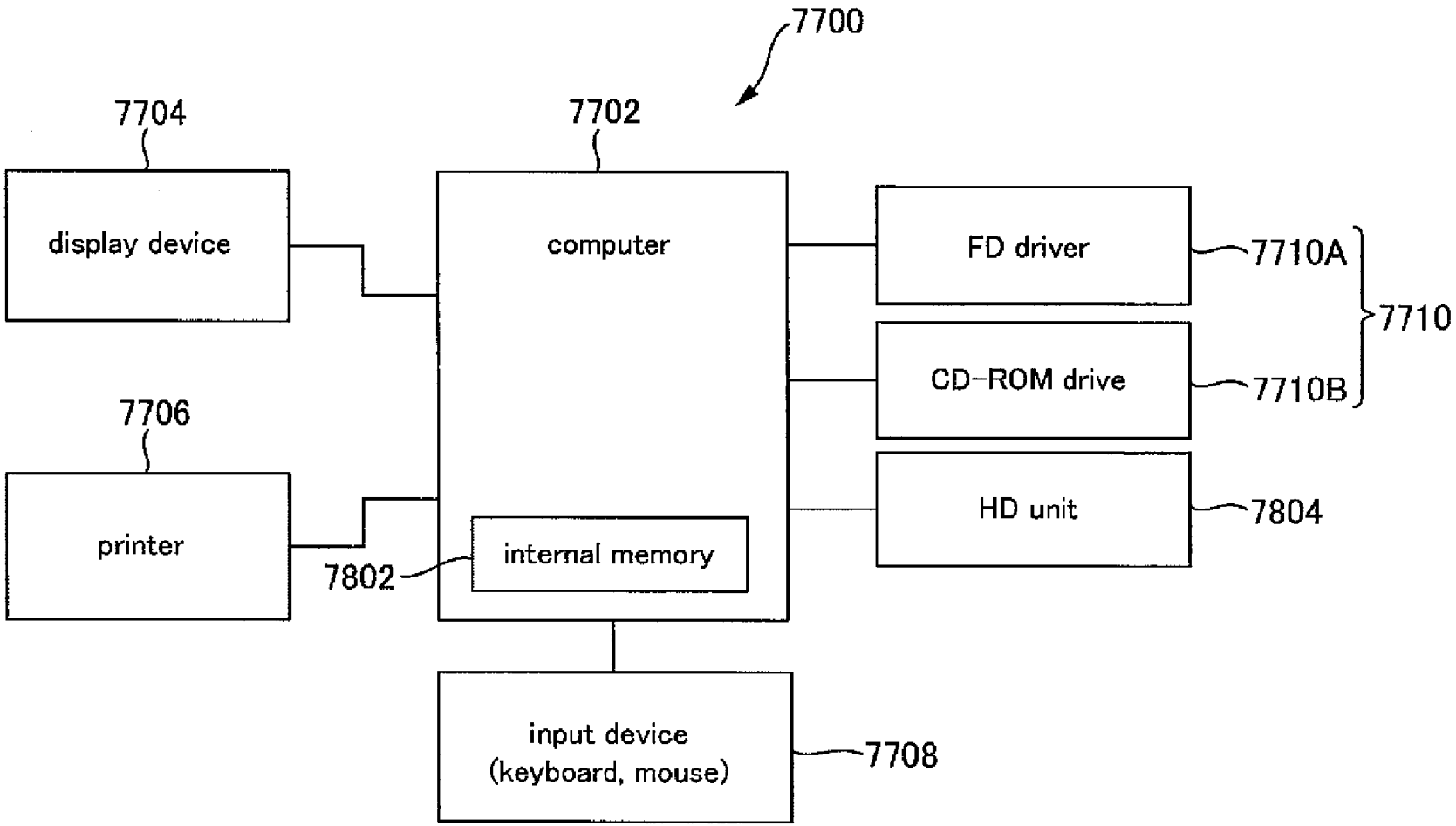
FIG. 101 is a block diagram showing the configuration of the image forming system shown in FIG. 100.

FIG. 101 is a block diagram showing the configuration of the image forming system shown in FIG. 100. An internal memory 7802 such as a RAM is provided within the casing containing the computer 7702, and furthermore an external memory such as a hard disk drive unit 7804 is provided.

In the above explanations, an example was given in which the image forming system is constituted by connecting the printer 7010 to the computer 7702, the display device 7704, the input devices 7708, and the reading devices 7710, but there is no limitation to this. For example, the image forming system may also be made of the computer 7702 and the printer 7010, and the image forming system does not have to be provided with any one of the display device 7704, the input devices 7708, and the reading devices 7710.

It is also possible that the printer 77010 has some of the functions or mechanisms of each of the computer 7702, the display device 7704, the input devices 7708 and the reading devices 7710, for example. For example, the printer 77010 may be configured so as to have an image processing section for carrying out image processing, a display section for carrying out various types of displays, and a recording media mounting and dismounting section into and from which recording media storing image data captured by a digital camera or the like are inserted and taken out.

As an overall system, the image forming system that is thus achieved is superior to conventional systems.

Overview of Image Forming Apparatus of Ninth Embodiment

Figure 102:
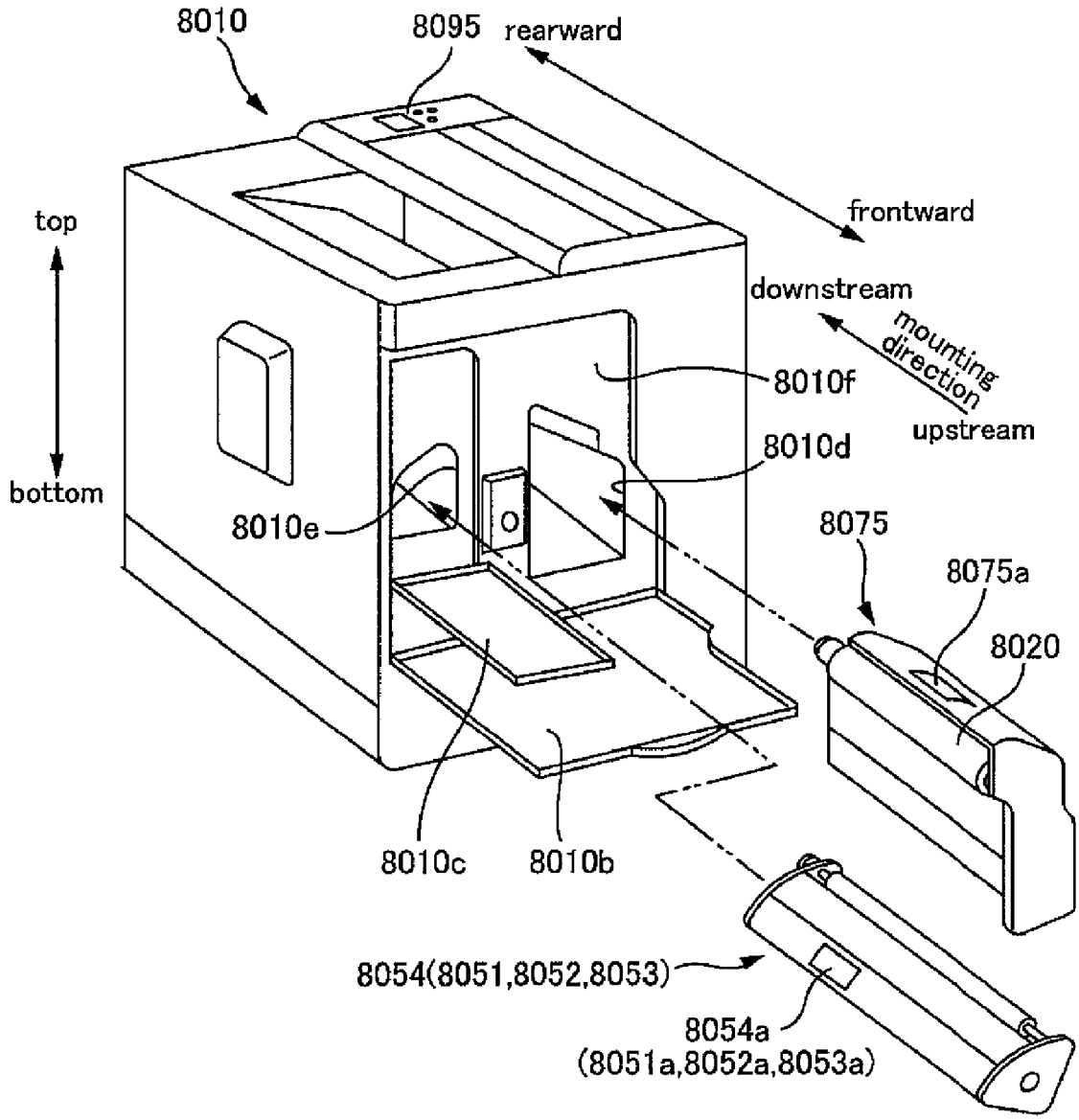
FIG. 102 is a diagram illustrating the configuration of a printer with respect to which developing containers and the like can be mounted and dismounted.
Figure 103:
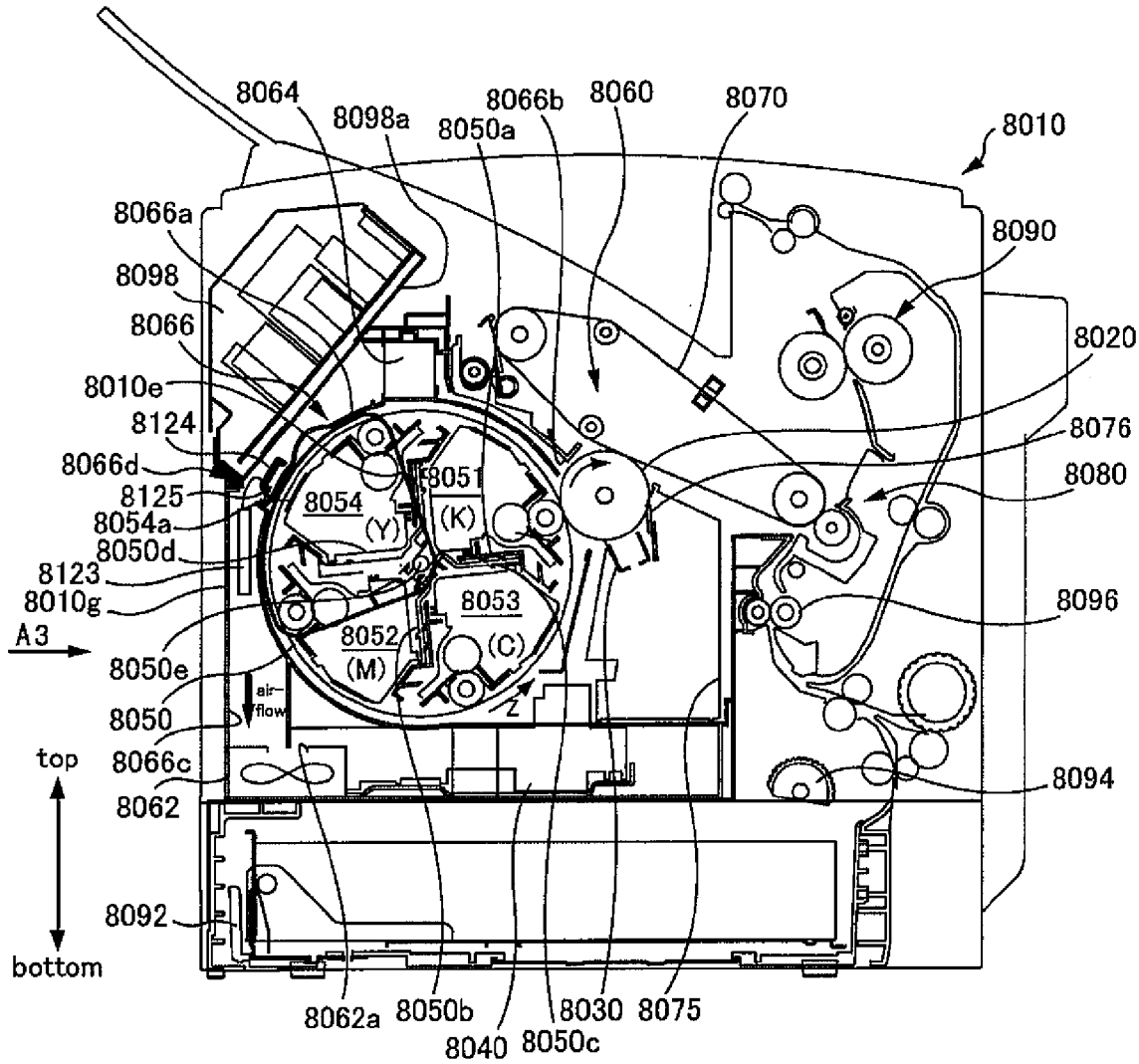
FIG. 103 is a diagram showing the main structural components constituting a printer.
Figure 104:
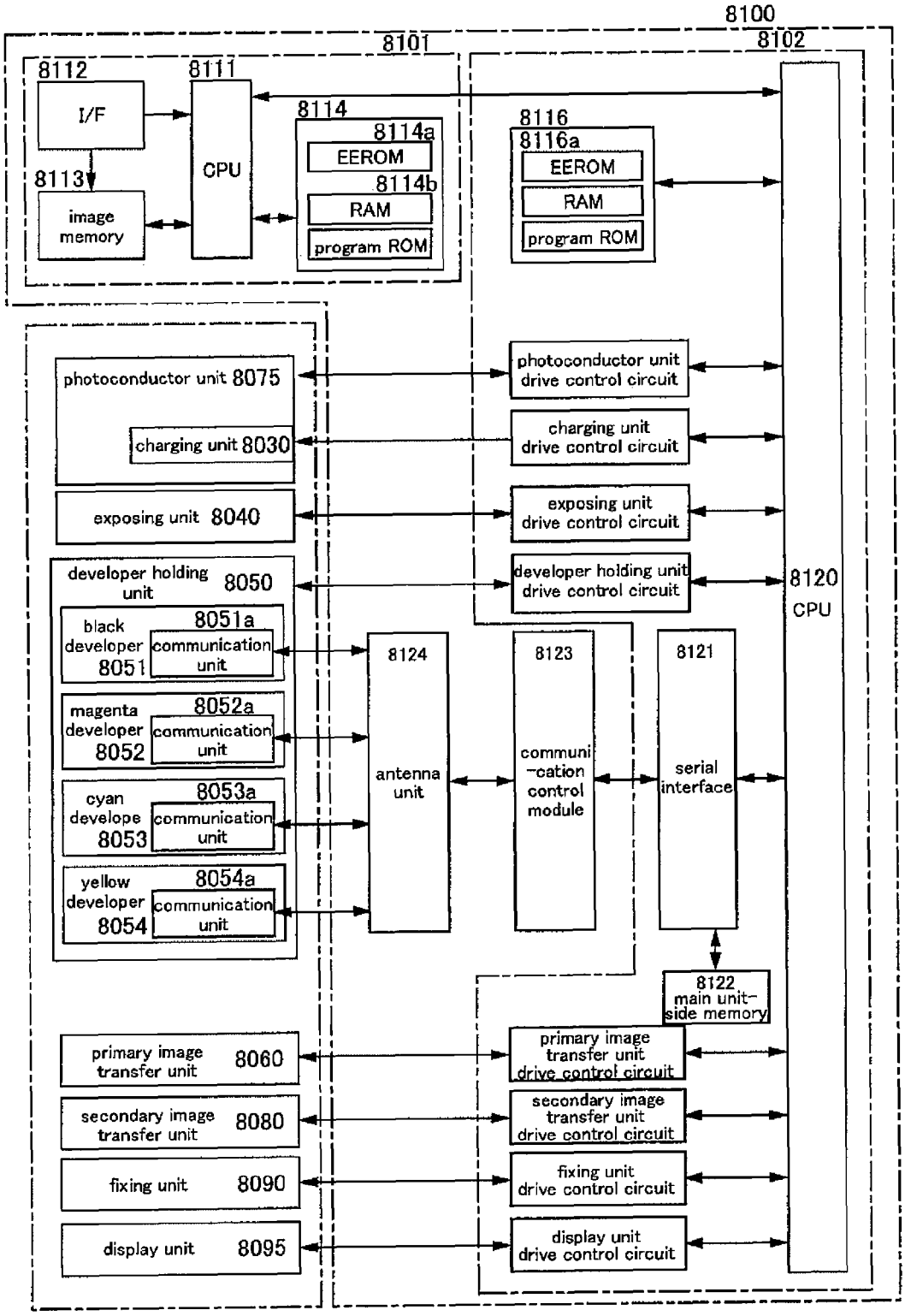
FIG. 104 is a block diagram showing the control unit of the printer.
Figure 105:
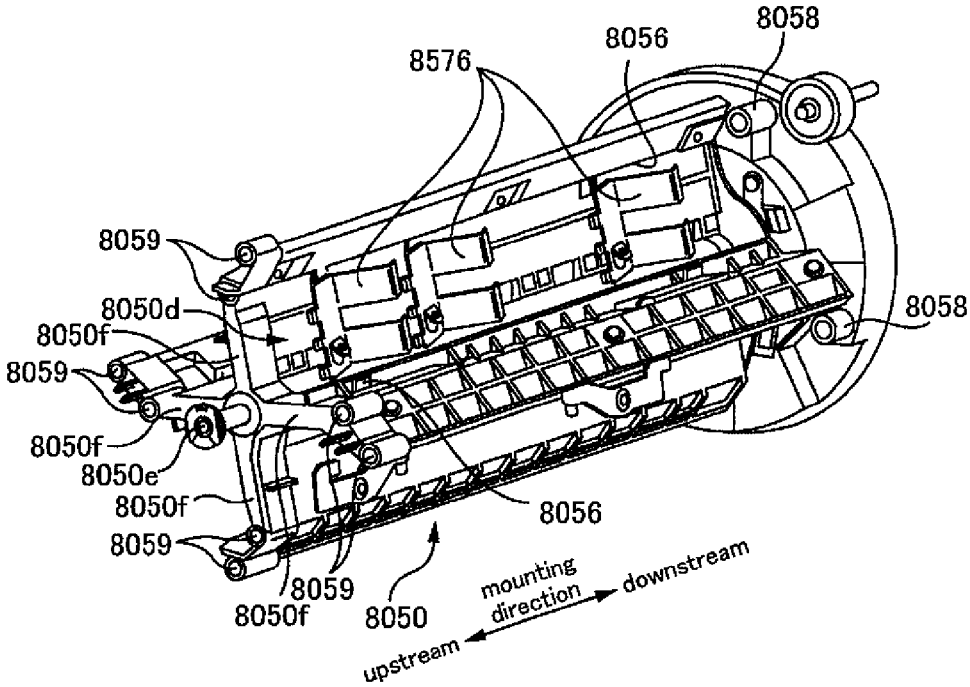
FIG. 105 is a perspective view of a developing container holding unit.
Figure 106:
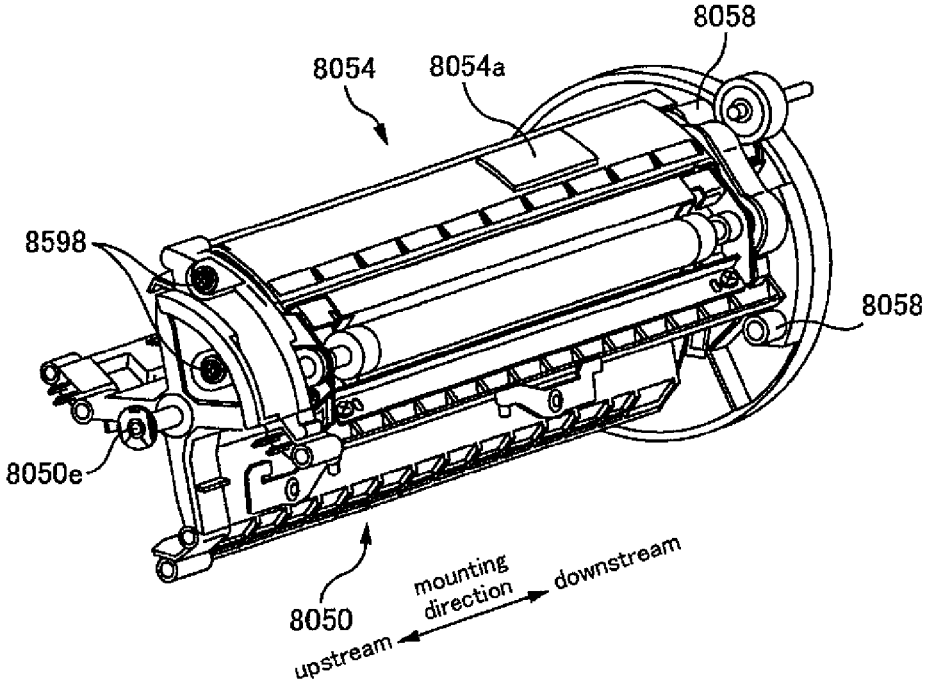
FIG. 106 is a diagram showing the developing container holding unit in a state in which a yellow developing container is mounted to a mounting and dismounting section.
Figure 107:
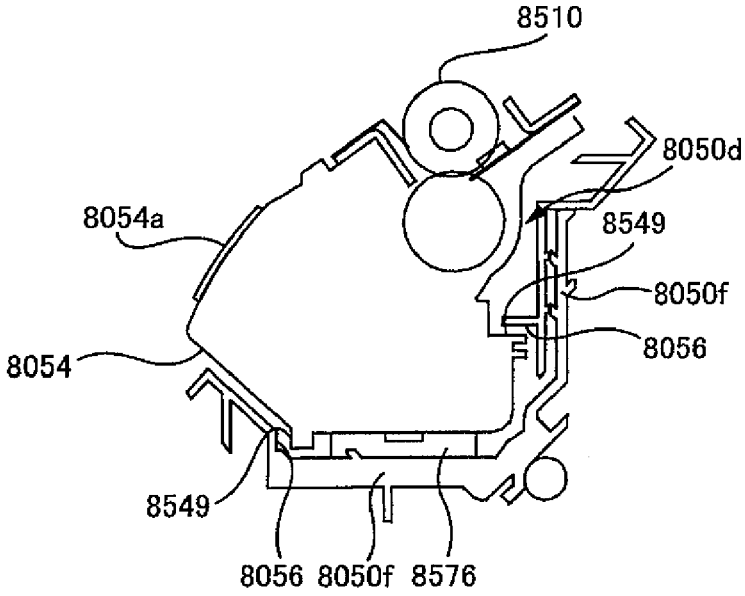
FIG. 107 is a diagram showing the positions of the mounted developing container and the developing container holding unit.

Referring to FIGS. 102 to 107, an overview of a laser beam printer (hereinafter, also referred to as "printer") 8010 serving as an example of an image forming apparatus is described. FIG. 102 is a diagram illustrating the configuration of a printer 8010 with respect to which developing containers 8051, 8052, 8053 and 8054 can be mounted and dismounted. FIG. 103 is a diagram showing the main structural components constituting the printer 8010. FIG. 104 is a block diagram showing the control unit 8100 of the printer 8010. FIG. 105 is a perspective view of a developing container holding unit 8050. FIG. 106 is a diagram showing the developing container holding unit 8050 in a state in which a yellow developing container 8054 is mounted to amounting and dismounting section 8050*d*. FIG. 107 is a diagram showing the positions of the mounted developing container and the developing container holding unit. It should be noted that FIG. 103 is a diagram of a cross section taken perpendicular to the mounting direction of the developing container, for example, in FIG. 102. Also, the vertical direction is indicated by arrows in FIG. 102 and FIG. 103, and for example, a paper supply tray 8092 is disposed at a lower part of the printer 8010 and a fixing unit 8090 is disposed at an upper part of the printer 8010.

<Mounting and Dismounting Configuration>

Developing containers 8051, 8052, 8053 and 8054, which are configured as cartridges and are examples of developing devices, and a photoconductor unit 8075, which is an example of an image bearing member unit, can be mounted and dismounted with respect to the printer 8010, which is an example of an image forming apparatus.

The printer 8010 has a first opening and closing cover 8010*b* that can be opened and closed, a second opening and closing cover 8010*c* that can be opened and closed and that is provided further inward than the first opening and closing cover 8010*b*, a photoconductor unit mounting and dismounting opening 8010*d* through which the photoconductor unit 8075 can be mounted and dismounted, and a developing container mounting and dismounting opening 8010*e* serving as an opening through which the developing containers 8051, 8052, 8053, and 8054 can be mounted and dismounted.

Here, by opening the first opening and closing cover 8010*b*, the user can mount and dismount the photoconductor unit 8075, which is configured as a cartridge, with respect to the printer 8010 through the photoconductor unit mounting and dismounting opening 8010*d*. Further, by opening the second opening and closing cover 8010*c*, the user can mount and dismount the developing containers 8051, 8052, 8053, and 8054 configured as cartridges with respect to the printer 8010 through the developing container mounting and dismounting opening 8010*e*.

<Configuration of the Printer 8010>

The configuration of the printer 8010 in a state in which the developing containers 8051, 8052, 8053, and 8054 and the photoconductor unit 75 are mounted to the printer 8010 is described next.

As shown in FIG. 103, the printer 8010 according to this embodiment includes a charging unit 8030, an exposing unit 8040, a developing container holding unit 8050, a first image transfer unit 8060, an intermediate image transfer member 8070, and a cleaning blade 8076. These units are arranged along the rotation direction of a photoconductor 8020, which is an example of an image bearing member bearing a latent image. The printer 8010 further includes a second image transfer unit 8080, a fixing unit 8090, a display unit 8095 constituted by a liquid-crystal panel and serving as a means for giving notifications to the user, a control unit 8100 for controlling these units and managing the operations of the printer, and a power source unit 8098 covered by a power source shielding member 8098*a*.

The photoconductor 8020, the charging unit 8030, the exposing unit 8040, the developing container holding unit 8050, the primary image transfer unit 8060, the intermediate image transfer member 8070, the cleaning blade 8076, the secondary image transfer unit 8080, the fixing unit 8090, the control unit 8100, and the power source unit 8098 are disposed in the mounting direction at intervals from the upstream side and the downstream side in a metal frame 8010*f* serving as a casing of the printer 8010. Moreover, between these elements and the frame 8010*f*, a metal stay 8010*g* is disposed on both ends in the direction intersecting with the mounting direction.

Furthermore, the printer 8010 is provided with a mounting shielding member for shielding electromagnetic waves intruding from the outside, and the printer 8010 is covered substantially entirely by this shielding member. That is to say, the frame 8010*f* and the stay 8010*g* that make up the casing also function as shielding members.

Furthermore, around the developing container holding unit 8050, an exhaust duct 8066 is provided that serves as a passageway for air to be exhausted out of the apparatus by sucking out air inside the printer 8010, that is, the image forming apparatus. The exhaust duct 8066 is explained later.

The photoconductor 8020 has a hollow cylindrical conductive base and a photoconductive layer formed on the outer circumferential surface of the conductive base, and is rotatable around its center axis. In this embodiment, the photoconductor 8020 rotates clockwise, as indicated by the arrow in FIG. 103. The charging unit 8030 is a device for charging the photoconductor 8020. In the printer 8010 of the present embodiment, the photoconductor 8020, the cleaning blade 8076, and the charging unit 8030 are configured as one photoconductor unit 8075 provided with a waster toner container.

The exposing unit 8040 is a device for forming a latent image on the photoconductor 8020, which has been charged by irradiating a laser beam on the photoconductor 8020. The exposing unit 8040 includes, for example, a semiconductor laser, a polygon mirror, and an F-θ lens, and irradiates a modulated laser beam onto the charged photoconductor 8020 in accordance with image signals that have been input from a host computer not shown in the drawings, such as a personal computer or a word processor.

The developing container holding unit 8050 is a device for developing the latent image formed on the photoconductor 8020 using toner T, which is an example of a developer contained in developing containers 8051, 8052, 8053, and 8054, that is, black (K) toner contained in a black developing container 8051, magenta (M) toner contained in a magenta developing container 8052, cyan (C) toner contained in a cyan developing container 8053, and yellow (Y) toner contained in a yellow developing container 8054.

This developing container holding unit 8050 includes a rotation shaft 8050*e* and four mounting and dismounting sections 8050*a*, 8050*b*, 8050*c*, and 8050*d* with respect to which the developing containers 8051, 8052, 8053, and 8054 can be mounted and dismounted and which are disposed at intervals of 90° in circumferential direction around the rotation shaft 8050*e*. Each of the mounting and dismounting sections 8050*a*, 8050*b*, 8050*c*, and 8050*d* is provided in the same space, partitioned by two neighboring wall sections 8050*f* of the four wall sections 8050*f* formed at intervals of 90° in four radial directions from the rotation shaft 8050*e* provided in the middle of the developing container holding unit 8050. That is to say, the mounting and dismounting section 8050*a* with respect to which the black developing container 8051 can be mounted and dismounted, the mounting and dismounting section 8050*b* with respect to which the magenta developing container 8052 can be mounted and dismounted, the mounting and dismounting section 8050*c* with respect to which the cyan developing container 8053 can be mounted and dismounted, and the mounting and dismounting section 8050*d* with respect to which the yellow developing container 8054 can be mounted and dismounted are disposed at intervals of 90° in circumferential direction around the rotation shaft 8050*e* in the developing container holding unit 8050.

It is possible to move the positions of the four developing containers 8051, 8052, 8053, and 8054 that are held by moving the mounting and dismounting sections 8050*a*, 8050*b*, 8050*c*, and 8050*d* through the rotation of the developing container holding unit 8050 around the rotation shaft 8050*e*. That is to say, the four developing containers 8051, 8052, 8053, and 8054 can be rotated around the rotation shaft 8050*e* while maintaining their relative positions. Then, when the developing containers 8051, 8052, 8053, and 8054 are mounted to the mounting and dismounting sections 8050*a*, 8050*b*, 8050*c*, and 8050*d* and are moved to the developing position through the movement of the mounting and dismounting sections 8050*a*, 8050*b*, 8050*c*, and 8050*d*, the latent image borne by the photoconductor 8020 is developed with the toner contained in the respective developing containers 8051, 8052, 8053, and 8054. It should be noted that details of the developing containers are discussed later.

As shown in FIG. 105, the mounting and dismounting sections 8050*a*, 8050*b*, 8050*c*, and 8050*d* are each provided with coupling holes 8059 into which coupling protrusions provided on a coupling member 8590 (see FIG. 108) of each developing container can be fitted, a guiding section 8056 for guiding the developing container by engaging with a guided section 8549 provided on the developing container that is inserted from the developing container mounting and dismounting opening 8010*e*, and springs 8576 for biasing the developing containers toward the outer circumferential direction of the developing container holding unit 8050. For example, coupling pins 8595*a* and 8595*b* (see FIG. 112), which are examples of coupling protrusions provided on the coupling member 8590 of the yellow developing container 8054, as shown in FIG. 106, are fitted into the coupling holes 8059 provided in the mounting and dismounting section 8050*d*.

And as shown in FIG. 107, the guiding sections 8056 are provided on each of the two wall sections 8050*f* constituting the mounting and dismounting section. The guiding sections 8050 have perpendicular surfaces formed on the respective wall sections 8050*f* and are arranged extending along the longitudinal direction of the yellow developing container 8054, protruding on the side of the same space partitioned by two adjacent wall sections 8050*f*. That is to say, the guiding sections 8056, which are provided on adjacent wall sections 8050*f* facing toward the same space, are formed such that their surfaces both face toward the rotation shaft 8050*e* side and their surfaces define an angle of substantially 90°. The yellow developing container 8054 is mounted by arranging the guided sections 8549 of the yellow developing container 8054 such that they are on the side of the rotation shaft 8050*e* with respect to the two perpendicular surfaces of the guiding sections 8056, and inserting the guided sections 8549 along the guiding sections 8056.

The springs 8576 provided on the mounting and dismounting section 8050*d* bias the yellow developing container 8054 toward the outer circumferential direction of the developing container holding unit 8050. Thus, when the yellow developing container 8054 is inserted from the developing container mounting and dismounting opening 8010*e* with the guided sections 8549 being arranged on the side of the rotation shaft 8050*e* with respect to the perpendicular surfaces of the guiding sections 8056, the yellow developing container 8054 is biased by the springs 8576 toward the outer circumferential direction. Moreover, as shown in FIG. 105, the mounting and dismounting sections 8050*a*, 8050*b*, 8050*c*, and 8050*d* are each provided with a positioning hole 8058 into which a positioning pin 8588 (see FIG. 108) or the respective developing container can be fitted. That is to say, by fitting the positioning pin 8588 provided on the yellow developing container 8054 into the positioning hole 8058 provided in the mounting and dismounting section 8050*d*, the yellow developing container 8054 is mounted by positioning it in a predetermined position.

The primary image transfer unit 8060 is a device for transferring a single color toner image formed on the photoconductor 8020 to the intermediate image transfer member 8070. When the four toner colors are successively transferred over one another, a full color toner image is formed on the intermediate image transfer member 8070. This intermediate image transfer member 8070 is an endless belt that is rotatively driven at substantially the same circumferential velocity as the photoconductor 8020.

The secondary image transfer unit 8080 is a device for transferring a single color toner image or a full color toner image formed on the intermediate image transfer member 8070 to a recording medium such as paper, film, or cloth. The fixing unit 8090 is a device for fusing the single color toner image or the full color toner image that has been transferred to the recording medium on the recording medium, such as paper, making it a permanent image.

The cleaning blade 8076 is made of rubber and is in contact with the surface of the photoconductor 8020. The cleaning blade 8076 scrapes off and removes toner remaining on the photoconductor 8020, after the toner image has been transferred to the intermediate image transfer body 8070 by the primary image transfer unit 8060.

The photoconductor unit 8075 is provided between the primary image transfer unit 8060 and the exposing unit 8040, and includes the photoconductor 8020, the charging unit 8030, the cleaning blade 8076, and a waste toner container not shown in the drawings containing toner that has been wiped away by the cleaning blade 8076.

The control unit 8100 is made of a main controller 8101 and a unit controller 8102, as shown in FIG. 104. An image signal is input into the main controller 8101, and in accordance with a command based on this image signal, the unit controller 8102 controls the various units, for example, to form the image.

<Operation of the Printer 8010>

The operation of the printer 8010 configured as above is described below, referring to other structural components thereof as well.

First, when an image signal from a host computer not shown in the drawings is input into the main controller 8101 of the printer 8010 via an interface (I/F) 8112, the photoconductor 8020, developing rollers 8510 provided in the developing containers 8051, 8052, 8053, and 8054, and the intermediate image transfer member 8070 are rotated under the control of the unit controller 8102 based on a command from the main controller 8101. While rotating, the photoconductor 8020 is successively charged by the charging unit 8030 at a charging position.

The region of the photoconductor 8020 that has been charged is brought to an exposure position through rotation of the photoconductor 8020, and a latent image corresponding to image information of a first color, for example yellow Y, is formed at that region by the exposing unit 8040. Moreover, the developing container holding unit 8050 positions the yellow developing container 8054 containing the yellow (Y) toner at the developing position opposite the photoconductor 8020.

The latent image formed on the photoconductor 8020 is brought to a developing position through the rotation of the photoconductor 8020, and is developed with yellow toner by the yellow developing container 8054. Thus, a yellow toner image is formed on the photoconductor 8020.

The yellow toner image that is formed on the photoconductor 8020 is brought to the primary image transfer position through rotation of the photoconductor 8020 and is transferred to the intermediate image transfer member 8060 by the primary image transfer unit 8070. At this time, a primary image transfer voltage of a polarity that is opposite the toner charge polarity is applied to the primary image transfer unit 8060. It should be noted that throughout this operation, the secondary image transfer unit 8080 is removed from the intermediate image transfer member 8070.

The above process is repeated for a second color, a third color, and a fourth color, thereby transferring toner images of four colors corresponding to various image signals layered over one another onto the intermediate image transfer unit 8070. Thus, a full color toner image is formed on the intermediate image transfer member 8070.

The full color toner image that is formed on the intermediate image transfer member 8070 is brought to the secondary image transfer position through the rotation of the intermediate image transfer member 8070 and is transferred to a recording medium such as paper by the secondary image transfer unit 8080. It should be noted that the recording medium is carried from the paper supply tray 8092 to the secondary image transfer unit 8080 via a paper supply roller 8094 and registration rollers 8096. Also, when performing the image transfer operation, the secondary image transfer unit 8080 is pressed against the intermediate image transfer member 8070 while applying a secondary image transfer voltage to it.

The fixing unit 8090 heats and applies pressure to the full color toner image that has been transferred to the recording medium, thus fusing it to the recording medium. On the other hand, after the photoconductor 8020 has passed the primary image transfer position, the toner adhering to its surface is scraped off by the cleaning blade 8076, and it is provided with a charge for forming the next latent image. The toner that is scraped off is collected in the waste toner container.

===Overview of the Control Unit===

The configuration of the control unit 8100 is described next, with reference to FIG. 104. The control unit 8100 includes the main controller 8101 and the unit controller 8102.

The main controller 8101 includes a CPU 8111, an interface 8112 for connection to a computer not shown in the drawings, an image memory 8113 for storing image signals input from the computer, and a main controller-side memory

8114 made of an EEPROM 8114*a* that can be rewritten electrically, a RAM 8114*b*, an a program ROM or the like in which a program for the various kinds of control is stored.

The CPU 8111 of the main controller 8101 controls the reading in and the reading out of image data that has been input via the interface into the image memory 8113, and performs the control of the overall apparatus in synchronization with the CPU 8120 of the unit controller 8102 based on the control signals input from the computer.

The unit controller 8102 includes the CPU 8120, a unit controller-side memory 8116 including an EEPROM 8116*a* that can be rewritten electrically, a RAM and a program ROM or the like in which a program for the various kinds of control is stored, as well as drive control circuits or the like for performing drive control of the various units of the entire device (the charging unit 8030, the exposing unit 8040, the developing container holding unit 8050, the primary image transfer unit 8060, the photoconductor unit 8075, the secondary image transfer unit 8080, the fixing unit 8090 and the display unit 8095).

The CPU 8120 of the unit controller 8102 is electrically connected to the various drive control circuits and controls the various drive control circuits in accordance with control signals from the CPU 8111 of the main controller 8101. That is to say, while the state of the units is detected by receiving signals from sensors or the like provided in each of the units, the units are controlled in accordance with signals input from the main controller 8101.

Also, the CPU 8120 provided in the unit controller 8102 is connected to a non-volatile storage element (hereinafter, also referred to as "main unit-side memory") 8122 such as a serial EEPROM via the serial interface (I/F) 8121. This main unit-side memory 8122 stores data that is necessary for the control of the apparatus.

Furthermore, the CPU 8120 is capable of wirelessly communicating with communication units 8051*a*, 8052*a*, 8053*a*, and 8054*a*, which are respectively provided in the developing containers 8051, 8052, 8053, and 8054, via the serial interface 8121, a communication control module 8123 serving as an antenna driving circuit and an antenna unit 8124 serving as an apparatus-side antenna. Through the communication of the antenna unit 8124 and the communication units 8051*a*, 8052*a*, 8053*a*, and 8054*a*, the control unit 8100 can write information into the communication units 8051*a*, 8052*a*, 8053*a*, and 8054*a* provided in the developing containers 8051, 8052, 8053, and 8054, as well as read in information from the communication units 8051*a*, 8052*a*, 8053*a*, and 8054*a* provided in the developing containers 8051, 8052, 8053, and 8054. The communication units 8051*a*, 8052*a*, 8053*a*, 8054*a* and the antenna unit 124 are explained further below.

===Overview of the Developing Containers===

Figure 108:
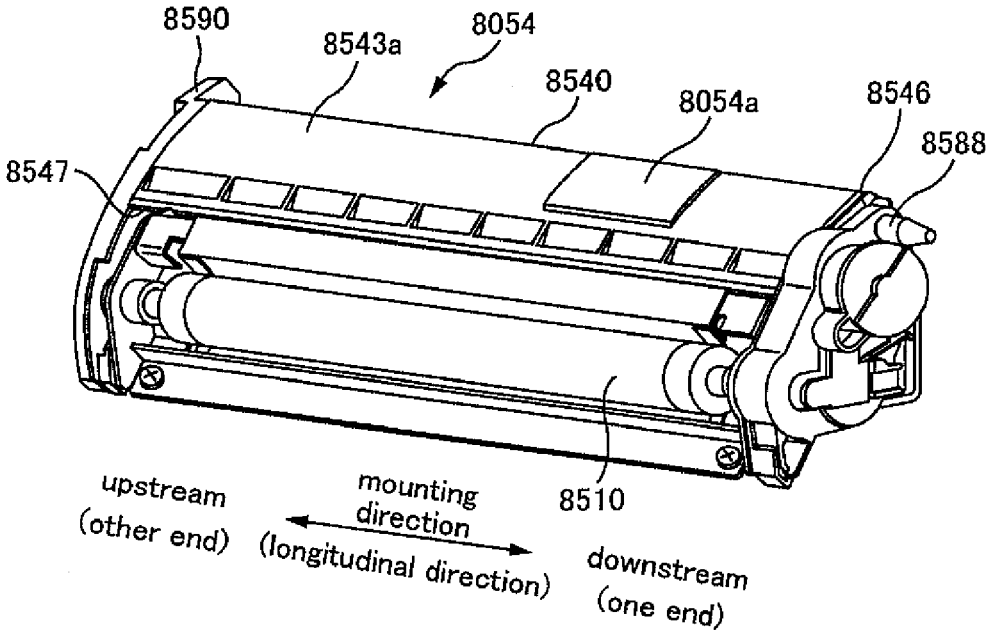
FIG. 108 is a perspective view of the yellow developing container.
Figure 109:
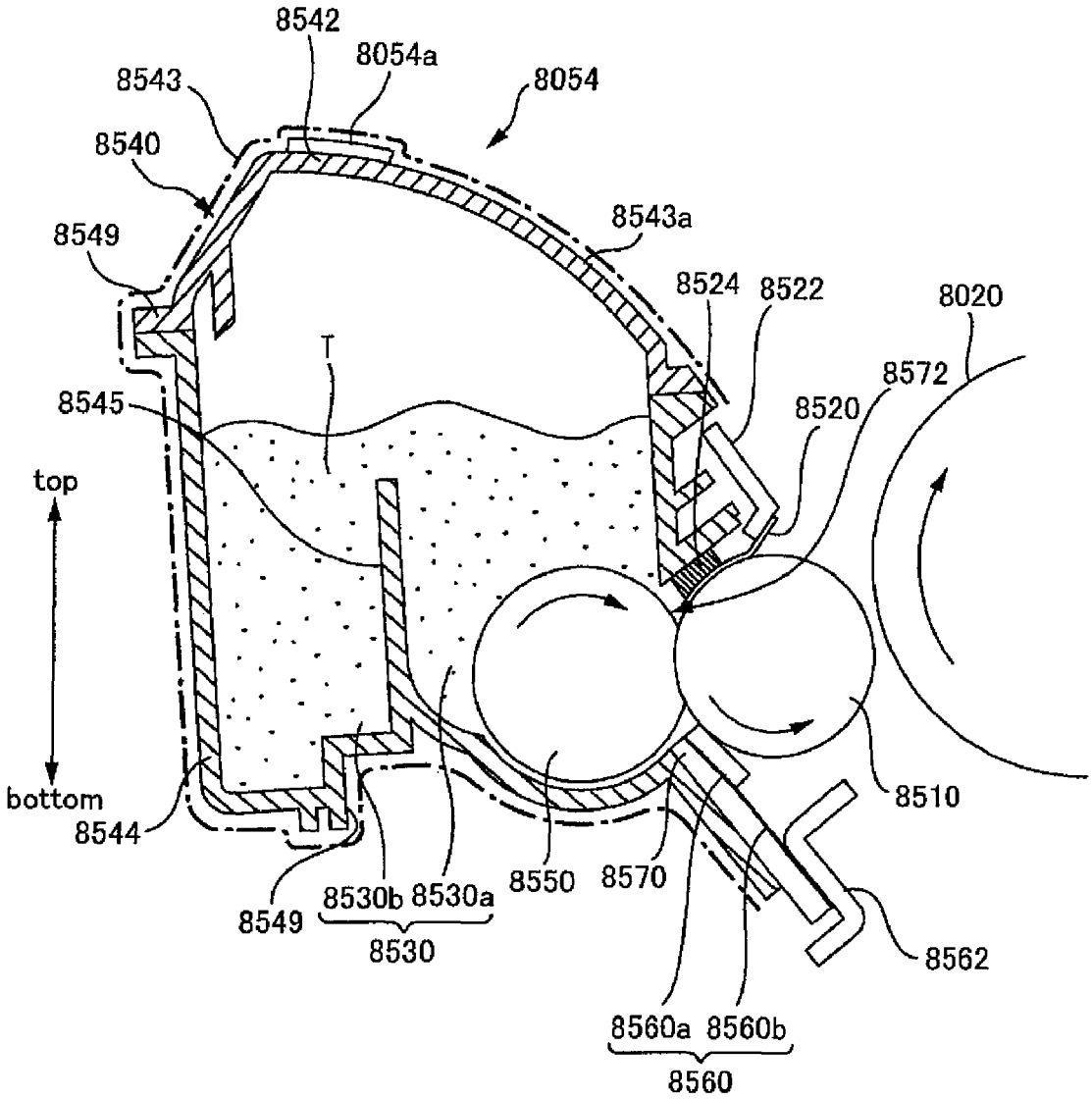
FIG. 109 is a cross-sectional view showing main structural components of the yellow developing container.
Figure 110:
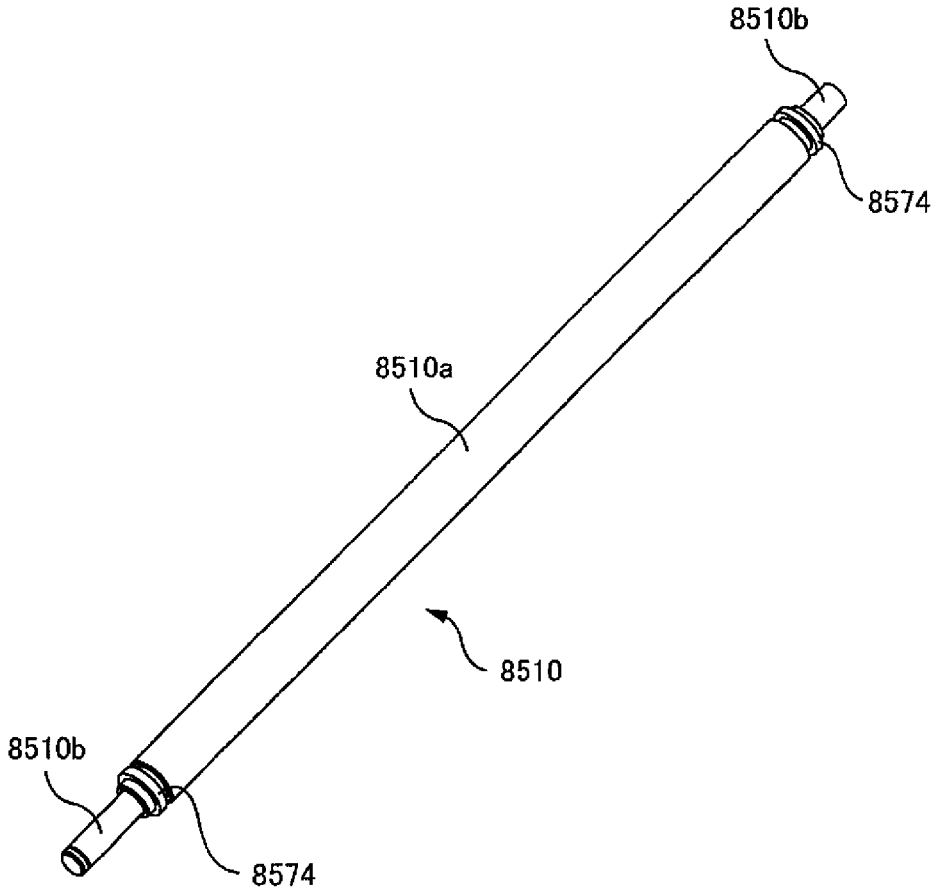
FIG. 110 is a perspective view of a developing roller provided with rolls.
Figure 111:
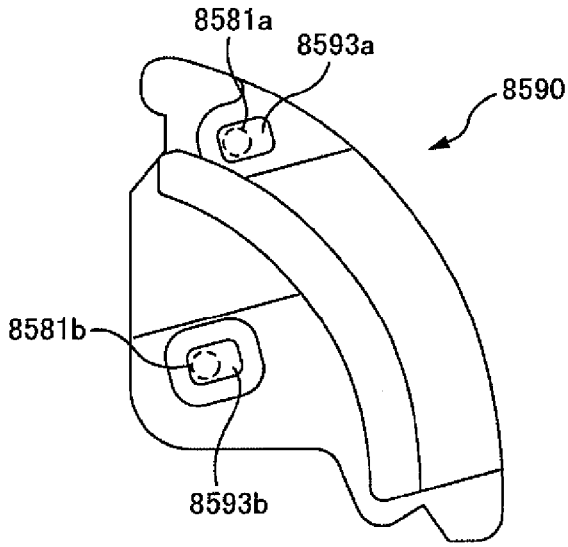
FIG. 111 is a front view of a coupling member.
Figure 112:
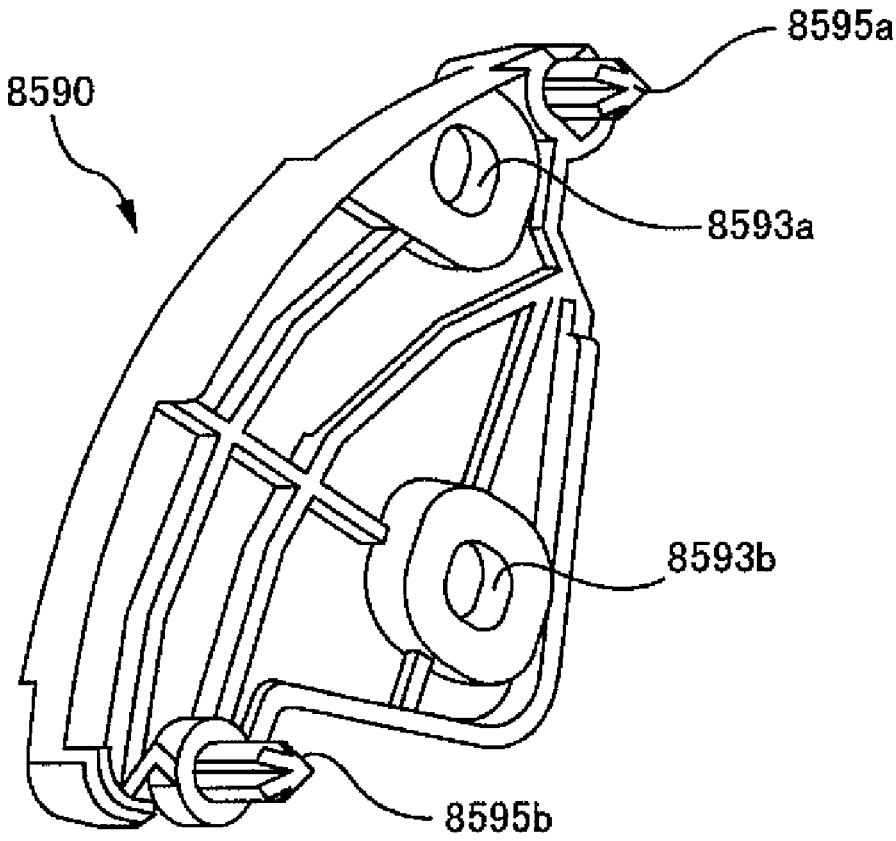
FIG. 112 is a perspective view showing the rear side of the coupling member.

The configuration and operation of the developing containers 8051, 8052, 8053, and 8054 is explained next, using FIG. 108 to FIG. 112. FIG. 108 is a perspective view of the yellow developing container 8054. FIG. 109 is a cross-sectional view showing the main structural components of the yellow developing container 8054. FIG. 110 is a perspective view of a developing roller 8510 provided with rolls 8574. FIG. 111 is a front view of the coupling member 8590. FIG. 112 is a perspective view showing the rear side of the coupling member 8590. It should be noted that the cross-sectional view in FIG. 109 shows a cross section of the yellow developing container 8054 taken along a plane that is perpendicular to the longitudinal direction shown in FIG. 108. Moreover, in FIG. 109, like in FIG. 102, the vertical direction is indicated by arrows, and for example, the center axis of the developing roller 8510 is lower than the center axis of the photoconductor 8020. Also, in FIG. 109, the yellow developing container 8054 is shown positioned at a developing position that is in opposition to the photoconductor 8020.

The black developing container 8051 containing black (K) toner, the magenta developing container 8052 containing magenta (M) toner, the cyan developing container 8053 containing cyan (C) toner, and the yellow developing container 8054 containing yellow (Y) toner can be mounted to the developing container holding unit 8050, but since the configuration and the operation of each of the developing containers is the same, explanations are given only for the yellow developing container 8054 in the following.

<Internal Configuration of the Yellow Developing Container 8054>

First, the configuration of the yellow developing container 8054 is described. The yellow developing container 8054 includes the developing roller 8510, which is an example of a developer carrying member, a toner containing section 8530, a housing 8540 containing toner T, a toner supply roller 8550, a regulating blade 8560, a sealing member 8520, a positioning shaft (also referred to as "positioning pin" in this embodiment) 8588 serving as an example of a positioning member and a coupling member 8590.

The developing roller 8510 bears toner T and carries it to the developing position opposite the photoconductor 8020, and develops the latent image borne on the photoconductor 8020 with the toner T carried to the developing position. This developing roller 8510, which is made of metal, is fabricated from an aluminum alloy, such as 5056 aluminum alloy or 6063 aluminum alloy, or an iron alloy such as STKM, and may be nickel-plated or chromium-plated if necessary. As shown in FIG. 110, the developing roller 8510 includes a large-diameter section 8510*a* and shaft sections 8510*b*.

Moreover, as shown in FIG. 108, the developing roller 8510 is supported by the housing 8540 at its two end portions in the longitudinal direction, that is, at the shaft sections 8510*b*, and can be rotated around its center axis. As shown in FIG. 109, the developing roller 8510 rotates in a direction (the counterclockwise direction in FIG. 109) that is opposite to the rotation direction of the photoconductor 8020 (the clockwise direction in FIG. 109). Its center axis is lower than the center axis of the photoconductor 8020.

Also, as shown in FIG. 109, in a state where the yellow developing container 8054 is in opposition to the photoconductor 8020, there is a gap between the developing roller 8510 and the photoconductor 8020. That is to say, the yellow developing container 8054 develops the latent image formed on the photoconductor 8020 in a noncontacting manner. It should be noted that during the development of the latent image formed on the photoconductor 8020, an alternating electric field is formed between the developing roller 8510 and the photoconductor 8020.

Furthermore, as shown in FIG. 110, rolls 8574, which are an example of distance holding members, are formed on both end portions in the longitudinal direction of the developing roller 8510. When the developing containers 8051, 8052, 8053, and 8054 are positioned in the developing position, these rolls 8574 have the function of coming into contact with the photoconductor 8020 and thereby holding a constant distance between the photoconductor 8020 and the developing roller 8510. The rolls 8574 are slid rotatably onto the shaft sections 8510*b*. The outer diameter of the rolls 8574 is larger than the outer diameter of the large-diameter section 8510*a*. Therefore, it is possible to hold a constant distance between the developing roller 8510 and the photoconductor 8020 by rotating the rolls 8574 while they contact the photoconductor 8020.

The sealing member 8520 prevents the toner T in the yellow developing container 8054 from leaking to the outside, and also collects toner T on the developing roller 8510, after it has passed the developing position, into the developing container without scraping it off. This sealing member 8520 is a seal made of polyethylene film or the like. The sealing member 8520 is supported by a seal support metal plate 8522, and is attached to the housing 8540 via the seal support metal plate 8522. Furthermore, a seal biasing member 8524 made of Moltopren or the like is provided on the side of the sealing member 8520 that is opposite to its developing roller 8510 side, and due to the elasticity of the seal biasing member 8524, the sealing member 8520 is pressed against the developing roller 8510. It should be noted that the contact position where the sealing member 8520 contacts the developing roller 8510 is above the center axis of the developing roller 8510.

The housing 8540 is fabricated by welding together a plurality of integrally molded housing sections, namely an upper housing section 8542 and a lower housing section 8544. A partitioning wall 8545 for partitioning the inside of the housing, which protrudes from the inner wall to the inside (vertically in FIG. 109), partitions the housing 8540 into two toner containing sections 8530, namely a first toner containing section 8530*a* and a second toner containing section 8530*b*. It should be noted that the housing 8540 has a housing opening 8572 at its bottom portion, and the developing roller 8510 is arranged such that a portion of it is exposed in this housing opening 8572. Moreover, a communication unit 8054*a* is attached to the housing 8540. The configuration of this communication unit 8054*a* and the position at which it is attached to the housing 8540 are explained later.

A second side wall 8547, which is arranged on the frontward side of the printer 8010 in the longitudinal direction of the housing 8540, is provided with attachment protrusions 8581*a* and 8581*b* (see FIG. 111). The attachment protrusion 8581*a* can be fitted into an attachment hole 8593*a* of the later-explained coupling member 8590, and the attachment protrusion 8581*b* can be fitted into an attachment hole 8593*b* of the coupling member 8590. The attachment protrusions 8581*a* and 8581*b* have a circular cross section.

Moreover, the toner containing section 8530 may be provided with a stirring member for stirring the toner T, but in the present embodiment, the developing containers (the black developing container 8051, the magenta developing container 8052, the cyan developing container 8053 and the yellow developing container 8054) rotate with the rotation of the developing container holding unit 8050, and this stirs the toner T inside the developing containers, so that the toner containing section 8530 is not provided with a stirring member.

The toner supply roller 8550 is provided in the above-mentioned first toner containing section 8530*a* and not only supplies toner T that is contained in this first toner containing section 8530*a* to the developing roller 8510, but also scrapes off, from the developing roller 8510, toner T that has remained on the developing roller 8510 after developing. The toner supply roller 8550 is made of polyurethane foam, for example, and is in contact with the developing roller 8510 in a state of elastic deformation. The toner supply roller 8550 is disposed at the bottom portion of the toner containing section 8530, and the toner T contained in the containing section 8530 is supplied to the developing roller 8510 by this toner supply roller 8550 at the bottom portion of the toner containing section 8530. The toner supply roller 8550 rotates in a direction (the clockwise direction in FIG. 109) that is opposite the rotation direction of the developing roller 8510 (the counterclockwise direction in FIG. 109). Its center axis is lower than the rotation center axis of the developing roller 8510.

The regulating blade 8560 applies a charge to the toner T borne on the developing roller 8510 and regulates the layer thickness of the toner T borne on the developing roller 8510. The regulating blade 8560 has a rubber part 8560*a* and a rubber supporting part 8560*b*. The rubber part 8560*a* is made of silicone rubber or urethane rubber, for example, and the rubber supporting part 8560*b* is a thin plate of phosphor bronze or stainless steel, for example, and has elasticity. The rubber part 8560*a* is supported by the rubber supporting part 8560*b*, and the rubber supporting part 8560*b* is attached to the housing 8540 via a blade support metal plate 8562, with one end portion of the rubber supporting part 8560*b* being supported by the blade support metal plate 8562. Also, a blade backing member 8570 made of Moltopren or the like is provided on the side of the regulating blade 8560 that is opposite the side of the developing roller 8510.

Here, the rubber part 8560*a* is pressed against the developing roller 8510 by the elastic force due to the bending of the rubber supporting part 8560*b*. The blade backing member 8570 prevents the toner T from entering in between the rubber supporting part 8560*b* and the housing 8540, and stabilizes the elasticity due to the bending of the rubber supporting part 8560*b* while pressing the rubber part 8560*a* against the developing roller 8510 by urging the rubber part 8560*a* toward the developing roller 8510 from directly behind the rubber part 8560*a*. Consequently, the blade backing member 8570 makes the contact of the rubber part 8560*a* with the developing roller 8510 more uniform.

The end of the regulating blade 8560 on the side opposite the side supported by the blade support metal plate 8562, that is, its front end, is not in contact with the developing roller 8510, and a portion thereof removed from this front end by a predetermined distance is in contact with the developing roller 8510 over a certain width. That is to say, the regulating blade 8560 does not come into contact with the developing roller 8510 at its edge but rather at a mid section thereof. Also, the regulating blade 8560 is disposed such that its front end is facing upstream with respect to the direction in which the developing roller 8510 rotates, and is in so-called counter contact. It should be noted that the contact position where the regulating blade 8560 contacts the developing roller 8510 is below the center axis of the developing roller 8510 and is below the center axis of the toner supply roller 8550.

<Configuration of the Positioning Member>

The following is a description of the configuration of the positioning pin 8588. As shown in FIG. 108, the positioning pin 8588 is provided on a one end side in the longitudinal direction of the yellow developing container main unit, which is an example of a developing device main unit, that is, on the downstream side with respect to the direction in which the developing container is mounted.

This positioning pin 8588 has the function of positioning the yellow developing container main unit with respect to the mounting and dismounting section 8050*d* by engaging the mounting and dismounting section 8050*d*, or more specifically by fitting into the positioning hole 8058 provided on the mounting and dismounting section 8050*d*, as shown in FIG. 106, when the yellow developing container 8054 is mounted to the mounting and dismounting section 8050*d*.

Moreover, the positioning pin 8588, which is made of metal, is arranged such that its axial direction extends in the longitudinal direction of the developing container main unit. One end of the positioning pin 8588 is fixed to a first side wall 8546 of the housing 8540, on the downstream side with respect to the mounting direction. The front end of the positioning pin 8588 is tapered, so that it can be easily fitted into the positioning hole 8058 of the mounting and dismounting section 8050*d*.

<Configuration of the Coupling Member>

The configuration of the coupling member 8590 is described next. As shown in FIG. 108, the coupling member 8590 is attached to the upstream side, with respect to the mounting direction, of the yellow developing container main unit.

As shown in FIG. 112, the coupling member 8590 is provided with coupling pins 8595*a* and 8595*b*, which are an example of coupling protrusions that can be fitted into the coupling holes 8059 of the mounting and dismounting section 8050*d*. When the yellow developing container 8054 is mounted to the mounting and dismounting section 8050*d*, the coupling pins 8595*a* and 8595*b* are fitted into the coupling holes 8059 provided in the mounting and dismounting section 8050*d*. Thus, when the yellow developing container 8054 is mounted to the mounting and dismounting section 8050*d*, the coupling member 8590 is coupled to the mounting and dismounting section 8050*d*. It should be noted that when the coupling member 8590 is coupled to the mounting and dismounting section 8050*d*, the movement of the coupling member 8590 with respect to the mounting and dismounting section 8050*d* is restricted.

Furthermore, as shown in FIG. 111, the coupling member 8590 includes an attachment hole 8593*a* into which the attachment protrusion 8581*a* provided on the second side wall 8547 on the other end side in the longitudinal direction of the housing 8540, that is, the upstream side with respect to the mounting direction of the developing container, can be fitted, and an attachment hole 8593*b* into which the attachment protrusion 8581*b* can be fitted. When the attachment protrusion 8581*a* is fitted into the attachment hole 8593*a* and the attachment protrusion 8581*b* is fitted into the attachment hole 8593*b*, the coupling member 8590 is attached to the side wall on the upstream side in the mounting direction of the housing 8540, that is, of the developing container, by stopping screws 8598 via the coupling member 8590 with respect to screw holes provided in the attachment protrusion 8581*a* and the attachment protrusion 8581*b*, as shown in FIG. 106.

Moreover, as shown in FIG. 111, the attachment hole 8593*a* and the attachment hole 8593*b* have a substantially elliptical cross section. The attachment hole 8593*a* and the attachment hole 8593*b* are provided such that the directions of the major axes of the substantially elliptical cross sections are the same direction. Moreover, as noted above, the cross section of the attachment protrusion 8581*a* is circular. Consequently, the attachment hole 8593*a* allows movement of the attachment protrusion 8581*a*, which is fitted into the attachment hole 8593*a*, within the attachment hole 8593*a*. Similarly, the attachment hole 8593*b* allows movement of the attachment protrusion 8581*b*, which is fitted into the attachment hole 8593*b*, within the attachment hole 8593*b*.

That is to say, the attachment hole 8593*a* allows movement of the attachment protrusion 8581*a* within the attachment hole 8593*a* in the direction of the major axis of its substantially elliptical cross section, and the attachment hole 8593*b* allows movement of the attachment protrusion 8581*b* within the attachment hole 8593*b* in the direction of the major axis of its elliptical cross section. It should be noted that the movement of the attachment protrusion 8581*a* within the attachment hole 8593*a* and the movement of the attachment protrusion 8581*b* within the attachment hole 8593*b* occur at the same timing. Thus, the coupling member 8590 is attached in such a manner that its relative position to the developing container main unit can be changed.

<Operation of the Yellow Developing Container 8054>

Next, the operation of the yellow developing container 8054 is described. In the yellow developing container 8054 configured in this manner, the toner T that is contained in the toner containing section 8530 is supplied to the developing roller 8510 by rotating the toner supply roller 8550.

As the developing roller 8510 rotates, the toner T that is supplied to the developing roller 8510 is brought to the contact position of the regulating blade 8560, and when it passes that contact position, the layer thickness of the toner T is regulated, and a charge is applied to it. The toner T on the developing roller 8510, whose layer thickness has been regulated and which has been charged, is brought to the developing position in opposition to the photoconductor 8020 by further rotation of the developing roller 8510, and is supplied for the development of the latent image formed on the photoconductor 8020 in an alternating electric field at the developing position.

The toner T on the developing roller 8510 that has passed the developing position due to further rotation of the developing roller 8510 passes the upper sealing member 8520 and is collected in the developing device without being scraped off by the upper sealing member 8520. Moreover, the toner T that still remains on the developing roller 8510 is stripped off by the toner supply roller 8550.

===The Developing Position, Communication Position and Mounting and Dismounting Position of the Developing Containers===

Figure 113A:
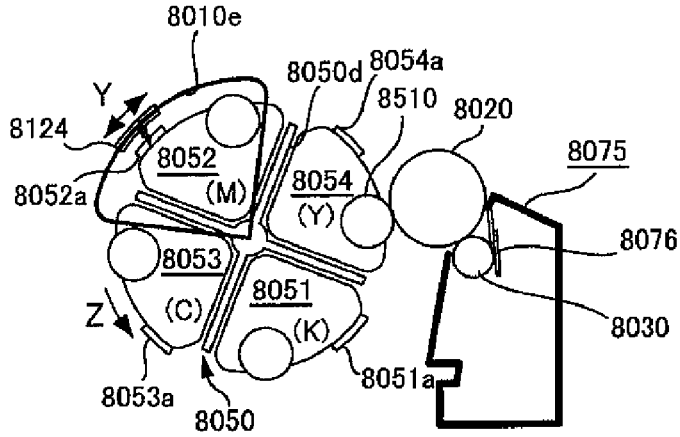
FIG. 113A is a diagram showing the developing container holding unit in a state where the yellow developing container 8054 is positioned at the developing position.
Figure 113B:
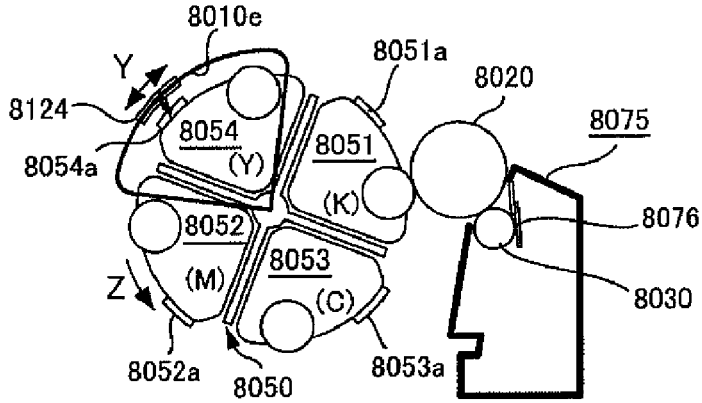
FIG. 113B is a diagram showing the developing container holding unit in a state where the yellow developing container 8054 is positioned at the communication position.
Figure 113C:
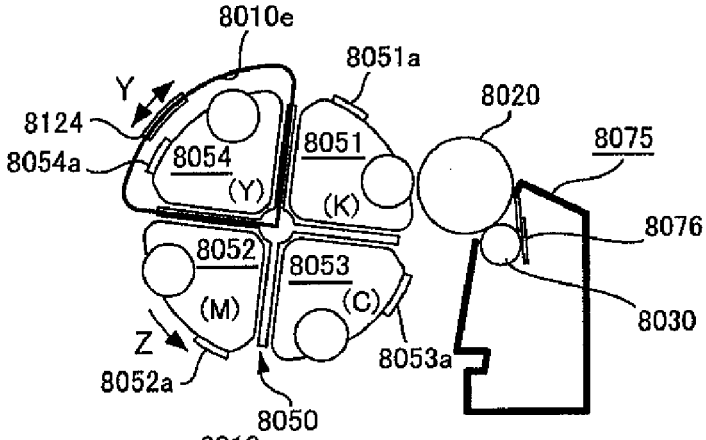
FIG. 113C is a diagram showing the developing container holding unit in a state where the yellow developing container is positioned at the mounting and dismounting position.
Figure 113D:
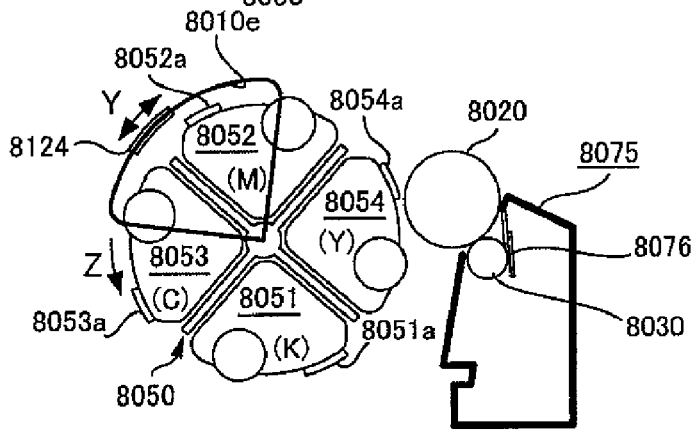
FIG. 113D is a diagram showing a state where the developing container holding unit is positioned in its home position.

As mentioned above, the developing containers 8051, 8052, 8053, and 8054 are moved together with the movement of the mounting and dismounting sections 8050*a*, 8050*b*, 8050*c*, and 8050*d*. At that time, the mounting and dismounting sections are moved such that the developing containers are positioned in predetermined positions. Such predetermined positions are the developing position serving as a first position, the communication position serving as a second position, and the mounting and dismounting position. Since the developing position, the communication position and the mounting and dismounting position of each of the developing containers are the same, the developing position, the communication position, and the mounting and dismounting position of the yellow developing container 8054 are explained in the following with reference to FIGS. 113A to 113D. FIG. 113A is a diagram showing the developing container holding unit 8050 in a state where the yellow developing container 8054 is positioned at the developing position. FIG. 113B is a diagram showing the developing container holding unit 8050 in a state where the yellow developing container 8054 is positioned at the communication position. FIG. 113C is a diagram showing the developing container holding unit 8050 in a state where the yellow developing container 8054 is positioned at the mounting and dismounting position. FIG. 113D is a diagram showing a state where the developing container holding unit 8050 is positioned in its home position.

In the state shown in FIG. 113A, the yellow developing container 8054 is positioned at the developing position in which the developing roller 8510 is in opposition to the photoconductor 8020. In this state, the developing roller 8510 is able to develop the latent image borne on the photoconductor

8020. In the state in which the yellow developing container 8054 is positioned in the developing position, as noted above, the springs 8576 provided in the mounting and dismounting section 8050*d* bias the yellow developing container main unit towards the outer circumferential side. Due to this spring force of the springs 8576, the rolls 8574 come into contact with the photoconductor 8020. It should be noted that when the photoconductor 8020 is installed in a slanted manner with respect to the printer 8010, then the yellow developing container main unit moves with respect to the coupling member 8590 when the yellow developing container 8054 is positioned in the developing position, that is, the attachment protrusion 8581*a* of the yellow developing container main unit moves in the major axis direction within the attachment hole 8593*a* of the coupling member and the attachment protrusion 8581*b* of the yellow developing container main unit moves in the major axis direction within the attachment hole 8593*b* of the coupling member 8590, so that the rolls 8574 with which the yellow developing container main unit is provided contact suitably with the photoconductor 8020. During this, the relative position of the developing container main unit and the coupling member 8590 is changed in accordance with the spring force of the springs 8576. It should be noted that in a state in which the yellow developing container 8054 is positioned in the developing position, the magenta developing container 8052 is positioned in the communication position.

Furthermore, when the developing container holding unit 8050 is rotated for a predetermined angle in Z-direction in FIG. 113A from the state shown in FIG. 113A around its rotation shaft 8050*e*, then the state shown in FIG. 113B is achieved. In the state shown in FIG. 113B, the yellow developing container 8054 is positioned in the communication position. In this state, the communication unit 8054*a* provided on the yellow developing container 8054 opposes the antenna unit 8124 in a noncontacting manner. This communication unit 8054*a* can then communicate with the antenna unit 8124. Furthermore, when the yellow developing container 8054 is positioned in the communication position, the rolls 8574 of the yellow developing container 8054 do not come into contact with members on the side of the printer 8010. It should be noted that when the yellow developing container 8054 is positioned in the communication position, the black developing container 8051 is positioned in the developing position. Therefore, the communication between the antenna unit 8124 and the communication element 8054*a* can take place while the black developing container 8051 develops the latent image borne on the photoconductor 8020.

Furthermore, when the developing container holding unit 8050 is rotated around its rotation shaft 8050*e* for a predetermined angle in Z-direction in FIG. 113B from the state shown in FIG. 113B, then the state shown in FIG. 113C is achieved. In the state shown in FIG. 113C, the yellow developing container 8054 is positioned in the mounting and dismounting position. In this state, the yellow developing container 8054 can be mounted and dismounted via the developing container mounting and dismounting opening 8010*e*, that is, the yellow developing container 8054 can be mounted to the mounting and dismounting section 8050*d* or it can be dismounted from the mounting and dismounting section 8050*d*.

It should be noted that after the power source of the printer 8010 has been turned on and an initialization operation has been performed, and before the printer 8010 forms an image, the developing container holding unit 8050 is positioned in the home position shown in FIG. 113D.

===Configuration of the Communication Unit===

Figure 114:
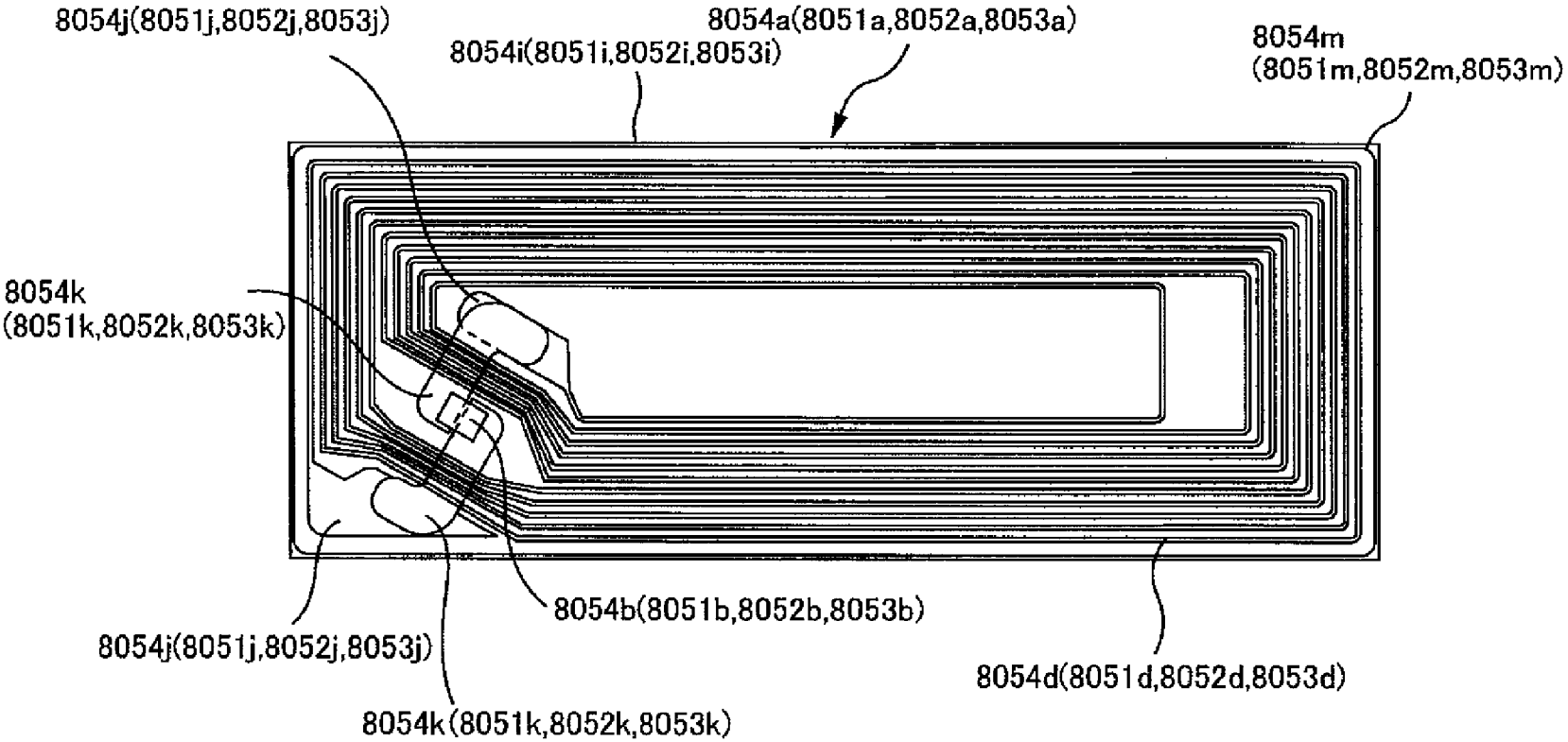
FIG. 114 is a plan view showing the configuration of the communication unit.
Figures 115, 116:
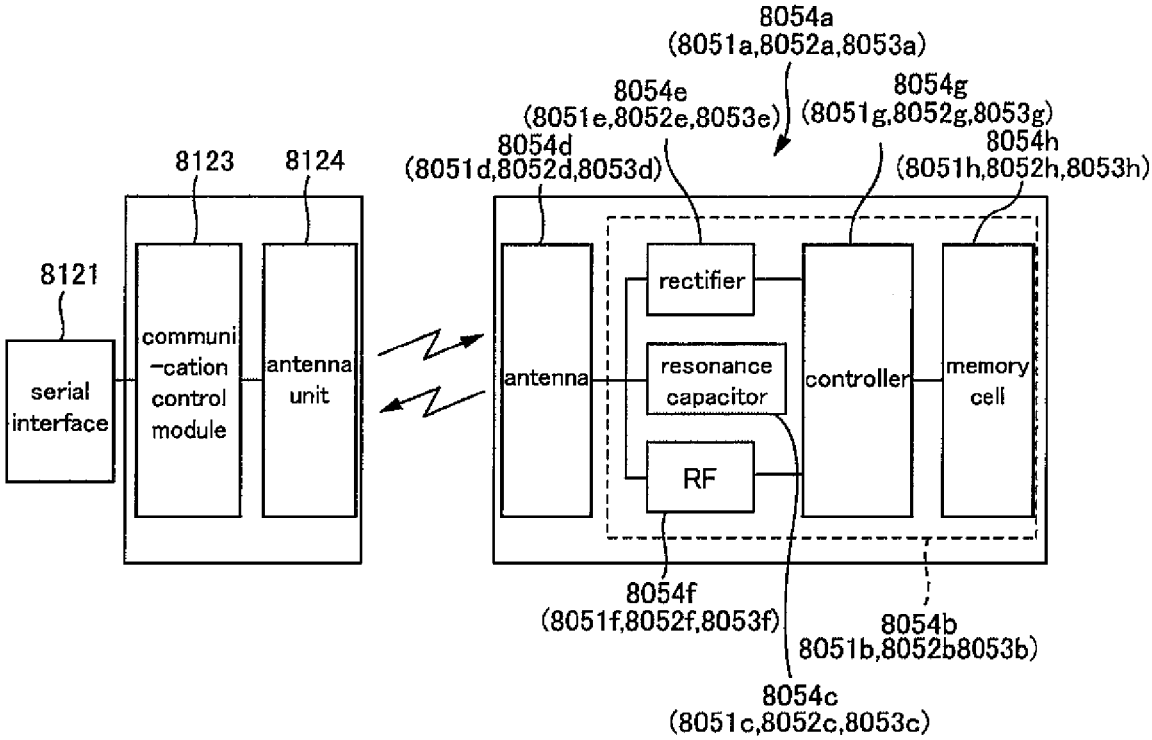
FIG. 115 is a block diagram illustrating the internal configuration of the communication unit and the send/receive section.
FIG. 116 is a diagram illustrating the information stored in a memory cell of the communication unit.

The configuration of the communication unit provided in the developing container as well as the configuration for sending and receiving data is described next with reference to FIG. 114, FIG. 115 and FIG. 116. FIG. 114 is a plan view showing the configuration of the communication unit. FIG. 115 is a block diagram illustrating the internal configuration of the communication unit and the send/receive section. FIG. 116 is a diagram illustrating the information stored in a memory cell 8054*h* of the communication unit 8054*a*.

Communication units are attached respectively to the developing containers 8051, 8052, 8053, and 8054, but since the configuration of the communication units attached to the developing containers and the positions at which the communication units are attached to the developing container main units are the same for all developing containers, the following is an explanation taking the communication unit 8054*a* attached to the yellow developing container 8054 as an example.

When the yellow developing container 8054 is mounted to the mounting and dismounting section 8050*d*, the communication unit 8054*a* can communicate with the antenna unit 8124 on the side of the printer 8010 in a noncontacting manner. As mentioned above, the yellow developing container 8054 is moved by the movement of the mounting and dismounting section 8050*d*. When the yellow developing container 8054 has been moved to the communication position, which is different from the developing position, the communication unit 8054*a* communicates in a noncontacting manner with the antenna unit 8124 with which the printer 8010 is provided. The communication unit 8054*a* is provided inward of the antenna unit 8124 in radial direction with respect to the center of the rotation shaft 8050*e* of the developing container holding unit 8050.

The communication unit 8054*a* includes a thin plate-shaped substrate 8054*i* serving as a substrate made of a thin plate-shaped piece of plastic that is flexible in its longitudinal direction, an antenna 8054*d* serving as a first antenna made by arranging copper foil in a rectangular planar coil shape, antenna terminals 8054*j* provided on both end portions of the antenna, a non-contact IC chip 8054*b* including a memory and serving as an element for communicating with an external antenna, two coupling sections 8054*k* made of aluminum that connect the chip terminals of the non-contact IC chip 8054*b* with the antenna terminals 8054*j*, and a film-shaped protective sheet 8054*m* covering these elements, sandwiching them together with the thin plate-shaped substrate 8054*i*.

As shown in FIG. 114, one antenna terminal 8054*j* of the antenna 8054*d* is arranged at one end side in the longitudinal direction of the rectangular thin plate-shaped substrate 8054*i*, the antenna 8054*d* is wrapped about ten times in a coil shape along the outer shape of the thin plate-shaped substrate 8054*i*, and the other antenna terminal 8054*j* is provided to the inner side of the antenna 8054*d*. The outer antenna terminal 8054*j* and the inner antenna terminal 8054*j* are both provided on the same side in the longitudinal direction of the thin plate-shaped substrate 8054*i*. On the thin plate-shaped substrate 8054*i*, the ten copper foil structures of the antenna 8054*d* are lined up next to each other along the vertical and horizontal edges of the rectangular shape, and are divided into five each at one corner portion on that end portion side of the thin plate-shaped substrate 8054*i* where the antenna terminals 8054*j* are provided, the non-contact IC chip 8054*b* being arranged between these. Furthermore, two coupling sections 8054*k* connecting chip terminals (not shown in the drawings) provided on the non-contact IC chip 8054*b* with the antenna terminals 8054*j* are provided, respectively straddling five copper foil structures. That is to say, on the thin plate-shaped substrate 8054*i*, the non-contact IC chip 8054*b*, two antenna terminals 8054*j*, and two coupling sections 8054*k* are provided on a one end side in longitudinal direction, and the copper foil structures serving as the antenna 8054*d* are guided around the remaining region, except for the center.

As shown in FIG. 108, the communication unit 8054*a* is provided between the positioning pin 8588 and the coupling member 8590, on the downstream side from the center in the longitudinal direction of the yellow developing container main unit on the side of the positioning pin 8588, that is, on the downstream side from the center with respect to the direction in which the yellow developing container 8054 is mounted. In this situation, the communication unit 8054*a* is arranged such that the end portion side where the non-contact IC chip 8054*b* is provided is arranged on the upstream side of the communication unit 8054*a* with respect to the mounting direction.

Moreover, the communication unit 8054*a* is attached to an outer surface 8543 of the housing 8540, which is provided extending in the longitudinal direction of the housing 8540. Here, the outer surface 8543 refers to the part of the housing 8540 corresponding to the dash-dotted line in FIG. 109. It should be noted that this outer surface 8543 includes a circularly arc-shaped surface 8543*a*, whose cross section through a perpendicular plane that is perpendicular to the longitudinal direction of the housing 8540 is circularly arc-shaped. This circularly arc-shaped surface 8543*a* is arranged such that its circular arc extends along the rotation direction of the developing container holding unit 8050 when the yellow developing container 8054 is mounted to the mounting and dismounting section 8050*d*. As shown in FIG. 109, the communication unit 8054*a* is attached at a position of the circularly arc-shaped surface 8543*a* that is furthest removed from the developing roller 8510.

Figure 117:
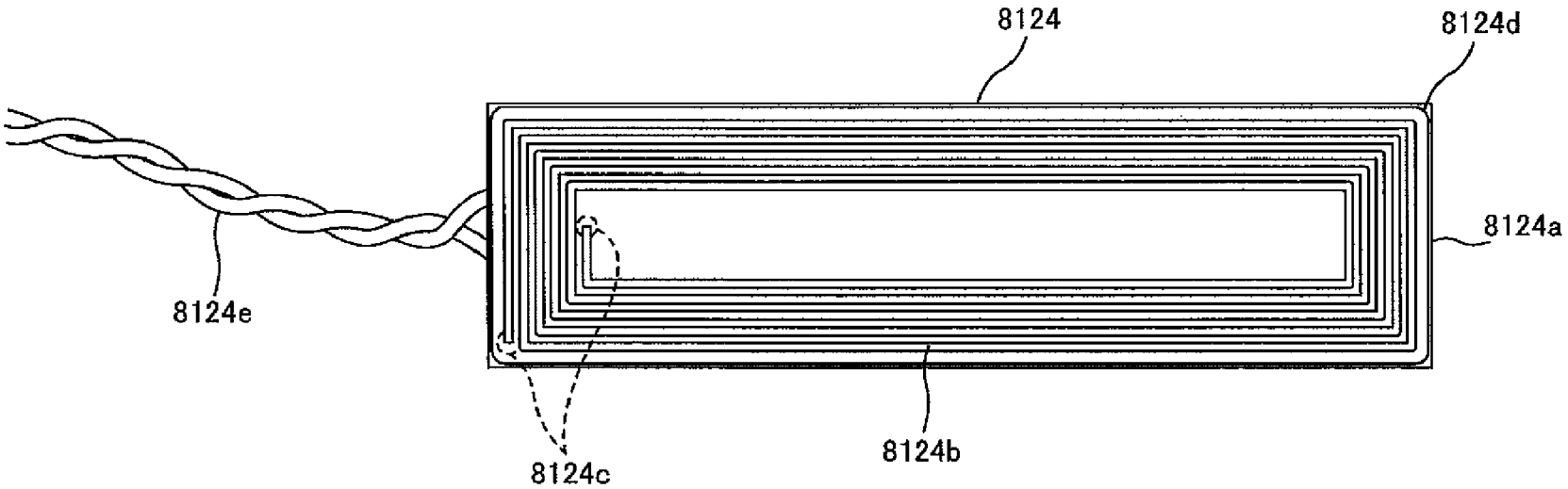
FIG. 117 is a diagram illustrating the antenna unit.
Figure 118:
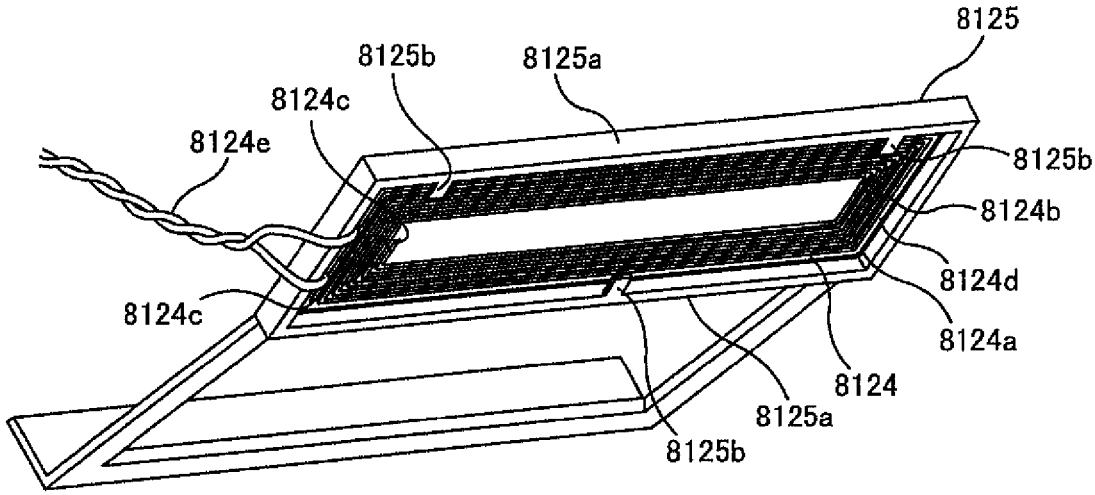
FIG. 118 is a diagram illustrating how the antenna unit is installed in a holder.
Figure 119:
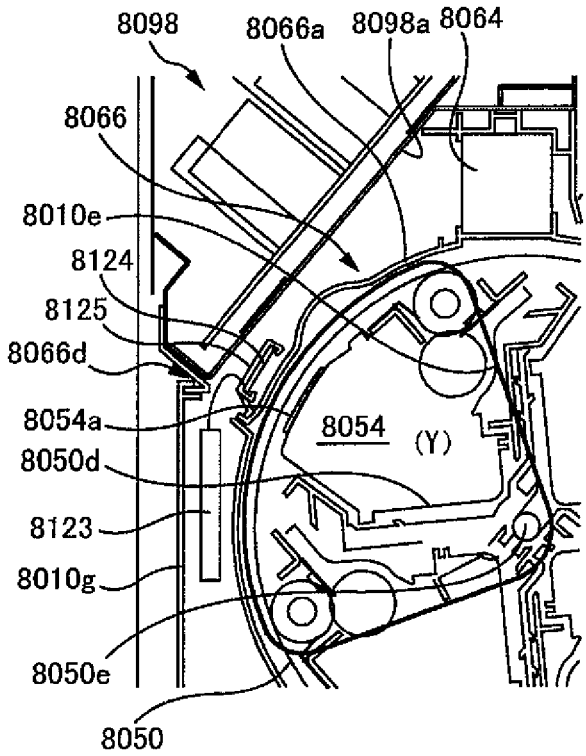
FIG. 119 is a diagram illustrating the arrangement of the antenna unit in a first working example of this embodiment.

FIG. 117 is a diagram illustrating the antenna unit 8124. FIG. 118 is a diagram illustrating how the antenna unit is attached to a holder. FIG. 119 is a diagram illustrating the arrangement of the antenna unit in a first working example of the ninth embodiment.

The antenna unit 8124 provided on the side of the printer 8010 includes a substrate 8124*a* that is formed on a plate material made of resin, an antenna 8124*b* serving as a second antenna that is made of copper foil wrapped in a planar coil shape along the outer shape of the substrate 8124*a*, substantially the same as in the communication unit 8054*a*, antenna terminals 8124*c* provided at the end portions of the antenna 8124*b*, and a film-shaped protective sheet 8124*d*. Furthermore, the two antenna terminals 8124*c* are each connected to a wire 8124*e* and connected to the control unit 8100 via the communication control module 8123. Here, the antenna unit 8124 of the present embodiment is configured having a protective sheet 8124*d*, but it is not necessarily required to provide the protective sheet 8124*d*.

The communication control module 8123 is an antenna driving circuit board for controlling the timing of the communication between the communication unit 8054*a* and the antenna 8124*b* and the writing of information into the non-contact IC chip 8054*b*, as well as the reading of information from the non-contact IC chip 8054*b*, and the exchange of this information between the communication unit 8054*a* and the unit controller 8102. Moreover, when the mounted yellow developing container 8054 is arranged in the communication position, the antenna 8054*d* of the communication unit 8054*a* and the antenna 8124*b* of the antenna unit 8124 are arranged along the radial direction of a circle given by the rotation trajectory of the developing container holding unit 8050, with an inner wall plate 8066*a* of the exhaust duct 8066 arranged between them. In the first working example shown in FIG. 119, the antenna unit 8124 is fixed with a holder 8125 made of resin to the inner wall plate 8066*a* of the exhaust duct 8066 made of resin.

The holder 8125 is box-shaped, covering the surroundings of the antenna unit 8124 as well as the sides of the substrate 8124*a* and open on one side, and is arranged such that the antenna 8124*b* faces the outer side from the open side. At the edges of the open sides of the holder 8125, flexible tongues 8125*b* protruding toward the inside are provided on opposing side walls 8125*a*. The antenna unit 8124 is accommodated inside the box-shaped holder 8125 and is held there by the tongues 8125*b*. That is to say, the antenna unit 8124 is held only by the holder 8125 made of resin, so that metal components such as screws are not required to fasten the antenna unit 8124.

If the communication unit 8054*a* and the antenna unit 8124 are in a predetermined positional relationship, for example, if they are within a distance of 10 mm of one another, then information can be exchanged in a noncontacting manner between the two. The communication unit 8054*a* is overall very compact and thin, and is adhesive on one of its sides and can be adhered to an object as a seal. It is also called a memory tag, for example, and is commercially available in various forms.

As shown in FIG. 115, the non-contact IC chip 8054*b* includes a resonance capacitor 8054*c*, a rectifier 8054*e*, a signal analysis section RF (Radio Frequency) 8054*f*, a controller 8054*g*, and the memory cell 8054*h*. The memory cell 8054*h* is a nonvolatile memory that can be electrically read and written, such as an NAND flash ROM, and is capable of storing information that has been written on it and reading stored information from the outside.

The antenna 8054*d* of the communication unit 8054*a* and the antenna unit 8124 communicate wirelessly with one another, so that information stored in the memory cell 8054*h* can be read and information can be written to the memory cell 8054*h*. Also, the high-frequency signals that are generated by the communication control module 8123 of the printer 8010 are induced as a high-frequency magnetic field via the antenna unit 8124. This high-frequency magnetic field is absorbed via the antenna 8054*d* of the communication unit 8054*a* and is rectified by the rectifier 8054*e*, thus serving as a DC power source for driving the circuits in the non-contact IC chip 8054*b*.

The memory cell 8054*h* of the communication unit 8054*a* stores various types of information, as shown in FIG. 116. The address 00H stores unique ID information for each communication unit, such as the serial number of the communication unit, the address 01H stores the date when the yellow developing container 8054 was manufactured, the address 02H stores information for specifying the destination of the yellow developing container 8054, the address 03H stores information for specifying the manufacturing line on which the yellow developing container 8054 was manufactured, the address 04H stores information for specifying models with which the yellow developing container 8054 is compatible, the address 05H stores remaining toner amount information as information indicating the amount of toner that is contained in the yellow developing container 8054, and the address 06H and subsequent regions also store information as appropriate.

The ID information that is stored in the memory cell 8054*h* of the communication unit 8054*a* can be written at the time that the storage communication unit is manufactured in the factory. The printer 8010 can read this ID information to identify the individual communication units 8054*a*, 8051*a*, 8052*a*, and 8053*a*.

It should be noted that it is also possible to let the antenna unit 8124 communicate wirelessly with the communication unit 8054*a* not only when the developing container holding unit 8050 is standing still but also when the developing container holding unit 8050 is moving. That is, the antenna unit 8124 may be able to communicate wirelessly with the communication unit 8054*a* even when the communication unit 8054*a* is moving.

===Communication Distance and Communication Region of Communication Units and Antenna Unit===

Figure 120:
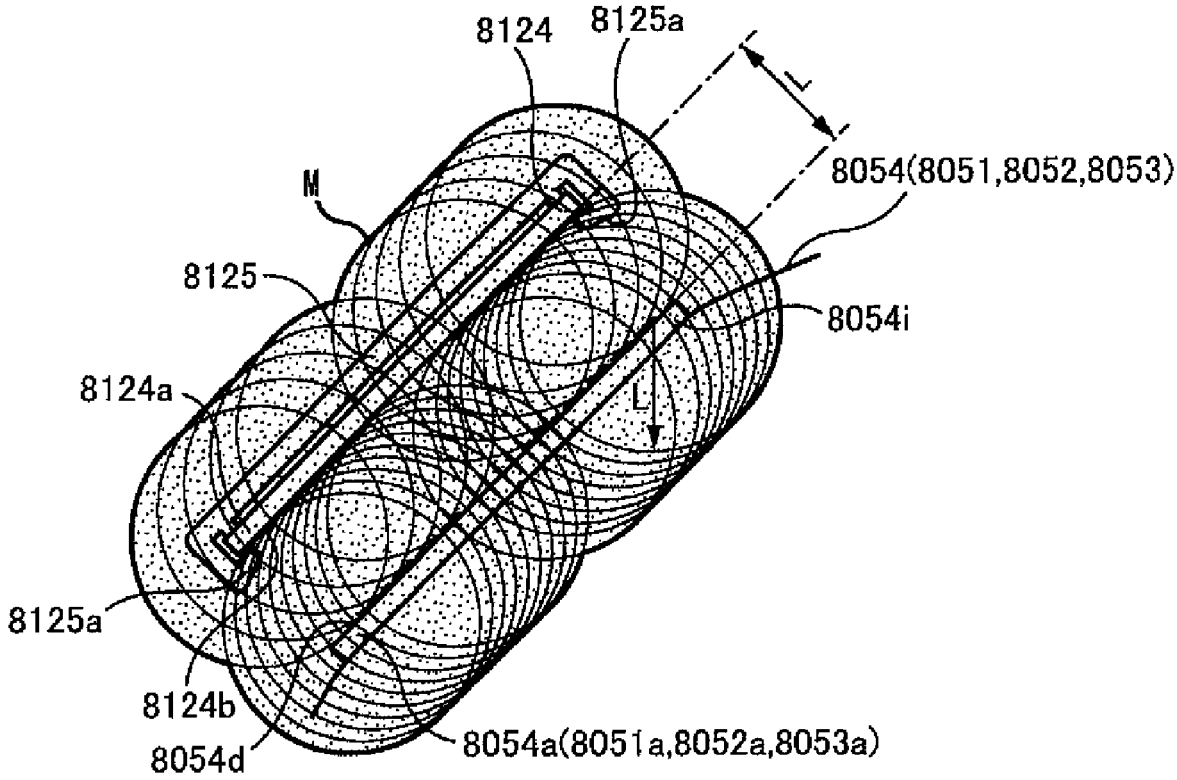
Figure 121:
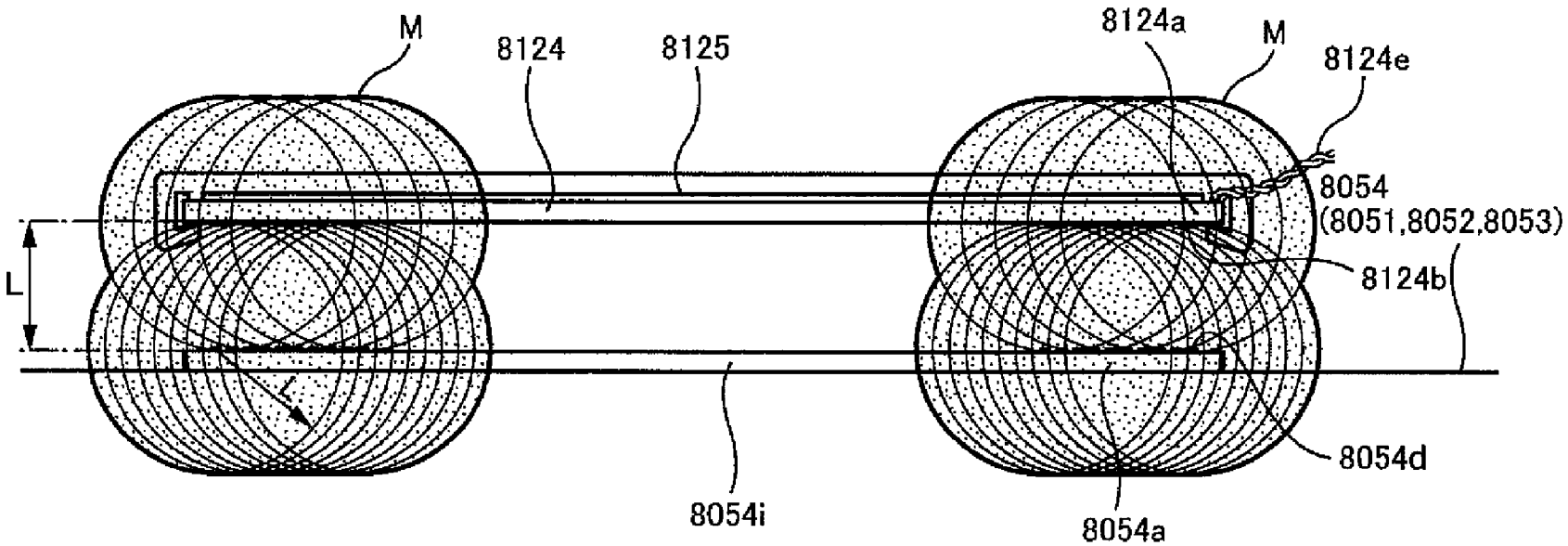

FIG. 120 is a cross-sectional view, taken from a direction perpendicular to the mounting direction, illustrating the communication distance and the communication region of the communication units and the antenna unit. FIG. 121 is a cross-sectional view, taken from a direction parallel to the mounting direction, illustrating the communication distance and the communication region of the communication units and the antenna unit.

As shown in these drawings, the communication units 8051*a*, 8052*a*, 8053*a*, and 8054*a* and the antenna unit 8124 are spaced apart by a communication distance L. The communication units 8051*a*, 8052*a*, 8053*a*, and 8054*a* are provided, respectively, on the developing containers 8051, 8052, 8053, and 8054. They are held by the developing container holding unit 8050 and are moved by rotating the developing container holding unit 8050 around its rotation shaft 8050*e*. For this reason, the antenna unit 8124, which is provided on the side of the printer 8010, is arranged at a position where it does not come into contact with the portion protruding furthest outward when the developing container holding unit 8050 holding the developing containers 8051, 8052, 8053, and 8054 rotates. On the other hand, rolls 8574 are provided on the shaft sections 8510*b* of the developing roller 8510 of the developing container, such that the developing roller 8510 and the photoconductor 8020 face each other at a predetermined distance. That is to say, the rolls 8574 are the only components that come in contact with the printer 8010. For this reason, the communication units 8051*a*, 8052*a*, 8053*a*, and 8054*a* are disposed inward from the outer circumference of the rolls 8574, that is, closer to the center of the rotation shaft 8050*e*, and the antenna unit 8124 is disposed outward from the outer circumference of the rolls 8574, that is, on the side that is further away from the center of the rotation shaft 8050*e*.

The communication units 8051*a*, 8052*a*, 8053*a*, and 8054*a* and the antenna unit 8124 are arranged such that they face each other at the above-mentioned communication position, preferably spaced apart at a communication distance L of, for example, 10 mm, at which satisfactory communication is possible. Moreover, the communication units 8051*a*, 8052*a*, 8053*a*, and 8054*a* do not include a power source, so that electric power is supplied to them through carrier waves from the antenna unit 8124. That is to say, electric power as well as signals are transmitted to the communication units 8051*a*, 8052*a*, 8053*a*, and 8054*a* through electromagnetic induction occurring between the planar coil-shaped antennas 8054*d* and 8124*b* with which the communication units 8051*a*, 8052*a*, 8053*a*, and 8054*a* and the antenna unit 8124 are respectively provided. For this reason, when the communication units 8051*a*, 8052*a*, 8053*a*, and 8054*a* and the antenna unit 8124 communicate, a magnetic flux occurs around the copper foils of the antennas 8051*d*, 8052*d*, 8053*d*, 8054*d*, and 8124*b*. This magnetic flux occurring at the antenna 8124*b* of the antenna unit 8124 then has to reach at least the antennas 8051*d*, 8052*d*, 8053*d*, and 8054*d* of the communication units 8051*a*, 8052*a*, 8053*a*, and 8054*a*, which are removed by at least the communication distance L. That is to say, for the communication units 8051*a*, 8052*a*, 8053*a*, and 8054*a* and the antenna unit 8124 to communicate, it is necessary that magnetic flux can be generated in a region of the distance L around the copper foils of the antennas 8051*d*, 8052*d*, 8053*d*, 8054*d*, and 8124*b* (referred to as "communication region M" below). Considering the precision of the components of the communication units 8051*a*, 8052*a*, 8053*a*, and 8054*a* and the antenna unit 8124 or attachment errors when attaching components to the printer 8010, it is preferable that the radius L, which defines the communication distance L and the communication region M, is set to such a distance that favorable communication conditions can be ensured.

In the case of this embodiment, around the communication units 8051*a*, 8052*a*, 8053*a*, and 8054*a* and the antenna unit 8124, a region of the distance L from the center of the copper foil constituting the antennas of the communication units and the antenna of the antenna unit becomes the communication region M, as shown in FIG. 120 and FIG. 121.

Now, if there are conductive members within this communication region M, then the magnetic flux occurring in the antenna 8124*b* passes through the conductive members, so that eddy currents flow through these conductive members with the magnetic flux at the axial center and the carrier wave is attenuated significantly. For this reason, the communication region M of this embodiment is set to such a region that no other conductive members besides the communication units 8051*a*, 8052*a*, 8053*a*, 8054*a*, the antenna unit 8124, and the wires 8124*e* are present within this communication region M.

===Arrangement of Exhaust Duct and Antenna Unit===

Figure 122:
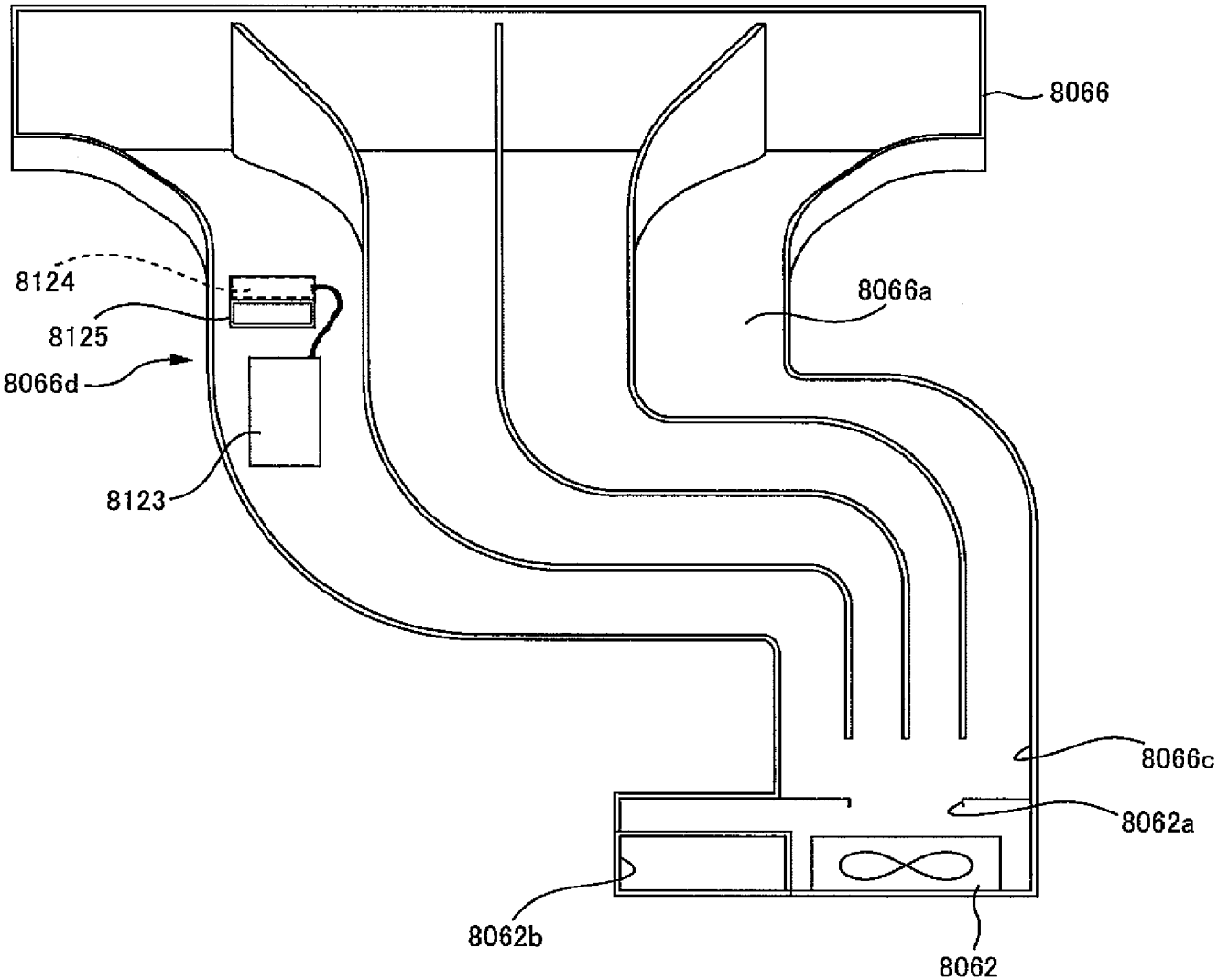

The following is, first of all, an explanation of the exhaust duct 8066 with which the antenna unit 8124 is provided. FIG. 122 is a diagram of the exhaust duct, taken from A3 in FIG. 103.

The exhaust duct 8066, whose opening 8066*b* on the inner side of the printer 8010 faces the photoconductor unit 8075, extends along the outer circumference of the developing container holding unit 8050, and is configured to exhaust air inside the printer that is sucked by an exhaust fan 8062 provided on the lower side of the printer 8010 to the outside. A portion of the wall on the outer circumferential side of the exhaust duct 8066 is constituted by the shielding member 8098*a* of the power source unit 8098 and the stay 8010*g*. Furthermore, the inner wall plate 8066*a* on the side of the developing container holding unit 8050, which constitutes the exhaust duct 8066, is made of resin.

Inside the exhaust duct 8066, a filter 8064 for scavenging toner, dust and the like included in the sucked air is arranged above the developing container holding unit 8050. The opening 8066*b* of the exhaust duct 8066 on the inner side of the printer 8010 has about the same width as the length of the photoconductor 8020 in longitudinal direction, and this width continues to a position where the filter 8064 is accommodated. The width of the exhaust duct 8066 on the side of the exhaust fan 8062 is narrower than the filter 8064. The antenna 8124 and the communication control module 8123 for communicating with the communication units 8051*a*, 8052*a*, 8053*a*, and 8054*a* provided on the developing containers are provided at a part where the width of the exhaust duct 8066 has become narrower. That is to say, upstream, with respect to the direction of the air flow, from an antenna placement part 8066*d* where the antenna unit 8124 is arranged, the exhaust duct 8066 has a part with a cross-sectional area that is larger than the cross-sectional area in a direction intersecting with the direction of the air flow at the antenna placement part 8066*d*. Moreover, an exhaust-side opening 8066*c* of the exhaust duct 8066 is connected to a suction port 8062*a* of the exhaust fan 8062, and an exhaust port 8062*b* of the exhaust fan 8062 is directed toward the outside of the printer 8010 in a direction perpendicular to the mounting direction of the developing containers in the printer 8010.

That is to say, with regard to the direction of the airflow within the exhaust duct 8066, the opening 8066*b* on the inner side of the printer, which is the most upstream side, follows in its longitudinal direction along the photoconductor 8020, and is arranged in opposition to the photoconductor 8020. Air inside the printer 8010 is sucked in from the opening 8066*b*, which has a larger cross-sectional area than the cross-sectional area at the antenna placement part 8066*d*. In this situation, also unnecessary toner near the developing containers 8051, 8052, 8053, and 8054 is sucked in from the opening 8066*b*. The air and the like that is sucked in is passed through the exhaust duct 8066 and reaches the filter 8064, and when it passes through the filter 8064, toner and the like mixed into the air is scavenged by the filter 8064. The air that has passed through the filter 8064 flows to the downstream side while the speed of the air flow is accelerated due to the fact that the shape of the exhaust duct 8066 becomes narrower. The accelerated air flow passes along the antenna unit 8124, which is provided inside the exhaust duct 8066 at the antenna placement part 8066*d*. Thus, the antenna unit 8124 is cooled by the air flow. As the air that has passed the antenna placement part 8066*d* is output from the exhaust-side opening 8066*c* on the furthest downstream in the exhaust duct 8066, it flows from the suction port 8062*a* into the exhaust fan 8062 and is exhausted from the exhaust port 8062*b* to the outside of the printer 8010.

With the printer 8010 according to this first working example of the ninth embodiment, the exhaust duct 8066 provided inside the printer 8010 is a passageway of an air flow, so that the inside of the exhaust duct 8066 is cooled by the airflow. Therefore, also the antenna 8124*b* of the antenna unit 8124 with which the exhaust duct 8066 is provided is cooled, so that a temperature increase of the antenna 8124*b* is suppressed. That is to say, by providing the antenna 8124*b* inside the exhaust duct 8066, the antenna 8124*b* is cooled directly by the air flow, so that it is possible to cool the antenna 8124*b* efficiently. By suppressing an increase in temperature due to the cooling, it is possible to ensure favorable communication between the printer 8010 and the communication unit 8054*a*.

Furthermore, with the printer 8010 according to the ninth embodiment, upstream of the antenna placement part 8066*d*, there is a part having a cross-sectional area that is larger than the cross-sectional area in the direction perpendicular to the direction of the air flow at the antenna placement part 8066*d*, for example the part where the filter 8064 is provided, so that the air flow within the exhaust duct 8066 is accelerated at the antenna placement part 8066*d*. Therefore, the antenna 8124*b* of the antenna unit 8124 provided at the antenna placement part 8066*d* can be cooled more efficiently by the fast air flow.

Furthermore, the inner wall plate 8066*a* of the exhaust duct 8066 is made of resin, that is, a non-conductive member, so that it is possible to ensure favorable communication through the antenna 8054*d*, without blocking the antenna 8124*b* with the exhaust duct 8066. Therefore, by providing the antenna unit 8124 inside the exhaust duct 8066 in order to cool the antenna unit 8124, it is possible to ensure favorable communication conditions, even when the inner wall plate 8066*a* of the exhaust duct 8066 is arranged between the antenna unit 8124 and the communication unit 8054*a*.

Moreover, as a method for cooling the antenna unit 8124, the exhaust duct 8066 for exhausting the air inside the printer 8010 to outside of the printer 8010 is used, so that it is possible to cool the antenna 8124*b* by using the air flow generated by exhausting the air inside the printer 8010, without providing a separate cooling device.

Moreover, the filter 8064 is provided upstream of the antenna unit 8124, with respect to the direction of the air flow inside the exhaust duct 8066, so that it is possible to prevent dirt, dust and the like inside the printer 8010 from adhering to the antenna unit 8124. Now, if no filter 8064 is provided, and conductive material, such as iron powder is included in the dust, dirt and the like inside the printer 8010, then there is the risk that favorable communication with the communication unit 8054*a* through the antenna unit 8124 is not possible when this iron powder or the like adheres to the antenna unit 8124. Since the filter 8064 is provided upstream of the antenna unit 8124, iron powder and the like is prevented from adhering to the antenna 8124*b*, and a favorable communication state is maintained.

Moreover, the printer 8010 according to the first working example of the ninth embodiment is a laser printer, so that for example toner is used as the developer. Therefore, the exhaust duct 8066 and the filter 8064 are typically provided inside the printer 8010, so that no toner is scattered, but by using this exhaust duct 8066 to cool the antenna unit 8124, it is possible to realize favorable communication via the communication unit 8054*a* and the antenna unit 8124, while preventing the scattering of the toner.

Moreover, in the printer 8010 according to this first working example of the ninth embodiment, also the communication control module 8123 connected to the antenna 8124*b* is provided inside the exhaust duct 8066, so that it is possible to cool also the communication control module 8123 with the air flow inside the exhaust duct 8066.

Figure 123:
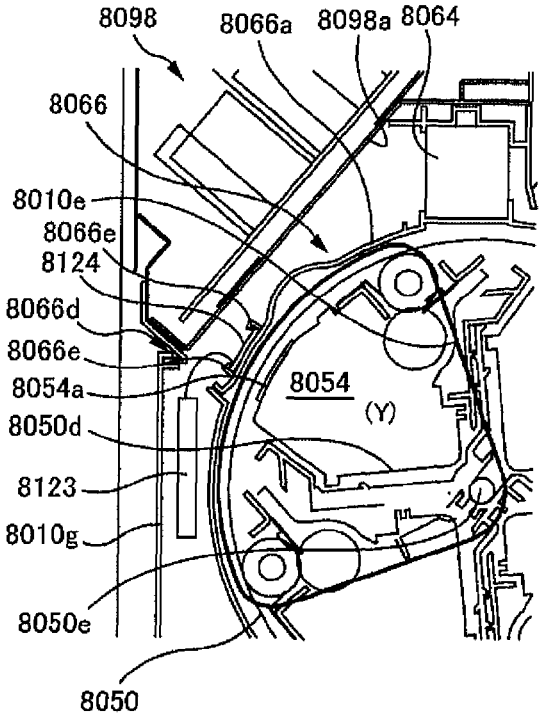

FIG. 123 is a diagram showing a second working example of the ninth embodiment. In the second working example shown in the diagram, flexible tongues 8066*e* protruding from the inner wall plate 8066*a* of the exhaust duct 8066 into the exhaust duct 8066 is provided, and the antenna unit 8124 is directly fixed to an inner wall surface 8066*f* by these tongues 8066*e*. Therefore, it is not necessary to provide a separate member for fixing the antenna unit 8124. That is to say, it is possible to directly expose the antenna unit 8124 to the air flow and cool it efficiently, while reducing the number of parts and the number of man-hours for assembly. In this case, the antenna unit 8124 does not protrude deeply into the exhaust duct 8066 as in the first working example, so that it is less likely to obstruct the air flow, but since only one side of the antenna unit 8124 can be exposed to the air flow, the cooling efficiency is lower than in the first working example.

Figure 124:
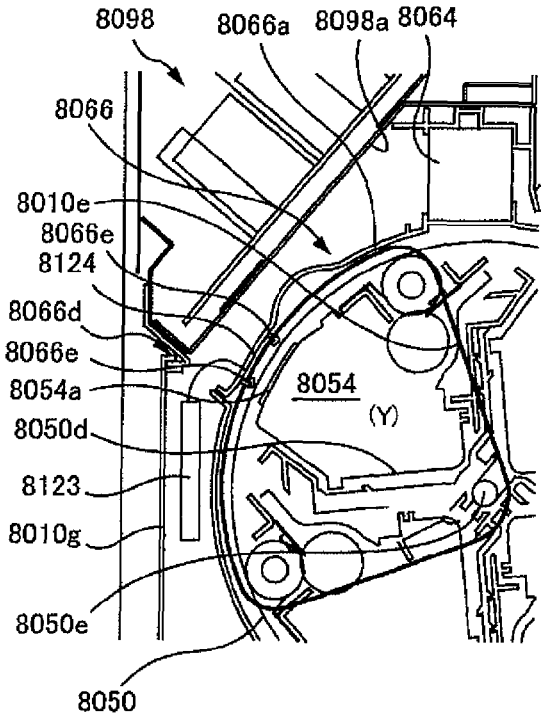

FIG. 124 is a diagram showing a third working example. In the third working example shown in the diagram, flexible tongues 8066*e* protruding in a direction out of the exhaust duct 8066 from the inner wall plate 8066*a* of the exhaust duct 8066 are provided, and the antenna unit 8124 is directly fixed to the inner wall plate 8066*a* by these tongues 8066*e*. Therefore, as in the second working example, it is not necessary to provide a separate member for fixing the antenna unit 8124, and it is possible to cool the antenna unit 8124 while reducing the number of parts and the number of man-hours for assembly. However, in the third working example, the antenna unit 8124 is provided on an outer wall surface 8066*g* of the exhaust duct 8066, so that the antenna unit 8124 is cooled via the inner wall plate 8066*a* of the exhaust duct 8066. Therefore, the efficiency with which the antenna unit 8124 is cooled is lower than in the first working example and the second working example. On the other hand, in comparison to the first working example and the second working example, in which the antenna unit 8124 is provided inside the exhaust duct 8066, the inner wall plate 8066*a* is present between the antenna unit 8124 and the communication unit 8054*a*, so that it is possible to arrange the antenna unit 8124 and the communication unit 8054*a* closer to each other than in the first working example and the second working example. Thus, it is possible to arrange the antenna unit 8124 and the communication unit 8054 at a distance at which favorable communication is possible, and furthermore to achieve favorable communication by cooling the antenna 8124*b* via the exhaust duct 8066.

In the present embodiment, an example was shown in which both the antenna unit 8124 and the communication control module 8123 are arranged in the exhaust duct 8066, but it is also possible to arrange only the antenna unit 8124 in the exhaust duct 8066. Moreover, the antenna unit 8124 was arranged in the exhaust duct 8066, but as long as it is a part at which an air flow is generated, it is also possible to arrange it in a suction duct, or to arrange it in a duct that is provided for cooling a specified unit, such as the exposing unit 8040.

Other Embodiments

An image forming apparatus or the like according to this invention was explained by way of the foregoing embodiment, but the foregoing embodiment of the invention is merely for the purpose of elucidating the present invention and is not to be interpreted as limiting the present invention. The invention can of course be altered and improved without departing from the gist thereof and equivalents are intended to be embraced therein.

In the foregoing embodiment, an intermediate image transfer type full-color laser beam printer was described as an example of the image forming apparatus, but the present invention can also be applied to various other types of image forming apparatuses, such as full-color laser beam printers that are not of the intermediate image transfer type, monochrome laser beam printers, copying machines, and facsimiles.

Also, in the foregoing embodiment, the photoconductor, which is an image bearing member, was explained as having a photoconductive layer on the outer circumferential surface of a hollow cylindrical conductive member, but there is no limitation to this. For example, it may also be a so-called photoconductive belt, in which a photoconductive layer is provided on the surface of a belt-shaped photoconductive member.

Furthermore, in the foregoing embodiment, as shown in FIG. 103 for example, the mounting and dismounting sections 8050*a*, 8050*b*, 8050*c*, and 8050*d* are movable, and when the developing containers 8051, 8052, 8053, and 8054 are mounted to the mounting and dismounting sections and are moved to the developing position through the movement of the mounting and dismounting sections, then the latent image borne on the photoconductor 8020 (image bearing member) provided in the printer 8010 is developed. Moreover, the communication units 8051*a*, 8052*a*, 8053*a*, and 8054*a* communicate in a noncontacting manner with the printer 8010 when the developing containers 8051, 8052, 8053, and 8054 have been moved to the communication position, which is different from the developing position. However, there is no limitation to this. For example, it is also possible to let the developing containers not move at all.

However, if the developing containers 8051, 8052, 8053, and 8054 move together with the movement of the mounting and dismounting sections 8050*a*, 8050*b*, 8050*c*, and 8050*d*, then the relative position between the developing container main units and the coupling member 8590 changes more easily when the developing containers are positioned in the communication position than in the case that the developing containers do not move, so that there is a greater risk that the distance between the printer 8010 and the elements 8051*a*, 8052*a*, 8053*a*, and 8054*a* changes. Therefore, the effect of providing the communication unit on the one end side in the longitudinal direction of the developing container main units, that is, the effect that developing containers can be realized that can communicate properly with the printer 8010 is more advantageous in the case that the developing containers move together with the movement of the mounting and dismounting sections. For this reason, the above-described embodiment is more preferable.

Furthermore, in the foregoing embodiment, as shown in FIG. 110, the developing container main units include a developing roller 8510 (developer bearing member) for bearing toner T (developer) and developing the latent image borne on the photoconductor 8020 with toner T, and rolls 8574 (distance holding members) that are provided at both end portions in the longitudinal direction of the developing rollers 8510 and that are for holding a distance between the photoconductor 8020 and the developing roller 8510 by coming into contact with the photoconductor 8020. Moreover, when the developing containers 8051, 8052, 8053, and 8054 are moved to the developing position, the rolls 8574 hold this distance by coming into contact with the photoconductor 8020. However, there is no limitation to this.

Furthermore, in the above-described embodiment, as shown in FIG. 108, the developing container main unit is supported by the housing 8540 at both end portions in the longitudinal direction, and is provided with the developing roller 8510 for bearing the toner T and developing the latent image borne on the photoconductor 8020 with the toner T. Moreover, as shown in FIG. 109, the outer surface 8543 of the housing 3540 is provided with a circularly arc-shaped surface 8543*a*, whose cross section through a perpendicular plane that is perpendicular to the longitudinal direction of the housing 8540 is circularly arc-shaped. As shown in FIG. 109, the communication units 8051*a*, 8052*a*, 8053*a*, and 8054*a* are attached at positions of the circularly arc-shaped surface 8543*a* that are furthest removed from the developing rollers 8510. However, there is no limitation to this. For example, it is also possible that the communication units are attached at positions of the circularly arc-shaped surface 8543*a* that are close to the developing rollers 8510.

However, if the communication units 8051*a*, 8052*a*, 8053*a*, and 8054*a* are attached at the positions of the circularly arc-shaped surface 8543*a* that are furthest removed from the developing rollers 8510, then it can be prevented that the toner T borne on the developing rollers 8510 is scattered and adheres to the communication units, so that the communication units can communicate more properly with the printer 8010. For this reason, the above-described embodiment is more preferable.

===Configuration of Image Forming System Etc.===

Next, an embodiment of an image forming system serving as an example of an embodiment of the present invention is described with reference to the drawings.

Figure 125:
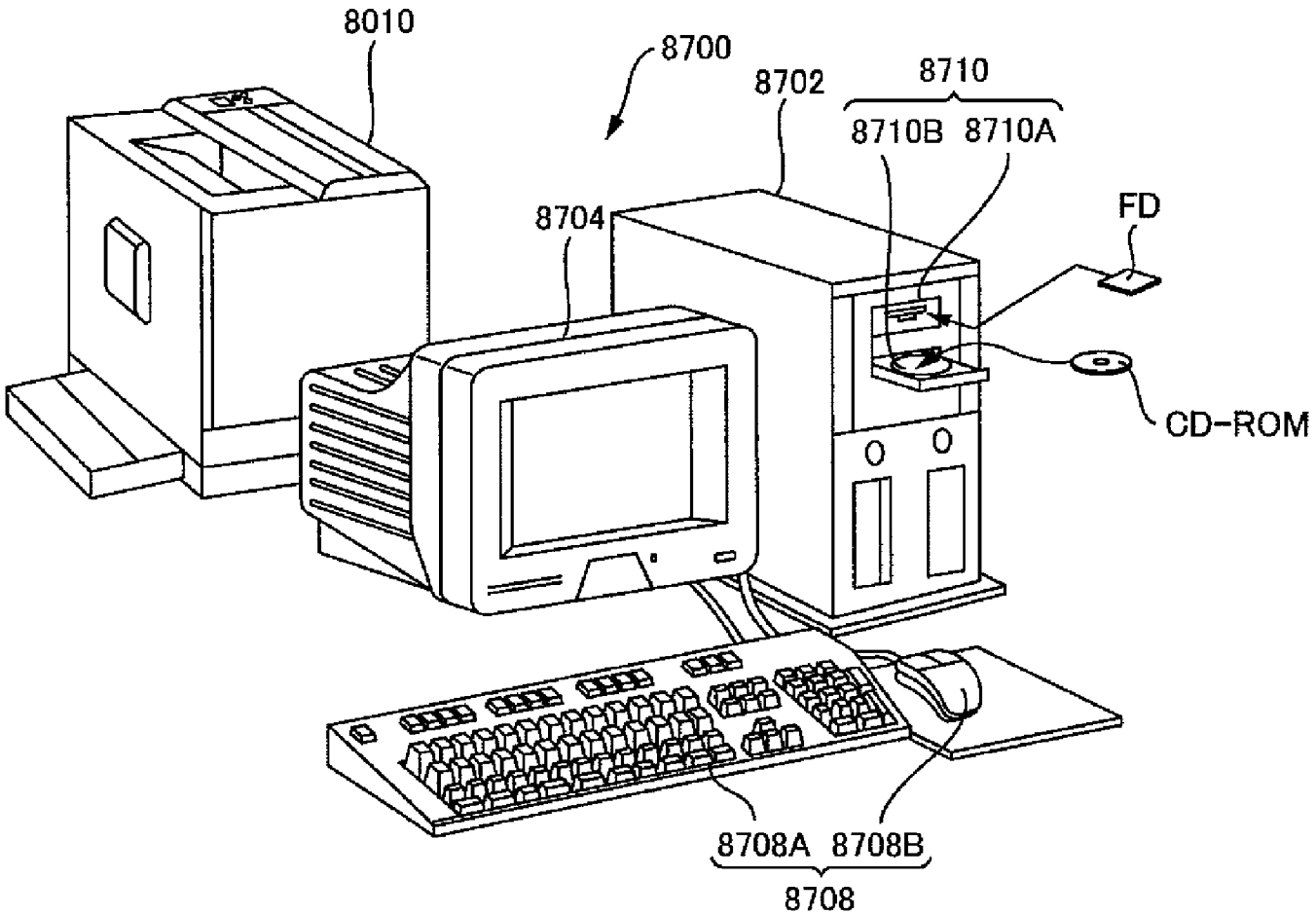

FIG. 125 is an explanatory diagram showing the external configuration of an image forming system. An image forming system 8700 is provided with a computer 8702, a display device 8704, a printer 8010, input devices 8708 and reading devices 8710.

In this embodiment, the computer 8702 is contained within a mini-tower type housing, but there is no limitation to this. A CRT (cathode ray tube), plasma display, or liquid crystal display device, for example, is generally used as the display device 8704, but there is no limitation to this. As the printer 8010, the printer described above is used. In this embodiment, the input devices 8708 are a keyboard 8708A and a mouse 8708B, but there is no limitation to these. In this embodiment, a flexible disk drive device 8710A and a CD-ROM drive device 8710B are used as the reading devices 710, but there is no limitation to these, and it is also possible to use an MO (magneto-optical) disk drive device or a DVD (digital versatile disk), for example.

Figure 126:
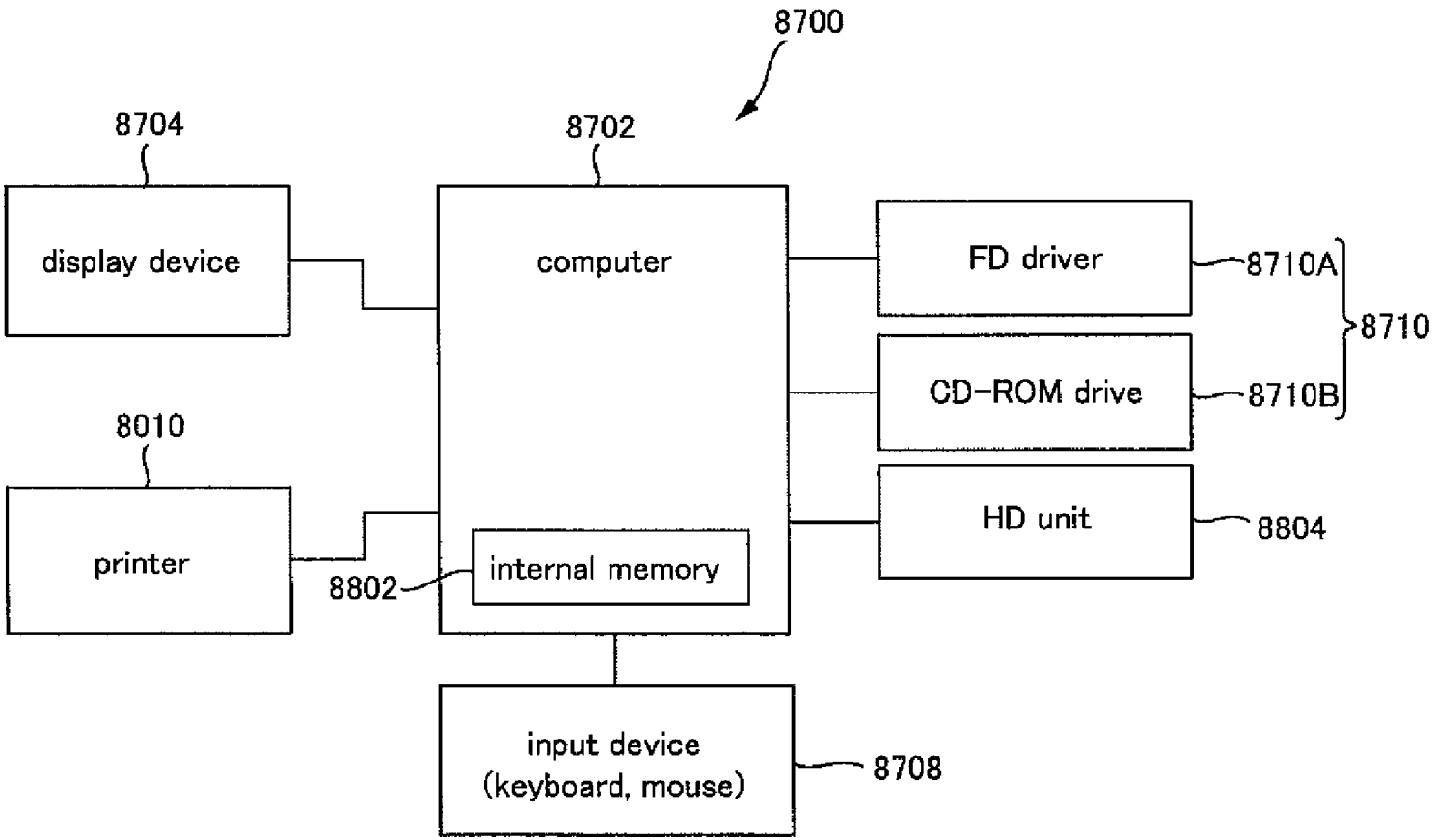

FIG. 126 is a block diagram showing the configuration of the image forming system shown in FIG. 125. An internal memory 8802 such as a RAM is provided within the casing containing the computer 8702, and furthermore an external memory such as a hard disk drive unit 8804 is provided.

In the above explanations, an example was given in which the image forming system is constituted by connecting the printer 8010 to the computer 8702, the display device 8704, the input devices 8708, and the reading devices 8710, but there is no limitation to this. For example, the image forming system may also be made of the computer 8702 and the printer 8010, and the image forming system does not have to be provided with any one of the display device 8704, the input devices 8708, and the reading devices 8710.

It is also possible that the printer 8010 has some of the functions or mechanisms of the computer 8702, the display device 8704, the input devices 8708, and the reading devices 8710. For example, the printer 8010 may be configured so as to have an image processing section for carrying out image processing, a display section for carrying out various types of displays, and a recording media mounting and dismounting section into and from which recording media storing image data captured by a digital camera or the like are inserted and taken out.

As an overall system, the image forming system that is thus achieved is superior to conventional systems.

Overview of Image Forming Apparatus of Tenth Embodiment

Figure 127:
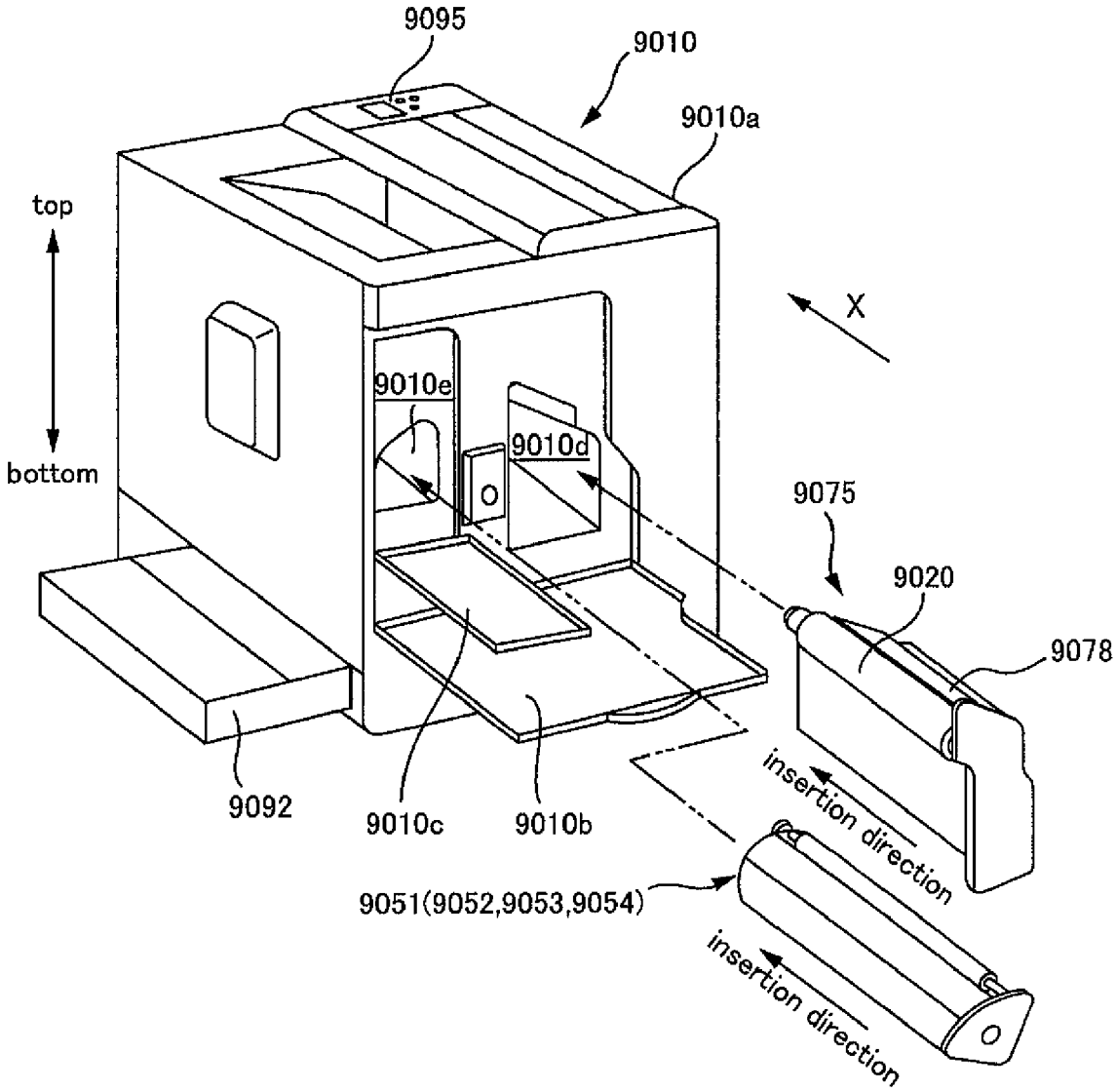
Figure 128:
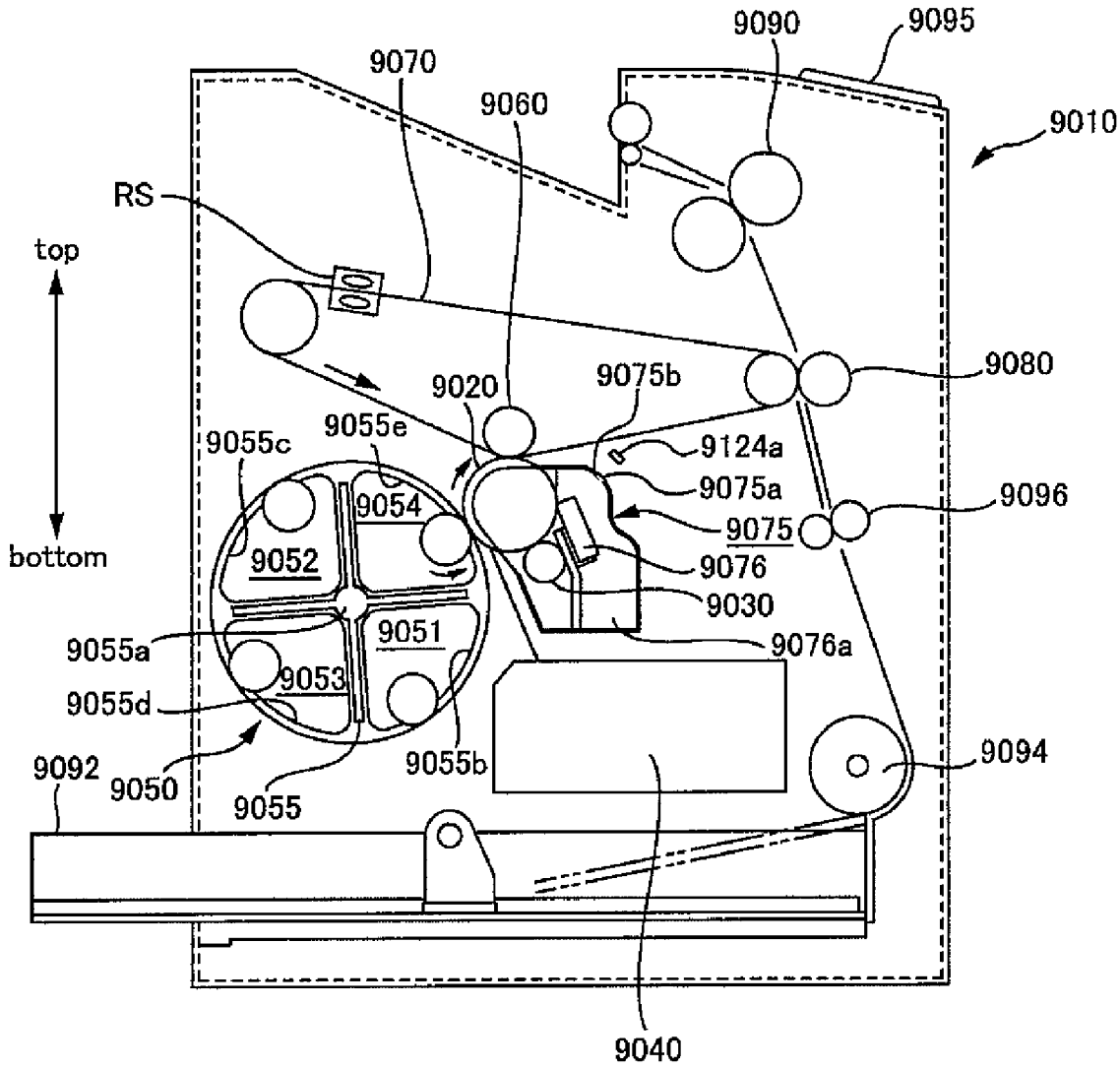

Next, using FIG. 127 and FIG. 128, an overview of a laser beam printer (hereinafter, also referred to as "printer") 9010 serving as an example of an image forming apparatus is described. FIG. 127 is a diagram illustrating how the developing unit 9051 (9052, 9053, 9054) and the photoconductor unit 9075 are mounted to and dismounted from the printer main unit 9010*a*, which is an example of an image forming apparatus. FIG. 128 is a diagram showing the main structural components constituting the printer 9010. It should be noted that FIG. 128 is a diagram of a cross section taken perpendicular to the X direction in FIG. 127. Also, the vertical direction is indicated by arrows in FIG. 127 and FIG. 128, and for example, a paper supply tray 9092 is disposed at a lower part of the printer 9010 and a fixing unit 9090 is disposed at an upper part of the printer 9010.

<<<Mounting and Dismounting Configuration>>>

The developing unit 9051 (9052, 9053, 9054) and the photoconductor unit 9075 can be mounted to and dismounted from the printer main unit 9010*a*. The printer 9010 is constituted by mounting the developing unit 9051 (9052, 9053, 9054) and the photoconductor unit 9075 to the printer main unit 9010*a*.

The printer main unit 9010*a* has a first opening and closing cover 9010*b* that can be opened and closed, a second opening and closing cover 9010*c* that can be opened and closed and that is provided more inward than the first opening and closing cover 9010*b*, a photoconductor unit mounting and dismounting opening 9010*d* through which the photoconductor unit 9075 is mounted and dismounted, and a developing unit mounting and dismounting opening 9010*e* through which the developing unit 9051 (9052, 9053, 9054) is mounted and dismounted.

Here, by opening the first opening and closing cover 9010*b*, the user can mount and dismount the photoconductor unit 9075 with respect to the printer main unit 9010*a* through the photoconductor unit mounting and dismounting opening 9010*d*. The photoconductor unit 9075 is mounted to the printer main unit 9010*a* by inserting it into the printer main unit 9010*a*.

Further, by opening the second opening and closing cover 9010*c*, the user can mount and dismount the developing unit 9051 (9052, 9053, 9054) with respect to the printer main unit 9010*a* through the developing unit mounting and dismounting opening 9010*e*. The developing unit 9051 (9052, 9053, 9054) is mounted to the printer main unit 9010*a* by inserting it into the printer main unit 9010*a*.

<<<Overview of the Printer 9010>>>

The following explains an overview of the printer 9010 in which the developing unit 9051 (9052, 9053, 9054) and the photoconductor unit 9075 are mounted to the printer main unit 9010*a*.

As shown in FIG. 128, the printer 9010 of this embodiment has a charging unit 9030, an exposing unit 9040, a YMCK developing device 9050, a primary image transfer unit 9060, an intermediate image transfer member 9070, and a cleaning blade 9076, arranged along the rotation direction of the photoconductor 9020. It further includes a secondary image transfer unit 9080, a fixing unit 9090, a display unit 9095 made of a liquid crystal panel for constituting means for notifying the user, for example, and a control unit 9100 (FIG. 129) for controlling these units, for example, so as to control the operation of the printer 9010.

The photoconductor 9020 has a hollow cylindrical conductive base and a photoconductive layer formed on the outer circumferential surface of the conductive base, and is rotatable around its center axis. In the present embodiment, the photoconductor 9020 rotates clockwise, as indicated by the arrow in FIG. 128.

The charging unit 9030 is a device for charging the photoconductor 9020. The exposing unit 9040 is a device for forming a latent image on the charged photoconductor 9020 by irradiating a laser beam thereon. The exposing unit 9040 includes, for example, a semiconductor laser, a polygon mirror, and an F-θ lens, and irradiates a modulated laser beam onto the charged photoconductor 9020 in accordance with image signals that have been input from a host computer not shown in the drawings, such as a personal computer or a word processor.

The YMCK developing device 9050 has a rotary 9055 that serves as a rotating member, and four developing units mounted to the rotary 9055. The rotary 9055 is capable of rotation, and is provided with tour mounting and dismounting sections 9055*b*, 9055*c*, 9055*d*, and 9055*e* with respect to which the four developing units 9051, 9052, 9053 and 9054, respectively, can be mounted and dismounted through the developing unit mounting and dismounting opening 9010*e*. The black developing unit 9051, which accommodates black (K) toner, can be mounted to and dismounted from the mounting and dismounting section 9055*b*, the magenta developing unit 9052, which accommodates magenta (M) toner, can be mounted to and dismounted from the mounting and dismounting section 9055*c*, the cyan developing unit 9053, which accommodates cyan (C) toner, can be mounted to and dismounted from the mounting and dismounting section 9055*d*, and the yellow developing unit 9054, which accommodates black yellow (Y) toner, can be mounted to and dismounted from the mounting and dismounting section 9055*e*.

By rotating, the rotary 9055 moves the four developing units 9051, 9052, 9053, and 9054 that are mounted to the mounting and dismounting sections 9055*b*, 9055*c*, 9055*d*, and 9055*e*, respectively. That is, the rotary 9055 rotates the four mounted developing units 9051, 9052, 9053, and 9054 about a central shaft 9055*a* while maintaining their positions relative to one another. The developing units 9051, 9052, 9053, and 9054 are selectively brought into opposition with the latent image formed on the photoconductor 9020, and develop the latent image on the photoconductor 9020 with the toner, which is an example of a developer, contained in the developing units 9051, 9052, 9053, and 9054. It should be noted that the developing units are described in detail later.

The primary image transfer unit 9060 is a device for transferring a single color toner image formed on the photoconductor 9020 to the intermediate image transfer member 9070. When the four toner colors are successively transferred over one another, a full color toner image is formed on the intermediate image transfer member 9070.

The intermediate image transfer member 9070 is a layered endless belt made by providing a tin vapor deposition layer on the surface of a PET film and forming a semiconductive coating on its surface. The intermediate image transfer member 9070 is driven to rotate at substantially the same circumferential speed as the photoconductor 9020. A read sensor RS for synchronization is provided near the intermediate image transfer member 9070. The read sensor RS for synchronization is a sensor for detecting a reference position of the intermediate image transfer member 9070, and obtains a synchronization signal Vsync in the sub-scanning direction, which is perpendicular to the main scanning direction. The read sensor RS for synchronization has a light-emitting section for emitting light and a light-receiving section for receiving light. Light that is emitted from the light-emitting section passes through a hole formed at a predetermined position of the intermediate image transfer member 9070, and when light is received by the light-receiving section, the read sensor RS for synchronization generates a pulse signal. One pulse signal is generated for each revolution of the intermediate image transfer member 9070.

The secondary image transfer unit 9080 is a device for transferring a single color toner image or a full color toner image formed on the intermediate image transfer member 9070 to a recording medium such as paper, film, or cloth.

The fixing unit 9090 is a device for fusing the single color toner image or the full color toner image that has been transferred to the recording medium on the recording medium, such as paper, making it a permanent image.

The cleaning blade 9076 is made of rubber and is in contact with the surface of the photoconductor 9020. The cleaning blade 9076 scrapes off and removes toner remaining on the photoconductor 9020, after the toner image has been transferred to the intermediate image transfer member 9070 by the primary image transfer unit 9060.

Figure 129:
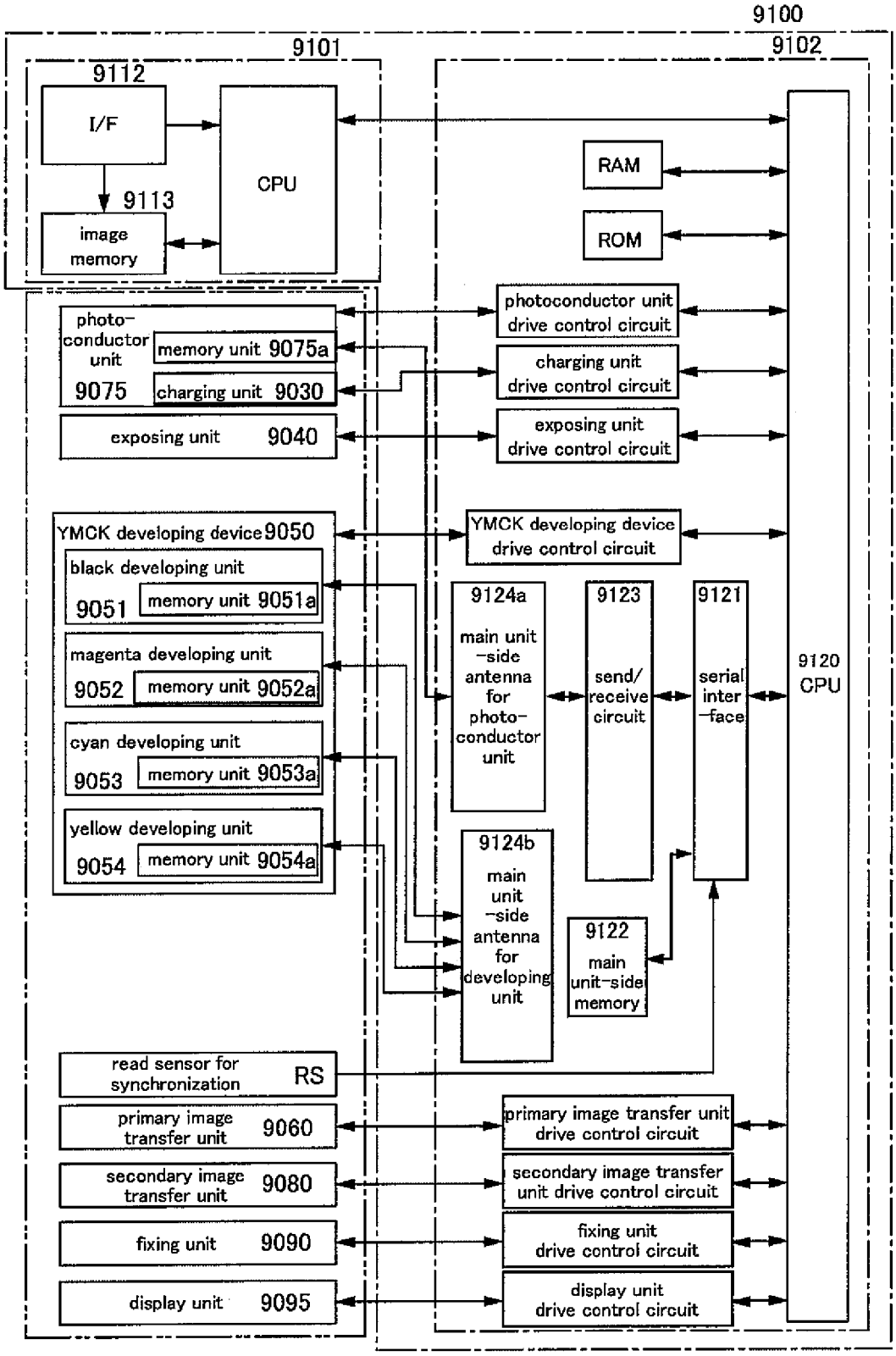

The control unit 9100 is made of a main controller 9101 and a unit controller 9102, as shown in FIG. 129. An image signal is input into the main controller 9101, and in accordance with a command based on this image signal, the unit controller 9102 controls the various units, for example, to form the image.

The photoconductor unit 9075 is arranged between the primary image transfer unit 9060 and the exposing unit 9040, and includes the photoconductor 9020, the charging unit 9030, the cleaning blade 9076, a waste toner containing section 9076*a* containing toner that has been scraped off by the cleaning blade 9076, a housing 9075*b*, and a memory unit 9075*a* that is provided in this housing 9075*b*. The memory unit 9075*a* is capable of wireless communication with a main unit-side antenna 9124*a* for the photoconductor unit, with which the printer main unit 9010*a* is provided.

===Operation of the Printer 9010===

The operation of the printer 9010 configured as above is described below, referring to other structural components thereof as well.

First, when an image signal from a host computer not shown in the drawings is input to the main controller 9101 of the printer 9010 via an interface (I/F) 9112, the photoconductor 9020 and the intermediate image transfer member 9070 are rotated under the control of the unit controller 9102 based on a command from the main controller 9101. Then, the reference position of the intermediate image transfer member 9070 is detected by the read sensor RS for synchronization, and a pulse signal is output. This pulse signal is sent to the unit controller 9102 via a serial interface 9121. The unit controller 9102 controls the following operation, taking the pulse signal that is received as a reference.

While rotating, the photoconductor 9020 is successively charged by the charging unit 9030 at a charging position. The region of the photoconductor 9020 that has been charged is brought to an exposure position through rotation of the photoconductor 9020, and a latent image corresponding to image information of a first color, for example yellow Y, is formed at that region by the exposing unit 9040.

The latent image formed on the photoconductor 9020 is brought to a developing position through the rotation of the photoconductor 9020, and is developed with yellow toner by the yellow developing unit 9054. Thus, a yellow toner image is formed on the photoconductor 9020.

The yellow toner image that is formed on the photoconductor 9020 is brought to the primary image transfer position through rotation of the photoconductor 9020 and is transferred to the intermediate image transfer member 9070 by the primary image transfer unit 9060. At this time, a primary image transfer voltage of a polarity that is opposite the toner charge polarity is applied to the primary image transfer unit 9060. It should be noted that, during this process, the photoconductor 9020 and the intermediate image transfer member 9070 are in contact, whereas the secondary image transfer unit 9080 is kept separated from the intermediate image transfer member 9070.

The above process is repeated for a second color, a third color, and a fourth color, transferring different color toner images corresponding to various image signals over one another onto the intermediate image transfer unit 9070. Thus, a full color toner image is formed on the intermediate image transfer member 9070. The full color toner image that is formed on the intermediate image transfer member 9070 is brought to the secondary image transfer position through the rotation of the intermediate image transfer member 9070 and is transferred to a recording medium by the secondary image transfer unit 9080. It should be noted that the recording medium is carried from the paper supply tray 9092 to the secondary image transfer unit 80 via a paper supply roller 9094 and registration rollers 9096. Also, when performing the image transfer operation, the secondary image transfer unit 9080 is pressed against the intermediate image transfer member 9070 while applying a secondary image transfer voltage to it.

The fixing unit 9090 heats and applies pressure to the full color toner image that has been transferred to the recording medium, thus fusing it to the recording medium.

On the other hand, after the photoconductor 9020 has passed the primary image transfer position, the toner adhering to its surface is scraped off by the cleaning blade 9076, and it is provided with a charge for forming the next latent image. The toner that is wiped away is collected in the waste toner containing section 9076*a*.

===Overview of the Control Unit===

The configuration of the control unit 9100 is described next, with reference to FIG. 129. FIG. 129 is a block diagram showing the control unit 9100 provided in the printer 9010.

The main controller 9101 of the control unit 9100 is connected to a host computer via an interface 9112, and is provided with an image memory 9113 for storing image signals that it receives from this host computer.

The unit controller 9102 of the control unit 9100 is electrically connected to the various units (the charging unit 9030, the exposing unit 9040, the primary image transfer unit 9060, the photoconductor unit 9075, the secondary image transfer unit 9080, the fixing unit 9090, and the display unit 9095) and the YMCK developing device 9050. Receiving signals from the sensors provided in these components, the unit controller 9102 controls these units and the YMCK developing device 9050 based on signals input from the main controller 9101 as it detects the state of these units and the YMCK developing device 9050. As the structural components for driving these units and the YMCK developing device 9050, FIG. 129 shows a photoconductor unit drive control circuit, a charging unit drive control circuit, an exposing unit drive control circuit, a YMCK developing device drive control circuit, a primary image transfer unit drive control circuit, a secondary image transfer unit drive control circuit, a fixing unit drive control circuit, and a display unit drive control circuit.

Also, the CPU 9120 provided in the unit controller 9102 is connected to a non-volatile storage element (hereinafter, also referred to as main unit-side memory 9122) such as a serial EEPROM via the serial interface (I/F) 9121.

Moreover, the CPU 9120 is capable of wirelessly communicating with later-described memory units 9051*a*, 9052*a*, 9053*a*, and 9054*a*, which are respectively provided in the developing units 9051, 9052, 9053, and 9054, via the serial interface 9121, a send-receive circuit 9123, and a main unit-side antenna 9124*b* for the developing units. The CPU 9120 is further capable of wirelessly communicating with the memory unit 9075*a* provided in the photoconductor unit 9075 via the serial interface 9121, the send-receive circuit 9123 and a main unit-side antenna 9124*a* for the photoconductor unit. During wireless communication, the main unit-side antenna 9124*b* for the developing units writes information into the memory units 9051*a*, 9052*a*, 9053*a*, and 9054*a* provided in the developing units 9051, 9052, 9053, and 9054, respectively. The main unit-side antenna 9124*b* for the developing units is also capable of reading information from the memory units 9051*a*, 9052*a*, 9053*a*, and 9054*a* provided in the developing units 9051, 9052, 9053, and 9054, respectively. During wireless communication, the main unit-side antenna 9124*a* for the photoconductor unit writes information into the memory unit 9075*a* provided in the photoconductor unit 9075. The main unit-side antenna 9124*a* for the photoconductor unit can also read information from the memory unit 9075*a* provided in the photoconductor unit 9075.

===Overview of the Developing Units===

Figure 130:
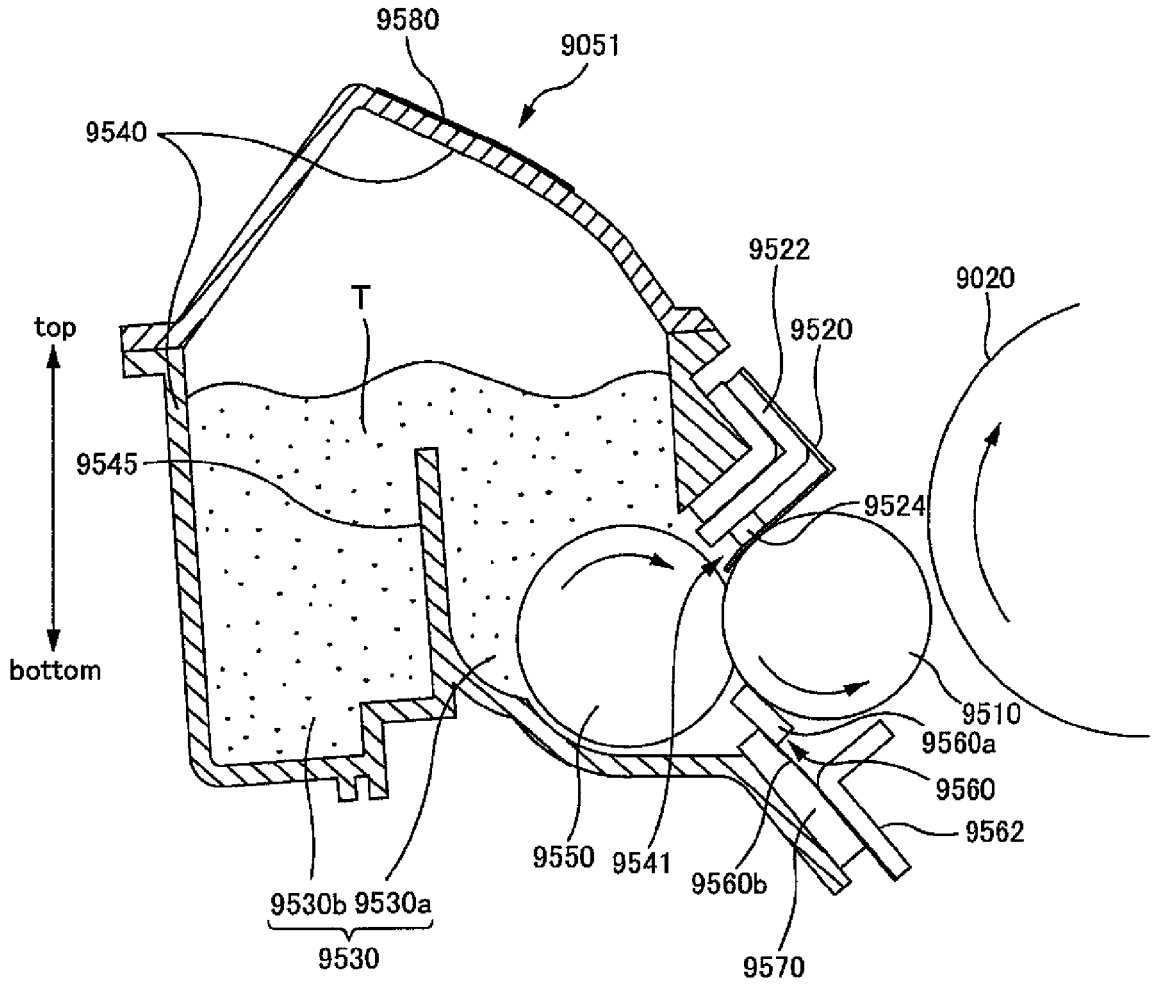

An overview of the developing units is provided next using FIG. 130 to FIG. 137. FIG. 130 is a cross-sectional view showing the main structural components of the black developing unit 9051. FIG. 131 is a perspective view of the black developing unit 9051, taken from the side of the developing roller 9510. FIG. 132 is a perspective view showing an arrangement in which a label 9580 is removed from the black developing unit 9051 shown in FIG. 131. FIG. 133 is an exploded perspective view showing the positional relationship between the housing 9540, the memory unit 9051*a*, and the label 9580 of the black developing unit 9051. FIG. 134 is a cross-sectional diagrammatic view showing the positional relationship between the housing 9540, the memory unit 9051*a*, and the label 9580 of the black developing unit 9051. FIG. 135 to FIG. 137 are explained later. It should be noted that the cross-sectional view in FIG. 130 shows a cross section of the black developing unit 9051 taken along a plane that is perpendicular to the longitudinal direction shown in FIG. 131. Furthermore, in FIG. 130, the vertical direction is indicated by arrows, and, for example, the center axis of the developing roller 9510 is lower than the center axis of the photoconductor 9020. Also, in FIG. 130, the black developing unit 9051 is shown positioned at a developing position that is in opposition to the photoconductor 9020.

The rotary 9055 is provided with the black developing unit 9051 containing black (K) toner, the magenta developing unit 9052 containing magenta (M) toner, the cyan developing unit 9053 containing cyan (C) toner, and the yellow developing unit 9054 containing yellow (Y) toner. Since the configuration of each of the developing units is the same, only the black developing unit 9051 will be explained in the following.

As shown in FIG. 130 to FIG. 133, the black developing unit 9051 includes a housing 9540, a toner containing member 9530, a developing roller 9510, a toner supply roller 9550, a regulating blade 9560, a sealing member 9520, a memory unit 9051*a*, and a label 9580.

The housing 9540 is made by welding together an upper housing and a lower housing that are integrally molded. Inside the housing 9540, the toner containing member 9530 containing the toner T is formed. The toner containing member 9530 is divided by a regulating wall 9545 for partitioning the toner T, which protrudes inwards (in the vertical direction in FIG. 130) from the inner wall, into two toner containing sections, namely, a first toner containing section 9530*a* and a second toner containing section 9530*b*. The upper portions of the first toner containing section 9530*a* and the second toner containing section 9530*b* are in communication, and the movement of the toner T between them is regulated by the regulating wall 9545.

An opening 9541 that communicates with the outside of the housing 9540 is provided at the bottom portion of the first toner containing section 9530*a*. The toner supply roller 9550 is provided in the first toner containing section 9530*a* with its circumferential surface facing the opening 9541, and is rotatably supported on the housing 9540. Also, the developing roller 9510 is provided with its circumferential surface facing the opening 9541 from outside the housing 9540, and the developing roller 9510 is in contact with the toner supply roller 9550.

The developing roller 9510 bears toner T and carries it to the developing position opposite the photoconductor 9020. The developing roller 9510 is made of aluminum, stainless steel or iron, for example, and if necessary, it can be subjected to nickel plating or chrome plating or the like. Moreover, as shown in FIG. 131, the developing roller 9510 is provided such that its longitudinal direction extends along the longitudinal direction of the black developing unit 9051. Also, the developing roller 9510 can rotate around its center axis, and as shown in FIG. 130, it rotates in a direction (the counterclockwise direction in FIG. 130) that is opposite to the direction in which the photoconductor 9020 rotates (the clockwise direction in FIG. 130). Its center axis is lower than the center axis of the photoconductor 9020. As shown in FIG. 130, in a state where the black developing unit 9051 is in opposition to the photoconductor 9020, there is a gap between the developing roller 9510 and the photoconductor 9020. That is, the black developing unit 9051 develops the latent image formed on the photoconductor 9020 in a noncontacting manner. It should be noted that during the development of the latent image formed on the photoconductor 9020, an alternating electric field is formed between the developing roller 9510 and the photoconductor 9020.

The toner supply roller 9550 supplies toner T to the developing roller 9510. This toner supply roller 9550 is made of polyurethane foam or the like, and is in contact with the developing roller 9510 in a state of elastic deformation. The toner supply roller 9550 is disposed at a lower part of the first toner containing section 9530*a*, and the toner T contained in the first toner containing section 9530*a* and the second toner containing section 9530*b* is supplied to the developing roller 9510 by the toner supply roller 9550 at the lower part of the first toner containing section 9530*a*. The toner supply roller 9550 is rotatable around its center axis. The center axis of the toner supply roller 9550 is lower than the central rotation axis of the developing roller 9510. Also, the toner supply roller 9550 rotates in a direction (the clockwise direction in FIG. 130) that is opposite the rotation direction of the developing roller 9510 (the counterclockwise direction in FIG. 130). It should be noted that the toner supply roller 9550 not only has the function to supply toner T to the developing roller 9510, but also the function to scrape off toner T that has remained on the developing roller 9510 after the development from the developing roller 9510.

The regulating blade 9560 regulates the thickness of the toner T layer borne on the developing roller 9510, and applies charge to the toner T borne on the developing roller 9510. The regulating blade 9560 has a rubber part 9560*a* and a rubber supporting part 9560*b*. The rubber part 9560*a* is made of silicone rubber or urethane rubber, for example, and the rubber supporting part 9560*b* is a thin plate of phosphor bronze or stainless steel, for example, and has elasticity. The rubber part 9560*a* is supported by the rubber support part 9560*b*, and one end of the rubber supporting part 9560*b* is fixed to a blade support metal plate 9562. In this state, the rubber part 9560*a* is pressed against the developing roller 9510 by the elastic force created by the bending of the rubber supporting part 9560*b*.

Also, a blade backing member 9570 made of Moltopren or the like is provided on the side of the regulating blade 9560 that is opposite the side of the developing roller 9510. The blade backing member 9570 prevents the toner T from entering in between the rubber supporting part 9560*b* and the housing 9540 so as to stabilize the elasticity due to the bending of the rubber supporting part 9560*b*, and presses the rubber part 9560*a* against the developing roller 9510 by biasing the rubber part 9560*a* toward the developing roller 9510 from directly behind the rubber part 9560*a*. Consequently, the blade backing member 9570 increases the contact uniformity and the sealing properties of the rubber part 9560*a* with respect to the developing roller 9510.

The end of the regulating blade 9560 on the side opposite the side supported by the blade support metal plate 9562, that is, its front end, is not in contact with the developing roller 9510, and a portion thereof removed from this front end by a predetermined distance is in contact with the developing roller 9510 over a certain width. That is to say, the regulating blade 9560 does not come into contact with the developing roller 9510 at its edge but rather at a mid section thereof. Also, the regulating blade 9560 is disposed such that its front end is facing upstream with respect to the direction in which the developing roller 9510 rotates, and is in so-called counter contact. It should be noted that the contact position where the regulating blade 9560 contacts the developing roller 9510 is below the center axis of the developing roller 9510 and is below the center axis of the toner supply roller 9550.

The sealing member 9520 prevents the toner T in the black developing unit 9051 from leaking out of the unit, and also collects toner T on the developing roller 9510, after it has passed the developing position, into the developing unit without scraping it off. This sealing member 9520 is a seal made of polyethylene film or the like. The sealing member 9520 is supported by a seal support metal plate 9522. Furthermore, a seal biasing member 9524 made of Moltopren or the like is provided on the side of the sealing member 9520 that is opposite to its developing roller 9510 side, and due to the elasticity of the seal biasing member 9524, the sealing member 9520 is pressed against the developing roller 9510. It should be noted that the contact position where the sealing member 9520 contacts the developing roller 9510 is above the center axis of the developing roller 9510.

The memory unit 9051*a* is provided on the housing 9540 described above. The memory unit 9051*a* according to the present embodiment is a component having a small and thin rectangular shape. It is also referred to as "memory tag" and is commercially available in various forms.

This memory unit 9051*a* has an adhesive surface 9572 (tacky surface) on its rear side, and is affixed to this housing 9540 by adhering this adhesive surface 9572 to the surface of the housing 9540. More specifically, as shown in FIG. 133, the housing 9540 has an indentation 9540*a*, and the memory unit 9051*a* is adhered to the surface of this indentation 9540*a* while being fitted into this indentation 9540*a*. Moreover, the memory unit 9051*a* is provided at an end portion in the longitudinal direction of the black developing unit 9051. As shown in FIG. 131, this end portion is the end portion that is positioned on the downstream side with respect to the direction in which the black developing unit 9051 is inserted into the printer main unit 9010*a*.

The configuration of the memory unit 9051*a* is explained in detail further below.

Furthermore, a label 9580 is stuck to the housing 9540. This label 9580 is made of PET film, and various sorts of information relating to the black developing unit 9051 are written on this label 9580.

As shown in FIG. 131 and FIG. 132, this label 9580 is stuck to the surface of the housing 9540, from a center portion in the longitudinal direction of the black developing unit 9051 to the end portion that is positioned on the downstream side with respect to the insertion direction, covering the memory unit 9051*a*. Furthermore, as noted above, the memory unit 9051*a* is adhered to the surface of the indentation 9540*a*, but as shown in FIG. 134, the maximum thickness t of the memory unit 9051*a* is smaller than the minimum depth d of the indentation 9540*a*. Therefore, the label 9580 is adhered to a portion 9540*b* outside of the indentation (that is, a portion of the housing 9540 located around the indentation 9540*a*), without being adhered (stuck) to the indentation 9540*a*. Moreover, as shown in FIG. 134, an air layer 9590 is formed between the rear surface of the label 9580, or more specifically, that part of the rear surface of the label 9580 that is not adhered to the housing 9540, and the surface 9574 of the memory unit 9051*a* that is on the side opposite to the adhesive surface 9572.

It should be noted that the information written on the label 9580 is described in detail further below. Moreover, there is a protruding portion (protrusion 9576) formed on the memory unit 9051*a* shown in FIG. 134, and this protrusion 9576 is where a later-described non-contact IC chip 9051*b* of the memory unit 9051*a* protrudes.

In the black developing unit 9051 configured in this manner, the toner supply roller 9550 supplies the toner T contained in the toner containing member 9530 to the developing roller 9510. As the developing roller 9510 rotates, the toner T that is supplied to the developing roller 9510 is brought to the contact position of the regulating blade 9560, and when it passes that contact position, the layer thickness of the toner T is regulated, and a charge is applied to it. The toner T on the developing roller 9510, whose layer thickness has been regulated, is brought to the developing position in opposition to the photoconductor 9020 due to further rotation of the developing roller 9510 and is supplied for developing the latent image formed on the photoconductor 9020 in an alternating electric field at the developing position. The toner T on the developing roller 9510 that has passed the developing position due to further rotation of the developing roller 9510 passes the sealing member 9520 and is collected in the developing unit without being scraped off by the sealing member 9520.

<<<Configuration of the Memory Unit>>>

The configuration of the memory unit 9051*a* is described next, with reference to FIG. 135 and FIG. 136. FIG. 135 is a plan view showing the configuration of the memory unit 9051*a*. FIG. 136 is a block diagram illustrating the internal configuration of the memory unit 9051*a*.

The memory units with which the developing units besides the black developing unit 9051 are provided are the same as the memory unit 9051*a* provided on the black developing unit 9051, so that in the following description, the memory unit 9051*a* provided on the black developing unit 9051 is taken as an example.

The memory unit 9051*a* includes a thin plate-shaped substrate 9051*i* serving as a substrate made of a thin plate-shaped piece of plastic that is flexible in its longitudinal direction, an antenna 9051*d* made by arranging copper foil in a rectangular planar coil shape, antenna terminals 9051*j* provided on both end portions of the antenna, a non-contact IC chip 9051*b* including a memory and serving as an element, two coupling sections 9051*k* made of aluminum that connect the chip terminals of the non-contact IC chip 9051*b* with the antenna terminals 9051*j*, and a film-shaped protective sheet 9051*m* covering these elements, sandwiching them together with 9051*i*.

As shown in FIG. 135, one antenna terminal 9051*j* of the antenna is arranged at one end portion side in the longitudinal direction of the rectangular thin plate-shaped substrate 9051*i*, the antenna is wrapped about ten times in a coil shape along the outer shape of the thin plate-shaped substrate 9051*i*, and the other antenna terminal 9051*j* is provided to the inner side of the antenna 9051*d*. The outer antenna terminal 9051*j* and the inner antenna terminal 9051*j* are both provided on the same side in the longitudinal direction of the thin plate-shaped substrate 9051*i*. On the thin plate-shaped substrate 9051*i*, the ten copper foil structures of the antenna 9051*d* are lined up next to each other along the vertical and horizontal edges of the rectangular shape, and are divided into five each at one corner portion on that end portion side of the thin plate-shaped substrate 9051*i* where the antenna terminals 9051*j* are provided, the non-contact IC chip 9051*b* being arranged between these. Furthermore, two coupling sections 9051*k* connecting chip terminals (not shown in the drawings) provided on the non-contact IC chip 9051*b* with the antenna terminals 9051*j* are provided, respectively straddling five copper foil structures. That is to say, on the thin plate-shaped substrate 9051*i*, the non-contact IC chip 9051*b*, two antenna terminals 9051*j* and two coupling sections 9051*k* are provided on a one end side in the longitudinal direction, and the copper foil structures serving as the antenna 9051*d* are guided around the remaining region, except for the center.

As shown in FIG. 136, the non-contact IC chip 9051*b* includes a resonance capacitor 9051*c*, a rectifier 9051*e*, a signal analysis section RF (Radio Frequency) 9051*f*, a controller 9051*g*, and the memory cell 9051*h*. The memory cell 9051*h* is a nonvolatile memory that can be electrically read and written, such as an NAND flash ROM, and is capable of storing information that has been written on it and reading stored information from the outside.

The antenna 9051*d* of the memory unit 9051*a* and the main unit-side antenna 9124*b* for the developing unit wirelessly communicate with one another and can read information stored on the memory cell 9051*h* and write information to the memory cell 9051*h*. Also, the high frequency signals that are generated by the send-receive circuit 9123 of the printer main unit 9010*a* are induced as a high-frequency magnetic field via the main unit side antenna 9124*b*. This high-frequency magnetic field is absorbed via the antenna 9051*d* of the memory unit 9051*a* and is rectified by the rectifier 9051*e*, thus serving as a DC power source for driving the circuits in the non-contact IC chip 9051*b*.

<<<The Information Written on the Label>>>

Referring to FIG. 137, the following is an explanation of the information written on the label 9580. FIG. 137 is a diagram showing an example of the label 9580.

As shown in FIG. 137, information representing warning messages relating to the handling of the black developing unit 9051 is written on the label 9580. In the present embodiment, the information that it is forbidden to touch the developing roller 9510 is written at the position marked by symbol "A4" and the information that it is forbidden to throw the black developing unit 9051 into fire is written at the position marked by symbol "B4". Furthermore, information indicating the insertion direction of the black developing unit 9051 is written at the position marked by symbol "C4". Also, information that cautions persons handling the black developing unit 9051 to heed these warnings is written at the position marked by symbol "D4".

Furthermore, information indicating the supplier of the black developing unit 9051 (at "E4") and information indicating the color (here, black) of the toner inside the developing unit (at "F4") is written on the label 9580. It should be noted that in the present embodiment, the supplier is represented by a mark (a sun mark), but the supplier may also be expressed by text.

===Overview of the Rotary===

Next, an overview of the rotary 9055 is given using FIG. 138A, FIG. 138B, and FIG. 138C. The rotary 9055 includes a central shaft 9055*a* positioned in its center. A support frame

9055*f* for holding the developing units is fixed to this central shaft 9055*a*. The central shaft 9055*a* spans the distance between two frame side plates (not shown in the drawings) of the housing of the printer 9010, which support its two end portions. It should be noted that the axial direction of the central shaft 9055*a* intersects with the vertical direction.

The support frame 9055*f* includes four mounting and dismounting sections at spacings of 90° in circumferential direction, in which the above-mentioned four developing units 9051, 9052, 9053, and 9054 are held in a mountable and dismountable manner.

A pulse motor not shown in the drawings is connected via a clutch to the central shaft 9055*a*, and by driving this pulse motor, the support frame 9055*f* is rotated and the four developing units 9051, 9052, 9053, and 9054 can be positioned at predetermined positions.

FIG. 138A, FIG. 138B, and FIG. 138C illustrate three stop positions of the rotating rotary 9055. FIG. 138A shows a stand-by position in which the rotary 9055 is waits for the carrying out of image formation. This stand-by position is a home position (referred to as "HP position" below), which is also the stop position serving as a reference position for the rotational direction of the rotary 9055. FIG. 138B shows the communication position of the yellow developing unit 9054 mounted to the rotary 9055. FIG. 138C shows the mounting and dismounting position of the yellow developing unit 9054.

Here, in FIG. 138B and FIG. 138C, the communication position and the mounting and dismounting position of the yellow developing unit 9054 are shown, but the communication position and the mounting and dismounting position of each developing unit can be achieved by rotating the rotary 9055 successively by amounts of 90°.

First, the HP position shown in FIG. 138A is explained. An HP detection section (not shown in the drawings) for detecting the HP position is provided at one end side of the central shaft 9055*a* of the rotary 9055. This HP detection section includes a circular disk for generating a signal that is attached to one end of the central shaft 9055*a*, and an HP sensor made of a photo-interrupter including a light-emitting section and a light-receiving section. The outer edge portion of the circular disk is arranged such that it is positioned between the light-emitting section and the light-receiving section of the HP sensor. When slit sections formed in the circular disk are moved to a detection position of the HP sensor, the signal that is output by the HP sensor changes from "L" to "H". Then, the HP position of the rotary 9055 is detected from this change in signal level and the pulse number of the pulse motor, and taking this HP position as a reference, it is possible to position each of the developing units at the communication position or the like.

FIG. 138B shows the communication position of the yellow developing unit 9054, which is achieved by letting the pulse motor rotate by a predetermined number of pulses from the HP position. In the communication position of the yellow developing unit 9054 shown in FIG. 138B, the memory unit 9054*a* of the yellow developing unit 9054 communicates wirelessly with the main unit-side antenna 9124*b* for the developing unit provided on the printer main unit 9010*a*. It should be noted that the communication position for the yellow developing unit 9054 is the developing position of the black developing unit 9051, in which the developing roller 9510 of the black developing unit 9051 and the photoconductor 9020 face each other. That is to say, the communication position of the rotary 9055 for the yellow developing unit 9054 is the developing position of the rotary 9055 for the black developing unit 9051. Moreover, when the pulse motor rotates the rotary 9055 for 90° in the counterclockwise direction, the communication position of the black developing unit 9051 and the developing position of the cyan developing unit 9053 are attained. When the rotary 9055 is rotated by amounts of 90° each, the communication position and the developing position of each of the developing units are successively achieved.

Moreover, one of the two frame side plates that support the rotary 9055 and are part of the housing of the printer 9010 is provided with the above-mentioned developing unit mounting and dismounting opening 9010*e*. This developing unit mounting and dismounting opening 9010*e* is formed at such a position that, when the rotary 9055 is rotated and stopped at one of the mounting and dismounting positions that are set for of the developing units, only the corresponding developing unit (here, the yellow developing unit 9054) can be removed by pulling it out in a direction parallel to the central shaft 9055*a*, as shown in FIG. 138C. Furthermore, the developing unit mounting and dismounting opening 9010*e* is formed slightly larger than the outer shape of the developing unit, and in the mounting and dismounting position, it is not only possible to remove the developing unit, but also to insert a new developing unit through this developing unit mounting and dismounting opening 9010*e* in the direction parallel to the central shaft 9055*a* and mount this developing unit to the support frame 9055*f*. While the rotary 9055 is not positioned in a mounting and dismounting position, the mounting and dismounting of developing units is prevented by the frame side plates.

It should be noted that the rotary 9055 is provided with a locking mechanism not shown in the drawings, in order to position and fix the rotary 9055 reliably at the above-noted positions.

Advantageous Effects of the Developing Units ETC. According to the Present Embodiment As noted in the explanations regarding the object to be solved by the invention, the aspect of preventing destruction of the memory units 9051*a*, 9052*a*, 9053*a*, and 9054*a* has been taken into consideration in determining the positions at which the memory units 9051*a*, 9052*a*, 9053*a*, and 9054*a* are attached to the developing units 9051, 9052, 9053, and 9054. The developing units 9051, 9052, 9053, and 9054 are mounted and dismounted by a user or the like, so that it is necessary to employ countermeasures to effectively prevent the destruction of the memory units 9051*a*, 9052*a*, 9053*a*, and 9054*a* by the user touching the memory units 9051*a*, 9052*a*, 9053*a*, and 9054*a* or the memory units 9051*a*, 9052*a*, 9053*a*, and 9054*a* coming into contact with other members of the printer 9010 during the mounting or dismounting.

As an approach for solving this problem, it is known to embed the memory units 9051*a*, 9052*a*, 9053*a*, and 9054*a* in the developing units 9051, 9052, 9053, and 9054 and place a lid on them. However in this case, it is necessary to provide a separate lid, so that the number of parts increases.

By contrast, the developing units 9051, 9052, 9053, and 9054 of the present embodiment have a label 9580 on which the information regarding the developing units 9051, 9052, 9053, and 9054 is written and that is stuck to the developing units 9051, 9052, 9053, and 9054 such that it covers the memory units 9051*a*, 9052*a*, 9053*a*, and 9054*a*. That is to say, in the present embodiment, the label 9580 not only has the function of providing the person handling the developing units 9051, 9052, 9053, and 9054 (that is, the user or the like) with information regarding these developing units 9051, 9052, 9053, and 9054, but also the function of protecting the memory units 9051*a*, 9052*a*, 9053*a*, and 9054*a* by covering them, so that it is not necessary anymore to provide a separate lid mentioned above. Consequently, with the present embodiment, it is possible to effectively prevent the destruction of memory units 9051*a*, 9052*a*, 9053*a*, and 9054*a* without increasing the number of parts.

Other Embodiments

A developing unit or the like according to the present invention was explained by way of the foregoing embodiment, but the foregoing embodiment of the invention is merely for the purpose of elucidating the present invention and is not to be interpreted as limiting the present invention. The invention can of course be altered and improved without departing from the gist thereof and equivalents are intended to be embraced therein.

In the foregoing embodiment, an intermediate image transfer type full-color laser beam printer was described as an example of the image forming apparatus, but the present invention can also be applied to various other types of image forming apparatuses, such as full-color laser beam printers that are not of the intermediate image transfer type, monochrome laser beam printers, copying machines, and facsimiles.

Also the memory units 9051*a*, 9052*a*, 9053*a*, and 9054*a* are not limited to the configuration explained in this embodiment. For example, they may also be devised such that the antenna 9051*d* is provided separately. Moreover, in the foregoing embodiment, the memory units 9051*a*, 9052*a*, 9053*a*, and 9054*a* are capable of communication wirelessly with the printer main unit 9010*a* in a state in which the developing units 9051, 9052, 9053, and 9054 are mounted to the printer main unit 9010*a*, but there is no limitation to this.

Moreover, in the foregoing embodiment, the memory units 9051*a*, 9052*a*, 9053*a*, and 9054*a* are arranged on the downstream side with respect to the insertion direction of the developing units 9051, 9052, 9053, and 9054, but there is not limitation to this. For example, it is also possible to arrange the memory units 9051*a*, 9052*a*, 9053*a*, and 9054*a* on the upstream side with respect to the insertion direction of the developing units 9051, 9052, 9053, and 9054.

However, the foregoing embodiment is more preferable in view of the fact that the memory units 9051*a*, 9052*a*, 9053*a*, and 9054*a* are more difficult to touch by the user during the mounting and dismounting of the developing units 9051, 9052, 9053, and 9054 with respect to the printer main unit 9010*a*, so that it is possible to prevent the destruction of the memory units 9051*a*, 9052*a*, 9053*a*, and 9054*a* more effectively.

Moreover, in the foregoing embodiment, the memory units 9051*a*, 9052*a*, 9053*a*, and 9054*a* are provided on the housing 9540 of the developing units 9051, 9052, 9053, and 9054, and the label 9580 is stuck to the surface of the housing 9540 in such a manner that it covers the memory units 9051*a*, 9052*a*, 9053*a*, and 9054*a*, but there is not limitation to this. For example, it is also possible to provide the memory units 9051*a*, 9052*a*, 9053*a*, and 9054*a* at a portion other than the housing 9540. It is also possible to stick the label 9580 to a portion other than the housing 9540.

Furthermore, in the foregoing embodiment, the memory units 9051*a*, 9052*a*, 9053*a*, and 9054*a* are stuck to the surface of the housing 9540, but there is no limitation to this. For example, it is also possible to fix the memory units 9051*a*, 9052*a*, 9053*a*, and 9054*a* to the housing 9540 with screws.

However, the foregoing embodiment is more effective not only due to the fact that the label 9580 has the above-described effect of effectively preventing the destruction of the memory units 9051*a*, 9052*a*, 9053*a*, and 9054*a* without increasing the number of parts, but also with regard to the effect of effectively preventing, without increasing the number of parts, that the memory units 9051*a*, 9052*a*, 9053*a*, and 9054*a* are peeled off from the housing 9540 by toner intruding between the rear side of the memory units 9051*a*, 9052*a*, 9053*a*, and 9054*a* and the surface of the housing 9540.

Furthermore, in the foregoing embodiment, the housing 9540 has an indentation 9540*a*, the memory units 9051*a*, 9052*a*, 9053*a*, and 9054*a* are adhered to the surface of the indentation 9540*a*, and the label 9580 is stuck to a portion 9540*b* of the housing 9540 that is not the indentation, but there is no limitation to this. For example, it is also possible that the housing 9540 does not have an indentation 9540*a*.

However, the foregoing embodiment is more preferable in view of the fact that the memory units 9051*a*, 9052*a*, 9053*a*, and 9054*a* are more difficult to touch by the user if the memory units 9051*a*, 9052*a*, 9053*a* and 9054*a* are accommodated in such indentations 9540*a*, so that it is possible to prevent the destruction of the memory units 9051*a*, 9052*a*, 9053*a*, and 9054*a* more effectively.

Moreover, in the foregoing embodiment, the maximum thickness of the memory units 9051*a*, 9052*a*, 9053*a*, and 9054*a* is smaller than the minimum depth of the indentation 9540*a*, but there is no limitation to this. For example, it is also possible to let the maximum thickness of the memory units 9051*a*, 9052*a*, 9053*a*, and 9054*a* be larger than the minimum depth of the indentation 9540*a*.

However, the foregoing embodiment is more preferable in view of the fact that the memory units 9051*a*, 9052*a*, 9053*a*, and 9054*a* are more difficult to touch by the user if the memory units 9051*a*, 9052*a*, 9053*a*, and 9054*a* are accommodated entirely in such indentations 9540*a*, so that it is possible to prevent the destruction of the memory units 9051*a*, 9052*a*, 9053*a*, and 9054*a* more effectively.

Moreover, in the foregoing embodiment, an air layer 9590 is formed between the rear side of the label 9580 and the surface 9574 of the memory units 9051*a*, 9052*a*, 9053*a*, and 9054*a* that is on the opposite side of the adhesive surface 9572, but there is no limitation to this. For example, it is also possible to stick the label 9580 to the front surface 9574 of the memory units 9051*a*, 9052*a*, 9053*a*, and 9054*a*, so that no air layer 9590 is formed.

However, the foregoing embodiment is preferable with regard to the fact that the air layer 9590 has the cushioning function of suitably preventing the destruction of the memory units 9051*a*, 9052*a*, 9053*a* and 9054*a* even if the user presses the label 9580.

Moreover, as shown in FIG. 139, it is also possible that the developing units 9051, 9052, 9053 and 9054 have a cushion material 9595 between the surface 9574 of the memory units 9051*a*, 9052*a*, 9053*a* and 9054*a* that is on the opposite side of the adhesive surface 9572 and the rear surface of the label 9580.

In this case, the cushion material 9595 fulfills the function of a cushion and suitably prevents the destruction of the memory units 9051*a*, 9052*a*, 9053*a*, and 9054*a* even when the user pushes down the label 9580. It should be noted that FIG. 139 corresponds to FIG. 134 and is a cross-sectional diagrammatic view showing the cushion material 9595.

Moreover, in the foregoing embodiment, information representing warning messages relating to the handling of the developing units, information cautioning the persons handling the developing units, information indicating the supplier of the developing unit, information indicating the toner color, and information indicating the insertion direction of the developing unit were given as examples of the information relating to the developing units that is written onto the labels 9580 that are stuck to the developing units 9051, 9052, 9053 and 9054 such that they cover the memory units 9051*a*, 9052*a*, 9053*a* and 9054*a*. However, there is no limitation to this, and it may be any information relating to the developing unit.

Moreover, as shown in FIG. 140, as information relating to the developing units, it is also possible to write onto the label 9580 the information that persons handling the developing unit must not grasp the developing unit at the portion where the label is stuck.

In this case, the possibility that persons handling the developing unit, such as users, touch the memory units 9051*a*, 9052*a*, 9053*a*, and 9054*a* is reduced, and it becomes possible to prevent the destruction of the memory units 9051*a*, 9052*a*, 9053*a*, and 9054*a* more effectively. FIG. 140 is a diagram showing an example of information indicating the fact that persons handling the developing unit must not grasp the developing unit at the portion where the label is stuck.

As shown in FIG. 141, it is also possible that information urging persons handling the developing unit to grasp the developing unit at a portion other than the portion where the label is stuck is written on the label 9580 or that other portion.

Also in this case, the possibility that persons handling the developing unit touch the memory units 9051*a*, 9052*a*, 9053*a*, and 9054*a* is reduced, and it becomes possible to prevent the destruction of the memory units 9051*a*, 9052*a*, 9053*a*, and 9054*a* more effectively. FIG. 141 is a diagram showing an example of such information urging persons handling the developing unit to grasp the developing unit at a portion other than the portion where the label is stuck.

Moreover, in the foregoing, an example is given in which the present invention is applied to developing units 9051, 9052, 9053, and 9054, but it is also possible to apply the present invention to the photoconductor unit 9075. As noted above, a memory unit 9075*a* is provided on the photoconductor unit 9075. This memory unit 9075*a* has, for example, the above-described configuration, that is, the configuration shown in FIG. 135 and FIG. 136. As shown in FIG. 142, a label 9075*c* on which information relating to the photoconductor unit 9075 is written may be stuck to the housing 9075*b* of the photoconductor unit 9075, covering the memory unit 9075*a*. FIG. 142 is an exploded perspective view showing the positional relationship between the housing 9075*b*, the memory unit 9075*a*, and the label 9075*c* of the photoconductor unit 9075.

===Configuration of Image Forming System Etc.===

Next, an embodiment of an image forming system serving as an example of an embodiment of the present invention is described with reference to the drawings.

FIG. 143 is an explanatory diagram showing the external configuration of an image forming system. An image forming system 9700 is provided with a computer 9702, a display device 9704, a printer 9706, input devices 9708, and reading devices 9710. In this embodiment, the computer 9702 is contained within a mini-tower type housing, but there is no limitation to this. A CRT (cathode ray tube), plasma display, or liquid crystal display device, for example, is generally used as the display device 9704, but there is no limitation to this. As the printer 9706, the printer described above is used. In this embodiment, the input devices 9708 are a keyboard 99708A and a mouse 9708B, but there is no limitation to these. In this embodiment, a flexible disk drive device 9710A and a CD-ROM drive device 9710B are used as the reading devices 9710, but the reading devices 9710 are not limited to these, and may also include an MO (magneto-optical) disk drive device or a DVD (digital versatile disk), for example.

FIG. 144 is a block diagram showing the configuration of the image forming system shown in FIG. 143. An internal memory 9802 such as a RAM is provided within the casing containing the computer 9702, and furthermore an external memory such as a hard disk drive unit 9804 is provided.

In the above explanations, an example was given in which the image forming system is constituted by connecting the printer 9706 to the computer 9702, the display device 9704, the input devices 9708, and the reading devices 9710, but there is no limitation to this. For example, the image forming system may also be made of the computer 9702 and the printer 9706, and the image forming system does not have to be provided with any one of the display device 9704, the input devices 9708, and the reading devices 9710.

It is also possible that the printer 9706 has some of the functions or mechanisms of the computer 9702, the display device 9704, the input devices 9708, and the reading devices 9710. For example, the printer 9706 may be configured so as to have an image processing section for carrying out image processing, a display section for carrying out various types of displays, and a recording media mounting and dismounting section into and from which recording media storing image data captured by a digital camera or the like are inserted and taken out.

As an overall system, the image forming system that is thus achieved is superior to conventional systems.

The invention claimed is:

1. A developing device that can be mounted to and dismounted from a mounting and dismounting section provided in an image forming apparatus main unit, the developing device comprising:

a developing device main unit;

a positioning member for positioning the developing device main unit with respect to the mounting and dismounting section by engaging the mounting and dismounting section when the developing device is mounted to the mounting and dismounting section, the positioning member being fixed on a one end side in a longitudinal direction of the developing device main unit;

a coupling member that is to be coupled to the mounting and dismounting section when the developing device is mounted to the mounting and dismounting section, the coupling member being attached to the other end side in the longitudinal direction of the developing device main unit in such a manner that its relative position to the developing device main unit can be changed; and an element capable of communication in a noncontacting manner with the image forming apparatus main unit side when the developing device is mounted to the mounting and dismounting section, the element being provided at the one end side in the longitudinal direction of the developing device main unit.

2. A developing device according to claim 1, wherein the mounting and dismounting section is movable;

wherein the developing device develops a latent image borne on an image bearing member with which the image forming apparatus main unit is provided, when having been moved to a first position through a movement of the mounting and dismounting section while being mounted to the mounting and dismounting section; and wherein the element communicates in a noncontacting manner with the image forming apparatus main unit side when the developing device has been moved to a second position that is different from the first position.

3. A developing device according to claim 2, wherein the mounting and dismounting section includes a spring that biases the developing device main unit along its longitudinal direction; and the relative position of the developing device main unit and the coupling member changes in accordance with the biasing amount provided by the spring.

4. A developing device according to claim 2, wherein the developing device main unit includes:

a developer bearing member that bears a developer, and that is for developing the latent image borne on the image bearing member with the developer; and a distance holding member for holding a distance between the image bearing member and the developer bearing member by coming into contact with the image bearing member, the distance holding member being provided on both end portions in a longitudinal direction of the developer bearing member;

wherein the distance holding member holds the distance by coming into contact with the image bearing member when the developing device has moved to the first position.

5. A developing device according to claim 1, wherein the developing device main unit is provided with an attachment protrusion having a circular cross section;

wherein the coupling member is provided with an attachment hole that has an elliptical cross section and into which the attachment protrusion can be fitted; and wherein the attachment hole allows movement, within the attachment hole, of the attachment protrusion fitted into the attachment hole.

6. A developing device according to claim 1, wherein the developing device main unit is provided with a housing for containing a developer; and wherein the element is attached to an outer surface of the housing, the outer surface extending along a longitudinal direction of the housing.

7. A developing device according to claim 6, wherein the developing device main unit includes a developer bearing member that is supported by the housing at both end portions in its longitudinal direction, and that is for bearing a developer and developing a latent image borne on the image bearing member with the developer;

wherein the outer surface of the housing includes a circularly arc-shaped surface whose cross section through a perpendicular plane that is perpendicular to the longitudinal direction of the housing is circularly arc-shaped; and wherein the element is attached to a position of the circularly arc-shaped surface that is furthest removed from the developer bearing member.

8. A developing device according to claim 1 further comprising:

an element that, when the developing device is mounted to the image forming apparatus main unit, faces, across a gap, an antenna provided to the image forming apparatus main unit, and is capable of wireless communication with the antenna; and a metal plate, at least a portion of which is positioned to the outer side of the gap and at a position corresponding to the gap in a direction from the element toward the antenna, when the developing device is mounted to the image forming apparatus main unit and the element performs wireless communication with the antenna.

9. A developing device according to claim 8, comprising:

a developer bearing roller provided extending along a longitudinal direction of the developing device, that is for bearing a developer;

a first driving wheel provided at one end portion of the developer bearing roller, that is for driving the developer bearing roller; and a second driving wheel that receives a driving force from the image forming apparatus main unit when the developing device is mounted to the image forming apparatus main unit, and that transmits the driving force to the first driving wheel;

wherein the metal plate is a positioning member for positioning the first driving wheel and the second driving wheel.

10. A developing device according to claim 9, wherein the element is provided at an end portion, in the longitudinal direction of the developing device, at which the first driving wheel is positioned.

11. An image forming system according to claim 1 further comprising:

wherein the image forming apparatus main unit includes an antenna; and the developing device includes: an element that, when the developing device is mounted to the image forming apparatus main unit, faces the antenna across the gap, and is capable of wireless communication with the antenna; and a metal plate, at least a portion of which is positioned to the outer side of the gap and at a position corresponding to the gap in a direction from the element toward the antenna, when the developing device is mounted to the image forming apparatus main unit and the element performs wireless communication with the antenna.

12. A developing device according to claim 1, further comprising:

a cartridge comprising:

a communication unit including:

a base;

an antenna supported by the base; and an element supported by the base, the element being for communication via the antenna; and (b) a housing by which the communication unit is supported with the element being positioned on an upstream side of the base, with respect to a mounting direction in which it is mounted to the image forming apparatus main unit.

13. A developing device according to claim 12, wherein the communication unit communicates with the image forming apparatus main unit via an apparatus-side antenna provided to the image forming apparatus main unit.

14. A developing device according to claim 12, comprising a positioning section for positioning with respect to the image forming apparatus main unit on a downstream side in the mounting direction, wherein the communication unit is arranged on the downstream side in the mounting direction.

15. A developing device according to claim 12, wherein the base is fixed to the housing, and wherein the antenna and the element are supported by the base on the side of the base that is opposite to the housing and are covered by a film.

16. A developing device according to claim 12, wherein the image forming apparatus main unit includes:

an opening through which the cartridge is inserted; and a guiding portion that guides the cartridge to a mounting position;

wherein the element is passed through the opening and mounted after the guiding portion has been engaged when introducing the cartridge from the opening.

17. A developing device according to claim 1, further comprising:

a developing container containing a developer including a magnetic material;

a container-side antenna provided at the developing container, that is for communicating in a contactless manner, when mounted to an apparatus main unit, with a main unit-side antenna of the apparatus main unit; and an intrusion prevention section for preventing intrusion of the developer into a predetermined region between the container-side antenna and the developer.

18. A developing device according to claim 17, wherein the intrusion prevention section is a partitioning member for forming a gap by partitioning the predetermined region.

19. A developing device according to claim 17, wherein the intrusion prevention member is a region holding member that is provided such that it fills out the predetermined region.

20. A developing device according to claim 19, wherein the region holding member is a block made of urethane.

21. A developing device according to claim 17, wherein the container-side antenna and the main unit-side antenna communicate at positions spaced apart by a distance L; and wherein the predetermined region includes a region of a distance L from the container-side antenna, and is wider than that region.

22. A developing unit as claimed in claim 1, further comprising:

a memory unit including a memory; and a label on which information relating to the developing unit is written, and that has been stuck to the developing unit so as to cover the memory unit.

23. A developing unit according to claim 22, wherein the memory unit can communicate wirelessly with the image forming apparatus main unit side, when the developing unit is mounted to the image forming apparatus main unit.

24. A developing unit according to claim 22, wherein the developing unit is mounted to the image forming apparatus main unit by inserting it into the image forming apparatus main unit; and wherein the memory unit is provided on a downstream side, with respect to the insertion direction, of the developing unit.

25. A developing unit according to claim 22, wherein the memory unit is provided on a housing of the developing unit; and wherein the label has been stuck to a surface of the housing so as to cover the memory unit.

26. A developing unit according to claim 25, wherein the memory unit is adhered to a surface of the housing.

27. A developing unit according to claim 26, wherein the housing includes an indentation;

wherein the memory unit is adhered to a surface of the indentation; and wherein the label has been stuck to a portion of the housing outside of the indentation.

28. A developing unit according to claim 27, wherein a maximum thickness of the memory unit is smaller than a minimum depth of the indentation.

29. A developing unit according to claim 27, wherein an air layer is formed between a rear surface of the label and a surface of the memory unit on the side opposite to the adhesive surface.

30. A developing unit according to claim 27, comprising a cushion material between a rear surface of the label and a surface of the memory unit on the side opposite to the adhesive surface.

31. A developing unit according to claim 22, wherein the information is information representing warning messages relating to the handling of that developing unit.

32. A developing unit according to claim 22, wherein the information is information cautioning persons handling that developing unit.

33. A developing unit according to claim 22, wherein the information is information indicating a supplier of that developing unit.

34. A developing unit according to claim 22, wherein a developer is contained in the developing unit; and wherein the information is information indicating the color of the developer.

35. A developing unit according to claim 22, wherein the developing unit is mounted to the image forming apparatus main unit by insertion into the image forming apparatus main unit; and wherein the information is information indicating an inserting direction of the developing unit.

36. A developing unit according to claim 22, wherein the information is information indicating that persons handling the developing unit must not grasp the developing unit at a portion to which the label has been stuck.

37. A developing unit according to claim 22, wherein information is written that urges a person handling the developing unit to grasp the developing unit at a portion other than the portion to which the label has been stuck.

38. An image forming apparatus comprising:

an image bearing member for bearing a latent image; and a developing device that can be mounted to and dismounted from a mounting and dismounting section provided in an image forming apparatus main unit, the developing device including: a developing device main unit; a positioning member for positioning the developing device main unit with respect to the mounting and dismounting section by engaging the mounting and dismounting section when the developing device is mounted to the mounting and dismounting section, the positioning member being fixed on a one end side in a longitudinal direction of the developing device main unit; a coupling member that is to be coupled to the mounting and dismounting section when the developing device is mounted to the mounting and dismounting section, the coupling member being attached to the other end side in a longitudinal direction of the developing device main unit in such a manner that its relative position to the developing device main unit can be changed; and an element capable of communication in a noncontacting manner with the image forming apparatus main unit side when the developing device is mounted to the mounting and dismounting section, the element being provided at the one end side in the longitudinal direction of the developing device main unit, the developing device being for developing a latent image borne on the image bearing member when being mounted to the mounting and dismounting section.

39. An image forming apparatus according to claim 38, further comprising:

a developing cartridge for developing the latent image by selectively adhering a toner to the latent image on a surface of the bearing member;

a developing rotary unit provided in the apparatus main unit, that accommodates a plurality of the developing cartridges that can be inserted and removed around a rotation shaft, and lets one of the developing cartridges oppose the surface of the bearing member by rotating around the rotation shaft; and a storage element that stores and holds information relating to the developing cartridge, the storage element being provided at a position on an outer surface of the developing cartridge where its distance to an external cover of the apparatus main unit is shortest when the memory element communicates with the apparatus main unit after having been stopped in that stop position of the plurality of stop positions, at which the developing cartridge stops when being rotatively moved by the developing rotary unit, in which the outer surface of the developing cartridge is closest to the external cover.

40. An image forming apparatus according to claim 39, wherein, in the position in which the apparatus main unit communicates with the storage element, the storage element is positioned in a region in which it is furthest removed from a heat-generating member within the apparatus main unit.

41. An image forming apparatus according to claim 39, wherein the external cover is provided with a vent hole near the position in which the apparatus main unit communicates with the storage element.

42. An image forming apparatus according to claim 39, further comprising, in the position in which the apparatus main unit communicates with the storage element, a ventilation means that blows air onto a member surface near the storage element by forcibly generating an airflow near the storage element.

43. An image forming apparatus according to claim 42, further comprising an exhaust duct that is provided with a drainage opening near the storage element at the position in which the apparatus main unit communicates with the storage element and that is for sucking air inside the apparatus main unit and exhausting it out of the apparatus;

wherein the ventilation means forcibly generates the airflow near the storage element by sucking air into the exhaust duct.

44. An image forming apparatus according to claim 39, wherein antennas are provided at positions where the developing cartridge side faces the apparatus main unit side, allowing the storage element and the apparatus main unit to communicate in a noncontacting manner, and the antenna on the developing cartridge side is adjacent to the storage element.

45. An image forming apparatus comprising according to claim 39, wherein:

the image forming apparatus main unit includes an antenna; and the developing device includes: an element that, when the developing device is mounted to the image forming apparatus main unit, faces the antenna across a gap, and is capable of wireless communication with the antenna; and a metal plate, at least a portion of which is positioned to the outer side of the gap and at a position corresponding to the gap in a direction from the element toward the antenna, when the developing device is mounted to the image forming apparatus main unit and the element performs wireless communication with the antenna.

46. An image forming apparatus according to claim 45, wherein the image forming apparatus main unit includes a rotatable rotating member including a mounting and dismounting section to which the developing device can be mounted and dismounted;

wherein the element performs wireless communication with the antenna, when the developing device has been rotated through rotation of the rotating member with the developing device mounted in the mounting and dismounting section, so that the element provided on the developing device faces the antenna across the gap.

47. An image forming apparatus according to claim 45, wherein the developing device includes:

a developer bearing roller for bearing a developer, that is provided extending along a longitudinal direction of the developing device;

a first driving wheel for driving the developer bearing roller, that is provided at a one end portion of the developer bearing roller; and a second driving wheel that receives a driving force from the image forming apparatus main unit when the developing device is mounted to the image forming apparatus main unit, and that is for transmitting the driving force to the first driving wheel;

wherein the metal plate is a positioning member for positioning the first driving wheel and the second driving wheel.

48. An image forming apparatus according to claim 47, wherein the element is provided at an end portion, in a longitudinal direction of the developing device, at which the first driving wheel is positioned.

49. An image forming apparatus according to claim 45, wherein the image forming apparatus main unit includes a motor; and wherein the metal plate is positioned between the motor and the gap when the element communicates wirelessly with the antenna.

50. An image forming apparatus according to claim 45, wherein the image forming apparatus main unit includes:

a main unit-side metal plate at least a portion of which is positioned to an outer side of the gap and at a position corresponding to the gap in a direction from the element toward the antenna, when the element communicates wirelessly with the antenna.

51. An image forming apparatus according to claim 38, further comprising:

a developing cartridge for developing the latent image by selectively adhering a toner to the latent image on a surface of the bearing member;

a developing rotary unit provided in the apparatus main unit, that accommodates a plurality of the developing cartridges that can be inserted and removed around a rotation shaft, and lets one of the developing cartridges oppose the surface of the bearing member by rotating around the rotation shaft;

a duct having a suction opening for sucking a toner that drifts in a vicinity of a developing position at which the developing cartridge adheres a toner to the latent image on the surface of the developing member, by providing suction near the developing position; and a storage element capable of communication with the apparatus main unit, that stores and holds information relating to the developing cartridge, the storage element being provided on an outer surface of the developing cartridge to the outside of a region facing a part of the duct where the suction opening is formed, when the developing cartridge is rotated and passes the vicinity of the suction opening.

52. An image forming apparatus according to claim 51, wherein the storage element and the apparatus main unit include communication sections for communicating;

wherein antennas are placed at positions where the developing cartridge side faces the apparatus main unit side, so that the communication sections have a function of performing communication in a noncontacting manner, and the antenna on the developing cartridge side is adjacent to the apparatus element.

53. An image forming apparatus according to claim 38, further comprising:

a developing cartridge for developing the latent image by selectively adhering toner to the latent image on a surface of the bearing member;

a developing rotary unit provided in an apparatus main unit, that accommodates a plurality of the developing cartridges that can be inserted and removed around a rotation shaft, and lets one of the developing cartridges oppose the surface of the bearing member by rotating around the rotation shaft;

a duct having a suction opening for sucking a toner that drifts in a vicinity of a developing position at which the developing cartridge adheres a toner to the latent image on the surface of the developing member, by providing suction near the developing position;

a storage element for storing and holding information relating to the developing cartridge; and communication sections for letting the apparatus main unit and the storage element communicate with each other, the communication sections being placed to the outside, in a direction along the rotation shaft, of a part of the duct where the suction opening is formed.

54. An image forming apparatus according to claim 53, wherein the communication sections include a developing cartridge-side antenna and an apparatus main unit-side antenna for letting the storage element and the apparatus main unit communicate with each other, the developing cartridge-side antenna and the apparatus main unit-side antenna facing each other outside, in a direction along the rotation shaft, of a part of the duct where the suction opening is formed, so that the storage element and the apparatus main unit perform communication in a noncontacting manner.

55. An image forming apparatus according to claim 38 that forms an image by transferring a toner image on a bearing member surface onto a recording medium and fixing the toner image, the image forming apparatus comprising:

the bearing member that bears a toner image made by forming the latent image based on image data on a surface and developing that latent image;

an exposing unit that forms the latent image based on the image data by selectively scanning and exposing the bearing member surface;

a developing cartridge that develops the latent image by selectively adhering toner to the latent image on the bearing member surface;

a developing rotary unit that accommodates a plurality of the developing cartridges that can be inserted and removed around a rotation shaft and lets one of the developing cartridges face the bearing member surface by rotating around the rotation shaft; and a controller that controls the driving of various sections of the apparatus, including the bearing member and the developing cartridge, based on received image data and various kinds of information;

wherein a storage element storing and holding information relating to the developing cartridge is placed on an outer surface of the developing cartridge, and a communication means is provided that performs communication by reading out at least information inside the storage element as information to be processed by the controller; and wherein the storage element is arranged outside a position facing a heat-generating member when the rotation of the developing cartridge is stopped.

56. An image forming apparatus according to claim 55, wherein the heat-generating member is a scanner motor that rotates, at high speed, within the exposing unit in order to scan laser light that exposes the bearing member surface, or a driver section that controls the driving of the scanner motor.

57. An image forming apparatus according to claim 55, wherein a communication section has a function of performing communication in a noncontacting manner, with antennas being placed at positions where the developing cartridge side faces the apparatus main unit side, and the antenna on the developing cartridge side is adjacent to the storage element.

58. An image forming apparatus according to claim 55, wherein the storage element is arranged at a position that is removed, in the rotation direction, from a position where the heat-generating member faces an outer surface of the developing cartridge whose rotation is stopped.

59. An image forming apparatus according to claim 58, wherein the developing cartridge includes a developing roller that adheres contained toner onto the bearing member surface; and wherein also the developing roller is arranged at a position that is removed, in the rotation direction, from a position where the heat-generating member faces an outer surface of the developing cartridge whose rotation is stopped.

60. An image forming apparatus according to claim 55, wherein the storage element is arranged at a position that is removed, in an axial direction of the rotation shaft, from a position where the heat-generating member faces an outer surface of the developing cartridge whose rotation is stopped.

61. An image forming apparatus according to claim 38 that forms an image by transferring a toner image on a bearing member surface onto a recording medium and fixing the toner image, the image forming apparatus comprising: the bearing member that bears a toner image made by forming the latent image based on image data on a surface and developing that latent image; a developing cartridge that develops the latent image by selectively adhering toner to the latent image on the bearing member surface; a developing rotary unit that accommodates a plurality of the developing cartridges that can be inserted or removed around a rotation shaft and lets one of the developing cartridges face the bearing member surface by rotating around the rotation shaft; a controller that controls the driving of various sections of the apparatus, including the bearing member and the developing cartridge, based on received image data and various kinds of information;

the image forming apparatus further including:

a storage element that stores and holds information relating to the developing cartridge, placed on an outer surface of the developing cartridge, and a communication means that has a function of performing communication in a noncontacting manner, with antennas being placed at positions where the developing cartridge side can face the apparatus main unit side, and that performs communication in a noncontacting manner by reading out at least information inside the storage element as information processed by the controller;

wherein a blocking member is placed between a high-voltage member, which takes on a voltage equal or greater than that which is necessary for the adherence and transfer of a toner, and a rotation trajectory of the storage element on the outer surface of the developing cartridge, the blocking member limiting the influence that noise caused by the high-voltage member has on the storage element.

62. An image forming apparatus according to claim 61, wherein the storage element is placed on the outer surface of the developing cartridge, adjacent to the developing cartridge-side antenna.

63. An image forming apparatus according to claim 61, wherein the high-voltage member includes either one or both of a voltage applying member, which charges a contacting member with a high voltage, or that charged member.

64. An image forming apparatus according to claim 63, wherein the charged member is the bearing member bearing the toner image obtained by developing the latent image, and the voltage applying member is a member charging the bearing member surface to a potential at which the latent image is formed and toner is adhered.

65. An image forming apparatus according to claim 63, provided with an intermediate image transfer member that, after the toner image on the bearing member surface has been transferred to it by primary image transfer, performs secondary image transfer of the toner image onto a recording medium;

wherein the charged member is the intermediate image transfer member, and the voltage applying member is a member that charges the intermediate image transfer member to a potential at which the toner image is borne after receiving it from the bearing member.

66. An image forming apparatus according to claim 61, wherein the blocking member is placed at a position where the high-voltage member faces the antenna or the storage element.

67. An image forming apparatus according to claim 38, wherein the developing device includes the following (a) and (b):

(a) a communication unit including:

a base;

an antenna supported by the base; and an element supported by the base, the element being for communication via the antenna; and (b) a housing by which the communication unit, with the element being positioned on an upstream side of the base, is supported, with respect to a mounting direction in which it is mounted to the image forming apparatus main unit.

68. An image forming apparatus according to claim 38, further comprising:

(a) a mounting section that is to be mounted with a cartridge provided with an element unit having a first antenna and an element;

(b) an antenna unit including a second antenna for communicating with the first antenna, the antenna unit being arranged at a position that is spaced by a predetermined distance L from the first antenna of the cartridge mounted into the mounting section; and (c) a communication region in which no conductive members are present besides the element unit, the antenna unit and a wire connected to the antenna unit, within a distance of L from the first antenna and within a distance of L from the second antenna.

69. An image forming apparatus according to claim 68, comprising a holder made of resin, the holder including a flexible tongue;

wherein the antenna unit is fixed via the holder by engaging the base supporting the second antenna with the tongue.

70. An image forming apparatus according to claim 68, comprising a metal shielding member outside of the communication region.

71. An image forming apparatus according to claim 70, wherein the shielding member is an apparatus shielding member for blocking the image forming apparatus with respect to the outside.

72. An image forming apparatus according to claim 70, comprising a power source and a power source shielding member covering the power source;

wherein the shield is used as the power source shielding member.

73. An image forming apparatus according to claim 38, wherein the developing device includes:

a developing container containing a developer including a magnetic material;

a container-side antenna provided at the developing container, that is for communicating in a contactless manner, when mounted to an apparatus main unit, with a main unit-side antenna of the apparatus main unit; and an intrusion prevention section for preventing intrusion of the developer into a predetermined region between the container-side antenna and the developer.

74. An image forming apparatus according to claim 38, further comprising:

(a) a mounting section that is to be mounted with a cartridge so that it can be mounted and dismounted;

(b) a duct serving as an air passageway within an apparatus including the mounting section; and (c) a second antenna provided to the duct, the second antenna being for communicating with an element provided with the cartridge, via a first antenna provided to the cartridge.

75. An image forming apparatus according to claim 74, wherein the second antenna is provided inside the duct.

76. An image forming apparatus according to claim 74, wherein the second antenna is provided at an inner wall of the duct.

77. An image forming apparatus according to claim 74, wherein the second antenna is provided at an outer wall of the duct.

78. An image forming apparatus according to claim 74, wherein upstream, with respect to the direction of the air flow, from an antenna placement part where the second antenna is arranged, the duct has a part with a cross-sectional area that is larger than a cross-sectional area in a direction intersecting with the direction of the air flow at the antenna placement location.

79. An image forming apparatus according to claim 74, wherein the duct is made of resin.

80. An image forming apparatus according to claim 74, wherein the duct is an exhaust duct for exhausting air inside the apparatus to outside of the apparatus.

81. An image forming apparatus according to claim 74, wherein a filter is provided upstream of the second antenna, with respect to the direction of the air flow inside the duct.

82. An image forming apparatus according to claim 81, wherein a latent image borne on the image bearing member is developed using a developer; and the filter is provided in order to scavenge the developer.

83. An image forming apparatus according to claim 82, wherein the developer is a toner.

84. An image forming apparatus according to claim 74, comprising an antenna driving circuit connected to the second antenna, that is for achieving communication between the first antenna and the second antenna;

wherein the antenna driving circuit is provided at the duct.

85. An image forming apparatus according to claim 38, wherein the developing unit includes: a memory unit including a memory; and a label on which information relating to the developing unit is written, and that has been stuck to the developing unit so as to cover the memory unit.

86. An image forming system comprising:

a computer; and an image forming apparatus that can be connected to the computer, the image forming apparatus including: an image bearing member for bearing a latent image; and a developing device that can be mounted to and dismounted from a mounting and dismounting section provided in an image forming apparatus main unit, the developing device including: a developing device main unit; a positioning member for positioning the developing device main unit with respect to the mounting and dismounting section by engaging the mounting and dismounting section when the developing device is mounted to the mounting and dismounting section, the positioning member being fixed on a one end side in a longitudinal direction of the developing device main unit; a coupling member that is to be coupled to the mounting and dismounting section when the developing device is mounted to the mounting and dismounting section, the coupling member being attached to the other end side in a longitudinal direction of the developing device main unit in such a manner that its relative position to the developing device main unit can be changed; and an element capable of communication in a noncontacting manner with the image forming apparatus main unit side when the developing device is mounted to the mounting and dismounting section, the element being provided at the one end side in the longitudinal direction of the developing device main unit, the developing device being for developing a latent image borne on the image bearing member when being mounted to the mounting and dismounting section.

87. An image forming system according to claim 86, wherein the developing device includes the following (a) and (b):

(a) a communication unit including:

a base;

an antenna supported by the base; and an element supported by the base, the element being for communication via the antenna; and (b) a housing by which the communication unit, with the element being positioned on an upstream side of the base, is supported, with respect to a mounting direction in which it is mounted to the image forming apparatus main unit.

88. An image forming system according to claim 86, wherein the image forming apparatus includes the following (a) to (i):

(a) a mounting section that is to be mounted with a cartridge provided with an element unit including a first antenna and an element;

(b) an antenna unit having a second antenna for communicating with the first antenna, the antenna unit being arranged at a position that is spaced by a predetermined distance L from the first antenna of the cartridge mounted into the mounting section;

(c) a communication region in which no conductive member is present besides the element unit, the antenna unit and a wire connected to the antenna unit, within a distance of L from the first antenna and within a distance of L from the second antenna;

(d) a holder made of resin, the holder including a flexible tongue, wherein the antenna unit is fixed via the holder by engaging the base supporting the second antenna with the tongue; and (e) a metal shielding member outside of the communication region;

(f) the shielding member being an apparatus shielding member for blocking the image forming apparatus with respect to the outside;

(g) a power source and a power source shielding member covering the power source, the shield being used as the power source shielding member; and (h) wherein the cartridge is a developing device containing a developer for developing a latent image.

89. An image forming system according to claim 86, wherein the developing device includes:

a developing container containing a developer including a magnetic material;

a container-side antenna provided at the developing container, that is for communicating in a contactless manner, when mounted to an apparatus main unit, with a main unit-side antenna of the apparatus main unit; and an intrusion prevention section for preventing intrusion of the developer into a predetermined region between the container-side antenna and the developer.

90. An image forming system according to claim 86, wherein the image forming apparatus includes the following (a) to (c):

(a) a mounting section that is to be mounted with a cartridge so that it can be mounted and dismounted;

(b) a duct serving as an air passageway within an apparatus including the mounting section;

(c) a second antenna provided to the duct, the second antenna being for communicating with an element provided to the cartridge, via a first antenna provided to the cartridge.

91. An image forming system according to claim 86, wherein the developing unit includes: a memory unit including a memory; and a label on which information relating to the developing unit is written, and that has been stuck to the developing unit so as to cover the memory unit.

* * * * *